United States Patent [19]

Davidson, Jr.

[11] 4,411,194

[45] Oct. 25, 1983

[54] PRINTING PRESS

[75] Inventor: William W. Davidson, Jr., Port Washington, N.Y.

[73] Assignee: North Shore Precision Research Corporation, Ossining, N.Y.

[21] Appl. No.: 169,526

[22] Filed: Jul. 16, 1980

Related U.S. Application Data

[60] Division of Ser. No. 866,778, Jan. 3, 1978, Pat. No. 4,231,291, which is a division of Ser. No. 498,844, Aug. 19, 1974, Pat. No. 4,098,185, which is a division of Ser. No. 235,221, Mar. 16, 1972, Pat. No. 3,848,320, which is a continuation-in-part of Ser. No. 73,161, Sep. 17, 1970, abandoned, which is a continuation-in-part of Ser. No. 658,385, Aug. 4, 1967, abandoned.

[51] Int. Cl.[3] ..... B41F 13/00; B41F 21/00

[52] U.S. Cl. ..... 101/216; 101/234; 101/247

[58] Field of Search ..... 101/143, 144, 145, 216, 101/219, 136–142, 174, 175, 177, 183, 184, 185, 205–209, 216–219, 229, 232, 233–234; 74/568 R, 571 M, 568 T, 568 M; 271/258, 259

[56] References Cited

U.S. PATENT DOCUMENTS 2,800,808 7/1957 Cappelle et al. ..... 74/568 X 3,177,310 4/1965 Deeken ..... 74/568 X

*Primary Examiner*—J. Reed Fisher

*Attorney, Agent, or Firm*—Mason, Kolehmainen, Rathburn & Wyss

[57] ABSTRACT

The basic press structure includes a printing couple consisting of a lower printing cylinder, having a single work area, and a large printing cylinder, having an effective diameter which is a whole multiple, greater than one, of the effective diameter of the lower printing cylinder, and has a number (equal to the whole multiple) of work areas, in each of which one of a variety of the especially constructed removable and interchangeable segments may be mounted. One of a variety of different printing surfaces may be carried in each of the various work areas on the cylinders of the printing couple, in a wide range of combinations. The printing couple is mounted in a frame structure constructed so as to provide a plurality of module mounting positions, at each of which one of a variety of printing modules may be mounted in cooperative relationship with the large printing cylinder. The press includes feeder means on one side of the printing couple and delivery means on the other wide, and selectively controllable means are available for causing sheets to be fed to every revolution or to other than every revolution, of the lower printing cylinder, for causing a sheet to be carried through the bite of the printing couple, once or more than once, as it passes through the press and for causing the sheets to be delivered with a selected printing surface face-up.

10 Claims, 154 Drawing Figures

G-20
G-3021
GG-6
G-20
G-35
G-32
G-36
G-33
G-34

GG-3
G-13
13
24
G-13
G-15
G-14
GG
G-17
G-13
G-12

D-11
D-12
D-14
DD-3
D-19
D-16
D-15
D-20

FUNCTION NO. 1
2-R
BLACK
BLACK
OFFSET
BLACK
OFFSET
BLACK

FUNCTION NO. 4
2-R
BLACK
BLUE
RED
GREEN
OFFSET
GRN. BLK. BL. RED
OFFSET
GRN. BLK. BL. RED

FUNCTION NO. 8
2-R
BLACK
BLUE
RED
GREEN
OFFSET
GRN. BLK. BL. RED
OFFSET
GRN. BLK. BL. RED

FUNCTION NO. 13
2-R
BLACK
TRANSLUCENT
STOCK
MATCHING
BLACK
MIRROR IMAGE
BLACK
OFFSET-RIGHT-READING
IMAGE

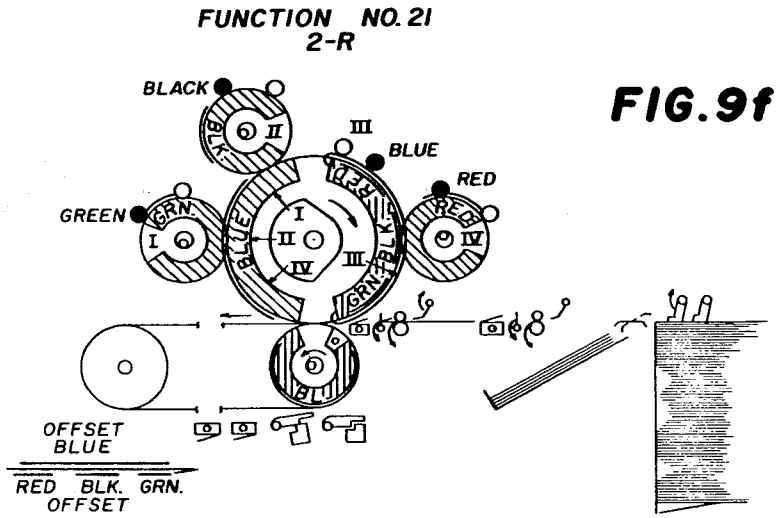
FIG. 9f
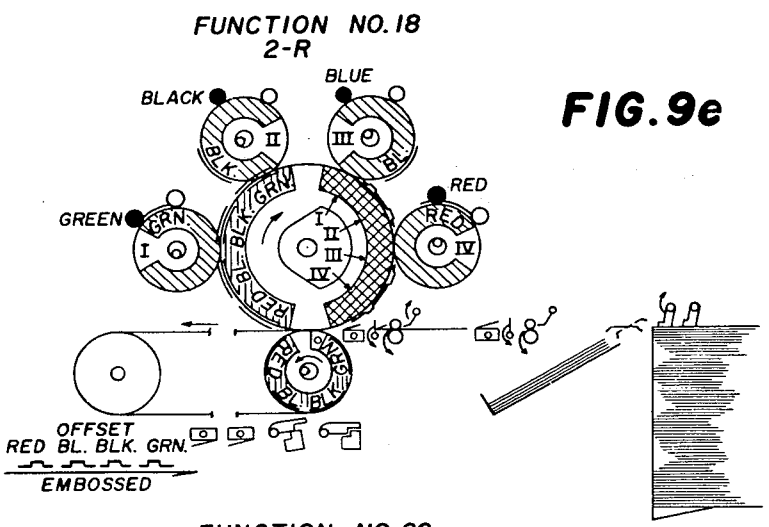
FIG. 9e
FIG. 9h
FIG. 9g

FUNCTION NO. 29
2-R

FUNCTION NO. 28
2-R

FUNCTION NO. 32
2-R

FUNCTION NO. 30
2-R

FUNCTION NO. 52
2-R
BLUE
RED
BLACK
GREEN
OFFSET
BL. RED
GRN.
OFFSET
GRN. BLK. BL. RED

FUNCTION NO. 46
2-R
BLUE
RED
BLACK
GREEN
OFFSET
GRN. RED BL.
OFFSET
GRN. BLK. BL.

OFFSET
LIGHT BLUE
GREEN RED
OFFSET
OFFSET
BLUE
BLACK RED
OFFSET
FUNCTION NO. 81
3-R
BLUE
RED
BLACK
GREEN

FUNCTION NO. 45
3-R
BLUE
RED
BLACK
GREEN
OFFSET
GREEN BLUE
BLACK RED
OFFSET

FUNCTION NO. 103
3-R
BLUE
RED
BLACK
GREEN
OFFSET
GREEN
BLUE
RED
BLACK

FUNCTION NO. 129
3-R
OFFSET
BLUE
BLACK
GREEN
OFFSET
LETTERPRESS
RED

FUNCTION NO. 86
3-R
LETTERPRESS
LETTERPRESS
OFFSET
GREEN
BLUE
RED
BLACK

FUNCTION NO. 105
3-R
OFFSET
GREEN
OFFSET
BLUE
OFFSET
RED
BLACK

A-21
62
A-11
13
15
37
F-41
36
61
A-47
14
60
A-20
42
22
35
32
34
51
33
41
F-41
31
H-14
40
23
24
46
23
53
54
H-21
21
44
43
H-22
45
20
H-20
H-26
65
H-16
H-25
64
H-30
H-15
H-24
H-23
H-13
H-11
63
H-31
H-32
H-33
H-34
12
13

A-21
II
A-11
A-20
15
62
III
A-40
61
A-48
41
14
60
16
40
I
IV
22
32
13
17
23
24
41
H-14
54
43
21
33
53
20
H-21
H-20
45
H-16
H22
H-43
H-35
49
H-36
H-40
H-41
H-42
H-30
H-15
H-23
H-11
H-13
H-31
12
H-32

I
II
III
IV
V
VI
A-21a
A-60a
A-62a
A-61a
A-53a
A-54a
A-56a
A-50a
A-20a
A-26a
A-32a
A-23a
A-31a
A-22a
A-11a
A-45a
A-44a
A-52a
A-21b
A-60b
A-56b
A-54b
A-55b
A-53b
A-50b
A-46b
A-20b
A-26b
A-44b
A-21c
A-60c
A-56c
A-54c
A-55c
A-53c
A-50c
A-46c
A-45c
A-44c
A-20c
A-26c
A-21d
A-60d
A-62d
A-63d
A-64d
A-65d
A-50d
A-46d
A-44d
A-20d
A-26d
A-32d
A-23d
A-22d
A-31d
A-11d
A-51d
A-52d
A-54d
A-56d
A-53d
A-55d
A-32b
A-23b
A-31b
A-22b
A-11b
A-51b
A-45b
A-44b
A-26b
A-32c
A-23c
A-31c
A-22c
A-11c
A-51c
A-45c
A-44c
A-26c
A-20c
A-32b
A-23b
A-31b
A-22b
A-11b
A-51b
A-45b
A-44b
A-26b
A-20b
A-32a
A-23a
A-31a
A-22a
A-11a
A-45a
A-44a
A-26a
A-20a
A-32d
A-23d
A-31d
A-22d
A-11d
A-51d
A-45d
A-44d
A-26d
A-20d

FIG. 20
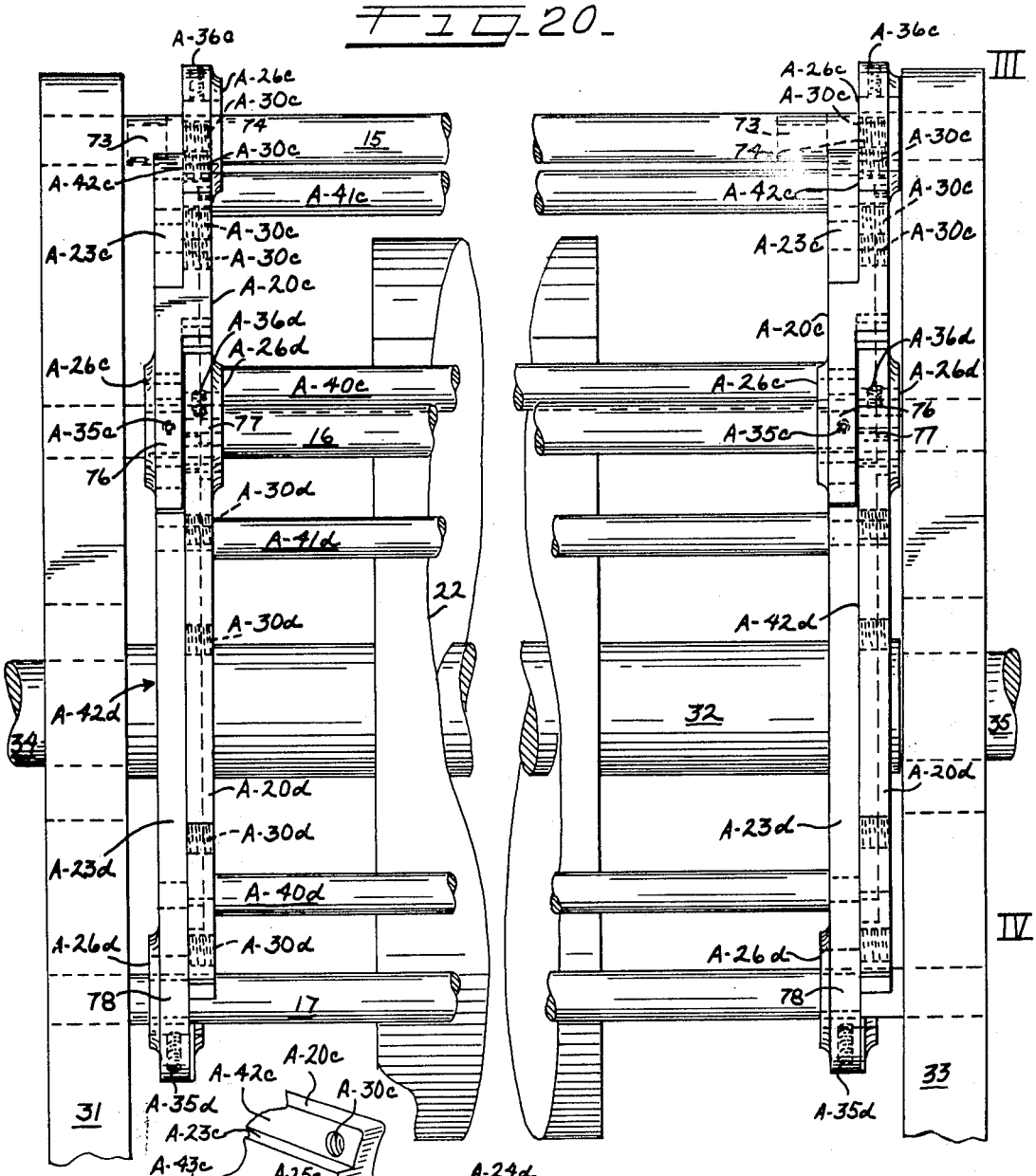
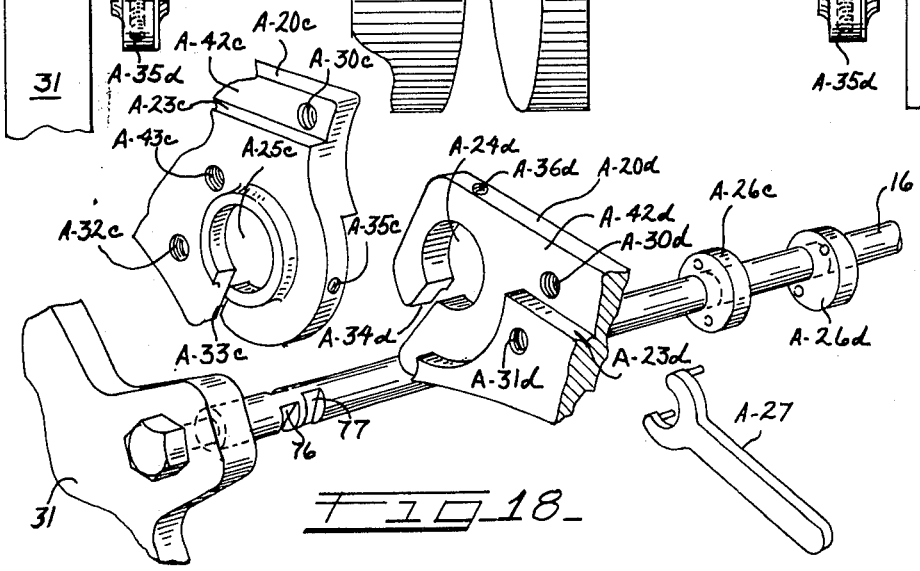
FIG. 18

SEQUENCE OF ACTION OF STOP FINGERS, UPPER & LOWER FEED ROLLERS, & GRIPPERS. ILLUSTRATED IN REFERENCE TO ROTATION OF LOWER CYLINDER. 0° IS AT POINT OF TANGENCY BETWEEN LARGE AND LOWER CYLINDERS. ROTATION OF LOWER CYL. CLOCKWISE. "DEGREES" SHOWN REFER TO THE POSITION OF THE CYLINDER STOPS AT THE LEADING EDGE OF THE LOWER CYLINDER THROUGH ONE REVOLUTION.

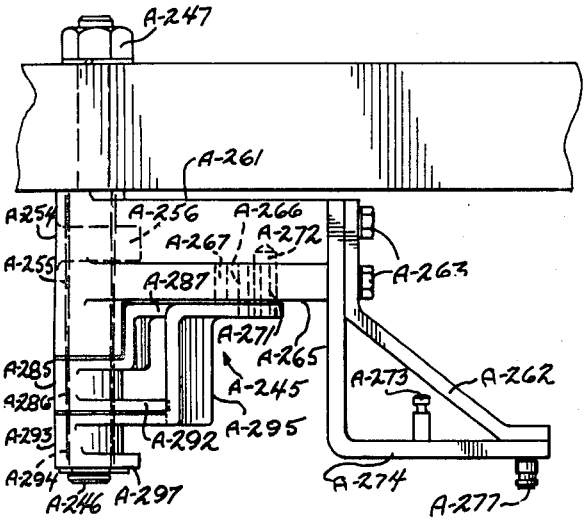
FIG-50-
FIG-51-
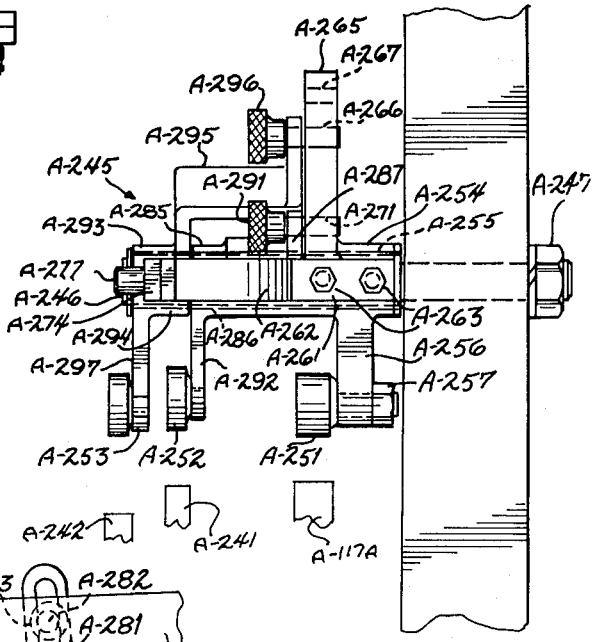
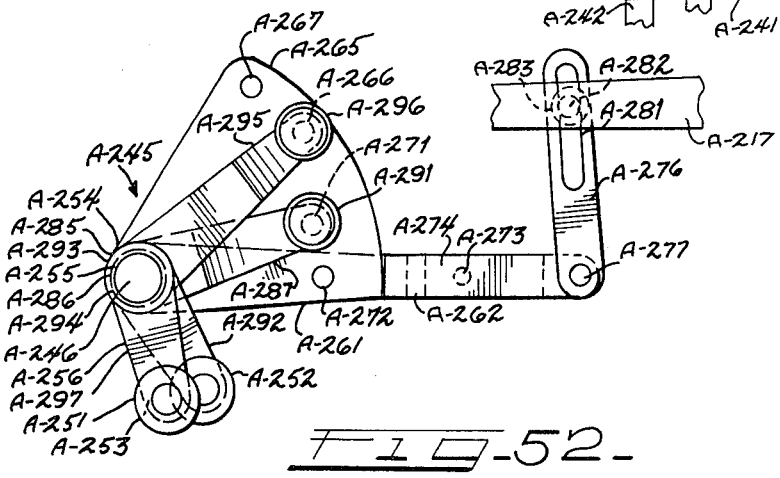
FIG-52-

KK-4 THRU KK-8
II
III
IV
I
A-21
A-11
A-3314
A-3312
A-3194
A-3186
A-3313
A-3201
A-3232
A-3231
A-3315
A-3212
A-3213
A-3215
A-3184
A-3045
A-3165
A-3171
A-172
A-182
A-183
A-181
A-174
A-173
A-3161
A-3267
A-3217
A-224
A-3296
A-221
A-3276
A-3268
A-3274
A-3271
A-3317
A-3244
A-3245
A-3266
A-3273
A-3291
A-3275
A-3223
A-3322
A-223
A-3304
A-3240
A-3253
A-3242
A-3326
A-3225
A-3256
A-3253
A-3202
A-3083
A-3324
A-3311
3035
A-3323
A-3241
A-3096
A-204
A-3321
A-3316
A-3243
A-3233
A-3318
3022
20
21
44
3033

A-3131-B
A-3142-B
A-3117-B
A-3131
A-3151
A-3113
A-3136
A-3135
A-3142
A-3137
A-3137-A
A-3136-A
A-3117
A-3151
A-3135-B
A-3136-B
A-3117-A
A-3135-A
A-3131-A
A-3142-A
A-3125-A
A-3144-A
A-3127-A
A-3147
A-3325
A-3152
A-3072-A
A-3132
A-3133
A-3131
A-3125
A-3147-B
A-3127-B
A-3144-B
A-3147-A
A-3133-A
A-3325-A
A-3132-A
A-3072-B
A-3133-B
A-3132-B
A-3131-B
A-3125-B
A-3117-B
A-3072
A-3113
A-3132-A
A-3145-A
A-3131-A
A-3315-A
A-3325-A
A-3147-A
A-3133-A
A-3133-B
A-3125-A
A-3146-A
A-3143-A

FIG-76-
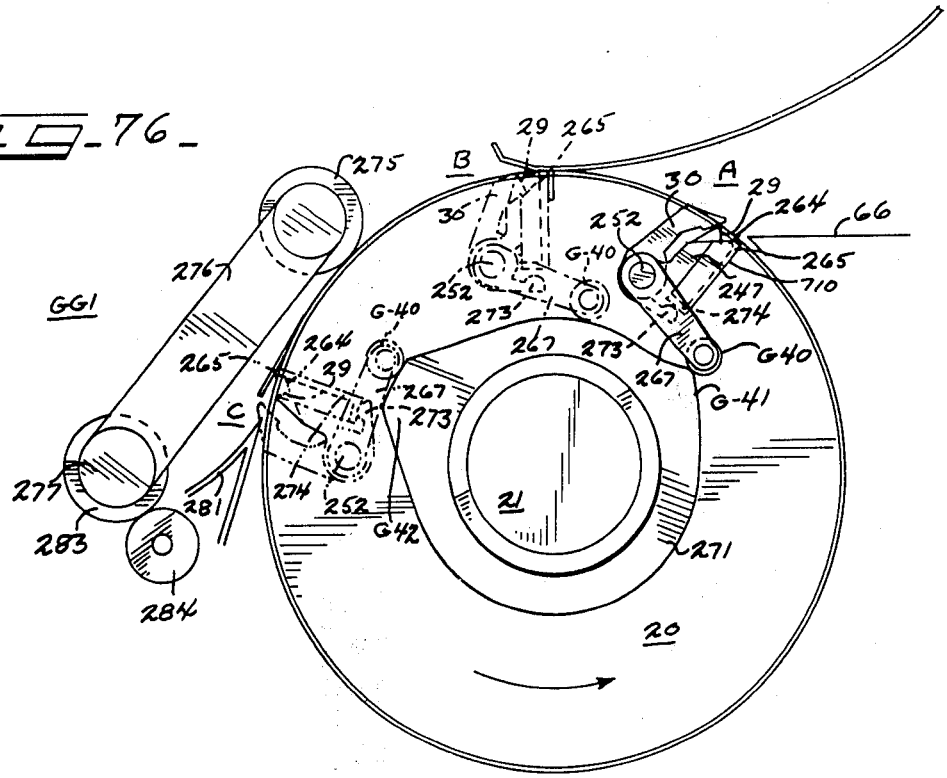
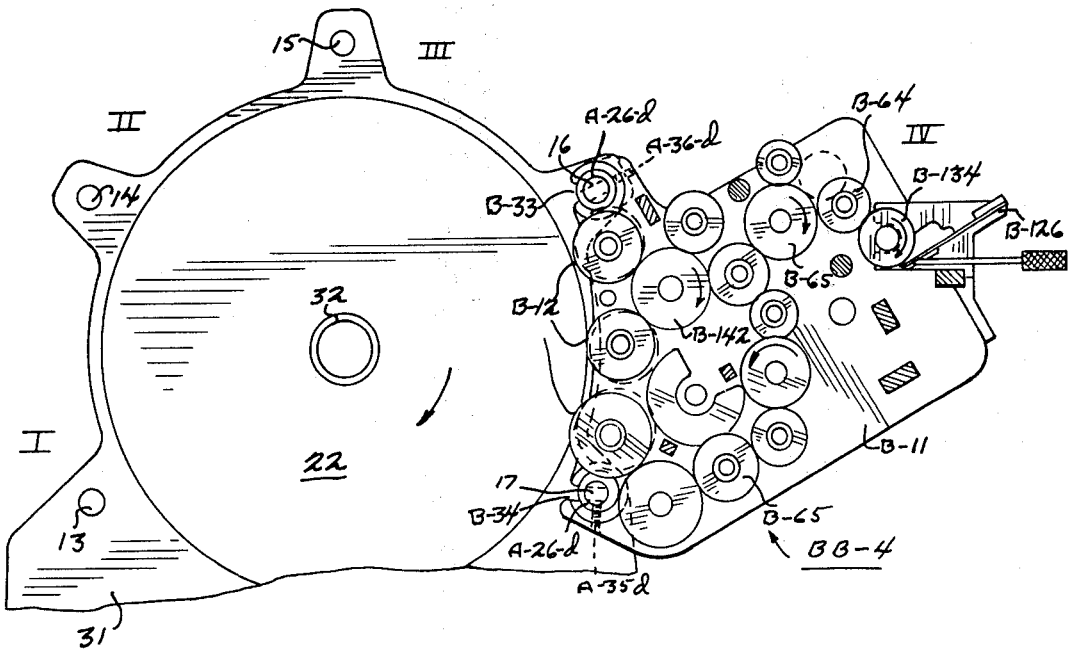
FIG-74-

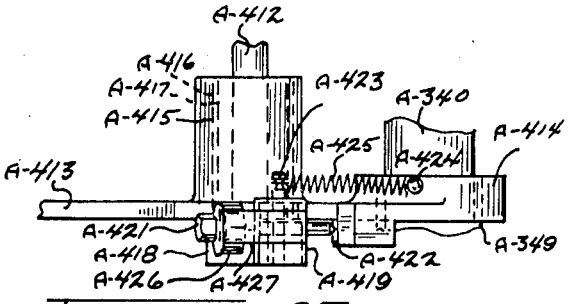
FIG. 87
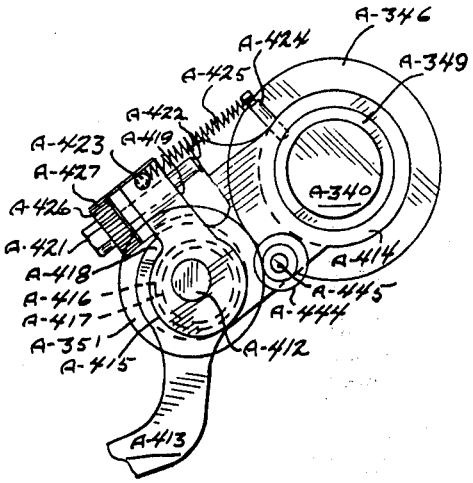
FIG. 86
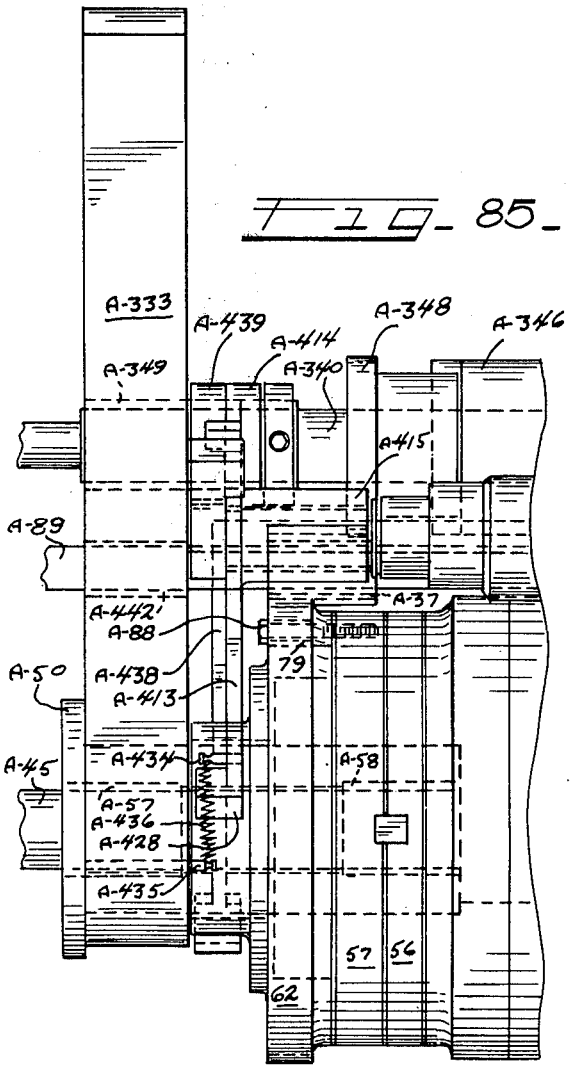
FIG. 85
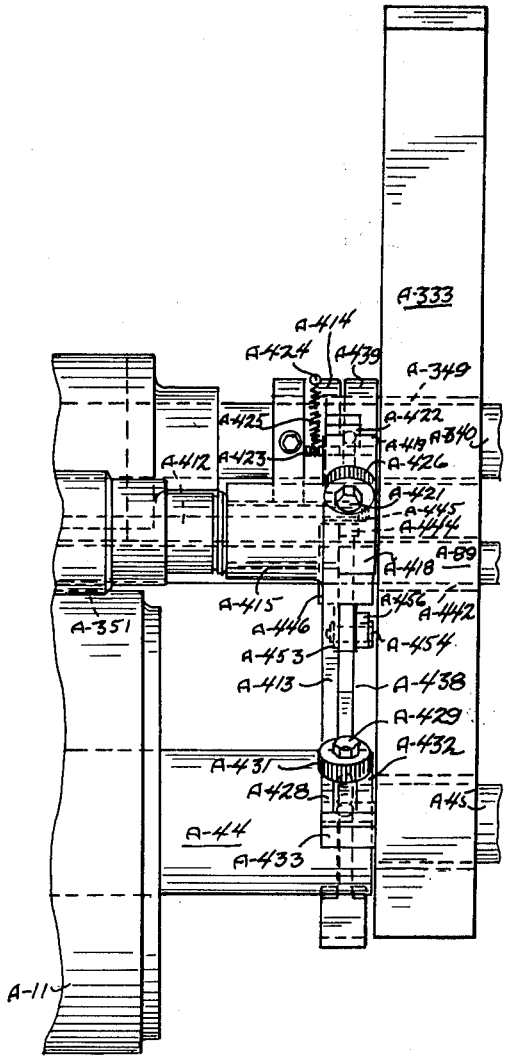

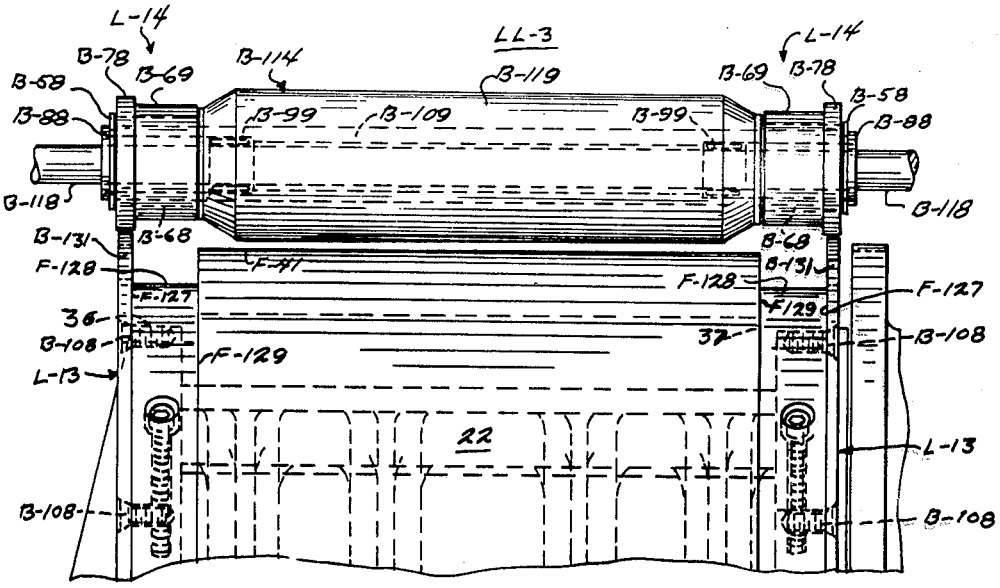
FIG. 111
FIG. 109
FIG. 110
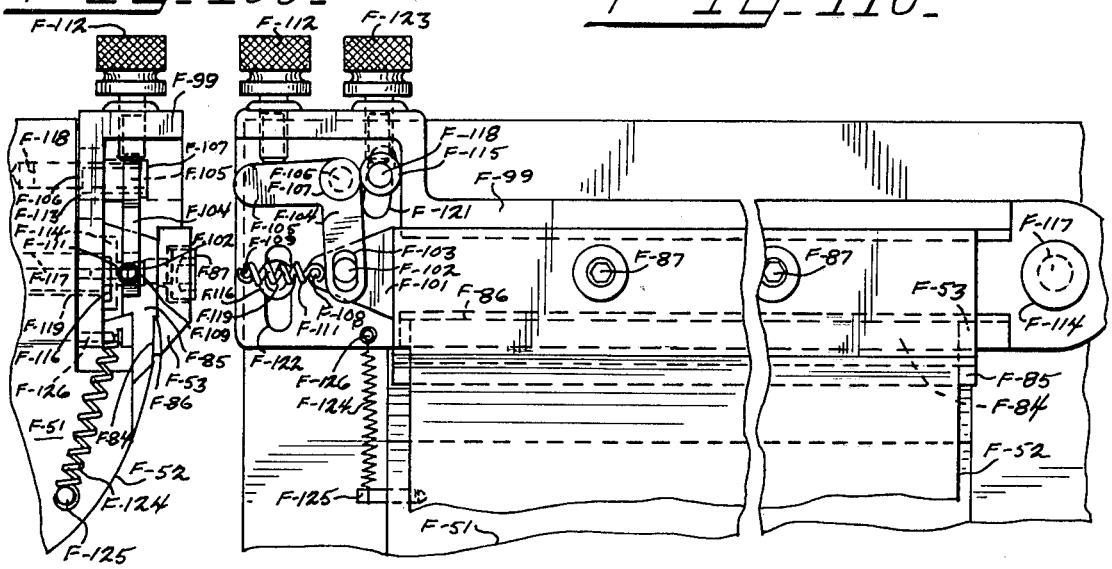

15
B-131
F-129
B-114
B-69
B-58
B-88
B-119
B-78
B-118
B-68
LL-3
F-128
B-108
L-14
36
L-13
F-41
F-127
22
16
31
32
34
III
III

L-11
B-68
B-69
B-78
LL-2
B-114
B-119
B-78
B-69
L-11
B-58
B-58
B-88
B-99
B-109
B-99
B-88
B-118
B-118
B-68
B-132
B-132
F-128
F-41
F-128
B-108
B-108
36
F-129
37
F-127
F-127
L-12
F-129
L-12
22
B-108
B-108

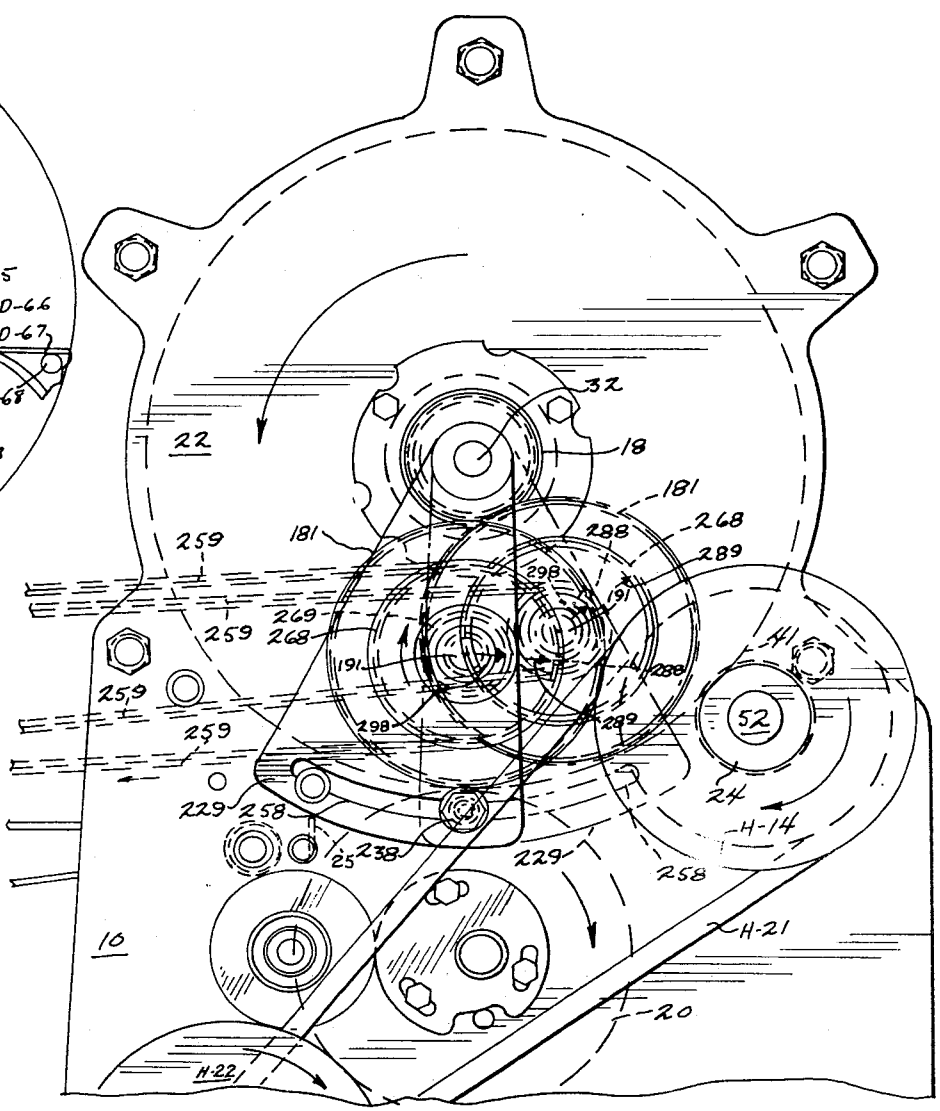
FIG. 121A.
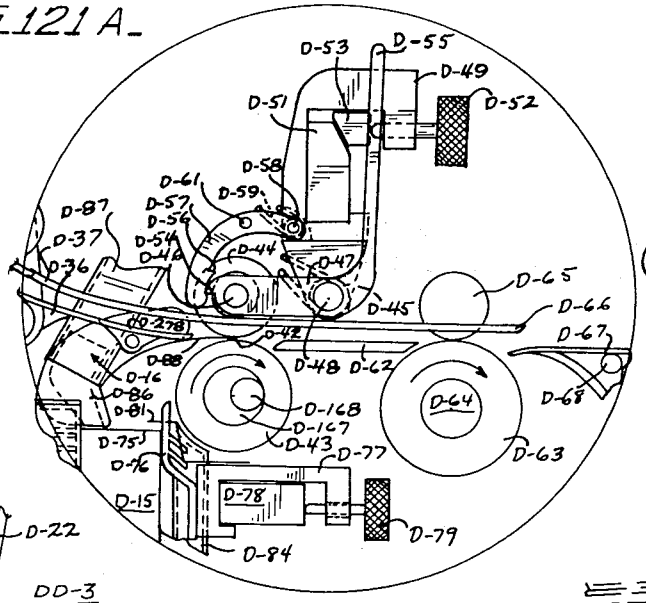
FIG. 121.
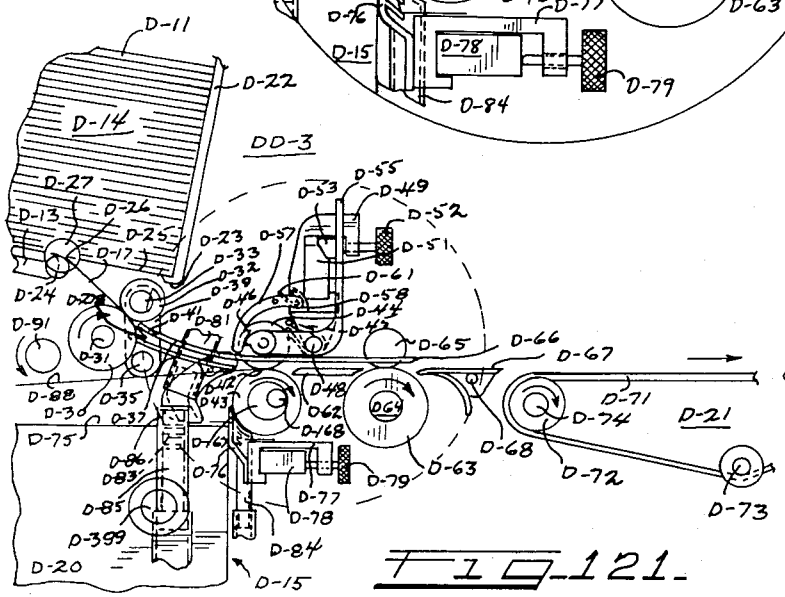

SEQUENCE OF FEEDER OPERATIONS FOR "PILE" AND "BOTTOM" FEEDERS IN COMBINATION

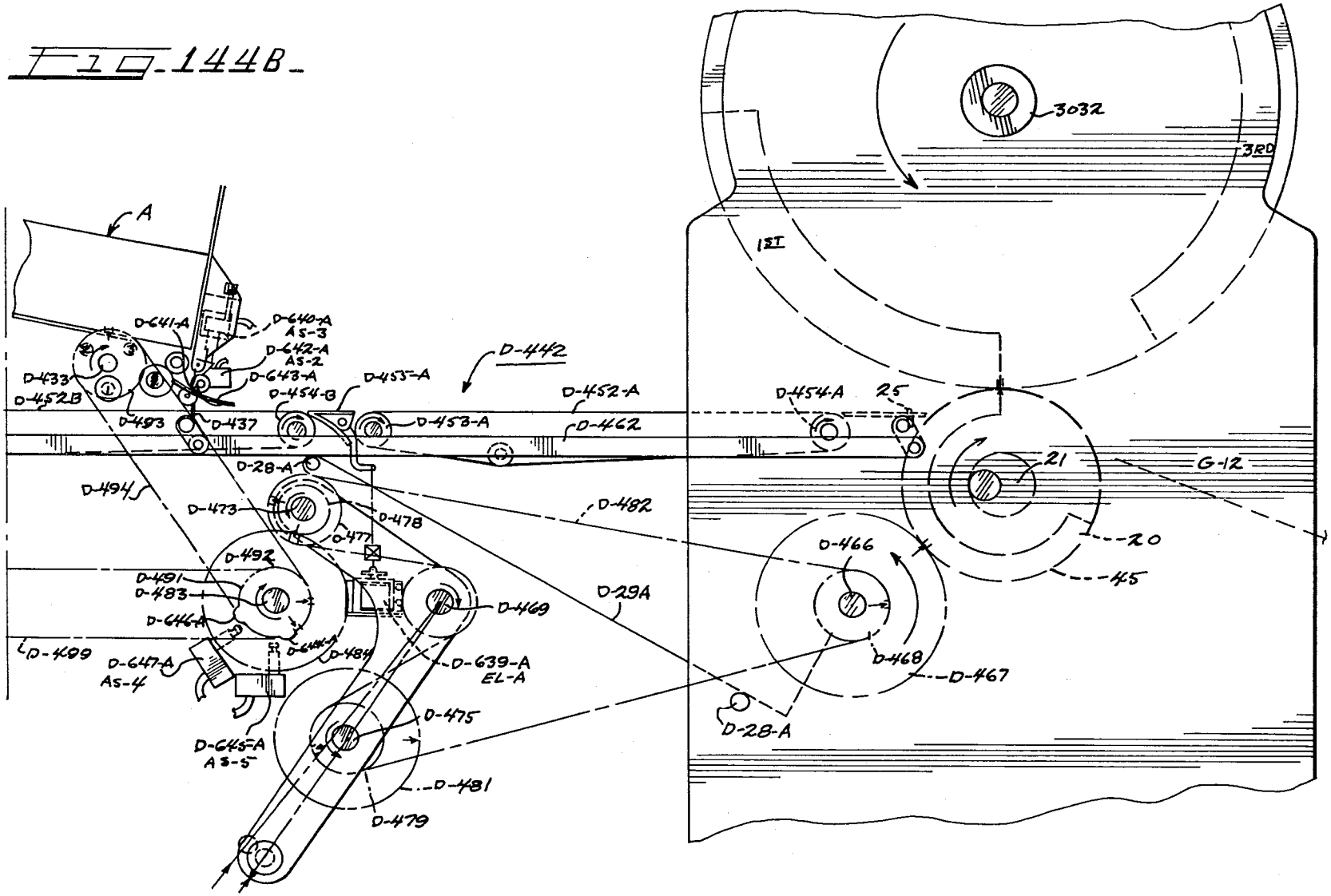
FIG-1474B-

PRINTING PRESS

This application is a division of my copending application Ser. No. 866,778, filed Jan. 3, 1978, now matured into U.S. Pat. No. 4,231,291 granted Nov. 4, 1980, which is a division of my earlier application Ser. No. 498,844, filed Aug. 19, 1974, now matured into U.S. Pat. No. 4,098,185, granted July 4, 1978, which is a division of my application Ser. No. 235,221, filed Mar. 16, 1972, now matured into U.S. Pat. No. 3,848,320, granted Nov. 19, 1974, which latter application was a continuation-in-part of my application Ser. No. 73,161 filed Sept. 17, 1970, now abandoned, which latter application was a continuation-in-part of my application. Ser. No. 658,385, filed Aug. 4, 1967, now abandoned.

This invention relates to a multi-purpose, rotary printing apparatus which has a high degree of selectiveness to meet an extremely wide range of printing and related needs at high levels of productivity, and to the method of manufacturing and assembling various configurations of said press from especially constructed standardized components.

The press of this invention is particularly well adapted to meet the requirements of both commercial and "in plant" printing establishments in the production of a wide range of printing functions and combinations of functions, where the quantities fall within what are commonly referred to as "short" to "medium" length runs, i.e., the production of anywhere from approximately 100 to 250,000 copies.

The printing apparatuses presently commercially available and generally used in meeting these printing requirements are, for the most part, small, sheet-fed offset presses designed basically to print a single image, in a single color, on one side of a sheet, for each pass of a sheet through the press.

Attachments are available for some of these presses which make it possible to print two non-overlapping colors on a sheet in a single pass through the press. For others, attachments are available which provide for the production of simultaneous two-sided printing. Attachments which will do certain auxiliary operations such as imprinting and numbering, in a limited way, are available for some. Other such presses are available which can be used to do either offset printing or letterpress printing, but not the two in combination.

In some cases, two such presses are used in tandem in order to print two images, either on the same side of a sheet or on opposite sides of a sheet. However, such tandem units are more expensive initially and difficulties are commonly encountered in transferring and re-registering the sheets from one printing head to the other; and these difficulties are often compounded by the fact that the ink applied by the first printing head is still wet as a sheet passes on through the press, and may be smeared by the devices that carry the sheets from one printing head to the other, or may cause ghosting as the sheets pass through the second printing head.

A considerable percentage of the printing jobs produced on such small sheet-fed offset presses involve the printing of more than a single image on each sheet, either in diffent colors and/or on both sides of the sheet. These requirements are usually handled by passing each sheet through the press once for each image to be printed, which may necessitate passing the sheets through the press two, three, or four or more times. The proper handling of such work required not only multiple press runs, but also that the sheets be stored after each run until the ink has had time to dry, after which the next run must be scheduled and the sheets handled again and loaded once more into the feeder for the next press run. This process is repeated for as many times as required to complete the job. Considerable space and handling equipment is thus required for the storage and handling of the sheets between runs. Some sheets are apt to be spoiled on each press run; and the total spoilage that must be allowed for increases in proportion to the number of press runs required. In addition to the additional press time required for multiple press runs, the total elapsed time required for the completion of such a job is usually many, many times the total of the actual press time required.

Further, when rush jobs are encountered, the effort is often made to re-run the sheets before the ink from the previous run has had time to dry properly. This in turn creates additional problems in the effort (which is not always successful) to prevent the sheets from being spoiled through the smearing of the wet ink in the rehandling of the sheets, both on and off the press.

If collating operations are required, they are ordinarily handled separately as a subsequent operation.

A wide variety of press designs have been suggested to accomplish the consolidation of various printing functions so that they might be accomplished in a single pass through the press. The combinations of functions which any one of such press designs can accomplish is generally quite limited. The market for a press able to perform a given limited combination of functions is usually not broad enough to justify the investment which a manufacturer would have to incur to design, to tool, and to carry the required inventories, for the production of such a press. The number of potential purchasers who would have sufficient requirement for a particular limited combination of functions, to keep such a press fully occupied, would be relatively small. Other plants engaged in printing might require the same particular limited combination of printing functions, from time to time, but not have sufficient requirement to justify the purchase of a press which was limited to the performance of that particular limited combination of printing functions.

Prior art presses designed to print a number of different images on one or on both sides of a sheet in a single pass of the sheet through the press, may, in general, be used to print a lesser number of images, or a single image. However, while certain of such presses may be efficient and highly productive when used for the particular complete combination of printing functions for which they were designed, they are generally less productive and less efficient, when used for the performance of only a portion of the functions of which they are capable, than are other presses designed specifically to perform those simple, or less complex functions.

A variety of approaches to the handling of certain combinations of printing functions are disclosed by prior art patents which illustrate and/or describe a number of alternate constructions without disclosing how more than one of these embodiments might be made other than to treat each as a separate press, for each of which there would have to be sufficient market tojustify all the costs involved in making separate drawings and separate tooling, and in producing and carrying separate inventories, etc. There are other prior art patents that disclose a variety of attachments for use in adapting an existing press to perform a variety of functions, or combinations of functions, beyond those for which it was designed, but whose use, in addition to other limitations, involves dividing a cylinder, or cylinders, of the existing press into a greater number of work areas than originally provided, with a proportionate reduction in the size of each work area and, consequently, in the size image that may be printed.

Now, in accordance with this invention, the aforementioned difficulties are overcome by providing a group of unique standardized components, including parts, assemblies, modules, cylinders, removable and interchangeable segments and basic press frame structures, all of which are so constructed that they may be assembled with each other in a wide variety of combinations; so that a manufacturer, by tooling and inventorying these unique, standardized components may assemble from them a wide range of standardized configurations. Some are relatively simple configurations to perform single functions for which there is a broad requirement, and others are more complex configurations each adapted to produce a different broad range of printing functions, and/or combinations of printing functions, or printing and collating functions, for which a relatively broad market exists.

It is also practical to assemble, from these same unique standardized components, an extremely wide range of specialized configurations, to meet highly specialized requirements, for limited markets, provided only that these requirements are such as to justify the higher assembly costs involved in these more specialized configurations. This now becomes practical because these more specialized configurations, too, may be assembled from the same unique, standardized components already in inventory, without encountering the much higher costs that would otherwise be involved in designing and producing such specialized equipment were it not for the availability of such unique, standardized components.

Certain of these unique, standardized components are also constructed so that they may be added at a later time, when it may be desired to broaden the range of functions, or combinations of functions, which a particular press, made in accordance with the inventions disclosed herein, will perform. Others of these components are of such a nature that they may be interchanged by the user of the press, to perform different functions or combinations of functions at different times.

The manufacturer is able to offer such potential purchaser a configuration of the press almost ideally suited to his individual requirements, without his having to also purchase additional features for which he may have no present use, with obvious advantages to both the manufacturer and the purchaser of the equipment.

An important factor in making this practical is that throughout the press many simple individual parts and assemblies, which perform relatively simple functions, have been made so that they may also be used as a part of a more complex structure which performs a more complex function, while still retaining the ability to perform the original simple function as well. Thus, throughout the press the manufacturer need offer and the purchaser need buy only the simpler devices, if his requirements are met thereby; and yet these same components become the basic structure around which the more complex devices are assembled, by the addition of whatever other parts are required. The fact that this is the case throughout all the interrelated functional areas of the press, including the feeder and delivery, greatly enhances the practical usefulness of the wide variety of configurations which may be offered.

With the press of the invention disclosed herein and the various embodiments thereof, it is now possible to achieve a multiplicity of printing and related functions, and combinations of functions, which it has been impossible to achieve with prior art apparatus. The various printing functions which this novel press is capable of performing, in a single pass of the sheets through the press, may be divided into five basic categories of printing functions, with various different printing function in each category, making possible the accomplishment of at least 129 permutations, through combinations of various functions within these five basic categories.

The five basic categories of printing functions referred to above include:

1. Printing one, two, three or four images, which do not overlap each other, by offset (either wet or dry) on the same side of a sheet of paper in one, two, three of four colors;

2. Printing on both sides of a sheet simultaneously by offset (either wet or dry);

3. Printing two or three colors which overlap each other;

4. Printing or embossing from a raised image (this includes letterpress printing which in turn includes imprinting and numbering);

5. Concurrently printing and collating sets of either two or three pages, with the individual sheets of paper stock within each set being of either the same or different weight and/or color.

When a printing function, or combination of functions, is referred to as being "performed" by the press of this invention, this is intended to mean that the printing function, or combination of functions, is completed when the sheets are delivered into the delivery hopper, and each sheet makes only one pass through the press from the feeder to the delivery hopper.

While sheets may, of course, be passed through the press two or more times to complete multiple printing functions more complex than those described herein, it should be understood from the outset that the "performance" of the printing functions, and combinations of functions, described herein, does not necessitate the use of tandem presses nor the passage of paper stock through the press from the feeder to the delivery hopper more than once.

Rather, each single sheet of paper has its leading edge aligned once against one set of cylinder register stops, and is held firmly in this one position of alignment while it is printed, on one or both sides, in a total of one, two, three or four colors, before being stripped and delivered by the delivery means of the press. This virtually eliminates the need for multiple handlings of sheets; and no sheet need not be re-registered a multiplicity of times in the completion of any of the printing functions, or combinations of functions, described herein. As a conseqeunce, any of these printing functions, or combinations of functions, may be completed without the need to store or rehandle the sheets, or to reschedule the running of the paper stock, and spoilage is greatly reduced. The press time for many of the printing functions, or combinations of functions is also greatly reduced; and the elapsed time from the beginning to the completion of the job is reduced by an even greater amount. Smearing, ghosting and mis-registration are all but eliminated since each single sheet, upon which a printing function, or combination of functions, is performed, is fed only once to the register stops and register grippers of the press.

Briefly, for disclosure purposes, the invention entails at least two basic press configurations, each having a lower printing cylinder, which is the same in both basic configurations, and each having a large printing cylinder mounted above the lower printing cylinder to form the printing couple. In one instance the effective diameter of the large printing cylinder is twice the effective diameter of the lower printing cylinder and this basic configuration is referred to as the 2-R press; in the other instance the effective diameter of a large printing cylinder is three times the effective diameter of the lower printing cylinder and this basic configuration is referred to as the 3-R press. The peripheral surface of the lower printing cylinder has a single work area; and the peripheral surface of the large printing cylinder has two work areas where the large printing cylinder is twice the effective diameter of the lower printing cylinder and three work areas where the large printing cylinder is three times the effective diameter of the lower printing cylinder. Each of the work areas on the cylinders of the printing couple is adapted to carry a variety of interchangeable printing surfaces.

The frame structure of each of the basic press configurations, consisting in each case of main frames and associated spreader bars, is adapted to mount the appropriate large printing cylinder above and in rotational, tangential relationship with, the lower printing cylinder, and is constructed to provide a plurality of module mounting positions at each of which one of a variety of self-contained printing modules may be mounted in cooperative relationship with the large printing cylinder.

There are three categories of printing modules as follows:

1. Plate Cylinder Modules

A plate cylinder module consists of a frame structure, which carries a plate cylinder equal in effective diameter to the effective diameter of the lower printing cylinder and having a single work area in which an offset plate (either wet or dry) may be mounted, together with associated ink and/or dampening rolls and various control and coordinating mechanisms.

2. Ink/dampening Modules

An inking, or inking and dampening, module consists of a frame structure carrying ink rolls, or ink and dampening rolls, with form rollers adapted to roll in contact with a plate mounted in a work area on the large printing cylinder, and with associated control and coordinating mechanisms.

3. Dampening Modules

A dampening module consists of a frame structure carrying dampening rolls, with a form roller or rollers adapted to roll in contact with a plate mounted in a work area on the large printing cylinder, and with associated control and coordinating mechanisms.

Each of these various modules is a self-contained unit. A plate cylinder module may be mounted in any one of the module mounting positions of either the 2-R press or the 3-R press and, when so mounted, the plate cylinder of the module is in rotational, tangential relationship with the large printing cylinder. An ink/dampening module may be mounted in any required module mounting position of the press. A dampening module may be mounted in the appropriate module mounting positions of the press. It is thus apparent that an extremely wide variety of printing module combinations may be arranged in the various module mounting positions.

A variety of removable and interchangeable segments, for carrying various printing surfaces, are available for each of the basic configurations of the press and any one of these segments may be mounted in any work area on the large printing cylinder of the appropriate basic configuration of the press.

In addition, a variety of paper feeding mechanisms is provided which may be used selectively, either singly or in combination, to feed sheets of paper toward the bite of the printing couple; and feeder control means are provided by means of which the feeder or feeders may be caused to feed a sheet to every revolution of the lower printing cylinder, or to other than every revolution of the lower printing cylinder. Mechanism is provided for registering the sheets and for carrying them through the bite of the printing couple once, or more than once. Provision is made for mounting any one of a variety of delivery mechanisms at the delivery position in the press so that a delivery mechanism appropriate to the printing function or functions to be performed by a particular embodiment of the press may be employed. The sheets, as they leave the bite of the printing couple, are stripped, and delivered with a printed face up into a delivery hopper. The delivery hopper is located on the opposite side of a vertical plane containing the axis of the lower printing cylinder, from the paper feeder or feeders.

An object of this invention is to provide a multipuprose printing apparatus which may be furnished in a wide variety of configurations, all constructed from a basic group of unique, standardized components including parts, assemblies, modules, cylinders, removable and interchangeable segments and basic press frame structures, all of which are so constructed that they may be assembled together in a wide variety of combinations, varying from relatively simple configurations capable of the efficient performance of single printing functions, through a wide variety of more complex configurations, capable in some cases of the efficient performance of single complex combinations of printing functions, and, in other cases, capable of the efficient performance of a very wide range of different printing functions and combinations of functions, both simple and complex and in some cases including concurrent printing and collating.

A still further object of this invention is the provision of a printing apparatus having a large printing cylinder with two or more work areas in which removable and interchangeable printing segments may be mounted and having means for facilitating the removal and interchanging of such segments in work areas of the large printing cylinder.

A further object of the invention is to construct basic frame structures and various printing modules in such way that some presses may be assembled with a plate cylinder module mounted in a particular mounting position, while other presses are assembled with an ink module or a combined inking and dampening module mounted in that module mounting position.

Another object of the invention is to construct the inking means for the plate cylinder module so that it employs the identical ink rollers used in the inking module and in the combined inking and dampening module, and so that the arrangement of these inking rollers in the plate cylinder module is a mirror image of their arrangement in the inking module and in the combined inking and dampening module.

Another object of the invention is to provide a dampening attachment for the plate cylinder module which employs the identical rollers used in the dampening attachment of the combined inking and dampening module.

Another object of the invention is to construct the inking system of the plate cylinder modules, the inking modules and the combined inking and dampening modules in such a way that it comprises a basic inking system that is a part of all such modules and an auxiliary inking attachment which may be furnished or omitted, as desired, but which is constructed in such a way that when the auxiliary inking attachment is included it provides an additional form roller.

A further object of the invention is to construct the auxiliary inking attachment in such manner that its form roller contacts the plate last, and so that the ink must pass through a greater number of nips to reach the form roller of the auxiliary inking attachment than must be passed through to reach any form roller of the basic inking system.

A further object of the invention is to provide a frame supporting structure constructed so that it may be attached to the basic frame structure at any of the module mounting positions, and to attach the frame supporting structure at a module mounting position or positions at which printing modules are not mounted on any individual press.

A further object of this invention is the provision of a double sheet detector and eliminator for use with first and second paper feeding devices used together, and so constructed that is may be independently adjusted to automatically:

a. pass a sheet from the first feeder when a single sheet is fed but deflect the sheets whenever more than a single sheet is fed;
b. pass a sheet from the second feeder when a single sheet is fed but deflect the sheets whenever more than a single sheet is fed;

irrespective of whether the thickness of the sheets being fed from the two feeders is the same or different.

Another object of this invention is to provide a multipurpose printing press which may be furnished in a wide variety of configurations, all of which have a common lower printing cylinder having a single work area; and the diameter and width of which common lower printing cylinder are determined by the maximum length and width of the images to be printed and the maximum length and width of the sheets to be handled by all of the various configurations of the press.

Another object of this invention is the provision of a sheet-fed, high production, multi-purpose, printing press comprising at least three printing cylinders, including a lower printing cylinder, an upper printing cylinder of equal effective diameter to said lower printing cylinder and adapted to carry a printing plate and having associated ink roller means for applying ink to the surface of said plate, and a large printing cylinder intermediate the other two printing cylinders, above the lower printing cylinder and in rotational, tangential relationship to both, the effective diameter of the large printing cylinder being an integer multiple, greater than one, of the effective diameter of the lower printing cylinder, the periphery of said large printing cylinder being divided into two or more substantially equal work areas, at least one of which carries an offset blanket; and automatic paper feeding means, including means for automatically feeding a sheet once for each revolution of the lower printing cylinder from a supply of sheets located on one side of a vertical plane containing the axis of the lower printing cylinder, and means for conveying such sheets through the bite of the large and lower printing cylinders, whereby at least one side of said sheets is printed upon, and into a delivery hopper on the other side of said vertical plane, with a thus printed side of said sheets facing up.

Another object of this invention is the provision of a sheet-fed, high production, multi-purpose, printing press having a printing couple consisting of a lower printing cylinder with one work area and a large printing cylinder with two or more substantially equal work areas, means for mounting a variety of combinations of printing surfaces in the work areas on the cylinders of the printing couple, means for mounting other printing surfaces and/or inking or inking and dampening rollers in cooperative relationship with the work areas of the large printing cylinder, means for feeding a sheet to the bite of the printing couple on every revolution, or on other than every revolution, of the lower printing cylinder, and selectively controllable coordinating and control means so that maximum utilization may be made of each revolution of the large printing cylinder in terms of the application of images to the sheets being printed, or concurrently printed and collated, in the light of the printing function or combination of functions being performed.

Still another object of this invention is the provision of a sheet-fed, high production, multi-purpose printing press having a printing couple consisting of a lower printing cylinder with one work area and a large printing cylinder with two or more substantially equal work areas, means for mounting a variety of combinations of printing surfaces in the work areas on the cylinders of the printing couple, means for mounting other printing surfaces and/or inking or inking and dampening rollers in cooperative relationship with the work areas of the large printing cylinder, means for feeding a sheet to the bite of the printing couple on every revolution, or on other than every revolution of the lower printing cylinder, means to cause a sheet to be carried through the bite of the printing couple once, or more than once, and selectively controllable coordinating and control means so that maximum utilization may be made of each revolution of the large printing cylinder in terms of the application of images to the sheets being printed, or concurrently printed out and collated, in the light of the printing function or combination of functions being performed.

Another object of this invention is to provide a printing apparatus having a basic configuration wherein a large printing cylinder is mounted over a lower printing cylinder and in rotational, tangential relationship thereto, with provisions for mounting associated members to accomplish sundry printing functions, wherein the large printing cylinder is adapted to provide two, or alternatively three, substantially equal work areas capable of receiving print producing, image transfer on other members; and wherein the effective diameter of the large printing cylinder is twice the effective diameter of the lower printing cylinder where two work areas are provided or three times the effective diameter of the lower printing cylinder where three work areas are provided.

Another object of this invention is to provide a basic printing apparatus with a unique frame structure, including frame connecting spreader bars, and carrying a large printing cylinder and a smaller lower printing cylinder, and having the intrinsic capability of receiving and mounting various unique, standardized, self-contained printing modules at several positions in cooperative relationship with the large printing cylinder; which printing modules comprise simple, or more extensive, dampening modules, simple, or more extensive, inking, or combined inking and dampening modules, and plate cylinder modules with associated simple, or more extensive, inking, or inking and dampening, systems; and with which frame structure these various printing modules may be used singly, or may be combined in a variety of combinations, to make possible the accomplishment of a very wide range of printing functions, or combinations of functions.

Another object of this invention is to provide a basic printing apparatus capable of mounting simple and/or more extensive paper sheet feeding and sheet delivery devices, with selective control means, which, in conjunction with selected printing modules or combinations of printing modules, together with selected combinations of printing surfaces in selected work areas of the plates and/or large and lower printing cylinders, permits letterpress printing, wet offset printing, dry offset printing, embossing, imprinting, and numbering operations to be performed, either singly or in various combinations with each other, or in combination with concurrent collating operations, and with the ability to print on one side and/or on two sides of paper stock, in one or multi-colors.

Another object of this invention is the provision of a printing press having paper feeding apparatus with selective control means, adapted to feed sheets to every revolution of a lower printing cylinder, to every second revolution of the lower printing cylinder, to every third revolution of the lower printing cylinder or to selected revolutions of the lower printing cylinder of the printing press.

Another object of this invention is the provision of a printing apparatus having means to cause a sheet of paper to pass through the bite of large and lower printing cylinders either once or twice as selected, or, alternatively, once, twice or three times, as selected.

A further object of this invention is the provision of a printing apparatus having new and novel means for causing a sheet of paper, which has been separated from a stack of sheets by its leading edge, to underlap the trailing edge of a previously separated sheet as the sheets are conveyed to the bite of a printing couple, in order to provide additional time for the registering of each sheet before it is passed through the bite of the printing couple.

Another object of this invention is the provision of a sheet fed printing apparatus having new and improved means for stopping and registering each sheet of paper against top fingers as it approaches the bite of a printing couple, and for then advancing the sheet to bring its leading edge into register with register stops carried by the lower printing cylinder of the couple, and for then seizing the leading edge of the sheet in grippers, which continue to hold the leading edge of the sheet in contact with the register stops while they carry the leading edge of the sheet to and through the bite of the printing couple once or more than once, as selected.

Still another object of this invention is the provision of sheet fed printing apparatus having new and improved means for detecting whether or not a sheet of paper is present at stop fingers, on preselected revolutions of a lower printing cylinder, ready to be advanced to register stops in the lower printing cylinder; and for causing the lower printing cylinder to maintain, or to assume, a printing or nonprinting relationship with a large printing cylinder in accordance with whether or not a sheet is found to be present; and for then causing the lower printing cylinder to maintain the determined relationship with respect to the large printing cylinder until the detecting means acts again, at the time of the next preselected revolution of the lower printing cylinder on which a sheet should be present at the stop fingers ready to be advanced to the cylinder register stops.

Another object of this invention is the provision of a printing apparatus having new and improved means for effecting independent pressure adjustments between a lower printing cylinder and each of two or more printing surfaces carried in separate work areas on a large printing cylinder.

A still further object of this invention is the provision of a printing press having one or a number of plate cylinders, carried by plate cylinder modules mounted in any one, or in two or more module mounting positions, with each such plate cylinder being in rotational, tangential relationship with a large printing cylinder having two or more work areas; the press having a new and novel means by which each plate cylinder, individually, may be held in printing relationship with any selected work area or areas on the large printing cylinder and out of printing relationship with any other selected work area or areas on the large printing cylinder.

A still further object of this invention is the provision of a printing apparatus having new and novel means for preventing the creation and transfer of streaks from the printing cylinders onto the printed copy, which consists of arranging the gear drive from each printing cylinder to each other printing cylinder so that, notwithstanding the fact that the effective diameter of one printing cylinder is an integer multiple, greater than one, of the effective diameter of the other printing cylinder, nevertheless, the drive from each such printing cylinder to each such other printing cylinder is such that the number of teeth in any gear in the gear train is never an integer multiple of the number of teeth in any gear with which it is in mesh.

A still further object of this invention is the provision of a printing press having a large printing cylinder divided into two or more substantially equal work areas in either or both of which printing plates may be mounted, and having one or two, or more, plate cylinders in rotational, tangential relationship with the large printing cylinder, each of which has a single work area in which a plate may be mounted; the press having new and novel means by which vertical image adjustments may be made with respect to the individual plates to bring the vertical positions of the images on all of the plates into register with each other, and additional novel means whereby the vertical positions of all such images may be simultaneously adjusted with respect to the vertical position of such images on the sheets to be printed, without disturbing the interrelationship of the vertical position of one image to another.

Still another object of this invention is the provision of a printing apparatus having new and novel means by which a plurality of gears, and/or cams, mounted on a common shaft, may be individually adjusted circumferentially about the axis of the shaft, with all of the adjustments being made from the outside of the outermost of said gears and/or cams.

A still further object of this invention is the provision of a printing apparatus having a large printing cylinder divided into two or more separate work areas and having a plurality of inking, and/or dampening, and/or inking and dampening modules mounted around the large printing cylinder so that the form rollers of each such inking, or dampening, or inking and dampening module may roll in contact with a printing surface in a work area on the large printing cylinder; and having new and novel means for selectively causing any selected ones of said form rollers to be lifted out of contact with any selected printing surface or surfaces, in any selected one or more of said work areas, so that they roll in contact only with a printing surface or surfaces in another selected work areas or areas on the large printing cylinder; while selected others of said form rollers are similarly controlled so that they roll in contact with only another printing surface or surfaces, in another work area or work areas on the large printing cylinder; and when there are more than two work areas on the large printing cylinder also including means so that still other selected ones of said form rollers may be similarly controlled so that they roll in contact only with still another printing surface in still another work area on the large printing cylinder.

Another object of this invention is the provision of a printing apparatus having new and novel means for varying the speed at which the printing cylinders are driven, through a speed range of at least four to one.

A still further object of this invention is the provision of a printing apparatus having a lower printing cylinder with a single work area, and a large printing cylinder with two or more substantially equal work areas, and a chain delivery mechanism consisting of chains carrying a plurality of delivery gripper bars, equal in number to a whole multiple of the number of work areas on the large printing cylinder.

Still another object of this invention is the provision of a printing press having a lower printing cylinder with a single work area, and a large printing cylinder having two or more work areas; and equipped with a first or "encircling" chain delivery mechanism consisting of a pair of chains, one at either end of the lower printing cylinder and each encirling the shaft of the lower printing cylinder and carrying between them a plurality of delivery gripper bars; and a second or "extension" chain-delivery mechanism located above the first and in part overlapping the first, and extending beyond the first away from the press, with the "extension" chain-delivery mechanism consisting of a pair of chains carrying between them a plurality of "extension" delivery gripper bars; and with means whereby the leading edge of a sheet may be transferred from grippers carried by the "encircling" chains to grippers carried by the "extension" chains, and the sheet thereby pulled by its leading edge, in a straight line, until it is in position above a delivery pile and is released to drop on the top of the pile with its original top surface facing up; and with means whereby, alternatively, the leading edge of a sheet may continue to be held by the grippers carried by the "encircling" chains until the sheet has been carried around the outer shaft of the "encircling" chain delivery mechanism, and thus turned over and pulled by its leading edge into position over an alternate delivery pile and then released to drop on the top of the pile with its original bottom surface facing up.

Still another object of this invention is the provision of a printing apparatus having a lower printing cylinder, with a single work area, and large printing cylinder, with two or more substantially equal work areas, and a separate chain delivery mechanism, carrying a plurality of gripper bars, with means to transfer the leading edge of a sheet from cylinder grippers carried by the lower printing cylinder, to delivery grippers carried by one of the gripper bars of the separate chain delivery mechanism; the number of gripper bars in the separate chain delivery mechanism being equal to a whole multiple of the number of work areas on the large printing cylinder.

A still further object of this invention is the provision of a printing apparatus having a lower printing cylinder with a single work area, and having register stops fixed to the lower cylinder, and cylinder grippers carried by the lower cylinder for receiving and gripping the leading edge of a sheet which has been brought into register with register stops, with means for causing the cylinder grippers to then continue to grip the leading edge of the sheet as the cylinder rotates, until a delivery position is reached and then to open to release the sheet; the lower cylinder also carrying ejector fingers located below the leading edge of the sheet, which operate to lift the leading edge of the sheet out beyond the periphery of the lower cylinder when the grippers open to release the sheet so that the leading edge of the sheet is caused to pass over stripper fingers adjacent to the lower cylinder at the delivery position; and having means by which the cylinder grippers may alternatively be caused to retain their grip on the leading edge of the sheet as they pass the delivery position and until the leading edge of the sheet has been carried through the bite of the cylinders of the printing couple twice, or three times, and then to cause the cylinder grippers to open to release the sheet when they next reach the delivery position; and also having means to cause the ejector fingers to remain below the periphery of the lower cylinder as they pass the point where the cylinder grippers open to receive a sheet and also to remain below the periphery of the lower cylinder as they pass the delivery position, except when the cylinder grippers open to release a sheet as they reach the delivery position.

A still further object of this invention is the provision of a printing apparatus having a unique frame structure with a plurality of module mounting positions, in any of which a plate cylinder module may be mounted, and having a plate cylinder module mounting bracket so constructed that the identical brackets may be used for mounting both side frames of a plate cylinder module and for mounting a plate cylinder module in any of the module mounting positions; and whereby plate cylinder modules may be mounted, in any or all of the module mounting positions simultaneously and when so mounted, each side frame of each of the plate cylinder modules thus mounted will be held in the same vertical plane with the corresponding side frames of all other plate cylinder modules thus mounted.

Another object of this invention is the provision of a printing apparatus having a unique basic frame structure in which are mounted in rotational tangential relationship a lower printing cylinder having a single work area and a large printing cylinder having an effective diameter which is an integer multiple greater than one of the effective diameter of the lower printing cylinder and which is divided into two or more substantially equal work areas, and which frame structure is constructed to provide means for mounting a plate cylinder, equal in effective diameter to the lower printing cylinder, in rotational tangential relationshipto the large printing cylinder together with means for inking a plate mounted on the plate cylinder and which frame structure also is constructed to provide one or more mounting stations at which either a plate cylinder module or an inking module may be mounted; with said plate cylinder module comprising a second frame structure in which a plate cylinder equal in effective diameter to said lower printing cylinder is mounted together with means for inking a plate carried on said plate cylinder, said second frame structure being so constructed that when said plate cylinder module is mounted at said module mounting station on said basic frame structure the said plate cylinder is in rotational tangential relationship to the large printing cylinder; and with said inking module comprising a third frame structure carrying inking rollers and including at least one form roller, said third frame structure being so constructed that when said inking module is mounted at said module mounting station on said basic frame structure the said form roller may roll in contact with a plate mounted in one of the work areas of the large printing cylinder.

A still further object of this invention is the provision of a printing apparatus having two or more printing cylinders, which may be of different diameters, and with each printing cylinder having at least one work area and one gap on its periphery and having means for actuating reciprocating motions, such as the drive for the ink and/or dampening mechanisms, and the drive for oscillating rollers in the inking, or dampening, or inking and dampening systems, and in which these reciprocating motions are caused to occur rhythmically but not more frequently than once for every four revolutions of the smallest printing cylinder.

Another object of this invention is the provision of a dampening fountain tray for use in printing modules which are adapted to be mounted in a number of module mounting positions located around a printing cylinder with the dampening fountain tray being so constructed that it may be used in the printing module irrespective of which of the module mounting positions the printing module may be mounted in, and in all cases the dampening fountain tray may be affixed to the module so that it will hold the dampening solution in contact with the dampening fountain roller.

Still another object of this invention is the provision of a printing apparatus in which "streaking" or the transfer of streaks to the printed copy is minimized by having each inking and/or dampening roller in very train of inking and/or dampening rollers be of a different diameter than any roller with which it comes in contact and by having no such roller have a diameter which is an integer multiple of any roller with which it come in contact and by having each of the ink and/or dampening form rolls which contact any one plate be of different diameters; and by the further means of having each gear in very train of gears driving any element within the inking and/or dampening systems of such diameter and therefore have a number of gear teeth such that the number of teeth on any such gear is not, in any case, divisible a whole number of times into the number of teeth on any gear with which it is in mesh.

Still another object of this invention is the provision of a lithographic printing apparatus having novel means for storing the dampening solution when the press is not in use, for causing the dampening solution to enter the dampening fountain tray prior to putting the press in operation, for maintaining the level of the dampening solution in the fountain tray during the operation of the press and for returning the dampening solution to storage upon completion of the operation of the press.

Another object of this invention is the provision of a printing apparatus having unique means for controlling the flow of ink from an ink fountain and ink fountain roller through an ink ductor system to other rollers which in turn carry the ink to the form roller or rollers that roll in contact with the surface of a plate or other imaging device.

Another object of this invention is the provision of a basic printing apparatus having a plurality of module mounting positions located about a large printing cylinder, with a variety of self-contained printing modules for mounting in various combinations in the various module mounting positions, wherein the drive for the basic printing apparatus is so constructed and the drive for each of the self-contained printing modules is so constructed that the drive will be transmitted from the basic printing apparatus to each of the self-contained printing modules when mounted in any of the module mounting positions.

A still further object of this invention is the provision of a printing apparatus having one or a number of plate cylinders carried by plate cylinder modules mounted in any one or in two or more module mounting positions, with each such plate cylinder being in rotational, tangential relationship with a large printing cylinder the periphery of which is divided into two or more substantially equal work areas and including means by which each plate cylinder may be individually held in printing relationship with any selected work area or areas of the large printing cylinder and out of printing relationship with any other selected work area or areas of the large printing cylinder; and also having means whereby the pressure between each plate mounted on the surface of any individual plate cylinder and each other printing surface with which it comes in printing contact, mounted in separate work areas of the large printing cylinder, may be individually and separately controlled; and also having means for causing each such plate cylinder to move out of printing relationship with each such passing work area with which it would otherwise be in printing relationship whenever the lower printing cylinder, under the control of the sheet detecting mechanism which controls the printing or nonprinting relationship of the lower printing cylinder to the large printing cylinder, was held out of printing relationship with that work area of the large printing cylinder on the last passage of that work area past the bite between the lower printing cylinder and the large printing cylinder.

Still another object of this invention is the provision of a printing apparatus having a printing couple comprising a large printing cylinder with a plurality of work areas and a lower printing cylinder with a single work area which are mounted in rotational tangential relationship to each other to form a printing "bite" there between, and having register stops fixed to the lower printing cylinder and cylinder grippers carried by the lower printing cylinder for receiving and gripping the leading edge of a sheet which has been brought into register with the register stops, with means for causing the cylinder grippers to then continue to grip the leading edge of the sheet as the cylinder rotates and carries the leading edge of the sheet thru the bite of the printing couple and until a delivery position is reached and to then open to release the sheet; a separate chain delivery mechanism extending toward the rear of the press from the lower printing cylinder and consisting of a pair of delivery chains each extending over a pair of sprockets and with the chains carrying between them a plurality of delivery gripper bars, the number of delivery gripper bars being a whole multiple of the number of work areas on the large printing cylinder, and one pair of the delivery sprockets being in rotational, tangential relationship to the lower printing cylinder at the delivery position; and means to cause the grippers of the delivery gripper bars to grip the leading edge of the sheet just as it is released by the cylinder grippers; and including means by which the cylinder grippers may alternatively be caused to retain their grip on the leading edge of the sheet as they pass the delivery position and until the leading edge of the sheet has been carried through the bits of the cylinders of the printing couple twice, or three times, and to then cause the cylinder grippers to open to release the sheet when they next reach the delivery position; and also including means by which the gripper fingers on delivery gripper bars, which reach the point of tangency with the lower printing cylinder in coincidence with a revolution of the lower printing cylinder on which the cylinder grippers retain their grip on the leading edge of the sheet as they pass the delivery position, may be held open and inactive; while leaving those gripper bars of the chain delivery system, which reach the point of tangency with the lower printing cylinder in coincidence with the opening of the cylinder grippers to release the sheet, operative to effect the transfer of the leading edge of the sheet to the grip of the delivery grippers.

Still another object of this invention is the provision of a printing appartus having a printing couple comprising a large printing cylinder with a plurality of work areas and a lower printing cylinder with a single work area which are mounted in rotational tangential relationship to each other to form a printing "bite" there between and having register stops fixed to the lower printing cylinder and cylinder grippers carried by the lower printing cylinder for receiving and gripping the leading edge of a sheet which has been brought into register with the register stops, with means for causing the cylinder grippers to then continue to grip the leading edge of the sheet toward the bite of the printing couple and a chain delivery mechanism extending toward the rear of the press from the lower printing cylinder and consisting of a pair of delivery chains each extending over a pair of sprockets and with the chains carrying between them a plurality of delivery gripper bars, the number of delivery gripper bars being a whole multiple of the number of work areas on the large printing cylinder, means to cause the grippers of the delivery gripper bars to grip the leading edge of the sheet and means to cause the cylinder grippers to open to release the leading edge of the sheet at a transfer point and including means by which the cylinder grippers may alternatively be caused to retain their grip on the leading edge of the sheet as they pass the transfer point and cause the leading edge of the sheet to be carried through the bite of the cylinders of the printing couple twice, or three times, and including means by which the gripper fingers on delivery gripper bars, which reach the transfer point in coincidence with a revolution of the lower printing cylinder on which the cylinder grippers retain their grip on the leading edge of the sheet as they pass the transfer point, may be held open and inactive; while leaving those gripper bars of the chain delivery system, which reach the transfer point in coincidence with the opening of the cylinder grippers to release the sheet, operative to effect the transfer of the leading edge of the sheet to the grip of the delivery grippers.

Another object of this invention is the provision of means for mounting an ink fountain in cooperative relation to an ink fountain roller in a printing module in a variety of angular positions so that the ink fountain will be in a substantially horizontal position regardless of the position in which the module is mounted, throughout a range of module mounting positions which includes a module mounted with its sides at a 5° angle above the horizontal to the right of center and a module mounted with its sides at a 10° angle above the horizontal to the left of center.

Another object of this invention is the provision of a printing press having a lower printing cylinder with a single work area, and a large printing cylinder with two or more work areas, and a separate chain delivery mechansim consisting of a pair of chains carrying between them a plurality of gripper bars, with means to transfer the leading edge of a sheet from cylinder grippers carried by the lower printing cylinder to delivery grippers carried by one of the gripper bars of the separate chain delivery mechanism; and a second or "extension" chain delivery mechanism extending beyond the first, away from the press, with the "extension" chain delivery mechanism consisting of a pair of chains carrying between them a plurality of "extension" delivery gripper bars, and with means whereby the leading edge of a sheet may be transferred from grippers carried by the separate chain delivery mechanism to grippers carried by the "extension" chain delivery mechanism, and the sheet thereby pulled by its leading edge until the sheet has been carried around the outer shaft the "extension" chain delivery mechanism and thus turned over and pulled into position over a delivery pile and released to drop on the top of the pile with its original bottom surface facing up; and with means whereby, alternatively, the leading edge of a sheet may be pulled by the grippers of the separate chain delivery mecahnism only, until it is in position above a delivery pile in an alternate position, and then released to drop on the top of this pile with its original top surface facing up.

A still further object of this invention is the provision of a printing press in which two or three, or more, printing plates may be mounted, each carrying a separate image and each of which may be inked by separate inking rollers, and having new and novel means by which either each sheet of a set of two, or each sheet of a set of three, fed to the press, is printed with a different one of the images or with a different combination of the images, so that each set of two sheets in the one case, or each set of three sheets in the other case, forms a complete set which has been printed and collated concurrently by the press.

Still another object of this invention is the provision of a printing press having new and novel means for mounting either one or two or three paper feeders, in cooperative relationship with each other, to feed sheets to the printing couple of the press, and having control means whereby sheets may be fed, selectively, from one, two or three of the feeders, to selected revolutions of the lower printing cylinder, and whereby sheets of different size and/or weight and/or color may be fed from the different feeders, so that printed and concurrently collated sets of either two sheets, or of three sheets, may be delivered by the press, and the sheets within a set may be of different size and/or weight and/or color.

Another object of this invention is the provision of a printing press equipped with means for concurrently printing and collating either sets of two sheets, or sets of three sheets, and having a new and novel means both for detecting wheter more than a single sheet has been fed, with means for deflecting such multiple sheets from the path by which single sheets are conveyed to the stop fingers of the press, and for detecting whether a feeder has failed to feed a sheet; an also having means, operative whenever a sheet has not been conveyed to the stop fingers of the press, for either reason, to cause the sheet deflector or deflectors to remain open to deflect additional sheets from the path of single sheets being conveyed to the stop fingers of the press for a sufficient number of strokes of the feeder or feeders, so that the total numer of sheets from the feeder or feeders which do not reach the stop fingers of the press is equal to one complete set of two, or one complete set of three, depending upon the number of sheets in the sets being concurrently printed and collated by the press.

A still further object of this invention is the provision of a printing apparatus having new and novel means by which additional, auxiliary ink rollers may be added to a basic inking, or inking and dampening, system when required; and in which the train of auxiliary ink rollers includes a form roller which rolls in contact with the printing plate being inked, on each revolution of the cylinder carrying the plate, after the form roller (or form rollers) of the basic inking system have rolled in contact with the printing plate; and in which the path which ink from the ink fountain must follow to reach the plate through the form roller of the auxiliary ink train is longer, in terms of the number of bites, or nips, between ink rollers which must be passed through, than the path which such ink must follow to reach the plate through the form roller (or form rollers) of the basic inking system; and in which certain of the auxiliary ink rollers are mounted in a hinged frame, which can be swung away to provide easy access to other rollers of the inking, or inking and dampening system.

These, and still further and additional, objects and embodiments of this invention will become apparent from the hereinafter following commentary, taken in conjunction with the drawings, wherein like characters of reference indicate like elements and wherein:

FIG. 1 schematically depicts one embodiment of the 2 R press.

FIG. 2*a* and 2*b*, together, schematically illustrate a more sophisticated embodiment of the 2-R press shown in FIG. 1;

FIG. 3 illustrates a modification of the press of FIGS. 2*a* and 2*b;*

FIGS. 4*a* and 4*b* schematically illustrate one embodiment of the 3-R press;

FIGS. 5*a* and 5*b*, together, schematically illustrate a more sophisticated embodiment of the 3-R press shown in FIG. 4*a*.

FIG. 6 illustrates a modification of the press of FIG. 5*a* and 5*b*.

FIGS. 7*a*, 7*b*, 7*c* and 7*d*, taken together, from FIG. 7, which is a coordinated, diagrammatic illustration centered around the unique construction of the basic press frame structure and illustrating many of the unique interrelated components, including various printing modules, etc., together with a number of related control functions; from which various elements may be selected, in a wide variety of combinations, to form various embodiments of the press;

FIGS. 8*a*, 8*b*, 8*c*, and 8*d*, taken together, form FIG. 8, which is another coordinated, diagrammatic illustration, similar to FIG. 7 but showing additional elements and control functions pertaining only to the 3-R press;

FIGS. 9*a*, 9*b*, 9*c*, 9*d*, 9*e*, 9*f*, 9*h*, 9*i*, 9*j*, 9*k*, 9*m*, 9*n*, 9*p*, 9*q*, 9*r*, 9*s*, and 9*t* are "function diagrams" which illustrate diagrammatically a variety of typical printing functions, and combinations of functions, as they would be accomplished on the 2-R press.

FIGS., 10*a*, 10*b*, 10*c*, 10*d*, 10*e*, and 10*f* are "function diagrams" which illustrate diagrammatically additional typical printing functions, and combinations of functions, as they would be accomplished on the 3-R press.

FIG. 20 shows the press frames and the mounting brackets for the plate cylinder modules as seen from the right side of FIG. 19;

Figure 11:
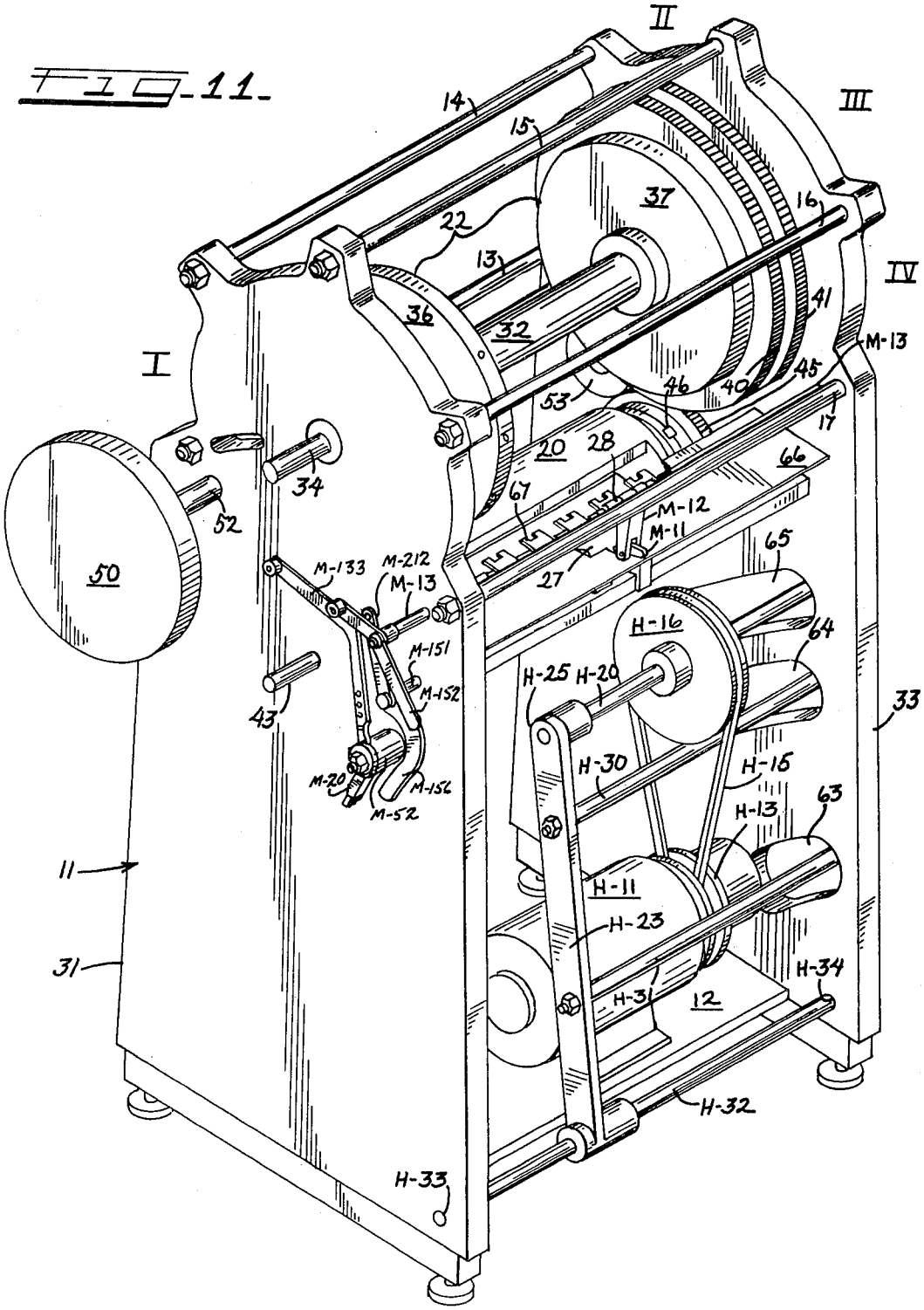
FIG. 11, is an isometric drawing of the frame structure of one embodiment of the 2-R press.
Figure 13:
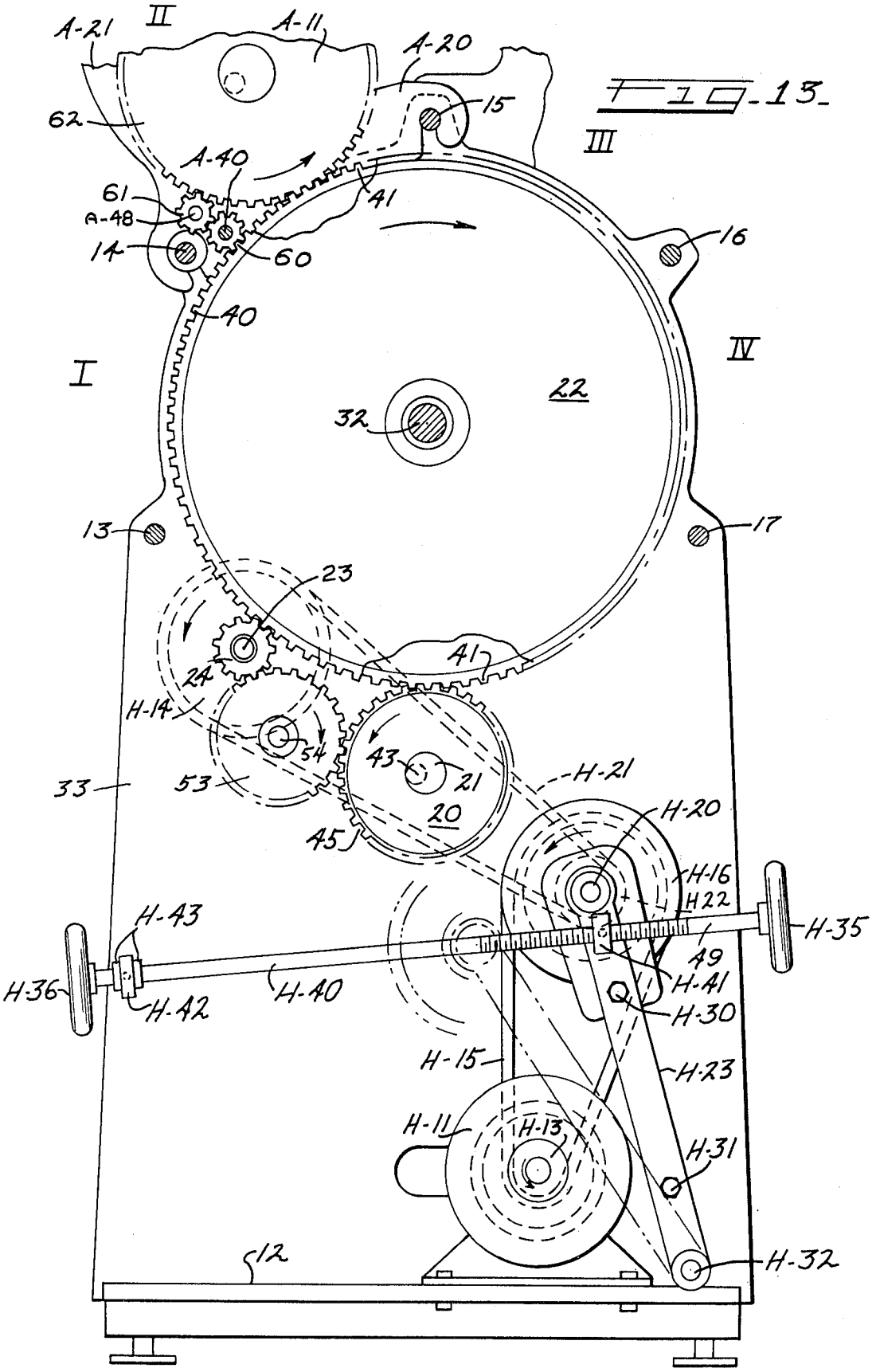
FIG. 13, is a cross-sectional view taken along the line 13—13 of FIG. 12.
Figure 24:
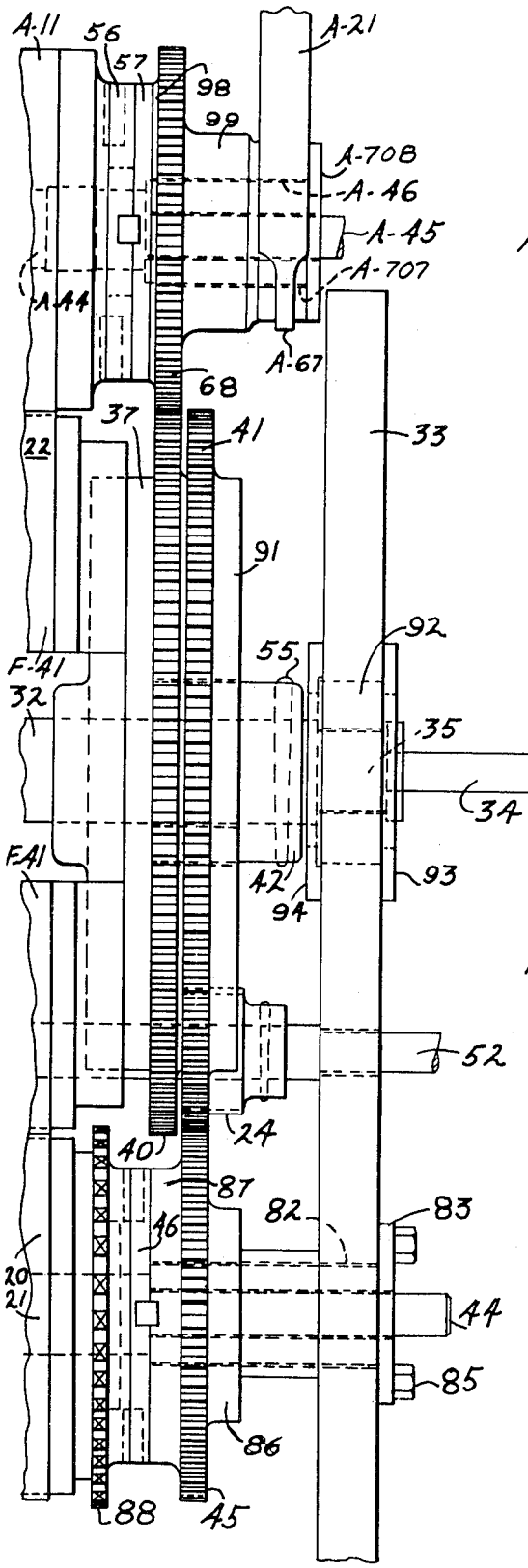
Figure 23:
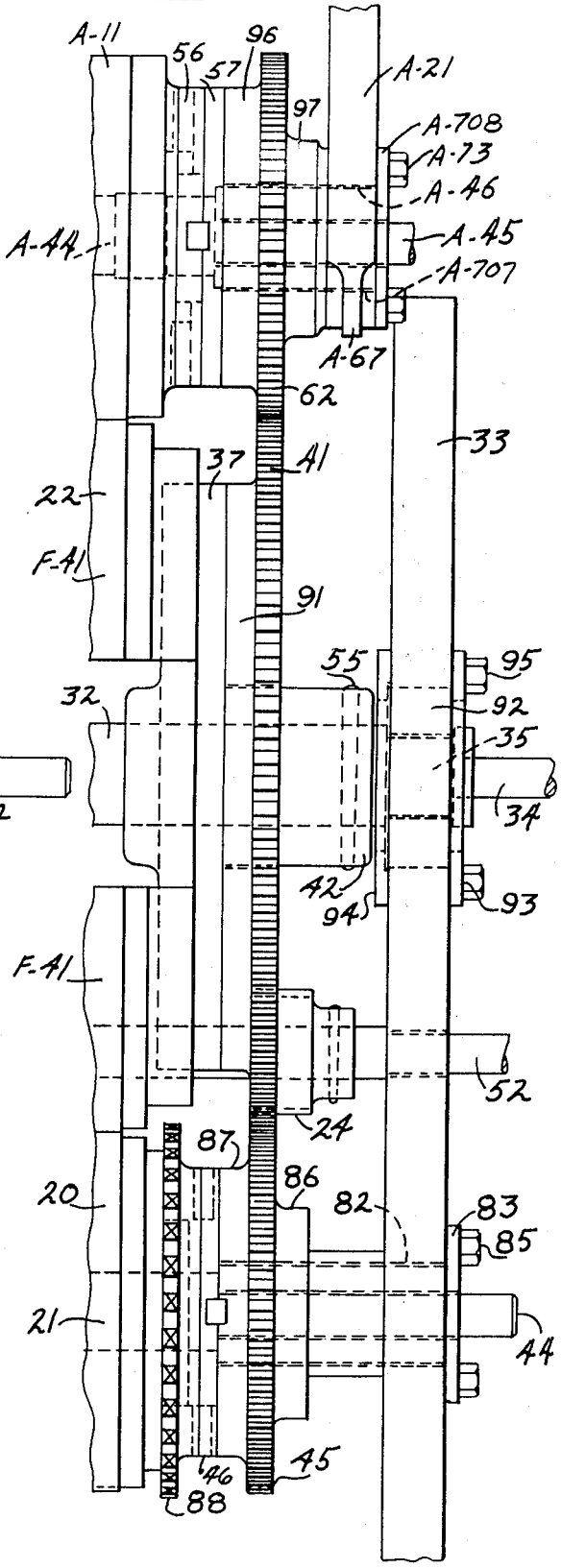
Figure 25:
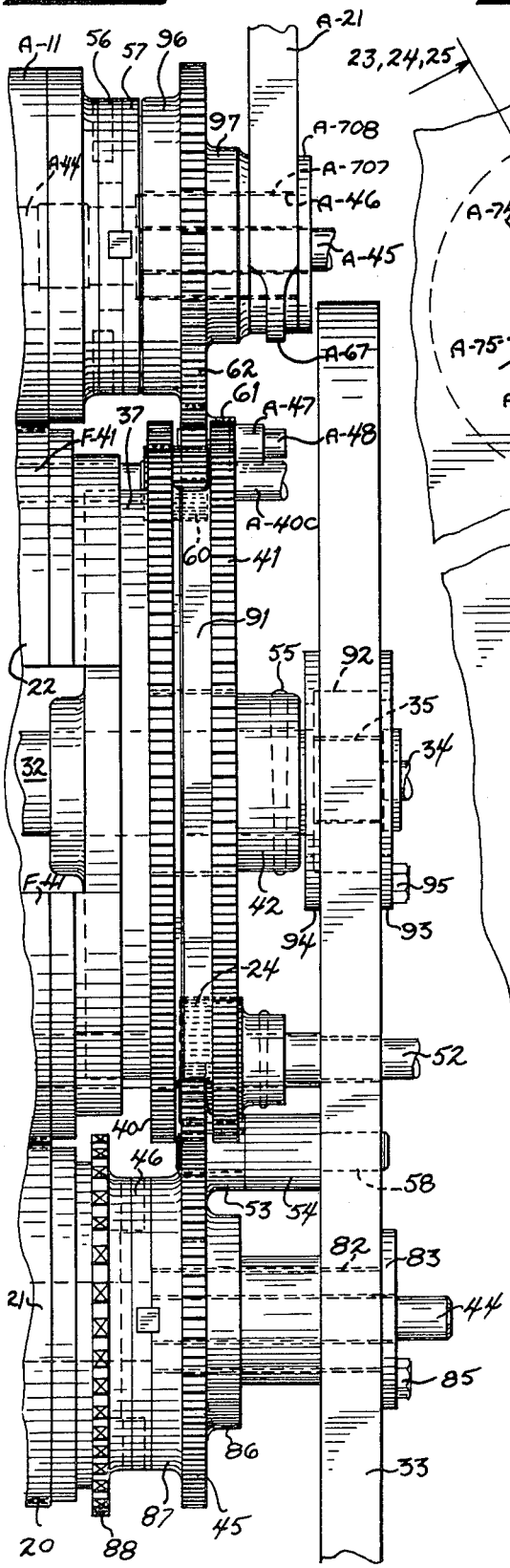
Figure 26:
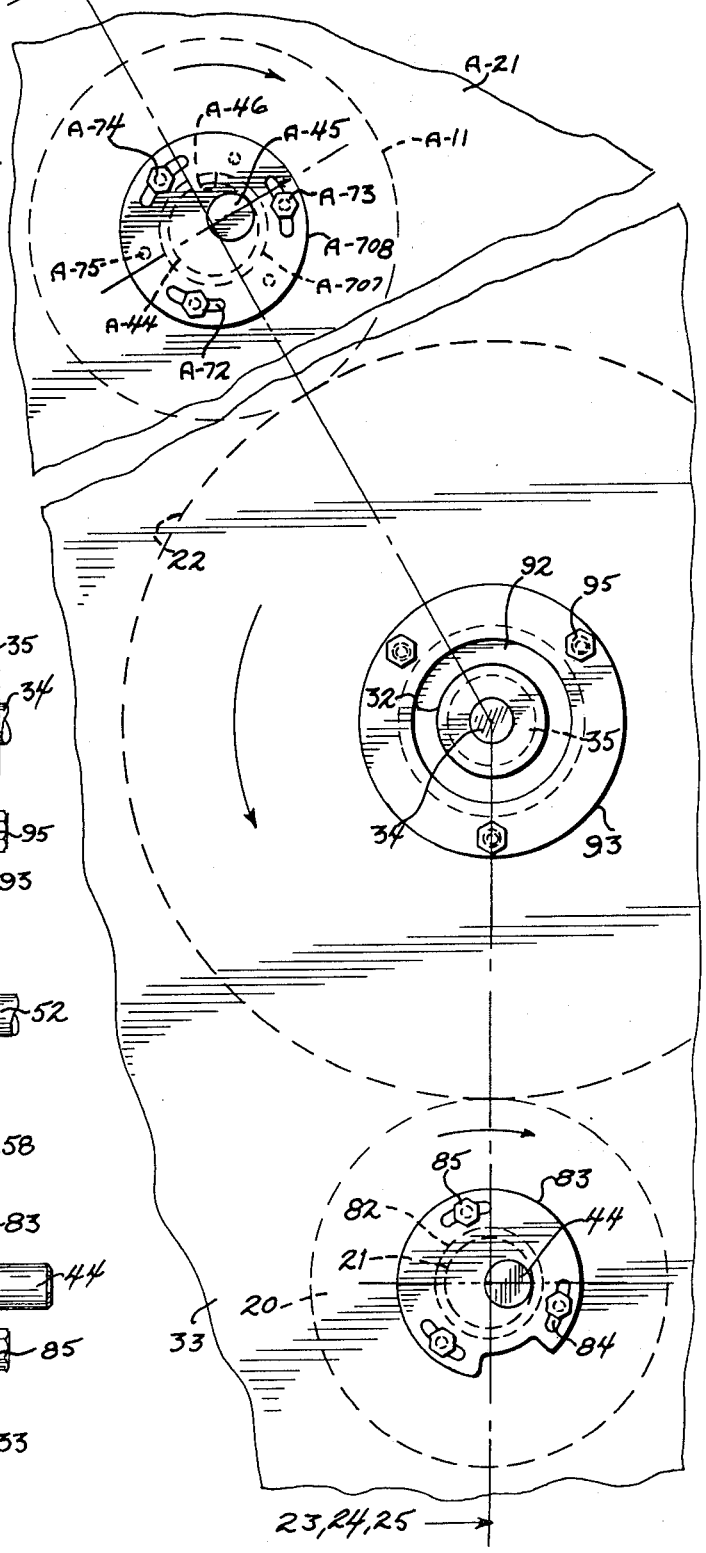
Figure 27:
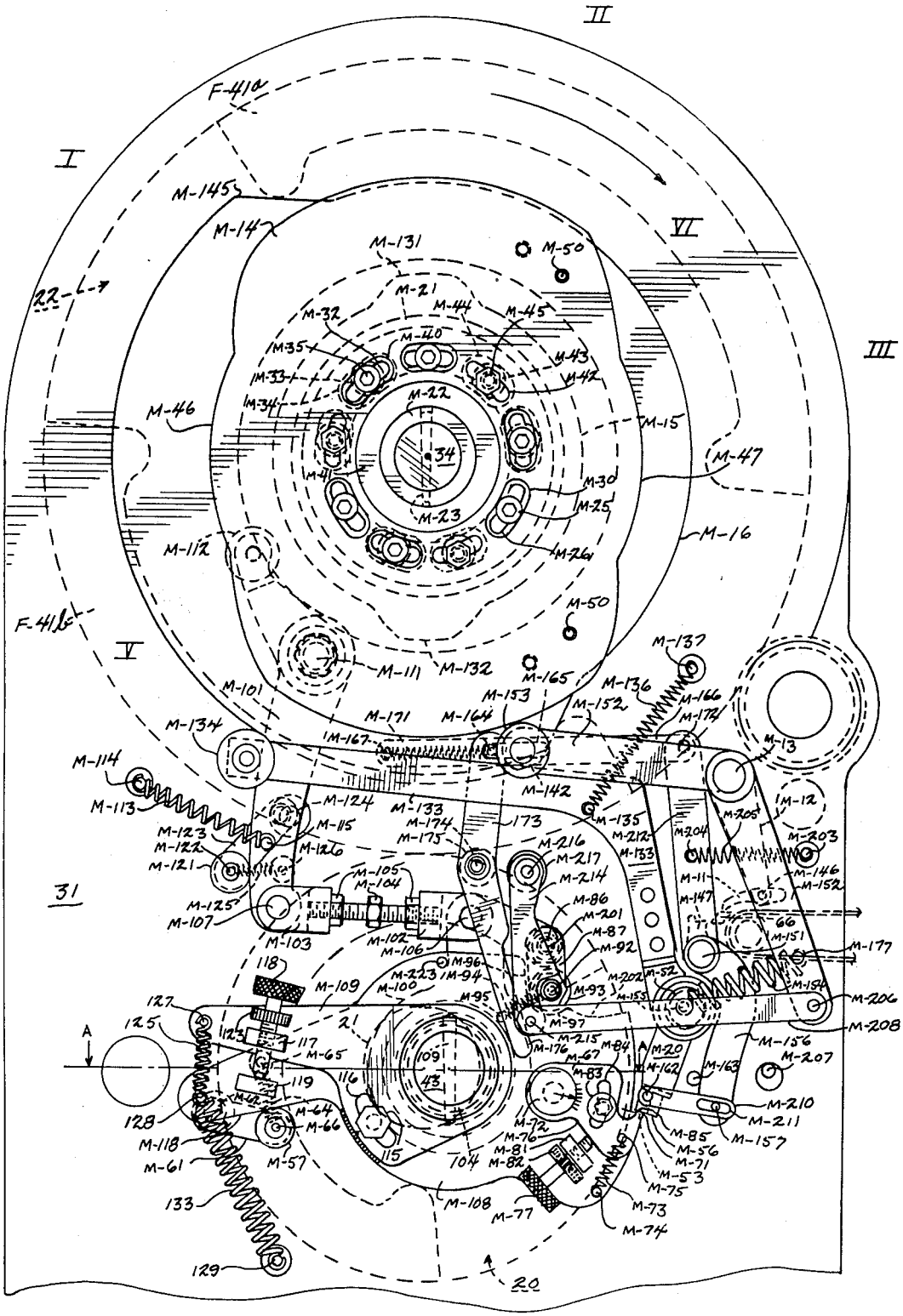
Figure 27A:
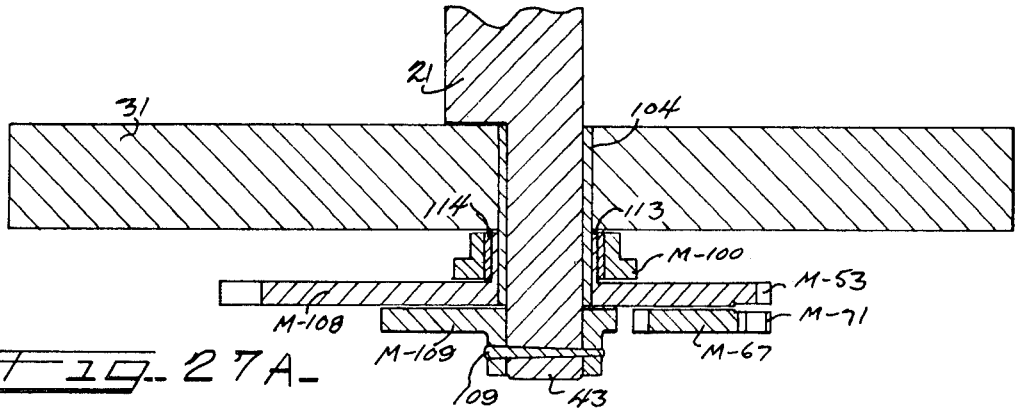
Figure 29A:
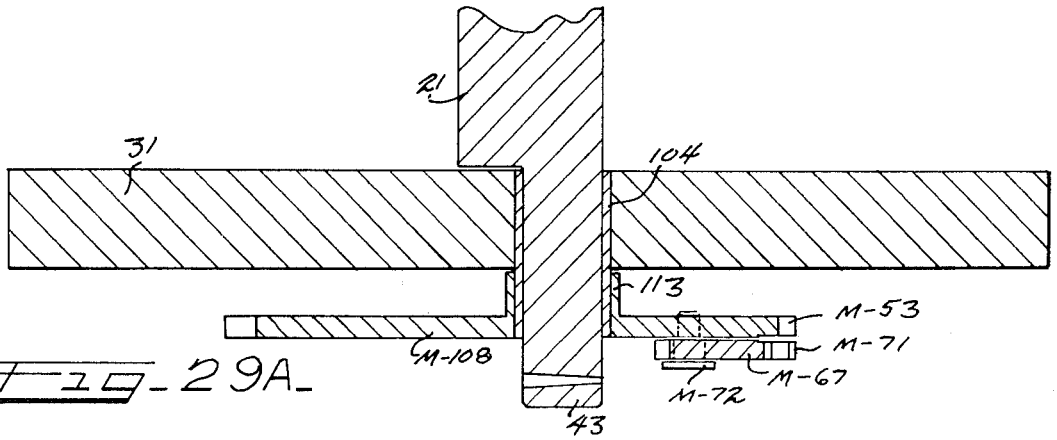
Figure 32A:
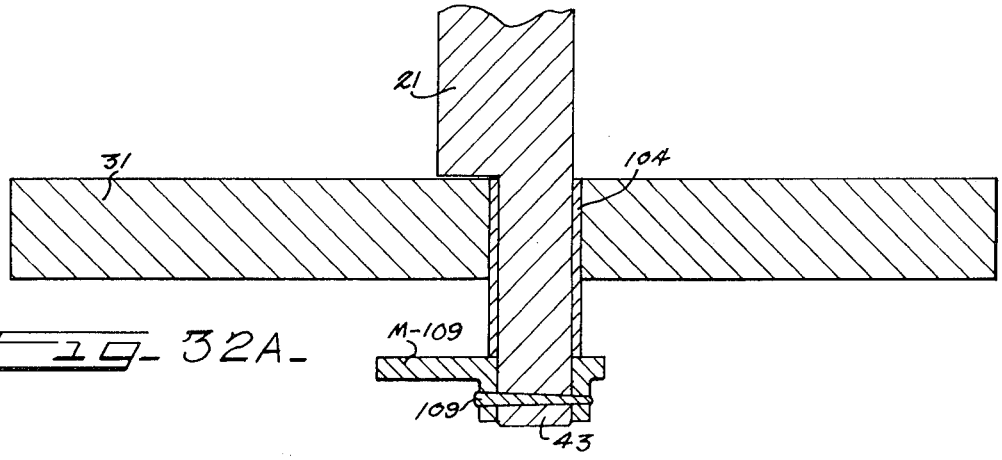
Figure 27B:
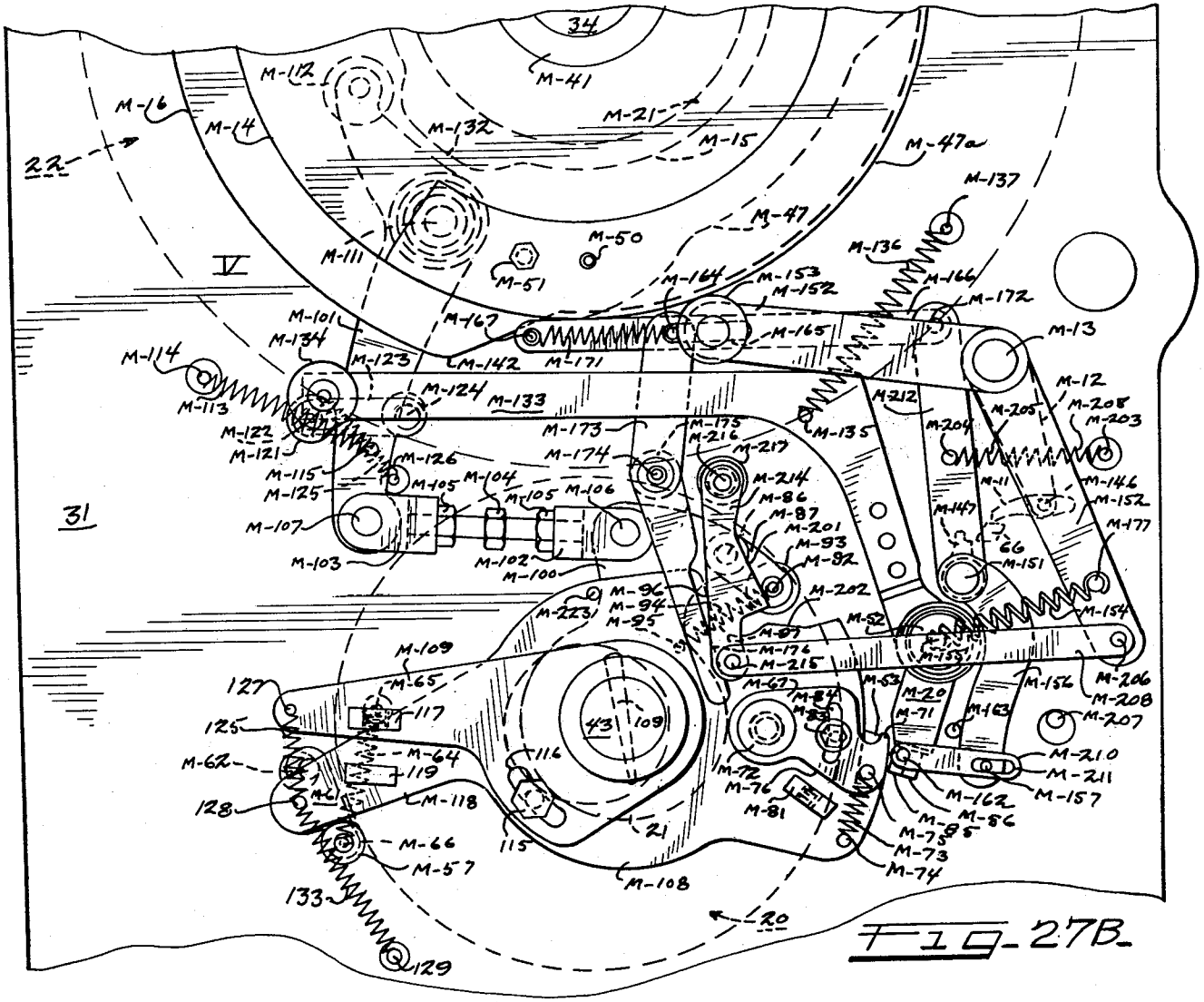
Figure 30:
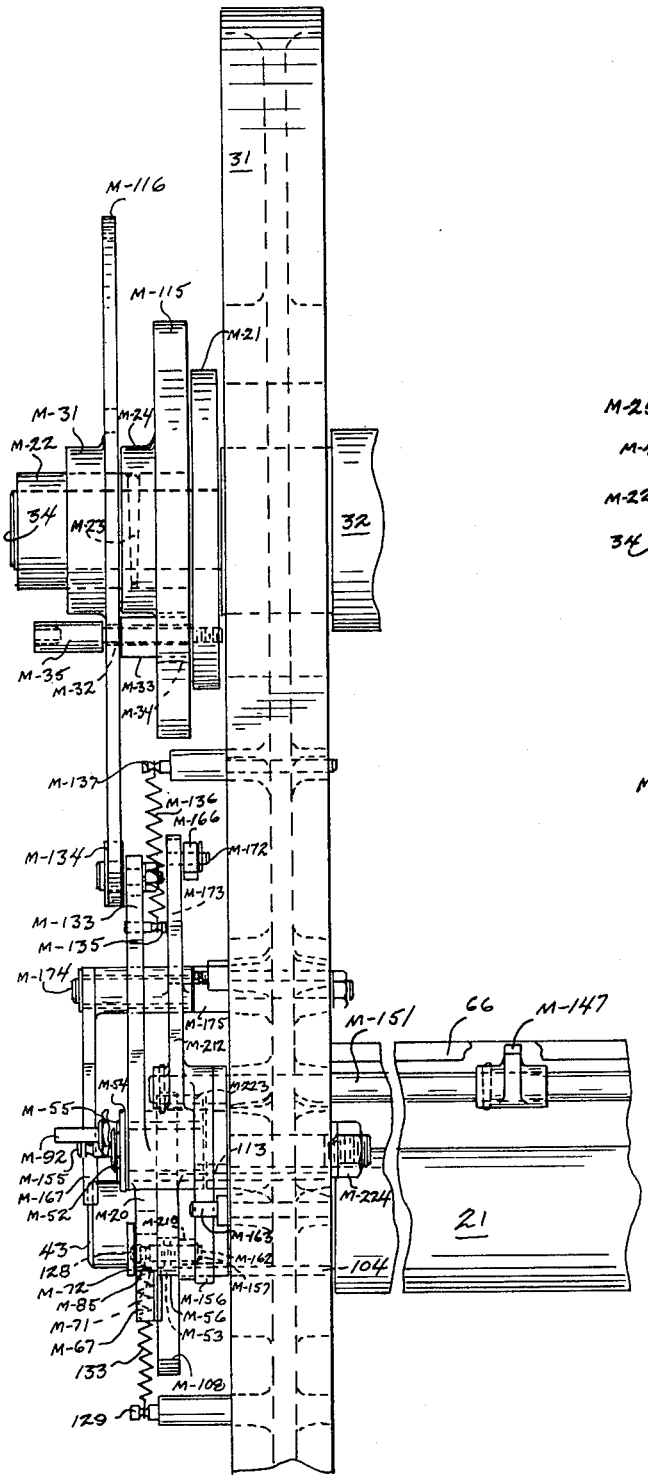
Figure 28:
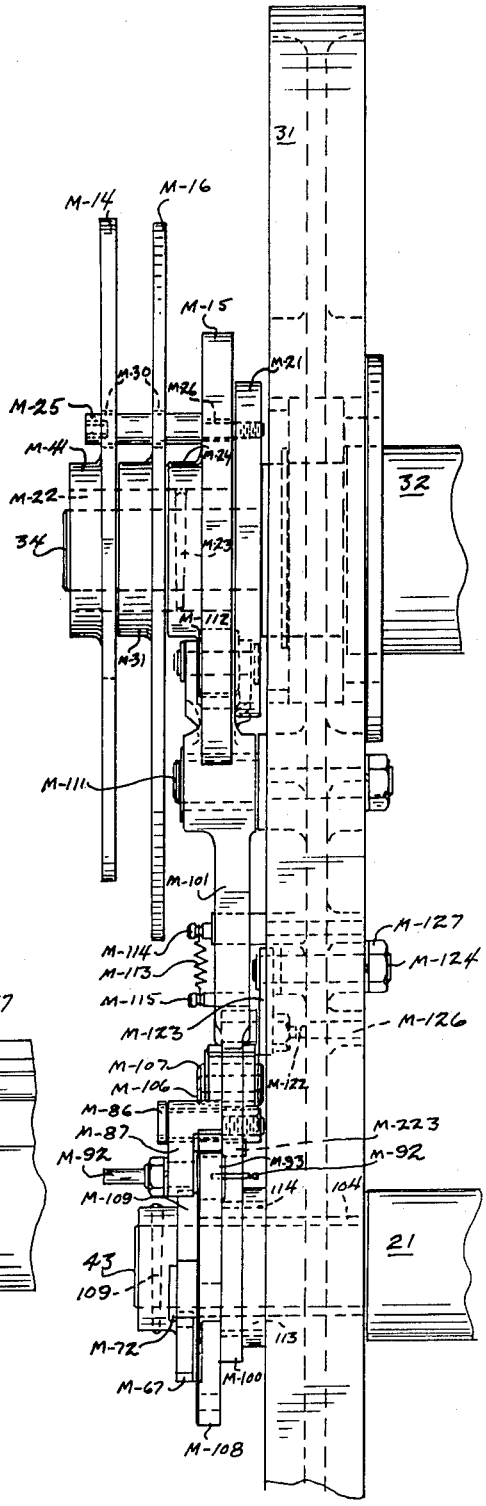
Figure 29:
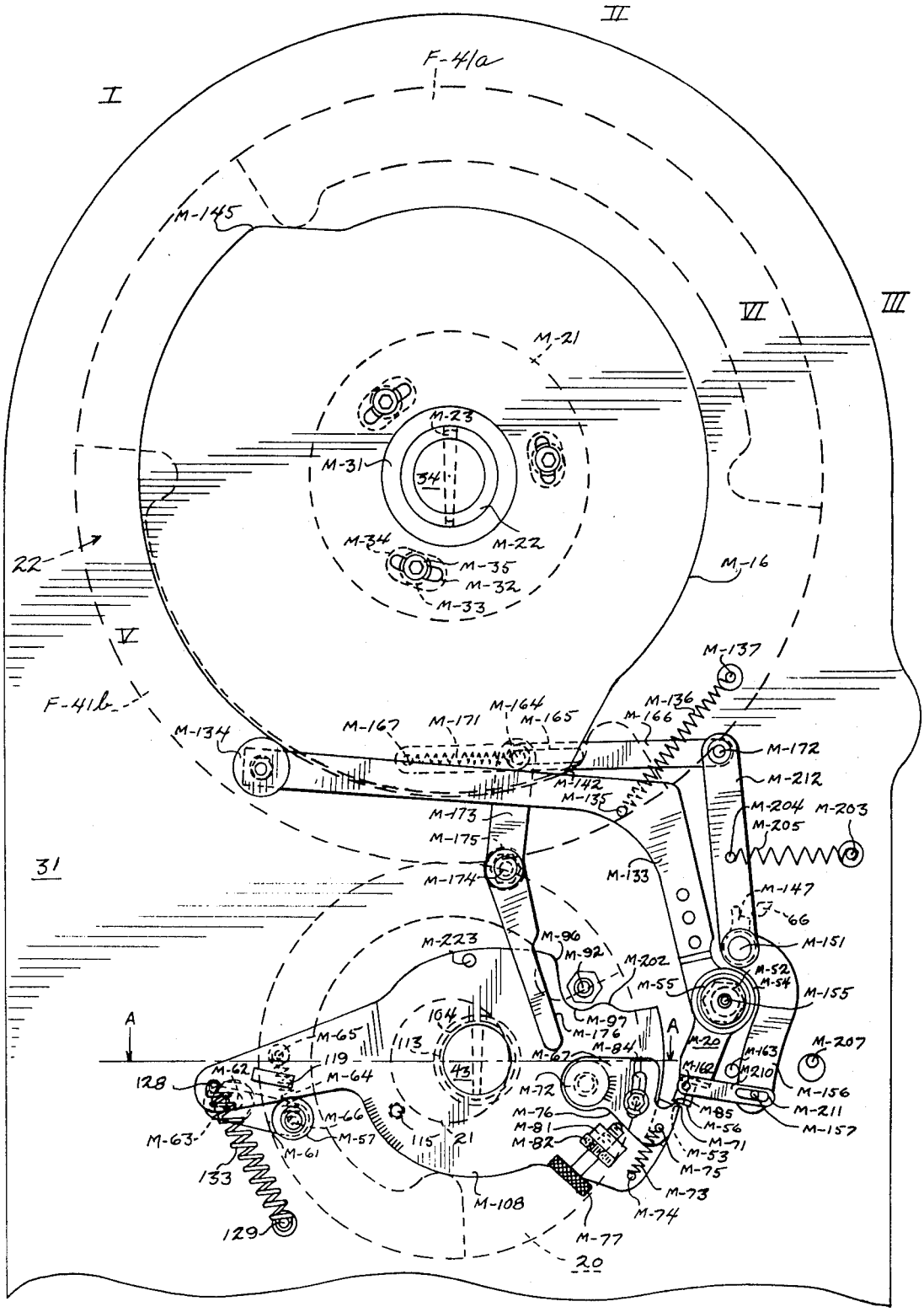
Figures 31, 33:
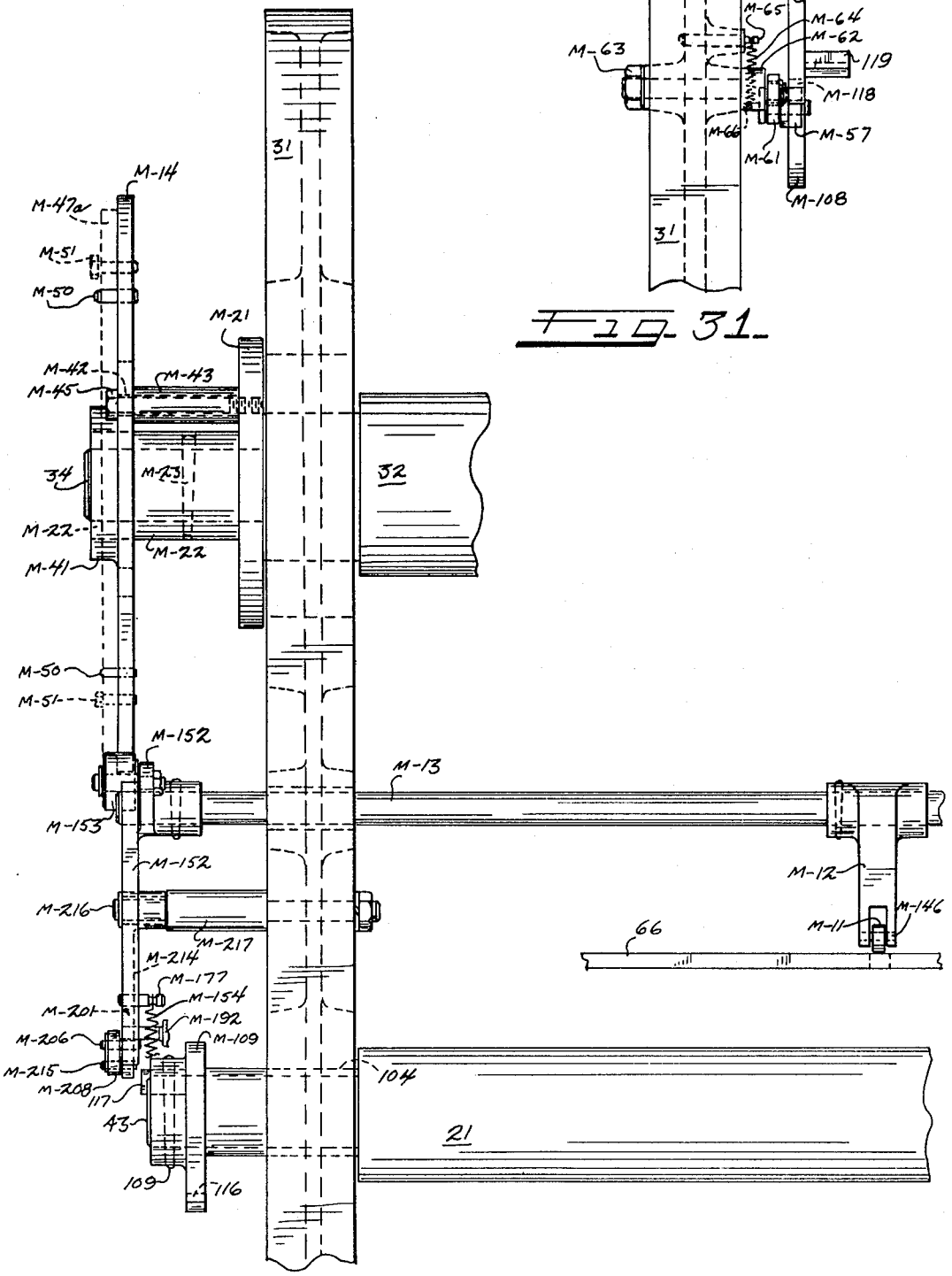
Figure 32:
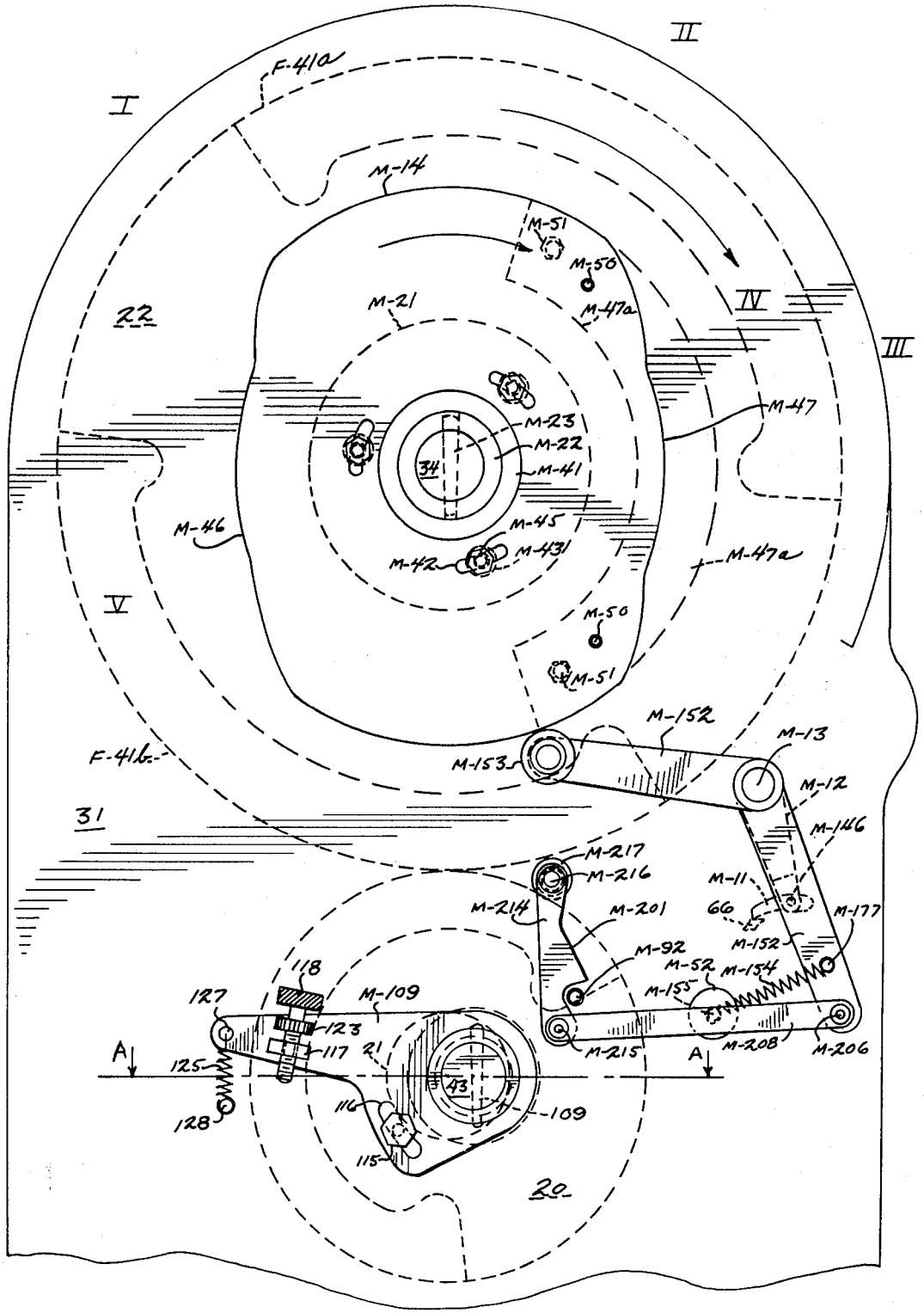
Figure 34:
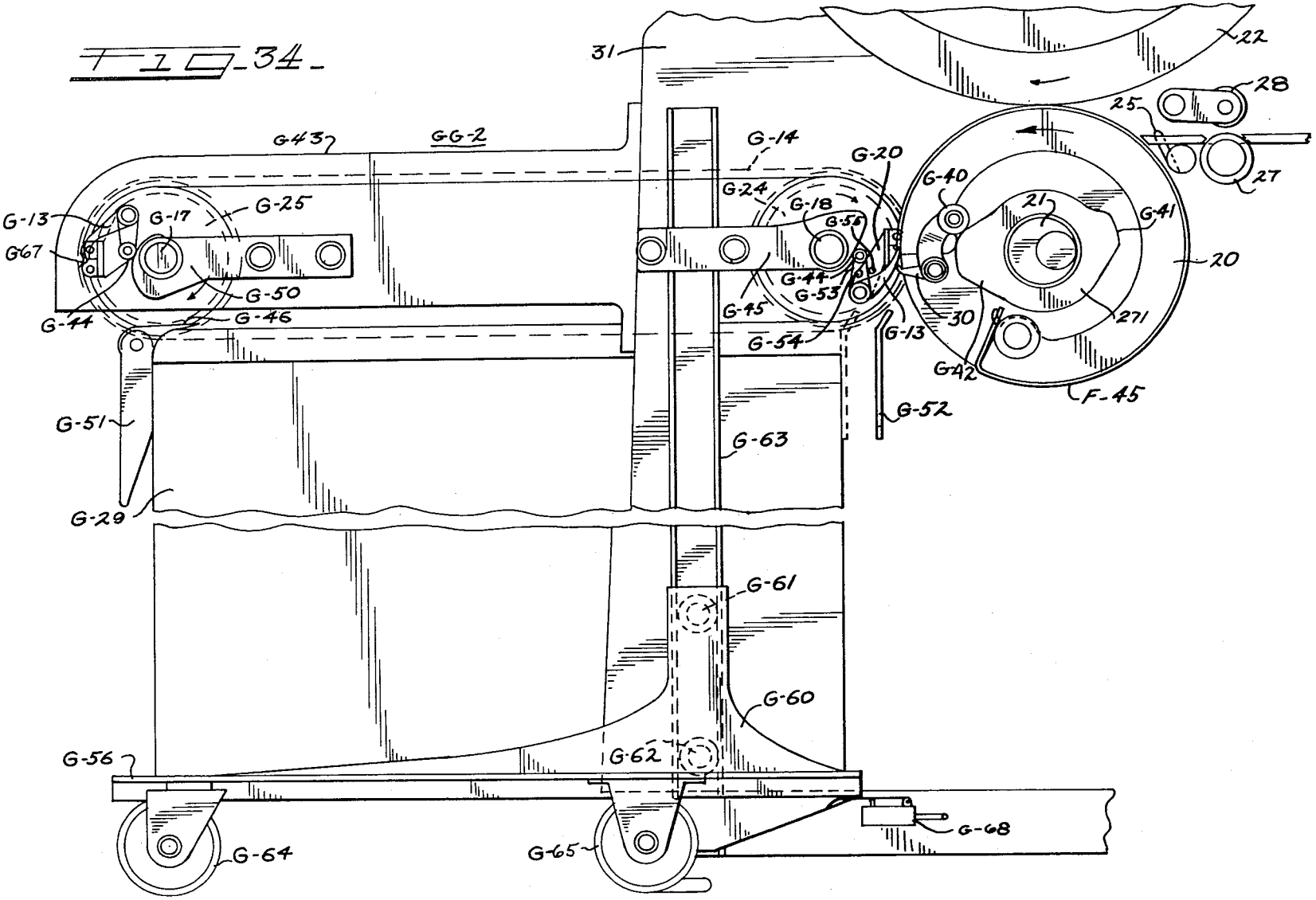
Figures 35, 36:
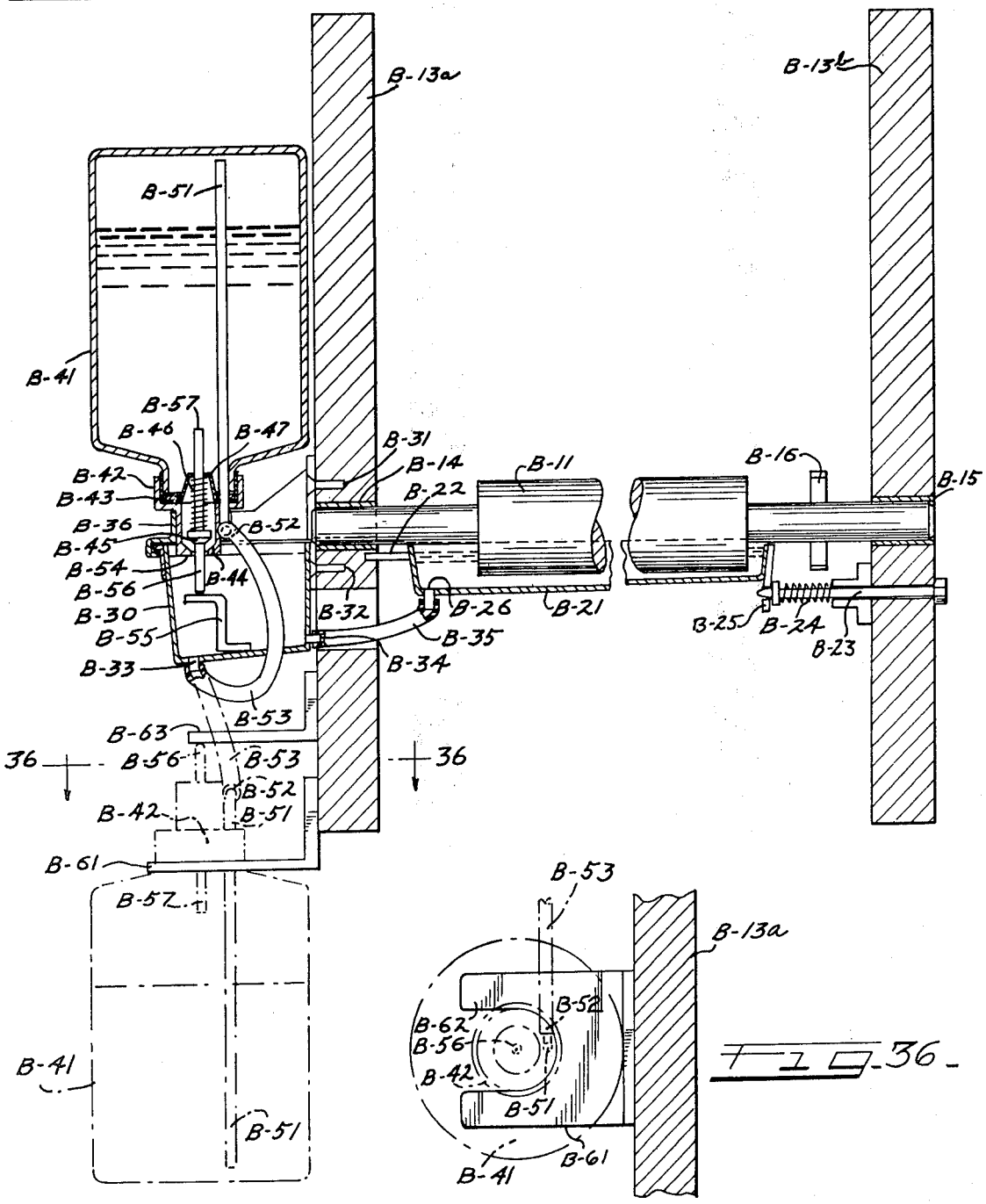
Figure 40B:
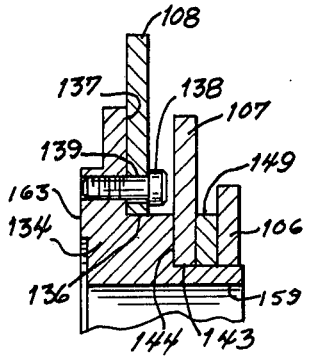
Figure 40A:
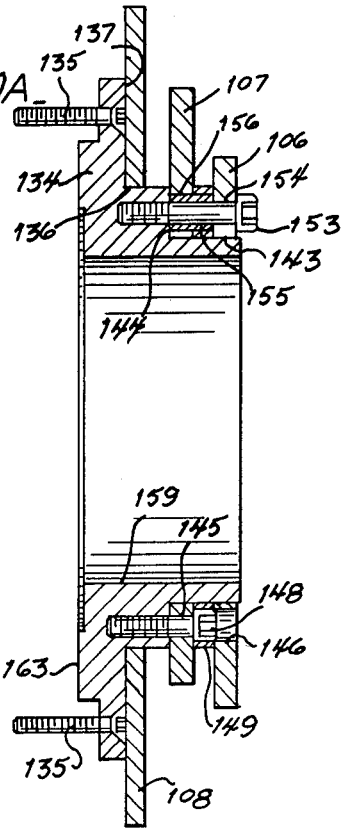
Figure 37:
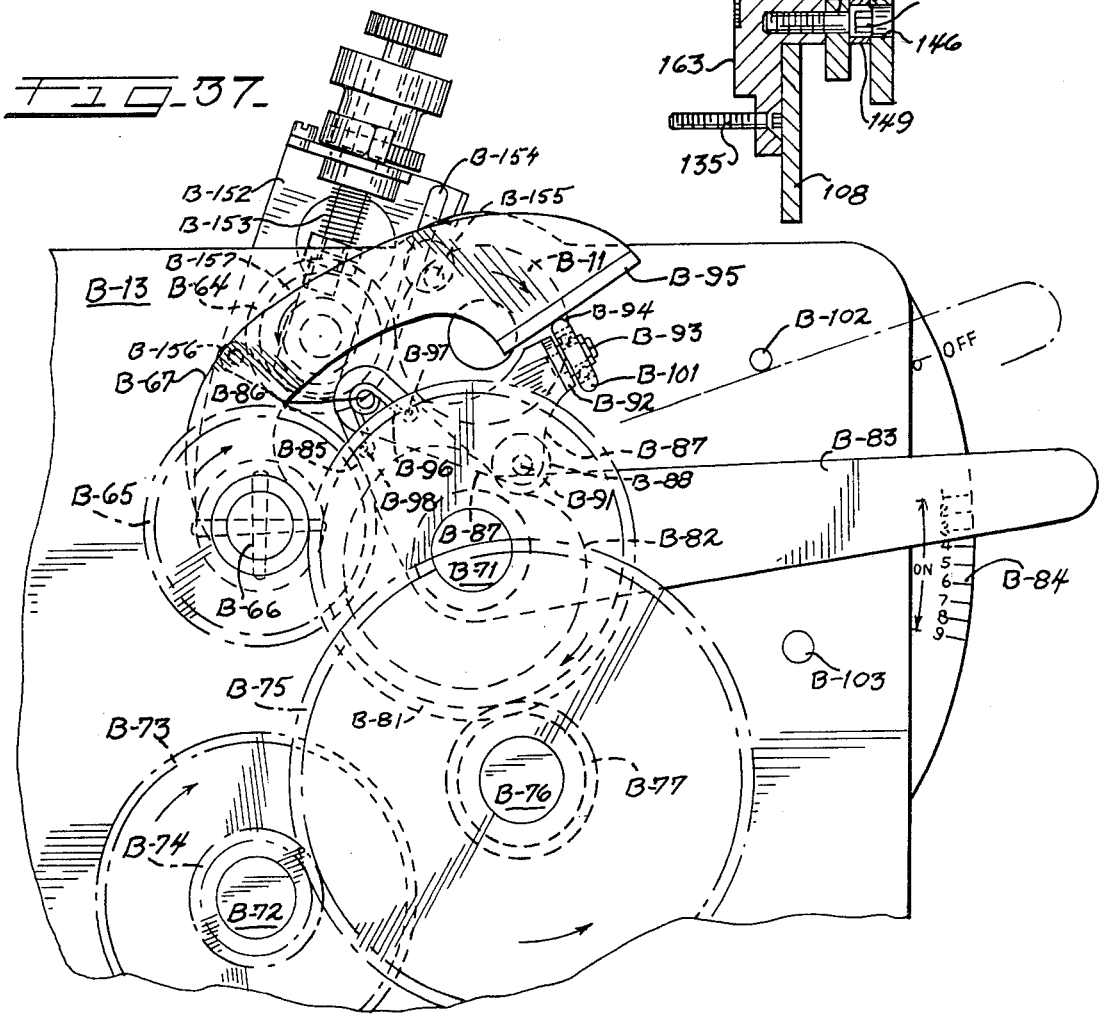
Figure 38:
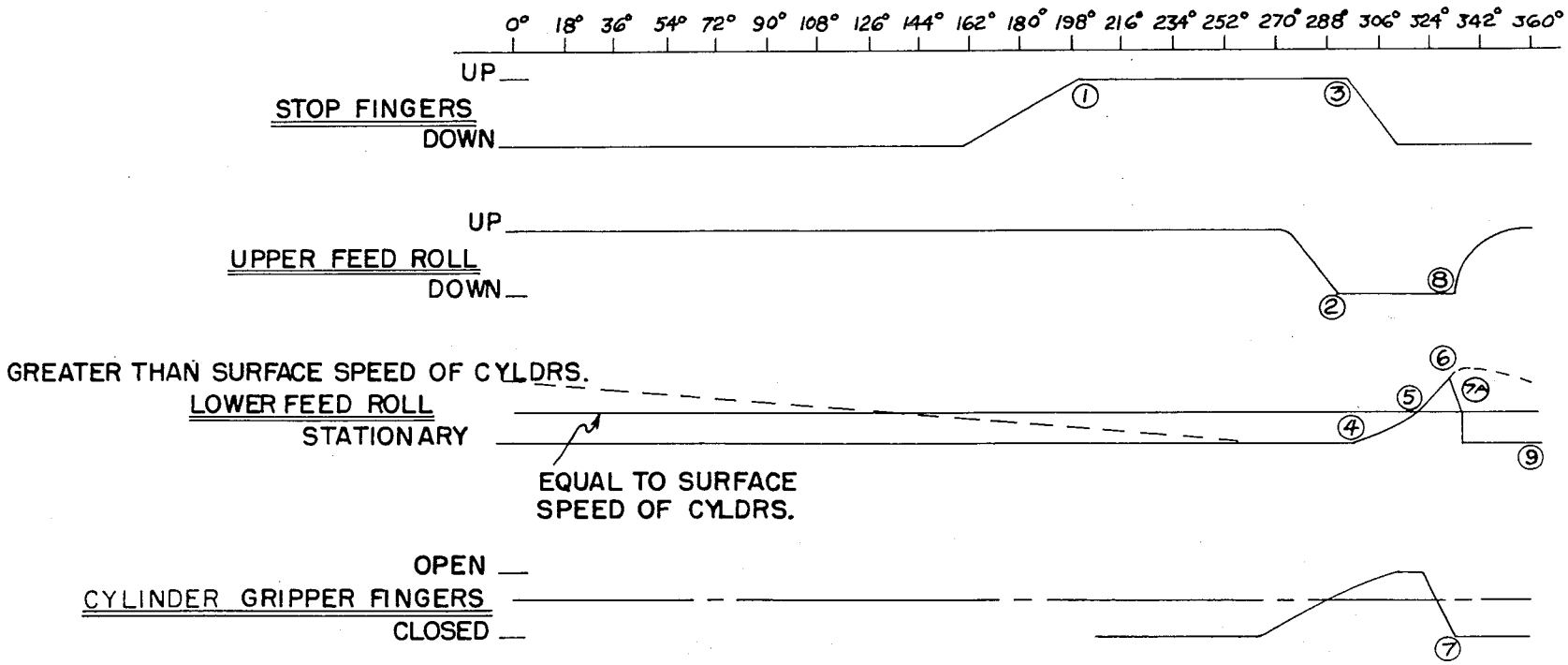
Figure 39:
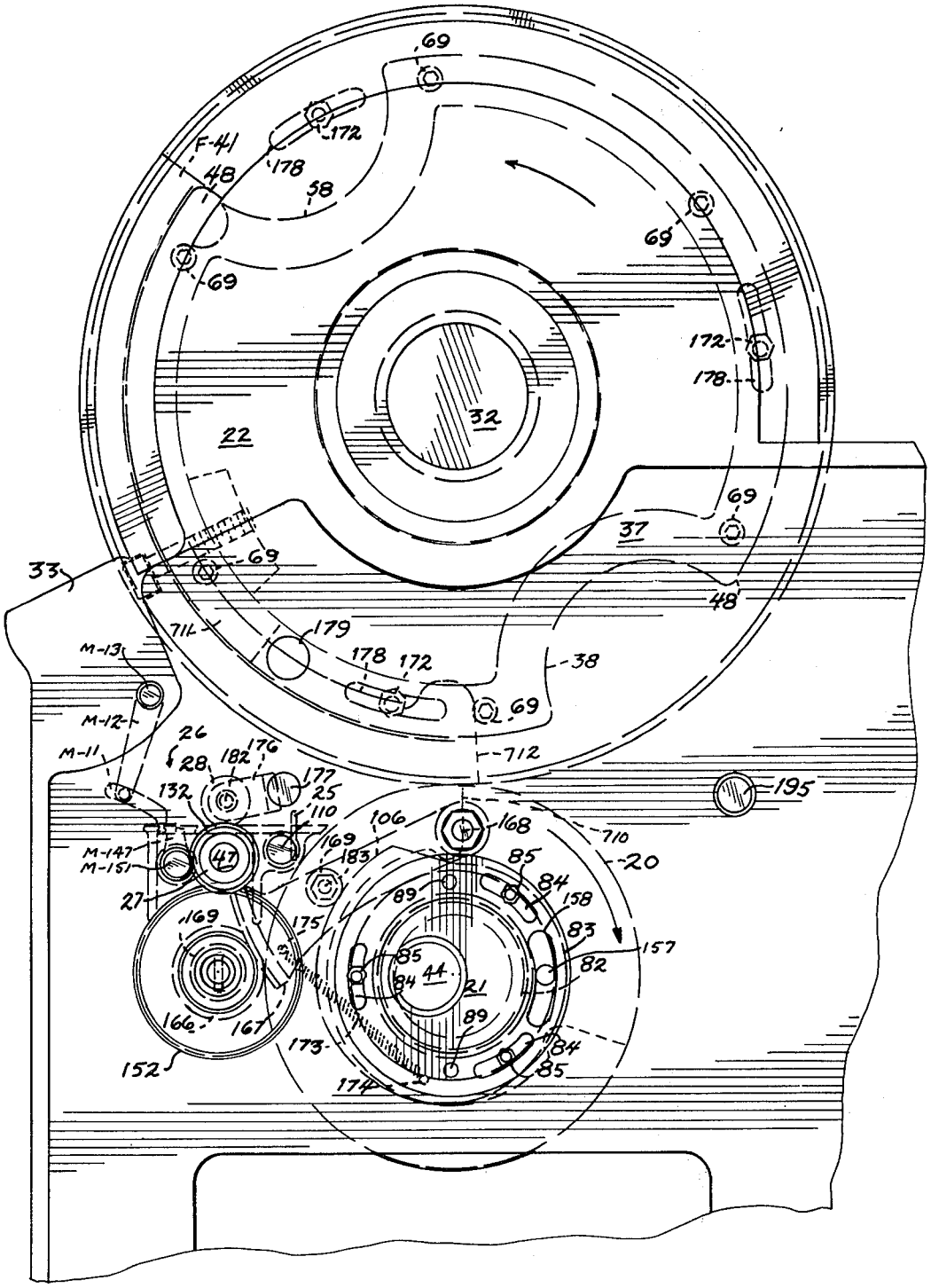
Figure 40:
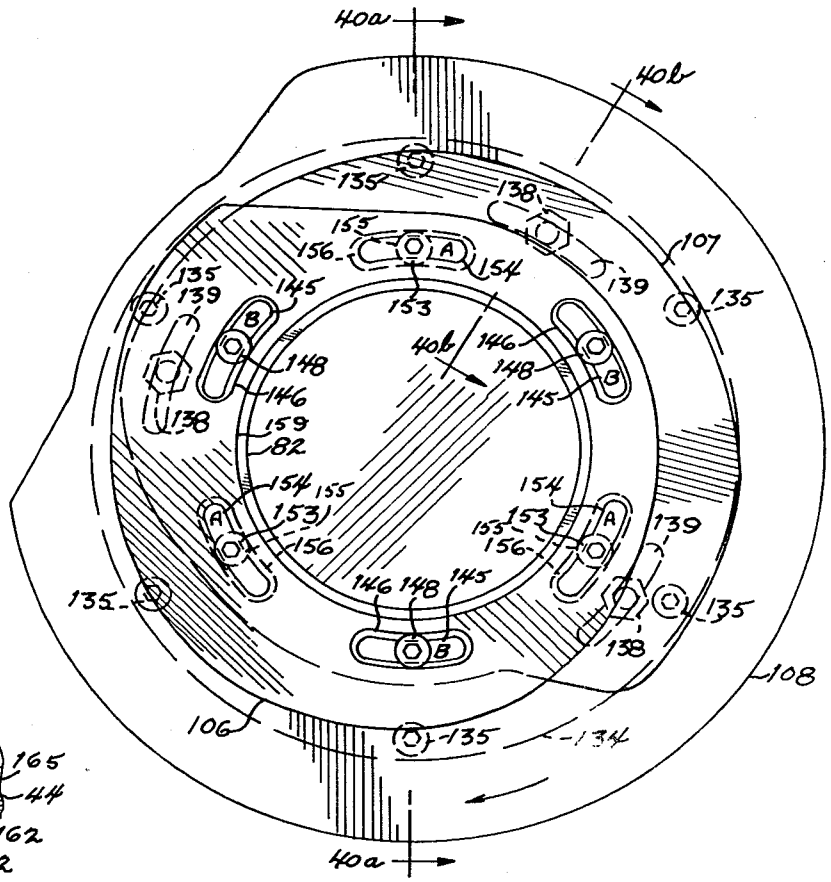
Figure 41:
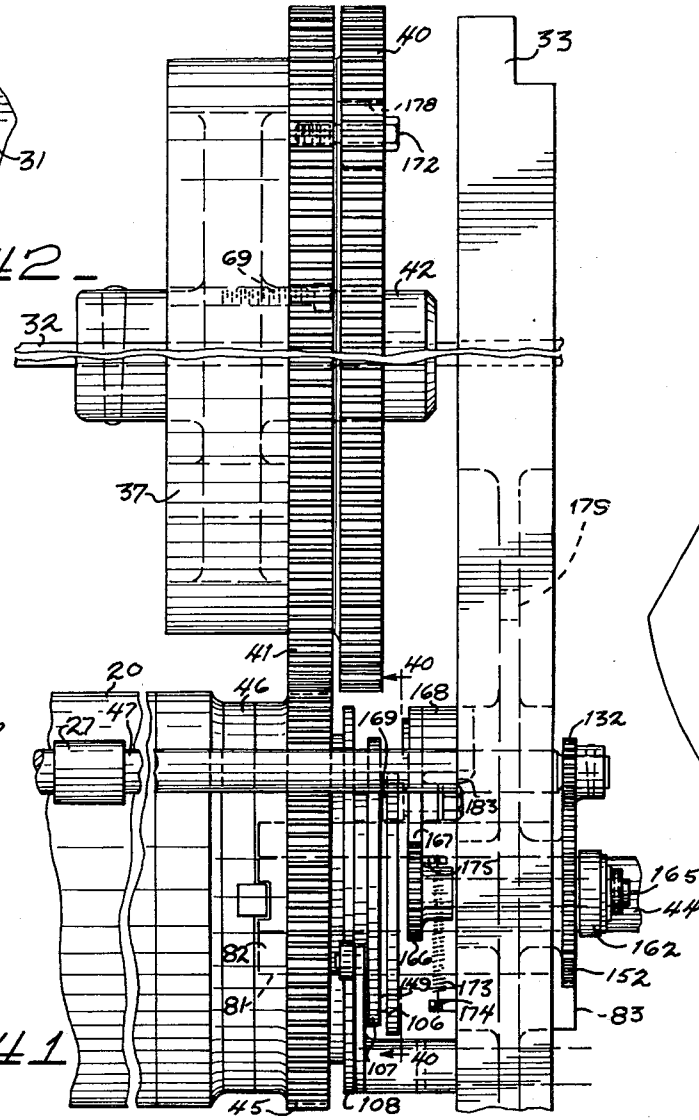
Figure 42:
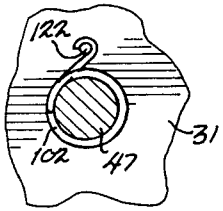
Figure 43:
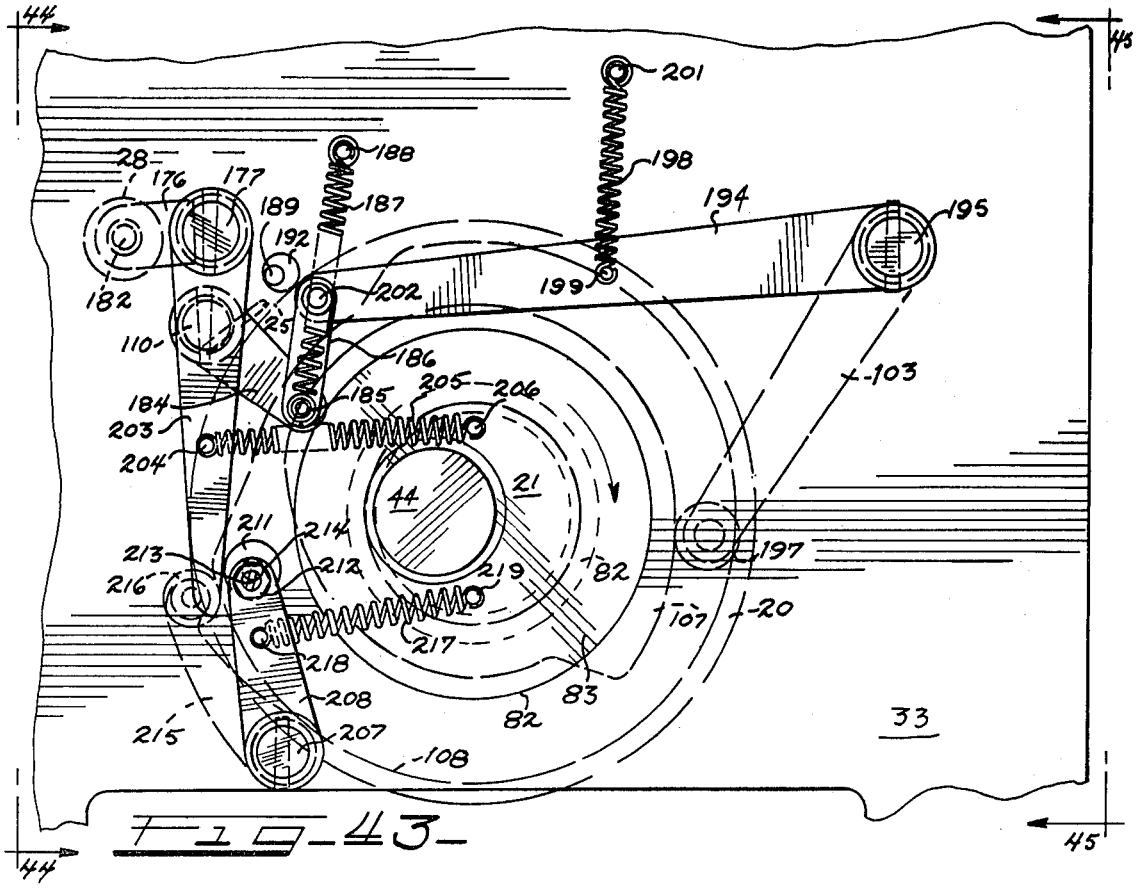
Figure 44:
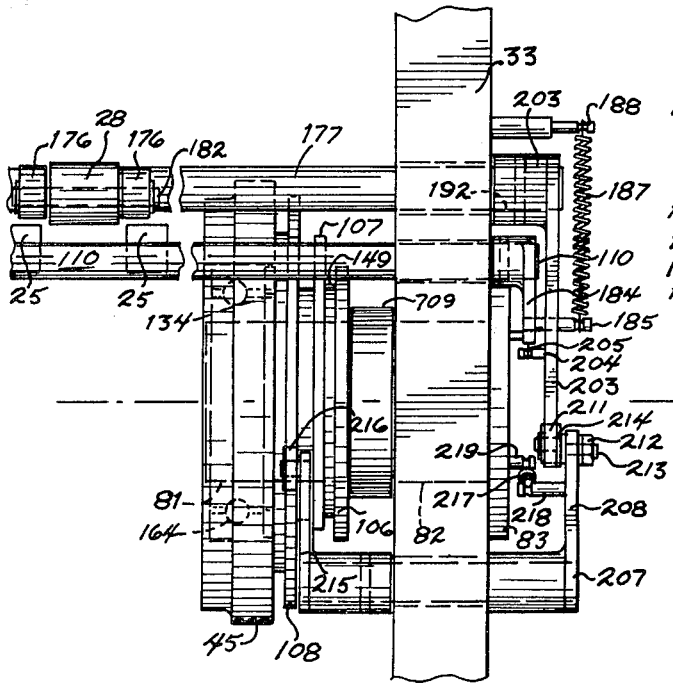
Figure 45:
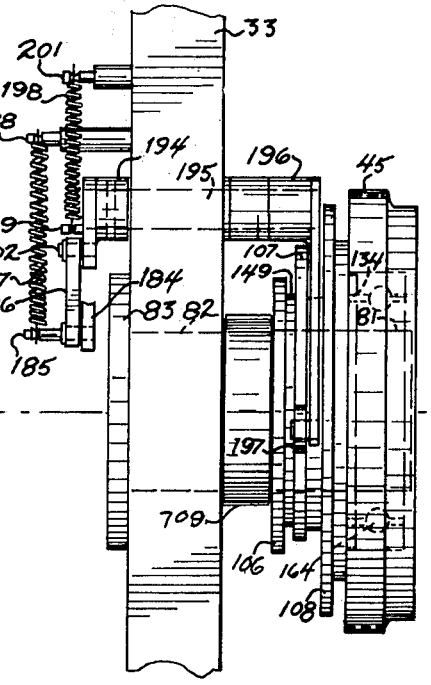
Figure 46:
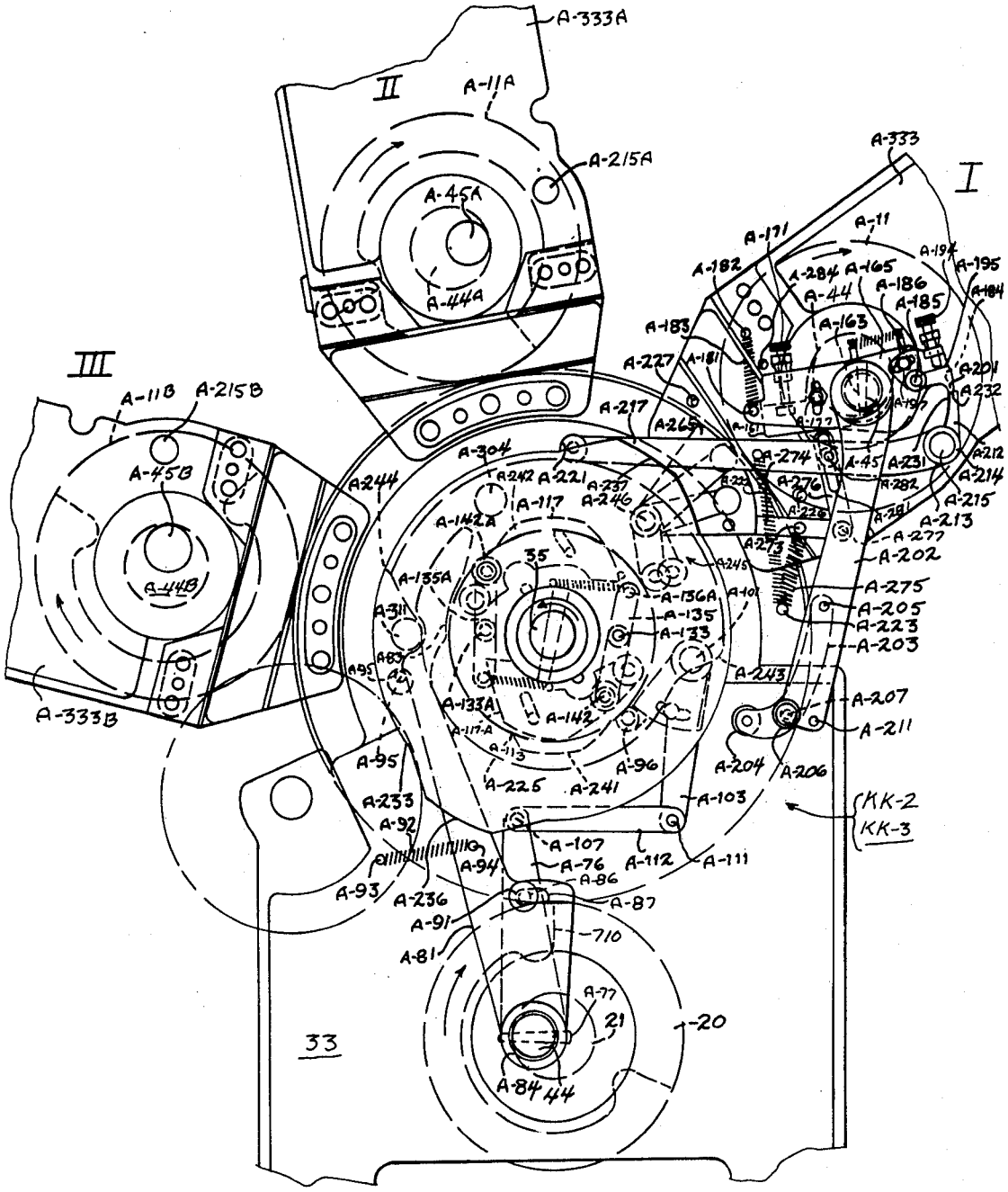
Figure 46A:
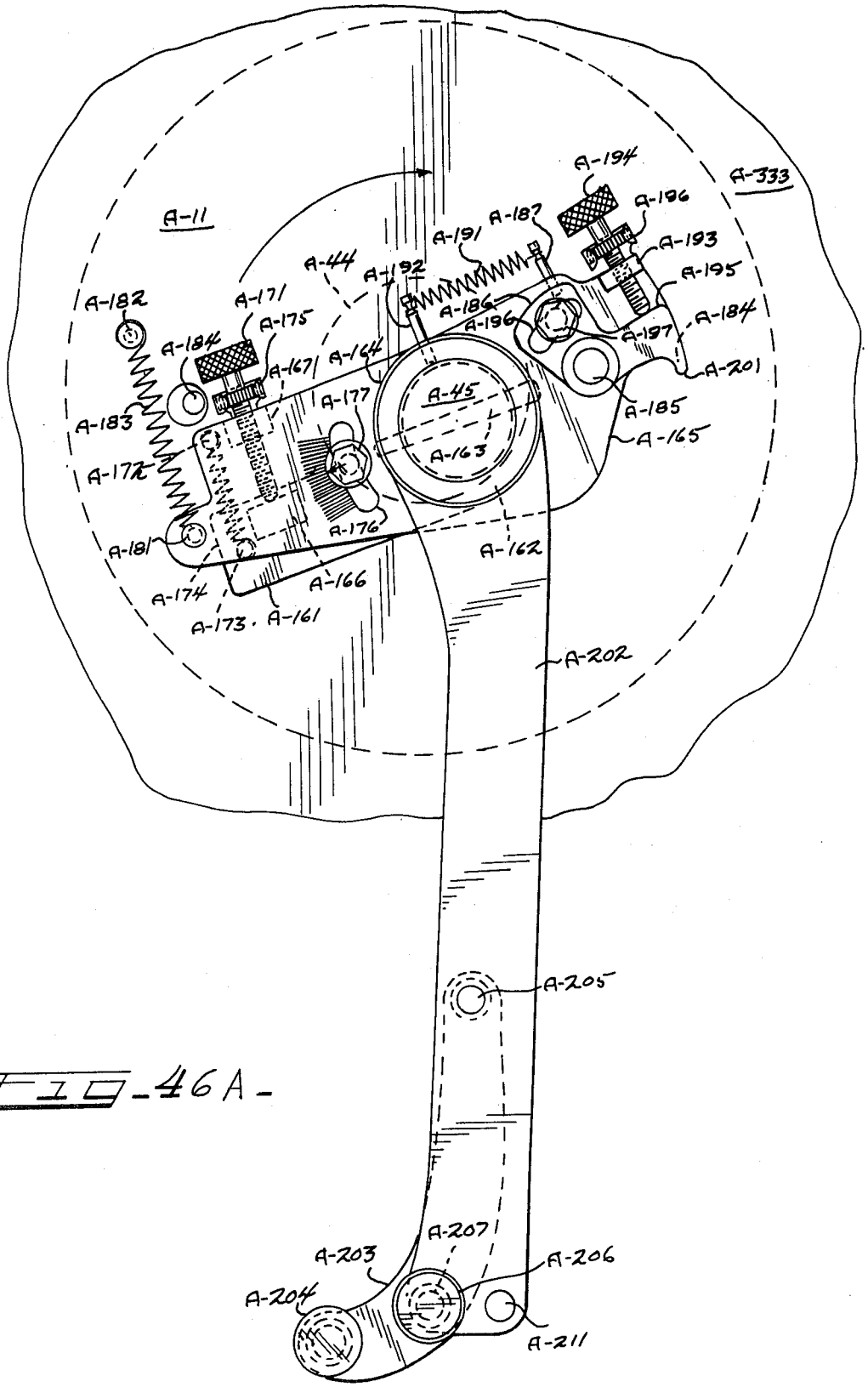
Figure 46C:
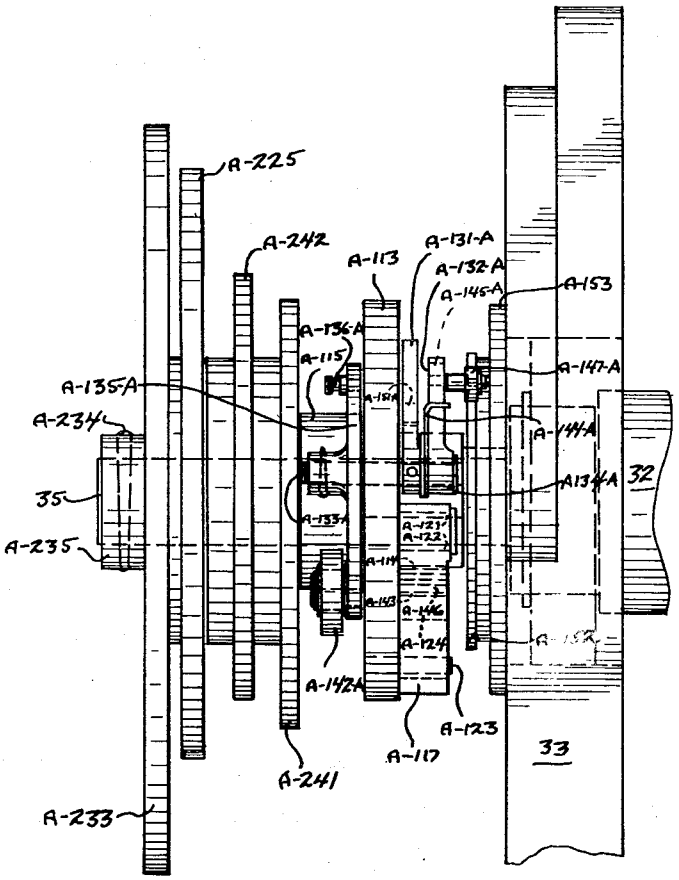
Figure 46B:
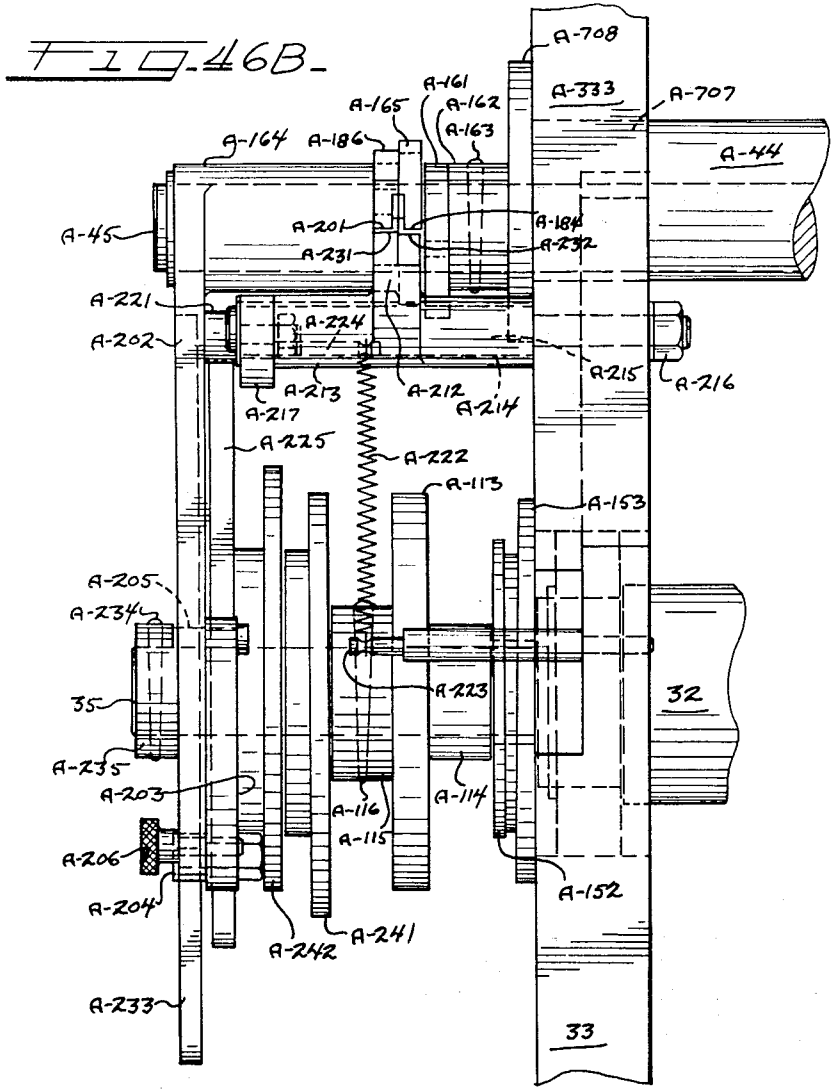
Figure 47:
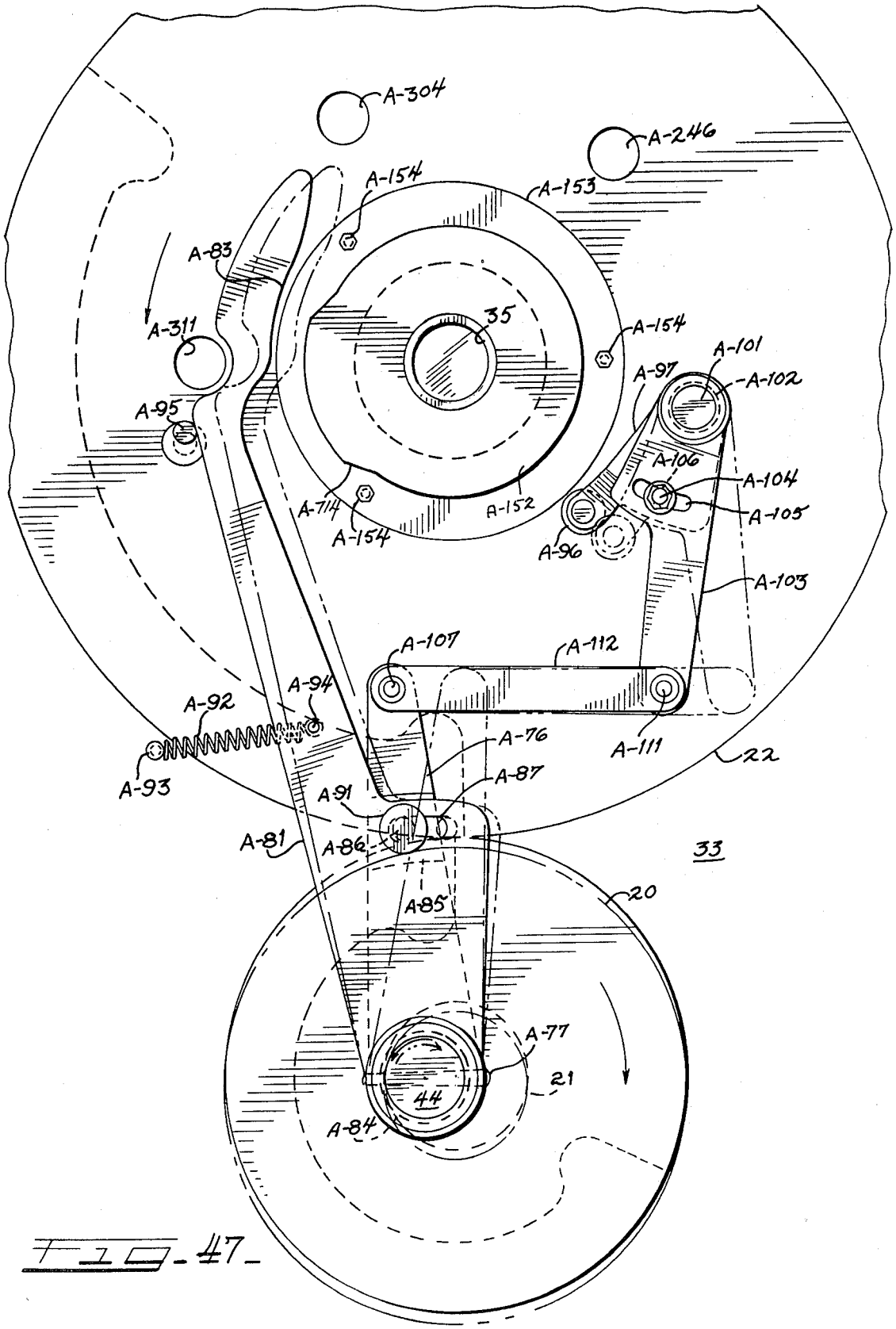
Figure 17:
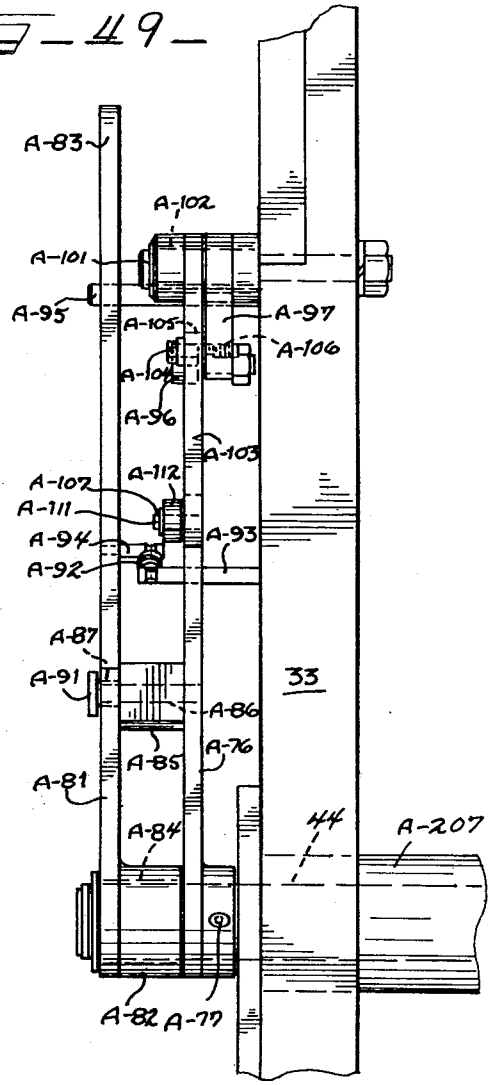
Figure 18:
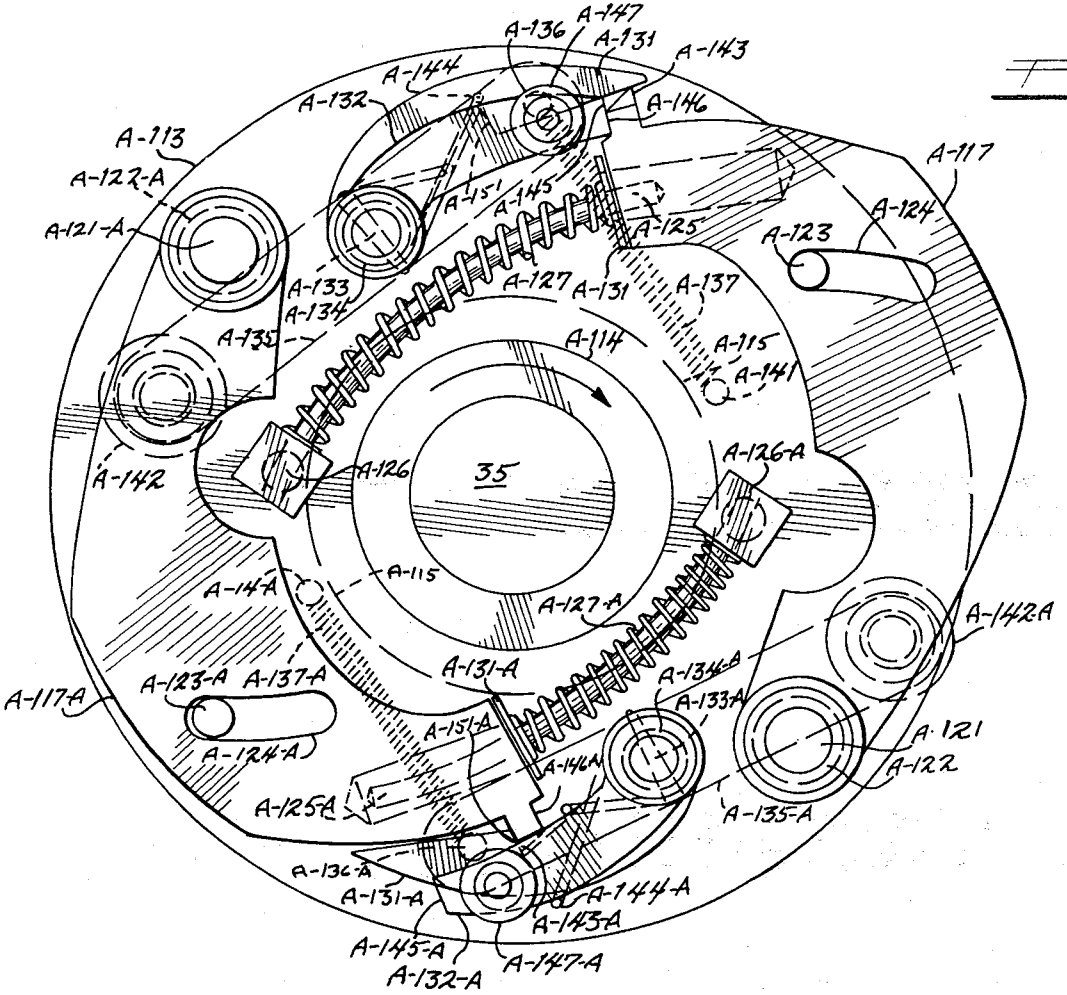
FIG. 18 is an exploded perspective view of a spreader bar showing the detail of attaching the mounting brackets theron.
Figure 53:
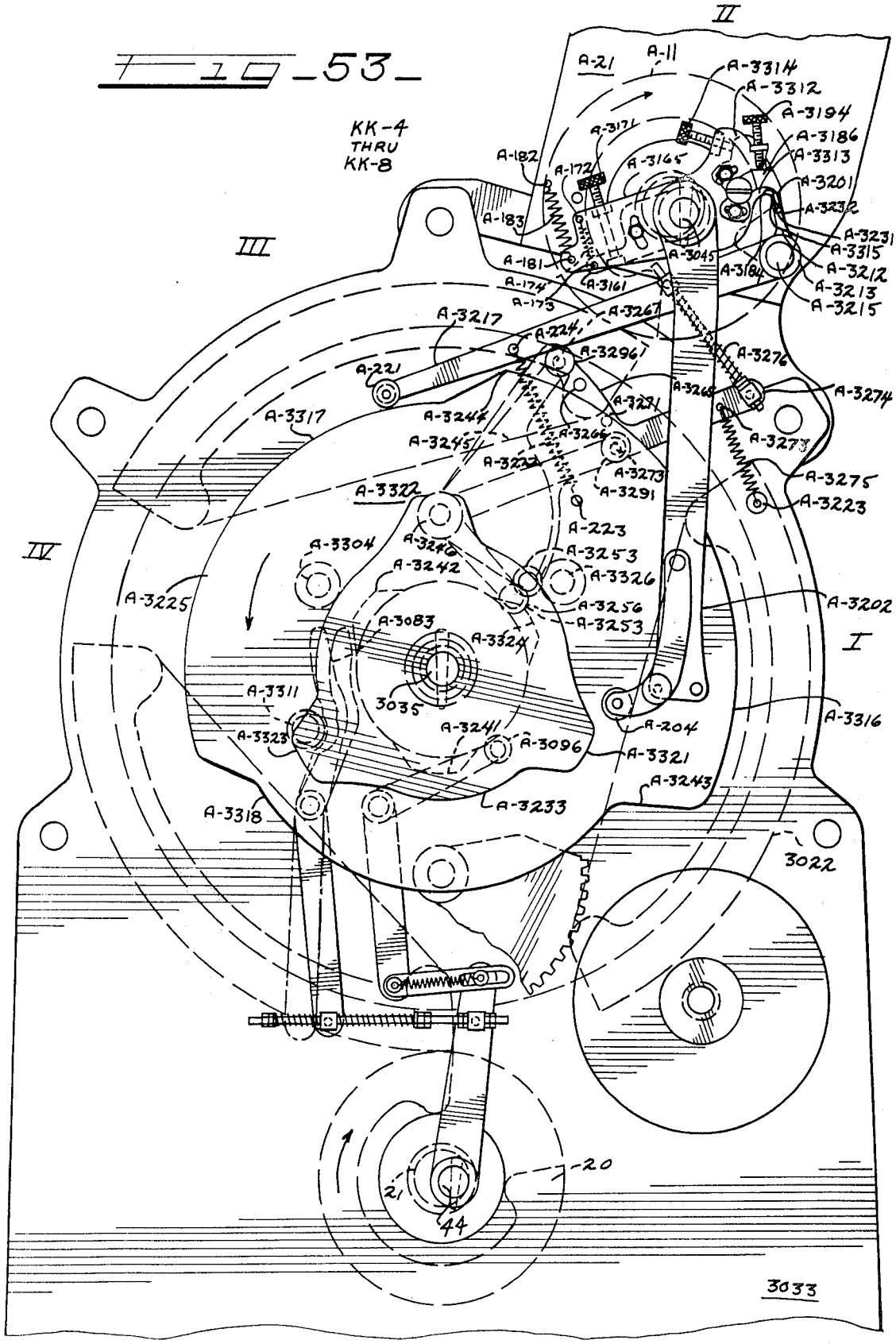
Figures 54, 55:
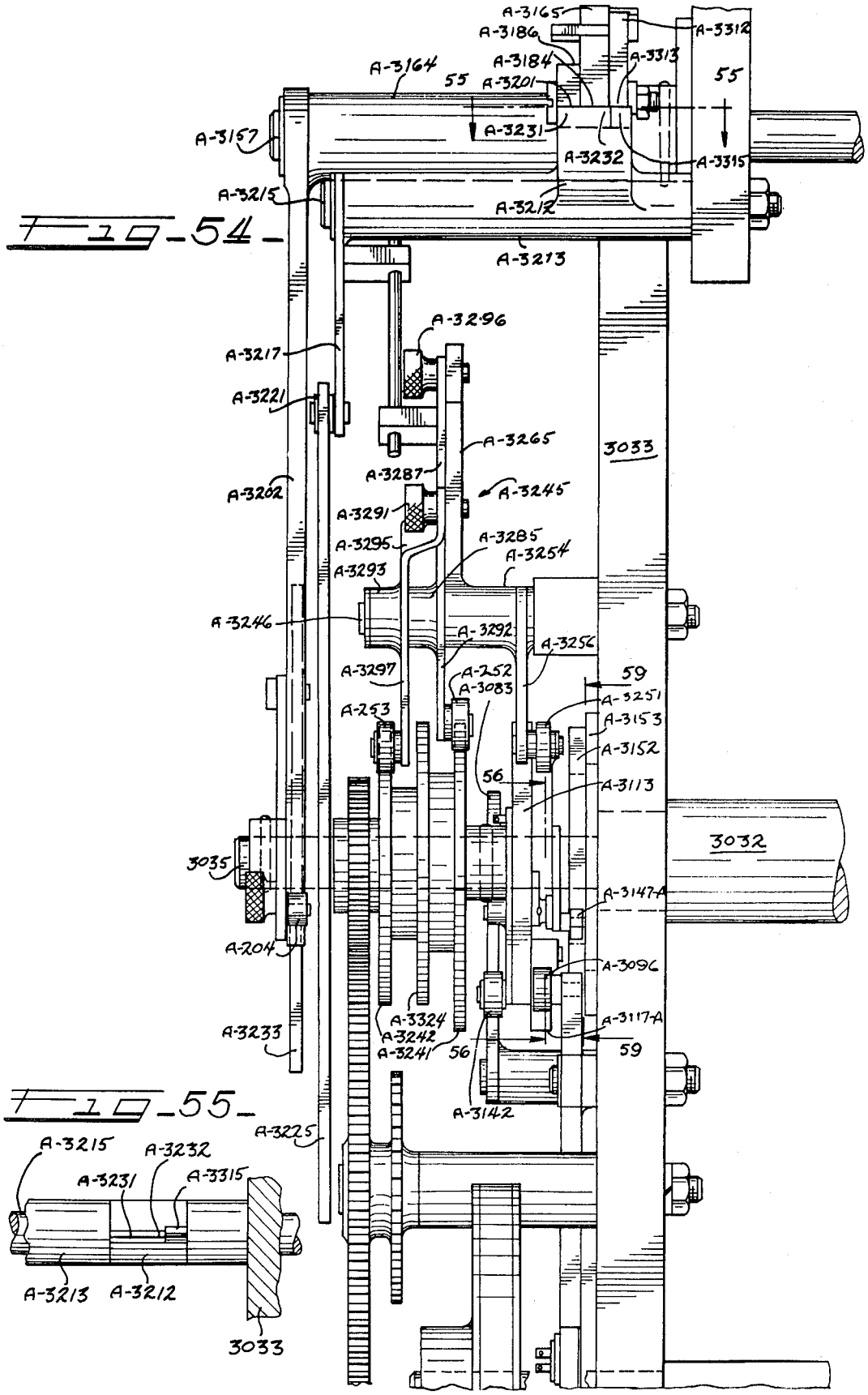
Figure 56:
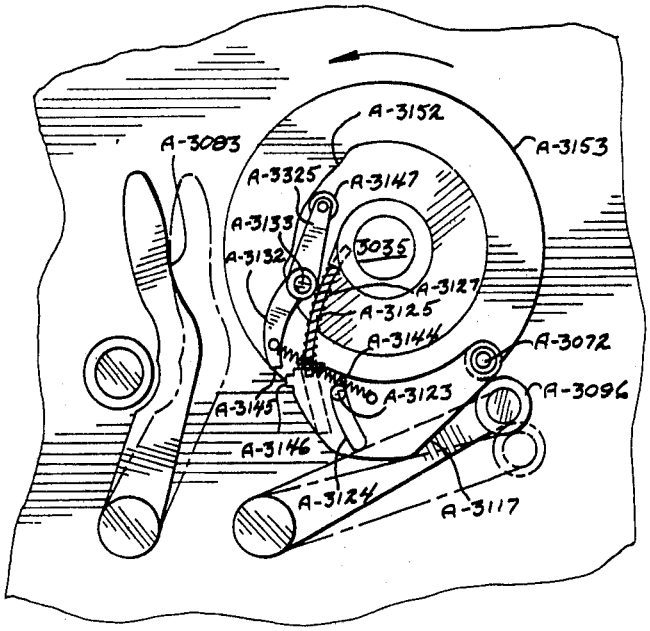
Figure 57:
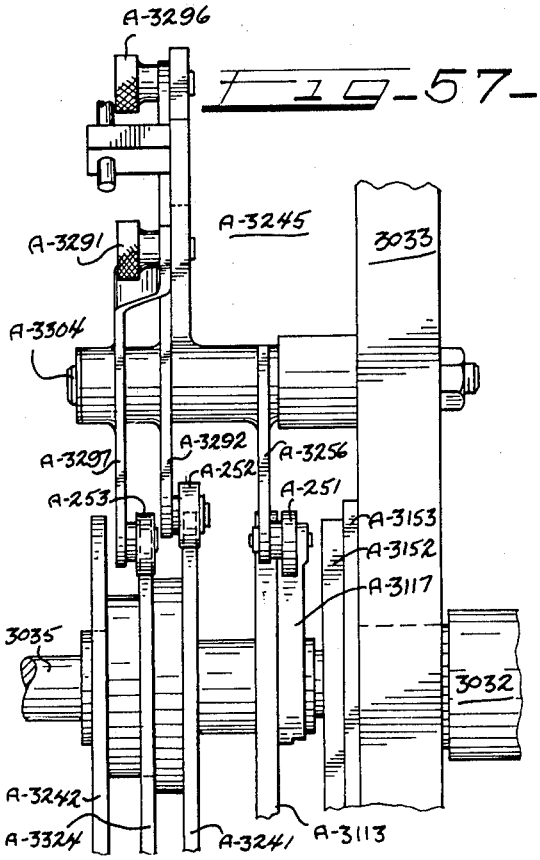
Figure 58:
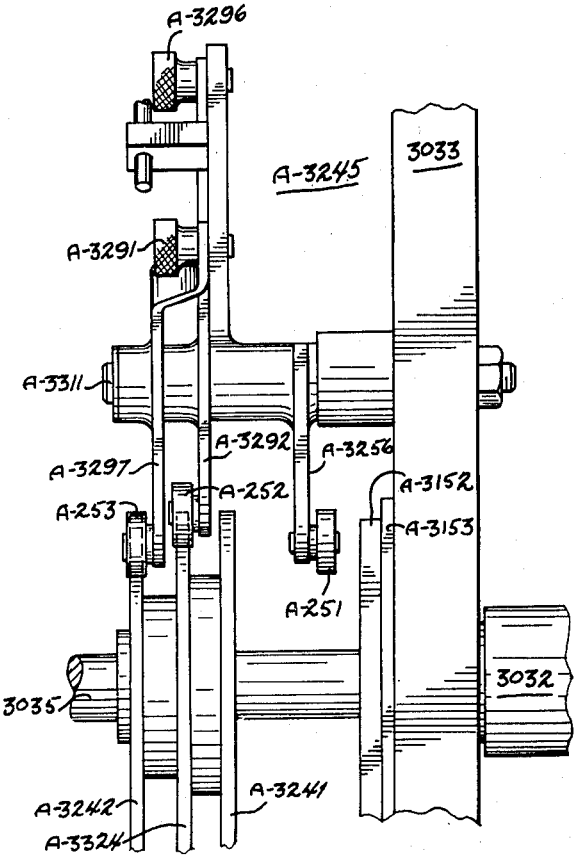
Figure 73:
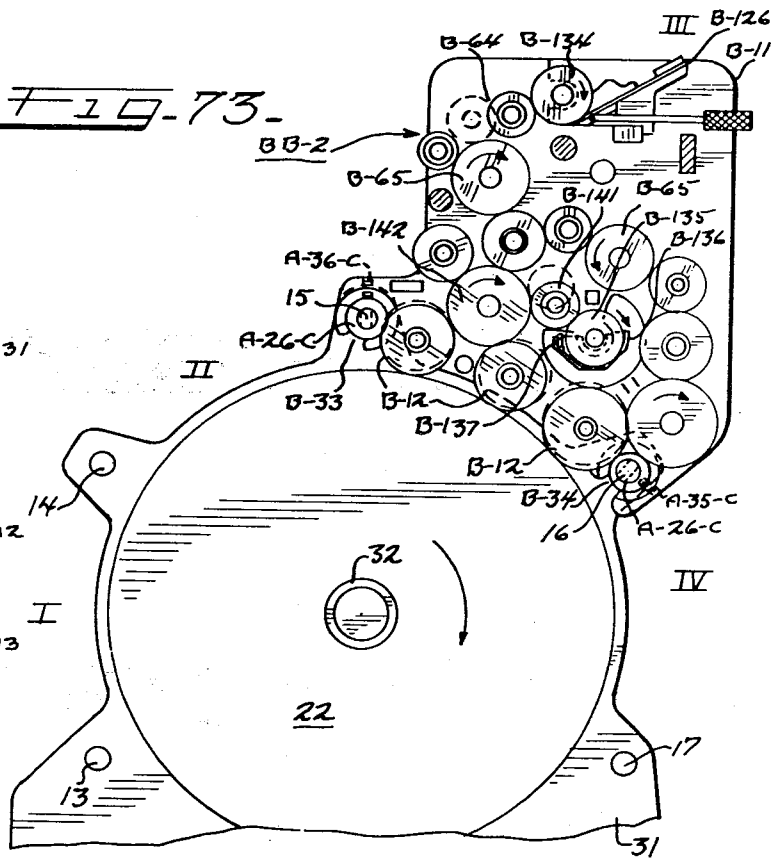
Figure 77:
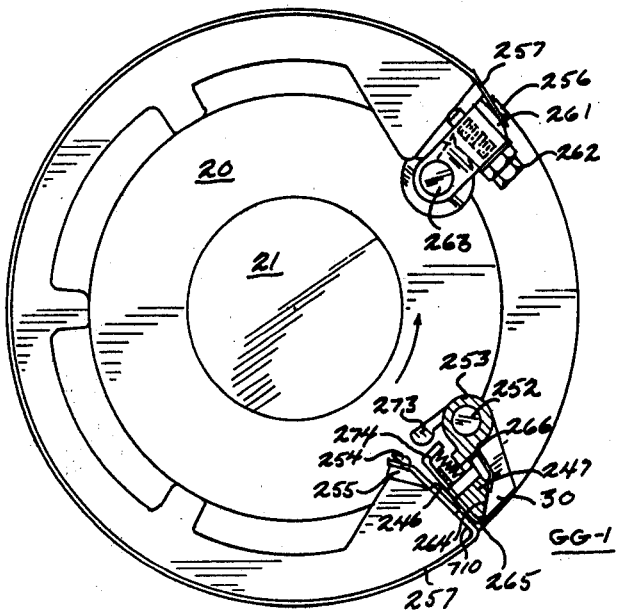
Figure 75:
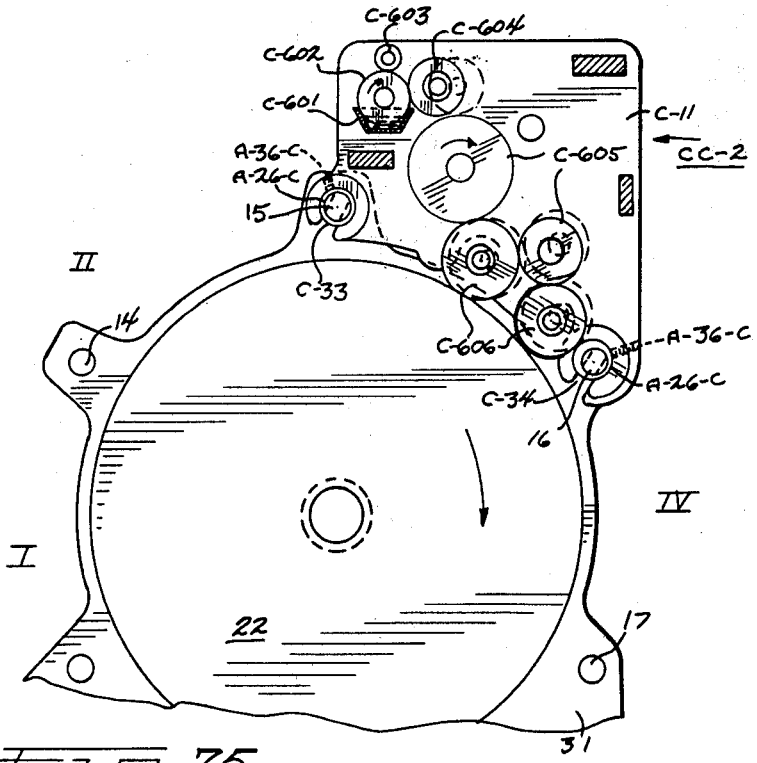

FIGS. 23, 24, and 25 illustrations of the gearing mechanism for the various cylinders comprising views along the lines 23—23, 24—24 and 25—25 of FIG. 26 and showing alternate means by which the drive is transmitted to the large and lower cylinders of the press and to the plate cylinders;

FIG. 26 shows the mounting mechanism for the large cylinder, the lower cylinder and a plate cylinder as seen from outside the press main frame;

FIG. 27 is an illustration of the sheet detecting and cylinder latching mechanisms and shows the mechanisms as viewed from the front side of the press;

FIG. 27*b* is a view to larger scale of a portion of the mechanism seen in FIG. 27, and shows the mechanism as it appears when the cylinders are unlatched;

FIG. 28 is a side view of a portion of the mechanism of FIG. 27;

FIG. 29 is a view from the front side of the press shoing a portion of the sheet detecting and cylinder latching mechanism of FIG. 27;

FIG. 30 is a side view of the mechansim shown in FIG. 29 and also including some additional elements from FIG. 27;

FIG. 31 is a view from the left side of FIG. 29 showing a portion of that mechanism;

FIG. 32 is another view from the front side of the press showing another portion of the mechanism of FIG. 27;

FIG. 33 is a side view of the mechanism of FIG. 32;

FIG. 27*a*, 29*a* and 32*a* are cross-sectional views taken along the lines A—A of FIG. 27, 29 and 32 respectively;

FIG. 34 is an illustration of one form of the chain delivery mechanism and a receding pile stacker;

FIG. 35 is a sectional view showing the dampening fountain tray and the arrangement for maintaining the fluid at a constant level, and for draining the fountain tray and storing the fluid when the press is not in use;

FIG. 36 is a detail view of the bottle mounting bracket used for the storage position;

FIG. 37 illustrates one embodiment of the ink ductor roller mounting and control mechanism;

FIG. 38 is a timing diagram showing the sequence of action of the stop fingers, upper and lower feed rolls, and gripper fingers;

FIG. 39 is a general view of the right hand side of the 2R press, including stop fingers, the upper and lower feed rolls and the sheet detector;

FIG. 40*a* is a sectional view taken on the line 40–40*a* of FIG. 40 showing the cam attachment;

FIG. 40*b* is a detail view also showing the cam attachment taken on line 40*b*–40*b* of FIG. 40;

FIG. 41 is a side view of the press as shown in FIG. 39 and showing the cams illustrated in FIG. 40;

FIG. 42 is a detail sectional view taken on the line 42—42 of FIG. 41;

FIG. 43 is a view of the stop finger control mechanism and the upper feed roll control mechanism;

FIG. 44 is a side view of the stop finger control and upper feed roll control mechanism illustrated in FIG. 43;

FIG. 45 also is a side view of the control mechanims but taken from the opposite side of FIG. 43 from that shown in FIG. 44;

FIG. 46 shows the right hand side of the 2R press with three plate cylinder modules mounted in three module mounting stations, and shows the mechanism by which the latching and unlatching and the pressure adjustment of a plate cylinder is controlled;

FIG. 46*a* is a more detailed view of a portion of the plate cylinder latching and pressure control mechanism of FIG. 46;

FIG. 46*b* and 46*c* are side elevational views of a portion of the mechanism shown in FIG. 46;

FIG. 47 is a side view of a portion of the mechanism, for controlling the latching of the plate cylinders;

FIG. 48 is a side view in detail showing a portion of the plate cylinder latching mechanism;

FIG. 49 is a side elevational view of the mechanism shown in FIG. 47;

FIG. 50, 51, and 52 are top, end and elevational views illustrating the details of a portion of the control device for the latching and unlatching mechanism, for the plate cylinders:

FIG. 53 is an elevational view of the plate cylinder latching and pressure adjusting mechanism for a 3R press;

FIG. 54 is an edge elevational view of the mechanism illustrated in FIG. 53;

FIG. 55 is a detail view partially in section taken on the line 55—55 of FIG. 54;

FIG. 56 is an enlarged detail view of a portion of the latching control mechanism shown on the 3R model;

FIG. 57 is an edge elevational view of one setting of the cams and follower mechanism for control of a plate cylinder on the 3R model;

FIG. 58 is similar to FIG. 57 but shows another setting of the controls for a plate cylinder on the 3R model;

FIGS. 59, 60, 61, 62, and 63 are detail views of the latching control mechanism on a 3R press corresponding to similar mechanism on a 2R press;

FIGS. 64 through 72 illustrate typical configurations of the preferred form of the 2R press showing various combinations of standard plate cylinder modules and standard inking modules assembled with auxiliary ink attachments and with and without dampening attachments and mounted at various of the module mounting stations of the basic 2R frame structure to form a variety of 2R press models;

FIG. 73 is a view showing a combined inking and dampening module mounted in a mounting station, of the 2R press configuration of FIGS. 11 and 13;

FIG. 74 is a view similar to FIG. 73 but showing an inking module;

FIG. 75 also is a view similar to FIGS. 73 and 74 but shows a separate dampening module;

FIG. 76 is a view showing the cylinder grippers and ejector fingers, with the grippers indicated by means of phantom lines in two additional operative positions; FIG. 77 also shows the cylinder gripper mechanism, but this view shows the attachment of the leading and trailing edges of a blanket to the lower printing cylinder.

Figure 116A:
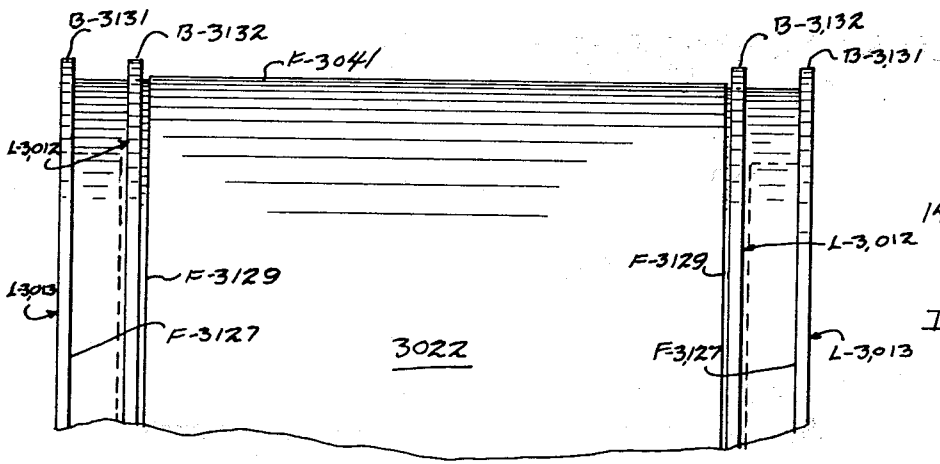
Figure 78:
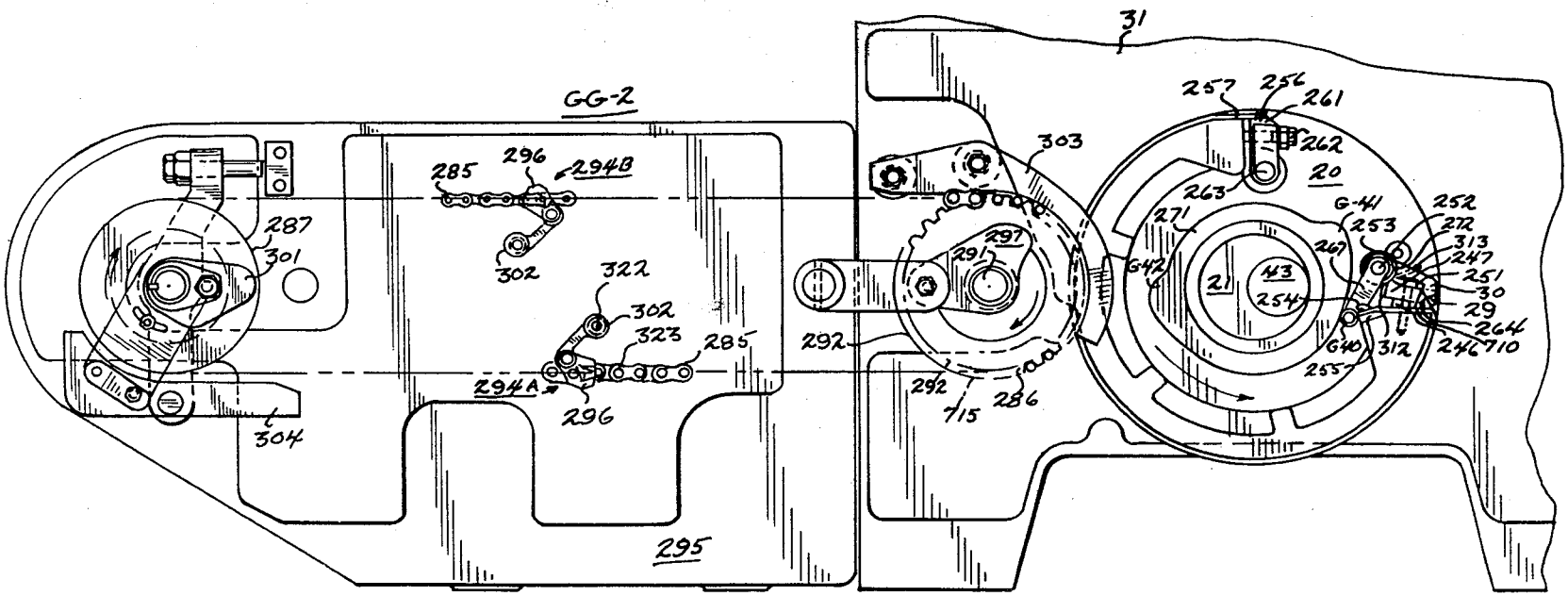
Figure 79A:
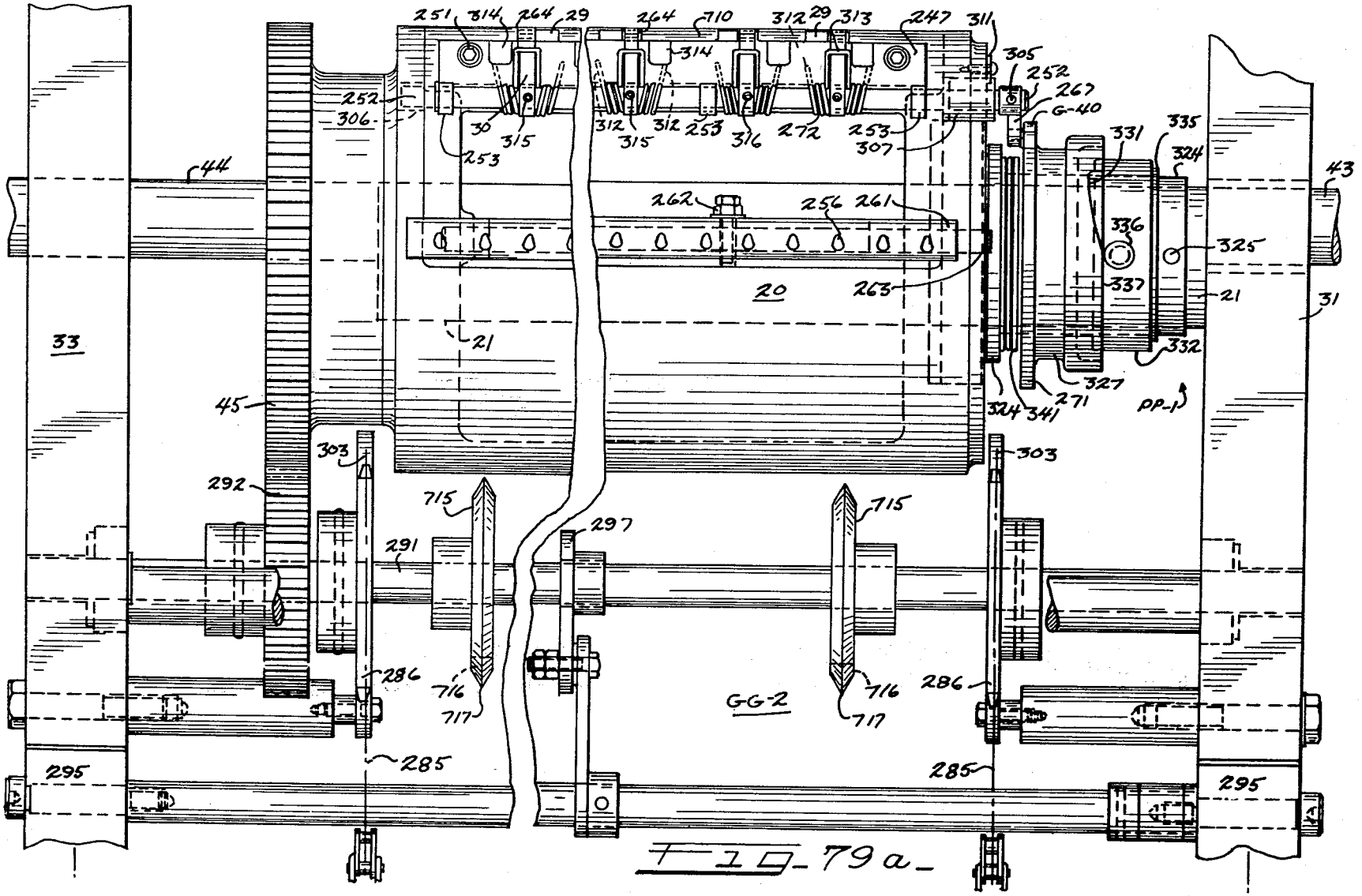
Figure 79B:
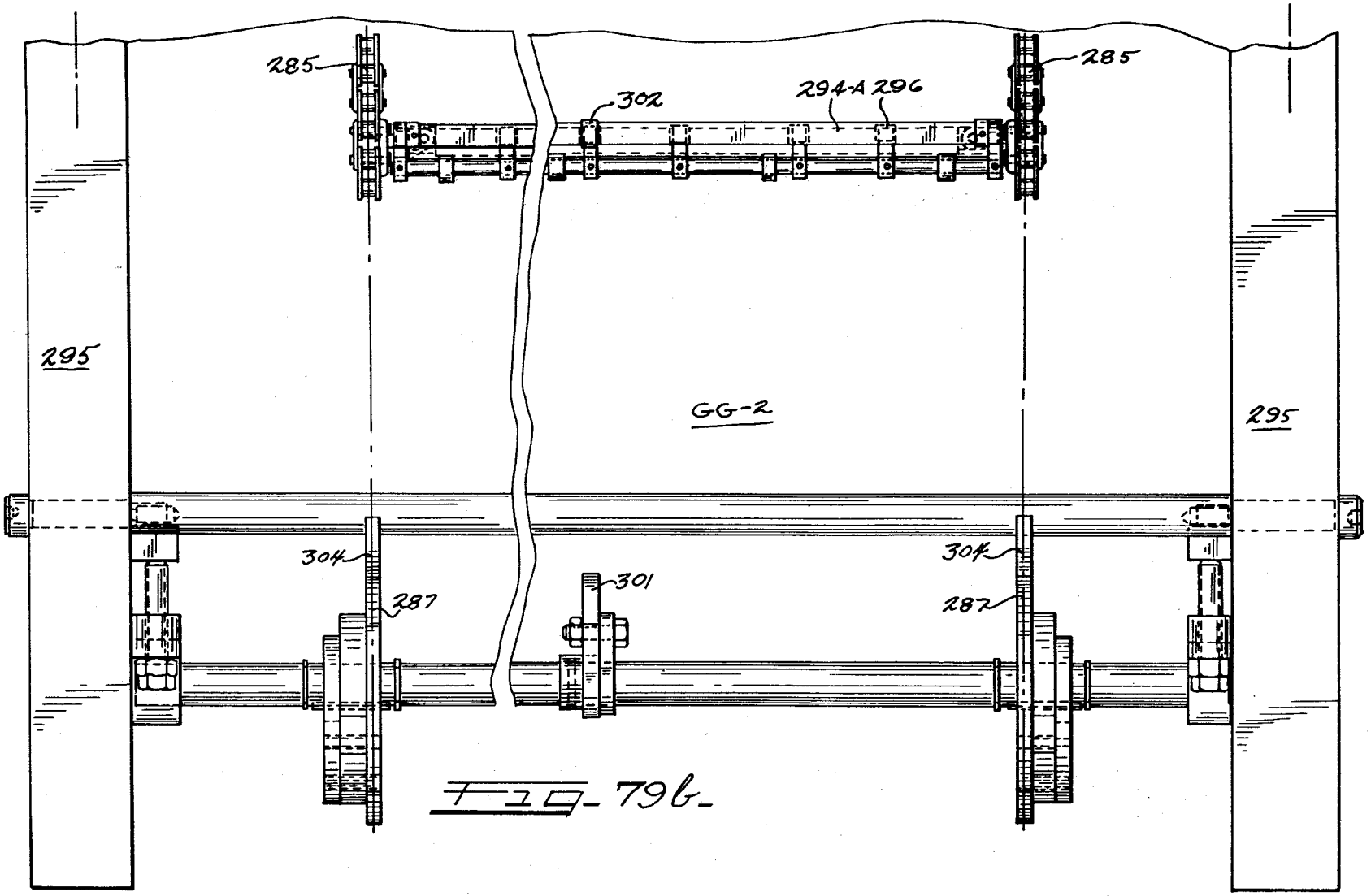
Figure 80:
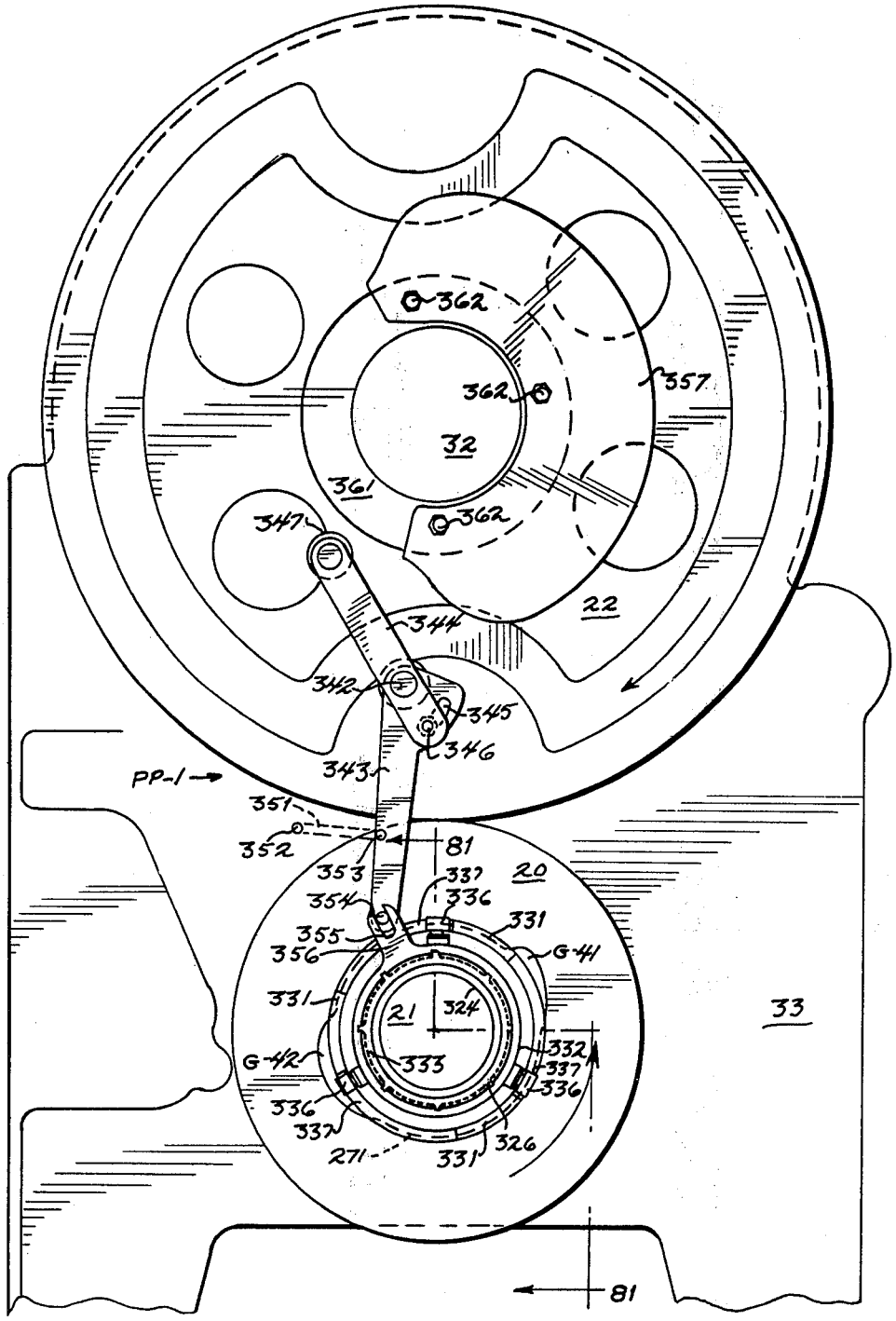
Figure 81:
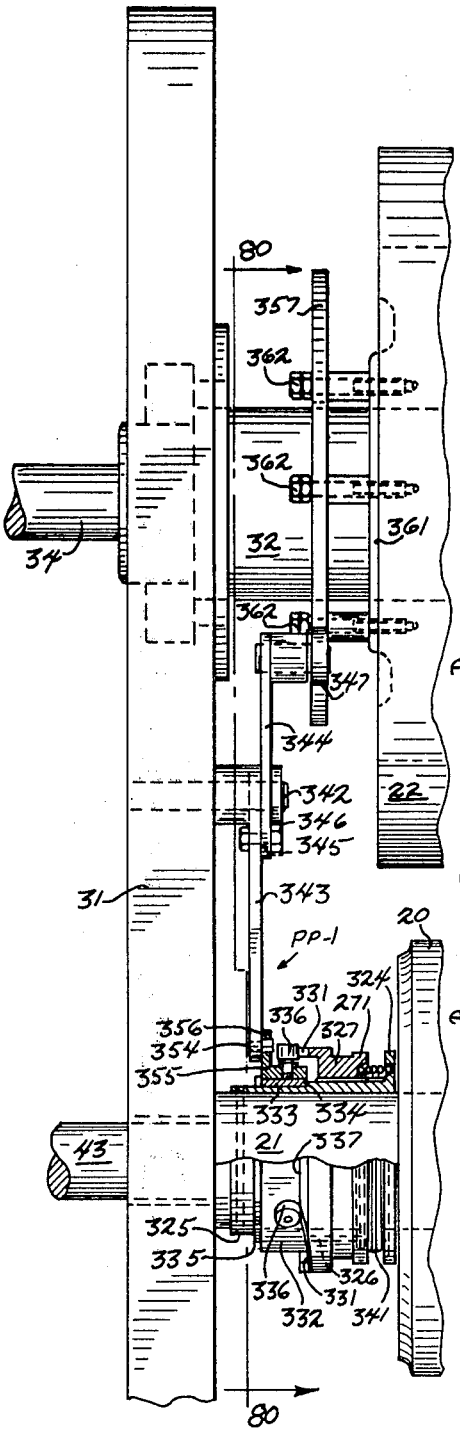
Figure 82:
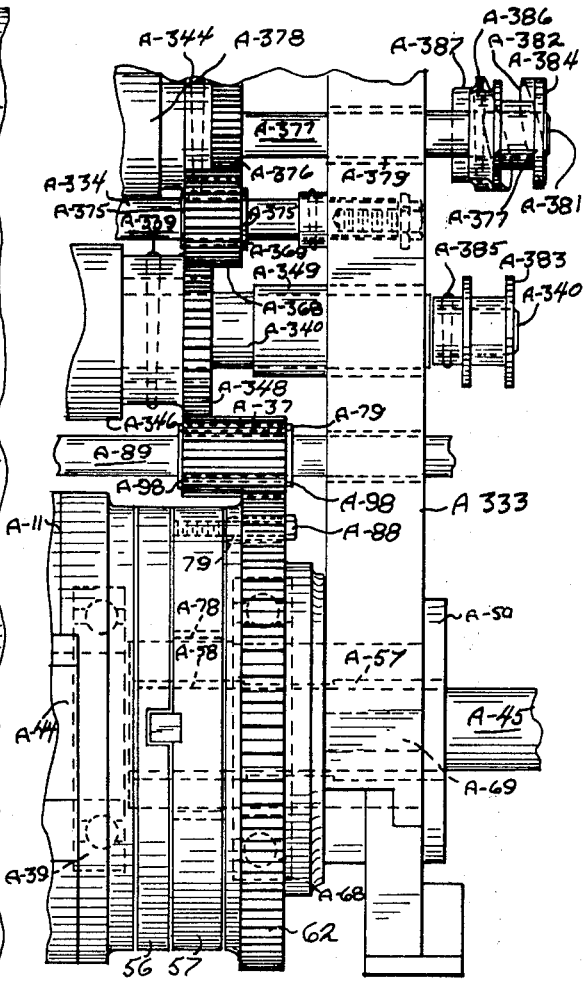
Figure 84:
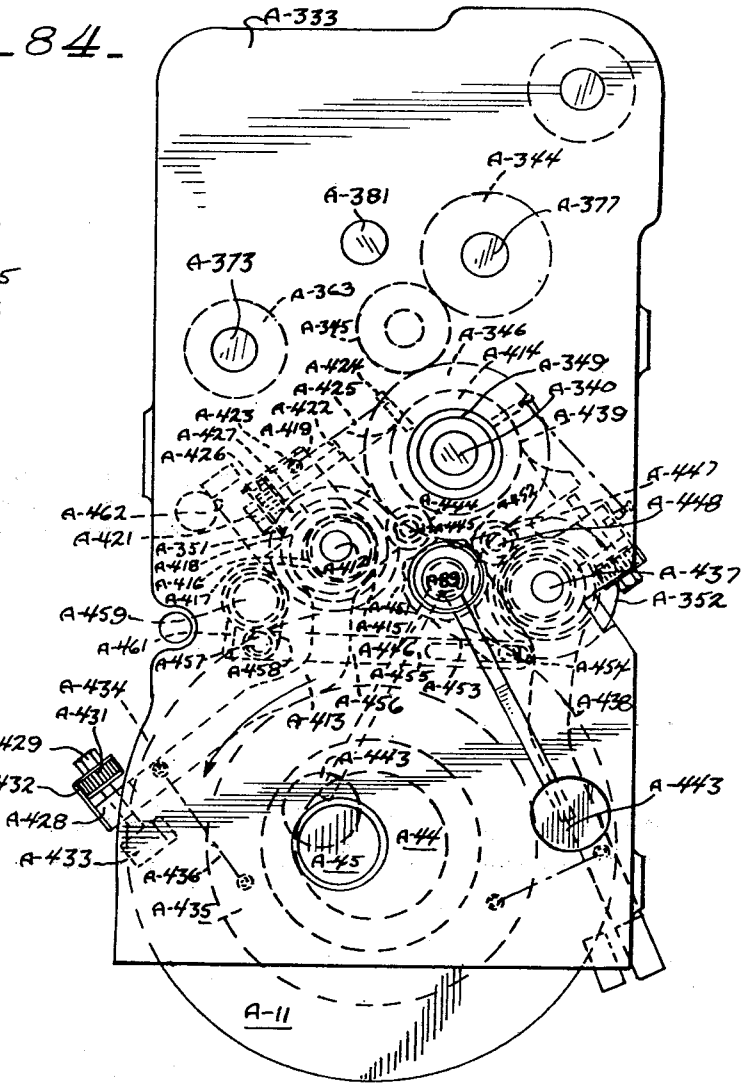
Figure 83:
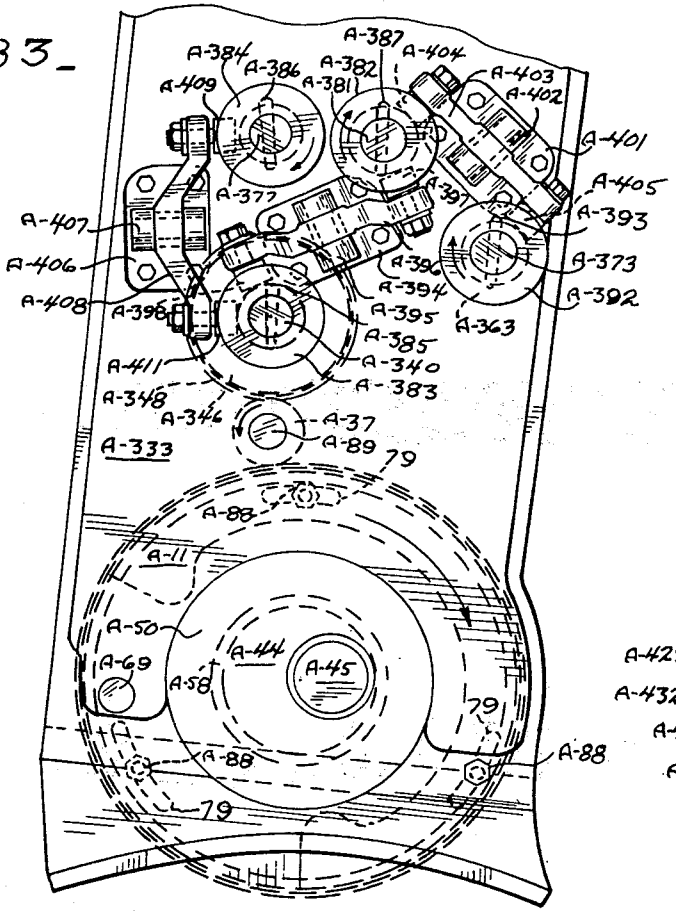
Figure 89:
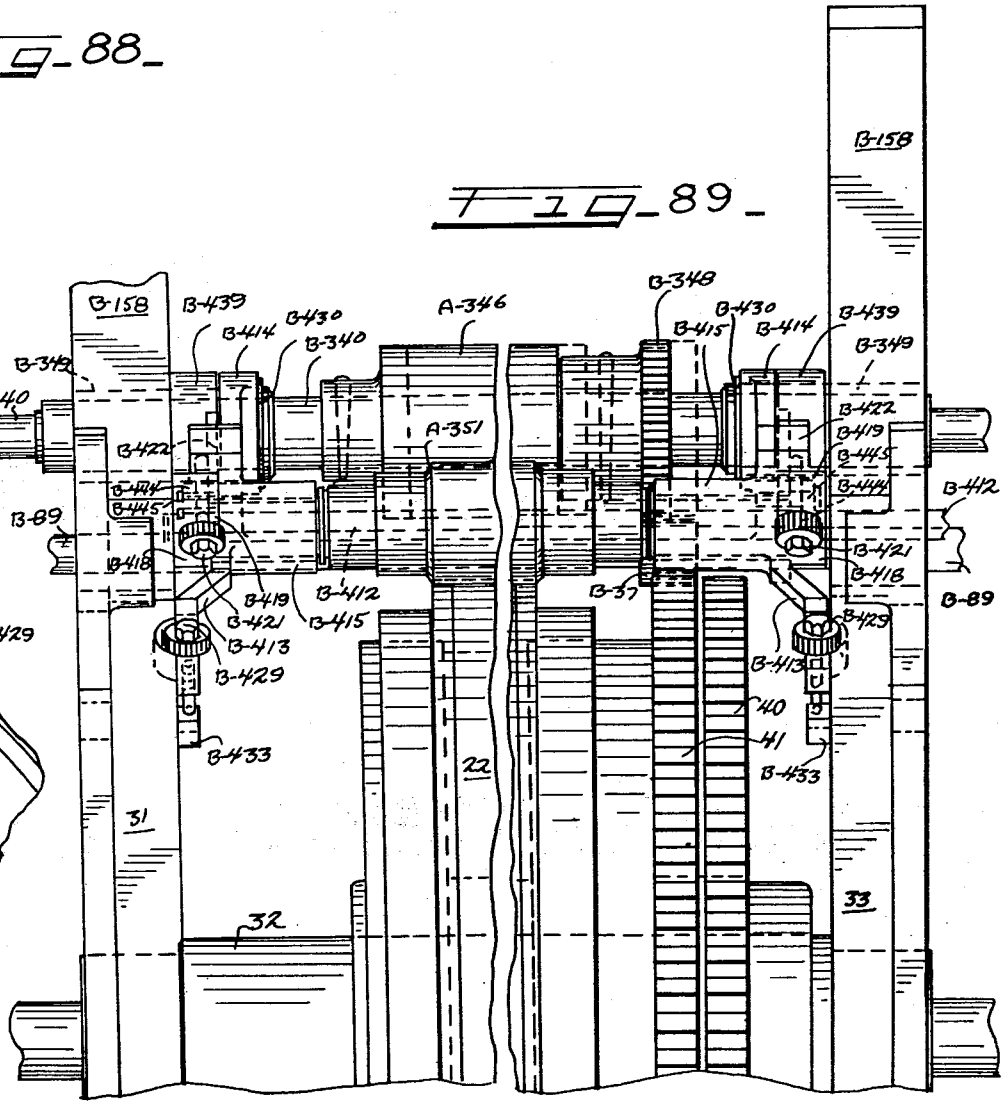
Figure 88:
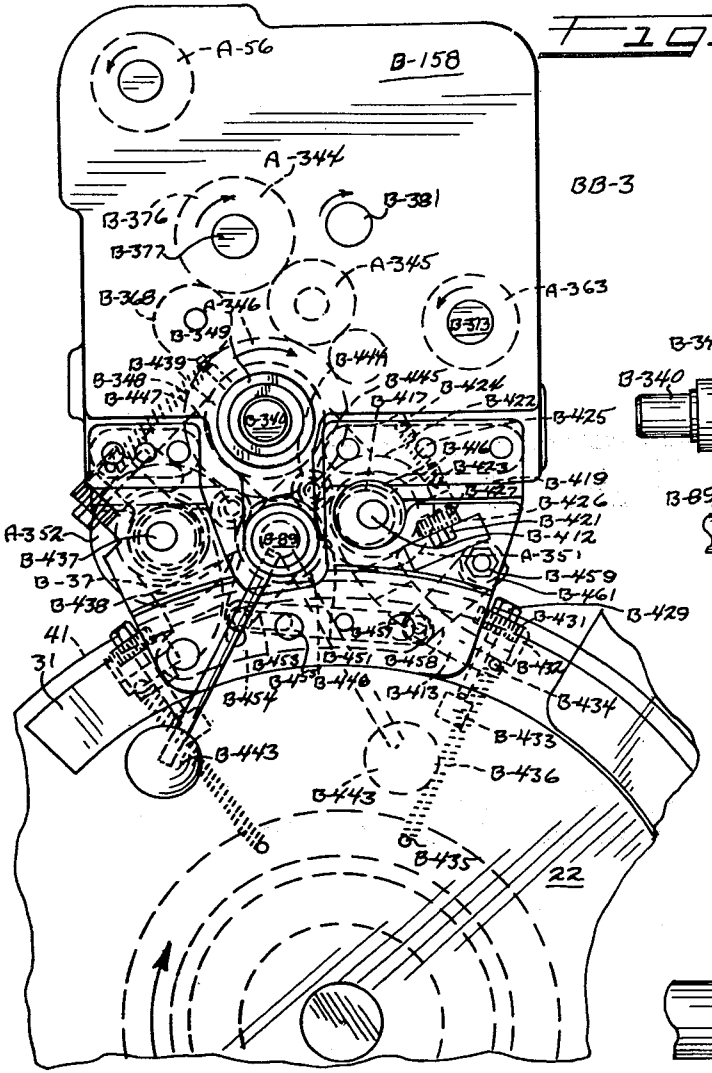
Figure 90:
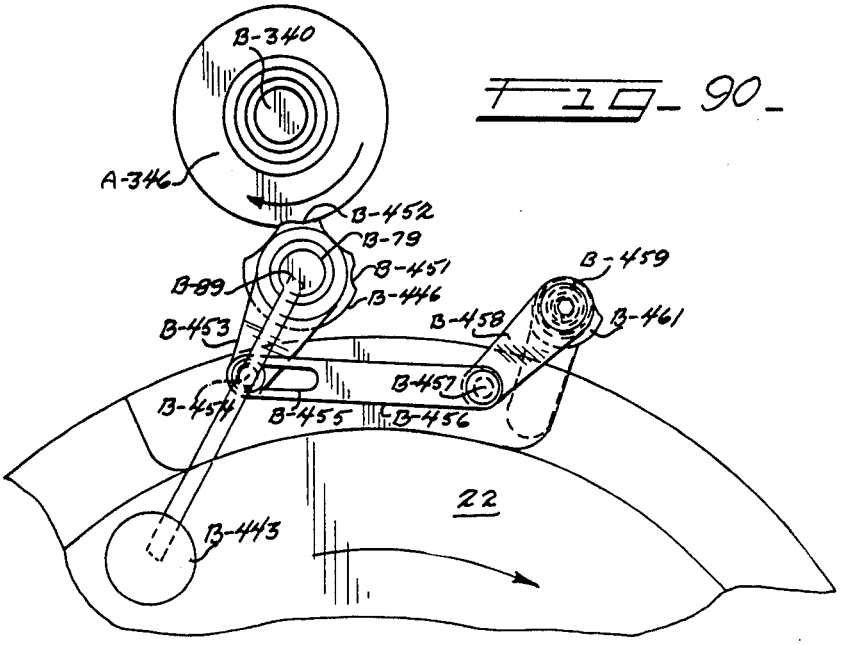
Figure 91:
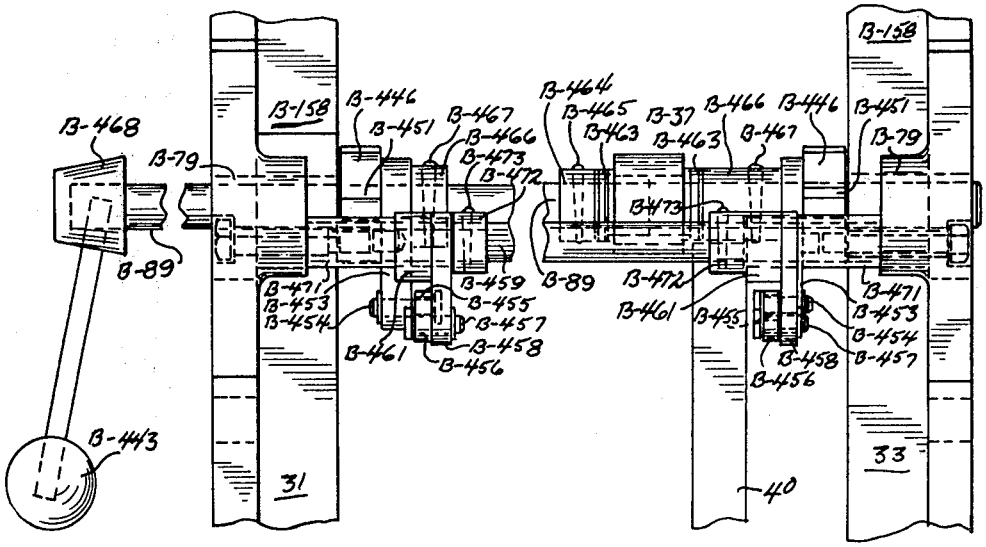
Figure 93:
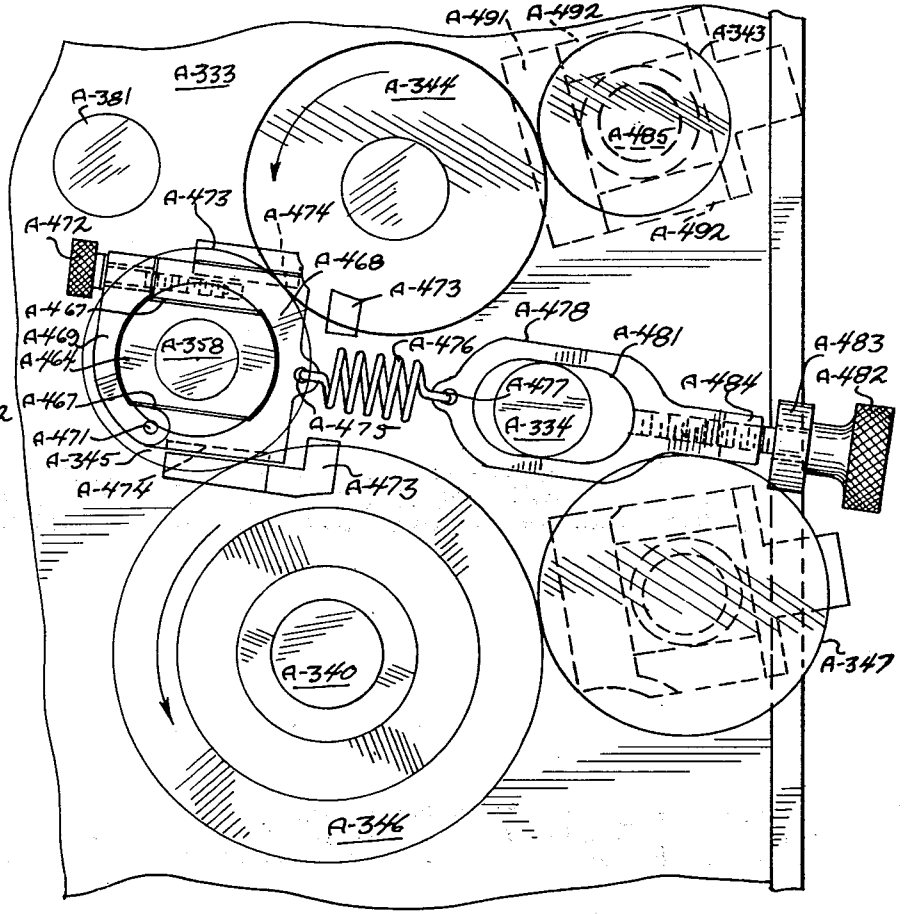
Figure 92:
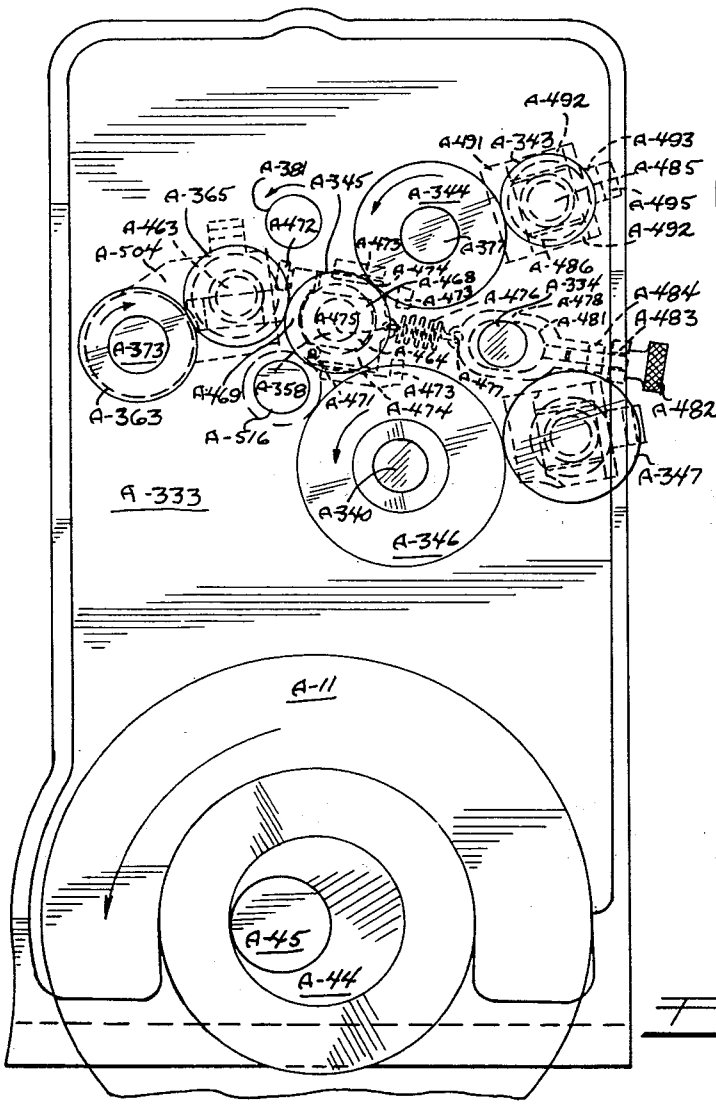
Figure 94:
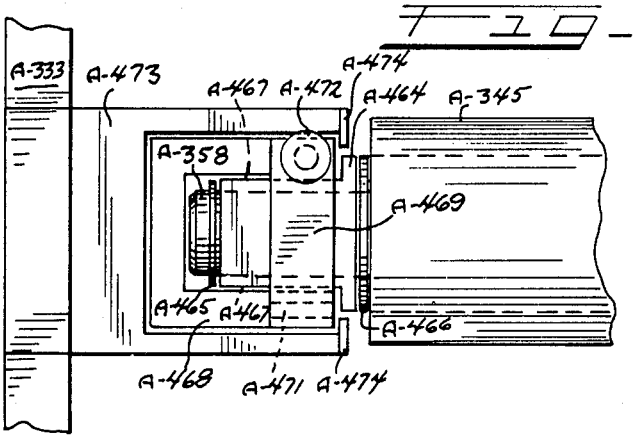
Figure 95:
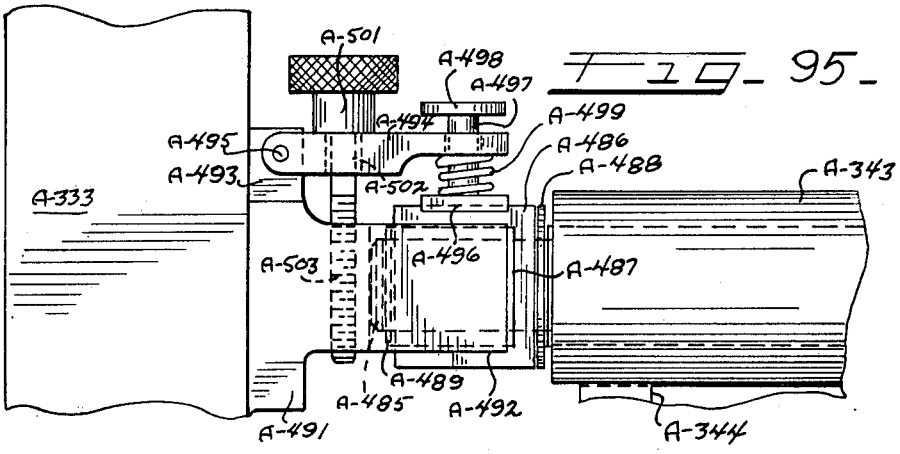
Figure 96:
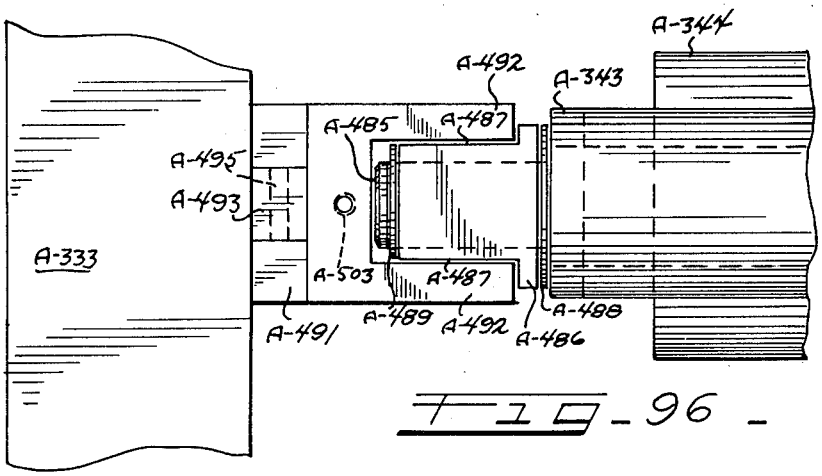
Figures 97, 98:
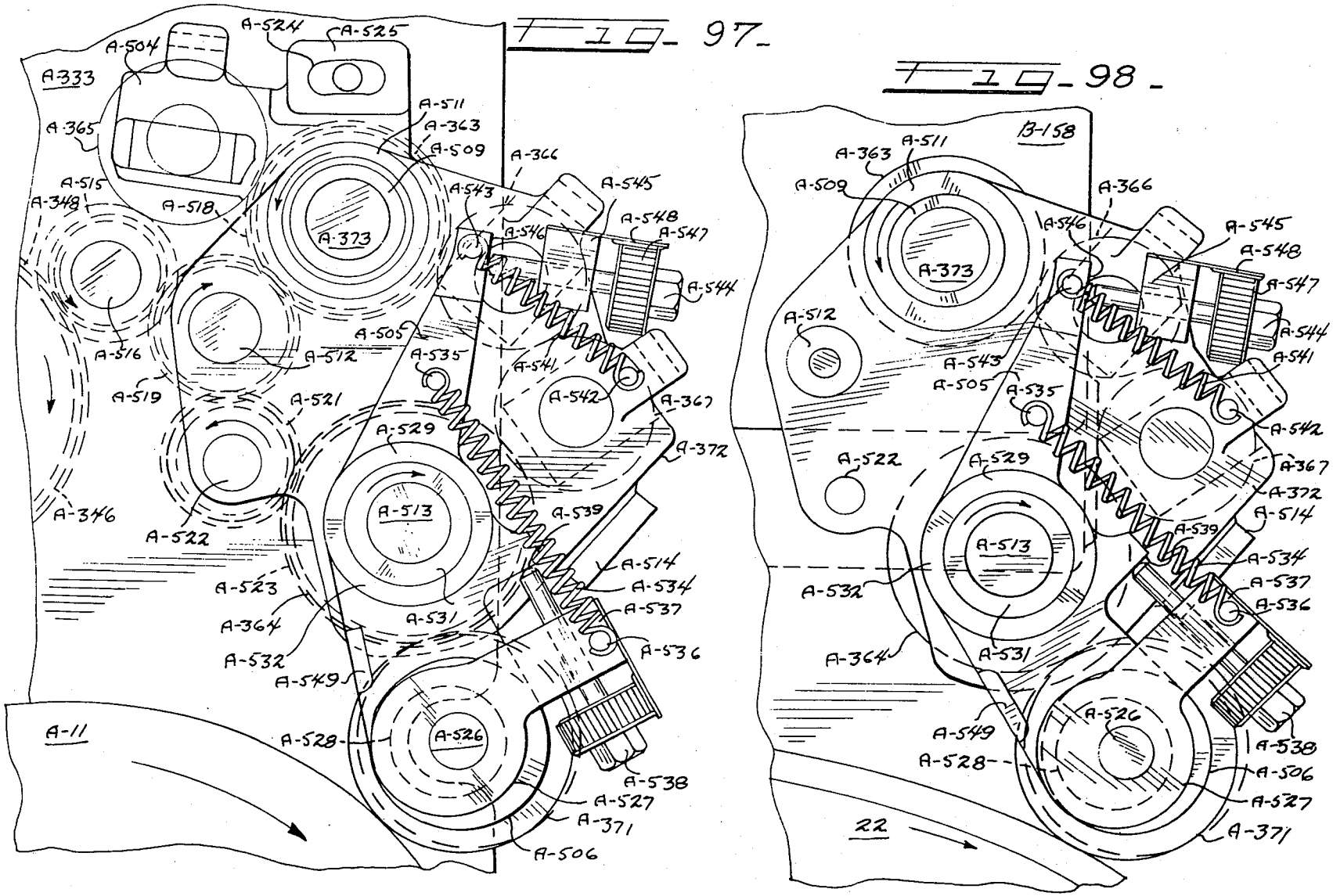
Figure 99:
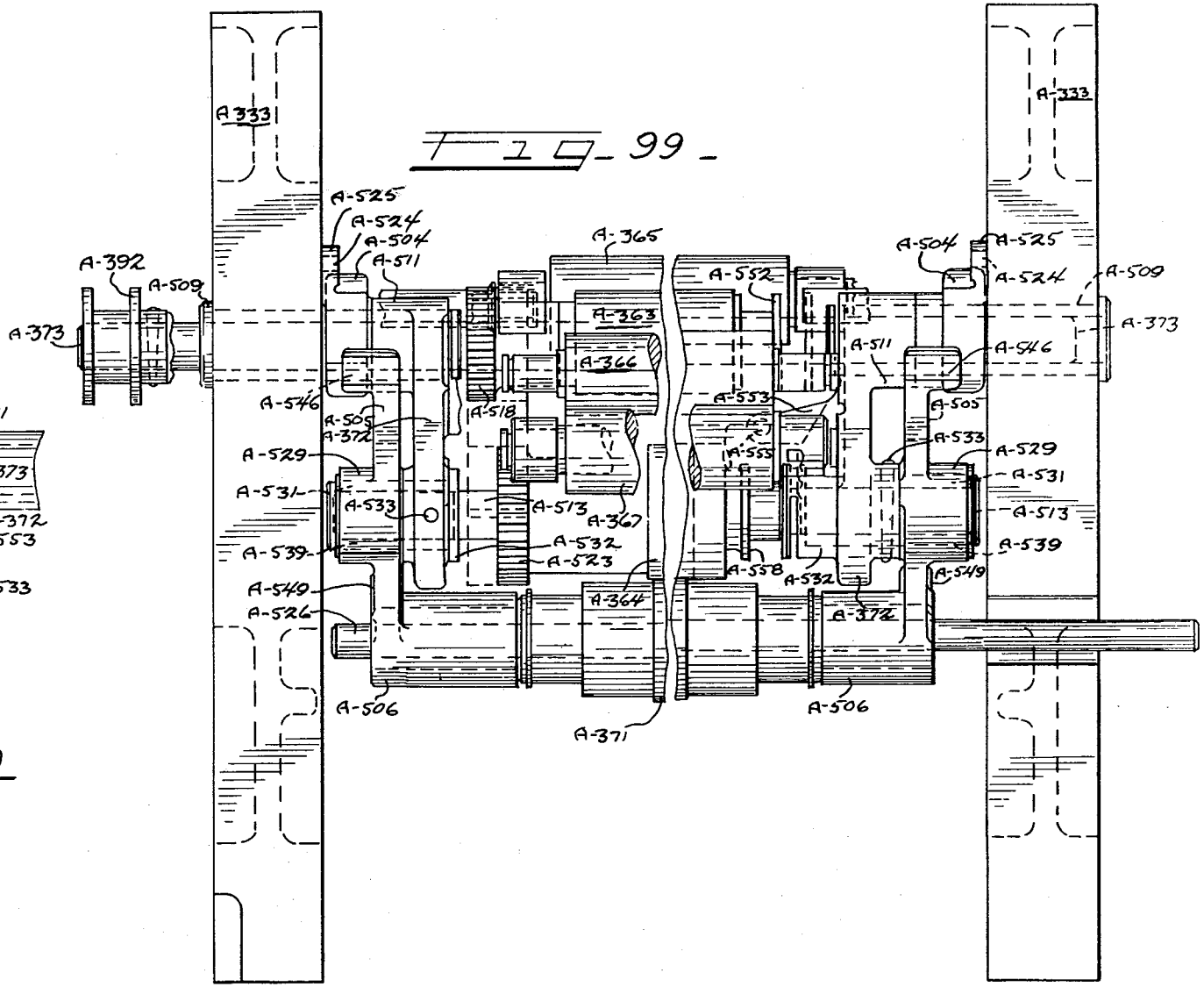
Figure 100:
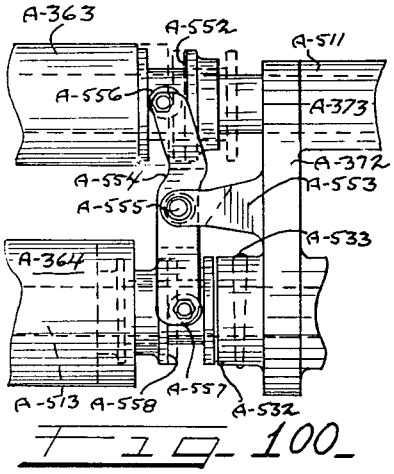
Figure 101:
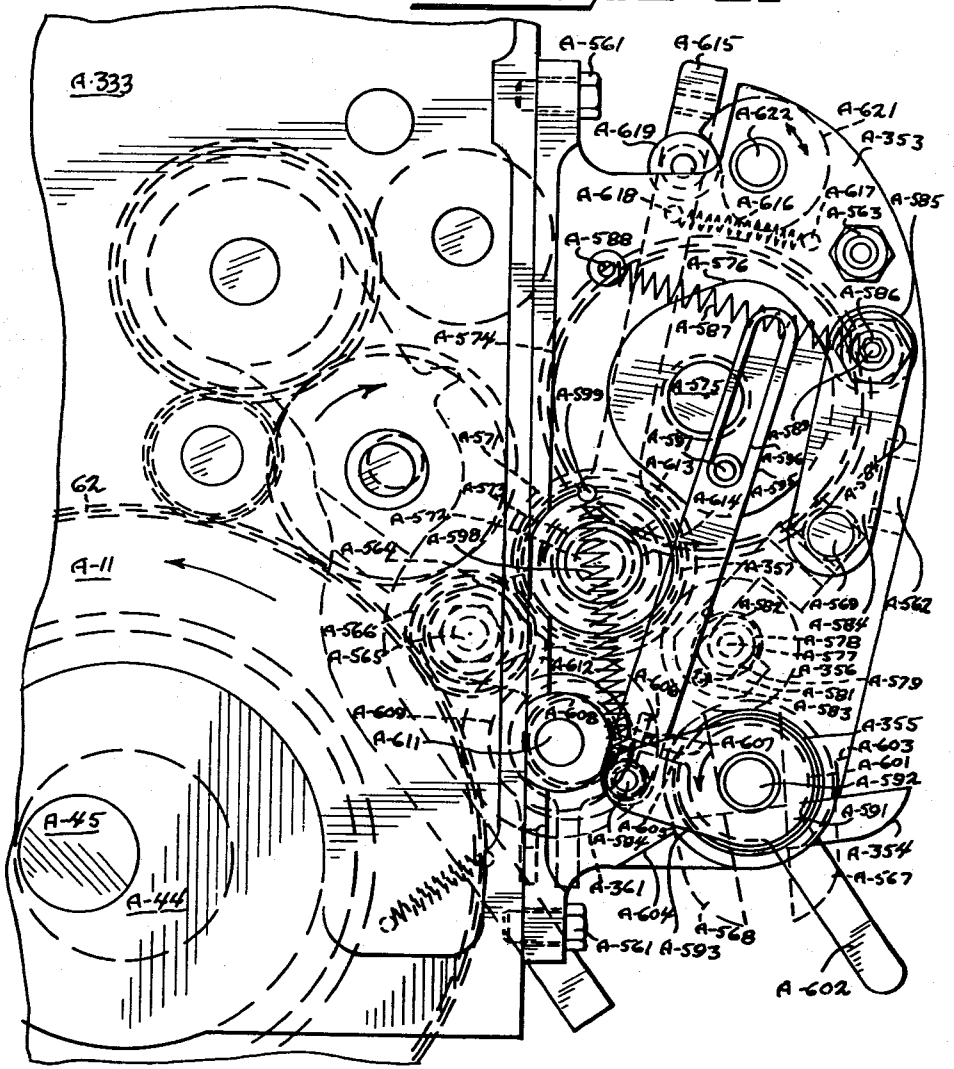
Figure 102:
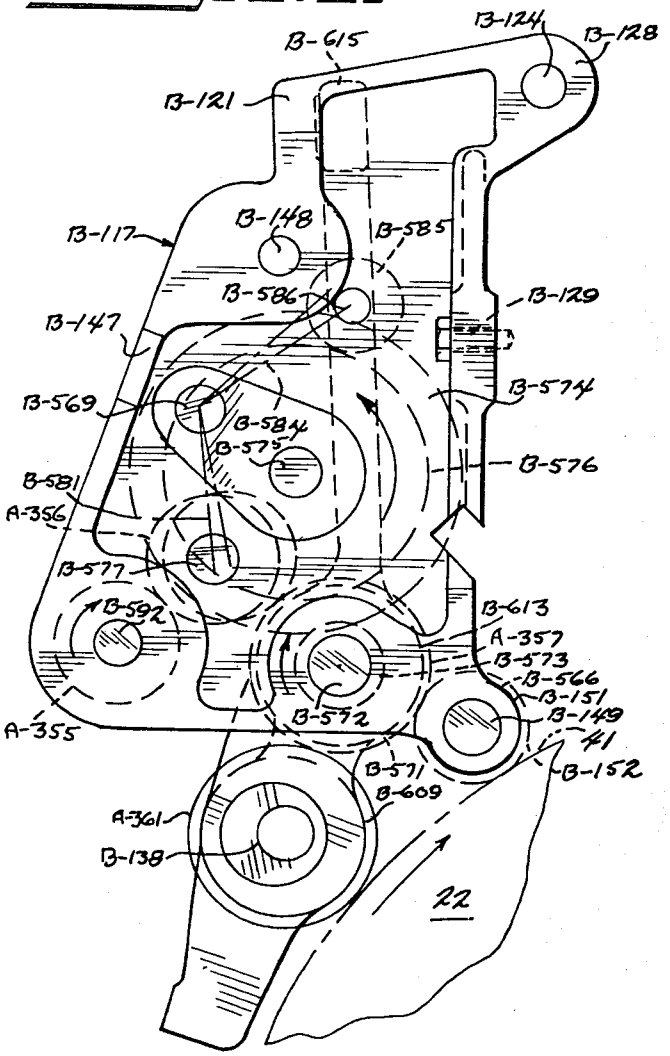
Figure 103:
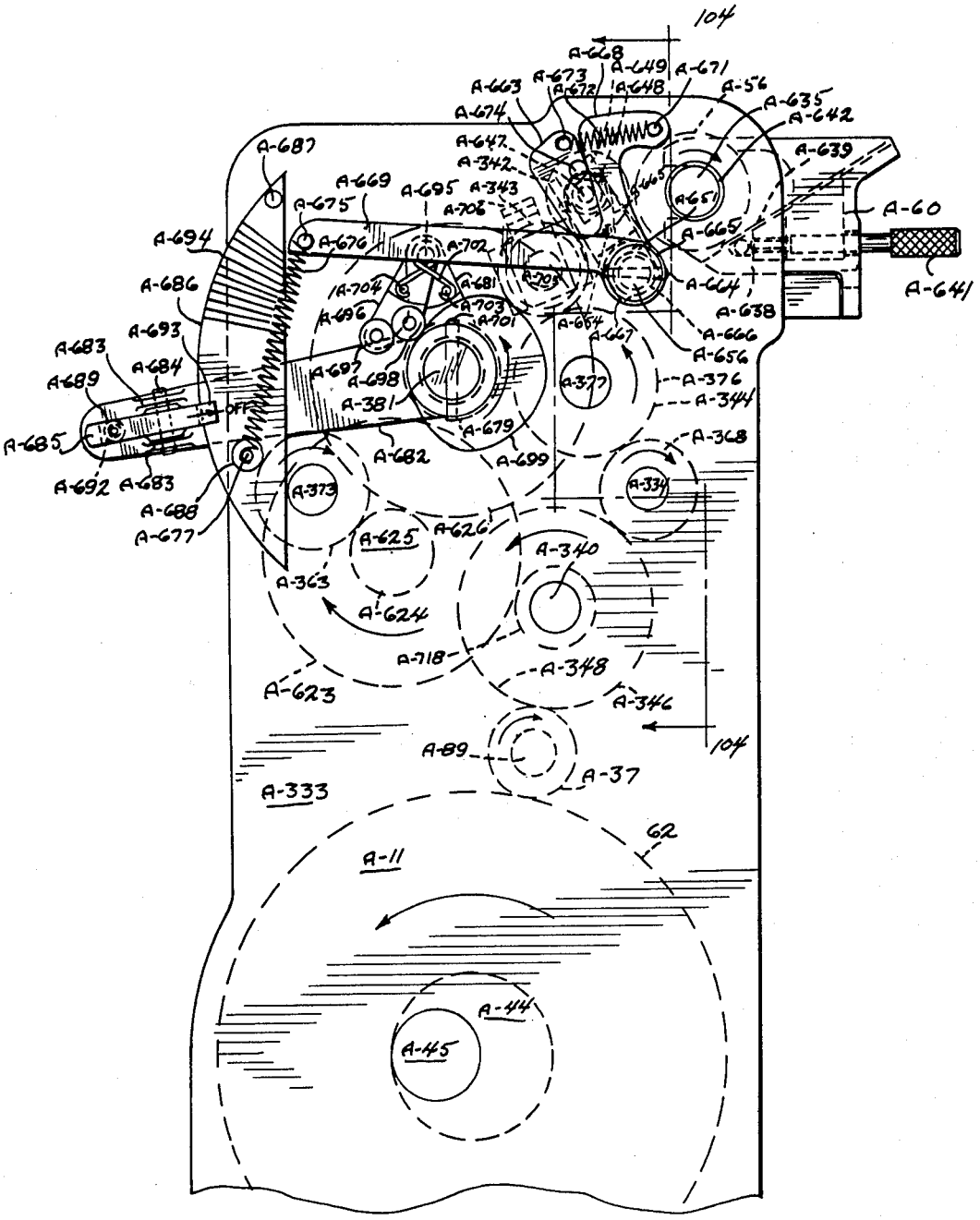
Figure 104:
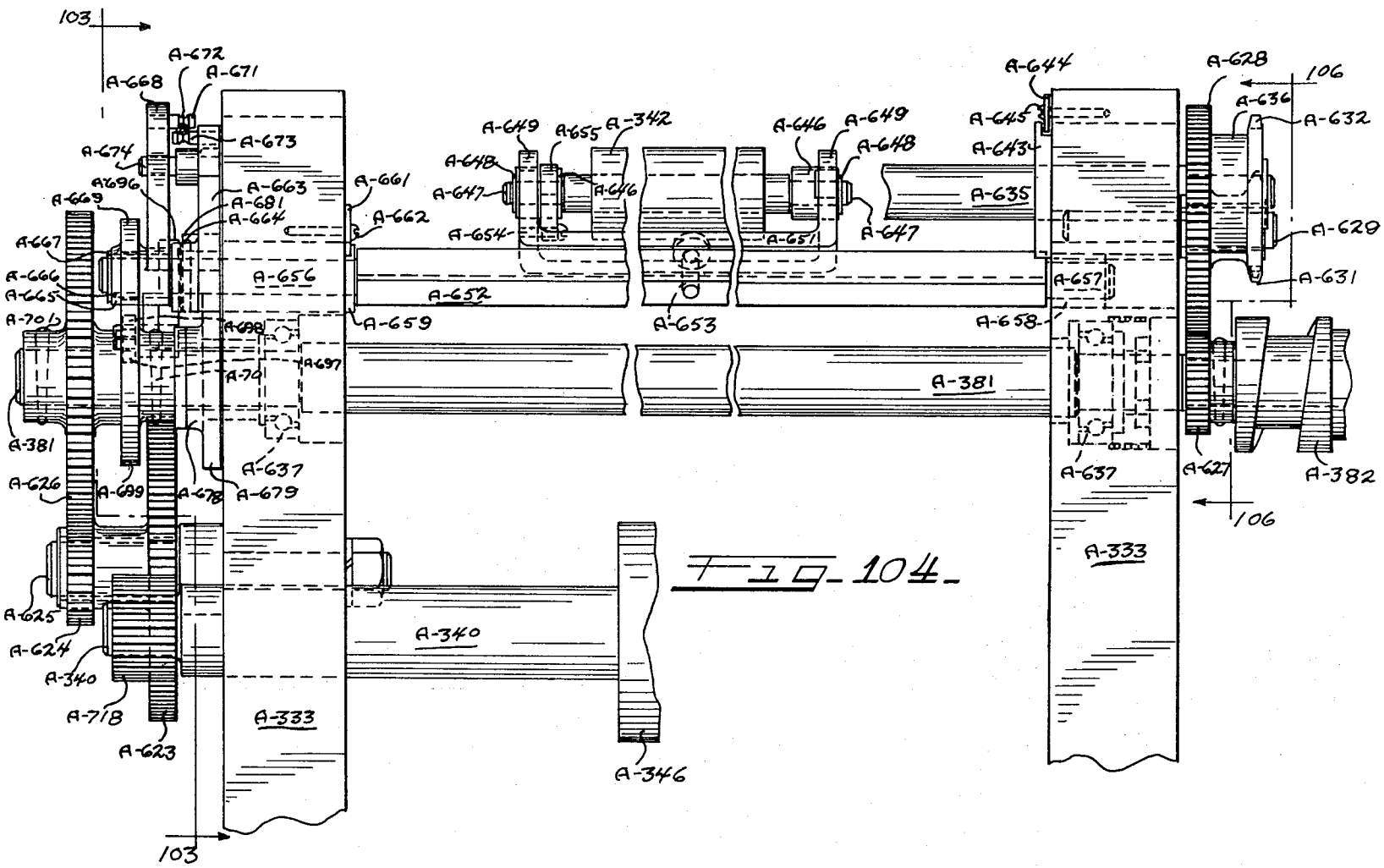
Figure 107:
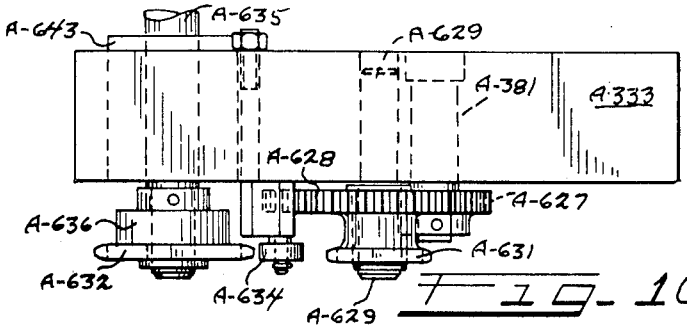
Figure 106:
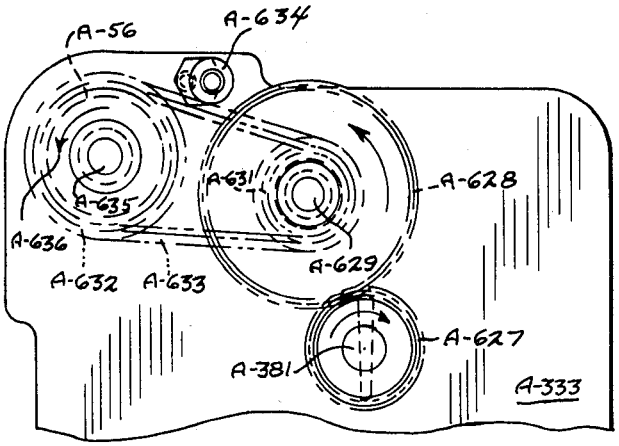
Figure 105:
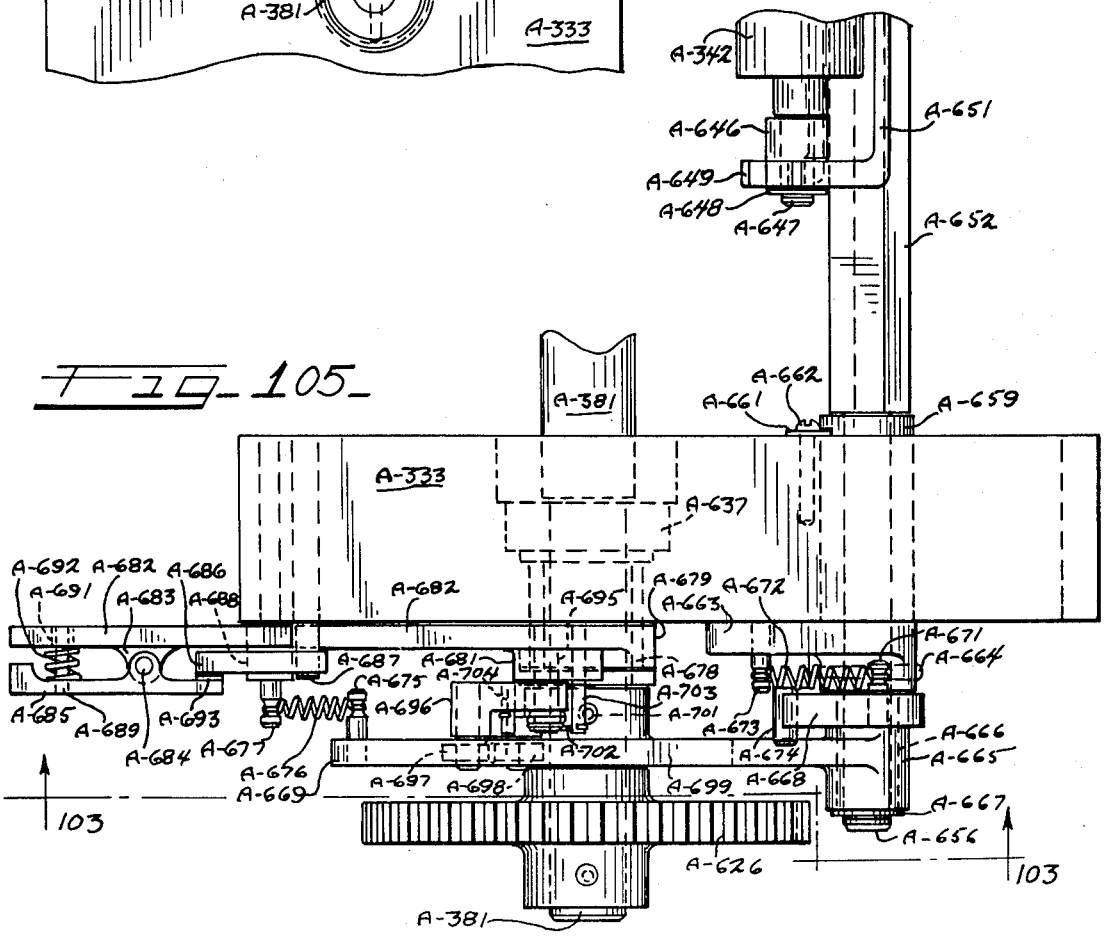
Figure 108:
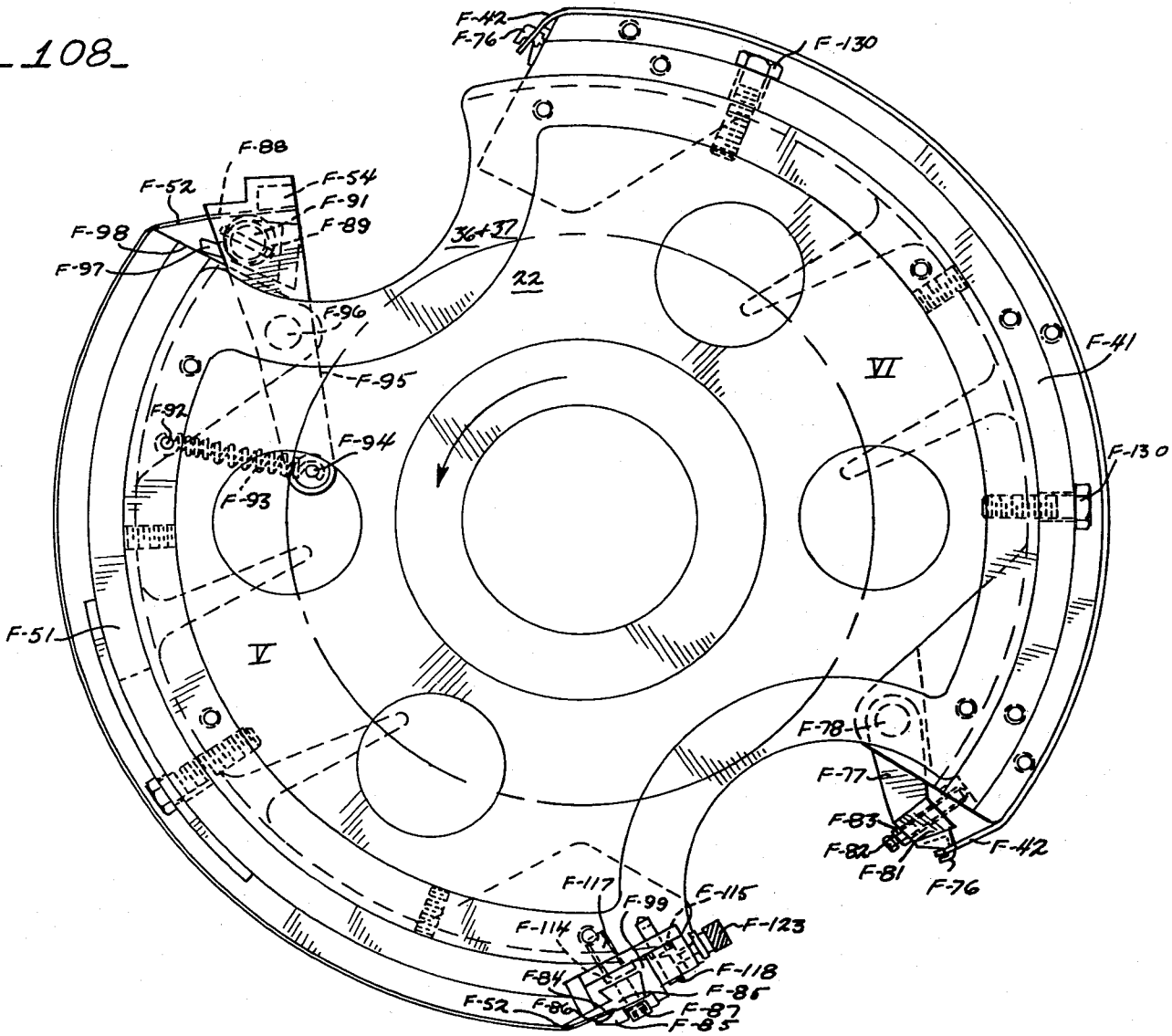
Figure 112:
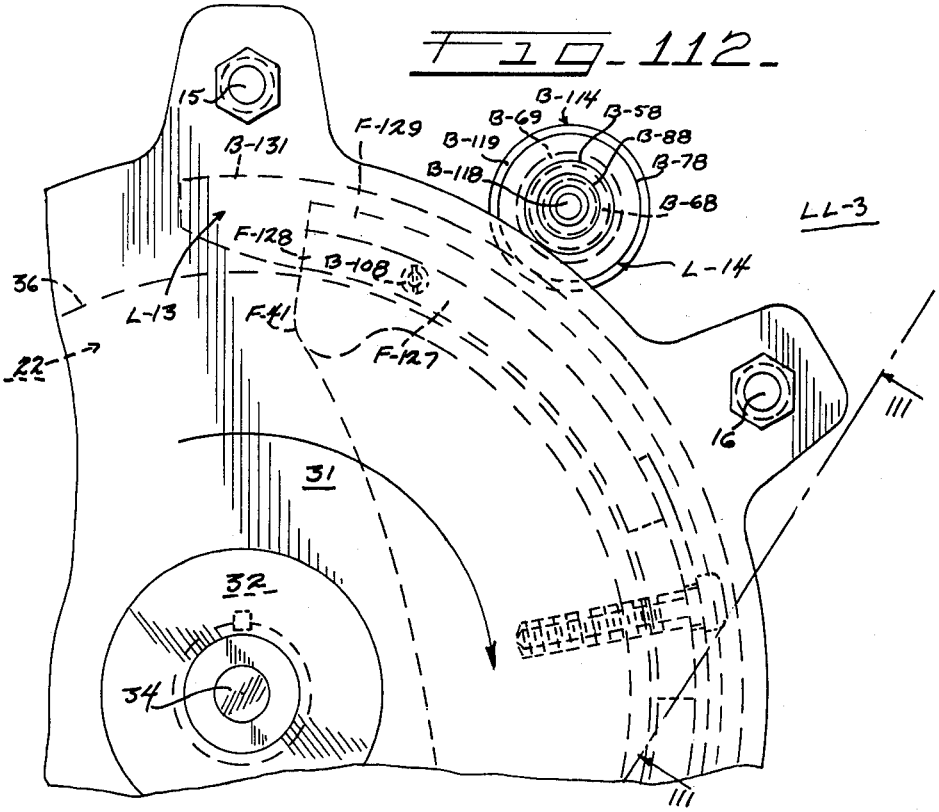
Figure 113:
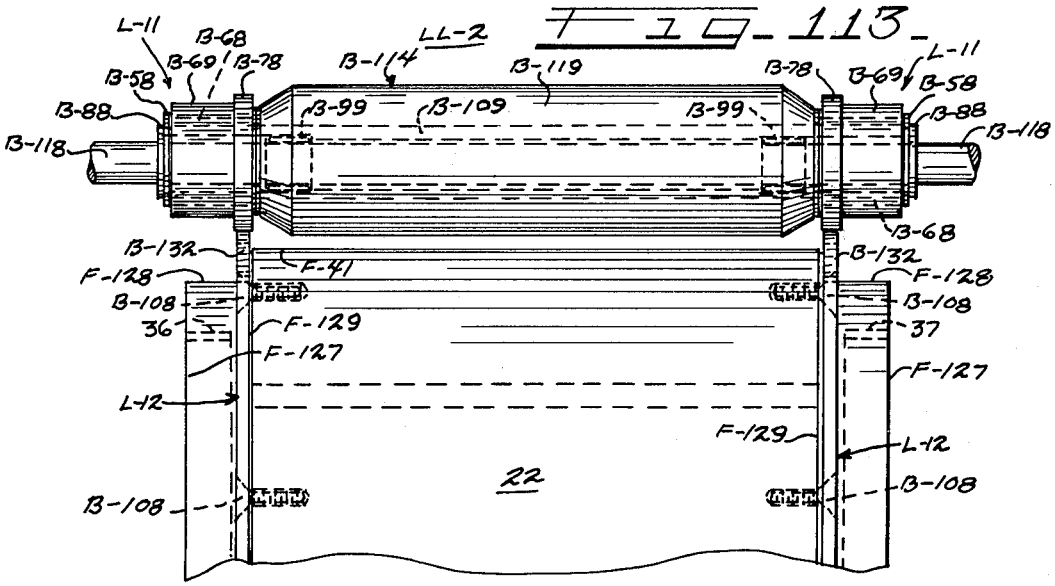
Figure 114:
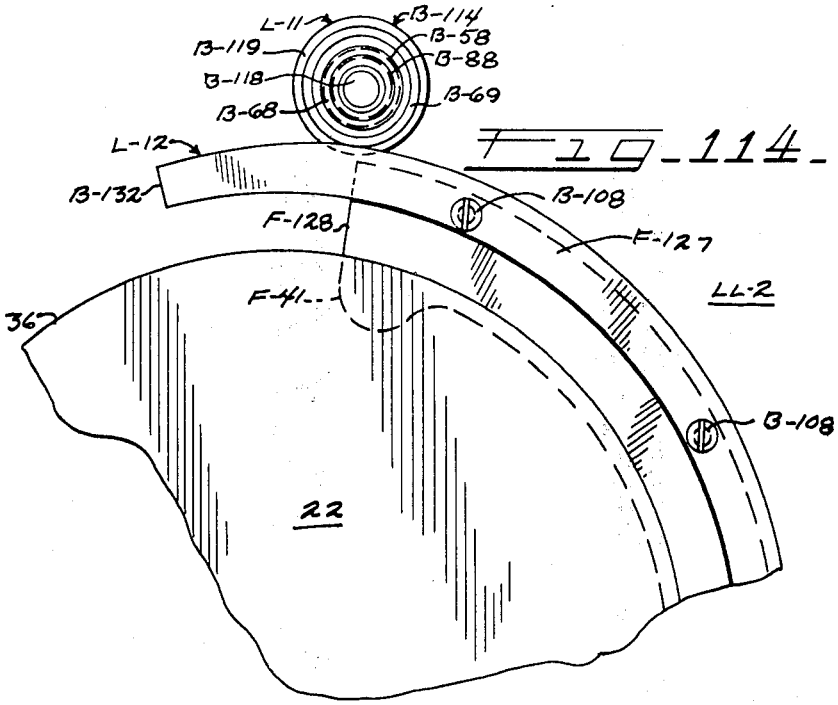
Figure 115:
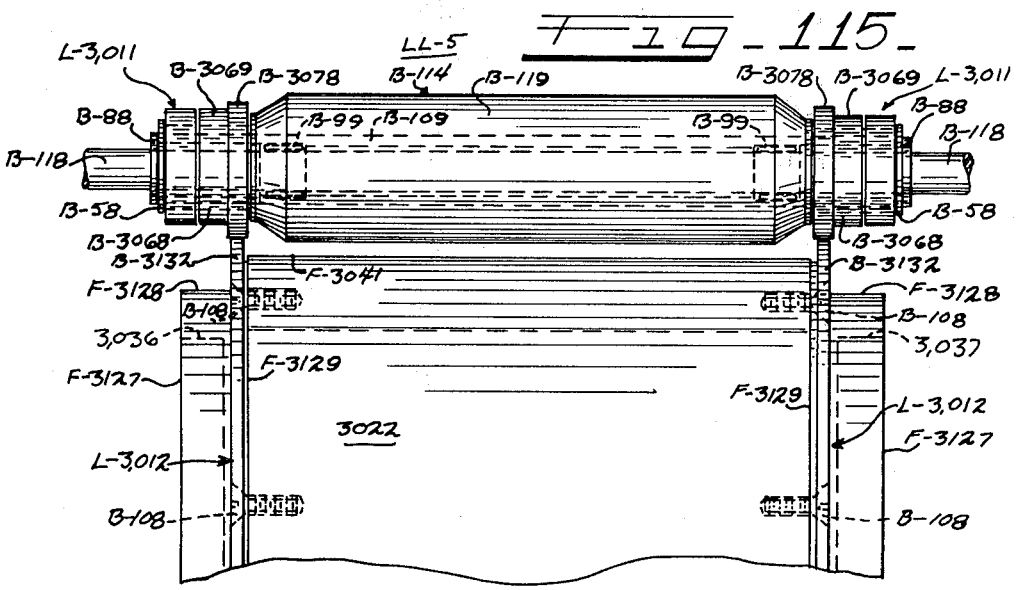
Figure 116:
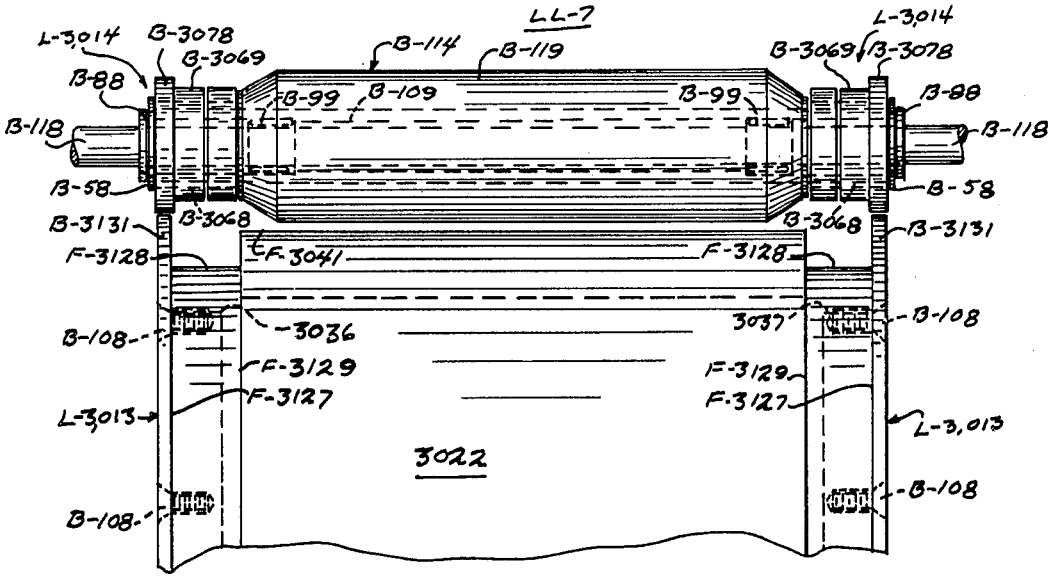
Figure 117:
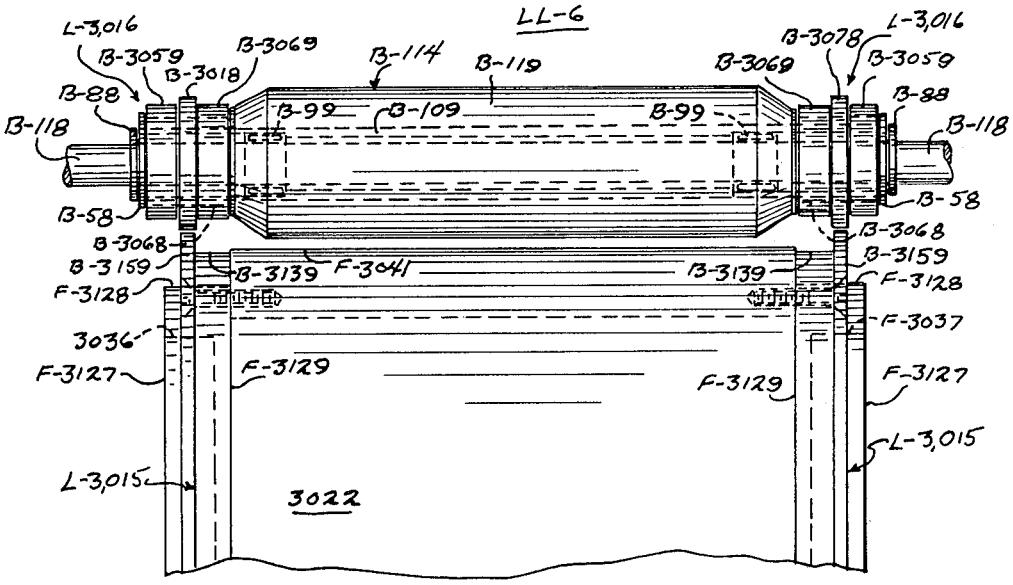
Figure 118:
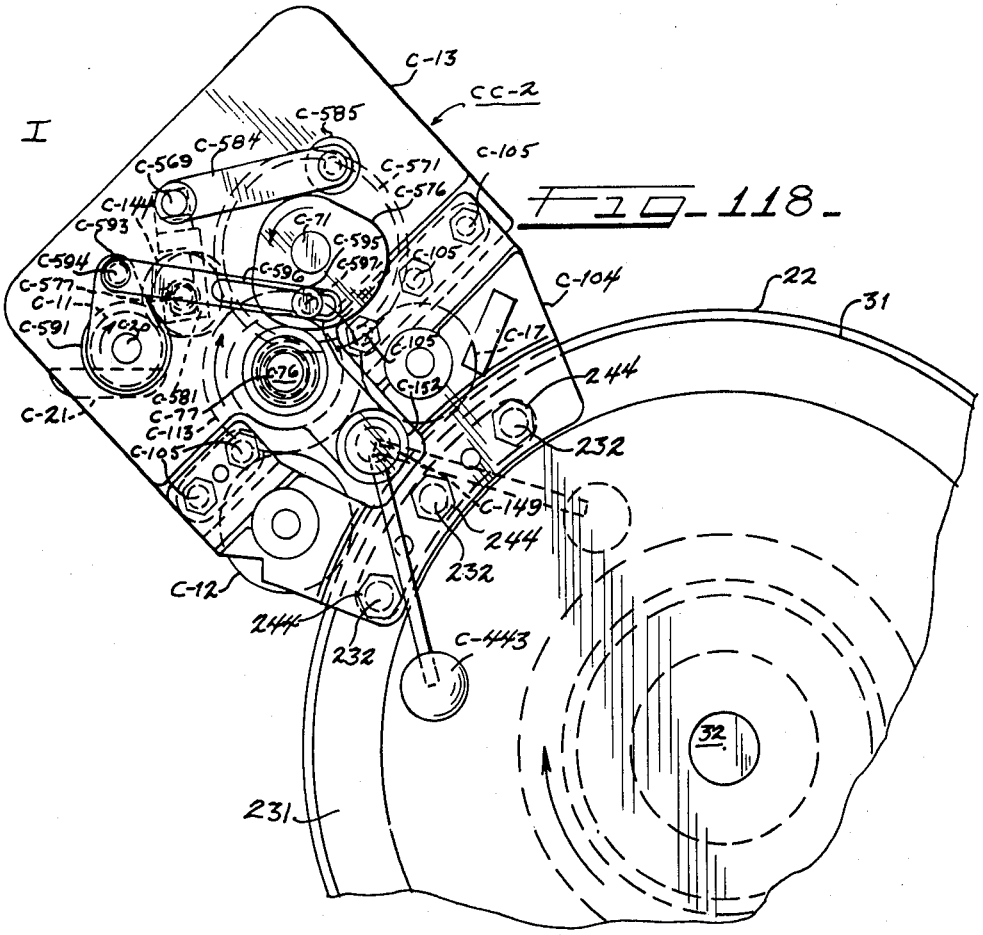
Figure 120:
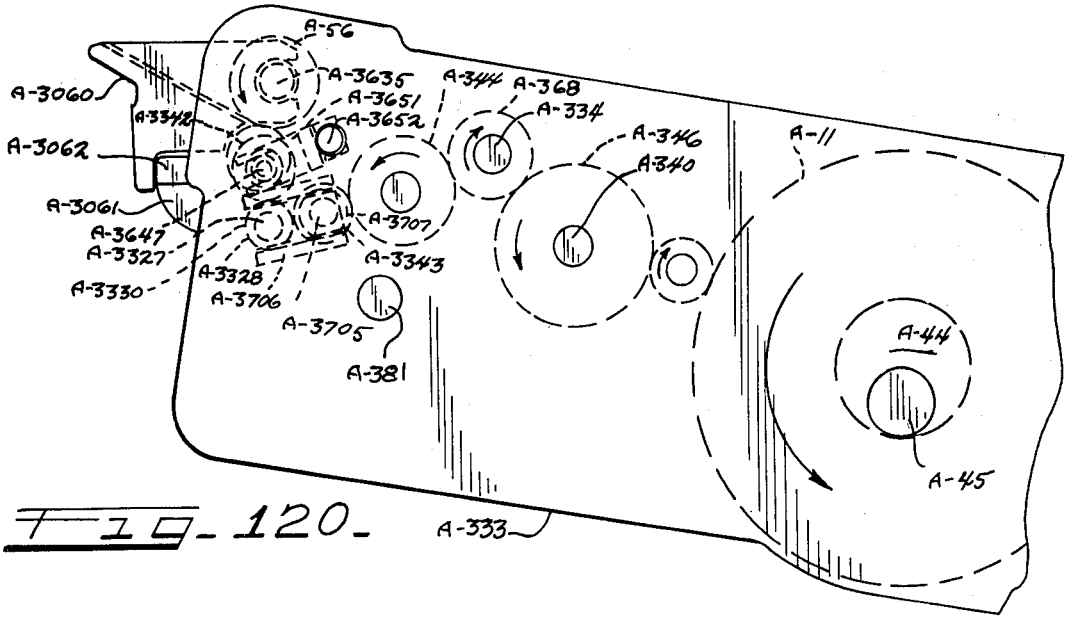
Figure 119:
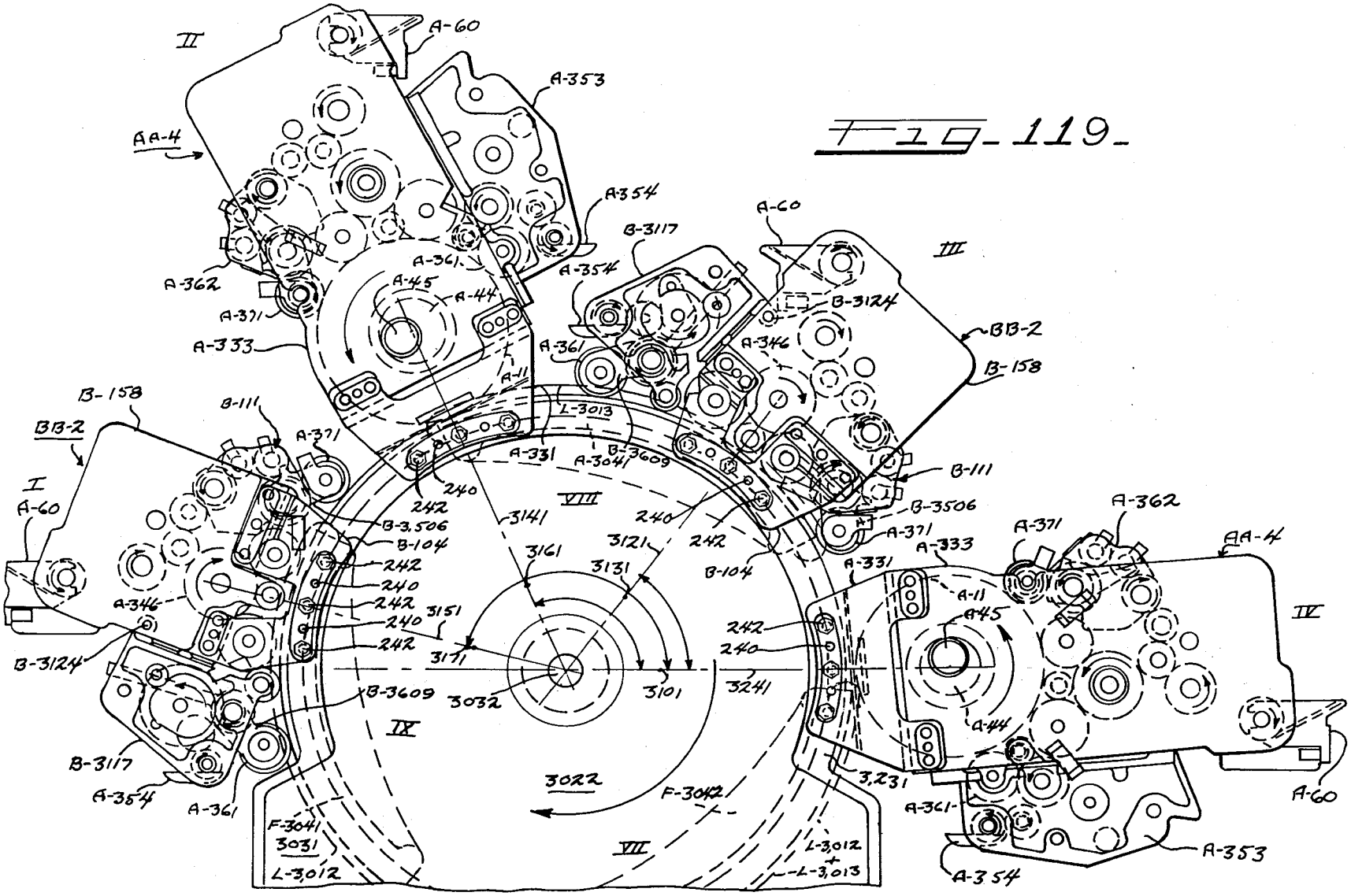
Figure 122:
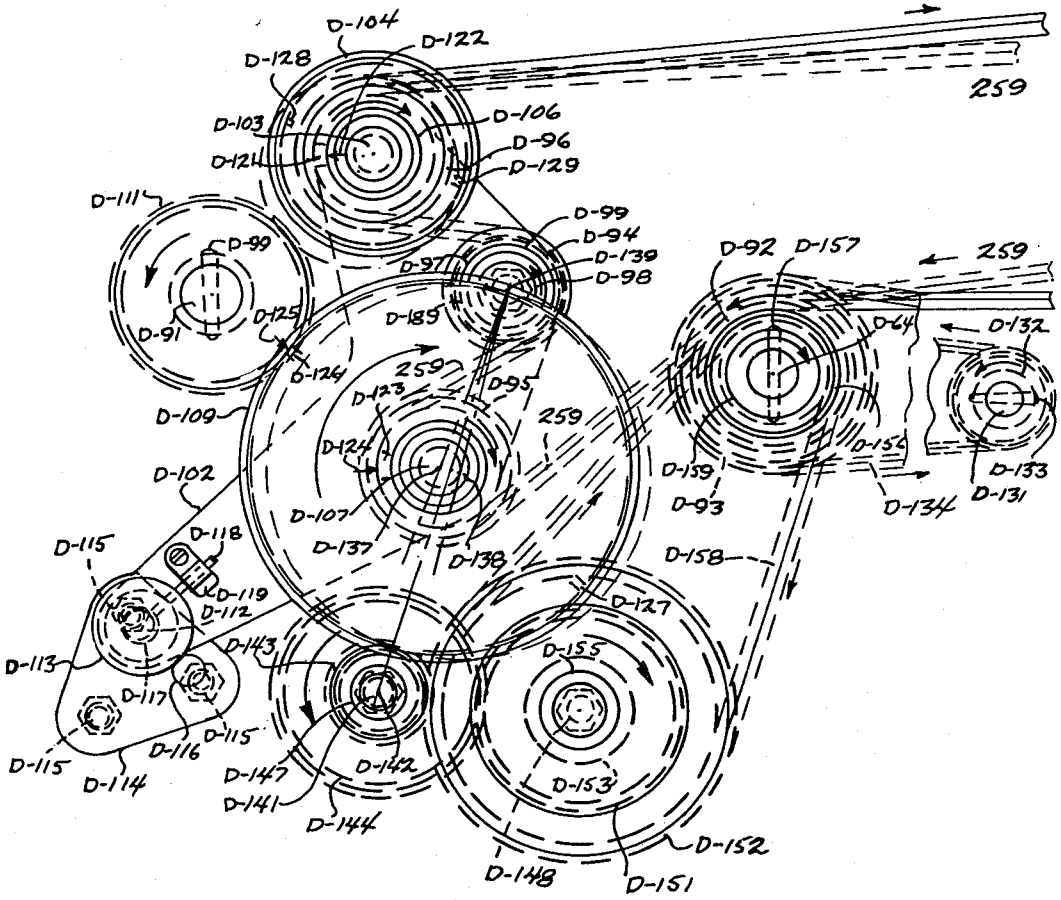
Figure 123:
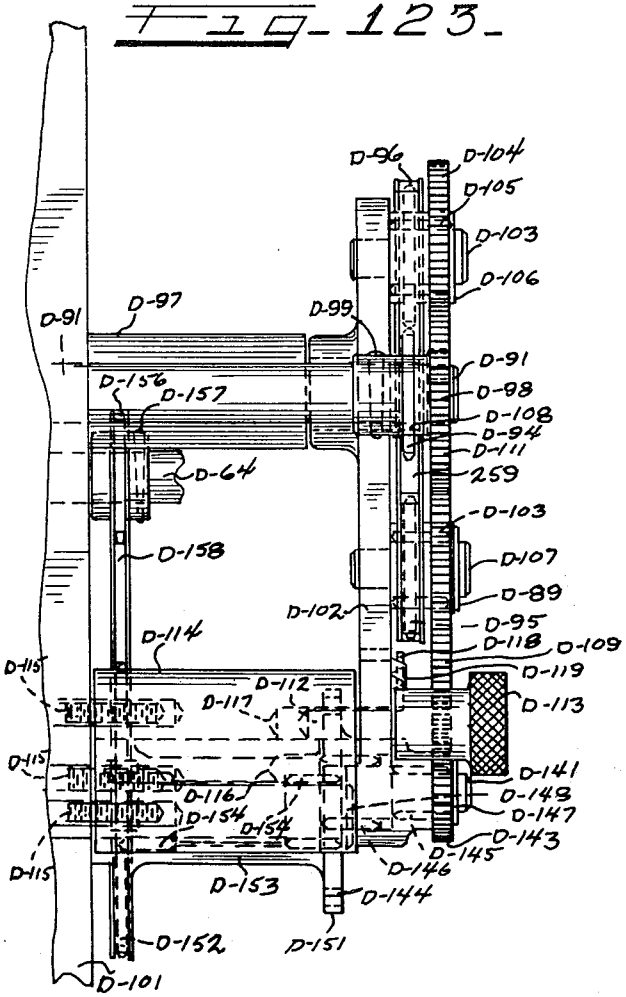
Figures 124, 127:
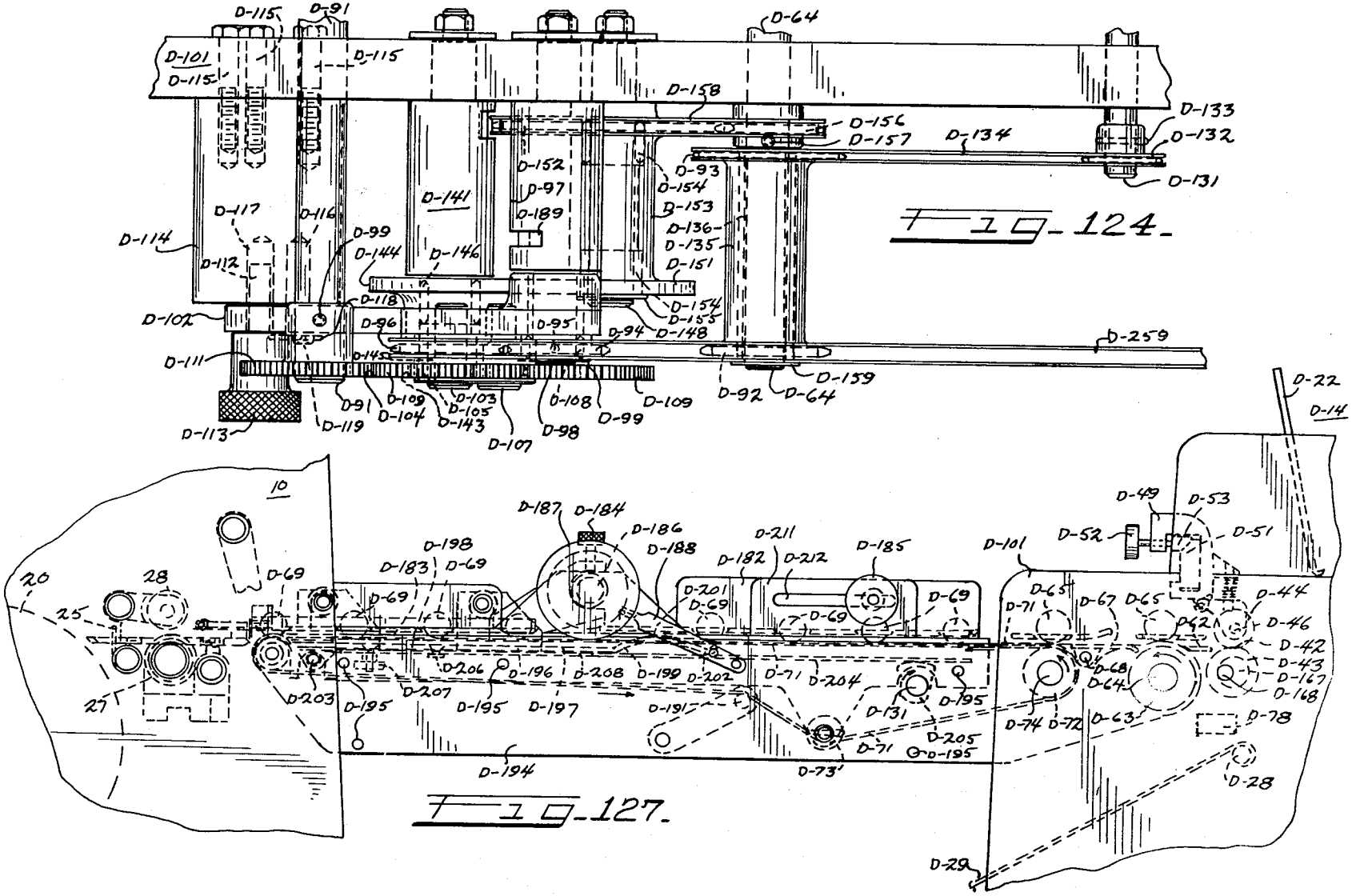
Figures 125, 126:
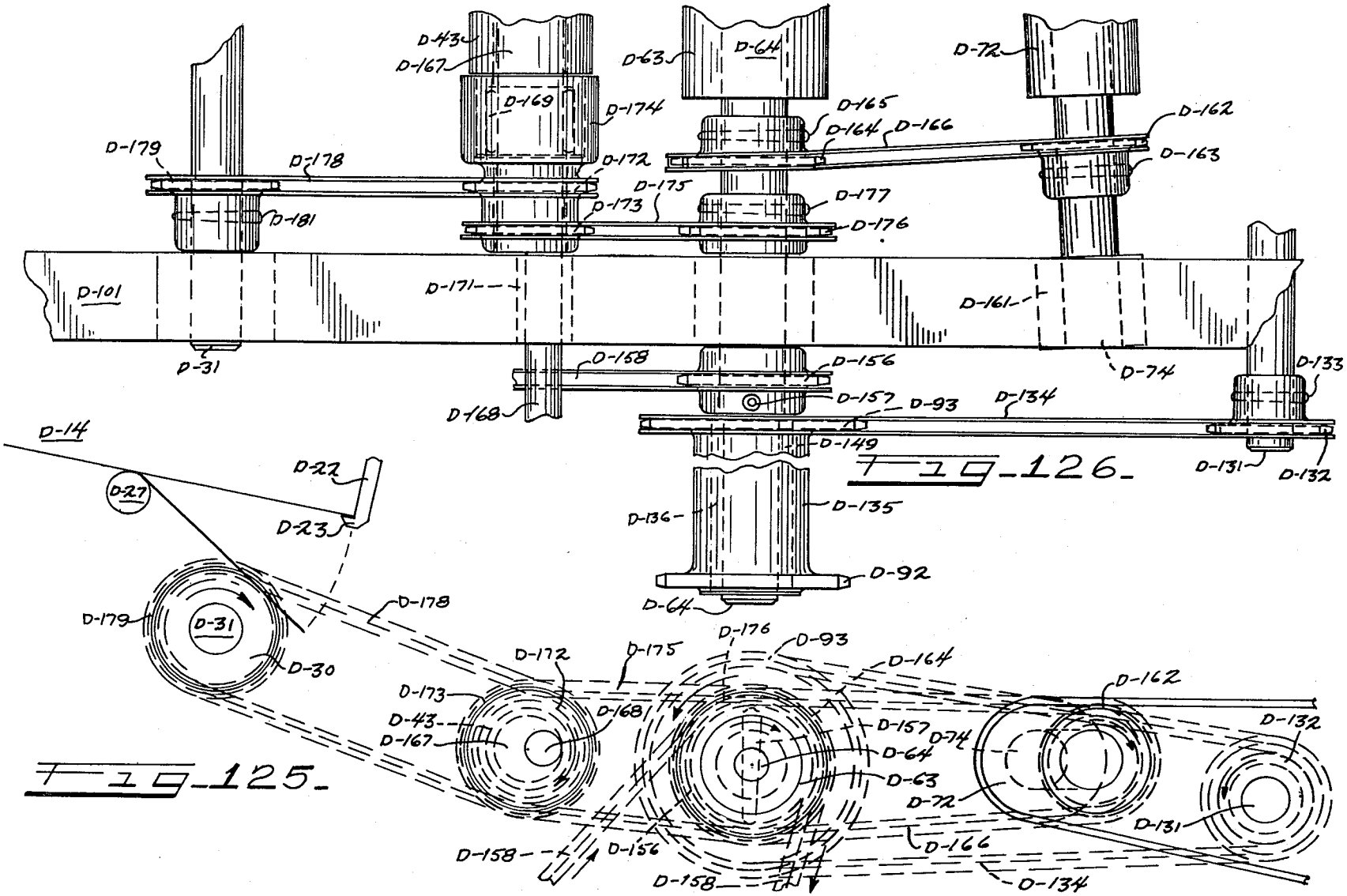
Figure 128:
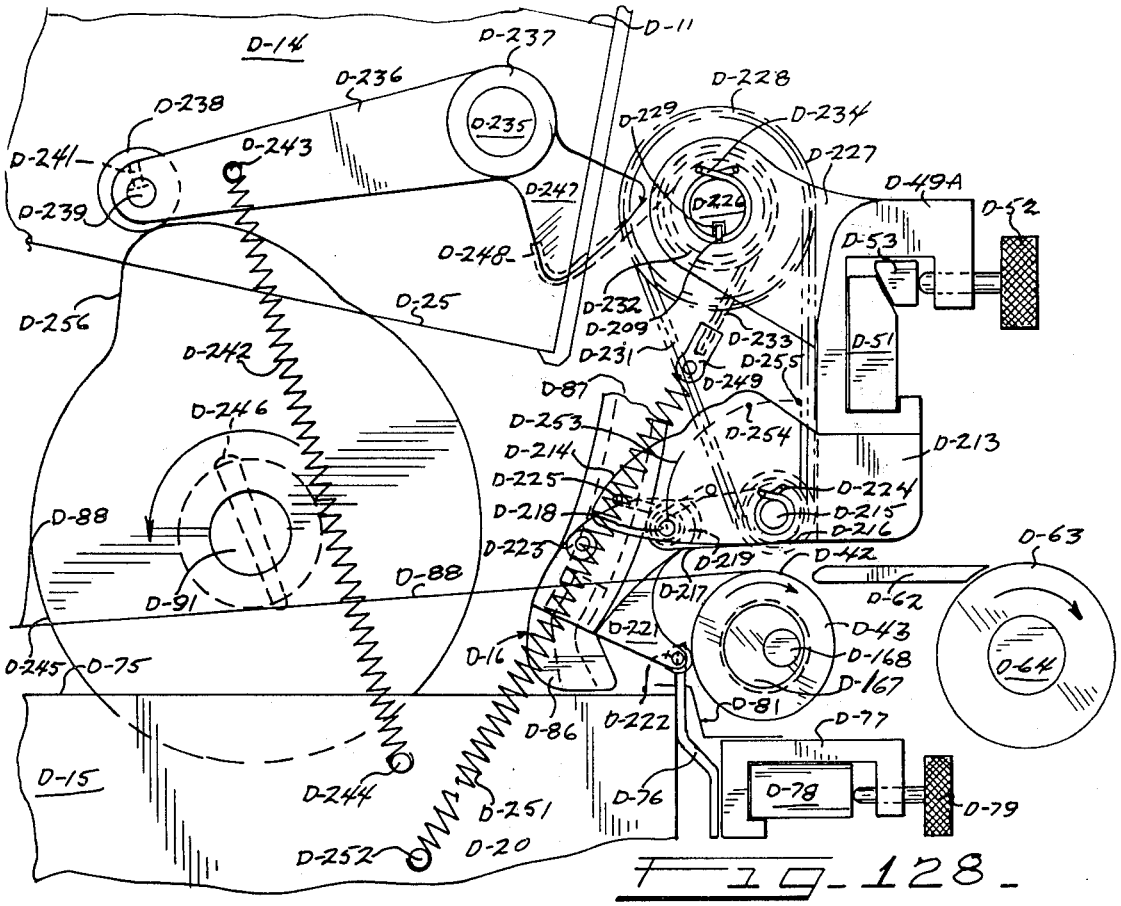
Figure 129:
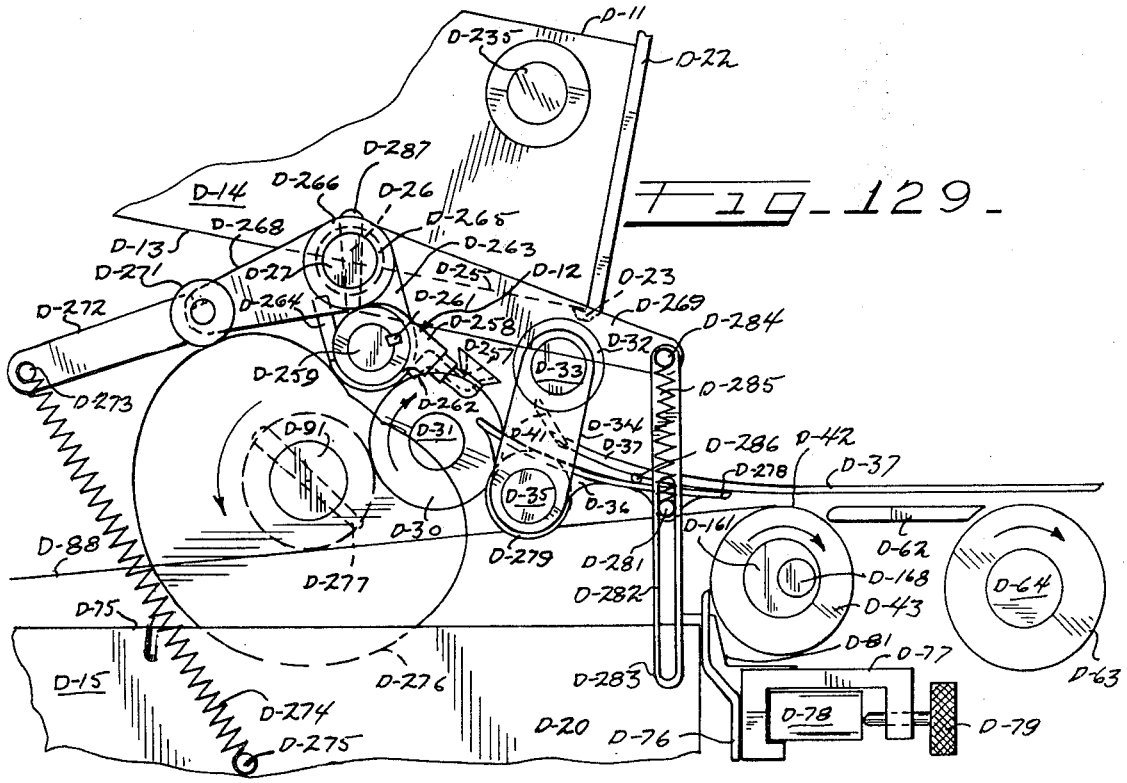
Figure 130:
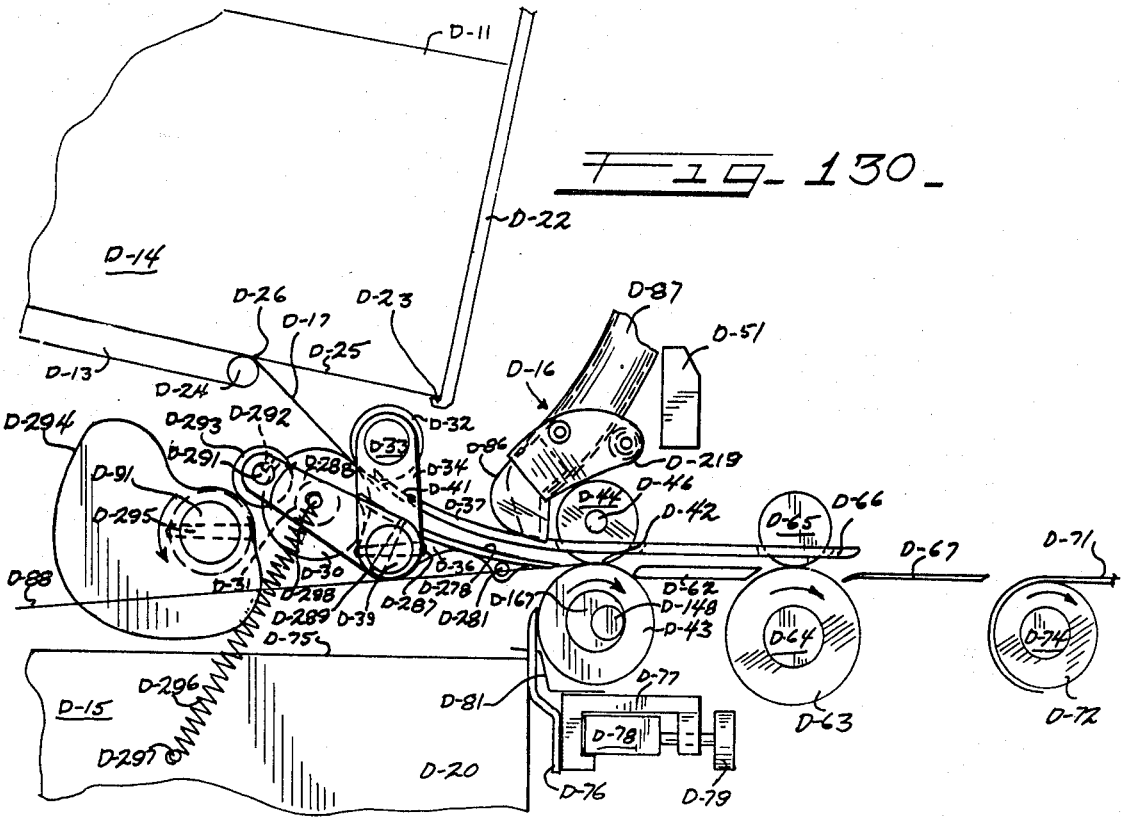
Figure 132:
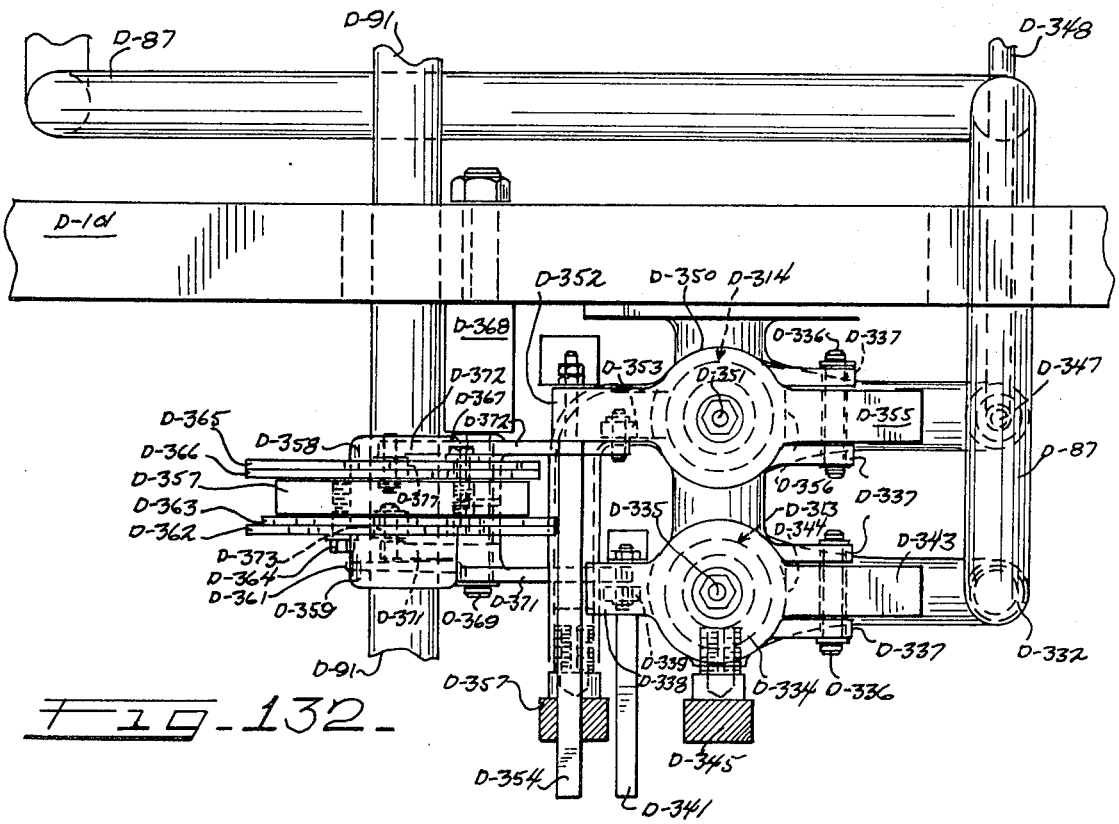
Figure 131:
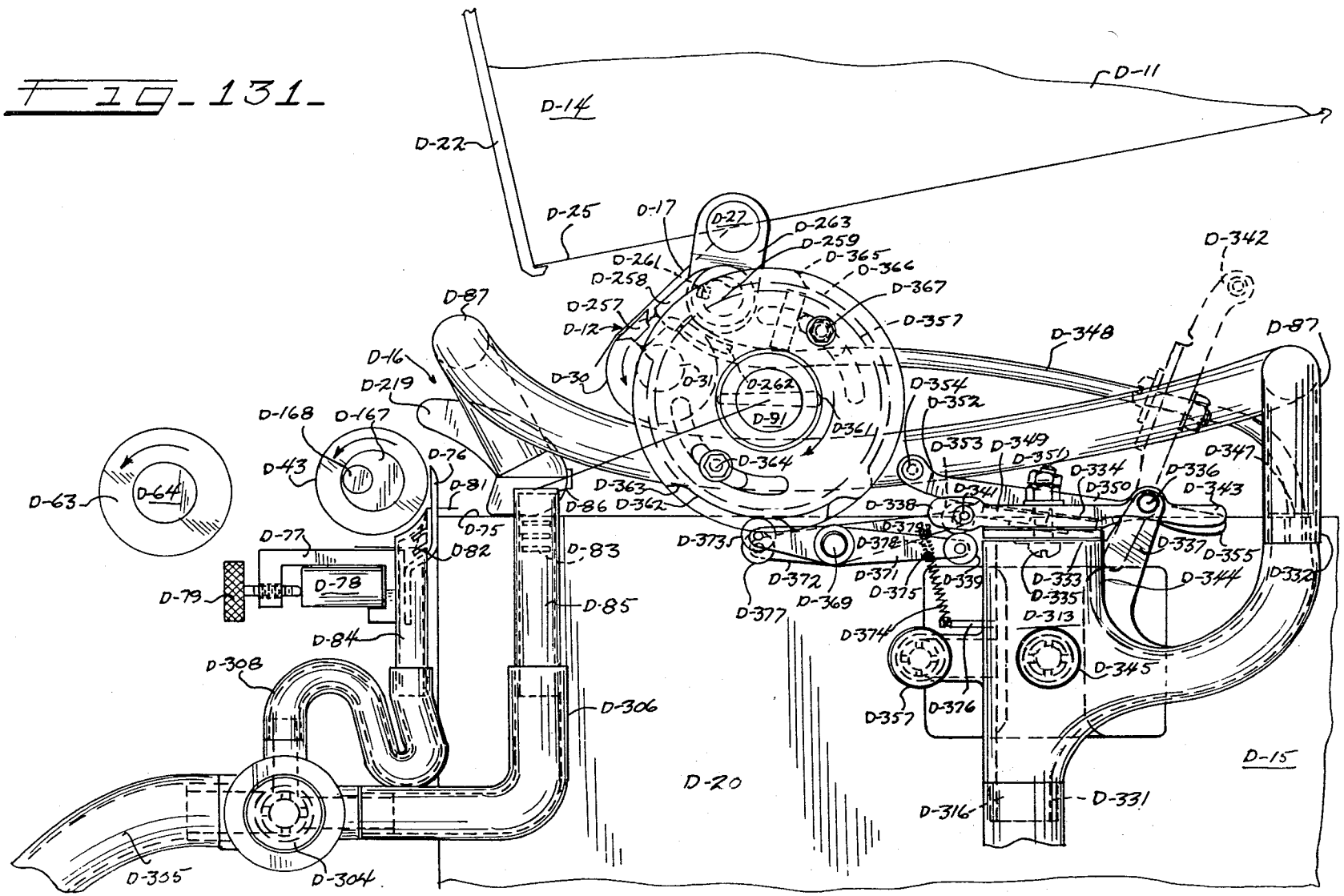
Figure 134:
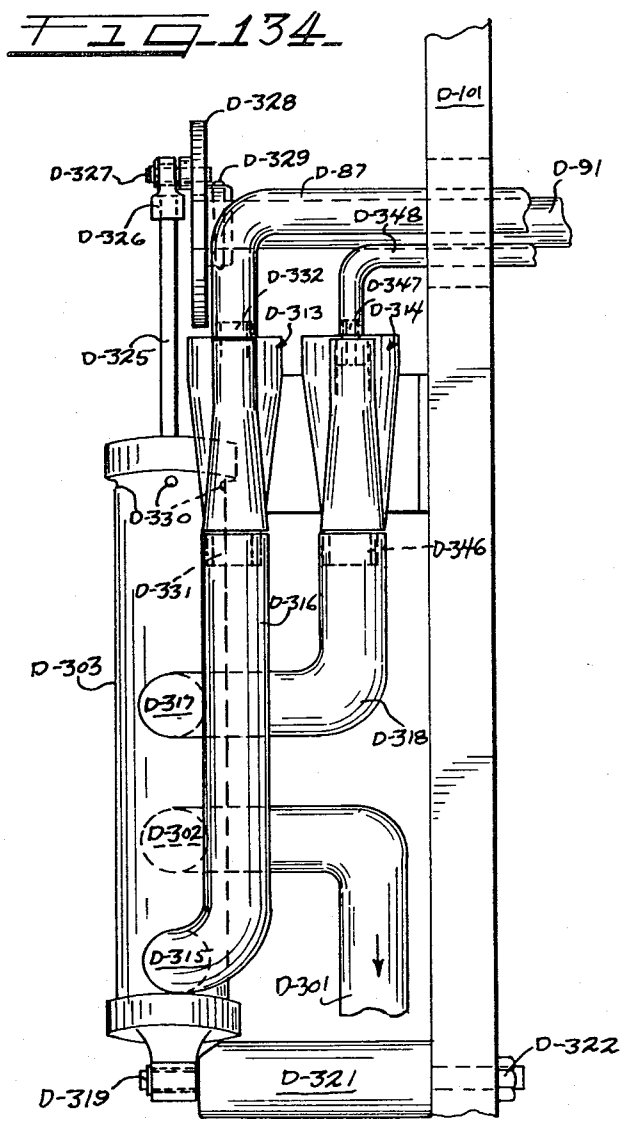
Figure 133:
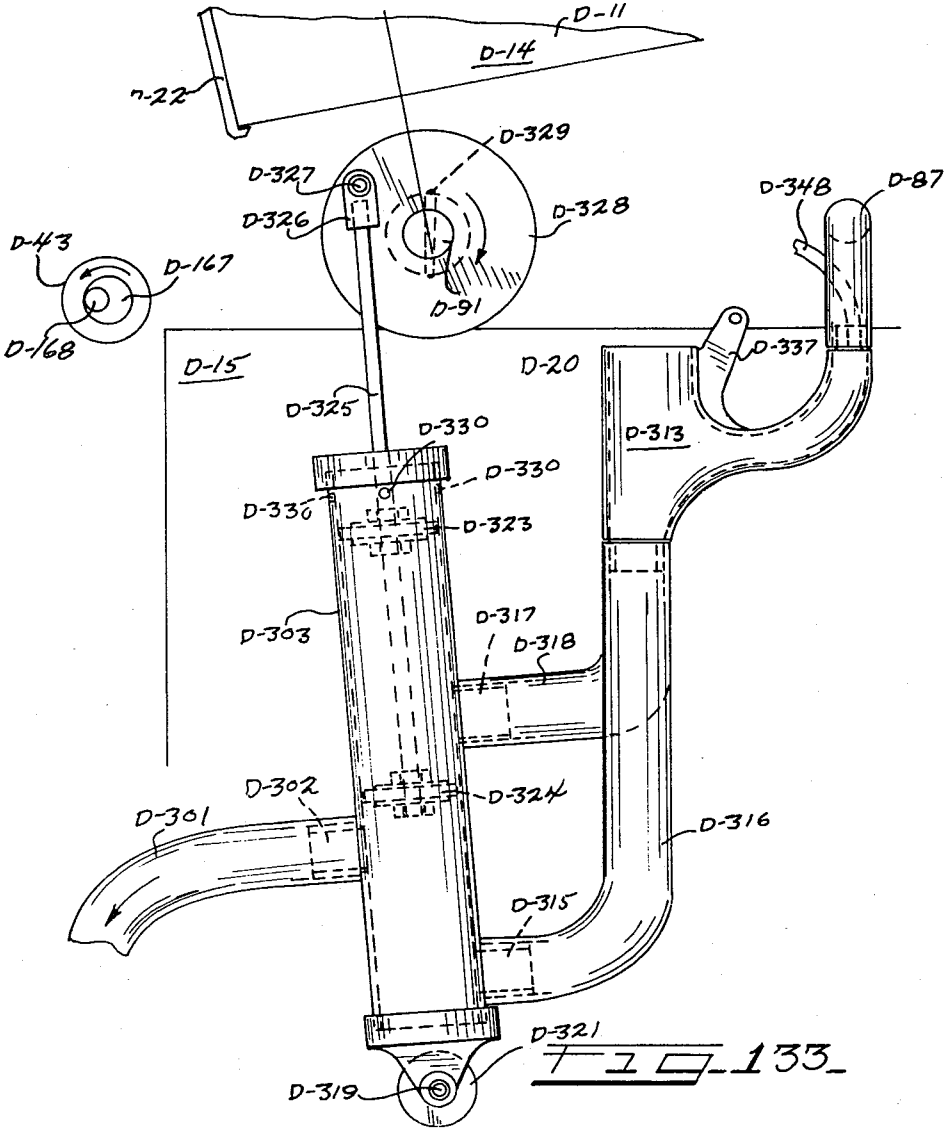
Figure 135:
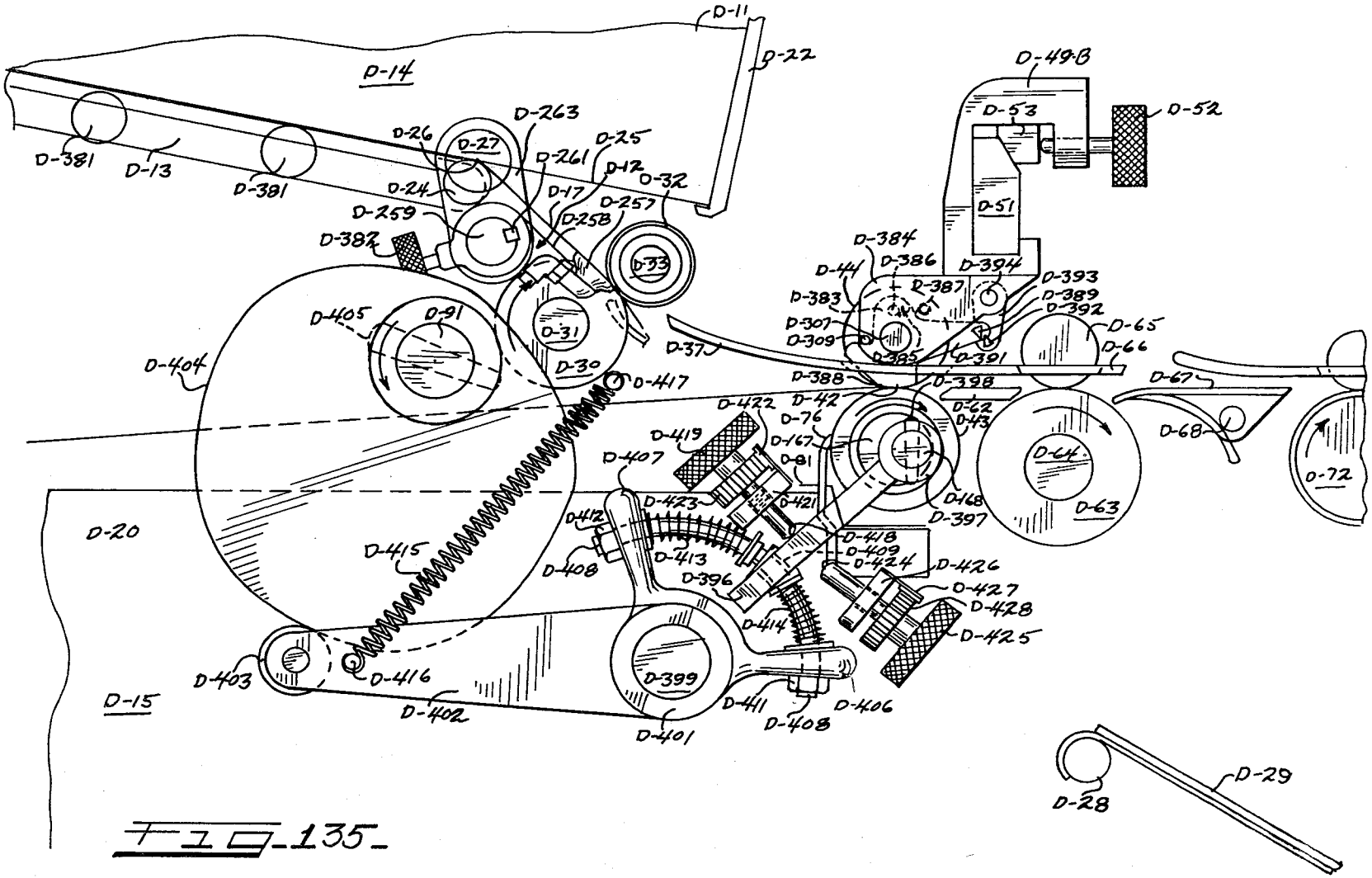
Figure 136:
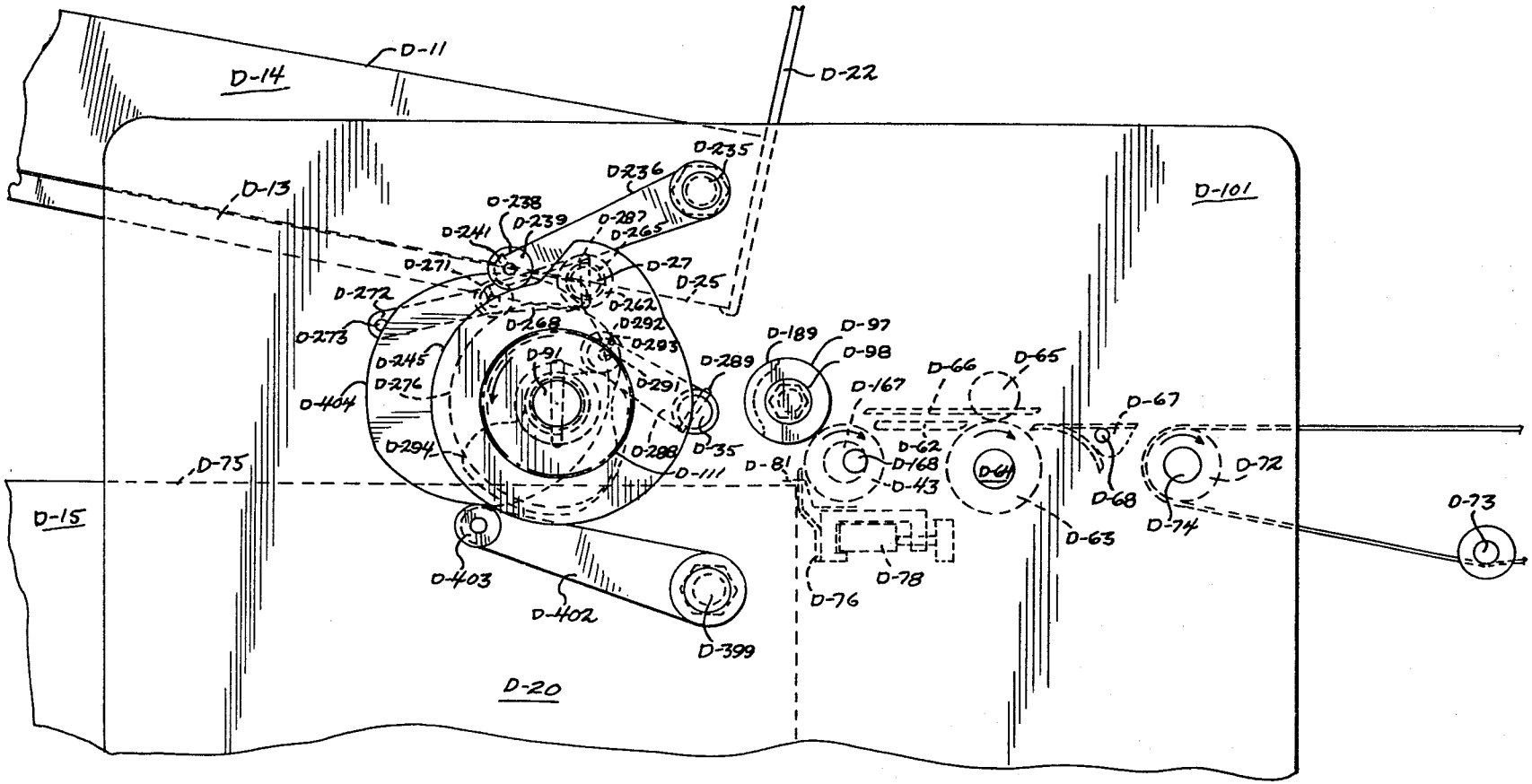
Figure 138:
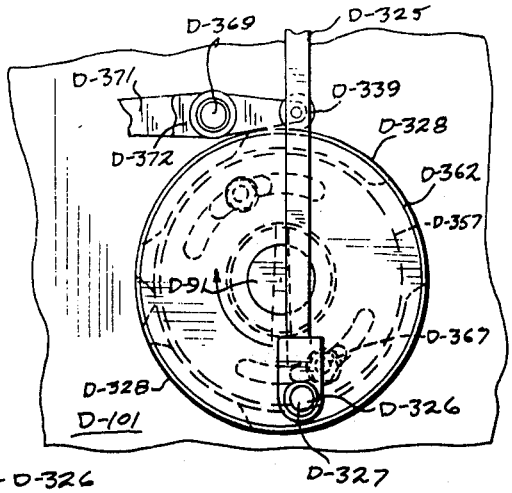
Figure 137:
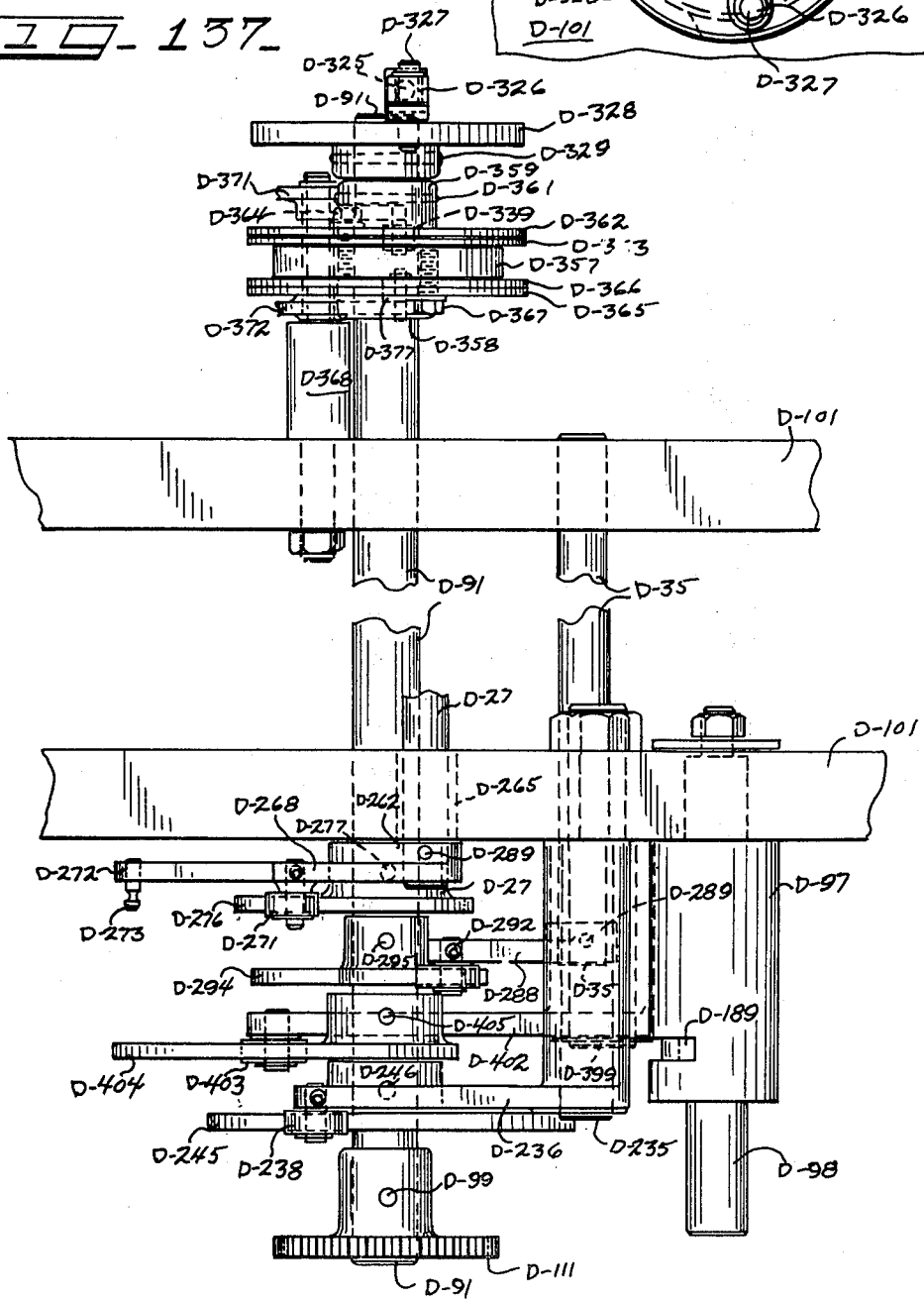
Figure 139:
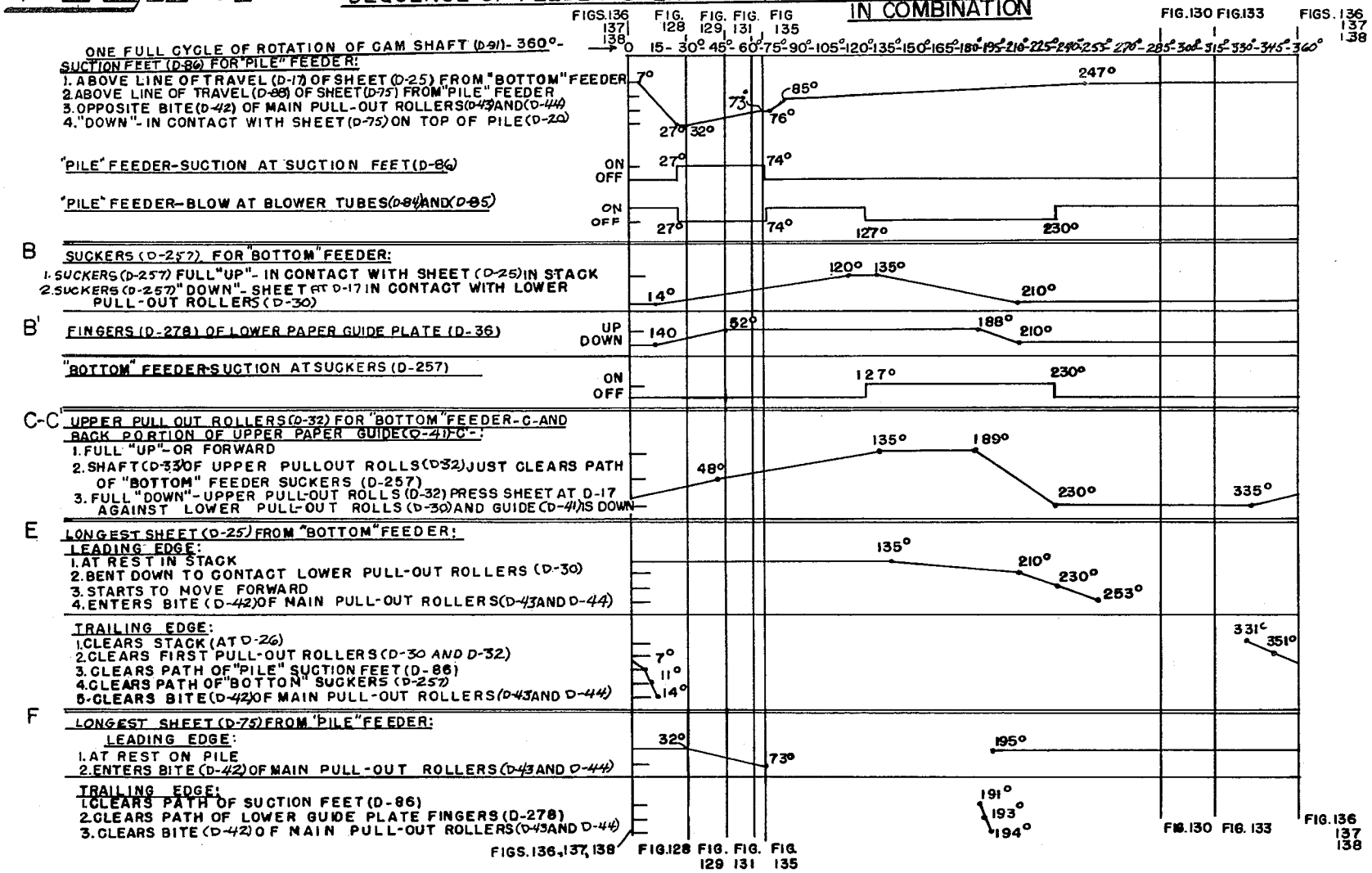
Figure 140:
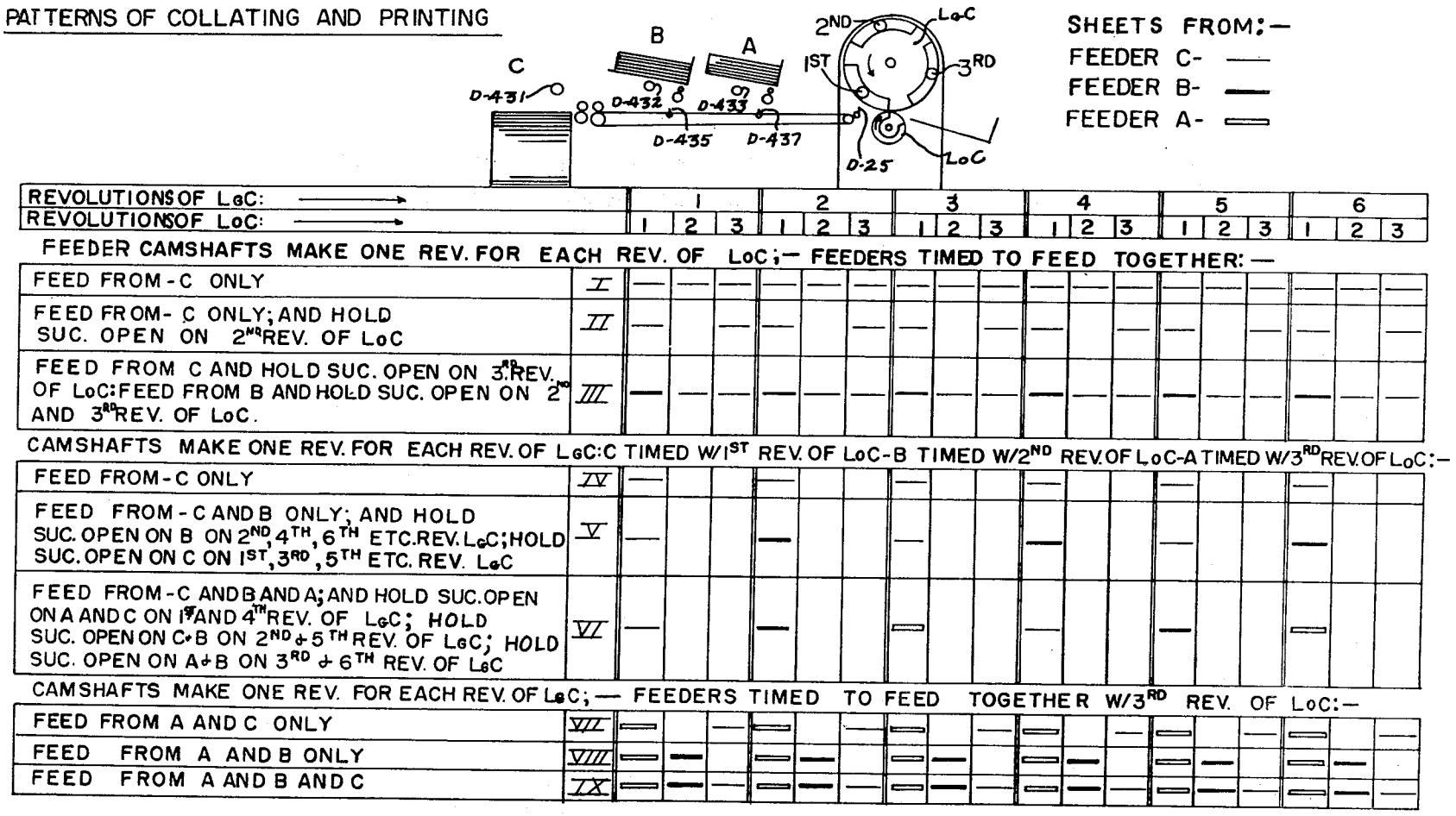
Figure 141:
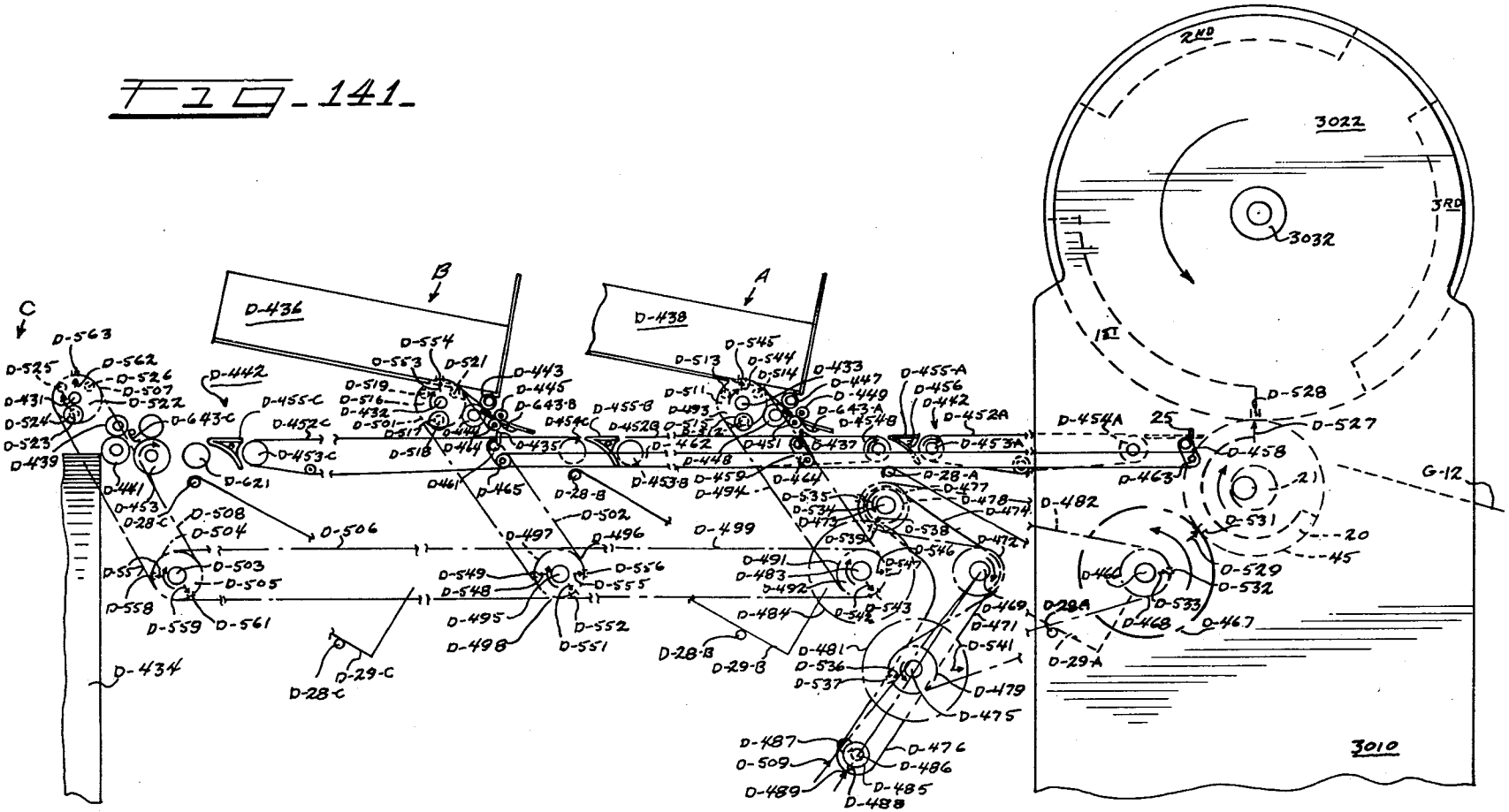
Figure 142:
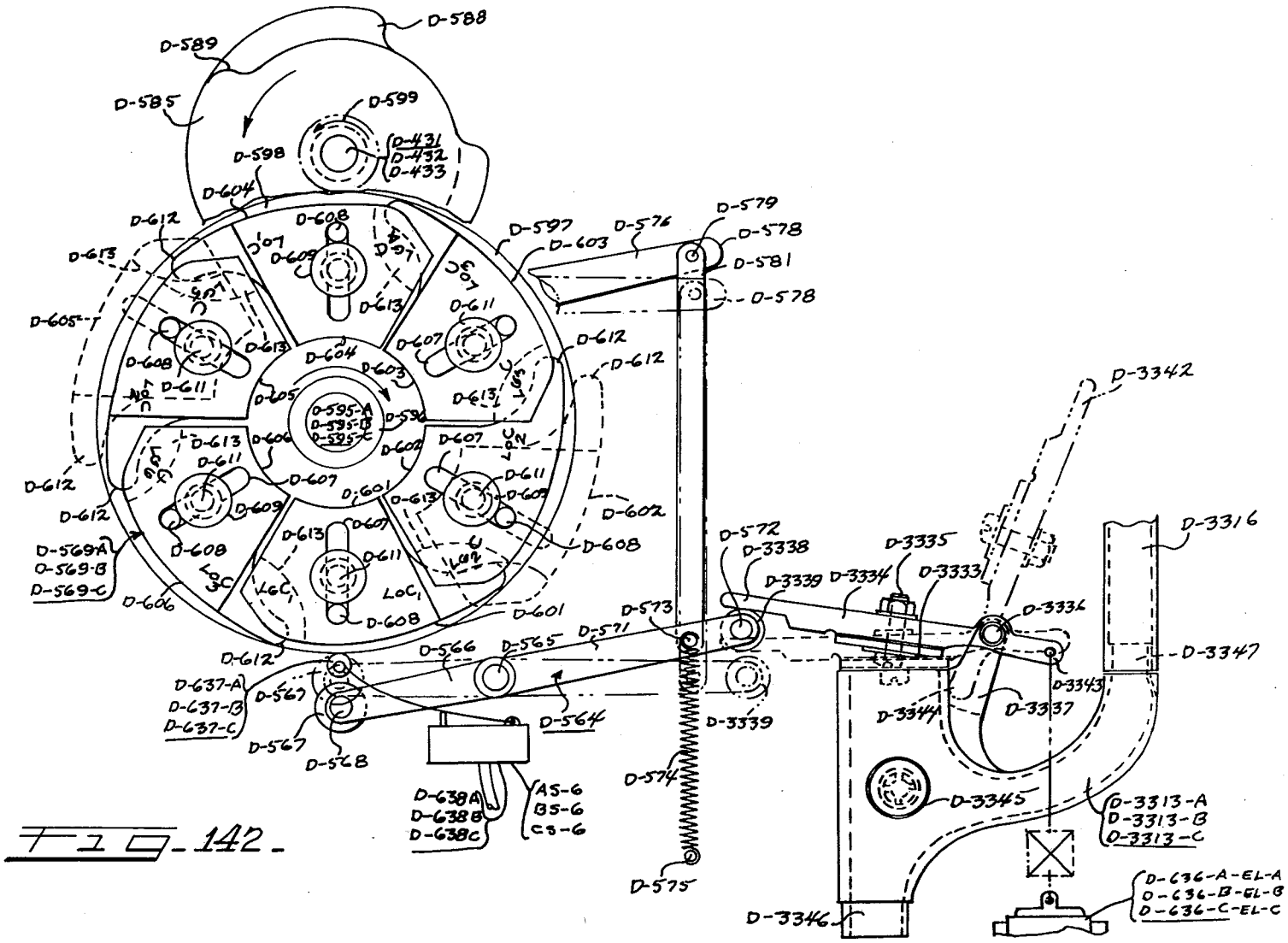
Figure 143:
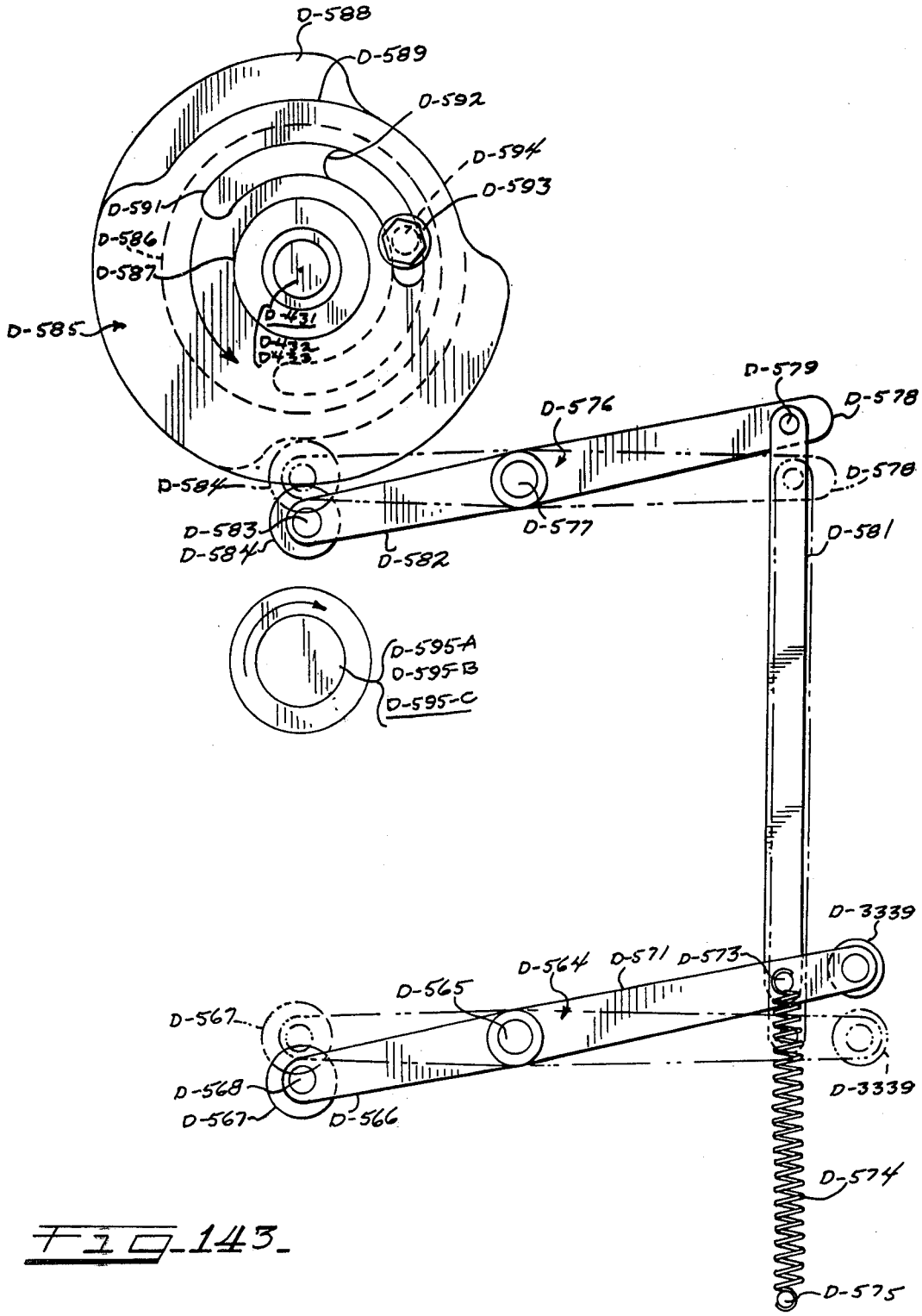
Figure 144A:
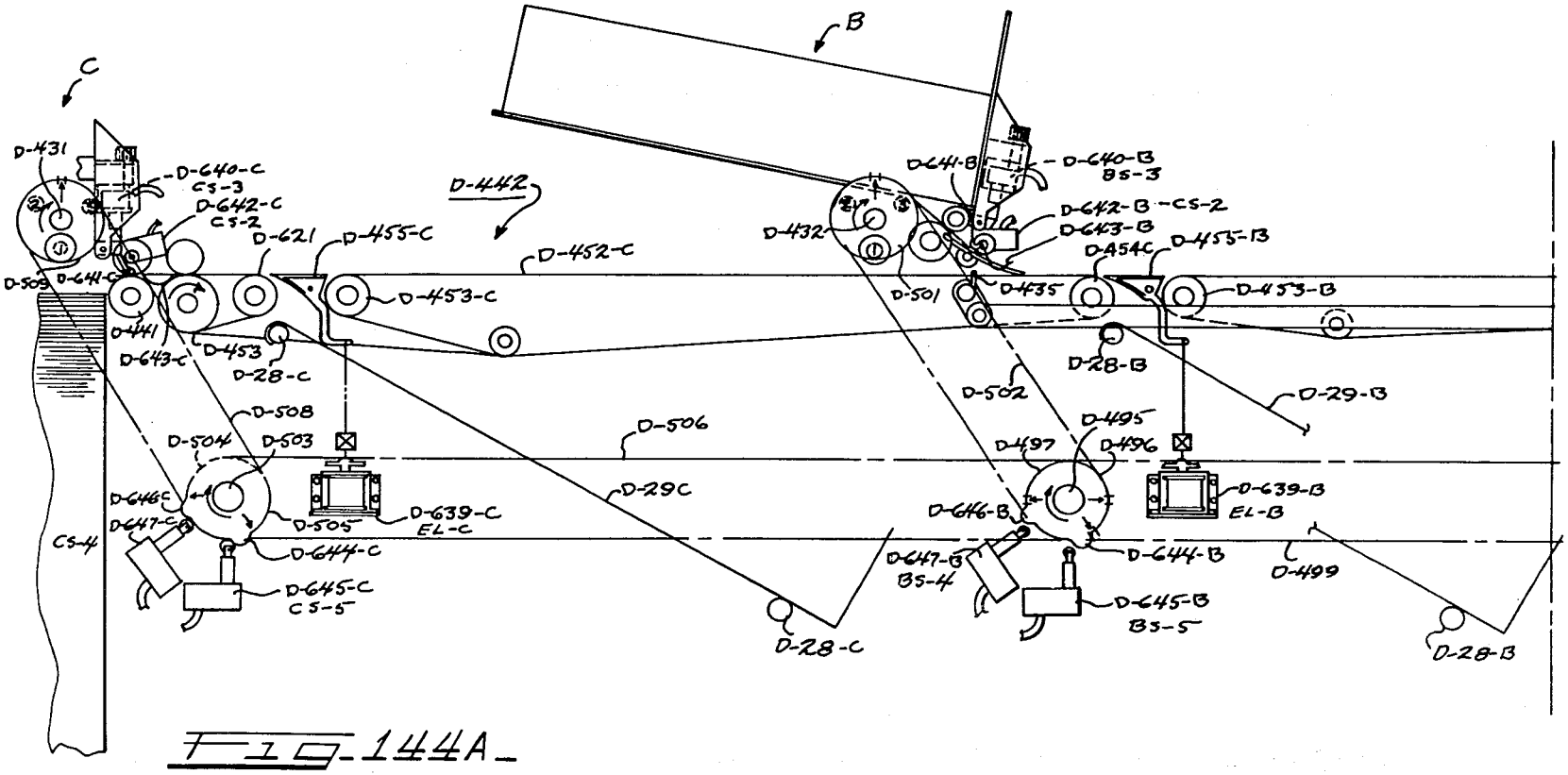
Figure 145:
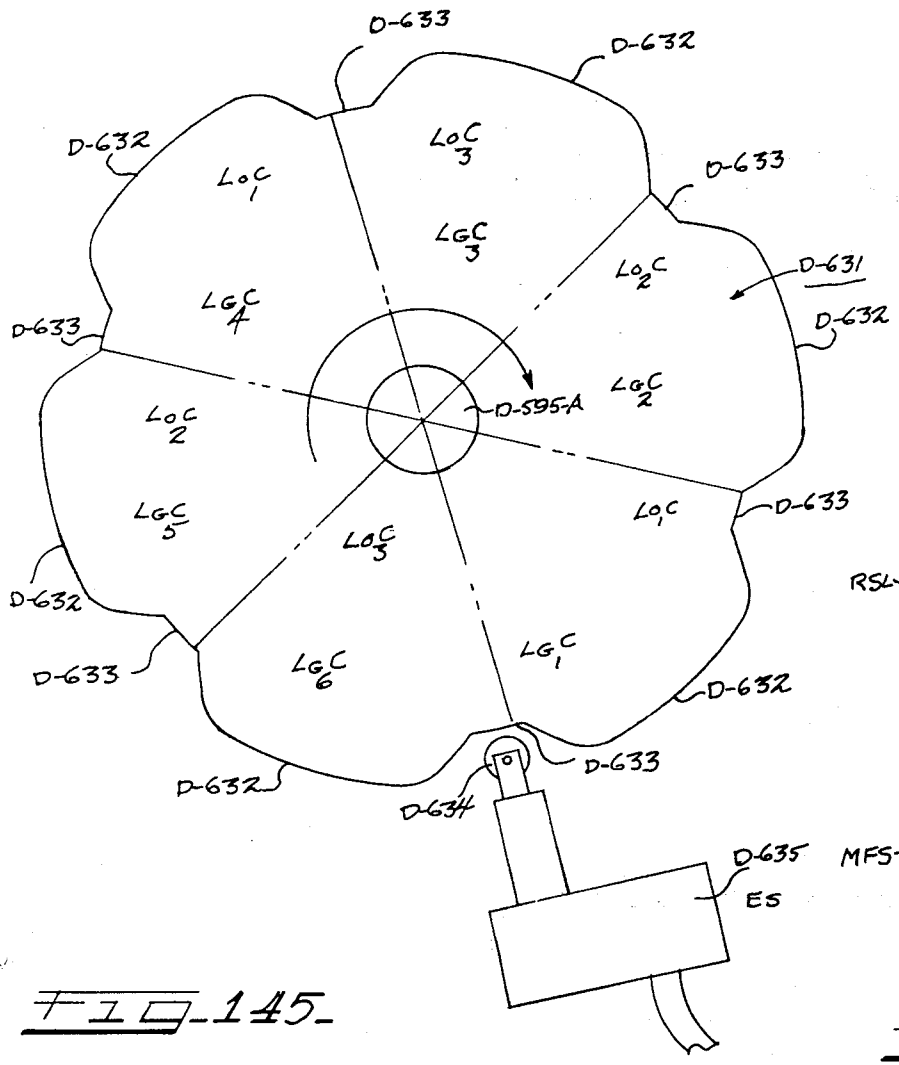

FIG. 78 is a side view of the lower printing cylinder and grippers and including a chain delivery mechansim;

FIG 79*a* and 79*b* together comprise a plan view of the cylinder gripper mechanism and chain delivery as shown in FIG. 78;

FIG. 80 is a view taken along the line 80—80 of FIG. 81 showing the mechanism for passing a sheet through the bite of the printing couple once or more than once;

FIG. 81 is a view partially in elevation and partially in section taken on the line 81—81 of FIG. 80 also relating to the mechanism for passing a sheet once, or more than once, through the bite between the large printing cylinder and the lower printing cylinder;

FIGS. 82 and 83 illustrate the drive for the oscillating distributor rollers and the mechanism for oscillating the rollers in the direction of their length, shown in a plate cylinder module;

FIGS. 84 and 85 illustrate the mounting of the form rollers in a plate cylinder module and show the mechansim for adjusting their pressure against the ink distributor roll, and against the plate, and the mechanism for lifting the form rollers out of contact with the plate;

FIG. 86 and 87 show details of the bracket for mounting and for adjusting the pressure of the form rolls;

FIGS. 88 and 89 are two views of an ink module showing its mounting and the mounting of the ink form rolls, and shows the mechanism for adjusting their pressure against the ink distributor roll and against a plate mounted in a work area of the large printing cylinder;

FIG. 90 and 91 illustrate the details in an ink module of the shaft carrying the cams and the linkage mechanism to manually lift the form rollers, out of contact with the plate;

FIG. 92 illustrates the mounting of certain of the soft ink distributor rollers in contact with the hard distributor rollers, and shows certain of the rolls of the auxiliary ink attachment;

FIG. 93 illustrates the mounting for the intermediate soft ink roller and showing the removability of the roller;

FIG. 94 shows details of the end mounting of the shaft for the intermediate soft ink roller;

FIGS. 95 and 96 illustrate details of the mounting of the soft idler distributor rollers in relation to the associated hard ink distributor rollers;

FIG. 97 is a view illustrating the auxiliary ink attachment mounted in a plate cylinder module;

FIG. 98 Shows the auxiliary ink attachment mounted in an ink module;

FIG. 99 is a side view of the auxiliary ink attachment looking at it from the right hand side of either FIG. 97 or FIG. 98;

FIG. 100 is a detail view of the mechanism for oscillating the hard distributor rollers of the auxiliary inking attachment in opposite phase to each other as they move from side to side;

FIG. 101 illustrates a dampening attachment as used with a plate cylinder module;

FIG. 102 shows a similar dampening attachment for use with an inking module;

FIG. 103 is a sectional view taken on the line 103—103 of FIGS. 104 and 105 and shows a plate cylinder module as seen from the left hand side of the press, showing the preferred mechanism for mounting and controlling the ink ductor roll;

FIG. 104 is a sectional view taken on the line 104—104 of FIG. 103;

FIG. 105 is a partial plan view of the mechanism illustrated in FIG. 103;

FIG. 106 is a sectional view taken on the line 106—106 of FIG. 104 and showing the means by which the ink fountain roller is driven;

FIG. 107 is a plan view illustrating the mechanism shown in FIG. 106;

FIG. 108 is a view of a large printing cylinder for a 2R model of the press showing a blanket segment mounted in one work area of the cylinder and a plate segment mounted in the other work area of the cylinder;

FIGS. 109 and 110 illustrate in detail the attaching means for securing and adjusting a plate on a plate segment on the large printing cylinder, or on a plate cylinder of a plate cylinder module;

FIG. 111 is an elevational view of a form roller of an inking or inking and dampening module with cam follower discs at each of the roller, shown with the hub portions of the followers facing inwardly, to align the follower disc with lifter cams mounted at the outer mounting positions on a segment on the large printing cylinder;

FIG. 112 is a side view of the form roller and the segment mounted on the large printing cylinder showing one of the lifter cams and cam follower discs by means of which the roller is lifted out of contact with the surface of the segment;

FIG. 113 is an elevational view similar to FIG. 111 of another form roller of an inking or inking and dampening module but with the hub portions of the cam follower discs facing outwardly, to align the follower disc with the lifter cams which are mounted at the inner position on a segment;

FIG. 114 is a side view of the form roller and segment arrangement illustrated in FIG. 113;

FIG. 115, 116 and 117 are elevational views similar to FIGS. 111 and 113 but showing the inking or inking and dampening module form roller, follower disc, and lifter cam arrangements as used on a 3R model press;

FIG. 116*a* is a view of the 3R segment of FIG. 116 but showing lifter cams mounted in two positions;

FIG. 118 shows a separate dampening module mounted at station I on a preferred form of a 2R model press;

FIG. 119 illustrates the preferred form of the basic frame structure and module mounting arrangement of a 3R model press showing the three work areas of the large printing cylinder and the locations of the four module mounting stations, and showing a typical combination of printing modules mounted at the four module mounting stations;

FIG. 120 illustrates the ink ductor and fountain roll arrangement for a plate cylinder module mounted at station I of a 3R press such as shown in FIG. 119, and shows the arrangement for mounting the ink fountain in a horizontal position when this module is mounted at this module mounting station;

FIG. 121 is a view of a 2R press with a pile type suction feeder associated therewith in combination with a "bottom feeder";

FIG. 121*a* is an enlargement of the area encircled in FIG. 121;

FIG. 122, taken with FIG. 121, illustrates the drive for the feeders and the conveyor;

FIG. 123 is a side view of the arrangement shown in FIG. 122 as seen from the left side thereof;

FIG. 124 is a plan view of the mechanism shown in FIG. 122;

FIGS. 125 and 126 illustrate the drive arrangement for the pull-out rolls and the conveyor tapes on the feeders;

FIG. 127 shows details of the conveyor board for conveying sheets from the main pull-out rolls of the feeders to the feed rollers and stop fingers of the press;

FIG. 128 illustrates the suction foot arrangement for the "pile" feeder and shows the cam and associated mechanism for driving and controlling the position thereof;

FIG. 129 illustrates the cam and mechanism for driving the suction foot or suction feet for the "bottom" feeder with linkage to move a paper guide synchronized with the suction foot;

FIG. 130 shows the mechanism for controlling the operation of the upper pull-out roll on the "bottom" feeder;

FIG. 131 and 132 illustrate the arrangement for making and breaking suction on the feeders, and for blowing air between the edges of the sheets at the top of the pile on the "pile" feeder;

FIGS. 133 and 134 illustrate the valve arrangement for drawing suction from one feeder and then the other, timed with their operation;

FIG. 135 is an illustration of the feeders with the double sheet eliminator for detecting papers of different thickness from the two feeders;

FIGS. 136, 137 and 138 show the feeder camshaft and cams from both sides and in plan;

FIG. 139 is a chart showing the sequence of feeder operations for the "pile" and "bottom" feeders in combination;

FIG. 140 is a chart which shows various patterns of collating and printing one, two or three sheets that may vary as to color, thickness, material, texture or length, and which may be printed with the same or different images;

FIG. 141 is an illustration of a 3R press showing three feeders mounted in cooperative relation to each other and with the press;

FIGS. 142 and 143 illustrate the control means by which the several feeders are operated to obtain the results indicated in the chart of FIG. 140;

FIGS. 144*a* and 144*b* taken together illustrate certain of the electro-mechanical control elements of the feeders shown in FIG. 141;

FIG. 145 shows the detail of additional elements of the electro-mechanical controls of FIGS. 144*a* and 144*b;*

Figure 146:
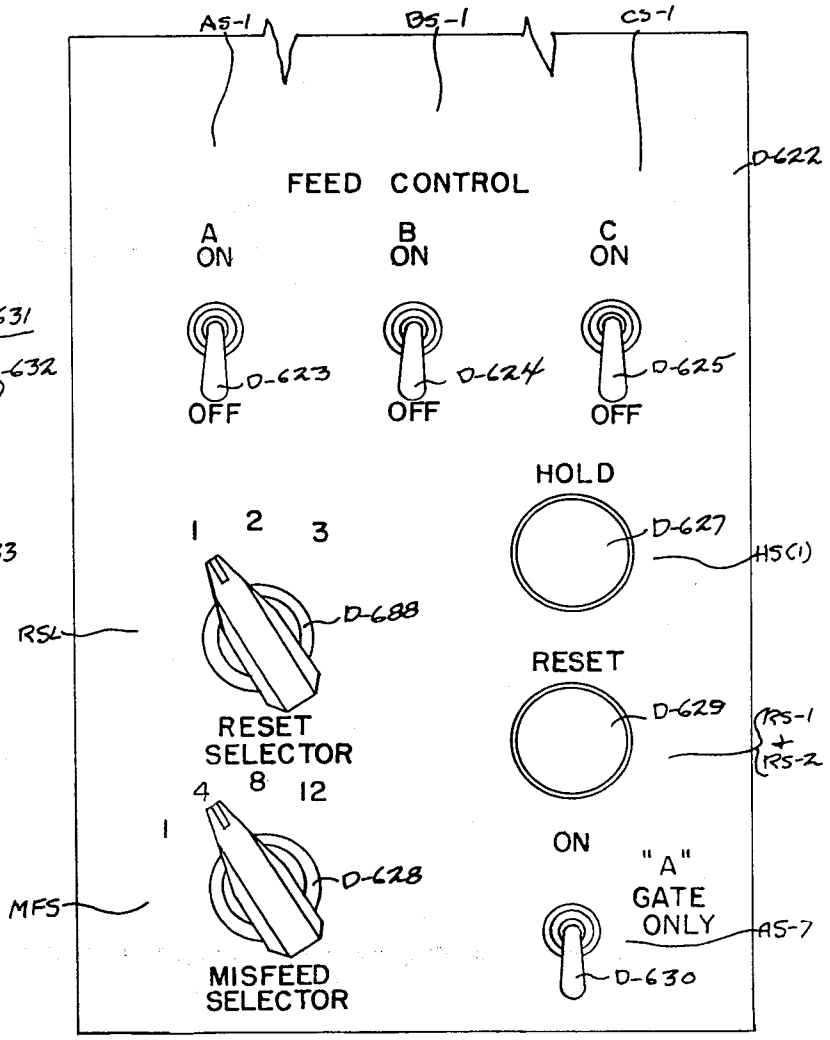
Figure 147:
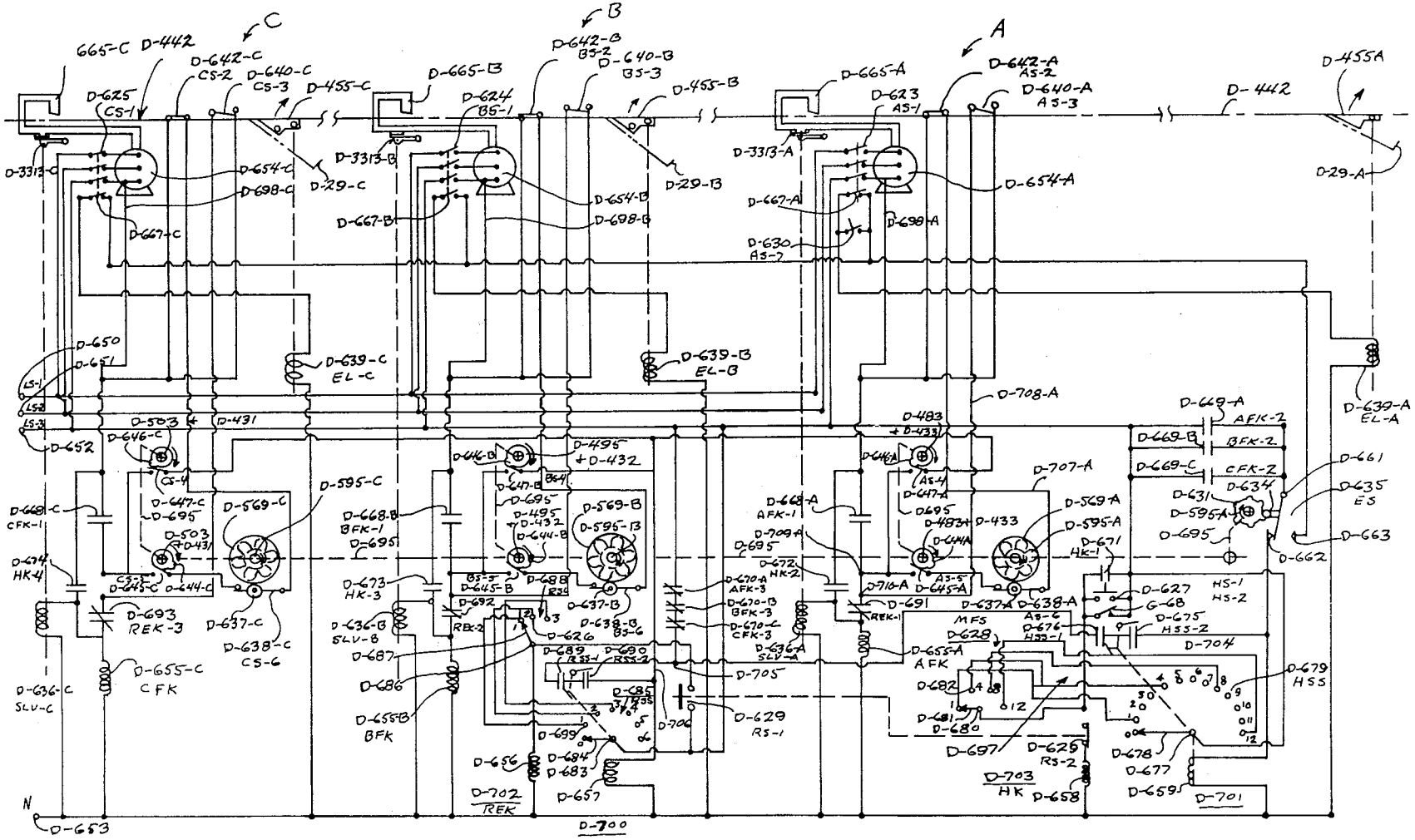
Figures 148, 148A, 149, 149A, 150, 150A, 151, 151A:
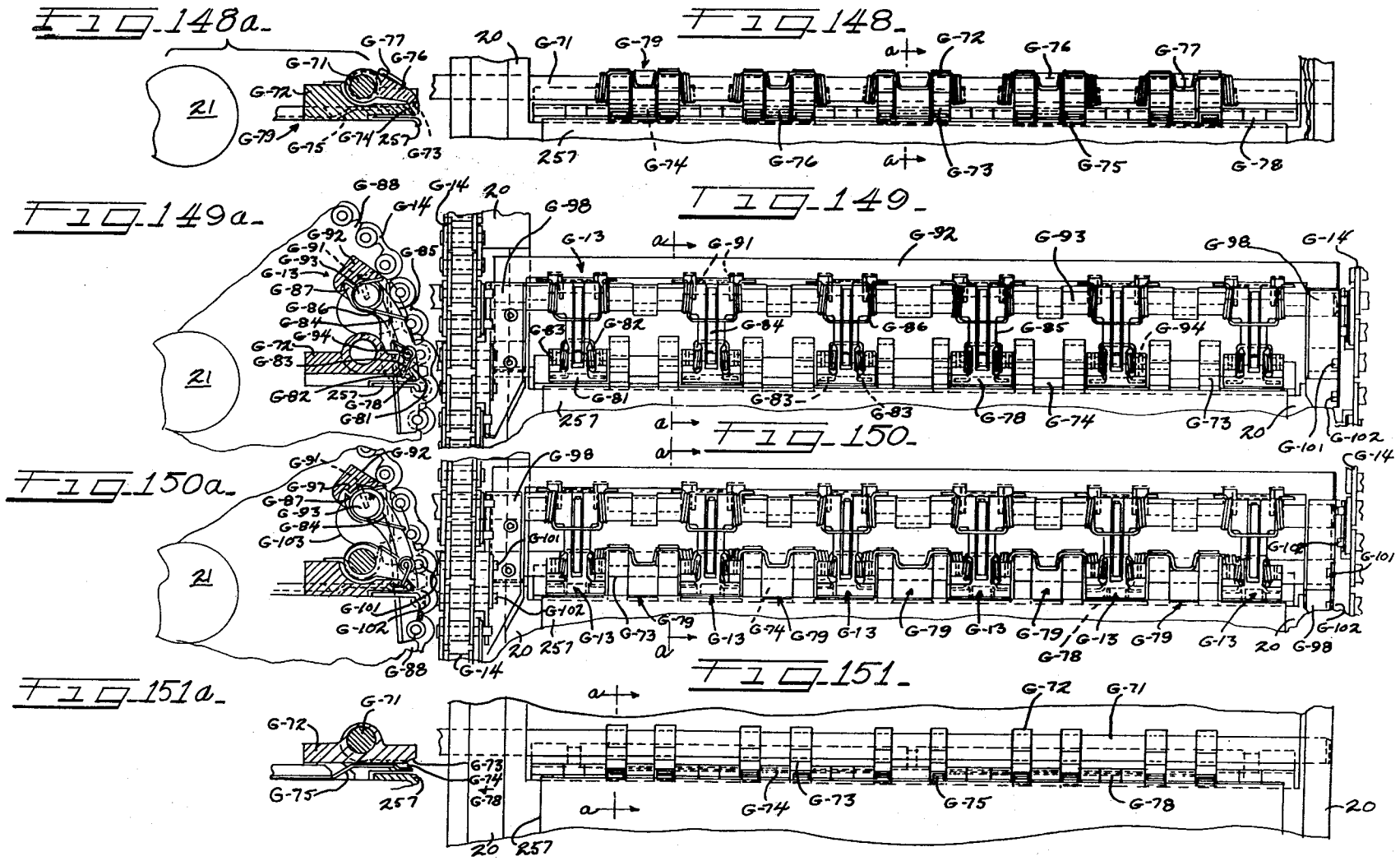
Figure 152:
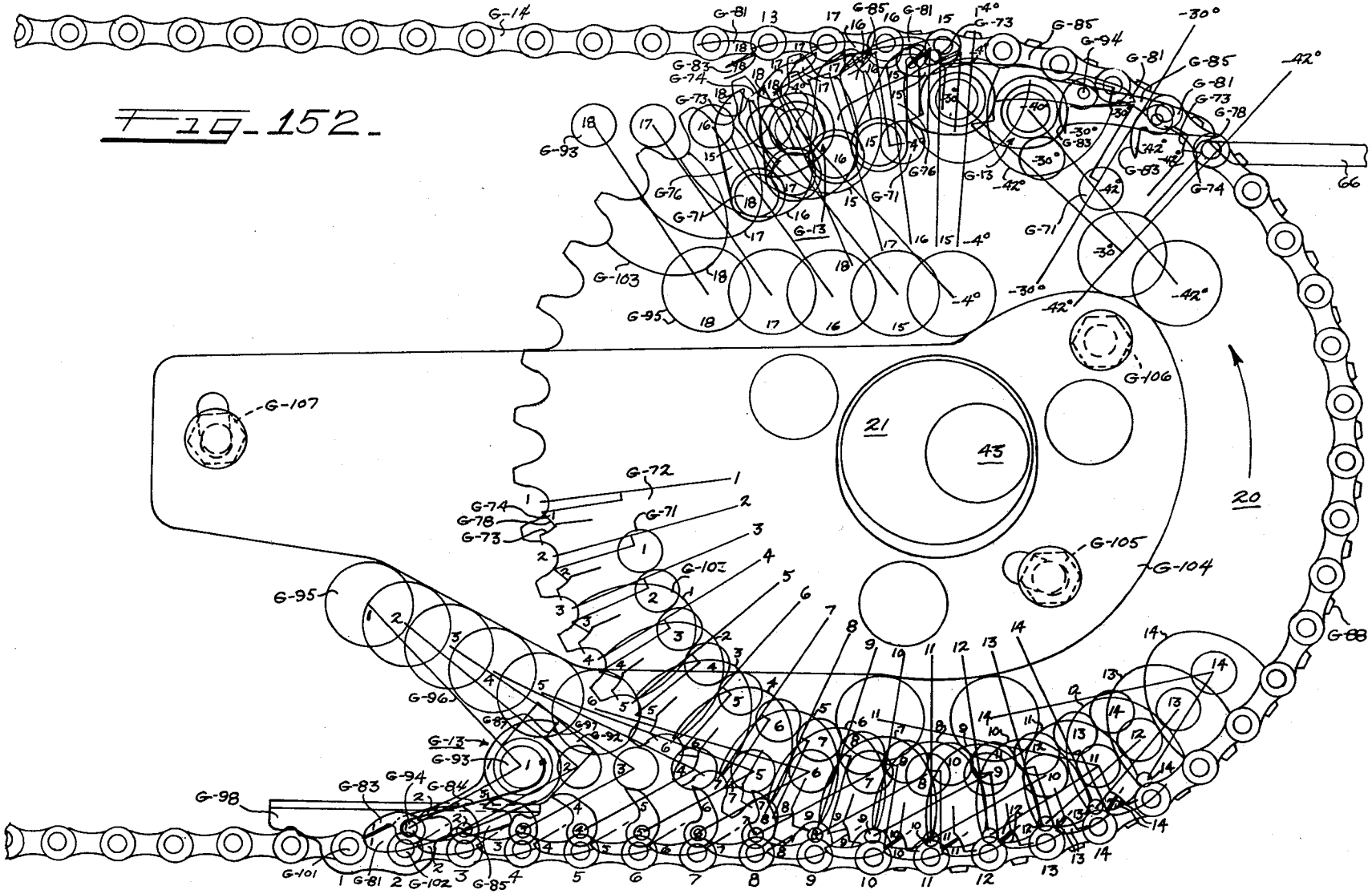
Figure 154:
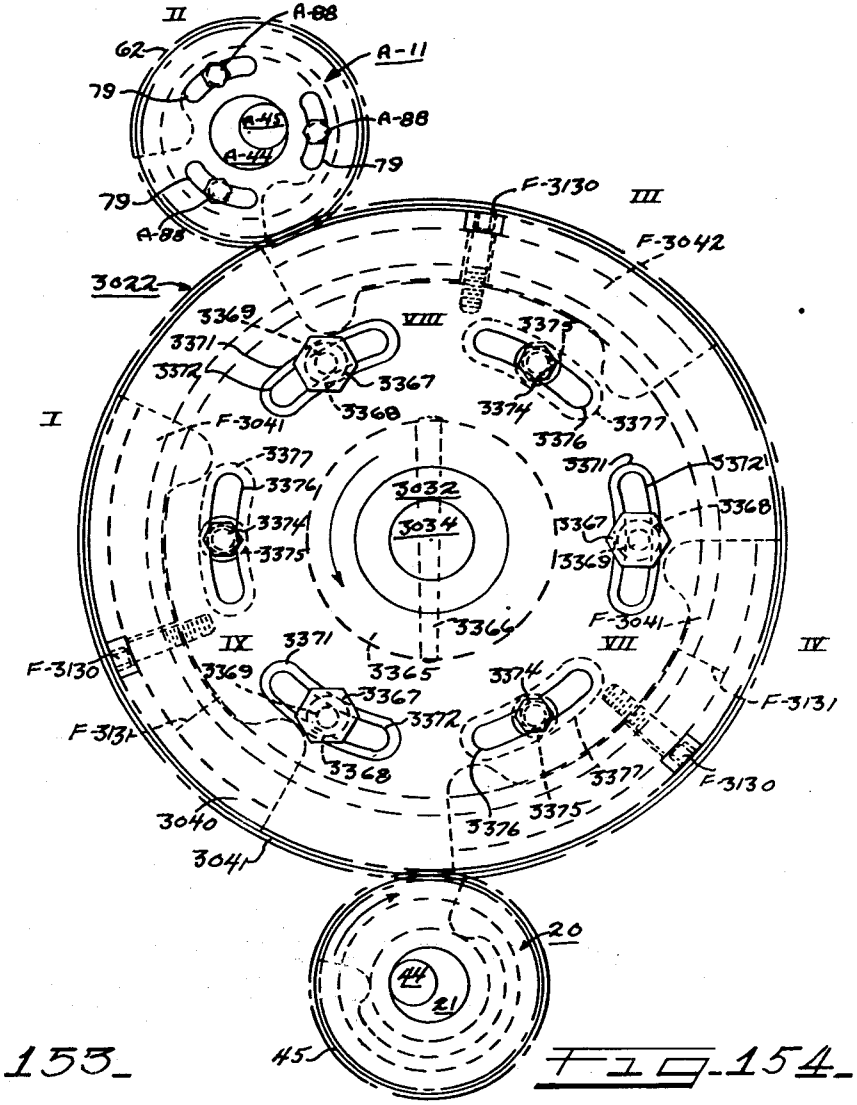
Figure 153:
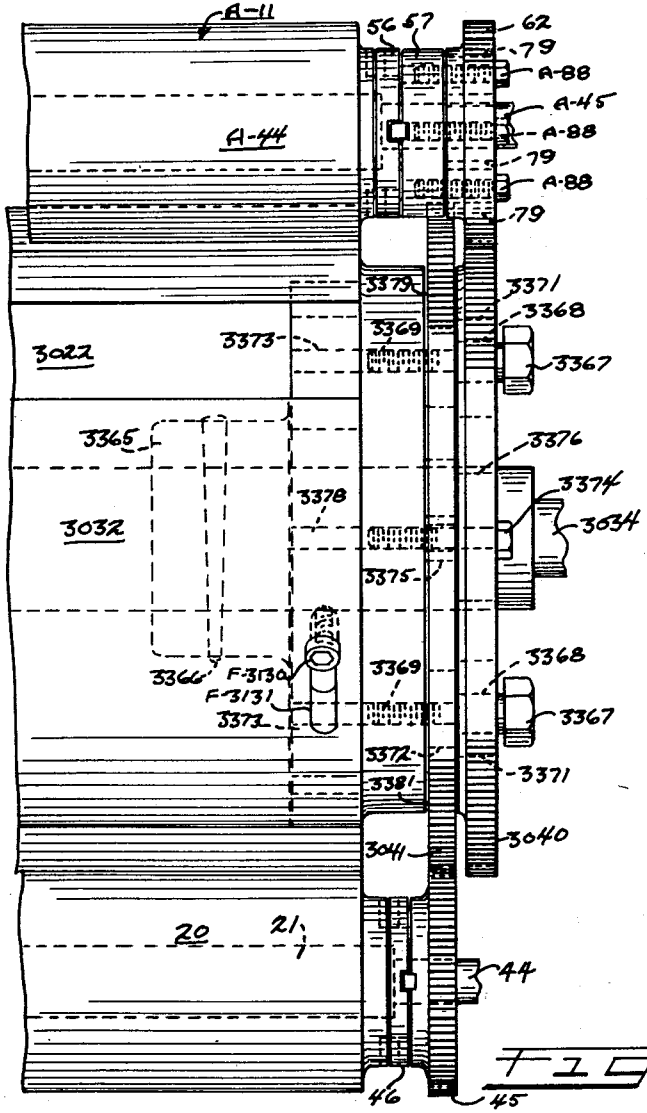

FIG. 146 shows the control panel for the electro-mechanical controls;

FIG. 147 is a wiring diagram showing the electrical interconnection of the electro-mechanical components;

FIG. 148 and FIG. 148*a* taken on the line a—a of FIG. 148, illustrate the cylinder grippers and ejector fingers and the cylinder stops and the anvils which are rigidly secured to the lower printing cylinder;

FIG. 149, and FIG. 149*a* taken on the line a—a of FIG. 149, illustrate the chain grippers carried by the encircling chains and the cylinder stops and the anvils;

FIG. 150, and FIG. 150*a* taken on the line a—a of FIG. 150, illustrate the cylinder grippers in combination with the chain-carried grippers together with the cylinder stops and the anvils;

FIG. 151, and FIG. 151*a* taken on the line a—a of FIG. 151, show the member which comprises the cylinder stops secured to the lower printing cylinder and the anvils and the supports for the shaft of the cylinder grippers as well as the ejector fingers;

FIG. 152 is a view of the lower printing cylinder with the encircling chain-carried grippers and cylinder grippers, showing the progressive opening and closing of the encircling chain-carried grippers as they approach the lower printing cylinder on the encircling chains and then pass around the cylinder and away, and FIGS. 153 and 154 illustrate the means for making vertical image adjustments on the 3R model of the press.

DEFINITION OF TERMS

In order to make the commentary contained herein more readily understandable the following terminology has been adopted:

OFFSET—The term "offset" refers to any printing process in which an image is first transferred to an intermediate printing surface and then transferred again (offset) onto the sheet being printed upon.

DOUBLE OFFSET—The term "double offset" refers to a printing process in which an original image is first transferred to an intermediate printing surface, from which it is then again transferred (offset) onto another intermediate printing surface, from which it is finally transferred again (offset) onto the sheet being printed upon.

WET OFFSET—The term "wet offset" refers to the offset lithographic process, in which a lithographic, grease receptive image, on the surface of a planographic plate, is repetitively inked with a greasy ink, while the non-image areas of the plate are kept ink repellent by repetitive applications of grease repelling materials, with the inked image being printed onto sheets through an offset process.

DRY OFFSET—The term "dry offset" refers to the printing process in which a raised image is repetitively inked and the inked image is printed onto sheets through an offset process. The non-image areas are depressed and, therefore, do not come in contact with the ink rollers or the printing surface to which the image is transferred. (This is sometimes referred to as "letterset" printing).

WET OFFSET PLATE—A "wet offset plate" is any plate of zinc, aluminum, paper, plastic or other material, which is planographic and which carries on its surface an image receptive to greasy ink, and the non-image areas of which are receptive to a substance which will not accept, or which repels, greasy ink.

DRY OFFSET PLATE—A "dry offset plate" is any plate, or other imaging device (of any material) with a raised image area and a relatively depressed non-image area, and from which the image is to be printed onto sheets through an offset process.

OFFSET BLANKET—An "offset blanket" is a sheet of resilient material which may be attached to a cylindrical surface and which has a smooth, continuous, ink receptive outer surface, and which is used as an intermediate printing surface in the transferring, or offsetting, of an image in the offset printing process.

LETTERPRESS—"Letterpress" is any printing process in which ink is applied to a raised image and the image is then printed onto sheets by direct contact of the inked image with the sheets to be printed. The non-image areas are relatively depressed and, therefore, do not receive ink from the ink rollers and do not contact the sheet being printed. The raised image may be in the form of a plate individual type characters, linotype slugs, or an imaging device such as a numbering machine. The raised image may be of any material, such as various metals, rubber, plastic, etc.

LETTERPRESS PLATE—A "letterpress plate" is any form of raised image used in letterpress printing.

PLATEN—A "platen" is any roller or cylinder which rolls in contact with one side of a sheet for the purpose of applying pressure, so that the sheet is squeezed between the "platen" and a printing surface carrying an inked image, on the other side of the sheet, for the purpose of causing the inked image to be transferred to the surface of the sheet.

PLATEN SURFACE—The cylindrical surface, or surface covering, of a cylinder that acts as a platen. Various materials may be used as platen surfaces, such as metals, plastics, special papers, and rubber of varying degrees of hardness, including offset blankets. (When pressure is applied to a sheet as it passes between two offset blankets, each of which carries an inked image, so that images are printed simultaneously on both sides of the sheet, then, in this instance, both offset blankets are also acting in the capacity of platen surfaces.)

EMBOSSING PLATE—An "embossing plate" is a plate with a raised image (which is ordinarily not inked) which squeezes a sheet passed between it and an opposing resilient printing surface with sufficient force to cause the sheet to be pressed into the opposing resilient surface far enough that the pattern of the image on the embossing plate is embossed into the sheet. (The resilient printing surface may also carry an inked image which is an identical "mirror" image of the image on the embossing plate, and is in perfect register with it, and in this case the embossing plate also acts as a platen. If there is no inked image on the resilient printing surface, and the embossing plate is not inked, the embossing which results is known as "blind" embossing.)

PRINTING SURFACE—A "printing surface" is any cylindrical surface directly involved in a printing or embossing process, such as a wet offset plate, a dry offset plate, an offset blanket, a letterpress plate, a platen surface, an embossing plate, or any other image carrying or transferring surface, or any surface which applies pressure to a sheet in connection with the transferring of an image or the embossing of sheets.

PRINTING CYLINDER—A "printing cylinder" is any cylinder in the press which carries, or may carry, a "printing surface" as herein above defined.

WORK AREA—A "work area" on any of the printing cylinders of the press is any single, uninterrupted circumferential portion of the surface of such a printing cylinder, extending across the width of the printing cylinder, in which is mounted, or may be mounted a "printing surface". The effective length (measured around the circumference) of a work area on any one of the printing cylinders is substantially equal to the effective length of any other work area on any other printing cylinder of the press.

GAP—A "gap" is the space on the surface of a printing cylinder between adjacent work areas, or between the ends of a work area, and extending across the width of the printing cylinder, in which no "printing surface" is ever mounted. As the printing cylinders revolve, a work area on one printing cylinder is substantially opposite a work area on another printing cylinder or a gap on one printing cylinder is substantially opposite a gap on another printing cylinder, at the line of tangency between the cylinders.

PRINTING COUPLE—The "printing couple" of the printing press of this invention consists of the lower printing cylinder and a large printing cylinder mounted above it in rotational, tangential relationship.

"BITE" OF THE PRINTING COUPLE—The "bite" of the printing couple is the line of tangency between the two printing cylinders of the printing couple. Sheets passing between the cylinders of the printing couple are contacted by printing surfaces, mounted in work areas on the two cylinders, along this line of tangency.

2 R AND 3 R PRESSES—A press in which the effective diameter of the large printing cylinder is two times the effective diameter of the lower printing cylinder, and in which the lower printing cylinder, therefore, makes two revolutions for each revolution of the large printing cylinder, is referred to as a "2 R" press. A press in which the effective diameter of the large printing cylinder is three times the effective diameter of the lower printing cylinder, and in which the lower printing cylinder, therefore, makes three revolutions for each revolution of the large printing cylinder, is referred to as a "3 R" press. For any given "size" press, in terms of the maximum size image which can be printed, the lower printing cylinder is the same in both the 2 R and the 3 R press. The effective diameter and, associated therewith, the effective circumferential length of the single work area of the common lower printing cylinder determines the maximum length image which can be printed by either the 2 R or the 3 R press.

EFFECTIVE DIAMETER—The "Effective Diameter" of a printing cylinder is twice the radius of the printing cylinder including the thickness of any printing plate, offset blanket, draw sheet Tympan sheets or other underlays or overlays which may be used, and, in the case of a printing cylinder which includes grippers to carry a sheet to be printed, the thickness of the sheet to be printed itself, all plus or minus any increment which may be added or subtracted to achieve "true rolling" with respect to the other printing surfaces of the press.

RIGHT READING—A "right reading image" on a printing plate or other printing surface is an image in which the text or illustration appears as it normally would on a printed page.

RIGHT READING PLATE—A "right reading plate" is a printing plate on which a right reading image appears.

MIRROR IMAGE—A "mirror image" is an image which appears on a printing surface the way a right reading image would appear if viewed in a mirror. When an inked right reading image on one printing surface is pressed against another printing surface and thereby transferred thereto, the resulting image on the second printing surface is a "mirror image".

MIRROR IMAGE PLATE—A "mirror image plate" is a printing plate which bears a mirror image on its surface.

COLLATE—The term collate as used herein refers to the assembling of the pages of a manuscript in proper order. For example: in the case where a 3-page letter is to be produced it is customary to print the required quantity of page 1, then print the required quantity of page 2, and finally print the required quantity of page 3. These are then assembled or "collated" by bringing together in the proper order one copy of page 1, one copy of page 2 and one copy of page 3, and this process is repeated until the required quantity of the three page letters have been assembled or "collated" in proper order—page 1, page 2, and page 3.

MAJOR FUNCTIONAL AREAS OF THE PRESS

PLATE CYLINDER MODULE (AA Series)

A "plate cylinder module" comprises a frame structure which may be attached, either directly or by means of mounting brackets, to the frame structure of either the 2-R press or the 3-R press at any or all of the module mounting positions, designated I, II, III and IV, and which includes a plate cylinder which, when the module is so mounted, is in rotational tangential relationship to the large printing cylinder, and also includes means for inking, or inking and dampening, a plate mounted on the plate cylinder.

INKING AND INK/DAMPENING MODULES (BB Series)

An "inking module" comprises a frame structure which may be attached, either directly or by means of mounting brackets, to the frame structure of the 2-R press, to the frame structure of the 3-R press, or to either, at selected ones of the module mounting positions, and includes means for inking one or more printing surfaces mounted in a work area or work areas of the large printing cylinder. An "ind/dampening module" is an inking module which also includes means for dampening the printing surface or surfaces which are inked.

DAMPENING MODULE (CC Series)

A "dampening module" comprises a frame structure which may be attached, either directly or by means of mounting brackets, to the frame structure of the 2-R press, to the frame structure of the 3-R press, or to either, at selected ones of the module mounting positions, and includes means for dampening one or more printing; surfaces mounted in a work area or areas of the large printing cylinder.

PAPER FEEDER (DD Series)

A "paper feeder" is an automatic device for separating and feeding single sheets from a supply of sheets and conveying them successively to the stop fingers of the press. The paper feeder includes feeder control mechanisms which may be pre-set, selectively, to cause the feeder or feeders to feed sheets in proper timed relationship, and at the proper intervals, to conform to the particular printing function, combination of functions or combined printing and collating functions being performed by the press; as for example, by feeding sheets from a single feeder, in proper time with the stop fingers of the press, once for every revolution of the lower printing cylinder, or alternatively, once for every other revolution of the lower printing cylinder, or alternatively, by feeding sheets from one feeder to one revolution of the lower printing cylinder and from another feeder to the next revolution of the lower printing cylinder, etc., etc. The paper feeder also includes a combined double sheet eliminator and "miss" detector. The double sheet eliminator senses the thickness of the sheets fed from one feeder, or from more than one feeder, and deflects the sheets into a tray or trays for receiving rejects whenever more than a single sheet has been fed. When concurrent printing and collating are being done this mechanism is combined with a "miss" detector which detects when a sheet has failed to feed; The two mechanisms function cooperatively so that if either a sheet fails to feed, or sheets are deflected because more than a single sheet is fed, then, in either case, the correct number of additional sheets are deflected so that the total number of sheets failing to reach the bite of the printing couple is equal to the total number of sheets in one complete collated set, thus insuring that only complete sets enter the delivery hopper.

VARIOUS COMBINATIONS OF DIFFERENT PRINTING SURFACES WHICH MAY BE MOUNTED IN THE WORK AREAS ON THE TWO CYLINDERS OF THE PRINTING COUPLE, USING REMOVABLE AND INTERCHANGEABLE SEGMENTS ON THE LARGE PRINTING CYLINDER (FF Series)

Various combinations of removable and interchangeable segments and/or printing surfaces which may be mounted in the work areas on the large printing cylinder in combination with various printing surfaces which may be carried by the lower printing cylinder, in performing various printing functions, or combinations of functions, of the press;

SHEET DELIVERY MECHANISM (GG Series)

The "sheet delivery mechanisms" strip and delivery a sheet, starting after its leading edge passes through the bite of the printing couple for the last time; and include means to strip the sheet from the printing surfaces with which it is in contact, and deliver it into a receiving hopper with a printed surface face-up.

VARIABLE SPEED DRIVE (HH Series)

The "variable speed drive" transmits driving power from the drive motor of the press to the main drive shaft of the press and is adjustable to vary the rotational and surface speeds of the cylinders of the printing couple.

MAIN GEAR TRAIN (JJ Series)

The "main gear train" is the train of gears leading from the main drive shaft of the press and driving and synchronizing the rotation of the printing cylinders, and includes means by which certain printing cylinders may be adjusted about their axes for convenience of operation in making vertical image position adjustments.

PLATE CYLINDER CONTROLS (KK Series)

The "plate cylinder controls" comprise controllable mechanisms for causing individual plate cylinders of individual plate cylinder modules, to contact only selected printing surfaces in selected work areas on the large printing cylinder, as required in performing various printing functions and combinations of functions of the press; they also include manually adjustable means by which the pressure between each individual plate carried by each plate cylinder, and each of the different printing surfaces in different work areas on the large printing cylinder may be independently adjusted and automatically controlled; and they also include means by which the printing relationship between each plate cylinder and each work area on the large printing cylinder is controlled in response to the presence or absence of a sheet in the bite of the printing couple at the appropriate time in the cycle in the performance of a variety of printing functions and combinations of functions of the press.

FORM ROLL LIFTER CAMS AND FOLLOWERS (LL Series)

The "form roll lifter cams and followers" selectively lift the form rollers of selected inking modules, ink-/dampening modules, or dampening modules, out of contact with selected printing surfaces in selected work areas on the large printing cylinder, as required in performing various printing functions and combinations of functions of the press.

SHEET DETECTOR AND CYLINDER LATCHING MECHANISM (MM Series)

The "sheet detector mechanism" includes means which senses the presence or absence of a sheet at the stop fingers of the press at the time in the cycle when a sheet should have reached the stop fingers, but only on those revolutions of the lower printing cylinder when a sheet should reach the stop fingers in order to accomplish a particular printing function or combination of functions of the press. The sheet detector mechanism then provides the signal to the cylinder latching mechanism which determines the printing or nonprinting relationship of the cylinders of the printing couple until the next sensing action of the detector means. The cylinder latching mechanism includes the automatic printing couple pressure controls which provide manually adjustable means by which independent pressure adjustments may be made between a printing surface on the lower printing cylinder and each different printing surface in each of the different work areas on the large printing cylinder, which pressures are then automatically controlled on each cycle of operation of the press.

CONTROL OF THE NUMBER OF TIMES A SHEET IS CARRIED THROUGH THE BITE OF THE PRINTING COUPLE (PP Series)

This mechanism controls the number of times a given sheet is carried through the bite of the printing couple before it is stripped and delivered.

The major functional areas of the press are generally designated in the drawings by the double letters set forth above with these double letters used as a prefix to a series of numbers to generally designate subdivisions of these major areas.

There is a considerable amount of overlapping since these major functional areas, and subdivisions thereof, act on and in cooperation with each other throughout the press.

Many individual parts and components carry a number with a single letter prefix determined by one or another of these overlapping major functional areas of which they form a part.

NUMBERING SYSTEM

A numbering system using a combination of numbers, and letters and numbers, has been adopted to facilitate a better understanding of the invention and the many embodiments thereof.

It is intended to help clarify the relationship between the preferred embodiments of the invention, which comprise at least two basic press configurations, wherein the first employs a large printing cylinder two times the effective diameter of the lower printing cylinder (referred to herein as the 2-R press) and the second employs a large printing cylinder three times the effective diameter of the lower printing cylinder (referred to herein as the 3-R press), and in which a large number of parts and other components are used without change in both the 2-R and 3-R presses, and many other parts and components perform identical mechanical functions in both the 2-R and 3-R press, although differing in size and/or shape.

2-R PRESS

The 2-R press is described first, and an unprefixed series of number is used to designate parts and other components of the basic press structure.

Double letters have been assigned to designate major functional areas of the press, as hereinbefore described, with these double letters also serving, in each case, as prefixes to a series of numbers in designating subdivisions of these major functional areas.

Within each of these major functional areas of the press, parts and other components are designated by numbers with a single letter prefix in a separate series; and the single letter prefix in such series corresponds to the double letter designation of a functional area of the press involved.

Roman numerals, I, II and III and in certain configurations IV have been used to designate specific module mounting positions at which various printing modules may be attached to the frame structure of the press; and Roman numerals V and VI have been used to designate specific work areas on the large printing cylinder in which removable and interchangeable segments, and/or various printing surfaces, may be carried.

3-R PRESS

In describing the 3-R press, the same Roman numerals, i.e., I, II, III and IV have been used to designate comparable specific module mounting positions at which the same or equivalent printing modules may be attached to the frame structure of the 3-R press. Roman numerals VII, VIII and IX have been used to designate specific work areas on the large printing cylinder of the 3-R press in which removable and interchangeable segments, and/or various printing surfaces, may be carried.

Within each number series, with or without prefix, parts or other components of the 3-R press which are identical to like parts of the 2-R press retain the same designation.

Within each number series with a single letter prefix, or without prefix, parts or other components of the 3-R press which differ only in size or shape from like parts or other components of the 2-R press, but perform the same mechanical function, are assigned a similar number to their 2-R counterpart, but above 3,000. For example, where a part for the 2-R press is designated 192, a part for the 3-R press which performs the same mechanical function, but differs in size and/or shape, will be designated 3,192; or, similarly, where a component for the 2-R press is designated K-76, the component for the 3-R press, which performs the same mechanical function, if it differs in size and shape, will be designated K-3,076.

Within each number series with a single letter prefix or without prefix, parts or other components found only in the 3-R press, and which have no mechanically functional equivalent in the 2-R press, will be given numbers starting from 3,600. Thus, these parts will be designated 3,601, 3,602, etc. or N-3,601, N-3,602, etc.

Figure 1:
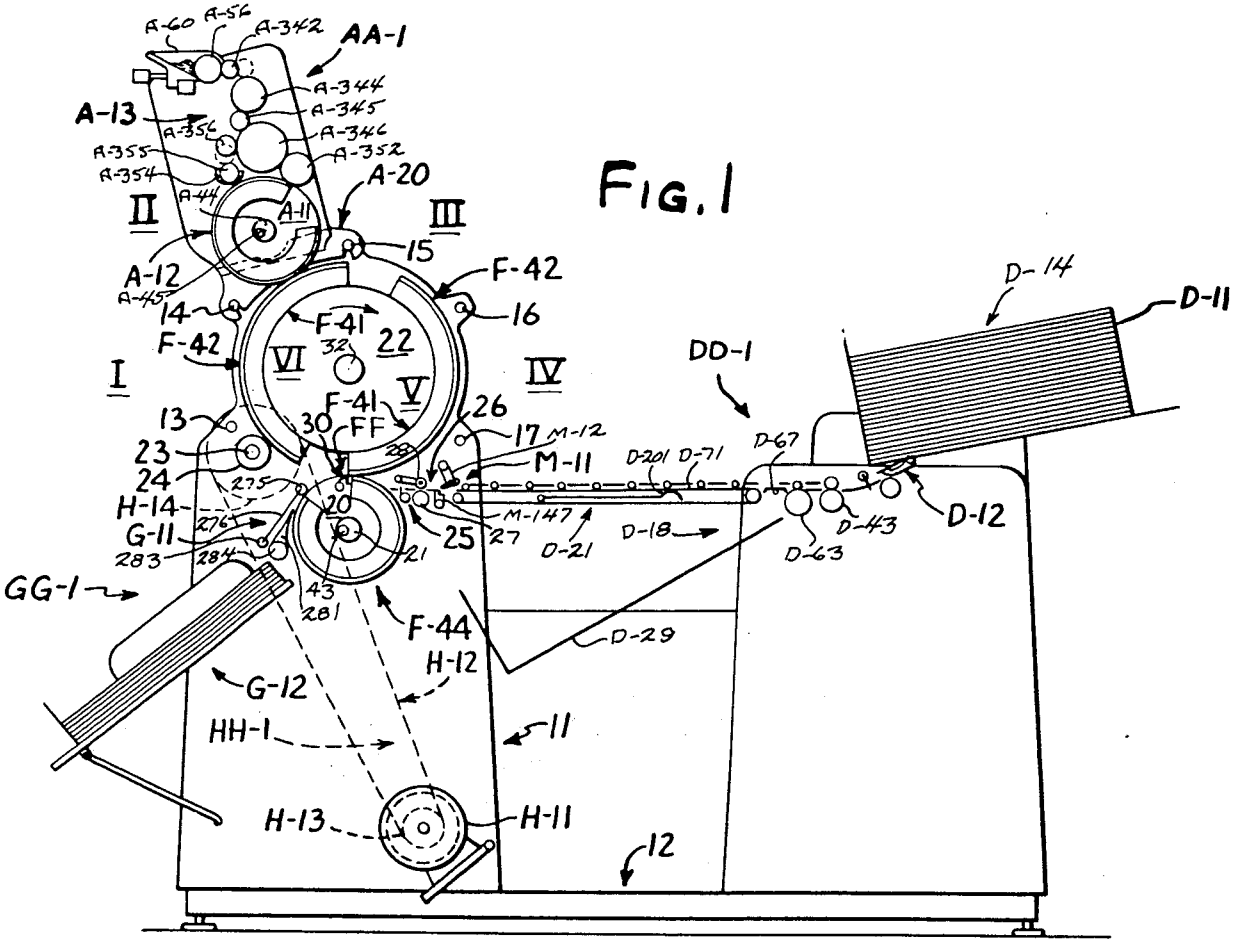

Referring specifically to the drawings, FIG. 1 schematically illustrates one of the basic embodiments of the 2-R press. This embodiment of the 2-R press broadly comprises a pair of side frame members, generally designated 11, suitably supported on a base frame, generally designated 12, and held in rigid relationship by intermediate spreader bars 13, 14, 15, 16, and 17.

Rotatively supported between the side frames 11 is a printing couple, generally designated FF, comprising a lower printing cylinder, generally designated 20, which has a single work area, which, in this instance, carries a platen surface, generally designated F-44, and a large printing cylinder generally designated 22, having an effective diameter twice that of the lower printing cylinder and having on its periphery two substantially equal work areas V and VI, in both of which, in this instance, are mounted removable segments, generally designated F-41, carrying on their surfaces offset blankets, generally designated F-42.

The side frame members 11, conjointly with the spreader bars 13, 14, 15, 16, and 17, which are equidistant from the center of large printing cylinder 22, provide four module mounting positions designated I, II, III and IV at which printing modules may be mounted: with spreaders 13 and 14 forming the supports for modules mounted in position I, spreaders 14 and 15 forming the supports for modules mounted in position II, spreaders 15 and 16 forming the supports for modules mounted in position III, and with spreaders 16 and 17 forming the supports for modules mounted in position IV. The spreader bars in each pair are spaced apart from each other by an equal distance.

A plate cylinder module, generally designated AA-1, including a plate cylinder, generally designated A-11, equal in effective diameter to lower printing cylinder 20 and carrying a lithographic (or a dry offset) plate, generally designated A-12, and also including associated ink rollers and (if required) dampening rollers, all generally designated A-13, is shown mounted in position II by means of mounting brackets generally designated A-20.

Both lower printing cylinder 20 and plate cylinder A-11 are in rototaional, tangential relationship to the large printing cylinder 22.

Positioned at the front of the press, in spaced relation thereto, and also mounted on base frame 12, is a paper feeder and tape conveyor, generally designated DD-1, which separates a single sheet of paper from the supported stack D-11, of the feeder, generally designated D-14 by means of a suction foot, generally designated D-12, for every revolution of the lower cylinder 20, and conveys it to the press by means of the tape conveyor, generally designated D-21. A double sheet eliminator, with a tray to receive rejects, all generally designated D-18, is also provided.

The drive for the press and feeder, generally designated HH-1, includes motor H-11, which transmits driving power through a V-belt system, generally designated H-12, from a variable speed drive pulley H-13, mounted on the motor shaft, to a driven pulley H-14, which is mounted on the main drive shaft 23. Pinion gear 24, also mounted on main drive shaft 23, in turn drives a train of gears and chains, not shown. Large printing cylinder 22 is driven in a clockwise direction as viewed in FIG. 1.

For each revolution of lower printing cylinder 20, a sheet of paper is conveyed to a point spaced from the bite of the printing couple FF, at which point each sheet is topped by stop fingers, generally designated 25, and individually registered. Concurrently sensing means, generally designated M-11, senses for the presence or absence of a sheet of paper and causes the cylinders of the printing couple to assume or maintain either a printing or non-printing relationship, through its control of the action of a cylinder latching and throw-out mechanism, not shown in FIG. 1.

The sheet is then advanced toward the bite of the printing couple by a feed roller mechanism, generally designated 26, until its leading edge is registered against register stops carried by lower cylinder 20, and it is then grasped by grippers, generally designated 30, carried by lower cylinder 20, which carry the leading edge of the sheet through the bite of the cylinders of the printing couple. As the sheet passes through the bite of the printing couple, it has an offset image printed on its upper surface from one of the offset blankets, F-42, carried by large cylinder 22, and is thereafter stripped from the peripheral surface of the cylinders by the co-action of grippers 30, ejector fingers, not shown, and stripper means, generally designated G-11, and is delivered, face-up, into a delivery tray, generally designated G-12, of sheet delivery means, generally designated GG-1, mounted at the back or delivery end of the press.

Directing attention to the plate cylinder module AA-1, a right-reading image on the surface of the plate A-12, carried by plate cylinder A-11, is inked and (if required) dampened on each revolution of plate cylinder A-11. This right-reading image is then successively transferred to the surface of each of the offset blankets F-42, mounted in positions V and VI on large cylinder 22, during two revolutions of plate cylinder A-11. The image as it appears on the surface of each of the offset blankets F-42 is a "mirror image" of the image as it appeared on plate A-12, and each of these mirror images is then again transferred (offset) onto the upper surface of successive sheets, passing through the bite of the printing couple, where the image appears as a right-reading image.

Since both plate cylinder A-11 and lower cylinder 20 make two revolutions for each revolution of large cylinder 22, and since a sheet of paper is fed to each revolution of lower cylinder 20, it is apparent that for each revolution of large cylinder 22, two successive identical images are transferred from plate A-12 to the two blankets F-42 mounted on large cylinder 22 and in turn transferred again (offset) onto the upper surfaces of two successive sheets of paper which are fed to the two corresponding revolutions of lower cylinder 20.

Figure 2A:
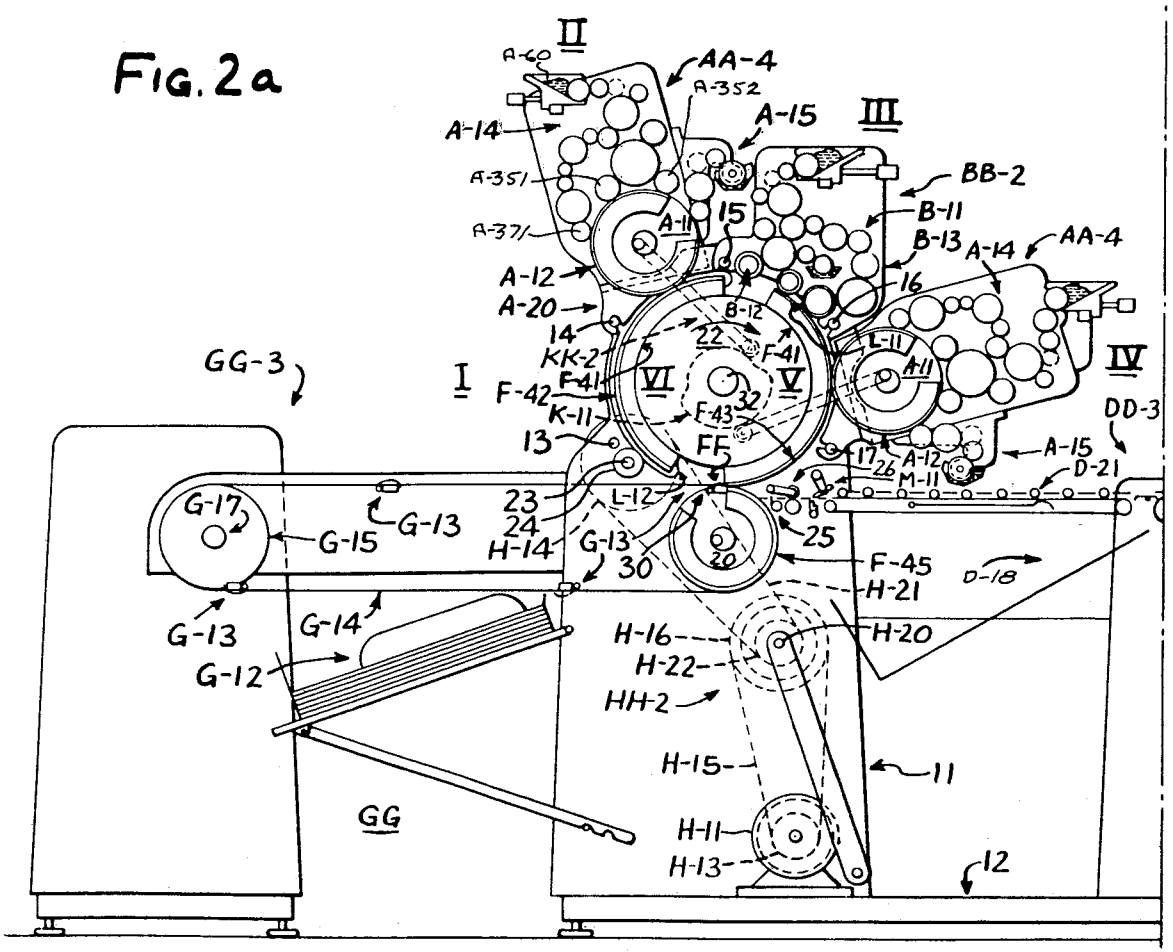
Figures 2B, 3, 4B:
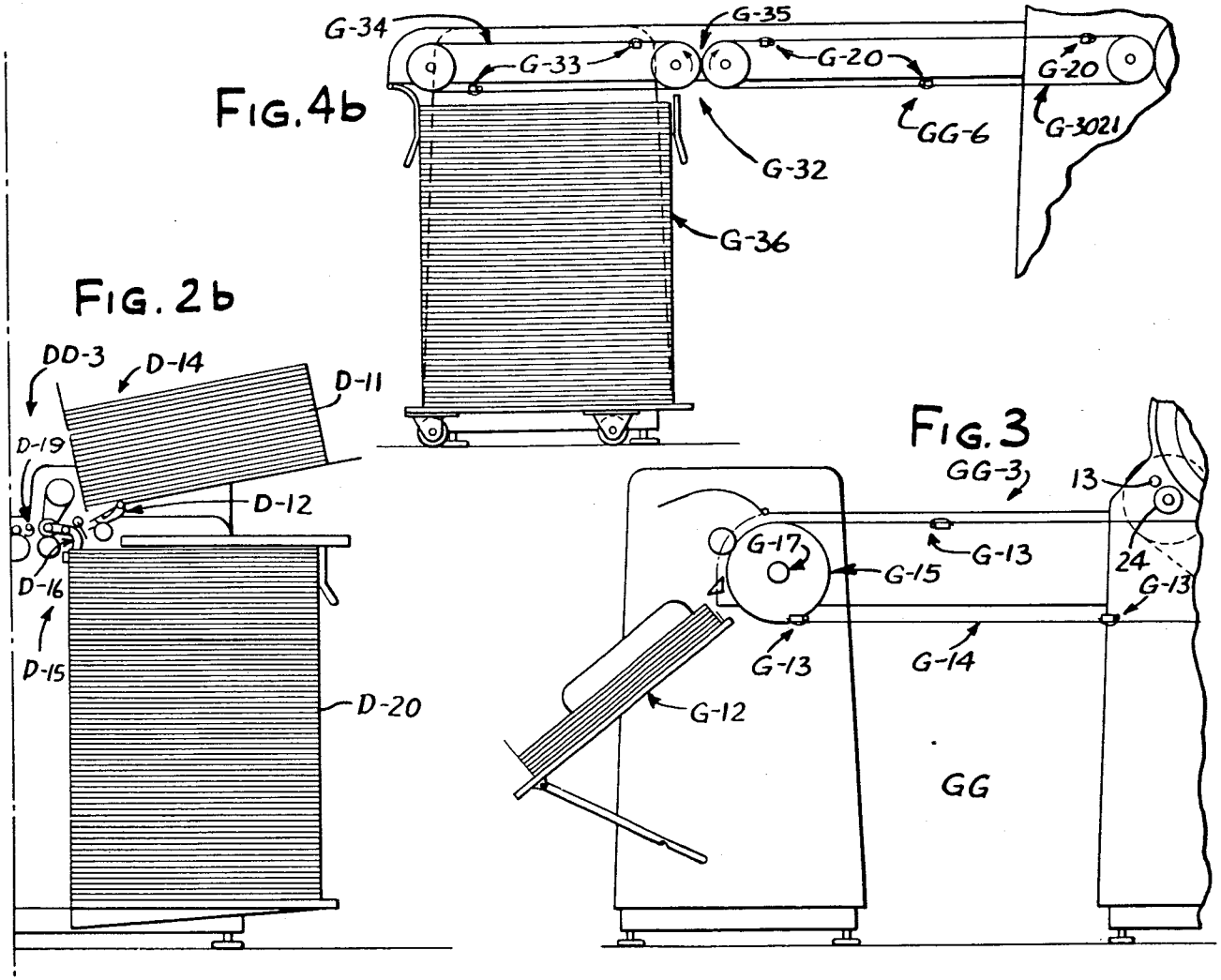

FIGS. 2*a* and 2*b* are parts of the same drawing but appear on different sheets because the size of the apparatus is too large to be included on a single sheet. To view this configuration of the press as a whole, FIGS. 2*a* and 2*b* should be placed together along the center line shown at the right of FIG. 2*a* and at the left of FIG. 2*b*.

FIGS. 2*a* and 2*b*, taken together, schematically illustrate another of the basic embodiments of the 2-R press. Side frame members 11, base frame 12, spreader bars 13, 14, 15, 16 and 17 and the basic members of printing couple FF are identical to the similar members shown in and described for FIG. 1.

As shown in FIGS. 2*a* and 2*b*, lower printing cylinder 20 carries an offset blanket, generally designated F-45; and large printing cylinder 22 has both a removable segment, generally designated 41, which carries a lithographic (or dry offset) plate, generally designated F-43, mounted in position V and another removable segment F-41, which carries on offset blanket, generally designated F-42, mounted in position VI.

Two plate cylinder modules, generally designated AA-4, are mounted in positions II and IV. Each of these plate cylinder modules includes a plate cylinder, generally designated A-11, and associated ink rollers, generally designated A-14, and (if required) separate dampening rollers, generally designated A-15. Each plate cylinder, A-11, has a single work area and an effective diameter equal to that of the lower cylinder 20, and carries a lithographic (or dry offset) plate, generally designated A-12.

An inking, or inking and dampening, module, generally designated BB-2, and comprising ink rollers and (if required) dampening rollers, all generally designated B-11, for inking and (if required) dampening plate F-43 ( mounted in position V on large cylinder 22) is mounted in position III. The form rollers, generally designated B-12, of this inking/dampening module BB-2 have cam follower discs, generally designated L-11, at their ends, in alignment with and adapted to coact with form roll lifter cams, generally designated L-12, which are mounted at each end of the removable segment F-41 which is in position VI on large cylinder 22 and carries offset blanket F-42. These cams and followers cause form rollers B-12 to be lifted, during the passage of offset blanket F-42, so that they do not contact the surface of the blanket.

A plate cylinder control cam, generally designated K-11, mounted on shaft 32 of large cylinder 22 forms a part of a plate cylinder control mechanism, generally designated KK-2, which may be set to cause each of the two plates A-12 mounted on the surfaces of the two plate cylinders A-11 to each roll in contact successively with the surface of offset blanket F-42, while also causing each of these two plates A-12 to be lifted out of contact successively with the surface of plate F-43.

Positioned at the front of the press are two paper feeders and a tape conveyor, all generally designated DD-3. The uppermost feeder, generally designated D-14, is referred to in the art as a "bottom feeder" inasmuch as it acts to separate single sheets from the bottom of the supported stack D-11, by means of a suction foot, generally designated D-12. The lower feeder, generally designated D-15, is referred to in the art as a "pile feeder" since it separates single sheets from the top of a pile of sheets D-20, by means of a suction foot, generally designated D-16. Single sheets from either one of these feeders alone, or alternately from both feeders, pass by a double sheet eliminator with a tray to receive rejects, all generally designated D-18, out onto a tape conveyor, generally designated D-21, which conveys them one at a time toward the bite of the printing couple FF. There is also a "miss" detector, generally designated D-19, which may be used in combination with the double sheet eliminator D-18 when sheets are being concurrently printed and collated.

Control means, not shown, may be set selectively to cause sheets to be fed to every revolution, or every other revolution of lower cylinder 20 from "bottom feeder" D-14 only. Alternatively, these control means may be set to cause sheets from "pile feeder" D-15 only to be fed either to every revolution, or to every other revolution, of lower cylinder 20. Additionally, these control means may be set to cause a sheet from "bottom feeder" D-14 to be fed to one revolution of lower cylinder 20 and a sheet from "pile feeder" D-15 to be fed to the next revolution of lower cylinder 20; or to cause sheets from alternate feeders to be fed only to every other revolution of lower cylinder 20.

The drive for the press and feeders, generally designated HH-2, includes a motor H-11 which transmits driving power through a V-belt H-15, from a variable speed drive pulley H-13 on the motor shaft to a driven pulley H-16, mounted on a countershaft H-20, and then, through another V-belt H-21, from a second variable speed pulley H-22, also mounted on countershaft H-20, to driven pulley H-14 mounted on main drive shaft 23. Pinion gear 24, mounted on main drive shaft 23, in turn drives a train of gears and chains not shown. Large cylinder 22 is driven in a clockwise direction as viewed in FIG. 2*a*.

Each sheet conveyed to the printing couple, from either of the feeders D-14 or D-15, is carried to a point spaced from the bite of the printing couple, FF, at which point each sheet is stopped by stop fingers, generally designated 25, and individually registered, and concurrently a sensing means, generally designated M-11, senses for the presence or absence of a sheet of paper and causes the cylinders of the printing couple to assume or maintain either a printing or non-printing relationship through its control of the action of a cylinder latching and throw-out mechanism, not shown.

Stop fingers 25 rise into their operative position, to stop a sheet, on every revolution of lower cylinder 20, irrespective of whether the control mechanism for the feeders is set to feed a sheet to every revolution, or to every other revolution, of lower cylinder 20. However, sensing mechanism M-11 senses for the presence or absence of a sheet of paper on every revolution of lower cylinder 20 only when the control mechanism for the feeders is set to feed a sheet for every revolution of lower cylinder 20. When the control mechanism for the feeders is set to feed a sheet on every other revolution of lower cylinder 20, the sensing mechanism M-11 is caused to sense for the presence or absence of a sheet of paper only on that revolution of lower cylinder 20 to which the feeder control mechanism has been set to feed a sheet.

When the control mechanism for the feeders has been set to feed a sheet to each revolution of lower cylinder 20, then, once the sensing mechanism M-11 has sensed the presence or absence of a sheet of paper, and the cylinders of the printing couple have been caused to assume or maintain either a printing or non-printing relationship, this printing or non-printing relationship is maintained until the next revolution of lower cylinder 20, at which time the action of sensing means M-11 again determines whether the cylinders of the printing couple shall assume or maintain a printing or non-printing relationship.

When the control mechanism for the feeders has been set to cause a sheet to be fed to every other revolution of lower cylinder 20 (which is the same as feeding a sheet to every revolution of large cylinder 22), then, when the sensing means M-11 senses for the presence or absence of a sheet of paper and causes the cylinders of the printing couple to assume or maintain either a printing or non-printing relationship, this relationship is thereafter maintained for two revolutions of lower cylinder 20 (or one revolution of large cylinder 22), after which sensing means M-11 again senses for the presence or absence of a sheet of paper and again causes the cylinders of the printing couple to assume or maintain either a printing or non-printing relationship, through its control of the action of the cylinder latching and throw-out mechanism.

From its position at rest, with its leading edge in contact with stop fingers 25, a sheet is then advanced toward the bite of the printing couple by a feed roller mechanism, generally designated 26, until its leading edge is registered against register stops carried by lower cylinder 20 and it is then grasped by grippers, also carried by lower cylinder 20, which carry it toward the bite of the printing couple (the register stops and cylinder grippers together being generally designated 30). As the sheet is carried toward the bite of the printing couple by the cylinder grippers, its leading edge is also seized by the grippers of a chain carried gripper bar, generally designated G-13. As the leading edge of the sheet reaches the bite of the printing couple it is released by the cylinder grippers and carried through the bite of the printing couple by the grippers of the chain carried gripper bar G-13.

This gripper bar, G-13, is one of four such gripper bars which are carried by a pair of chains, generally designated G-14, which encircle the shaft of lower cylinder 20. These, together with the delivery tray, generally designated G-12, comprise the encircling chain delivery, stripping and delivery mechanism, generally designated GG-3, which is mounted at the delivery end of the press, generally designated GG.

The chains G-14, which encircle the shaft of lower cylinder 20, have a length equal to four times the effective circumference of lower cylinder 20, and the four chain carried gripper bars G-13 are spaced apart by a distance equal to the effective circumference of lower cylinder 20.

The grippers of gripper bar G-13 maintain their hold on the leading edge of the sheet, cause it to be stripped from the peripheral surfaces of the cylinders of the printing couple and continue to carry the sheet out and around the shaft, generally designated D-17, for the outer sprockets, generally designated G-15, which provide the outer supports for the encircling chains. This causes the sheet to be turned over; and it is then released by the grippers of gripper bar G-13 as it passes over the delivery tray G-12, so that it is dropped into the delivery tray with its original bottom surface face-up.

Alternatively, delivery tray G-12 may be placed in the position shown in FIG. 3, and the sheets may be released by the grippers of gripper bar G-13 as it passes around sprockets G-15, in which case the sheets are delivered into delivery tray G-12 without being turned over, and with their original top surface facing up.

In this embodiment of the press the cylinder grippers, carried by lower cylinder 20, may be set to close to seize the leading edge of a sheet, advanced to the cylinder register stops, and to open again to release the leading edge of such a sheet as they reach the bite of the printing couple (in order to allow the sheet to be stripped and delivered by the chain carried grippers G-13) on each revolution of lower cylinder 20, irrespective of whether the feeder controls have been set to feed a sheet to every revolution, or to every other revolution, of lower cylinder 20. Similarly, the gripper fingers of each of the chain carried gripper bars G-13 may be set to close to seize the leading edge of a sheet as they approach the bite of the printing couple, and to stay closed as they pass through the bite of the printing couple, and until they open to release a sheet (at either the position shown in FIG. 2*a* or the position shown in FIG. 3), irrespective of whether the feeder controls have been set to cause a sheet to be delivered to every revolution, or to every other revolution, of lower cylinder 20.

In an alternate use of this embodiment of the press, the control mechanism for the feeders is set so that sheets are fed only to every other revolution of lower cylinder 20, and a sheet, after being advanced into register with the cylinder stops and having its leading edge gripped by the cylinder grippers, is carried, by the cylinder grippers, through the bite of the printing couple and on around lower cylinder 20 and to the bite of the printing couple for a second time. In this case, as the leading edge of the sheet approaches the bite of the printing couple for the second time the grippers on the corresponding chain carried gripper bar, G-13, close to seize the leading edge of the sheet; and, as the leading edge of the sheet reaches the bite of the printing couple for the second time, the cylinder carried grippers open to release the sheet and the chain carried grippers G-13 carry the leading edge of the sheet through the bite of the printing couple a second time, strip the sheet from the peripheral surfaces of the cylinders of the printing couple, and deliver it, as previously described. In this case the two chain carried gripper bars G-13, which are in coincidence with the cylinder grippers when a sheet approaches the bite of the printing couple for the first time, are inactivated so that they remain open and do not seize the leading edge of the sheets, whereas the other two, alternate, chain carried gripper bars G-13, are left operative, and act, as described above (in cooperation with the cylinder grippers), to seize the leading edge of a sheet as it approaches the bite of the printing couple for the second time, and to then carry it through the bite of the printing couple, to strip the sheet and to deliver it to the selected delivery position.

A comparison of the plate cylinder modules AA-4 of FIG. 2*a* with the plate cylinder module AA-1 of FIG. 1 will show that in the plate cylinder module AA-1 of FIG. 1 there is a combined ink/dampening system, and a single form roller applies the combined ink and dampening solution to the surface of the plate A-12; while in the plate cylinder modules AA-4 of FIG. 2*a* there is a separate dampening system A-15, and the dampening solution is applied to the surface of the plate A-12 by a separate dampening form roller. There are three ink form rollers in the plate cylinder modules AA-4 of FIG. 2*a* and two of these are a part of the basic inking system while the third one, farthest to the left, is part of a train of auxiliary ink rollers. The plate cylinder A-11 turns in a counter-clockwise direction as seen in FIG. 2*a* and therefore this third ink form roller, which is a part of the train of auxiliary ink rollers, is the last of the three ink form rollers to contact the plate before the plate A-12 contacts the blanket F-42 on each revolution of plate cylinder A-11. It will also be seen that in passing from the ink fountain to the plate the ink must pass through a greater number of "bites" between ink rollers to reach the plate through the train of auxiliary ink rollers and the third ink form roller which is a part of this train than must be passed through to reach the plate through the basic inking system and either of the first two form rollers which are a part of this basic system.

SOME PRINTING FUNCTIONS THAT CAN BE ACCOMPLISHED BY THIS EMBODIMENT OF THE PRESS

One important printing function which can be performed on the embodiment of the 2-R press illustrated in FIGS. 2*a*, 2*b* and 3 is the printing of two non-overlapping images, in different colors, on one side of a sheet, by either wet or dry offset, while simultaneously printing another image on the other side of the sheet in one of the same two colors, or in a third color, by either wet or dry offset.

To accomplish this, two plates A-12, bearing the two non-overlapping images to be printed on the same side of the sheet, are placed on plate cylinders A-11, in positions II and IV, and ink of one of the desired colors is placed on the ink rollers of the plate cylinder module mounted in position II and ink of the other desired color is placed on the ink rollers of the plate cylinder module mounted in position IV. If the plates to be used are wet offset plates the dampening rollers A-15 are used but if they are dry offset plates the dampening rollers A-15 are not used. A plate F-43, bearing the image to be printed simultaneously on the other side of the sheets is placed on the surface of the removable segment F-41 which is mounted in position V on large cylinder 22; and ink of the color in which this image is to be printed is applied to the ink rollers of the ink/dampening module mounted in position III. The images on all three of these plates are "right reading" images. An offset blanket, F-42, is mounted on the surface of the removable segment F-41 which is mounted in position VI on large cylinder 22. Another offset blanket, F-45, is mounted on the surface of lower cylinder 20.

In operation, plate F-43, in position V on large cylinder 22, is inked (and if required, dampened) by the form rollers B-12 of the ink/dampening module mounted in position III. The two plates A-12 are held out of contact with the surface of plate F-43 by the operation of plate cylinder control mechanism KK-2, previously described. Paper is placed in one or the other of the two feeders, as for instance, the pile feeder D-15, and the feeder control mechanism is set to cause sheets to be fed to every other revolution of lower cylinder 20, with the sheets being timed to be fed to lower cylinder 20 so that they will pass through the bite of the printing couple between the surface of blanket F-45, mounted on lower cylinder 20 and blanket F-42, mounted in position VI on large cylinder 22. Thus, when plate F-43, mounted in position V on large cylinder 22, rolls in contact with blanket F-45, mounted on lower cylinder 20, there is no paper present, and the inked, right-reading image on the surface of plate F-43 is transferred onto the surface of blanket F-45, on lower cylinder 20, where it appears as a mirror image.

Plate A-12, on plate cylinder A-11 in position II, is inked (and if required, dampened) by ink and dampening rollers A-14 and A-15 and then rolls in contact with blanket F-42, mounted in position VI on large cylinder 22, causing the inked, right-reading image on the plate to be transferred onto the surface of blanket F-42, as a mirror image.

Blanket F-42 then passes position III as the large cylinder rotates in a clockwise direction, as seen in FIG. 2*a*, and form rollers B-12 of ink/dampening module BB-2 are lifted out of contact with the surface of blanket F-42 in the manner previously described.

As large cylinder 22 continues to rotate in a clockwise direction, blanket F-42 rolls in contact with the plate A-12 of the plate cylinder module mounted in position IV, which in turn has been inked (and if required, dampened) by ink and dampening rollers A-14 and A-15 of this module. Thus, the right-reading, inked image on this plate, which does not overlap the image previously applied to blanket F-42, is in turn transferred onto the surface of blanket F-42, where it appears as a mirror image in a second color.

As the leading edge of blanket F-42, mounted in position VI of large cylinder 22, and the leading edge of blanket F-45, mounted on lower cylinder 20, approach the bite of the printing couple, a sheet of paper, previously fed in proper timed relationship by suction foot D-16, from pile D-20, advances from the stop fingers 25 into the cylinder grippers 30, which carry it toward the bite of the printing couple and transfer it to the grippers of one of the chain carried gripper bars, G-13. As the leading edge of the sheet is then pulled through the bite of the printing couple by the grippers of the chain carried gripper bar G-13, the sheet passes between, and is squeezed between, blanket F-42 carried in position VI on large cylinder 22 and blanket F-45 carried on lower cylinder 20.

This causes the two, non-overlapping images, in two different colors, to be printed on the top surface of the sheet from blanket F-42 while, simultaneously, the other image from blanket F-45, on lower cylinder 20, is printed on the bottom surface of the sheet.

The action of the chain carried grippers G-13, in pulling the leading edge of the sheet away from the bite of the printing couple, acts to strip the sheet from the peripheries of both cylinders of the printing couple and the sheet is thus pulled out, turned over and deposited in delivery tray G-12 as shown in FIG. 2*a*, if it is desired to deliver the sheets with the image from plate F-43 and blanket F-45 on top.

If, on the other hand, it is desired to deliver the sheets with the two-color image, from blanket F-42, on top, the sheets are then released and delivered into the delivery tray G-12 without being turned over, as depicted in FIG. 3.

Another function which may be performed on this embodiment of the 2-R press is to print two separate images, which do not overlap, in two colors, on one side of the sheet (by either wet or dry offset) and then print a third color by letterpress on the same side of the sheet either in one of the same two colors or in a third color. The letterpress image may, if desired, overlap either or both of the images printed by offset. To accomplish this function a letterpress plate is mounted on the removable segment F-41 in position V of large cylinder 22, or a letterpress image holding device is substituted for the removable segment F-41 in position V. The dampening portion of the ink/dampening module BB-2, mounted in position III, is inactivated. The form rollers B-12 of this module then apply ink to the surface of the letterpress plate. A two color offset image is applied to the surface of blanket F-42, mounted in position VI of large cylinder 22, in the manner previously described. Blanket F-45 on lower cylinder 20 either acts as a platen surface or is replaced with a covering more suitable for use as a platen surface. The controls for the feeder are set to cause a sheet to be fed to every other revolution of lower cylinder 20, timed to reach the bite of the printing couple in coincidence with the leading edges of the segment carrying blanket F-42 and of lower cylinder 20. Sheets may be fed from one of the two feeders, as for instance, from the pile feeder D-15, as described above. The cylinder grippers 30 and the gripper bars G-13, carried by the encircling chains G-14 are set, as previously described, to cause each sheet to be carried through the bite of the cylinders of the printing couple two times. On the first passage of a sheet through the bite of the printing couple, the two-color image from blanket F-42 is printed on the upper surface of the sheet, with lower cylinder 20 acting as a platen. Then, as the sheet passes through the bite of the printing couple a second time, it passes between the surface of lower cylinder 20, acting as a platen, and the inked letterpress image mounted in position V of large cylinder 22, which then prints this image, by the letterpress process. This letterpress image is also printed on the top of the sheet. The sheet is then stripped and delivered, by the chain carried grippers G-13, into delivery tray G-12, which is mounted in the position shown in FIG. 3, so that the sheets are delivered face-up, printed with two non-overlapping offset images and a third letterpress image.

Still another function can be performed on this embodiment of the 2-R press by leaving the arrangement of the plates and blankets, on large cylinder 22 and on the plate cylinders of the plate cylinder modules, as just described above but by changing the arrangement of the feeder controls so that sheets are fed to every revolution of lower cylinder 20; and by changing the cooperative arrangement of the cylinder grippers 30 and the chain carried grippers G-13 so that the sheets are carried through the bite of the printing couple only once. This will result in one sheet passing through the bite of the printing couple between blanket F-42 (mounted in position VI of large cylinder 22 and with two non-overlapping images, in two colors, on its surface) and lower cylinder 20, acting as a platen. The next sheet, presented to the next revolution of lower cylinder 20, will pass between lower cylinder 20, acting as a platen, and the letterpress plate (inked in one of the same two colors or a third color and mounted in position V of large cylinder 22). The sheets, which are stripped and delivered face-up, as described above, into delivery tray G-12, mounted in the position shown in FIG. 3, will comprise collated sets, which have been printed and collated concurrently; with each set having two sheets, with one sheet being printed by offset in two non-overlapping colors and the other sheet being printed by letterpress in one of the same two colors or in a third color.

In addition, by placing paper of one color or weight in the pile feeder, D-15, and paper of another color and/or weight in the "bottom feeder", D-14, and by setting the feeder controls so that sheets are fed alternately, first from feeder D-15 and then from feeder D-14, but still with a sheet fed to each revolution of lower cylinder 20, the sheets which are delivered into receiving tray G-12, in the position shown in FIG. 3, will comprise collated sets; each set having a sheet of one color and weight, printed by offset with images in two non-overlapping colors, and a sheet of a different color and/or weight, printed by letterpress with an image in one of the same two colors or in a third color.

It will, of course, be apparent that this embodiment of the 2-R press can also be used to print a single color by off-set by the simple expedient of disengaging the ink-/dampening module mounted in position III and the plate cylinder module mounted in position IV and using only the plate cylinder module mounted in position II. In this case an offset blanket is also mounted in position V on the large cylinder 22 and the arrangement of the plate, blankets and platen surface are as described for the embodiment of the 2-R press illustrated and described in FIG. 1 and the plate cylinder in position II contacts both the blankets in positions V and VI. However, in this case, since this embodiment is equipped with an encircling chain delivery mechanism, the sheets will be delivered by the chain carried grippers G-13 into the receiving tray mounted in the position shown in FIG. 3, so that the sheets will be delivered with their printed surface face-up. If the plate cylinder modules in positions II and IV are both used each sheet may be printed by offset with two non-overlapping images in two colors. Sheets of a single color or weight may be placed in either one of the two feeders and sheets fed to every revolution of lower cylinder 20, resulting in the delivery of identically printed sheets, on a single type of paper stock with one sheet being delivered for each revolution of lower cylinder 20; or, if desired, sheets of different color and/or weight may be loaded into each of the two feeders and the feeders caused to feed sheets alternately, but with a sheet being fed to each revolution of lower cylinder 20, with the result that the sheets which are delivered will comprise collated sets; each set having one sheet of one color and weight and another sheet of a different color and/or weight but with both sides having identical images.

Still another alternative is to load one of the two feeders with pre-printed sheets and the other feeder with blank sheets to be printed. By then removing one of the removable segments F-41 and timing the feeders so the sheets are fed alternately from the two feeders, but to every revolution of lower cylinder 20, and with the timing such that the blank sheets are fed to pass through the bite of the printing couple between lower cylinder 20 and the remaining segment F-41, and the pre-printed sheets timed to pass through the bite of the printing couple on that revolution of lower cylinder 20 which coincides with the half of upper cylinder 22 on which no segment is mounted, the printing of the blank sheets and the concurrent collation of them with the pre-printed sheets will result.

Still another function that may be performed on this embodiment of the 2-R press involves the production of forms of a type which are produced for use in later copying process and which are printed on translucent paper stock with a single identical image on both the front and the back of the sheet, the image printed on the front of the sheet being a right-reading image, and the image printed on the back being an identical mirror image in exact register with the image printed on the front. As a result the opacity of the image is increased over what it would be if the image were printed on only one side of the sheet, thus resulting in sharper and clearer copies when these forms are later used in further copying processes. This is accomplished, in this embodiment of the 2-R press, by placing a single offset plate A-12 (either wet or dry) on plate cylinder A-11 of the plate cylinder module mounted in position II. Offset blankets are then placed on the surfaces of both the removable segments F-41, mounted in positions V and VI on large cylinder 22, and a third offset blanket F-45 is mounted on lower cylinder 20. Translucent paper stock is then loaded into one of the two feeders and the feeder controls set to feed sheets to every other revolution of lower cylinder 20. A right-reading image on plate A-12, carried by plate cylinder A-11, in position II, is transferred onto the surface of first one, and then the other, of the two blankets mounted on both of the removable segments F-41. These images on the surfaces of these two blankets are both mirror images of the image on the plate A-12. On the revolution of lower cylinder 20 when no paper is present, the blanket mounted in position VI on large cylinder 22 rolls in contact with blanket F-45 on lower cylinder 20 and transfers its inked image onto blanket F-45, where it appears as a right-reading image. On the next revolution of lower cylinder 20 a sheet of paper is presented and passes through the bite of the printing couple between blanket F-45 mounted on lower cylinder 20, and the blanket mounted in position V on large cylinder 22. The image from the blanket in position V is printed onto the top of the translucent sheet as a right-reading image and, simultaneously, the image from blanket F-45, mounted on lower cylinder 20, is printed onto the bottom of the translucent sheet as a mirror image. Since the two images are otherwise identical, and are in perfect register one with the other, the result is that the matching right-reading and mirror images are printed on both sides of the translucent sheet, thus creating what appears to be a single image of great opacity. The sheets are then stripped and delivered, by the chain carried grippers G-13, into receiving tray G-12, which may be mounted in either the position shown in FIG. 2*a* or the position shown in FIG. 3. The translucent sheets would normally be delivered into the tray G-12 in the position shown in FIG. 3 since in this position the right-reading image would be face-up.

Still another function which can be performed by this embodiment of the 2-R press is to simultaneously print and emboss a sheet. To accomplish this with the image printed in one color, only the plate cylinder module mounted in position II is used, and a mirror image plate A-12 (either wet or dry) is placed on plate cylinder A-11 of this module. An offset blanket, F-42, is mounted on the removable segment F-41 in position VI of large cylinder 22 and another offset blanket F-45 is placed on the surface of lower cylinder 20. A removable segment, F-41, carrying a plate with a raised, right-reading, identical image of the material to be embossed is placed at position V on large cylinder 22. Plate cylinder control KK-2 is set so that plate A-12 on plate cylinder A-11 of the plate cylinder module in position II rolls in contact with the surface of blanket F-42 carried in position VI and is lifted away from the surface of the raised image plate mounted in position V of large cylinder 22. The ink/water module, in position III, and the plate cylinder module, in position IV, are inactivated. Sheets are fed, from either one of the two feeders, to every other revolution of lower cylinder 20, timed so that they will pass through the bite of the printing couple between blanket F-45 on the surface of lower cylinder 20 and the right-reading, raised image plate mounted in position V on large cylinder 22. Mirror image plate A-12 on the plate cylinder A-11, in position II, transfers an image onto the surface of blanket F-42, mounted in position VI on large cylinder 22, where this image appears as an inked right-reading image. Blanket F-42 then rolls against the surface of blanket F-45, mounted on lower cylinder 20, during the revolution of lower cylinder 20 when no paper is present, with the result that this image is transferred onto the surface of blanket F-45 on lower cylinder 20 as an inked mirror image. Then, on the revolution of lower cylinder 20 when a sheet is present, the sheet is passed between the un-inked, right-reading, raised image plate mounted in position V on large cylinder 22 and the inked mirror image on blanket F-45, mounted on lower cylinder 20, with the result that the pressure applied to the sheet causes the inked image on the surface of blanket F-45 on lower cylinder 20 to be printed onto the bottom of the sheet, where it appears as a right-reading image. Simultaneously, this pressure causes the raised, right-reading, image on the un-inked plate, mounted in position V on large cylinder 22, to squeeze the paper into the surface of blanket F-45 on lower cylinder 20 thereby embossing the sheet in the pattern of the image on this raised image plate. The embossing is in perfect register with the corresponding printed image and appears as a right-reading image when viewed from the printed side of the sheet. The un-inked plate, in position V on large cylinder 22, may also be provided with raised solid areas, to apply uniform pressure to the back of the paper for the transfer of an image from blanket F-45, on lower cylinder 20, without embossing, in those areas where the printed image is not to be embossed. The sheets are then delivered by the chain carried grippers, G-13, into delivery tray G-12 mounted in the position shown in FIG. 2*a*, so that the sheets are delivered with their printed surface face-up.

By also using the plate cylinder module mounted in position IV, it is apparent that an image printed in two non-overlapping colors may similarly be printed and simultaneously embossed.

It is also possible with this embodiment of the 2-R press to print sheets in two overlapping colors by offset (either wet or dry) in the following manner: The two offset plates, A-12, for the two colors are mounted on the plate cylinders A-11 of the plate cylinder modules in positions II and IV. The ink/dampening module in position III is inactivated. Two removable segments, F-41, each carrying offset blankets, F-42, are mounted in positions V and VI on large cylinder 22, with cams being provided in plate cylinder control mechanism KK-2 to cause the offset plate A-12, mounted in position II, to contact only the offset blanket F-42 mounted on the segment in position V on large cylinder 22, and causing the offset plate A-12, mounted in position IV, to contact only offset blanket F-42 mounted on the segment in position IV on large cylinder 22. Lower cylinder 20 acts as a platen cylinder. Sheets are placed in one of the feeders and the feeder controls set to cause sheets to be delivered to every other revolution of lower cylinder 20. Cylinder grippers 30 and the chain carried grippers G-13 are set, as described previously, to cause each sheet to be carried through the bite of the printing couple two times. On its first pass through the bite of the printing couple a sheet passes between lower cylinder 20, acting as a platen, and the blanket in position V, and the inked image on the surface of the blanket, F-42, in position V on large cylinder 22 is printed on the surface of the sheet. The sheet then passes around lower cylinder 20, and on its second pass through the bite of the printing couple it passes between lower cylinder 20, acting as a platen, and the surface of the blanket in position VI, and the inked image, in the second color, on the surface of the blanket, F-42, in position VI on large cylinder 22 is printed on the surface of the sheet. Since these two offset images are printed on separate passes through the bite of the printing couple, and from separate blankets, the two images may overlap. The sheet, with this two color, overlapping, offset image printed on its surface, is then stripped by the chain carried grippers G-13 and delivered face-up into receiving tray G-12 mounted in the position shown in FIG. 3.

If the segments and printing modules are left as just described and with lower cylinder 20 continuing to act as a platen, the feeder and delivery controls may be set so that sheets are delivered to every revolution of lower cylinder 20, and carried once through the bite of the printing couple; and, in this case, the image from the plate A-12, mounted on the plate cylinder A-11 in position II, will be printed on one sheet, and the image from the plate A-12, mounted on the plate cylinder A-11 in position IV, will be printed on the next sheet, and the sheets may be delivered, face-up, into delivery tray G-12 mounted in the position shown in FIG. 3 as collated sets; with each set consisting of two pages which have been printed, by offset, and collated concurrently. Also, as previously described, by using both feeders instead of one, these two pages may also be of different color and/or weight.

If the two images do not overlap each other the plate cylinder control mechanism KK-2 may also be set so that the images from both plates are printed on one sheet while the image from only one of the plates is printed on the alternate sheet.

Direct lithographic printing may be done by mounting a lithographic mirror image plate in position V (or in both work areas) on large cylinder 22 and using both the ink and dampening rollers of the ink/dampening module in position III.

It will be apparent that many other printing functions and combinations of functions may be performed by simply inactivating any of the printing modules which are not needed and using the feeder controls, and the various press and delivery controls, as described herein, in various combinations.

Finally, as an additional attribute, it wll be apparent that a different color of ink may be kept in each of the three printing modules, mounted in positions II, III and IV; and any one of these three modules may be used alone (with the other two inactivated) to produce single color offset printing, in any one of these three colors, without the need to wash up any of the ink rollers.

It will thus be seen that this one embodiment of the 2-R press may be used to perform an extremely broad range of different printing, and concurrent printing and collating, functions.

Figure 4A:
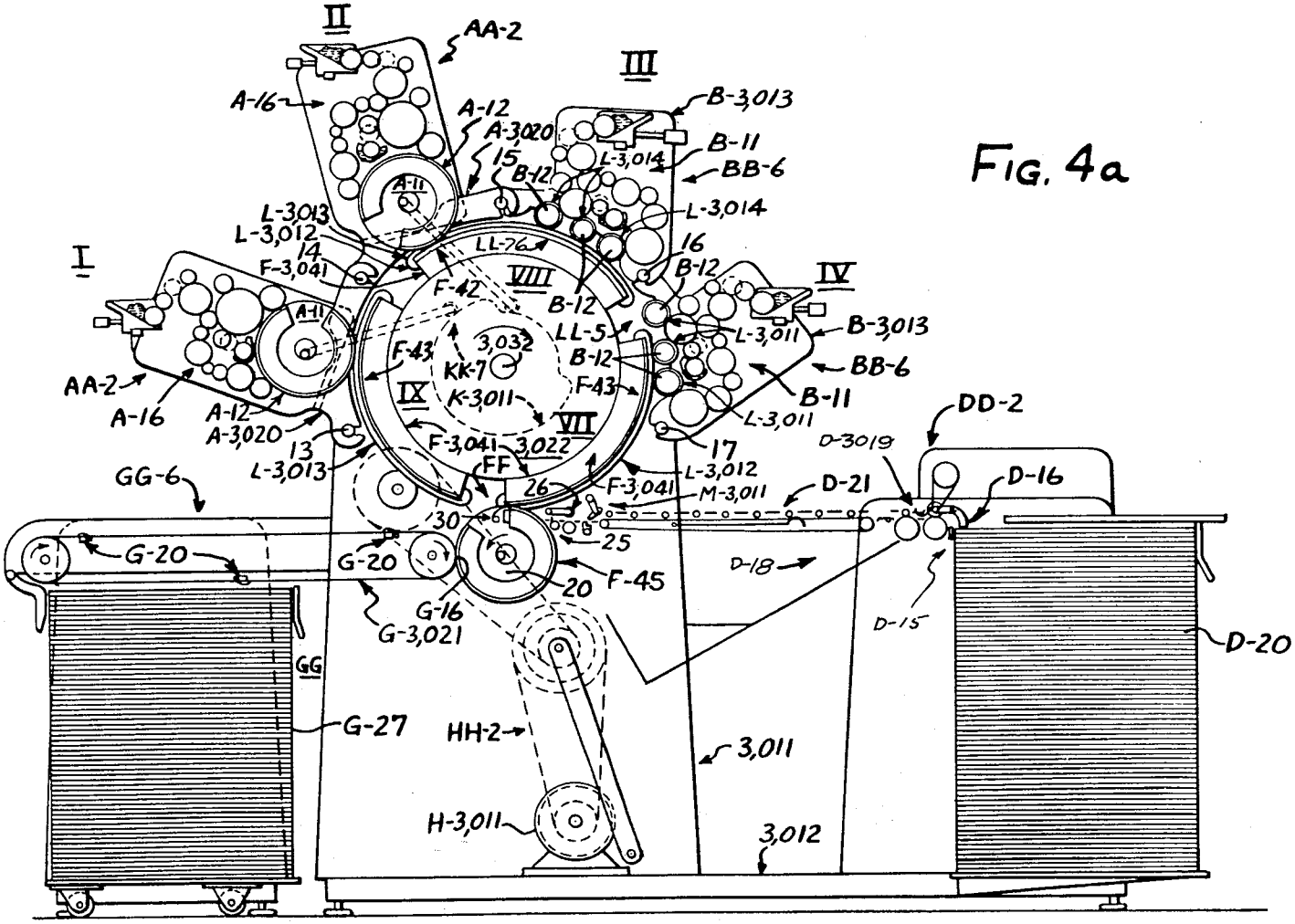

FIG. 4*a* illustrates schematically one of the many embodiments of the 3-R press. The 3-R press is substantially similar to the 2-R press and is constructed to a very large degree from the same parts and components. The essential difference is that whereas in the 2-R press the effective diameter of the large printing cylinder is two times the effective diameter of the common lower printing cylinder, in the 3-R press the effective diameter of the large printing cylinder is three times the effective diameter of the common lower printing cylinder. Similarly, while the surface of the large printing cylinder of the 2-R press is divided into two substantially equal work areas, the surface of the large printing cylinder of the 3-R press is divided into three substantially equal work areas.

The same lower printing cylinder is used in both the 2-R press and the 3-R press. It will be noted that, like the 2-R press, the 3-R press has four module mounting positions, and that the various printing modules available for mounting in these four positions are essentially the same as those available for mounting on the 2-R press.

With more specific reference to FIG. 4*a*, the 3-R press broadly comprises a pair of side frame members, generally designated 3,011, suitably supported on a base frame, generally designated 3,012, and held in rigid relationship by the same intermediate spreader bars 13, 14, 15, 16 and 17 used for the like purpose in the 2-R press.

Rotatively supported between the side frames 3,011 is a printing couple, generally designated FF, comprising the common lower printing cylinder 20 having, in this instance, an offset blanket F-45 on its surface, and above it a large printing cylinder, generally designated 3,022, having an effective diameter three times that of lower printing cylinder 20 and having its surface divided into three substantially equal work areas designated VII, VIII, and IX. In this instance, a removable segment, generally designated F-3,041, is mounted in each of these three work areas. In the embodiment illustrated in FIG. 4*a* the removable segment, F-3,041, in position VIII carries an offset blanket, F-42, on its surface while the removable segments in positions VII and IX both carry offset plates, F-43, on their surfaces.

The side frame members 3,011, conjointly with spreader bars 13, 14, 15, 16 and 17 provide four module mounting positions, designated I, II, III, and IV, at which various printing modules may be mounted to work cooperatively with large printing cylinder 3,022, as described with respect to the 2-R press embodiment illustrated in FIG. 1. Two plate cylinder modules, each generally designated AA-2, are mounted in positions I and II by means of mounting brackets A-3,020. Each of the plate cylinder modules includes a plate cylinder A-11, equal in effective diameter to lower printing cylinder 20, and carrying a lithographic (or dry offset) plate, A-12; and associated ink rollers and (if required) dampening rollers, all generally designated A-16.

The two plate cylinder, A-11, and lower printing cylinder 20 are all in rotational, tangential relationship with large printing cylinder 3,022.

It should be noted that while the plate cylinder module AA-1 (shown mounted in position II in FIG. 1) shows a relatively simple basic inking system with a combined dampening system, and while the plate cylinder modules AA-4 (shown mounted in positions II and IV in FIG. 2*a*) illustrate a more complete inking system with a separate dampening system, and while the plate cylinder modules AA-2 (shown mounted in positions I and II in FIG. 4*a*) illustrate a more complete inking system in combination with a combined dampening system, all may be used interchangeably and on either the 2-R press or on the 3-R press by simply attaching the proper mounting brackets to the frames of any one of the plate cylinder modules. Mounting brackets A-20 are used when the plate cylinder modules are to be mounted on the 2-R press and mounting brackets A-3,020 are used when the plate cylinder modules are to be mounted on the 3-R press.

Two ink/dampening modules, each generally designated BB-6, are shown in FIG. 4*a*, one mounted in position III and the other in position IV. Each of these comprises a combined ink dampening system, generally designated B-11, for applying ink and (if required) dampening, through form rollers B-12, to the surface of a plate carried by one or more of the removable segments F-3,041, or otherwise mounted in one or more of the work areas on large cylinder 3,022.

The side frames, generally designated B-3,013, of the ink/dampening modules BB-6, as seen in FIG. 4*a*, and the side frames, generally designated B-13, of the ink-/dampening module BB-2, as seen in FIG. 2*a*, are alike with the exception that the side frames B-13 of FIG. 2*a* are of the proper dimension at their base to span the spacing of the spreader bars of the 2-R press, whereas the side frames B-3,013 of FIG. 4*a* are of the proper dimension at their base to span the spacing of the spreader bars of the 3-R press. In other respects these two sets of side frames are alike; and the other components that make up these ink/dampening modules are, in fact, the same whether they are for use on the 2-R press or the 3-R press.

With reference again to FIG. 4*a*, there is a form roll lifting mechanism, generally designated LL-5, which lifts the form rollers, B-12, of the ink/dampening module mounted in position IV, out of contact with both the offset plate F-43 in position VII on large printing cylinder 3,022 and the offset blanket F-42 in position VIII on large printing cylinder 3,022, but allows these form rollers to roll in contact with the offset plate F-43 in position IX on large printing cylinder 3,022. This is accomplished by means of form roll lifter cams, generally designated L-3,012, mounted at both ends of each of the two removable segments, F-3,041, in positions VII and VIII on large printing cylinder 3,022. The form roll lifter cams on these two segments are in lateral alignment with each other and with cam follower discs, generally designated L-3,011, which are mounted at both ends of each of the form rollers, B-12, of the ink-/dampening module in position IV.

Similarly, another form roll lifting mechanism, generally designated LL-6, and laterally displaced from that just described, lifts the form rollers, B-12, of the ink-/dampening module in position III, out of contact with both the offset blanket F-42 in position VIII and the offset plate F-43 in position IX on large printing cylinder 3,022, but allows these form rollers, B-12, of the ink/dampening module in position III, to roll in contact with the offset plate F-43 in position VII on large printing cylinder 3,022. This is accomplished by means of other form roll lifter cams, generally designated L-3,013, which are mounted at both ends of each of the two removable segments F-3,041 in positions VIII and IX on large printing cylinder 3,022. Cam follower discs, generally designated L-3,014, mounted at both ends of each of the form rollers, D-12, of the ink/dampening module in position III are in lateral alignment with form roll lifter cams L-3,013, but are not in lateral alignment with form roll lifter cams L-3,012.

It will thus be noted that there is one form roll lifter cam at each end of each of the two segments in positions VII and IX on large printing cylinder 3,022, but that these two sets of form roll lifter cams are not in lateral alignment with each other; also, there are two form roll lifter cams at each end of the segment in position VIII on large printing cylinder 3,022, one form lifter cam L-3,012, at each end being in lateral alignment with a form roll lifter cam L-3,012 on the segment in position VII, and the other form roll lifter cam L-3,013 at each end being in lateral alignment with a form roll lifter cam L-3,013 on the segment in position IX. Thus the form rollers, B-12, of both of the ink/dampening modules, in positions III and IV, are raised out of contact with the blanket F-42 in position VIII; but the form rollers B-12 of the ink/dampening module in position III contact the plate in position VII but not the plate in position IX; whereas the form rollers B-12 of the ink dampening module in position IV contact the plate in position IX but not the plate in position VII.

Also, in the embodiment of the 3-R press shown in FIG. 4*a*, there is a plate cylinder control mechanism, generally designated KK-7, which includes a plate cylinder control cam, generally designated K-3,011, mounted on the shaft 3,032 of the large printing cylinder 3,022. This plate cylinder control mechanism, KK-7 may be set to lift each of the plate cylinders, A-11, in positions I and II, out of contact with each of the plates, F-43, in positions VII and IX on a large printing cylinder 3,022, while allowing each of the plate cylinders, A-11, to roll in contact successively with the blanket, F-42, in position VIII on large printing cylinder 3,022.

The press embodiment shown in FIG. 4*a* includes a pile suction feeder and tape conveyor, all generally designated DD-2, with a double sheet eliminator and tray for receiving rejects, all generally designated D-18. The feeder separates single sheets from the top of pile, D-20, by means of suction foot D-16, and conveys the sheets toward the printing couple on conveyor D-21, as previously described. This, and the other feeder mechanisms shown and described in FIGS. 1 and 2*b*, are interchangeable between the 2-R and 3-R press embodiments.

The feeder control mechanism for the 3-R press may be set to cause the feeder (or feeders) to feed a sheet either to every revolution of lower printing cylinder 20, or to every third revolution of lower printing cylinder 20, or, as another alternative, to the first, third, fourth, sixth, seventh, ninth, etc. revolutions of lower cylinder 20, with no sheets being fed to the second, fifth, eighth, etc. revolutions of lower printing cylinder 20.

Associated with the feeder DD-2 is a "miss" detector means, generally designated D-3019, which can be made operative when sheets are being concurrently printed and collated, and made inoperative at other times. This device acts to detect the presence or absence of a sheet passing through the pull-out rollers of the feeder, at the times when a sheet should be at this point if fed in accordance with the setting of the feeder control mechanism. The "miss" detector means is set for the number of sheets in each "set" being concurrently printed and collated. Whenever the "miss" detector senses that a sheet has been missed, it acts to cause a sufficient number of following sheets to be deflected into the reject tray of the double sheet eliminator so that the total number of sheets failing to reach the bite of the printing couple is equal to the number in one complete set. Thus only complete sets reach the delivery pile G-27. If more than a single sheet is fed at once, the double (or multiple) sheets are deflected into the reject tray by the double sheet eliminator, and, since this creates the same effect as a "miss" insofar as sheets reaching the bite of the printing couple are concerned, the double sheet eliminator is also tied in with the "miss" detector so that the operation of the double sheet eliminator triggers the action of the "miss" detector in exactly the same manner as if a sheet had, in fact, been missed.

The drive for the press is transmitted from the motor, H-3,011, through a variable speed drive mechanism, generally designated HH-2, as previously described with respect to the 2-R press of FIG. 2*a*. Large printing cylinder 3,022 is driven in a clockwise direction as seen in FIG. 4*a*.

The embodiment of the 3-R press shown in FIG. 4*a*, may be used to print two non-overlapping images in two colors on one side of a sheet while simultaneously printing two other non-overlapping images in two other colors on the other side of the sheet. To accomplish this, the feeder control is set to feed one sheet to every third revolution of lower printing cylinder 20, timed so that the sheet reaches the stop fingers, 25, as both the leading edge of lower printing cylinder 20, carrying offset blanket F-45, and the leading edge of the segment F-3,041, which carries off-set blanket F-42, in position VIII on large printing cylinder 3,022, are approaching the bite of the printing couple. While the sheet is at stop fingers 25, a sensing means, generally designated M-3,011, senses for the presence or absence of a sheet and causes the cylinders of the printing couple to assume or maintain either a printing or non-printing relationship through its control of the action of a cylinder latching and throw-out mechanism, not shown. The cylinders of the printing couple then maintain this relationship throughout three revolutions of lower printing cylinder 20, and until the next action of sensing means M-3,011, which takes place as the leading edge of the segment in position VIII on large printing cylinder 3,022 again approaches the bite of the printing couple, at which time a sheet should again be in position at stop fingers 25.

The sheet is then advanced toward the bite of the printing couple by the feed roller mechanism, generally designated 26, until its leading edge contacts the cylinder register stops and is grasped by the cylinder grippers, generally designated 30, which carry it through the bite of the printing couple.

As the sheet passes through the bite of the printing couple it has non-overlapping offset images, in two colors, printed on its top surface, from offset blanket F-42 in position VIII on large printing cylinder 3,022, while simultaneously it has printed on its bottom surface two other non-overlapping images in two other colors from offset blanket F-45, on lower printing cylinder 20.

Cylinder grippers 30 continue to grip the leading edge of the sheet until they have carried it around to the transfer point G-16, at which point it is transferred to one of the gripper bars, generally designated G-20, carried by the delivery chains, generally designated G-3,021, of the separate chain delivery mechanism, generally designated GG-6. As the chain carried grippers G-20 grip the sheet, it is released by the cylinder grippers 30 and the leading edge of the sheet is carried toward the rear of the press until the sheet is in proper position to be dropped on the delivery pile G-27, at which point it is released. The combined action of cylinder grippers 30 and chain carried grippers G-20 strips the sheet from the peripheral surfaces of the cylinders of the printing couple and the sheet is delivered, with a printed surface face-up, in the delivery position of the press, generally designated GG, which is at the opposite end of the press from the feeder.

As large printing cylinder 3,022 revolves, in a clockwise direction, a right-reading offset plate F-43 mounted in position IX on large printing cylinder 3,022 is inked and (if required) dampened by form rollers B-12 of the ink/dampening module mounted in position IV; and another right-reading offset plate F-43 in position VII on large printing cylinder 3,022 is inked and (if required) dampened by form rollers B-12 of the ink-/dampening module mounted in position III.

A right-reading offset plate, A-12, on plate cylinder A-11 of the plate cylinder module mounted in position I, rolls against offset blanket F-42, in position VIII on large printing cylinder 3,022, and transfers onto it an inked mirror image. Thereafter another right-reading offset plate, A-12, on plate cylinder A-11 of the plate cylinder module mounted in position II, rolls against offset blanket F-42 and transfers to it a second, non-overlapping, inked mirror image, in another color.

Lower printing cylinder 20 makes two complete revolutions to which no sheets are fed, and, on the first of these two revolutions, offset blanket F-45, on lower printing cylinder 20, rolls in contact with the inked right-reading image of the plate F-43, in position IX on large printing cylinder 3,022, and this image is transferred onto blanket F-45 where it appears as an inked mirror image. On the second such revolution of lower printing cylinder 20 offset blanket F-45 rolls in contact with the non-overlapping, inked right-reading image on the plate F-43 in position VII on large printing cylinder 3,022, and this image too is transferred onto blanket F-45, where it, too, appears as an inked mirror image, in another color, but not overlapping the first image.

A sheet of paper then passes through the bite of the printing couple, between blanket F-42 in position VIII on large printing cylinder 3,022 and blanket F-45 on lower printing cylinder 20, and is printed, stripped and delivered in the manner previously described.

On the 3-R press, as in the case of the 2-R press previously described, a sheet may be carried through the bite of the printing couple only one time, as just described, or it may be carried through the bite of the printing couple more than once; and, in the case of the 3-R press, it may be carried through the bite of the printing couple either one, two or three times.

It will be noted that there are three delivery gripper bars, G-20, carried by the delivery chains G-3,021 of the separate chain delivery mechanism GG-6, of the 3-R press. The length of the delivery chains, G-3,021, is equal to the effective circumference of large printing cylinder 3,022, and the distance between the delivery gripper bars G-20 is equal to the effective circumference of lower printing cylinder 20. Whenever the sheets are passed through the bite of the printing couple only once, the grippers of each of the chain carried gripper bars, G-20, close at the transfer point G-16 and the cylinder grippers 30 open at the transfer point G-16 on each revolution of lower printing cylinder 20, whether or not the feeder controls have been set to cause a sheet to be present in the bite of the cylinder grippers 30 on each revolution of lower printing cylinder 20.

However, when a sheet is to be carried through the bite of the printing couple two times, the cylinder grippers 30 do not open as they pass the transfer point G-16 the first time around, and the grippers of the chain carried gripper bar, G-20, which meets the cylinder grippers 30 at the transfer point, G-16, on that revolution of lower printing cylinder 20, are rendered inactive and locked in an open position, so that they do not close to seize the sheet as they pass the transfer point G-16. The second time the cylinder grippers 30 reach the transfer point G-16, after having carried the leading edge of the sheet through the bite of the printing couple a second time, they open to release the sheet, and the grippers of the chain carried gripper bar, G-20, which is in coincidence with the cylinder grippers on that revolution of lower printing cylinder 20, close to grip the leading edge of the sheet, so that the sheet is then stripped and delivered.

Similarily, if a sheet is to be carried through the bite of the printing couple three times, the cylinder grippers 30 pass the transfer point G-16 twice without opening, and the grippers of the two chain carried gripper bars, G-20, which are in coincidence with the cylinder grippers 30 on those two revolutions of lower printing cylinder 20 are rendered inoperative and locked open. Then on the third revolution of lower printing cylinder 20, after the cylinder grippers 30 have carried the leading edge of the sheet through the bite of the printing couple for the third time, the transfer from the cylinder grippers 30 to the grippers of the chain carried gripper bar G-20, which is in coincidence with the cylinder grippers 30 on that revolution of lower printing cylinder 20, is made, and the sheet is stripped and delivered.

FIG. 4*b* shows an additional "extension" chain delivery which may be used in combination with the separate chain delivery mechanism of FIG. 4*a*. This additional "extension" chain delivery makes it possible to deliver the sheets, alternatively, with what was their original bottom surface facing up. This additional "extension" chain delivery, generally designated G-32, comprises two "extension" delivery gripper bars, generally designated G-33, which are carried by two "extension" delivery chains, generally designated G-34. As shown in FIG. 4*b*, the direction of rotation of this "extension" chain delivery mechanism is opposite to that of the separate chain delivery mechanism of FIG. 4*a*. To deliver sheets with their original bottom surface facing up, the leading edge of a sheet is carried to the transfer point G-35 between the separate chain delivery mechanism GG-6 and the "extension" chain delivery mechanism G-32 by the grippers of one of the gripper bars G-20 of the separate chain delivery mechanism, and at this point the leading edge of the sheet is transferred from the grippers of the gripper bar G-20 of the separate chain delivery mechanism to the grippers of one of the gripper bars G-33 of the "extension" chain delivery mechanism. The sheet is then pulled by its leading edge over the top of the "extension" chain delivery mechanism, is turned over and, still being pulled by its leading edge, carried into position over the delivery pile, generally designated G-36, of the "extension" chain delivery mechanism until the sheet is in position to drop on the top of the pile, at which point the leading edge is released by the grippers of the gripper bar G-33.

The grippers of each of the gripper bars G-33 of the "extension" chain delivery mechanism G-32 close to seize the leading edge of a sheet each time the gripper bar passes the transfer point G-35, and open to release a sheet each time the gripper bar has reached the position that would place the sheet in proper position to be dropped on the top of the delivery pile G-36, irrespective of whether or not there is a sheet carried by the gripper bar G20 of the separate chain delivery mechanism with which it will come into coincidence at the transfer point G-35. Since there are three gripper bars G-20 carried by the separate chain delivery mechanism and two gripper bars G-33 carried by the "extension" chain delivery mechanism, it is apparent that each gripper bar G-33 of the "extension" chain delivery mechanism will not always come into coincidence with the same gripper bar G-20 of the separate chain delivery mechanism at the transfer point G-35.

As was the case on the 2-R press, stop fingers 25 and feed rollers 26 act on every revolution of lower printing cylinder 20 irrespective of whether the feeder control has been set to cause a sheet to be fed to every revolution of lower printing cylinder 20 or not. However, as was also the case on the 2-R press, sheet sensing mechanism M-3,011 is caused to act to sense the presence or absence of a sheet at the stop fingers 25, only at those times when, in accordance with the setting of the feeder controls, a sheet should be at the stop fingers 25.

It will be apparent that through the proper use and adjustment of the feeder and delivery controls and the controls governing the number of times a sheet is carried through the bite of the printing couple, through the use of appropriate removable and replaceable segments in the three work areas VII, VIII, IX on large printing cylinder 3,022, and through the proper use and adjustment of the plate cylinder modules in positions I and II together with the plate cylinder control mechanism, and the ink/dampening modules in positions III and IV together with the form roll lifter mechanisms, any of the functions described in connection with the embodiments of the 2-R press illustrated and described in FIGS. 1, 2*a*, 2*b* and 3 may also be performed on the embodiment of the 3-R press shown in FIG. 4*a*.

It will also be apparent that with the availability of the three work areas on large printing cylinder 3,022 of the 3-R press, together with the correspondingly increased capabilities of the feeder controls, the delivery controls, and the controls governing the number of times a sheet is carried through the bite of the printing couple, a very wide variety of other printing functions and combinations of functions may be performed.

With this in mind, it will be apparent that this embodiment of the 3-R press may be used to print two non-overlapping images in two colors by offset and two additional images in two other colors by letterpress, all on one side of a sheet, with the two letterpress images overlapping, if desired, either or both of the offset images, or each other. This might, for instance, involve printing two images which do not overlap, in two colors, by offset, adding a letterpress imprint in a third color by means of a rubber plate and also numbering the sheets, by letterpress, in a fourth color.

This embodiment of the 3-R press may also be used to print a sheet in three overlapping colors with two of the colors being printed by offset and one by letterpress.

It may also be used to concurrently print and collate three different pages of a bulletin, letter, office form, etc., with two of the pages being printed by offset and one by letterpress or with one of the pages being printed by offset in two non-overlapping colors and the other two pages being printed by letterpress; or, alternatively, to concurrently print and collate two pages, with one being printed by offset in two non-overlapping colors and the other page being printed in two colors by letterpress, with the colors either overlapping or not, as desired.

The printing functions and/or combinations of functions referred to above are but a few of the extremely wide variety of printing, and printing and collating, functions and combinations of functions that can be performed through the use of the many permutions of the components and adjustments of this embodiment of the 3-R press.

Figure 5A:
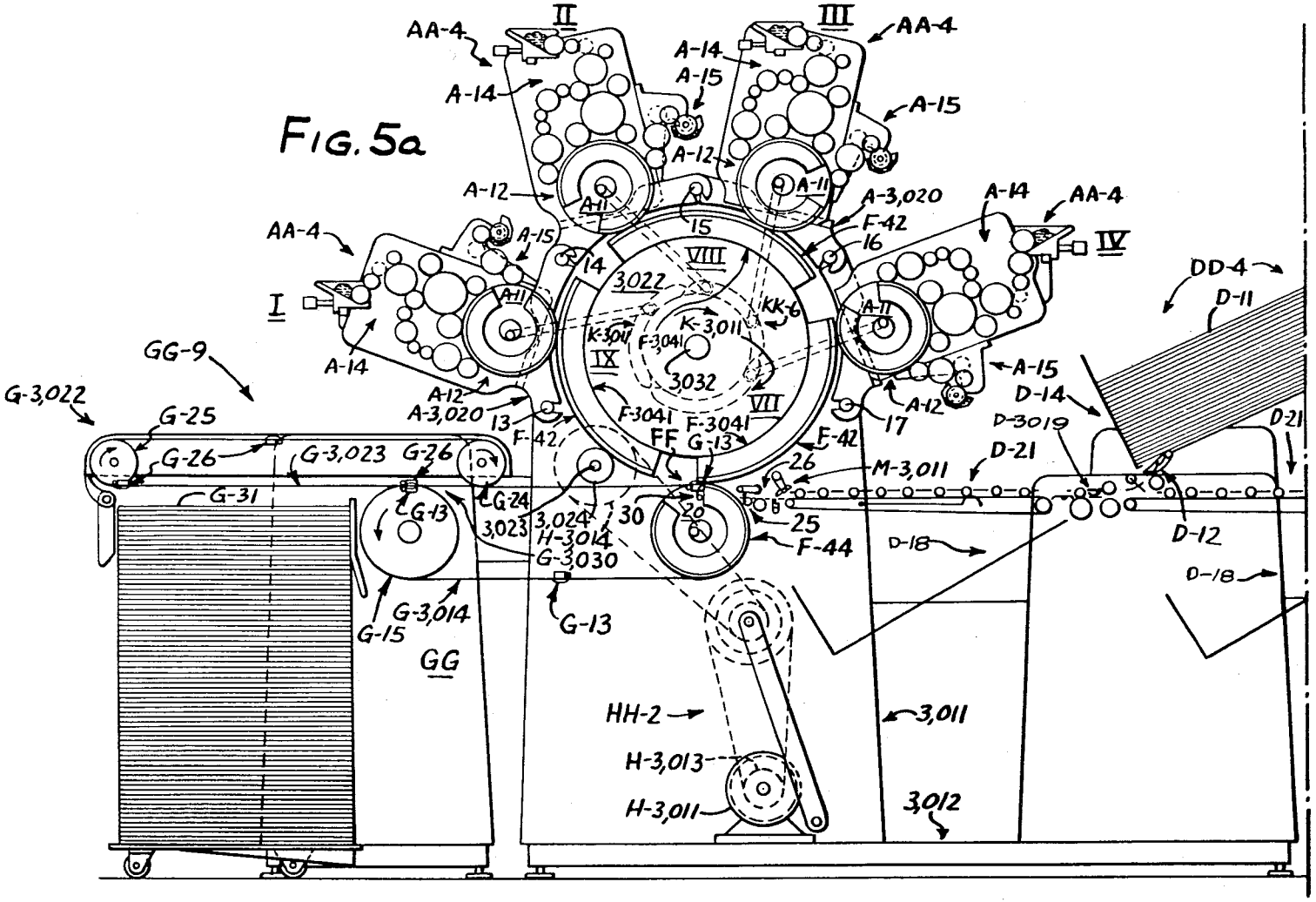
Figure 5B:
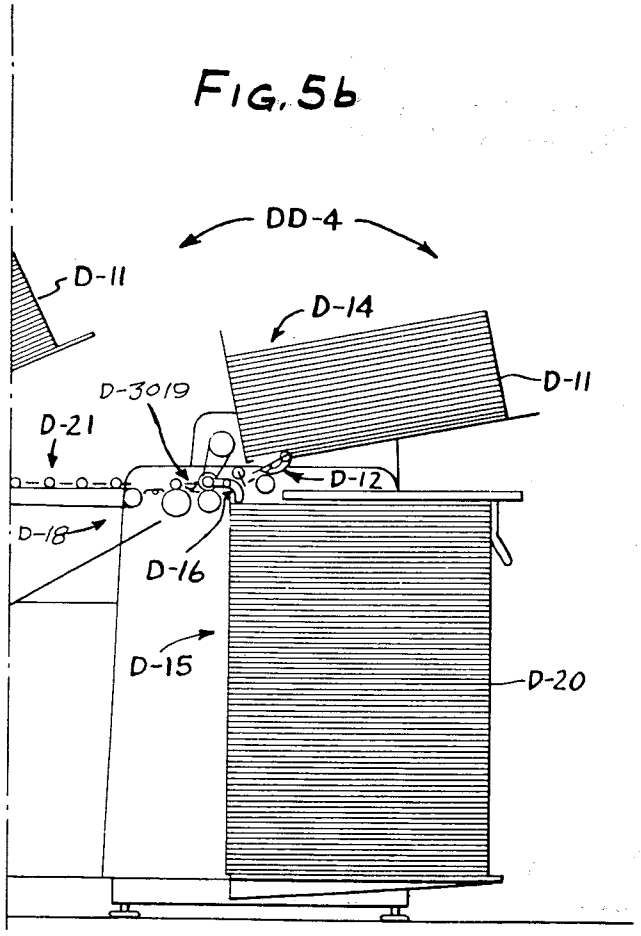

FIGS. 5*a* and 5*b* taken together, schematically illustrate another embodiment of the 3-R press. Because the size of this embodiment of the 3-R press is too large to be shown on a single sheet, FIGS. 5*a* and 5*b* appear on separate sheets; but they should be viewed together, and, for this purpose, should be placed together along the center line at the right of FIG. 5*a* and at the left of FIG. 5*b*.

The basic press structure of the 3-R press, including frames 3,011, base frame 3,012 and printing couple FF, etc. is all as described in connection with FIG. 4*a*. In this instance, however, lower printing cylinder 20 carries a platen surface, generally designated F-44, and each of the removable segments F-3,041, in the three work areas VII, VIII, and IX, on large printing cylinder 3,022 have offset blankets, F-42, mounted on their surfaces. There are four plate cylinder modules each generally designated AA-4; one being mounted in each of the module mounting positions, I, II, III and IV.

Each of these plate cylinder modules AA-4 includes a plate cylinder A-11, carrying an offset plate A-12 (wet or dry) mounted on its surface; the image on plate A-12 is inked by ink rollers, generally designated A-14, and separate dampening rollers, generally designated A-15, are provided, and may be used (if required) to dampen plate A-12. The four plate cylinder modules, AA-4, are mounted on spreader bars 13, 14, 15, 16 and 17 by means of mounting brackets, generally designated A-3,020, as previously described, so that each of the plate cylinders A-11 is in rotational, tangential relationship to large printing cylinder 3,022.

As previously described, the effective diameter of large printing cylinder 3,022 is three times the effective diameter of lower printing cylinder 20; and the effective diameter of each of the four plate cylinder, A-11, is equal to the effective diameter of lower printing cylinder 20.

A plate cylinder control mechanism, generally designated KK-6, is provided and includes three control cams, each generally designated K-3,011, which are mounted on, and rotate with, shaft 3,032 of large printing cylinder 3,022. Plate cylinder control mechanism KK-6 is so adjusted that the plate, A-12, in position I rolls in contact with the blanket, F-42, in position IX on large printing cylinder 3,022, but is held out of contact with the two blankets, F-42, in positions VII and VIII on large cylinder 3,022. The two plates, A-12, in positions II and III each roll in contact successively with the blanket, F-42, in position VIII on large printing cylinder 3,022, but both are held out of contact with the two blankets, F-42, in positions VII and IX on large printing cylinder 3,022. The plate, A-12, in position IV rolls in contact with the blanket, F-42, in positions VII on large printing cylinder 3,022, but is held out of contact with the two blankets, F-42, in positions VIII and IX on large printing cylinder 3,022.

Positioned at the front of the press, and in spaced relation thereto, and also mounted on base frame 3,012, is a feeder-collator-conveyor combination, generally designated DD-4, which consists of two "bottom" feeders, each generally designated D-14, a "pile" feeder, generally designated D-15, two tape conveyors, each generally designated D-21, two double sheet eliminators with trays for receiving rejects, all generally designated D-18 in each case, and two "miss" detectors, each generally designated D-3019. The feeder controls may be adjusted to cause the feeders to feed sheets to every revolution of lower printing cylinder 20, to every third revolution of lower printing cylinder 20, or to the first, third, fourth, sixth, seventh, ninth, etc. revolutions of lower printing cylinder 20, with no sheets being fed to the second, fifth, eighth, etc. revolutions of lower printing cylinder 20. Sheets may be fed from the "pile" feeder only, from one of the "bottom" feeders only, for the "pile" feeder and one "bottom" feeder in combination, or from all three feeders in combination. The double sheet eliminators, D-18, may be set so that whenever more than a single sheet is fed from any one of the feeders, the multiple sheets are defected into a tray for receiving rejects. The "miss" detector mechanisms D-3019, may be used when concurrently printing and collating sheets; and, when so used, are set for the number of sheets in the set being collated, and, if any one of the feeders being used fails to feed a sheet, or if a "double" is deflected, as previously described, the "miss" detector will cause a sufficient number of additional sheets to be deflected into one of the reject trays so that the total number of sheets failing to reach the bite of the printing couple will be exactly equal to the number in one full set of the sheets being concurrently printed and collated, thus insuring that there will be no interruption in the proper number or sequence in each set of concurrently printed and collated sheets being delivered by the press.

The drive mechanism, generally designated HH-2, is similar to that previously illustrated and described in connection with FIG. 2*a*. Large cylinder 3,022 is driven in a clockwise direction, as seen in FIG. 5*a*.

The operation of stop fingers, 25, feed rollers, 26, and sensing mechanism, M-3011, is as previously described.

Sheets that are to pass through the bite of the printing couple only once are advanced to the cylinder grippers and cylinder stops 30 by feed rollers 26, and gripped and carried by cylinder grippers 30 to the bite of the printing couple, by which time the leading edge of each sheet will also have been gripped by the grippers of one of the delivery gripper bars, G-13, carried by the encircling delivery chains G-3,014. The cylinder grippers 30 will open and release the sheet as they reach the bite of the printing couple and the sheet will remain in the grip of the chain carried grippers, G-13, which will strip it from the peripheral surfaces of the cylinders of the printing couple and carry it toward the delivery point.

Alternatively, the mechanism for controlling the number of times a sheet is to be carried through the bite of the printing couple may be set to carry a sheet through the bite of the printing couple two, or three, times, as required; the action being similar to that illustrated and described in connection with FIG. 2*a*. However, it will be noted that in the 3-R press, the length of the encircling chains, G-3,014, is equal to the effective circumference of large printing cylinder 3,022, and these encircling chains G-3,014 carry three delivery gripper bars, G-13, spaced apart from each other by a distance equal to the effective circumference of lower printing cylinder 20.

On the 3-R press the mechanism that controls the number of times a sheet is carried through the bite of the printing couple may also be set to carry one sheet through the bite two times and the next sheet through the bite only one time, with this sequence being repeated for each revolution of large printing cylinder 3,022.

If a sheet is to be carried through the bite of the printing couple two times, the grippers of the chain carried gripper bar G-13, which is in coincidence with cylinder grippers 30 during the first passage of the sheet through the bite of the printing couple are locked in an open position and they, therefore, do not grip the leading edge of the sheet as it approaches and passes through the bite of the printing couple for the first time; instead cylinder grippers 30 retain their grip on the leading edge of the sheet on this first passage through the bite of the printing couple, and carry the sheet around lower printing cylinder 20 and back to the bite of the printing couple for a second time. As cylinder grippers 30 approach the bite of the printing couple the second time, the grippers of the chain carried gripper bar G-13 which is then in coincidence with cylinder grippers 30 close and grip the leading edge of the sheet and pull the sheet by its leading edge to strip it from the peripheral surfaces of the cylinders of the printing couple, as previously described, whereas cylinder grippers 30 release the sheet as they reach the bite of the printing couple for the second time.

If a sheet is to be carried through the bite of the printing couple three times, the action is similar except that cylinder grippers 30 retain their grip on the leading edge of the sheet on both their first and second passages through the bite of the printing couple, and the grippers of both the chain carried gripper bars, G-13, that are in coincidence with cylinder grippers 30 on both of these revolutions of lower cylinder 20, are locked open; and the transfer from cylinder grippers 30 to the grippers of the third chain carried gripper bar, G-13, occurs as cylinder grippers 30 approach and reach the bite of the printing couple for the third time, with the grippers of the chain carried gripper bar, G-13, which is then in coincidence with cylinder grippers 30 performing the stripping and delivery of the sheet, and cylinder grippers 30 releasing the sheet as they reach the bite of the printing couple for the third time.

Figure 6:
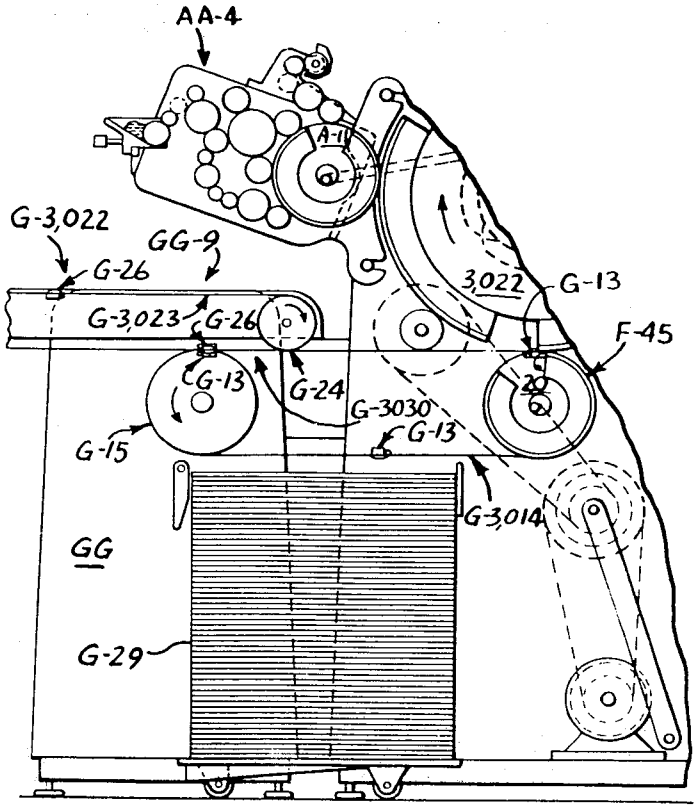

The embodiment of the 3-R press shown in FIGS. 5*a*, 5*b* and 6 is also equipped with an "extension" chain delivery, generally designated G-3,022. This "extension" chain delivery and the encircling chain delivery mechanism, together, make up the complete delivery mechanism, generally designated GG-9, located at the delivery end of the press, generally designated GG.

"Extension" delivery mechanism G-3,022 consists of a separate pair of "extension" delivery chains, generally designated G-3,023, which carry between them three "extension" delivery gripper bars, each generally designated G-26, and which are supported by a pair of inner sprockets, generally designated G-24, and a pair of outer sprockets, generally designated G-25. The preferred length of the "extension" delivery chains G-3,023 is the same as the length of the encircling delivery chains G-3,014, namely three times the effective circumference of lower cylinder 20. The "extension" delivery gripper bars G-26, carried by the "extension" delivery chains G-3,023, are spaced apart from each other by a distance equal to the effective circmference of lower cylinder 20.

It will be noted that the path of travel, out from the press, of the encircling delivery chains, G-3,014, is parallel to and spaced just below the path of travel, out from the press, of the "extension" delivery chains, G-3,023, and that for a portion of their length along these parallel paths of travel the two chains overlap one another. The timing is such that each of the delivery gripper bars, G-13, carried by the encircling delivery chains, G-3,014, meets one of the "extension" delivery gripper bars, G-26, carried by the "extension" delivery chains, G-3,023, and travels with it through this distance of overlap, which is referred to as the "transfer area," generally designated G-3,030.

As the two delivery gripper bars, G-13 and G-26, travel together through the transfer area G-3,030, the leading edge of the sheet is gripped by the grippers of the "extension" delivery gripper bar G-26 and released by the grippers of the delivery gripper bar, G-13, carried by the encircling chains G-3,014, so that the sheet continues to be gripped, and pulled by its leading edge, in a straight line, until it is in the proper position over the delivery pile G-31, at which point the grippers of the "extension" delivery gripper bar, G-26, open to drop the sheet on the top of the pile G-31. The sheet is thus delivered with its original top surface face-up and it has been pulled by its leading edge, in a straight line, directly from the bite of the printing couple to the position at which it is dropped onto the top of the delivery pile G-31.

An important advantage accrues from the fact that the transfer of the sheet, from the grippers carried by the encircling delivery chains to the grippers carried by the "extension" delivery chains, takes place as the two grippers move together through the "transfer area" G-3,030, thus providing a significantly longer time interval during which the transfer may take place, at any given cylinder speed, compared to a transfer effected at the line of tangency between two cylinders.

Similarly, the transfer from the cylinder grippers, 30, to the delivery grippers, G-13, carried by the encircling chains G-3,014, takes place as the two grippers move together through an arc about lower cylinder 20, as the grippers approach the bite of the printing couple; thus providing, in this case too, for a more leisurely and, therefore, more positive, and quieter, transfer than could be effected at the line of tangency between two cylinders.

FIG. 6 illustrates an alternative use of the delivery mechanism GG-9 in which the grippers of the "extension" delivery mechanism G-3,022 are locked in an open position, and thus rendered inactive, and the grippers of the gripper bars, G-13, carried by the encircling delivery chains G-3,014, are caused to retain their grip on the leading edge of a sheet until it has been carried around the shaft of the outer sprockets, G-15, of the encircling gripper mechanism, and is then released in position to be dropped on the top of the delivery pile, G-29, in the position shown in FIG. 6. In this case the sheet is pulled by its leading edge until it is delivered with what was originally its bottom surface facing up.

In performing one of the many functions or combinations of functions which may be performed by the embodiment of the 3-R press illustrated in FIGS. 5*a*, 5*b* and 6, right-reading offset plates (either wet or dry) are placed on each of the four plate cylinders, A-11, in positions I, II, III and IV. The image on each of these plates is inked and (if required) the surface of each plate is dampened, and the right-reading inked image on the plate, A-12, in position I is transferred to the offset blanket, F-42, in position IX on large cylinder 3,022. Two right-reading, non-overlapping inked images, on the two plates, A-12, in positions II and III are both transferred to the offset blanket, F-42, in position VIII on large cylinder 3,022. The right-reading inked image on the plate, A-12, in position IV is transferred to the offset blanket, F-42, in position VII on large cylinder 3,022. All of these images then appear as inked mirror images on the surfaces of the respective offset blankets.

Sheets of three different colors and/or weights are fed from the three feeders, timed so that one sheet is fed to each revolution of lower cylinder 20, coming successively from each of the three feeders. Each sheet passes through the bite of the printing couple one time, and the platen surface F-44 on lower cylinder 20 presses each sheet against the surface of successive ones of the offset blankets, F-42, as the sheets pass through the bite of the printing couple. The inked mirror image on the surface of the blanket, F-42, in position VII on large cylinder 3,022 is printed on the top surface of the first sheet, as a right-reading image. The two-color inked mirror image on the surface of the offset blanket, F-42, in position VIII on large cylinder 3,022 is printed on the top surface of the second sheet of the set, as it passes through the bite of the printing couple, where it appears as a two-color right-reading image. The third sheet of the set is similarly printed by having the inked image on the blanket, F-42, in position IX on large cylinder 3,022 transferred to its top surface, where it appears as a right-reading image. Each of the sheets is successively stripped and delivered, with its printed face up, onto the top of the delivery pile G-31, as previously described. Thus, for each revolution of large cylinder 3,022, a three-page form is printed, by either wet or dry offset, and concurrently collated, with each of the three sheets being of a different color and/or weight, and with a different image, in a different color on each sheet and with one of the sheets being printed in two non-overlapping colors.

A wide range of variations of the above described combination of functions may be performed. For instance, the different images on each of the sheets may all be in the same color, if desired, with the second color appearing on one of the sheets being the only other color used. Also, this fourth image, in another color, may be printed on each of the three sheets along with each of the three different images which appear on the different sheets of the set. Also, all three sheets of the set may be printed on identical paper stock and the sheets all fed from only one of the feeders. It will be apparent, of course, that a wide variety of other combinations are possible.

By using only one of the feeders and causing sheets to be fed only to every third revolution of lower cylinder 20, and by making the required adjustments to cause each sheet to be carried through the bite of the printing couple three times, each sheet may be printed (by wet or dry offset) in three overlapping colors and a fourth color, which may overlap two of the other colors, but not the third.

By placing an offset blanket F-45 on lower cylinder 20, in place of the platen surface, F-44, and by placing two mirror image (wet or dry) offset plates, A-12, on the two plate cylinders, A-11, at positions I and IV, (in place of the two right-reading plates) and by causing sheets to be fed from only one of the feeders and only to every third revolution of lower cylinder 20, timed to pass through the bite of the printing couple between lower cylinder 20 and the offset blanket, F-42, mounted in position VIII on large cylinder 3,022, the sheets may be printed, simultaneously, with two non-overlapping images in two colors on one side and two non-overlapping images in two other colors on the other side. The inked mirror images on the two plates, A-12, in positions I and IV are transferred, as inked right-reading images, onto the blankets F-42 mounted in positions IX and VII, respectively, on large cylinder 3,022, and since no paper is present when the offset blankets, F-42, in positions VII and IX on large cylinder 3,022 roll against lower cylinder 20, the right-reading inked images on their surfaces are both transferred to the offset blanket F-45 on lower cylinder 20, where they appear as two non-overlapping inked mirror images, in two colors. Also, as previously described, two non-overlapping, inked mirror images, in two colors, have been transferred onto the surface of the offset blanket F-42, mounted in position VIII on large cylinder 3,022. As a sheet of paper is passed through the bite of the printing couple between lower cylinder 20 and the segment mounted in position VIII on large cylinder 3,022, the sheet, simultaneously, has a two-color, right-reading image printed on its top surface and another two-color, right-reading image printed on its bottom surface. The sheet is then stripped and delivered by the chain carried encircling grippers, G-13, which pull its leading edge away from the bite of the printing couple, stripping the sheet from the peripheral surfaces of the cylinders of the printing couple, and, as shown in FIG. 6, it may be carried out around the shaft of the outer sprockets, G-15, of the encircling chain delivery mechanism, whereby it is turned over and pulled into the release position and dropped onto the top of the delivery pile G-29, with what was originally its bottom surface face-up.

Alternatively, the sheet may be delivered as illustrated and described in FIG. 5*a*, with its original top surface face-up, onto the delivery pile G-31 of FIG. 5*a*.

This embodiment of the 3-R press may also be used to print four non-overlapping images, in four colors, on one side of a sheet by offset (either wet or dry). To do this the plate cylinder control mechanism KK-6 is adjusted so that each of the four plate cylinders A-11, in positions I, II, III and IV, rolls in contact successively with each of the three offset blankets F-42, in the three work areas VII, VIII and IX on large printing cylinder 3,022. This causes identical four color non-overlapping inked mirror images to be transferred to each of these three off-set blankets. The platen surface F-44 is used on lower printing cylinder 20. The feeder control mechanism is adjusted to cause sheets to be fed to each revolution of lower printing cylinder 20 from any one of the feeders. Each sheet then has an identical four color non-overlapping right-reading image printed on its top surface as it passes through the printing couple. The sheets are delivered onto the delivery pile G-31 of FIG. 5*a* with their printed face up. Three sheets are printed and delivered for each revolution of large printing cylinder 3,022.

It will be apparent from the descriptions covering FIGS. 1, 2*a*, 3, 4*a* and 4*b*, together with the above description of the structure and operation of this embodiment of the 3-R press illustrated in FIGS. 5*a*, 5*b* and 6, that an extememly wide range of additional printing, and concurrent printing and collating, functions and combinations of functions may be performed by the proper use and adjustment of the various elements of this embodiment of the 3-R press.

MODULAR AND INTERCHANGEABLE PRESS STRUCTURES

The embodiments of the 2-R and 3-R presses shown in FIG. 1 through 6 are typical of the may embodiments that may be assembled from the various standardized components of this invention to produce so-called "standard" models.

These Figures and the descriptions accompanying them have illustrated broadly the basic structure and operation of the press and have illustrated the flexibility available to the user of any of these particular embodiments with respect to the efficient performance of a wide range of different printing and/or concurrent printing and collating functions, or combinations of functions.

FIGS. 7*a* through 8*d* on the other hand show diagrammatically the range of interrelated components for which a manufacturer might tool, and which would then be made in production quantities, and assembled into a variety of "standard" models, similar to the embodiments illustrated in FIGS. 1 through 6, on a regular basis; and which would then also be available for assembly into a much wider variety of specialized models to perform an equally wide variety of specialized printing functions, as the demand arose.

FIGS. 7*a* through 8*d*illustrated graphically, in diagrammatic form, the more important interrelated functional areas of the press and the alternatives that are available in each functional area in order that the necessary "back-up" mechanical functions may be performed when the various printing modules, etc. are mounted in a wide variety of configurations, to perform an even greater variety of printing functions and combinations of functions.

While means are provided in every functional area of the press to supply "back-up" mechanical functions for the embodiments in which the most complex combinations of printing modules, etc., are used, and for the performance of the most complex printing and/or concurrent printing and collating functions; the construction in each functional area of the press in such that other embodiments, (in which simpler combinations of printing modules, etc., are used to perform simpler printing functions or combinations of functions), need not be burdened with unnecessary supporting mechanism, but only such mechanism as is actually required (in keeping with the overall embodiment of the press being furnished) need be provided in each functional area of the press.

Figures 7, 7A:
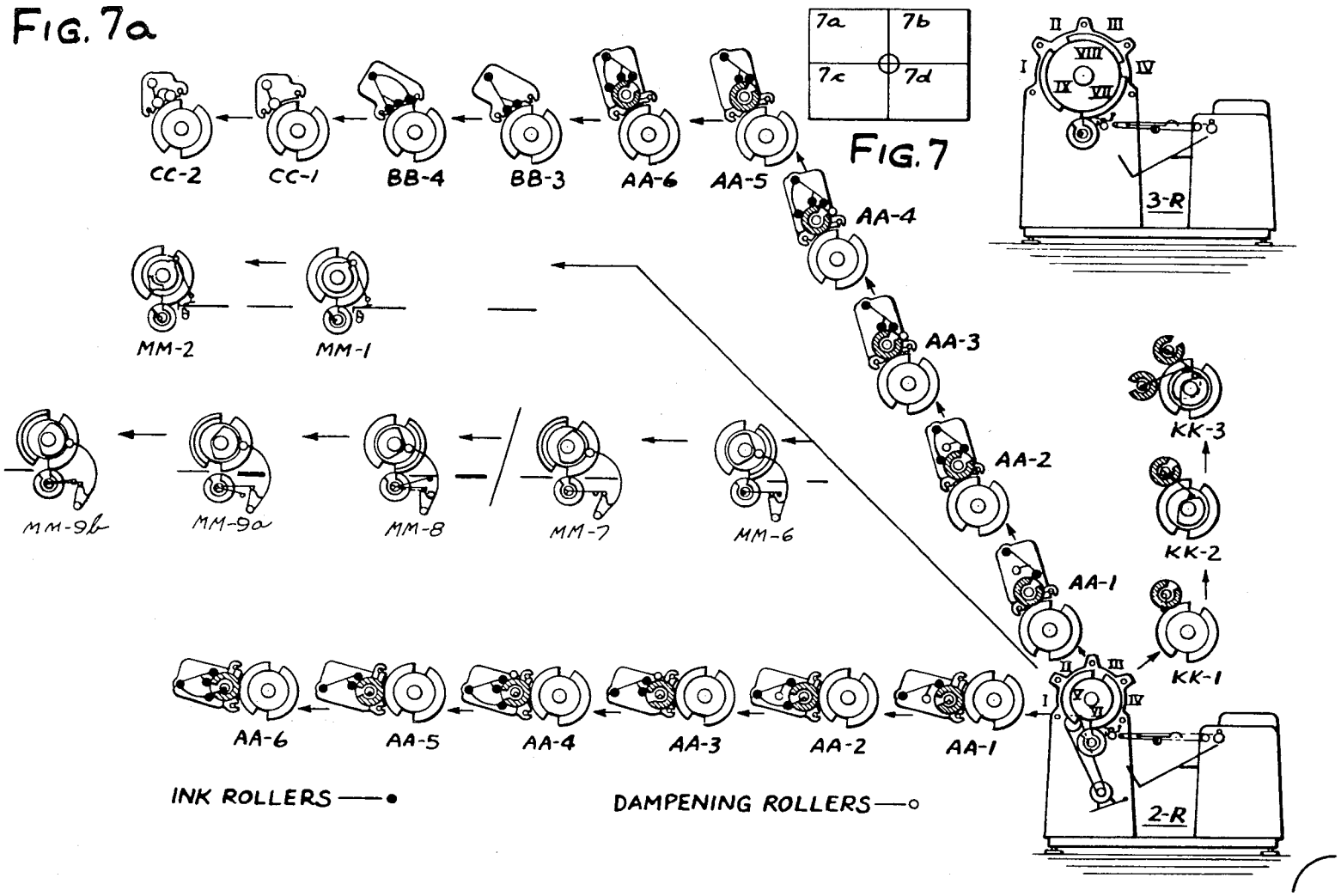

Referring to FIG. 7, this figure is of such size that it has been broken into four parts, FIGS. 7*a*, 7*b*, 7*c* and 7*d*, each on a separate sheet. To view FIG. 7 as a whole these four sheets should be assembled together, with FIG. 7*a* forming the upper left hand quadrant, FIG. 7*b* forming the upper right hand quandrant, FIG. 7*c* forming the lower left hand quadrant and FIG. 7*d* forming the lower right hand quadrant. To aid in assembling these properly into a single large drawing there is a 90 degree quadrant of a circle in one corner of each of these four Figures and when FIG. 7 has been properly assembled these four quadrants form a complete circle.

FIG. 7 then has the general form of the hub and spokes of a wheel, with a diagrammatic showing of the basic 2-R press structure (which is repeated on each of the four sheets for clarity) at the center, or "hub", and with diagrammatic showings of various interrelated functional areas of the total press structure shown radiating from this central diagram like the spokes of a wheel. The diagrams making up each of these "spokes" illustrate, diagrammatically, some interrelated aspect of the total mechanical function and/or structure of the press, and illustrate alternatives that are available.

These diagrams are mainly for the purpose of illustrating what takes place, and are only suggestive of how it takes place. Some of the diagrams show time sequence in the operation of the press with respect to both structure and/or the mechanical function performed.

This will be brought out in more detail as the diagrams making up each "spoke" of the "wheel" are described in greater detail.

It will be noted that there is also a diagrammatic showing of the basic structure of the 3-R press in the upper right hand corner of FIG. 7*a*. This is included since many aspects of the press covered in FIG. 7 as a whole apply as well to the 3-R press, although they are illustrated in FIG. 7 in connection with the 2-R press.

There is a small diagram on the sheet on which FIG. 7*a* appears showing how FIG. 7 as a whole should be assembled.

Referring now to FIG. 7, and starting with FIG. 7*a*: at the center of the "hub" is a diagrammatic showing of the basic structure of the 2-R press, showing in outline form the press and feeder frames mounted on a common base, and showing the printing couple consisting of a large printing cylinder and a lower printing cylinder, and also showing means for driving the printing couple. There are four module mounting positions designated I, II, III and IV, as previously described, around the upper portion of the press frame.

The effective diameter of the large printing cylinder is twice the effective diameter of the lower printing cylinder and the lower printing cylinder has one work area and one gap and the large printing cylinder has two work areas and two gaps. The work areas on the large printing cylinder are designated V and VI.

The 3-R press, shown diagrammatically in the upper right hand corner of the sheet, also comprises press frames and feeder frames mounted on a common base and with a printing couple consisting of a large printing cylinder and a lower printing cylinder. In the 3-R press, as in the 2-R press, there are four module mounting positions, designated I, II, III and IV at which various printing modules may be mounted. In the 3-R press the effective diameter of the large printing cylinder is three times the effective diameter of the lower printing cylinder and the lower printing cylinder is divided into one work area and one gap while the large printing cylinder, mounted above it, is divided into three work areas and three gaps. The work areas on the large printing cylinder of the 3-R press are designated VII, VIII and IX.

It is important to note the relationship between the 2-R press and the 3-R press, in which the key element is that the lower printing cylinders of both presses are identical. The basic feeders and feeder frames of the two presses are therefore also identical; and all of the basic devices for conveying and acting upon sheets between the feeder and the bite of the printing couple are identical on both presses. The essential difference lies in the fact that whereas the effective diameter of the large printing cylinder in the 2-R press is two times the effective diameter of the common lower printing cylinder, the effective diameter of the large printing cylinder in the 3-R press is three times the effective diameter of the common lower printing cylinder. It follows that the press frames of the two presses are, therefore, different in size, each being appropriate to the size of the large printing cylinder involved. The base frames also differ in that each is appropriate to supporting not only the feeder frames but the press frames of the press involved.

Two other elements in the structure and operation of the press of the present invention which are important factors in both its flexibility and its high productivity, and which are diagrammatically illustrated in FIGS. 7*a* through 8*d*, are:

1. The effective diameter of each plate cylinder is equal to the effective diameter of the common lower printing cylinder; and the lower printing cylinder and each plate cylinder each have one work area and one gap; and 2. Means are provided to cause a sheet to be fed, selectively, to every revolution, to only one revolution; or to only revolutions of the lower printing cylinder, during each complete revolution of the large printing cylinder.

The effective diameter, and therefore the effective circumference, of the lower printing cylinder determines the length of the work area on the circumference of the lower printing cylinder and this in turn determines the length of the longest image that can be printed, and of the longest sheet that can be handled, by the press. The lower printing cylinder is therefore the basic common element between the 2-R press and the 3-R press. It is because of this that the two presses handle sheets of the same size and the major elements of the various printing modules are the same for both the 2-R and 3-R presses. This is also the basic factor that makes it possible to use the same feeders, conveyor board, sheet detector, feed roll mechanism, stop fingers, etc., as well as most major components of the delivery mechanisms, in both the 2-R press and the 3-R press.

Many prior efforst to find an economically sound solution to the problems of producing equipment to handle a broad range of widely diversified printing functions have failed of practical success because of the failure to recognize this important point.

There are many instances in the prior art where advantages have been recognized in having the cylinders of a printing press be of different diameters, and with different numbers of work areas. Many of these have also recognized that these relationships could also be varied, and, that by doing so, it would then be possible to perform still other printing functions or combinations of functions. What has customarily not been recognized, however, is the advantage that would accrue if these variations were accomplished by keeping the diameter of the smallest cylinder or cylinders constant and varying the diameter of the larger cylinder or cylinders, as opposed to keeping the diameter of a larger cylinder or cylinders fixed and varying the diameter of the smallest cylinder or cylinders. The result of this latter approach is to diminish the practical value of the additional printing functions gained, because then only shorter images may be printed, and shorter sheets handled.

Another advantage that accrues from keeping the effective diameter of the lower printing cylinder the same in both the 2-R and 3-R presses of the present invention flows from the fact that the plate cylinders, (in the plate cylinder modules), have the same effective diameter as the lower printing cylinder; and thus both the plate cylinders themselves and the entire plate cylinder modules may be used on either the 2-R or the 3-R press, with only the mounting brackets and certain interconnecting control arms differing when the plate cylinder modules are used on one or the other of the two presses.

The way in which the press frame structure is constructed, to receive alternate printing modules in four different module mounting positions, and the way in which these printing modules are constructed, so that they may be mounted, either singly or together, in any one or in any number of the module mounting positions and in any required combination of printing modules of different types, is basic to the ability to offer a wide range of press embodiments, all assembled from standardized components, and able to handle either highly specialized, or a widely diversified range of, printing functions and/or combinations of functions.

In addition a variety of coordinated mechanical "back-up" functions are needed to make effective practical use of any one printing module, mounted in any one module mounting position, or of any combinations of printing modules mounted in any or all of the four module mounting positions. Some of these interrelated mechanical "back-up" functions are required in any embodiment of the press and others are required only to utilize fully the more complex press embodments. Some are required in simple form to perform simple coordinating functions in simple embodiments of the press, and in more complex form to perform more complex coordinating functions in the more complex embodiments of the press.

In FIG. 7*a*, extending out from module mounting position I are six AA series diagrams, illustrating diagrammatically six variations of the plate cylinder module, any one of which may be mounted in module mounting position I.

Diagram AA-1 illustrates a plate cylinder module equipped with a simple basic "combined" ink/dampening mechanism for applying a combination of ink and moisture to a lithographic offset plate, mounted on the plate cylinder of the module, through a single form roller. This plate cylinder module is also shown, in a somewhat more detailed diagrammatic form, in FIG. 1.

Diagram AA-2 illustrates a similar plate cylinder module, also equipped with a "combined" ink/dampening system, but with an additional train of ink rollers which includes a second form roller which contacts the plate after it has been contacted by the first form roller. This plate cylinder module is also shown, in somewhat more detailed diagrammatic form, in FIG. 4*a*.

Diagram AA-3 illustrates a similar plate cylinder module but with separate ink and dampening systems, the dampening solution being applied to the plate through a single dampening form roller and the ink being applied through two ink form rollers.

Diagram AA-4 illustrates a similar plate cylinder module with separate ink and dampening systems, the dampening solution being applied to the plate through a single dampening form roller, but with an additional train of ink rollers which includes a third ink form roller which contacts the plate after it has been contacted by the first two ink form rollers. This plate cylinder module is also shown, in somewhat more detailed diagrammatic form in FIGS. 2*a* and 5*a*.

Diagram AA-5 illustrates a similar plate cylinder module, but for use with a dry offset plate, and equipped with a simple basic ink system which applies ink to the surface of the plate through two ink form rollers.

Diagram AA-6 illustrates a similar plate cylinder module for use in dry offset printing but with an additional train of ink rollers which includes a third ink form roller which contacts the plate after it has been contacted by the first two ink form rollers.

The diagrams in the MM-6 thru MM-9*b* series illustrate a dual pressure adjustment mechanism of the press, which allows the distance between the fixed center of the large printing cylinder and the movable center of the lower printing cylinder to be adjusted independently to two different distances, so that one adjustment is effective when the lower printing cylinder makes a revolution in coincidence with one of the work areas of the large printing cylinder and another adjustment is effective when the lower printing cylinder makes its next revolution, in coincidence with the other work area of the large printing cylinder.

Diagrams MM-6 and MM-7, together, illustrate the operation of the mechanism when sheets of a single thickness are being fed to every revolution of the lower printing cylinder, in which case the two adjustments are equal, or vary only by an infinitesimal amount to compensate for small differences in the thicknesses of the surface coverings of the two work areas of the large printing cylinder. Diagram MM-6 illustrates the mechanism as it would be just as the first of two such sheets is about to pass through the bite of the printing couple; and diagram MM-7 illustrates the mechanism as it would be just as the second of the two such sheets is about to pass through the bite of the printing couple.

Diagrams MM-8, MM-9*a* and MM-9*b*, taken together, illustrate the way in which the mechanism compensates when sheets of different thicknesses are fed to alternate successive revolutions of the lower printing cylinder, or when a sheet is fed to the first revolution of the lower printing cylinder but no sheet is fed to the second revolution of the lower printing cylinder.

Diagram MM-8 illustrates the mechanism as it would be just as the first, and thinner, of two sheets is about to pass through the bite of the printing couple on the first revolution of the lower printing cylinder. (If no sheet is to be fed on the second revolution of the lower printing cylinder, the longer adjusting arm in diagram MM-8 would be in the dotted line position.)

Diagram MM-9*a* illustrates the mechanism as it would be just as the second, and thicker, of the two sheets is about to pass though the bite of the printing couple.

Diagram MM-9*b* illustrates the mechanism as it would be when no sheet is fed to the second revolution of the lower printing cylinder and just as the lower printing cylinder begins its second revolution, to roll in contact with a printing surface mounted in a work area on the large printing cylinder.

The diagrams in the MM-1 and MM-2 series illustrate a sheet detecting or "sensing" mechanism. This mechanism in turn controls the action of a cylinder throw-out and latching mechanism, not illustrated, which causes the lower printing cylinder to assume or to maintain a printing or non-printing relationship with respect to the large printing cylinder in accordance with the control signal which it receives from this sensing mechanism, and to then maintain that relationship until it again receives a control signal from this sensing mechansim.

Diagram MM-1 illustrates the situation in which the feeder control has been set to cause a sheet to be fed to every other revolution of the lower printing cylinder. The cam which actuates the sheet detecting mechanism is mounted on the shaft of the large printing cylinder, and, in this case, has a single lobe, so placed that the sheet detector will be actuated to sense for the presence or absence of a sheet at the time in the cycle when a sheet should have reached the stop fingers, on the first revolution of thelower printing cylinder. Since there is no other lobe on the cam, the sheet detector will not be actuated on the next revolution of the lower printing cylinder, to which no sheet is to be fed by the feeder.

Diagram MM-2 illustrates the case in which the feeder control has been set to cause a sheet to be fed to each revolution of the lower printing cylinder. Two lobes, 180° apart, are provided on the actuating cam mounted on the large cylinder shaft, so that the sheet detector will be actuated prior to each revolution of the lower printing cylinder, at the time in the cycle when a sheet should have reached the stop fingers.

Extending out from module mounting position II are ten diagrams illustrating ten printing modules, any one of which may be mounted in module mounting position II.

Six of these illustrate plate cylinder modules AA-1 through AA-6. These are the same as previously described.

Two of the other diagrams are in the BB series, which comprise ink/dampening modules for inking, or inking and dampening, a plate, or plates, in a work area, or areas, on the large printing cylinder.

Diagram BB-3 illustrates an ink/dampening module, but with only a simple ink system, with two ink form rollers for applying ink to plates or other printing surfaces in work areas on the large printing cylinder.

Diagram BB-4 illustrates a similar ink/dampening module, with only an ink system, but having an additional train of ink rollers including a third ink form roller which contacts the plate, mounted in a work area on the large printing cylinder, after it has been contacted by the first two ink form rollers.

The other two diagrams are in the CC series, which comprise separate dampening modules for dampening a plate, or plates, in a work area, or areas, on the large printing cylinder.

Diagram CC-1 illustrates a separate dampening module with a simple dampening system with a single dampening form roller for applying dampening solution to a plate mounted in a work area on the large printing cylinder.

Diagram CC-2 illustrates a similar separate dampening module but with an additional train of dampening rollers, including a second dampening form roller which contacts the plate after it has been contacted by the first dampening form roller; and with the number of bites between dampening rollers which the dampenig solution must pass through to reach the plate being greater for solution applied to the plate by the second form roller than for solution applied to the plate by the first form roller.

The diagrams in the KK series illustrate various mechanisms available to hold selected plate cylinders out of contact with the printing surfaces in selected work areas on the large printing cylinder.

Diagram KK-1 illustrates a simple handle, mounted on an eccentric stub at the end of the shaft of a plate cylinder. This handle is turned in a counter-clockwise direction to lift the plate cylinder out of contact with printing surfaces on the large printing cylinder, and latches in this position. It may then be turned in a clockwise direction to again bring the plate cylinder into contact with the printing surfaces on the large printing cylinder, and it then latches in this position. If no other mechanism is used in combination with this manual control, the plate cylinder involved will roll in contact with the printing surface in each work area on the large printing cylinder whenever the handle is latched in position to hold the plate cylinder in contact with the printing surfaces on the large printing cylinder.

Diagram KK-2 illustrates an automatic mechanism which includes a control cam mounted on the shaft of the large printing cylinder and a control arm, with a cam follower in alignment with the cam, fastened to the eccentric stub at the end of a plate cylinder shaft, and which causes the plate cylinder to be automatically lifted out of contact with the printing surface in one work area on the large printing cylinder and automatically returned to roll in contact with the printing surface in the other work area on the large printing cylinder. This mechanism may be used, or not used, selectively; and, when made operative, functions as just described; and, when made inoperative, the plate cylinder rolls in contact with the printing surfaces in each work area on the large printing cylinder.

This mechansim may be used in combination with the mechanism illustrated in diagram KK-1, in which case the plate cylinder may be manually latched in a position in which it is out of contact with all printing surfaces on the large printing cylinder, or it may be returned to the control of the automatic mechanism of diagram KK-2.

Either one, two, three or four plate cylinder modules may be mounted in the module mounting positions on the press frames, and the control arm on each plate cylinder shaft may be made operative or inoperative with respect to a single control cam mounted on the shaft of the large printing cylinder. Allsuch plate cylinders, on which the control arm is made operative, will then be lifted out of contact with the printing surface in the same work area on the large printing cylinder and will roll in contact with the printing surface in the other work area on the large printing cylinder; and any such plate cylinders on which the control arm is made inoperative, will roll in contact with the printing surfaces in both work areas on the large printing cylinder.

Diagram KK-3 illustrates a similar automatic mechanism in which there are two such control cams mounted on the shaft of the large printing cylinder, and displaced laterally from each other, so that one control cam lifts the plate cylinder or cylinders, whose control arms are in the same lateral plane with it, out of contact with the printing surface in work area VI on the large printing cylinder and returns them to roll in contact with the printing surface in work area V; whereas the plate cylinder or cylinders whose control arms are in the same lateral plane with the other control cam will be lifted out of contact with the printing surface in work area V on the large printing cylinder and returned to roll in contact with the printing surface in work area VI. Any plate cylinder whose control arm is made inoperative, as previously described, will roll in contact with the printing surfaces in both work areas on the large printing cylinder.

Figure 7B:
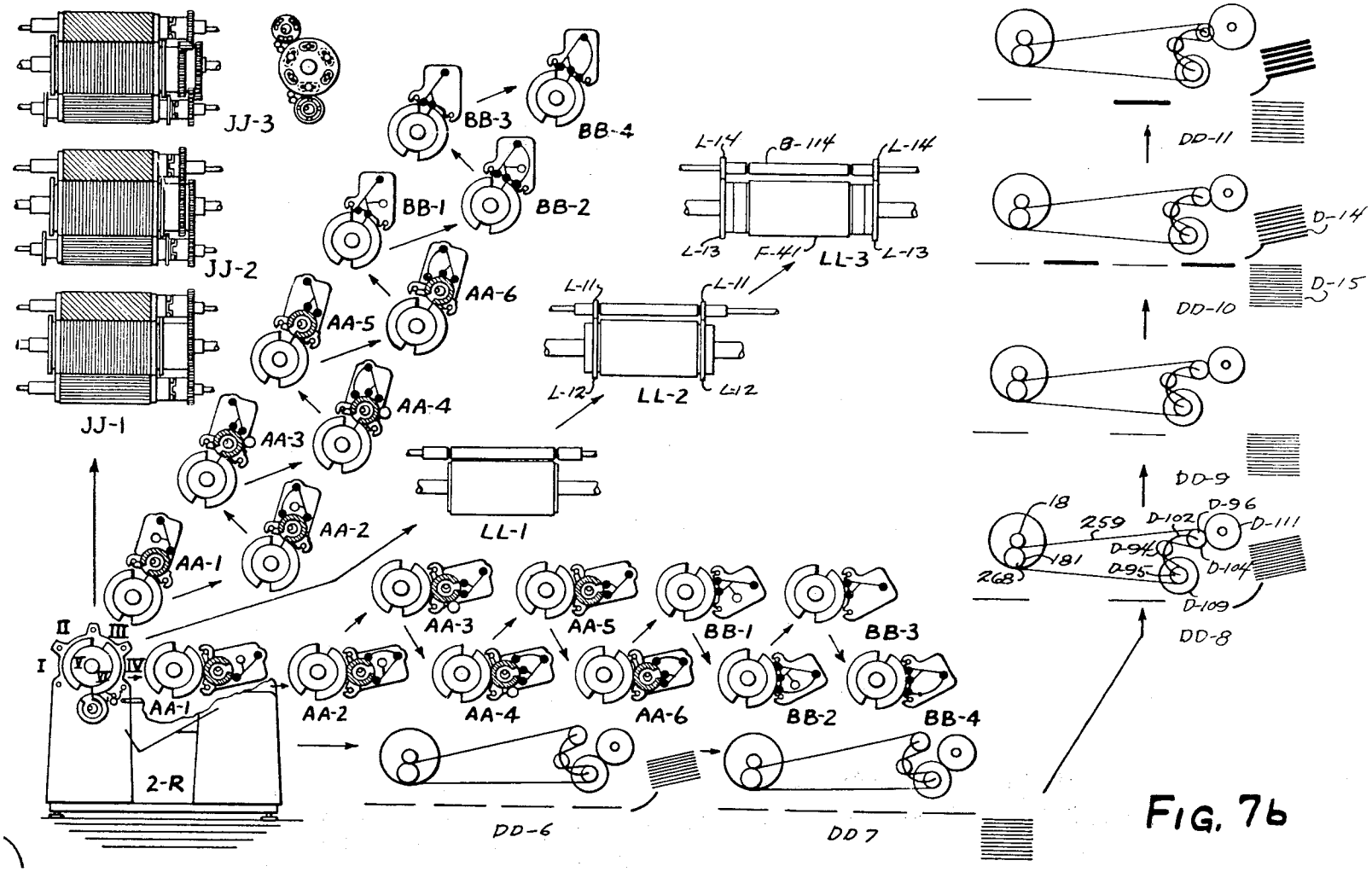
Figure 7A:
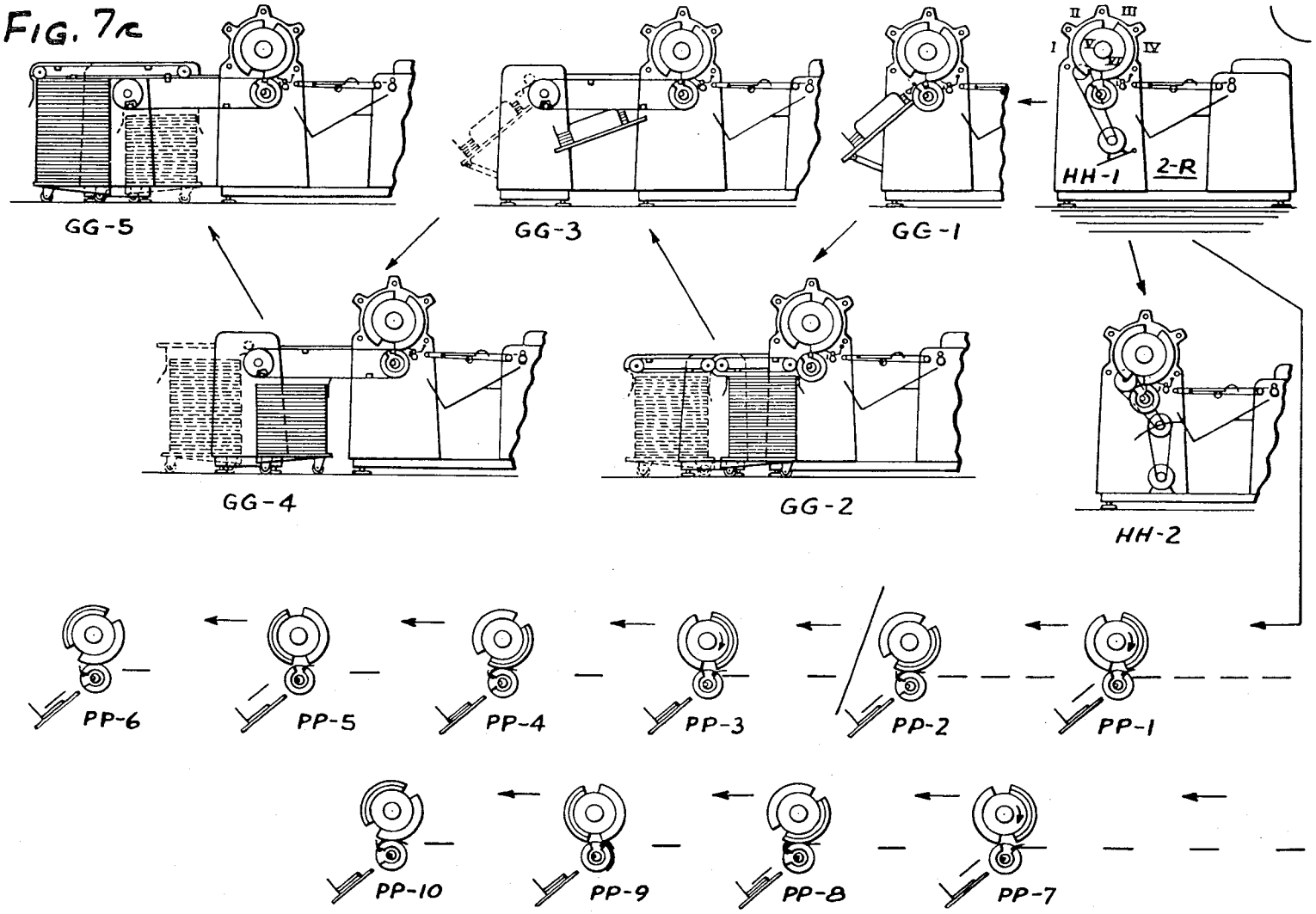

Referring to FIG. 7*b*, the JJ series of diagrams illustrates alternatives provided with respect to the train of gears that drives the printing cylinders of the press.

Diagram JJ-1 illustrates the simplest gear train, in which the gears on the two cylinders of the printing couple, and on any plate cylinders which may be used, are all in the same lateral plane and the drive is transmitted directly from one to the other. With this arrangement, if there is a printing plate mounted in one of the work areas on the large printing cylinder, vertical adjustments of the image from that plate may be made by loosening the fasteners for the segment on which the plate is mounted and moving the segment the required distacne around the circumference of the large printing cylinder, and then locking it in this position. Alternatively, the large printing cylinder may be disengaged from its associated gear and turned about its axis to accomplish the required adjustment, after which the large printing cylinder is again made fast to the gear. Vertical adjustments of the image from a plate carried by a plate cylinder are made by unlocking the plate cylinder from its associated gear, rotating the cylinder around its axis the required amount and then relocking it to the gear. This is a satisfactory procedure in instances where a single plate cylinder is being used. However, if more than a single plate cylinder is being used, to print a multicolor image, the individual plates carrying the different color images must first be registered with each other, and if it is then necessary to move the entire multicolor image vertically on the printed sheet, each of the plate cylinders, each carrying one of the color images, must be adjusted independently to the new vertical position, and the plates again reregistered with respect to each other.

FIG. JJ-2 illustrates a gear train arrangement for the printing cylinders in which the gear for the lower printing cylinder is in the same lateral plane as, and in mesh with, one gear carried by the large printing cylinder, and in which there is a second gear carried by the large printing cylinder, in another lateral plane spaced inwardly from the other, and the gear or gears for any plate cylinder or cylinders being used are in the same lateral plane as, and in mesh with, this second gear carried by the large printing cylinder.

With this arrangement, if the image from a plate mounted in a work area on the large printing cylinder must be moved vertically on the printed sheet, the segment which carries the plate on the large printing cylinder may be moved to make the vertical image adjustment, as previously described. Individual images, making up a multicolor image from plates on two or more plate cylinders, are brought into vertical registration with each other by making adjustments as previously explained in connection with diagram JJ-1. If it is then necessary to adjust the vertical position of the entire multicolor image with respect to its position on the printed page, the inner gear on the large printing cylinder may be disengaged, leaving the outer gear locked to the large printing cylinder. The large and lower printing cylinders are then rotated together about their axes to accomplish the required vertical adjustment. By holding one of the plate cylinders from turning, all of the plate cylinders, whose gears are all in mesh with the inner gear on the large printing cylinder, are similarly held from turning and thus the vertical position of the entire multicolor image on the printed sheet is adjusted without disturbing the registration, one to the other, of the different color images which make up the multicolor image. The inner gear is then, once again, locked to the large printing cylinder.

The outer gear on the large printing cylinder may also be disengaged from the cylinder while the inner gear remains locked to the large printing cylinder. When this is done the vertical positions of all images from all plates, whether mounted on plate cylinders or on segments in work areas on the large cylinder, may be adjusted simultaneously, and without disturbing the interrelationship between any of them, by holding either the large printing cylinder, or any plate cylinder, from turning, while the lower printing cylinder (and with it the outer gear on the large printing cylinder) is rotated to accomplish the desired vertical adjustment. The outer gear is then, once again, locked to the large printing cylinder.

Diagram JJ-3 illustrates another gear train for driving the cylinders of the printing couple and any associated plate cylinders. With this gear train, vertical image adjustments are made exactly as described in connection with diagram JJ-2, but the drive between the gear for the lower printing cylinder and the outermost gear of the large printing cylinder is transmitted through two smaller intermediate gears, and the drive from the inner gear on the large printing cylinder to any plate cylinder gear is transmitted through two smaller intermediate gears. The purpose being to transmit the drive through the printing couple, and to any plate cylinders which are being used, without having the number of teeth in any gear in the train equally divisible into the number of teeth in any adjacent gear with which it is in mesh, thus preventing a "pattern" of wear from developing between two adjacent gears which might lead to the production of a corresponding "pattern" of streaks in the images printed.

The end view of diagram JJ-3 shows diagrammatically the means by which a plate cylinder and its gear are affixed together, with provision for unlocking them, rotating them in relation to each other, about their axis, and then locking them in the new position; and also shows diagrammatically the means by which the same is accomplished, separately and independently, as between the large printing cylinder and each of the two gears mounted to turn therewith.

Extending out from module mounting position III are diagrams of ten printing modules, any one of which may be mounted in position III.

There are six AA series diagrams illustrating six variations of the plate cylinder module, previously described, any one of which may be mounted in position III.

There are also four BB series diagrams illustrating four variations of the ink/dampening module, any one of which may be mounted in position III. Diagrams BB-3 and BB-4 have been described previously.

Diagram BB-1 illustrates a combined ink/dampening module with a simple "combined" ink/dampening system and with two form rollers for applying a combination of ink and dampening solution to a lithographic plate mounted in a work area on the large printing cylinder.

Diagram BB-2 illustrates a similar combined ink-/dampening module but with an additional train of ink rollers including a third form roller which contacts the lithographic plate, mounted in a work area on the large printing cylinder, after it has been contacted by the first two form rollers. This ink/dampening module is also shown, in somewhat more detailed diagrammatic form, in FIG. 2*a*.

The LL series diagrams illustrate means provided for selectively controlling which printing surfaces, mounted in work areas on the large printing cylinder, are contacted by form rollers in ink/dampening modules, or in dampening modules, which may be mounted at any of the four module mounting positions.

Diagram LL-1 illustrates the case in which there are no lifter cams mounted at the ends of a segment mounted in a work area on the large printing cylinder and no cam follower discs mounted at the ends of the form rollers of an ink/dampening module, or dampening module, mounted in one of the module mounting positions. Such a form roller would roll in contact with the printing surface carried by any segment on the large printing cylinder, whether or not equipped with lifter cams. The printing surface carried on such a segment would be contacted by all form rollers in all ink/dampening, or dampening, modules in any of the module mounting positions, whether or not equipped with cam follower discs.

Diagram LL-2 illustrates a segment mounted in a work area on the large printing cylinder and having form roll lifter cams affixed to it at both ends. It also illustrates a form roller, with cam follower discs mounted at both ends, and in lateral alignment with the form roll lifter cams mounted at both ends of the segment. Such a form roller, so equipped, would be lifted out of contact with the printing surface carried by any segment mounted in a work area on the large printing cylinder and carrying such form roll lifter cams in the same lateral planes. However, this form roller would roll in contact with the printing surface on any segment carried by the large printing cylinder which was not fitted with form roll lifter cams, or that had form roll lifter cams that were not in the same lateral planes.

Diagram LL-3 illustrates a similar segment carried in a work area on the large printing cylinder and also equipped with form roll lifter cams at both ends. These form roll lifter cams are in different lateral planes from the form roll lifter cams affixed to the segment of diagram LL-2. Diagram LL-3 also illustrates a form roller with cam follower discs at both ends, and these cam follower discs are in the same lateral planes as the form roll lifter cams at the ends of the segment of this diagram.

Any form rollers equipped with cam follower discs in the lateral planes shown in diagram LL-3 would be lifted out of contact with the printing surfaces on segments carrying form roll lifter cams at their ends in the same lateral planes as shown in diagram LL-3; whereas such form rollers would roll in contact with printing surfaces on segments carrying no form roll lifter cams, as in diagram LL-1, or carrying form roll lifter cams in different planes, as in diagram LL-2. The form roll lifter cams and the cam follower discs of diagram LL-3 are the same as the same parts illustrated in diagram LL-2, but the cam follower discs have been turned end for end and the form roll lifter cams have been attached to opposite ends of the segment, and a collar of equal width added as a spacer, in diagram LL-3, to place them in different lateral planes as between the two diagrams. If it is desired to place form roll lifter cams in both lateral planes at both ends of a single segment, the spacer collars of diagram LL-3 may be replaced with a second set of lifter cams placed as shown in diagram LL-2. In diagram LL-1 both the cam follower discs and the form roll lifter cams have simply been removed.

Thus, by equipping the form rollers of any ink/dampening module, or of any dampening module, mounted in any of the four module mounting positions, with the proper cam follower discs, and by equipping the segments mounted in work areas on the large printing cylinder with the proper form roll lifter cams, the form rollers of this module may be caused to roll in contact with any selected printing surface, or surfaces, mounted in a work area, or areas on the large printing cylinder, while being lifted out of contact with any printing surface, or surfaces, mounted in another work area, or areas, on the large printing cylinder. The form rollers of other such modules may be similarly, but independently, controlled.

Extending out from module mounting position IV are diagrams of ten printing modules, any one of which may be mounted in position IV. There are six AA series diagrams illustrating six variations of the plate cylinder modules, previously described, any one of which may be mounted in position IV.

There are also four BB series diagrams illustrating four variations of the ink/dampening module, previously described, any one of which may be mounted in position IV.

The DD-6 thru DD-11 series diagrams illustrate diagrammatically various adjustments of the feeder control mechanism, including means by which the cam shaft of the feeder is driven and means by which the speed at which it is driven may be controlled in relation to the revolutions of the cylinders of the printing couple.

The separating mechanisms for both feeders available with the 2-R press are each actuated once for each revolution of the feeder cam shaft. When both feeders are installed together, they operate alternately, with both operating once for each revolution of the feeder cam shaft.

Diagram DD-6 illustrates the case in which a sheet from the "bottom" feeder is fed to every revolution of the lower printing cylinder. There is only a "bottom" feeder (or paper is placed in the "bottom" feeder only) and the feeder control mechanism is set to cause the feeder cam shaft to make one revolution for each revolution of the lower printing cylinder, thereby causing a sheet to be separated from the bottom of the stack, and conveyed to the stop fingers adjacent the bite of the printing couple, once for each revolution of the lower printing cylinder, and in time with the action of the stop fingers. Since no paper is placed in the "pile" feeder (if there is one), no sheets are fed from the "pile" feeder, even though it too, (if there is one) operates to feed a sheet on every revolution of the feeder cam shaft.

Diagram DD-7 illustrates the case in which a sheet from the "pile" feeder is fed to every revolution of the lower printing cylinder. There is only a "pile" feeder (or paper is placed in the "pile" feeder only), and the control mechanism is set to cause the cam shaft to make one revolution for each revolution of the lower printing cylinder, thereby causing a sheet to be separated from the top of the pile and conveyed to the stop fingers adjacent the bite of the printing couple, in proper timed relationship with the stop fingers, once for every revolution of the lower printing cylinder. Since no sheets are loaded into the "bottom" feeder, (if there is one), no sheets are fed from the "bottom" feeder, even though the separating mechanism of the "bottom" feeder (if there is one) also acts on each revolution of the feeder cam shaft.

Diagram DD-8 illustrates the case in which a sheet from the "bottom" feeder is fed to every other revolution of the lower printing cylinder. There is only a "bottom" feeder (or paper is placed in the "bottom" feeder only) and the control mechanism is set so that the feeder cam shaft is caused to make one complete revolution for every two revolutions of the lower printing cylinder, and so timed that sheets from the "bottom" feeder reach the stop fingers at the proper time during the first, third, fifth, etc. revolutions of the lower printing cylinder. Since no paper has been placed in the "pile" feeder (if there is one), no sheets are fed to the second, fourth, sixth, etc. revolutions of the lower printing cylinder.

Diagram DD-9 illustrates the case in which a sheet from the "pile" feeder is fed to every other revolution of the lower printing cylinder. There is only a "pile" feeder (or paper is placed in the "pile" feeder only), and the control mechanism is set so that the feeder cam shaft is caused to make one complete revolution for every two revolutions of the lower printing cylinder, and so timed that sheets from the "pile" feeder reach the stop fingers at the proer time during the first, third, fifth, etc. revolutions of the lower printing cylinder. Since no paper has been placed in the "bottom" feeder (if there is one), no sheets are fed to the second, fourth, sixth, etc. revolutions of the lower printing cylinder.

Diagram DD-10 illustrates the case in which sheets from the two feeders are fed alternately with one sheet being fed to each revolution of the lower printing cylinder. In this case sheets of one color and weight are placed in the "pile" feeder and sheets of another color and/or weight (in this case shown as being thicker) are placed in the "bottom" feeder. The control mechanism is left as described in connection with diagram DD-9 but now since paper has been placed in both feeders, a sheet from the "pile" feeder is fed to the first revolution of the lower printing cylinder, a sheet from the "bottom" feeder is fed to the second revolution of the lower printing cylinder, a sheet from the "pile" feeder to the third revolution, a sheet from the "bottom" feeder to the fourth revolution etc., etc. with each sheet reaching the stop fingers at the proper time during each revolution of the lower printing cylinder.

Alternatively, the control mechanism may be set as described in connection with diagram DD-8, in which case sheets from the "bottom" feeder are fed to odd number revolutions of the lower printing cylinder and sheets from the "pile" feeder to even number revolutions of the lower printing cylinder.

Diagram DD-11 illustrates the case in which sheets from the two feeders are fed alternately with one sheet being fed to every other revolution of the lower printing cylinder. As illustrated in the diagram, the thinner sheets are placed in the "pile" feeder and the thicker sheets are placed in the "bottom" feeder and sheets from the pile feeder are fed to the first, fifth, ninth, thirteenth, etc. revolutions, and sheets from the "bottom" feeder to the third, seventh, eleventh, fifteenth, etc. revolutions, of the lower printing cylinder. No sheets are fed to the second, fourth, sixth, eigth, tenth, etc. revolutions of the lower printing cylinder. In this case the control mechanism causes the feeder cam shaft to make one revolution for every four revolutions of the lower printing cylinder. In this case, too, it is possible to reverse the sequence of feed as between sheets from the "pile" feeder and the "bottom" feeder.

Referring now to FIG. 7*c* the HH series of diagrams illustrate alternatives that are available for the drive of the press.

Diagram HH-1 illustrates diagramatically a motor for driving the press, with the drive transmitted through a V-belt from a variable speed pulley on the motor shaft to a fixed diameter pulley on the main drive shaft of the press. The drive motor is mounted on a base platform, which is supported by, and hinged along one of its sides to, a spreader bar extending between the press frames. By raising or lowering the motor about this hinge the center distance between the motor shaft and the main drive shaft of the press may be decreased or increased, causing the effective diameter of the varible speed pulley on the motor shaft to be increased or decreased, thereby varying the speed at which the main drive shaft of the press is driven. If a variable speed pulley of conventional design is used, with a ratio of maximum to minimum diameter of two to one, the speed of the press may thus be varied through a range, from maximum to minimum, of two to one.

In the more complex embodiments of the press, in which sheets may be fed selectively, either to every revolution of the lower printing cylinder or to every other revolution of the lower printing cylinder, or, in some cases, to every third revolution of the lower printing cylinder, a wider range of press speed adjustment is highly desirable. Diagram HH-2 illustrates a drive for the press in which the drive motor is fixed to the base of the press and the drive is transmitted, first from a variable speed pulley on the motor shaft to a fixed diameter pulley on an intermediate counter-shaft by means of a V-belt, and then from another variable speed pulley mounted on the counter-shaft to a fixed diameter pulley on the main drive shaft of the press, again by means of a V-belt. Means are provided to swing the counter-shaft through an arc such that at one end of its arc of movement the counter-shaft is at its closest point to both the motor shaft and the main drive shaft of the press. At this point both variable speed pulleys are at their maximum effective diameters and the main drive shaft of the press is driven at its maximum speed. As the counter-shaft is swung to the other end of its arc of movement the distances between the counter-shaft and the motor shaft, and between the counter-shaft and the main drive shaft, both increase to their maximum value, and the effective diameters of both of the variable speed pulleys are reduced to their minimum values. At this point the main drive shaft of the press is driven at its slowest speed. If the ratio of the maximum effective diameter of each of the variable speed pulleys to its minimum effective diameter is two to one, the speed of the press may thus be adjusted through a range of four to one.

The GG series of diagrams illustrates various alternative arrangements for stripping and delivering sheets after they have completed their passage (or passages) through the bite of the printing couple.

Diagram GG-1 illustrates the press equipped with a "stripper finger and delivery roller" stripping and ejection mechanism and a tray type receiving hopper for the sheets. Sheets are delivered into the delivery tray with their original top surface face-up. The side and end guides of the delivery tray may be in adjustable fixed positions, or may be caused to reciprocate to jog the sheets and align their edges as they are delivered. This type of delivery arrangement is intended for use only in cases where the lower printing cylinder will always be used as a platen and the image, or images, will always be printed on the upper surface of the sheets as they pass through the bite of the printing couple, where the coverage and format of the material to be printed is such that the work may be satisfactorily stripped and delivered by stripper fingers and delivery rollers, and where the "length of run" requirements of the work to be done are such that the relatively limited capacity of a delivery tray is satisfactory. This type of delivery may be used satisfactorily irrespective of whether the sheets are carried through the bite of the printing couple once, or more than once, so long as the other conditions outlined above are present.

Diagram GG-2 illustrates an alternate delivery arrangement in which there is first a separate chain delivery mechanism consisting of a pair of chains, each of which passes around an inner and outer delivery sprocket, and which carry between them a number of delivery gripper bars. The number of such delivery gripper bars is equal to a whole multiple of the number of work areas on the large printing cylinder. The delivery gripper bars shown in this and in all other diagrams in the GG series, are spaced apart by a distance equal to the effectice circumference of the lower printing cylinder. After the cylinder grippers, mounted in the lower printing cylinder, have carried the leading edge of a sheet through the bite of the printing couple once, or more than once, they then carry the leading edge of the sheet to the line of tangency between the lower cylinder and the inner delivery sprockets. At this point one of the delivery gripper bars, carried by the delivery chains, is in coincidence with the cylinder grippers, and the sheet is transferred from the cylinder grippers to the delivery grippers; the interaction of both sets of grippers being controlled by cams. The leading edge of the sheet is then pulled by the chain carried delivery grippers until the sheet is in position just above the top of the delivery pile in the full line position as seen in diagram GG-2, at which point the leading edge of the sheet is released by the delivery grippers and the sheet falls onto the top of the pile, with its original top surface face-up, and its edges are jogged to align it with the other sheets in the pile. As sheets accummulate on the delivery pile the platform on which the sheets rest descends, at a pace regulated to match the accumulating thickness of the sheets delivered, until the wheels of the platform rest on the floor, at which point a sensing device stops the feeding of sheets. The pile is then removed, another platform inserted and raised into position and the feeding again is set in motion. This type of delivery may be used whether the sheets are carried through the bite of the printing couple once or more than once.

When the sheets are carried through the bite of the printing couple only once the cylinder grippers are set to open to release a sheet as they reach the line of tangency between the lower printing cylinder and the inner delivery sprocket on each revolution of the lower printing cylinder. Similarly, the grippers of each of the chain carried delivery gripper bars are caused to close to grip the leading edge of a sheet as each of the delivery gripper bars reaches this line of tangency in coincidence with the cylinder grippers. This action takes place on each revolution of the lower printing cylinder, each time the cylinder grippers come into coincidence with a chain carried delivery gripper bar at this line of tangency, irrespective of whether the feeder has been set to feed sheets to every revolution of the lower printing cylinder, or only to selected revolutions of the lower printing cylinder. If a sheet is present when the cylinder grippers and the chain carried delivery grippers come together at this line of tangency, the sheet is transferred from the cylinder grippers to the chain carried delivery grippers. If no sheet is present both the cylinder grippers and the chain carried delivery grippers nevertheless go through the motions of opening and closing, as though a sheet were to be transferred, but there simply is no sheet present. Similarly, each of the chain carried delivery grippers is caused to open to release a sheet each time it reaches the point where a sheet, carried by such a delivery gripper bar, would be in position to be released onto the top of the delivery pile, and if a sheet is present it is so released and if none is present the grippers open as if to release a sheet, in any case.

When the mechanism controlling the action of the cylinder grippers has been set to cause them to carry a sheet through the bite of the printing couple more than once the cylinder grippers will first remain closed as they pass this line of tangency, to carry the sheet through the bite of the printing couple the required number of times, and only then open to release the sheet as they next reach this line of tangency. Since the number of delivery gripper bars carried by the delivery chains is equal to the number of work areas on the large printing cylinder, or a whole multiple thereof, each of the chain carried delivery gripper bars will always come into coincidence with the cylinder grippers as the lower printing cylinder rolls in contact with the same work area on the large printing cylinder. Thus, the chain carried delivery gripper bar which comes into coincidence with the cylinder grippers as the sheet passes through the bite of the printing couple for the last time will operate, in conjunction with the cylinder grippers, to transfer the sheet, and strip and deliver it, as explained above. Other delivery grippers, which come into coincidence with the cylinder grippers on revolutions of the lower printing cylinder on which the cylinder grippers remain closed and retain their grip on the leading edge of the sheet, are locked in an open position so that they will not close to seize the leading edge of the sheet as they pass this line of tangency.

An additional "extension" chain delivery mechanism is also illustrated in diagram GG-2. This is for the purpose of delivering sheets with their original bottom surface face-up. The "extension" chain delivery mechanism may be furnished or not depending upon the requirements of the application. The "extension" chain delivery mechanism consists of another pair of delivery chains, each of which passes around an inner and outer sprocket, and which carry between them two or more "extension" delivery gripper bars. The inner sprockets of the "extension" chain delivery are each in rotational tangential relationship to the corresponding outer sprockets of the basic separate chain delivery mechanism. The sprockets of the basic separate chain delivery mechanism turn in a clockwise direction as seen in diagram GG-2 while the sprockets of the "extension" chain delivery turn in a counterclockwise direction.

Each of the delivery gripper bars of the basic separate chain delivery mechanism comes into coincidence with one of the "extension" delivery gripper bars at the line of tangency between the two delivery mechanisms. When the "extension" delivery is being used the grippers of the basic separate chain delivery do not release the sheet until they have carried the leading edge of the sheet to this line of tangency between the two delivery mechanisms and the two grippers transfer the leading edge of a sheet from the basic delivery grippers to the "extension" delivery grippers at this point. The "extension" grippers then pull the sheet, by its leading edge, Along the upper path of the chains of the "extension" delivery, around the shaft of the outer sprockets of the "extension" delivery, and back towards the press, until the sheet is in position above the pile of the "extension" delivery (shown in dotted lines) at which point the sheet is released and drops onto the top of the pile with its original bottom surface face-up.

The delivery mechanism shown in diagram GG-2 may be used when the ink coverage is heavier than that which can be satisfactorily stripped and delivered by the mechanism of diagram GG-1, or when the printing must bleed off the edges of the sheets (leaving no unprinted margins in which the delivery rollers of diagram GG-1 may track) or when both sides of the sheets are being printed simultaneously (in which case the stripping and delivery mechanism of diagram GG-1 would be inadequate) or in case the greater capacity of the delivery pile is required (in contrast to the capacity of the delivery tray of diagram GG-1) or in case the application requires that the sheets be delivered with their original bottom surface face-up, or selectively with either surface face-up.

Diagram GG-3 illustrates another alternative delivery arrangement in which a chain delivery mechanism is used. However, in this case the inner sprockets for the delivery chains are mounted at the ends of the lower printing cylinder and the delivery chains and the delivery gripper bars carried by the delivery chains encircle the shaft of the lower printing cylinder. The number of delivery gripper bars carried by the encircling delivery chains is equal to a whole multiple of the number of work areas on the large printing cylinder.

When the functions for which the press is to be used are such that sheets will only be carried through the bite of the printing couple one time, then no cylinder grippers need be used and the chain carried, encircling gripper bars will perform the dual function of gripping the leading edge of the sheets, after each sheet has been advanced by the stop finger and feed roll mechanism into register with the cylinder stops, and pulling the leading edge of the sheets to and through the bite of the printing couple; and, as the grippers move away from the bite of the printing couple they will retain their grip on the leading edge of the sheets and strip and deliver the sheets by pulling them away from any surface on the periphery of either of the cylinders of the printing couple to which it may tend to adhere. If the sheets have been printed on their original bottom surfaces and if it is desired to deliver the sheets with that surface face-up, the grippers may be set to retain their grip on the leading edge of the sheets, until the sheets have been pulled around the shaft of the outermost delivery sprockets and are being pulled back toward the press with their original bottom surfaces face-up, and to then release the sheets to drop into a delivery tray, such as that shown in the full line position in diagram GG-3. Alternatively, the leading edge of the sheets may be released just as each delivery gripper bar starts around the outermost delivery sprockets, in which case the sheets will be delivered into a delivery tray mounted in the dotted line position shown in diagram GG-3, and the sheets will be delivered with their original top surfaces face-up. Thus, whether the sheets have been printed on both sides simultaneously, or only on the top, or only on the bottom, they may be delivered with their printed surface face-up, or with either of their printed surfaces face-up if both have been printed.

When only the encircling, chain carried gripper bars are used; and there are no cylinder grippers, then, irrespective of whether or not the feeder control is set to feed sheets to every revolution of the lower printing cylinder, the grippers of each gripper bar carried by the encircling chains are caused to open and close to receive a sheet each time the gripper bar passes the sheet receiving position, and to open to release a sheet each time the gripper bar passes the selected sheet delivery position.

When a press equipped with the delivery mechanism of diagram GG-3 is to be used to perform functions which require that sheets may be carried through the bite of the printing couple selectively, once or more than once, then cylinder grippers are used in combination with the chain carried encircling grippers. In this case sheets are transferred from the cylinder grippers to the chain carried grippers as the cylinder grippers pass through an arc of rotation of the lower printing cylinder, between the point at which sheets which have been advanced from the stop finger and feed roll mechanism are received against the cylinder stops, and the line of tangency between the lower printing cylinder and the large printing cylinder.

Sheets that are to pass through the bite of the printing couple only once have their leading edges gripped simultaneously by the cylinder grippers and the chain carried encircling grippers, as the sheets are received against the cylinder stops from the stop finger/feed roll mechanism. The cylinder grippers then open and release the leading edge of the sheet as the point of tangency between the lower and the large printing cylinders is passed, whereas the chain carried encircling grippers retain their grip on the leading edge of the sheet and strip and deliver it as described above.

When sheets are carried through the bite of the printing couple more than once, the grippers of the chain carried encircling gripper bar which is in coincidence with the cylinder grippers at the time the leading edge of a sheet is received against the cylinder stops are locked in an open position, and only the cylinder grippers close and grip the leading edge of the sheet. The cylinder grippers then retain their grip on the leading edge of the sheet until they pass the bite of the printing couple for the last time. The grippers of any of the other chain carried encircling gripper bars, that come into coincidence with the cylinder grippers on any revolution of the lower printing cylinder before the revolution on which the cylinder grippers release the sheet, are also locked in an open position and do not close to grip the leading edge of the sheet. The grippers of the chain carried encircling gripper bar which comes into coincidence with the cylinder grippers on the revolution of the lower printing cylinder on which the leading edge of the sheet passes through the bite of the printing couple for the last time close, and grip the leading edge of the sheet as the cylinder grippers pass through the above-described arc of rotation of the lower printing cylinder. The cylinder grippers then open to release the leading edge of the sheet as they pass the bite of the printing couple, after having carried the leading edge through the bite for the last time. The timing is such that the chain carried encircling grippers have gripped the leading edge of the sheet prior to the release of the sheet by the cylinder grippers and the action of transferring the sheet will thus be completed as the leading edge of the sheet passes through the bite of the printing couple for the last time. As the chain carried encircling grippers move away from the bite of the printing couple, they strip and deliver the sheet as previously described.

Diagram GG-4 illustrates the same arrangement of chain carried encircling grippers, either alone or in combination with cylinder grippers, illustrated and described in diagram GG-3. However, in diagram GG-4 a receding pile delivery, with its greater capacity, is provided instead of the delivery tray illustrated in diagram GG-3. In the delivery mechanism illustrated diagrammatically in Diagram GG-4, the descending support for the delivery pile platform is carried by the frames of the delivery mechanism between the full line and the dotted line positions of the delivery piles, with supporting arms extending in both directions. The delivery pile platform may be placed in the full line position, as shown in diagram GG-4, to receive sheets with their original bottom surface delivered face-up, or it may be placed in the dotted line position, as shown in diagram GG-4, to receive sheets with their original top surface delivered face-up.

With the delivery mechanisms of diagrams GG-3 or GG-4, sheets which are delivered with their original bottom surface face-up are pulled by their leading edges by the encircling chain carried delivery grippers until they are in proper position to simply drop onto the top of the sheets previously delivered, when released by the delivery grippers. In the process they are carried around the shaft of the outermost sprockets of the delivery mechanism, and turned over. It is possible to carry much more rigid sheets through this path than can be carried around the "S" curve through which sheets must pass in the delivery of diagram GG-2.

With the delivery mechanisms of diagrams GG-3, or GG-4, sheets which are delivered with their original top surface face-up are not pulled by their leading edges until they are in position to simply drop onto the top of the previously delivered sheets when released, but are released as their leading edges approach the delivery hoppers (which are in the dotted line positions in diagram GG-3 and GG-4) and the sheets must have sufficient rigidity to then be pushed or projected into the delivery hopper. While the stripping of the sheets, from the peripheral surfaces of either, or both, of the cylinders of the printing couple has been completed prior to the time that the leading edge of the sheet is released for delivery out into the receiving hopper, and while the sheets are "cupped" to give them added rigidity as they are thus delivered, sheets of a certain degree of rigidity are required in order to successfully deliver them in this manner, and "cupping" wheels must track over some areas of the sheets.

The delivery mechanism illustrated in diagram GG-5 includes the encircling, chain carried delivery gripper mechanism illustrated and described in diagram GG-4, which, as previously described, may be used either alone or in combination with cylinder grippers, and in addition there is an "extension" chain delivery mechanism.

The "extension" chain delivery mechanism consists of a pair of "extension" delivery chains running over inner and outer "extension" delivery sprockets and carrying between them a number of "extension" delivery gripper bars, preferably equal to the number of gripper bars carried by the encircling delivery chains. The sprockets of the encircling chain delivery mechanism turn in a counterclockwise direction and the sprockets of the "extension" chain delivery mechanism turn in a clockwise direction, as seen in diagram GG-5. The inner sprockets of the "extension" chain delivery mechanism are closer to the cylinders of the printing couple than the outer delivery sprockets of the encircling gripper mechanism and the lower horizontal path of travel of the "extension" delivery chains is parallel to and just above the upper horizontal path of travel of the encircling delivery chains. The gripper bars carried by the "extension" delivery chains are positioned so that they each come into coincidence with a gripper bar carried by the encircling gripper chains at the point of tangency between the inner "extension" delivery sprockets and the upper horizontal path of travel of the encircling chains. Thus each gripper bar of the "extension" chain delivery mechanism moves in coincidence with a gripper bar of the encircling chain delivery mechanism, in a horizontal path, from the point of tangency of the inner sprockets of the "extension" chain delivery, to the point of tangency of the outer sprockets of the encircling chain delivery mechanism, with this horizontal path.

During the time that the two gripper bars move together along this horizontal path a sheet may be transferred from the chain carried encircling gripper bar to the chain carried "extension" gripper bar, and the leading edge of the sheet then continues to be pulled, in a straight line, until the sheet is in position to be dropped onto the top of the previously delivered sheets in the delivery pile, in the full line position of diagram GG-5, at which point the sheet is released by the gripper bar of the "extension" chain delivery and falls on top of the pile with its original top surface face-up.

Alternatively, the grippers of the "extension" delivery may be locked in an open position, and the chain carried encircling grippers caused to retain their grip on the sheet until it has been turned over and is pulled by its leading edge into position over the delivery pile as shown in the dotted line position in diagram GG-5, at which point the sheet is released and dropped onto the top of the pile with its original bottom surface face-up.

The delivery mechanism illustrated in diagram GG-5 has the advantage that sheets within an extremely wide range of both flexibility and rigidity may be delivered with either of their original surfaces face-up, as may be required by the printing function or combination of functions being performed, and in either case the sheet is pulled by its leading edge all the way to the point where the sheet is in position to be dropped onto the top of the delivery pile. Regardless of the degree of ink coverage printed on either the top or the bottom of the sheet, or on both the top and the bottom, and regardless of the limpness, or lack of rigidity, of the sheets, the sheets are positively stripped from the peripheral surfaces of the cylinders of the printing couple, since they are pulled by their leading edges until the entire stripping process has been completed. The printing may also bleed, from both side edges and from the trailing edge of the sheet, on both the top and bottom surfaces of the sheet, since no stripper fingers, delivery rollers, cupping rollers, etc. need track over any portion of the sheets because they are pulled by their leading edges all the way to the point where they are in position to be dropped onto the top of the delivery pile, irrespective of whether they are to be delivered with their original top surface face-up or with their original bottom surface face-up.

The delivery mechanism of diagram GG-5 has the further advantage that completely rigid and inflexible sheets may be delivered, since they may be pulled by their leading edges, in a straight line, throughout the entire stripping and delivery operation until they are in position to be dropped onto the top of the delivery pile, as shown in the full line position of diagram GG-5, with their original top surface face-up.

Another advantage of the delivery mechanism of diagram GG-5 lies in the fact that considerable elapsed time, measured in terms of the surface speed of the cylinders of the printing couple, is provided for any transferring of a sheet, from one set of grippers to another, that may be required, since, as has previously been described, any transfer between the cylinder grippers and the encircling chain carried grippers takes place as the cylinder grippers pass through an arc of travel of the lower printing cylinder, and any transfer from the encircling, chain carried grippers to the "extension", chain carried grippers takes place as the two grippers travel together for a distance, in a straight line. In both cases the time provided for the transfer, at any given speed of rotation of the cylinders of the printing couple, is far greater than that available when a transfer between two grippers must take place at a line of tangency between two cylindrical elements, as in diagram GG-2. The transfers may, therefore, take place at higher press speeds, in a more positive fashion, and with less noise being created by the functioning of the parts during the transfer process.

It will thus be apparent that the various embodiments of the press may each be equipped with a delivery mechanism appropriate both to the functions to be performed by the press and the type of material to be printed upon, with delivery means being available to meet the most exacting requirements, while appropriate simpler, less costly, delivery means are also available for all press requirements including the very simplest.

The PP series of diagrams illustrate actions and functions of the cylinder grippers. An adjustable mechanism, not shown, causes the cylinder grippers to open and close to receive a sheet, and to open to release the sheet, at the proper times to cause the cylinder grippers to carry a sheet through the bite of the printing couple once or more than once, as required, and as illustrated in the PP series of diagrams.

The actions of the cylinder grippers are illustrated for cases in which sheets are fed to every revolution of the lower printing cylinder and for cases in which sheets are fed to other than every revolution of the lower printing cylinder. For purposes of illustration the sheets are shown being delivered into a delivery tray and the cylinder grippers are shown opening to release a sheet at the point in the rotation of the lower printing cylinder which is appropriate to this delivery means. If one of the other delivery mechanisms of the GG series is used, the cylinder grippers open to release the sheet at the point in the rotation of the lower printing cylinder which is appropriate to the delivery mechanism used.

Since various ones of the diagrams in the PP series show the cylinders of the printing couple in different phases of a rotation of the large printing cylinder, one of the segments mounted in one of the work areas on the large printing cylinder is marked with a circular band in each diagram to distinguish it from the unmarked segment mounted in the other work area and to facilitate following the sequence of the actions illustrated within each group of diagrams.

Diagrams PP-1 and PP-2, together, illustrate the case in which a sheet is fed to every revolution of the lower printing cylinder and each sheet passes through the bite of the printing couple one time.

Diagram PP-1 shows diagramatically four successive sheets being fed to the lower printing cylinder so that a sheet will reach the cylinder grippers on each revolution of the lower printing cylinder. The first sheet is shown entering the cylinder grippers and the cylinder grippers are open to receive the leading edge of the sheet. The leading edge of the lower printing cylinder and the leading edge of the marked segment on the large printing cylinder are approaching the bite of the printing couple as the cylinders revolve. The sheet which passed through the bite of the printing couple on the previous revolution of the lower printing cylinder is shown falling into the delivery tray.

Diagram PP-2 illustrates the position of the various elements after the lower printing cylinder has rotated approximately 120°. During this rotation, between diagram PP-1 and diagram PP-2, the cylinder grippers closed on the leading edge of the first sheet and carried it to and through the bite of the printing couple. As the cylinders continued to rotate, the cylinder grippers began to open to release the sheet, and, at the point shown in diagram PP-2, the cylinder grippers have opened and the sheet is being released for delivery into the delivery tray. The previous sheet has practically completed its drop into the delivery tray. The first sheet is in the process of passing through the bite of the printing couple and is being squeezed between the printing surface on the lower printing cylinder and the printing surface on the marked segment carried by the large printing cylinder. Each of the following sheets has advanced toward the lower printing cylinder; and when the lower printing cylinder has rotated approximately another 240°, it will have returned to the position shown in diagram PP-1, the second sheet will then be entering the cylinder grippers and the leading edge of the unmarked segment will be approaching the bite of the printing couple in coincidence with the leading edge of the lower printing cylinder. The first sheet, shown passing through the bite of the printing couple in diagram PP-2, will then be falling into the delivery tray, in the position of the previous sheet shown in diagram PP-1, and this process will be repeated as the machine continues to operate.

Diagrams PP-3 through PP-6, taken together, illustrate the case in which sheets are delivered to every other revolution of the lower printing cylinder, and then pass through the bite of the printing couple once. This is the situation that exists, for instance, when an image, from a plate mounted on the unmarked segment on the large printing cylinder, is transferred to a blanket on the lower printing cylinder during a revolution of the lower printing cylinder when no paper is present, and then a sheet passes through the bite of the printing couple and the image previously transferred to the blanket on the lower printing cylinder is printed on the bottom surface of the sheet, while simultaneously another image, from the blanket on the marked segment on the large printing cylinder, is printed on the top surface of the sheet.

Diagram PP-3 shows a first sheet entering the cylinder grippers, which are open to receive it. The leading edge of the marked segment on the large printing cylinder and the leading edge of the lower printing cylinder are approaching the bite of the printing couple. There is no sheet in position to reach the lower printing cylinder on its next revolution, but there is a sheet in position to reach the lower printing cylinder on its second following revolution. A previously printed sheet has already settled into position in the delivery tray.

Diagram PP-4 shows the relative positions of the various elements after the lower printing cylinder has rotated approximately 120°. The first sheet has been gripped by the cylinder grippers and its leading edge carried through the bite of the printing couple and the grippers have now opened to release the sheet. The sheet is being squeezed between the printing surface on the lower printing cylinder and the printing surface on the marked segment on the large printing cylinder, and images from both surfaces are being printed simultaneously on the two sides of the sheet. The following sheet has moved closer to the lower printing cylinder.

Diagram PP-5 shows the relative positions of the various elements approximately 240° after diagram PP-4, and 360° after diagram PP-3. The first sheet is falling into the delivery tray. The leading edge of the unmarked segment on the large printing cylinder is approaching the bite of the printing couple in coincidence with the leading edge of the lower printing cylinder. The cylinder grippers have again opened to receive a sheet, but no sheet is present. The following sheet has again moved closer to the lower printing cylinder, timed so that it will reach the cylinder grippers as they complete their next full revolution.

Diagram PP-6 shows the relative positions of the various elements approximately 120° later, at which time the first sheet has practically completed its descent into the delivery tray. The cylinder grippers have opened to release a sheet, but no sheet is present. The printing surface on the lower printing cylinder is rolling in contact with the printing surface on the unmarked segment on the large printing cylinder and the image on the plate on the unmarked segment is being transferred to the blanket carried by the lower printing cylinder. The second sheet has again moved closer to the lower printing cylinder, timed to reach and enter the cylinder grippers approximately 240° of rotation of the lower printing cylinder later, when they again reach the position in which they are shown in diagram PP-3, at which time the relative positions of the various elements will again be as shown in diagram PP-3, but with the first sheet now at rest in the delivery tray, the second sheet having entered the open cylinder grippers, and a third sheet in position to reach the cylinder grippers two revolutions of the lower printing cylinder later. This process is repeated as the press continues its operation.

Diagrams PP-7 through PP-10, taken together, illustrate the sequence of actions when sheets are fed to every other revolution of the lower printing cylinder and each sheet then passes through the bite of the printing couple two times, as, for instance, when two overlapping images in two colors are printed on the top surface of each sheet, one image being printed on the first passage of the sheet through the bite of the printing couple (from a blanket on the marked segment on the large printing cylinder) and the second image, in a second color, being printed on the second passage of the sheet through the bite of the printing couple (from another blanket on the unmarked segment on the large printing cylinder).

Diagram PP-7 shows a first sheet entering the cylinder grippers, which are open to receive it. A second, third, and fourth sheet are also shown in position to reach the cylinder grippers on every other revolution of the lower printing cylinder. A previously printed sheet, having just previously been released from the cylinder grippers is falling into the delivery tray. The leading edge of the marked segment on the large printing cylinder and the leading edge of the lower printing cylinder are approaching the bite of the printing couple. As the cylinders continue to rotate the cylinder grippers will close on the leading edge of the first sheet and carry it to and through the bite of the printing couple.

Diagram PP-8 shows the relative positions of the various elements approximately 120° later, at which point the previous sheet has nearly completed its drop into the delivery tray. The first sheet is passing through the bite of the printing couple for the first time and the first image is being printed on the upper surface of the sheet as the sheet is squeezed between a platen surface on the lower printing cylinder and a blanket on the marked segment on the large printing cylinder. The cylinder grippers remain closed to carry the sheet on around the lower printing cylinder. The second sheet has moved closer to the lower printing cylinder but there is no sheet in position to reach the lower printing cylinder as it completes this revolution.

Diagram PP-9 illustrates the positions of the various elements approximately 240° after diagram PP-8, and 360° after diagram PP-7. At this point the first sheet has completed its first passage through the bite of the printing couple. The cylinder grippers have not opened to receive another sheet, but retain their grip on the leading edge of the first sheet. The leading edge of the lower printing cylinder and the leading edge of the unmarked segment on the large printing cylinder are now approaching the bite of the printing couple. The preceding sheet has completed its drop into the delivery tray and the second sheet has again moved closer to the lower printing cylinder, timed to reach and enter the cylinder grippers as they complete their next revolution.

Diagram PP-10 illustrates the positions of the various elements approximately 120° after diagram PP-9, and 360° after diagram PP-8. The cylinder grippers have now carried the leading edge of the first sheet through the bite of the printing couple a second time and have opened to release the sheet for delivery into the delivery tray. The first sheet is in the midst of its second passage through the bite of the printing couple and the second image in the second color is being printed on the upper surface of the sheet as the sheet is squeezed between the platen surface on the lower printing cylinder and a second blanket, on the unmarked segment on the large printing cylinder. The second sheet has again moved closer to the lower printing cylinder, to be in the position of the first sheet in diagram PP-7 after the lower printing cylinder has rotated approximately another 240°, at which time the various elements will have returned to the positions shown in diagram PP-7, but with the second sheet entering the open cylinder grippers and with the first sheet in the process of falling into the delivery tray. This process will be repeated as the press continues to run.

Turning now to FIG. *7d,* the DD series of diagrams illustrate various paper feeding means that are available with the press.

Diagram DD-1 illustrates the press equipped with a "bottom" feeder, so called because the sheet on the bottom of the stack is separated from the other sheets each time the separating mechanism is actuated. The sheets are supported throughout most of their length upon a bottom support plate which does not, however, extend under the forward portion of the stack, and which is slightly inclined, so that the leading edges of all sheets will lie in contact with a forward guide plate. The sheets are supported from below, along their leading edge, by a short lip, extending back from the bottom of the forward guide plate. Suction feet, which pivot about an axis which coincides with the leading edge of the bottom support plate, rock up into contact with the unsupported forward area on the underside of the bottom sheet of the stack. Suction is then drawn in the suction feet by means of a pump (a reciprocating pump is shown in the diagram) and the suction feet are then pivoted downward about their axis, and, through the action of the suction, they pull the leading edge of the bottom sheet down from above the forward support lip, separating this forward portion of the sheet from the other sheets in the stack. The forward portion of the bottom sheet is then bent down, but not pulled forward, as the suction feet continue to pivot downward, until its bottom surface contacts a lower pull-out roller. An upper pull-out roller then rocks into position above the sheet, in alignment with the lower pull-out roller, and the sheet is seized between the two pull-out rollers. The suction is then broken to cause the suction feet to release the sheet, and the pull-out rollers pull the sheet out from the bottom of the pile, onto a conveyor board which conveys it toward the lower printing cylinder until its leading edge contacts the stop fingers.

This process is repeated under the control of the feeder control mechanism, previously described, and in proper timed relationship to cause the leading edge of each sheet fed to reach the stop fingers when they are raised to receive a sheet. Sheets may be loaded onto the top of the stack while the feeder continues to run.

This diagram also illustrates diagrammatically an underlapping device on the conveyor board, which may be used when extremely long sheets are being fed, and which acts to lift the trailing edge of such a long sheet when its leading edge reaches the stop fingers, and to hold the trailing edge in a raised position while the sheet is in contact with the stop fingers, so that the leading edge of a following sheet, which reaches the trailing edge of the first sheet before the first sheet has been advanced to the cylinder stops, will pass under the trailing edge of the first sheet; and when the leading edge of the first sheet advances to the cylinder stops and through the bite of the printing couple the two sheets will move forward together on the conveyor board, with the second sheet underlapped with respect to the first, until the leading edge of the second sheet is stopped by the raised stop fingers and the trailing edge of the first sheet passes on through the bite of the printing couple.

Diagram DD-2 illustrates the press equipped with a pile suction feeder, in which a supply of sheets is loaded onto a pile support which is controlled by a raising mechanism, so that as sheets are withdrawn from the top of the pile, the pile support rises to maintain the top sheet of the pile in approximately the same plane at all times. A suction foot, or suction feet, located near the leading edge of the pile, comes down very close to the surface of the top sheet on the pile. Air from a pump is blown from the sides and front of the pile between the sheets at the top of the pile and suction is drawn on the suction foot. The air blown between the sheets causes the uppermost sheets of the pile to rise and lifts the top sheet into contact with the suction foot. The suction drawn in the suction foot causes the top sheet to be seized by the suction foot. The suction foot then moves upwardly causing the leading edge of the top sheet to be drawn over a flexible lip or "cat's whisker" which tends to hold back all but the single sheet held by the suction foot. The suction foot then moves farther up, and forward, to place the leading edge of the sheet into the bite of a pair of main pull-out rollers, which then pull the sheet out onto the conveyor board as the suction line is broken and the suction foot releases the sheet. The passage of the sheets along the conveyor board and to the printing couple of the press is as previously described. The feeding of sheets is controlled by the feeder control mechanism, previously described, to cause sheets to be fed to every revolution of the lower printing cylinder or to other than every revolution of the lower printing cylinder, selectively.

Diagram DD-3 illustrates the "pile" feeder of diagram DD-2 and the "bottom" feeder of diagram DD-1 mounted in combination, in which positions they may be used either together separately under the control of the feeder control mechanism, previously described, to feed sheets from either feeder alone, or, alternatively, from the two feeders successively, to every revolution of the lower printing cylinder or to other than every revolution of the lower printing cylinder, selectively.

A "roll-sheet-converter", which takes a roll of paper and cuts it into sheets of the proper length as the sheets are advanced onto the conveyor board may be substituted for either or both of the feeders shown, since individual sheets are thereby conveyed to the stop fingers of the press and the various printing functions of the press are then performed on these sheets as described elsewhere herein. The operation of the "roll-sheet-converter", or converters, would then be controlled by the feeder control mechanism instead of the paper feeder, or feeders, as described.

Diagram DD-12 illustrates diagrammatically a combined double sheet eliminator and "miss" detector. This device senses the thickness of the sheets fed, as they pass through the main pull-out rollers of the feeders, and may be set to pass sheets of a single thickness being fed from either one of the two feeders alone, or may be set to pass sheets of two different thicknesses, one fed from one feeder and one from the other feeder. Whenever a thickness greater than that for which the setting or settings have been made is sensed, a defector plate is actuated, and the multiple sheets are deflected out of the path of sheets to be carried out onto the conveyor board, and into a tray provided for receiving rejects. This insures that only single sheets, from either feeder, will reach the bite of the printing couple.

When only printing functions are being performed (as opposed to concurrent printing and collating functions) sheets are deflected into the reject tray only when the presence of more than a single sheet is sensed.

However, when the press is performing printing and collating functions concurrently it is important that only complete, collated sets be delivered into the delivery hopper. There is, therefore, a "miss" detector, which may be set to sense whether a sheet has, in fact, been fed on each stroke of the feeder or feeders for which the feeder control mechanism is set to cause a sheet to be fed. Also, whenever a "double" is ejected by the double sheet eliminator, the effect, at the delivery end of the press, is the same as if a sheet had been missed, since no sheet reaches the bite of the printing couple on that revolution of the lower printing cylinder.

When sheets are being printed and collated concurrently the "miss" detector and the double sheet eliminator work together, so that if a sheet is missed, or if sheets are deflected by the double sheet eliminator, the mechanism then acts, in either case, to deflect a sufficient number of additional sheets into the rejects tray so that the total number of sheets failing to reach the bite of the printing couple is equal to the number in one complete, collated set. This insures that the next sheet to reach the bite of the printing couple will be in proper sequence with the previous sheet, and thus maintains the proper sequence of printed and collated sheets reaching the delivery hopper.

The FF series of diagrams show the printing couple and illustrate various combinations of printing surfaces carried by segments mounted in work areas on the large printing cylinder and printing surfaces carried by the lower printing cylinder.

These diagrams also illustrate various combinations of form roll lifter cams which may be used with these printing surface combinations to lift the form rollers of selected inking/dampening modules, or dampening modules, out of contact with selected ones of these printing surfaces, while allowing them to contact other selected printing surfaces carried on other segments on the large printing cylinder. These diagrams also illustrate various combinations of plate cylinder control cams, for lifting selected plate cylinders, in plate cylinder modules, out of contact with selected printing surfaces on the large printing cylinder, while allowing them to roll in contact with other selected printing surfaces on the large printing cylinder.

Diagram FF-1 shows the printing couple with an impression surface on the lower printing cylinder and with two segments on the large printing cylinder, each carrying an offset blanket. There are no cams to lift either form rollers or plate cylinders out of contact with either of the offset blankets on the segments on the large printing cylinder.

Diagram FF-2 illustrates a similar arrangement but with only a single segment, carrying an offset blanket, on the large printing cylinder.

Diagram FF-3 illustrates the printing couple with an off- set blanket on the lower printing cylinder, and with two segments, each carrying another offset blanket, in the two work areas on the large printing cylinder. No lifter cams are used.

Diagram FF-4 illustrates the printing couple with an offset blanket on the lower printing cylinder, an offset plate, either wet or dry, on one segment on the large printing cylinder and an impression surface on the other segment on the large printing cylinder. The impression segment is equipped with form roll lifter cams to lift the form rollers of a dampening module and/or of an ink-/dampening module out of contact with the impression surface, while allowing them to contact the surface of the offset plate.

Diagram FF-5 illustrates the printing couple with an offset blanket on the lower printing cylinder, an offset plate, wet or dry, on one segment on the large printing cylinder and an embossing plate on the other segment on the large printing cylinder. There are form roll lifter cams on the embossing segment to lift the form rollers of a dampening module, and/or of an ink/dampening module, out of cantact with the embossing plate, while allowing them to contact the offset plate.

Diagram FF-6 illustrates the printing couple with an off-set blanket on the lower printing cylinder, another offset blanket on one segment on the large printing cylinder and an embossing plate on the other segment on the large printing cylinder. There is a plate cylinder control cam on the shaft of the large printing cylinder, in position to lift selected plate cylinders, in plate cylinder modules, out of contact with embossing plate, while allowing them to roll in contact with the offset blanket on the other segment on the large printing cylinder.

Diagram FF-7 illustrates the printing couple with an offset blanket on the lower printing cylinder, another offset blanket on one segment on the large printing cylinder and an offset plate (wet or dry) on the other segment on the large printing cylinder. There is a plate cylinder control cam, on the shaft of the large printing cylinder, positioned to lift selected plate cylinders, in plate cylinder modules, out of contact with the offset plate, while allowing them to roll in contact with the offset blanket on the other segment on the large printing cylinder. There are form roll lifter cams on the offset blanket segment to lift selected form rollers, mounted to cooperate with the large printing cylinder, out of contact with this offset blanket, while allowing them to roll in contact with the offset plate.

Diagram FF-8 illustrates the printing couple with an offset blanket on the lower printing cylinder, another offset blanket on a first segment on the large printing cylinder and another offset blanket on a second segment on the large printing cylinder. There are two plate cylinder control cams, in different lateral planes, on the shaft of the large printing cylinder. One cam is positioned to lift selected plate cylinders, in plate cylinder modules, out of contact with the offset blanket on the first segment, while allowing these plate cylinders to roll in contact with the other offset blanket on the second segment. The other cam is positioned to lift other selected plate cylinders, in other plate cylinder modules, out of contact with the offset blanket on the second segment while allowing these plate cylinders to roll in contact with the offset blanket on the first segment.

Diagram FF-9 illustrates the printing couple with an impression surface on the lower printing cylinder and either a letterpress plate, a direct litho plate or a letterpress imagine device in a single work area on the large printing cylinder. There are no lifter cams.

Diagram FF-10 illustrates the printing couple with an impression surface on the lower printing cylinder and first and second segments on the large printing cylinder, on each of which there is either a letterpress plate or imaging device, or a direct litho plate. There are form roll lifter cams on each segment. The form roll lifter cams on the first segment are in different planes from the form roll lifter cams on the second segment. Thus the form rollers of one ink/dampening module (or of one ink/dampening module and one dampening module) contact the printing surface on the first segment, but are lifted out of contact with the printing surface on the second segment, whereas the form rollers of another ink/dampening module contact the surface of the second segment, but are lifted out of contact with the surface of the first segment.

Diagram FF-11 illustrates the printing couple with an impression surface mounted on the lower printing cylinder, an offset blanket on one segment on the large printing cylinder and a letterpress plate or imaging device on a second segment on the large printing cylinder. There are form roll lifter cams on the offset blanket segment. There is a plate cylinder control cam on the shaft of the large printing cylinder. The form rollers of an ink-/dampening module (equipped only with ink rollers) would roll in contact with the letterpress plate or imaging device on the one segment and be lifted out of contact with the offset blanket on the other segment. The plate cylinders of any plate cylinder modules used would be lifted out of contact with the letterpress plate or imaging device, but would roll in contact with the offset blanket.

Diagram FF-12 illustrates the printing couple with an impression surface on the lower printing cylinder, an offset blanket on a first segment on the large printing cylinder and another offset blanket on a second segment on the large printing cylinder. There are two plate cylinder control cams, in different lateral planes, on the shaft of the large printing cylinder. Selected plate cylinders, in plate cylinder modules, are lifted out of contact with the offset blanket on the first segment, but roll in contact with the offset blanket on the second segment. Other selected plate cylinders, in other plate cylinder modules are lifted out of contact with the offset blanket on the second segment, but roll in contact with the offset blanket on the first segment. Still another plate cylinder or cylinders, in another plate cylinder module or modules, may roll in contact with the surfaces of both offset blankets, on both segments on the large printing cylinder.

Figures 8, 8A:
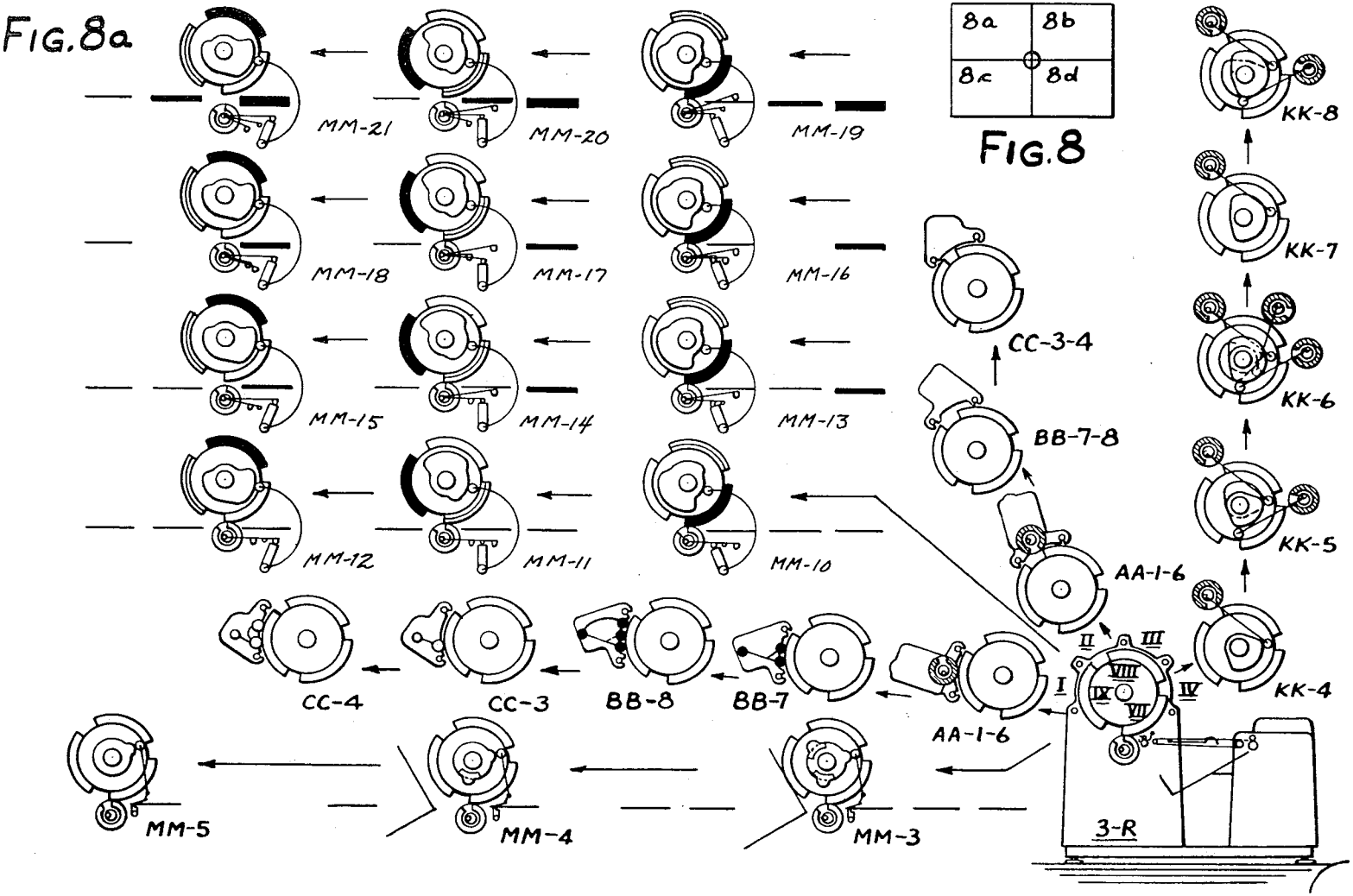

FIG. 8, like FIG. 7, is made up of four parts, FIGS. 8*a*, 8*b*, 8*c*, and 8*d*. The small diagram labeled FIG. 8 on the sheet with FIG. 8*a* shows the manner in which these four figures should be assembled to form FIG. 8 as a whole. There is a 90° quadrant of a circle in one corner of each of the sheets on which FIGS. 8*a*, 8*b*, 8*c*, and 8*d* appear. When properly assembled these four quadrants form a complete circle at the center of FIG. 8.

Many of the elements illustrated in FIGS. 7*a*, 7*b*, 7*c*, and 7*d* apply alike to both the 2-R press and the 3-R press. FIGS. 8*a*, 8*b*, 8*c*, and 8*d*, together, illustrate, in the same diagrammatic form, elements of the 3-R press which either differ from, or go beyond, the elements illustrated in FIGS. 7*a*, 7*b*, 7*c*, and 7*d*.

Like FIG. 7, FIG. 8 has the general form of the hub and spokes of a wheel, with a diagram of the basic 3-R press at the "hub" and diagrams illustrating various interrelated functional areas of the total press structure radiating out from this diagram like the spokes of a wheel.

As previously explained, the lower printing cylinder and the plate cylinders are the same in both the 2-R press and the 3-R press, whereas the large printing cylinder in the 2-R press is twice the effective diameter of the lower printing cylinder and the large printing cylinder in the 3-R press is three times the effective diameter of the lower printing cylinder.

Since the large printing cylinder of the 3-R press is larger in diameter than the large printing cylinder of the 2-R press, the frames of the 3-R press are correspondingly larger, and the spacing between the spreader bars, on which various printing modules may be mounted, in the positions designated I, II, III and IV, is greater on the 3-R press than on the 2-R press. Because of this, the mounting brackets which support the plate cylinder modules are different for the 3-R press, in that they are longer, to span the greater distance between the spreader bars to which they are in turn mounted. The basic plate cylinder modules thermselves are the same, whether used on the 2-R press or on the 3-R press.

The frames for the ink/dampening modules, and the frames for the dampening modules, are different as between the 2-R press and the 3-R press. The only difference, however, is that the base portion of these frames, which mounts to the spreader bars, is the proper dimension to span the distance between the spreader bars on the 2-R model in the one case and the proper dimension to span the distance between the spreader bars on the 3-R model in the other case. In all other respects the frames for use on the 2-R press and the frames for use on the 3-R press, for both these modules, are alike; and, except for this difference in the frames, all other components of these modules are the same whether for use on the 2-R or on the 3-R press.

In the lower righthand corner of FIG. 8*a* is a diagrammatic illustration of the basic 3-R press. Shown diagrammatically are the feeder frames, the double sheet eliminator and the tray for receiving rejects, the conveyor board, the stop fingers, feed rolls, sheet detector, and the lower printing cylinder. All of these elements are identical to the similar elements in the 2-R press. In addition, this diagram illustrates the larger frames of the 3-R press and the five spreader bars which tie the frames together, and which, together with the frames, form the module mounting positions designated I, II, III, and IV. Also shown is the large printing cylinder, which in this case, has an effective diameter three times the effective diameter of the lower printing cylinder, and which is divided into three work areas, designated VII, VIII, and IX, at each of which may be mounted various removable segments, or other devices, carrying a variety of printing surfaces. The larger printing cylinder, with its three work areas, and the lower printing cylinder, with its one work area, comprise the printing couple.

Extending out from module mounting position I are a series of diagrams illustrating various printing modules, any one of which may be mounted in module mounting position I.

the first of these diagrams, AA-1-6, indicates that any of the six plate cylinder modules which may be mounted in position I on the 2-R press, as illustrated and described in FIG. 7*a*, may also be mounted in position I on the 3-R press. The larger mounting brackets for the 3-R press are used, as illustrated in this diagram.

Diagram BB-7 illustrates an ink/dampening module, but with a simple ink system only, with two ink form rollers, and with frames appropriate to the spacing of the spreader bars on the 3-R press.

Diagram BB-8 illustrates a similar ink/dampening module with only an ink system, and with frames appropriate to the spacing of the spreader bars on the 3-Rpress, but having an additional train of ink rollers including a third ink form roller which contacts the plate, in a work area on the large printing cylinder, after it has been contacted by the first two form rollers.

Diagram CC-3 illustrates a separate dampening module with a single dampening form roller and the appropriate frames for use on the 3-R press.

Diagram CC-4 illustrates a similar separate dampening module but withan additional train of dampening rollers, including a second dampening form roller which contacts the plate after it has been contacted by the first dampening form roller, and with the appropriate frames for use on the 3-R press.

Extending out from module mounting position II are a series of diagrams illustrating various printing modules, any one of which may be mounted in module mounting position II.

The first of these diagrams, /AA-1-6, indicates that any of the six plate cylinder modules which may be mounted in position II on the 2-R press, as illustrated in FIG. 7*a*, may also be mounted in position II on the 3-R press with the use of the appropriate mounting bracket.

Diagram BB-7-8 indicates that either of the ink-/dampening modules BB-7 or BB-8, which are shown mounted in position I may also be mounted in position II on the 3-R press.

Diagram CC-3-4 indicates that either of the separate dampening modules CC-3 or CC-4 which are shown mounted in position I may also be mounted in position II on the 3-R press.

The diagrams of the MM series are a continuation, for the 3-R press, fo the similar diagrams of FIG. 7*a* illustrating the sheet sensing mechanism for detecting the presence or absence of a sheet at the stop fingers of the press at such times as the feeder control mechanism has been set to feed a sheet to that position. The sensing mechanism controls the positioning, or retention, of the cylinders of the printing couple in printing or non-printing relationship. They then remian in the position in which they are set until the next action of the sensing mechanism.

Diagram MM-3 illustrates the case in which the feeder control mechanism has been set to cause a sheet to be fed to each revolution of the lower printing cylinder on the 3-R press. The cam for actuating the sensing mechanism has three lobes, 120 apart, one corresponding to each revolution made by the lower printing cylinder as the cam (which is affixed to the shaft of the large printing cylinder) makes one revolution. The sensing mechanism therefore senses for the presence or absence of a sheet at the stop fingers on every revolution of the lower printing cylinder.

Diagram MM-4 illustrates the case in which the feeder control mechanism has been set to cause a sheet to be fed to the first revolution of the lower printing cylinder, to cause no sheet to be fed to the second revolution of the lower printing cylinder, and then to cause a sheet to be fed to the third revolution of the lower printing cylinder for each revolution of the large printing cylinder. There is a lobe, on the cam for actuating the sensing mechanism, in position to actuate the sheet detector at the time during the first revolution of the lower printing cylinder when the stop fingers are raised and a sheet should be present. There is no lobe on the cam at the position, 120° away, which will be opposite the cam follower at the point in the second revolution of the lower printing cylinder when the stop fingers are in the raised position. There is another lobe on the cam 240° away from the first lobe, and in position to contact the cam follower, and actuate the sheet detector mechanism, at that point in the third revolution of the lower printing cylinder when the stop fingers are in the raised position, and at which time the feeder control mechanism should have caused a sheet to be fed to the stop fingers.

Diagram MM-5 illustrates the case in which the feeder control mechanism has been set to cause a sheet to be fed to the stop fingers only on every third revolution of the lower printing cylinder. The sheet is timed to reach the stop fingers at the point in the first revolution of the lower printing cylinder when the stop fingers are in a raised position. There is, therefore, a lobe on the cam in the proper position to actuate the sheet detector mechanism at that time. There is no lobe on the cam 120° away, in position to actuate the sheet detector mechanism at the time during the second revolution of the lower printing cylinder when the stop fingers are in a raised position, since the feeder control is not set to cause a sheet to be fed to the stop fingers at that time; not for the same reason, is there a lobe on the cam 240° away, in the corresponding position to actuate the sheet detector when the stop fingers are in a raised position during the third revolution of the lower printing cylinder.

The MM-10 thru MM-21 series of diagrams is a continuation, for the 3-R press, of the similar diagrams in FIG. 7*a*, which illustrate independent pressure adjustments between the lower printing cylinder and different work areas of the large printing cylinder. These independent adjustments are accomplished by providing means to maintain or to vary the distance between the center of the lower printing cylinder and the center of the large printing cylinder separately and independently as each of the separate work areas of the large printing cylinder rolls in coincidence with the lower printing cylinder.

Whereas these pressure adjustments are "dual" adjustments on the 2-R press, which has two work areas on the large printing cylinder, they are three-way adjustments on the 3-R press, which has three work areas on the large printing cylinder.

The complete separation of the lower printing cylinder from the large printing cylinder, to a non-printing relationship, which is effected when the sheet sensing mechanism detects the absence of a sheet, is greater than, and overrides, the differences in these center distances effected the adjustments illustrated in this series of diagrams.

The adjustments illustrated in diagrams MM-10 through MM-21 are accomplished by providing three manually set, independently adjustable stops, affixed to one of the eccentric stubs at the ends of the shaft on which the lower printing cylinder is mounted. When one of these eccentric end stubs is turned in a clockwise direction the center of the lower printing cylinder is moved away from the fixed center of the large printing cylinder and conversely when one of these eccentric end stubs is moved in a counterclockwise direction the distance between the center of the lower printing cylinder and the fixed center of the large printing cylinder is decreased. Both the weight of the lower printing cylinder itself, and the pressure exerted against the surface of the lower printing cylinder by printing surfaces mounted in work areas on the large printing cylinder, tend to turn these eccentric end stubs in a clockwise direction and thereby to increase the distance between the center of the lower printing cylinder and the fixed center of the large printing cylinder.

A pivoted limit stop is provided to engage these adjustable stops and thereby limit the clockwise rotation of the eccentric end stubs. This limits the separation of the lower printing cylinder from the large printing cylinder. An arm attached to the pivoted limit stop carries a cam follower which rolls in contact with the surface of a three level cam on the shaft of the large printing cylinder. The three level cam moves the cam follower, and hence the pivoted limit stop, into three successive positions, in alignment with first one, then the second, and then the third of the adjustable stops, and maintains it, successively, in each one of these positions while each successive work area of the large printing cylinder rolls in coincidence with the work areas of the lower printing cylinder.

Another cam and lever mechanism, not illustrated in these diagrams, acts to rotate these eccentric end stubs on the shaft of the lower printing cylinder in a counterclockwise direction whenever a gap of the large printing cylinder is in coincidence with the gap of the lower printing cylinder, to relieve the pressure between the adjustable stops and the pivoted limit stops while the pivoted limit stop moves from one position to another, and while the latching or unlatching of the cylinders, set in motion by the sensing mechanism, takes place.

By adjusting the three adjustable stops independently, the distance between the center of the lower printing cylinder and the fixed center of the large printing cylinder (and thus the pressure between a printing surface on the lower printing cylinder and a printing surface on a work area on the large printing cylinder) may be independently controlled for each of the work areas of the large printing cylinder.

Diagrams MM-10 through MM-12, taken together, illustrate the case in which sheets of the same thickness are fed to each revolution of the lower printing cylinder.

Diagram MM-10 shows the positions of the various elements just prior to the passage of the first sheet through the bite of the printing couple, between the lower printing cylinder and the solidly marked segment on the large printing cylinder. The pivoted limit stop is in contact with the first of the adjustable stops.

Diagram MM-11 illustrates the positions of the various elements just prior to the time the second sheet passes through the bite of the printing couple, between the lower printing cylinder and the second segment on the large printing cylinder, which is marked with a line band. The mac follower has moved onto the second level of the three level cam and this in turn has caused a pivoted limit stop to move into alignment with the second of the adjustable stops.

Diagram MM-12 illustrates the positions of the various elements just prior to the passage of the third sheet through the bite of the printing couple, between the lower printing cylinder and the third, unmarked, segment on the large printing cylinder. The cam follower has moved onto the third level of the three level cam and this has moved the pivoted limit stop into alignment with the third adjustable stop.

While the adjustments are shown as being the same for all three sheets, since they are of equal thickness, small differences in the adjustments may be effected to compensate for differences in the thicknesses of the three printing surfaces on the different segments on the large printing cylinder. The adjustments would be the same if the first sheet were carried around the lower printing cylinder once and through the bite of the printing couple two times. In this case another sheet would not be fed to the second revolution of the lower printing cylinder, but sheets would be fed to the first and third revolutions of the lower printing cylinder only. The adjustments would also be the same if the first sheet were carried around the lower printing cylinder two times and through the bite of the printing couple three times. In this case a sheet would be fed only to the first revolution of the lower printing cylinder.

Diagrams MM-13 through MM-15, taken together, illustrate the case in which sheets of equal thickness are fed to the first two revolutions of the lower printing cylinder and a sheet of greater thickness is fed to the third revolution of the lower printing cylinder.

Diagram MM-13 illustrates the relative positions of the elements just prior to the passage of the first sheet through the bite of the printing couple and the adjustment is similar to that in diagram MM-10, except that the third manually adjustable stop has been raised.

Diagram MM-14 shows the positions of the elements just prior to the passage of the second sheet through the bite of the printing couple and the adjustment is similar to that shown in diagram MM-11, except that the third manually adjustable stop has been raised.

Diagram MM-15 shows the positions of the elements just prior to the passage of the third and thicker sheet through the bite of the printing couple. The pivoted limit stop has been brought into alignment with the third adjustable stop. The third of the manually adjustable stops has been raised by an amount proportionate to the thickness of the sheet and the eccentric end stubs at the ends of the lower cylinder shaft have rotated in a clockwise direction until this third adjustable stop has contacted the pivoted limit stop. Consequently the distance between the center of the lower printing cylinder and the fixed center of the large printing cylinder has been increased by the proper amount to allow the thicker sheet to pass through the bite of the printing couple with the proper pressure exerted as the sheet is squeezed between the printing surface on the lower printing cylinder and the printing surface on the unmarked segment on the large printing cylinder.

On the next revolution of the lower printing cylinder the elements will return to the positions shown in diagram NN-8.

Diagrams MM-16 through MM-18, taken together, illustrate the case in which a sheet is fed to the first revolution of the lower printing cylinder, no sheet is fed to the second revolution of the lower printing cylinder but an image is transferred from a printing surface on the large printing cylinder to an offset blanket on the lower printing cylinder during this revolution of the lower printing cylinder and then a sheet, thicker than the first, is fed to the third revolution of the lower printing cylinder.

Diagram MM-16 shows the positions of the elements just prior to the passage of the first sheet through the bite of the printing couple. The first adjustable stop is in alignment with the pivoted limit stop and the adjustment is similar to that in diagram MM-13, except that the second manually adjustable stop has been lowered.

Diagram MM-17 shows the relationship of the elements just prior to the second revolution of the lower printing cylinder, when no sheet has been fed. Since the feeder control was not set to feed a sheet and the arrangement of the sheet sensing mechanism is as seen in diagram MM-4, the cylinders of the printing couple have not been thrown into a nonprinting relationship. The pivoted limit stop has moved into alignment with and is in contact with the second adjustable stop. This second manually adjustable stop has been lowered by an amount sufficient to decrease the distance between the center of the lower printing cylinder and the fixed center of the large printing cylinder so that the offset blanket on the lower printing cylinder is squeezed against the printing surface on the segment marked with a line band when the second adjustable stop is in contact with the pivoted limit stop. These two printing surfaces are therefore pressed together as the lower printing cylinder makes its second revolution, resulting in the image on the printing surface on this segment on the large printing cylinder being transferred to the offset blanket on the lower printing cylinder.

Diagram MM-18 shows the relationship of the various elements just prior to the third revolution of the lower printing cylinder. A sheet, which is thicker than the first, is in position to pass through the bite of the printing couple, between the lower printing cylinder and the unmarked segment on the large printing cylinder, as the lower printing cylinder makes its third revolution. The third manually adjustable stop has been raised (moved in a counterclockwise direction) by the correct amount to cause the lower printing cylinder to be moved away from the large printing cylinder by the right amount to compensate for the thickness of this sheet, so that as the sheet passes through the bite of the printing couple it will have the correct printing pressure applied to it. The image on the offset blanket on the lower printing cylinder will be printed on the bottom of the sheet, and, if there is also an image on another offset blanket on the unmarked segment on the large printing cylinder, this image will simultaneously be printed on the top surface of the sheet.

Just prior to the next revolution of the lower printing cylinder the relationship of the elements will again be as seen in diagram MM-16.

Alternatively, the feeder control may be set to feed a sheet only to the first revolution of the lower printing cylinder, with no sheet being fed to either the second or third revolutions of the lower printing cylinder. In this case both the second and third manually adjustable stops may be lowered, and set in the position shown for the second adjustable stop in diamgrams MM-16, MM-17, and MM-18. This will then cause the offset blanket on the lower printing cylinder to roll in contact with the printing surfaces on both the segment marked with a line and on the unmarked segment as the lower printing cylinder makes its second and third revolutions. This will transfer two images in two colors to the offset blanket on the lower printing cylinder and these two images will then be printed on the bottom surface of the sheet as the sheet passes through the bite of the printing couple on the first revolution of the lower printing cylinder, between the solidly marked segment and the lower printing cylinder. Simultaneously any image or images on another offset blanket on the solidly marked segment on the large printing cylinder will be printed on the top surface of the sheet.

Diagrams MM-19 through MM-21, taken together, illustrate the case in which sheets of three different thicknesses are fed to successive revolutions of the lower printing cylinder. In the example shown the sheet fed to the second revolution is thicker than that fed to the first and the sheet fed to the third revolution is thicker than that fed to the second.

Diagram MM-19 shows the relationship of the elements just prior to the passage of the first sheet through the bite of the printing couple. The adjustment is similar to that in diagram MM-10, except that the second manually adjustable stop has been raised and the third manually adjustable stop has been raised still farther.

Diagram MM-20 shows the relationship of the elements just prior to the second revolution of the lower printing cylinder. The pivoted limit stop is in alignment with and is contacting the second adjustable stop. The second adjustable stop has been raised by an amount just sufficient to increase the distance between the center of the lower printing cylinder and the fixed center of the large printing cylinder to accommodate the greater thickness of the second sheet.

Diagramm MM-21 shows the relationship of the elements just prior to the third revolution of the lower printing cylinder. The third sheet is in position to pass through the bite of the printing couple and the pivoted limit stop is in alignment with and is contacting the third adjustable stop. The third adjustable stop has been raised by an amount just sufficient to increase the distance between the center of the lower printing cylinder and the fixed center of the large printing cylinder to accommodate the still greater thickness of the third sheet.

At the beginning of the next revolution of the lower printing cylinder the elements will have returned to the positions shown in diagram MM-19.

Diagrams KK-4 through KK-8 are a continuation of the KK series of diagrams of FIG. 7*a* and illustrate, for the 3-R press, various combinations of control cams and control arms with cam followers for lifting selected plate cylinders, of selected plate cylinder modules, out of contact with the printing surfaces in selected work areas on the large printing cylinder.

Diagram KK-4 illustrates an automatic mechanism for the 3-R press (similar to that shown and described for the 2-R press in diagram KK-2) which causes a plate cylinder (shown in position II) to be lifted out of contact with the printing surface in position VIII on the large printing cylinder while also causing it to roll in contact with the printing surfaces in positions VII and IX on the large printing cylinder.

Diagram KK-5 illustrates a case in which two control cams, in two lateral planes, are used, with the control arm for one plate cylinder being aligned with one of the control cams, and the control arm for another plate cylinder being aligned with the other control cam. The plate cylinder shown in position II in diagram KK-5 is lifted out of contact with the printing surface in work area IX on the large printing cylinder but rolls in contact with printing surfaces in work areas VII and VIII on the large printing cylinder. The plate cylinder shown in position IV is lifted out of contact with the printing surface in position VIII on the large printing cylinder but rolls in contact with printing surfaces in positions VII and IX on the large printing cylinder.

Diagram KK-6 illustrates a case in which there are three control cams, in three lateral planes, on the shaft of the large printing cylinder. The control arms for three plate cylinders, in three module mounting positions, are each aligned with a different one of the three control cams. As seen in diagram KK-6, the plate cylinder shown in position II rolls in contact with the printing surface in position IX on the large printing cylinder but is lifted out of contact with printing surfaces in positions VII and VIII on the large printing cylinder. The plate cylinder shown in position III rolls in contact with the printing surface in position VIII on the large printing cylinder but is lifted out of contact with printing surfaces in positions VII and IX on the large printing cylinder. The plate cylinder shown in position IV rolls in contact with the printing surface in position VII on the large printing cylinder but is lifted out of contact with printing surfaces in positions VIII and IX on the large printing cylinder.

Diagram KK-7 illustrates the case in which a plate cylinder, shown in position II, is lifted out of contact with printing surfaces in positions VIII and IX on the large printing cylinder but rolls in contact with a printing surface in postion VII on the large printing cylinder.

Diagramm KK-8 illustrates a case in which the control arm of one plate cylinder, shown in position II, is aligned with a control cam in one lateral plane, on the shaft of the large printing cylinder, just as in diagram KK-7, while the control arm of another plate cylinder, shown in position IV, is aligned with another control cam, in a different lateral plane from the first, on the shaft of the large printing cylinder. The plate cylinder shown in position II is controlled just as is the plae cylinder shown in diagram KK-7. The plate cylinder shown in position IV is lifted out of contact with printing surfaces in positions VII and VIII on the large printing cylinder but rolls in contact with the printing surface in position IX on the large printing cylinder.

It will, of course, be apparent that a wide variety of combinations other than those illustrated are possible. Broadly stated, means are provided so that any plate cylinder, in any of the module mounting positions, may be controlled so that it may roll in contact with any selected printing surface or surfaces in any selected one or more of the work areas on the large printing cylinder, or may roll in contact with all printing surfaces, in all work areas on the large printing cylinder, and/or may be lifted out of contact with any other selected printing surface or surfaces in any other selected work area or areas on the large printing cylinder or may be lifted out of contact with all printing surfaces in all work areas on the large printing cylinder; and each other such plate cylinder may concurrently be so controlled independently of any other plate cylinder, when any number of plate cylinder modules are mounted in the four module mounting positions.

Figure 8B:
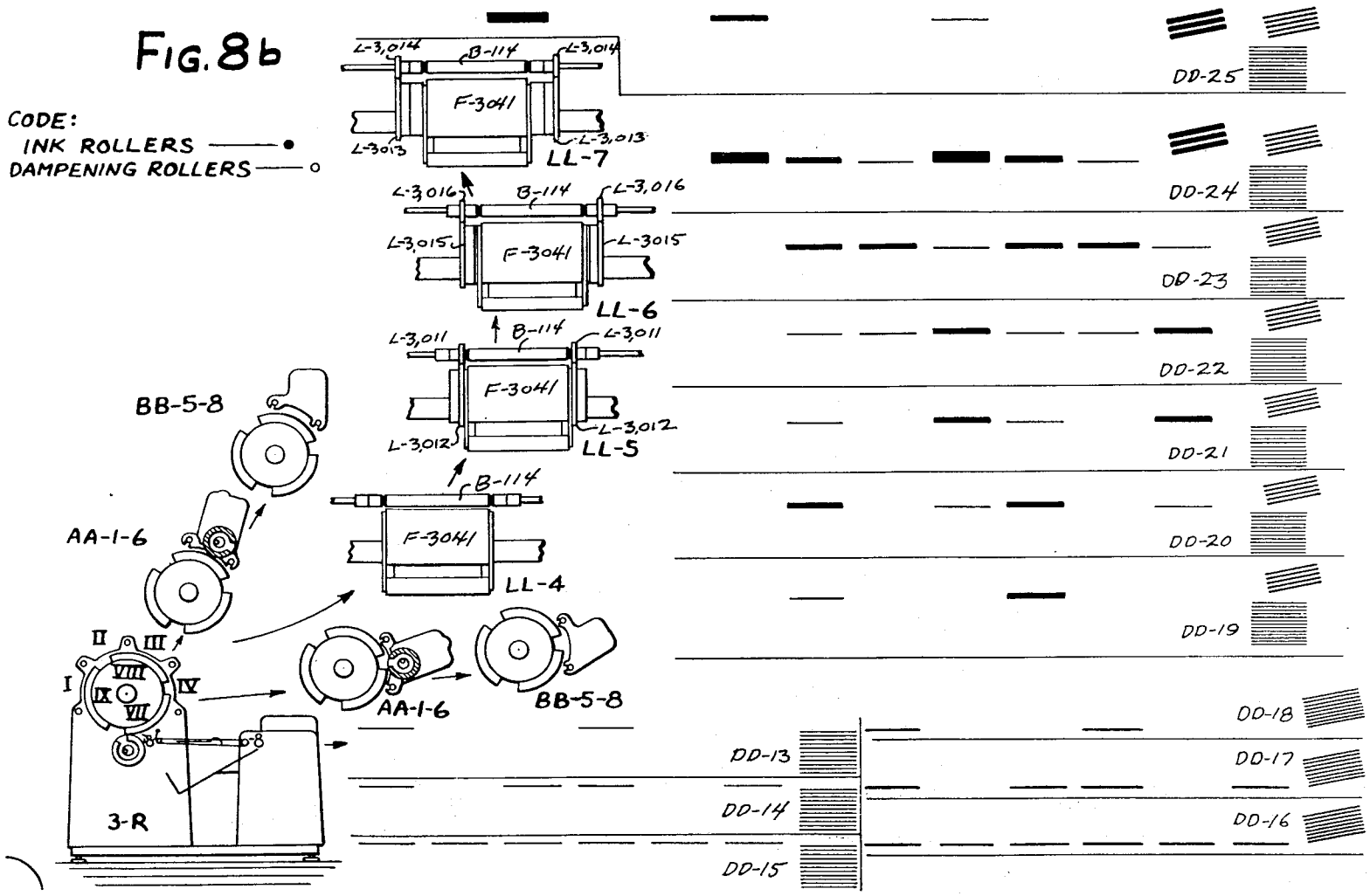

Turning now to FIG. 8*b*, the JJ series of diagrams of FIG. 7*b* have not been repeated or extended since they apply alike to both the 2-R press and the 3-R press.

Extending out from module mounting position III are diagrams illustrating various printing modules, any one of which may be mounted in module mounting position III on the 3-R press.

Diagram AA-1-6 indicates that any of the six plate cylinder modules, AA-1 through AA-6, which may be mounted in position III on the 2-R press, as illustrated in FIG. 7*b*, may also be mounted in mounting position III on the 3-R press with the use of the appropriate mounting bracket, as illustrated.

Diagram BB-5-8 indicates that any of the four ink-/dampening modules BB-5 through BB-8, which corresponds to the four ink/dampening modules BB-1 through BB-4, which may be mounted in position III on the 2-R press, as illustrated in FIG. 7*b*, but with the appropriate side frames for the module for use on the 3-R press (as illustrated), may be mounted in position III on the 3-R press.

Diagram AA-1-6 opposite module mounting position IV indicates that any one of the six plate cylinder modules, AA-1 through AA-6, may be mounted in position IV on the 3-R press with the use of the appropriate mounting bracket.

Diagram BB-5-8 opposite module mounting position IV indicates that any one of the four ink/dampening modules, BB-5 hrough BB-8 (which include the appropriate module side frames for use on the 3-R press) may be mounted at position IV on the 3-R press.

Diagrams LL-4 through LL-7 are a continuation of the LL series of diagrams of FIG. 7*b* and illustrate means by which the form rollers of any ink/dampening module, or of any dampening module, may roll in contact with any selected printing surface in any selected work area on the large printing cylinder of the 3-R press, and may be lifted out of contact with any selected printing surface or surfaces in any selected work area or work areas on the large printing cylinder. Other form rollers of other ink/dampening modules and/or dampening modules are similarly, but independently controlled.

Form roll lifter cams are available for mounting at each end of a segment, and consist of a cam portion and a spacer portion to one side of the cam portion. A separate, additional spacer is available which is equal in width to the total width, of the cam portion and the spacer portion, of the form roll lifter cams.

Cam follower discs are available for mounting at both ends of a form roller, on the form roll shaft. These cam follower discs comprise a disc portion and a spacer portion to one side of the disc portion. Separate, additional spacer collars are available which also mount on the form roll shaft and which are equal in width to the total width, of the cam portion and the spacer portion, of the cam follower discs.

The total width of the form roll lifter cams is equal to the total width of the cam follower discs which in turn is equal to the width of the separate spacers and of the separate spacer collars. The width of the form rollers is equal to the width of the segments.

Diagram LL-4 illustrates the case in which there are no form roll lifter cams at the ends of a segment on the large printing cylinder of the 3-R press and no cam follower discs at the ends of the form rollers of an ink-/dampening, or dampening, module. There are two spacer collars at each end of the form rollers. Any form rollers thus equipped would roll in contact with a printing surface on any segment thus equipped in any work area on the large printing cylinder.

Diagram LL-5 illustrates a case in which form roll lifter cams are mounted at the end of a segment with their cam portions against the ends of the segment and their spacer portions away from the segment. Cam follower discs are mounted at the ends of a form roller, on the form roll shaft, with their disc portions against the ends of the roller and their spacer portions away from the roller. The follower discs are thus aligned with the lifter cams. Additional separate spacer collars are also shown on the form roll shaft at each end of the form roller, but outside the cam follower discs. Any form rollers equipped as in diagram LL-5 will be lifted out of contact with a printing surface on any segment equipped as in diagram LL-5 but will roll in contact with a printing surface on any segments equipped as in diagram LL-4. Similarly, any form rollers equipped as in diagram LL-4 will roll in contact with a printing surface on any segments equipped as in diagrams LL-5 or LL-4.

Diagram LL-6 also illustrates a case in which form roll lifter cams are mounted at the ends of a segment, but the form roll lifter cams have been placed at the opposite ends of the segment from the positions shown in diagram LL-5, with the result that their spacer portions are against the ends of the segment and their cam portions are away from the segment. Cam follower discs are also mounted at the ends of the form roller, on the form roll shaft, but they have each been turned end for end, so that their spacer portions are against the ends of the form roller and their discs portions are away from the roller. The follower discs are thus, again, aligned with the lifter cams but in different lateral planes from diagram LL-5. Additional separate spacer colors are also shown on the form roll shaft at each end of the form roller, but outside the cam follower discs. Any form rollers equipped as in diagram LL-6 will be lifted out of contact with a printing surface on any segments equipped as in diagram LL-6, but will roll in contact with a printing surface on any segments equipped as in diagrams LL-4 or LL-5.

Similarly, any form rollers equipped as in diagrams LL-4 or LL-5 will roll in contact with a printing surface on any segments equipped as in diagrams LL-6 or LL-4.

Diagram LL-7 illustrates another case in which form roll lifter cams are mounted at the ends of a segment. In this case the form roll lifter cams have been mounted at the same ends of the segment as in diagram LL-6, with their cam portions away from the segment, and, in addition, separate additional spacers, equal in width to the total width of the form roll lifter cams, have been added between the ends of the segment and the spacer portions of the form roll lifter cams. Cam follower discs are mounted on the form roll shaft, at the ends of the form roller, with their disc portions away from the roller as in diagram LL-6, and, in addition, separate, additional spacer collars, equal in width to the total width of the cam follower discs, have been mounted on the form roll shaft between the ends of the roller and the spacer portions of the cam follower discs.

The follower discs are thus, again, aligned with the lifter cams, but in a third pair of lateral planes different from both diagrams LL-5 and LL-6. Any form rollers equipped as in diagram LL-7 will be lifted out of contact with a printing surface on any segments equipped as in diagram LL-7, but will roll in contact with a printing surface on any segments equipped as in diagrams LL-4, LL-5 or LL-6.

Similarly, any form rollers equipped as in diagrams LL-4, LL-5 or LL-6 will roll in contact with a printing surface on any segments equipped as in diagrams LL-7 or LL-4.

The separate additional spacers between the form roll lifter cams and the ends of the segment, as shown in diagram LL-7, may be replaced by another pair of form roll lifter cams, arranged as shown in diagram LL-5. The segment would then be equipped with two form roll lifter cams at each end, in two different lateral planes. Any form rollers equipped as in either diagram LL-7 or diagram LL-5 would then be lifted out of contact with a printing surface on any segments so equipped but any form rollers equipped as in diagram LL-4 or LL-6 would roll in contact with a printing surface on any segments so equipped.

Similarly, the separate, additional spacer collars on the form roll shaft, between the cam follower discs and the ends of the form roller, as shown in diagram LL-7, may be replaced by another pair of cam follower discs, arranged either as shown in diagram LL-5, or as shown in diagram LL-6. There will then, in either case, be two sets of cam follower discs at each end of the form roller, in different lateral planes.

When these inner additional cam follower discs are arranged as shown in diagram LL-5, any form rollers thus equipped will be lifted out of contact with a printing surface on any segments equipped as in diagrams LL-5 or LL-7, or equipped with two form roll lifter cams at each end, as described above; but will roll in contact with a printing surface on any segment equipped as in diagrams LL-4 or LL-6.

When these inner additional cam follower discs are arranged as shown in diagram LL-6, any form rollers thus equipped will be lifted out of contact with a printing surface on any segments equipped as in diagrams LL-6 or LL-7, or equipped with two form roll lifter cams at each end, as described above; but will roll in contact with a printing surface on any segments equipped as in diagrams LL-4 or LL-5.

Stated broadly, means are provided so that a form roller or form rollers of any ink/dampening module, or of any dampening module, mounted in any of the four module mounting positions, may be lifted out of contact with any selected printing surface or printing surfaces on any selected segment or segments in any selected work area or work areas on the large printing cylinder and/or may roll in contact with any other selected printing surface or printing surfaces on any other selected segment or segments in any selected work area or work areas of the large printing cylinder; while, concurrently, form rollers of any other ink/dampening module or modules, or dampening module or modules, mounted in any other module mounting position or positions may be similarly selectively, but independently, controlled.

Diagrams DD-13 through DD-25 are a continuation of the DD-6 thru DD-11 series of diagrams of FIG. 7*b* and show various patterns of sheet feeding that may be accomplished with the feeder control mechanism of the 3-R press.

Diagram DD-13 illustrates the case in which only a "pile" feeder is used and sheets are only fed to every third revolution of the lower printing cylinder. Sheets are fed to the first, fourth, seventh, tenth, thirteenth, etc. revolutions, of the lower printing cylinder and no sheets are fed to the second, third, fifth, sixth, eighth, ninth, etc. revolutions of the lower printing cylinder.

Diagram DD-14 illustrates the case in which sheets are fed from a "pile" feeder only and sheets are fed to the first, second, fourth, fifth, seventh, eighth, etc. revolutions of the lower printing cylinder and no sheets are fed to the third, sixth, ninth, etc. revolutions of the lower printing cylinder.

Diagram DD-15 illustrates the case in which sheets are fed from a "pile" feeder only and sheets are fed to every revolution of the lower printing cylinder.

Diagram DD-16 illustrates the case in which sheets are fed from a "bottom" feeder only and sheets are fed to every revolution of the lower printing cylinder.

Diagram DD-17 illustrates the case in which sheets are fed from a "bottom" feeder only and sheets are fed to the first, second, fourth, fifth, seventh, eighth, etc. revolutions of the lower printing cylinder and no sheets are fed to the third, sixth, ninth, etc. revolutions of the lower printing cylinder.

Diagram DD-18 illustrates the case in which sheets are fed from a "bottom" feeder only and sheets are fed to the first, fourth, seventh, tenth, thirteenth, etc. revolutions of the lower printing cylinder and no sheets are fed to the second, third, fifth, sixth, eighth, ninth, etc. revolutions of the lower printing cylinder.

Diagram DD-19 illustrates the case in which sheets are fed from both a "pile" feeder and a "bottom" feeder and sheets are fed from the "pile" feeder to the first, seventh, thirteenth, etc. revolutions of the lower printing cylinder, and sheets are fed from the "bottom" feeder to the fourth, tenth, sixteenth, etc. revolutions of the lower printing cylinder. No sheets are fed to the second, third, fifth, sixth, eighth, ninth, etc. revolutions of the lower printing cylinder.

Diagram DD-20 illustrates the case in which sheets are fed from both a "pile" feeder and a "bottom" feeder and sheets are fed from the "bottom" feeder to the first, fourth, seventh, tenth, etc. revolutions of the lower printing cylinder, and sheets are fed from the "pile" feeder to the third, sixth, ninth, etc. revolutions of the lower printing cylinder. No sheets are fed to the second, fifth, eighth, eleventh, etc. revolutions of the lower printing cylinder.

Diagram DD-21 illustrates the case in which sheets are fed from both a "pile" feeder and a "bottom" feeder and sheets are fed from the "pile" feeder to the first, fourth, seventh, tenth, etc. revolutions of the lower printing cylinder, and sheets are fed from the "bottom" feeder to the third, sixth, ninth, etc. revolutions of the lower printing cylinder. No sheets are fed to the second, fifth, eighth, eleventh, etc. revolutions of the lower printing cylinder.

Diagram DD-22 illustrates the case in which sheets are fed from both a "pile" feeder and a "bottom" feeder and sheets are fed from the "pile" feeder to the first, second, fourth, fifth, seventh, eighth, etc. revolutions of the lower printing cylinder, and sheets are fed from the "bottom" feeder to the third, sixth, ninth, etc. revolutions of the lower printing cylinder.

Diagram DD-23 illustrates the case in which sheets are fed from both a "pile" feeder and a "bottom" feeder and sheets are fed from the "bottom" feeder to the first, second, fourth, fifth, seventh, eighth, etc. revolutions of the lower printing cylinder, and sheets are fed from the "pile" feeder to the third, sixth, ninth, etc. revolutions of the lower printing cylinder.

Alternatively, in diagrams DD-19 through DD-23, both sheets may be fed from two "pile" feeders, or both may be fed from two "bottom" feeders but the operation of the feeder control mechanism is the same and the sequence of sheets fed is the same.

Diagram DD-24 illustrates the case in which sheets are fed from a "pile" feeder and a "bottom" feeder and a third "auxiliary" feeder and sheets are fed from the "auxiliary" feeder to the first, fourth, seventh, etc. revolutions of the lower printer cylinder, sheets are fed from the "bottom" feeder to the second, fifth, eighth, etc. revolutions of the lower printing cylinder and sheets are fed from th "pile" feeder to the third, sixth, ninth, etc. revolutions of the lower printing cylinder.

Diagram DD-25 illustrates the case in which sheets are fed from a "pile" feeder, a "bottom" feeder and a third "auxiliary" feeder and sheets are fed from the "auxiliry" feeder to the first, tenth, nineteenth, etc., revolutions of the lower printing cylinder, sheets are fed from the "bottom" feeder to the fourth, thirteenth, twenty-second, etc. revolutions of the lower printing cylinder and sheets are fed from the "pile" feeder to the seventh, sixteenth, twenty-fifth, etc. revolutions of the lower printing cylinder. No sheets are fed to the second, third, fifth, sixth, eighth, ninth, etc. revolutions of the lower printing cylinder.

Figure 8C:
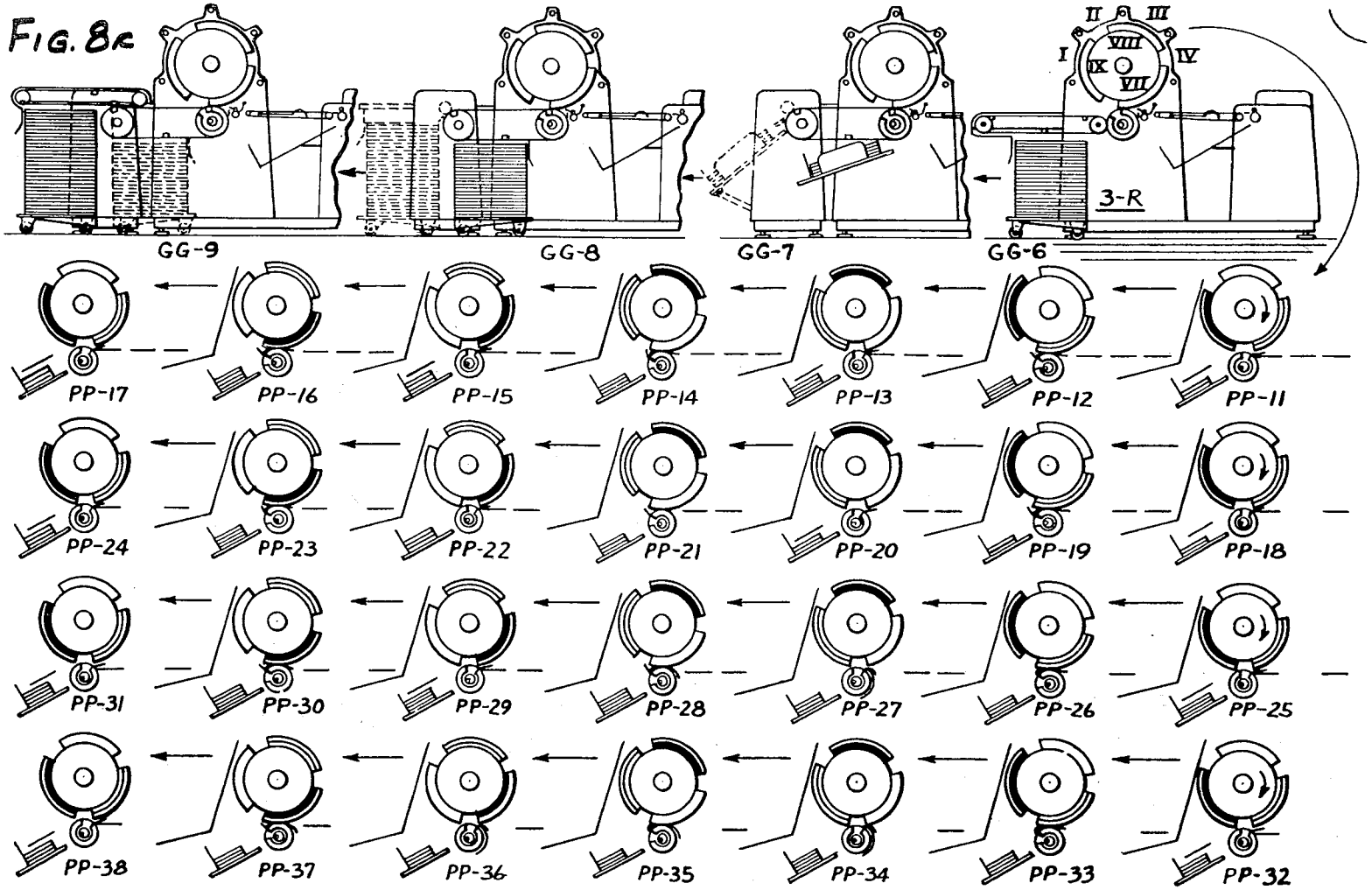

Turning to FIG. 8*c*, diagrams GG-6 through GG-9 are a continuation of the GG series of diagrams in FIG. 7*c*.

The delivery arrangement illustrated in diagram GG-1 of FIG. 7*c* may be used without change in either the 2-R press of the 3-R press.

The delivery arrangement shown in diagram GG-6 is similar to that shown and described diagram GG-2 of FIG. 7*c* with the exception that on the 3-R press, as shown in diagram GG-6, there are three chain carried delivery gripper bars in the separate chain delivery mechanism instead of two, since the number of such delivery gripper bars, in all cases, is equal to a whole multiple the number of work areas on the large printing cylinder.

The "extension" chain delivery mechanism as shown and described in diagram GG-2 of FIG. 7*c* may be used witout change with the separate chain delivery mechanism illustrated in diagram GG-6 and for that reason is not shown again.

The delivery arrangement shown in diagram GG-7 is similar to that shown and described in diagram GG-3 of FIG. 7*c* with the exception that on the 3-R press, as shown in diagram GG-7, there are three delivery gripper bars carried by the encircling chain delivery mechanism, since the number of such delivery gripper bars, in all cases, is equal to a whole multiple of the number of work areas on the large printing cylinder.

Similarly, diagram GG-8 shows a delivery mechanism for the 3-R press which is similar to that shown for the 2-R press in diagram GG-4 of FIG. 7*c*, the only difference being that on the 3-R press, as shown in diagram GG-8, there are three chain carried delivery gripper bars in the encircling chain delivery mechanism, since the number of such delivery gripper bars, in all cases, is equal to a whole multiple of the number of work areas on the large printing cylinder.

Diagram GG-9 shows a delivery mechanism for the 3-R press similar to that shown in diagram GG-5 of FIG. 7*c* for the 2-R press. Again, the only difference is that on the 3-R press, as shown in diagram GG-9, there are three chain carried delivery gripper bars in the encircling chain delivery mechanism and three chain carried delivery gripper bars in the "extension" chain delivery mechanism, since the number of such encircling delivery gripper bars, in all cases, is equal to a whole multiple of the number of work areas on the large printing cylinder, and this is the preferred number of delivery gripper bars for this type of "extension" delivery mechanism, on the 3-R press.

Diagrams PP-11 through PP-38 are a continuation of the PP series of diagrams of FIG. 7*c*, and illustrate the sequence of actions related to the opening and closing of the cylinder grippers, as controlled by the mechanism for causing a sheet to be carried through the bite of the printing couple once or more than once, for a variety of situations.

Each group of these diagrams illustrates the sequence of actions for three revolutions of the lower printing cylinder, or for one revolution of the large printing cylinder, on the 3-R press. One of the segments on the large printing cylinder is marked with a light line, one is marked with a heavy line, and the other is unmarked. References to "degrees" refer to degrees of rotation of the lower printing cylinder.

Diagrams PP-11 through PP-17, taken together, illustrate the case in which a sheet is fed to each revolution of the lower printing cylinder and each sheet passes through the bite of the printing couple one time.

Diagram PP-11 shows three sheets approaching the lower printing cylinder in proper spaced relationship so that one sheet will reach the cylinder grippers on each revolution of the lower printing cylinder. The cylinder grippers are open to receive the leading edge of the first sheet. A previously printed sheet is falling into the delivery tray. As the cylinders revolve from the position of diagram PP-11 to the position of diagram PP-12 the grippers close and carry the leading edge of the sheet through the bite of the printing couple.

Diagram PP-12 shows the cylinder grippers open to release the leading edge of the first sheet. The first sheet is passing through the bite of the printing couple and is being printed. The following sheets have moved forward and maintained their spaced relationship. The previous sheet has settled into position on top of the sheets in the delivery tray.

In diagram PP-13 the lower printing cylinder has rotated approximately 240° from its position in diagram PP-12. The cylinder grippers have opened again and the leading edge of the second sheet has entered the grippers. The first sheet is falling into position in the delivery tray.

Diagram PP-14 shows the positions of the elements approximately 120° after diagram PP-13 and 360° after diagram PP-12. The grippers have closed and carried the leading edge of the second sheet through the bite of the printing couple, and are open again to release the leading edge of the second sheet. The second sheet is passing through the bite of the printing couple and is being printed. The first sheet has settled on top of the sheets in the delivery tray.

Diagram PP-15 shows the relationship of the elements approximately 240° after diagram PP-14 and 360° after diagram PP-13. The cylinder grippers have opened again and the leading edge of the third sheet has entered the grippers. The second sheet is falling into the delivery tray.

Diagram PP-16 shows the relationship of the elements approximately 120° after diagram PP-15, the grippers have carried the leading edge of the third sheet through the bite of the printing couple and have opened again to release the leading edge of the third sheet. The third sheet is passing through the bite of the printing couple and is being printed. The second sheet has settled into position on top of the sheets in the delivery tray.

Diagram PP-17 shows the positions of the elements approximately 240° after diagram PP-16 and 360° after diagram PP-15. The cylinder grippers have again opened and the leading edge of a fourth sheet has entered the grippers. The third sheet is falling into position on top of the sheets in the delivery tray. Diagram PP-17 shows the relationship of the elements at the completion of three revolutions of the lower printing cylinder, or one revolution of the large printing cylinder, from diagram PP-11. The process is repeated as the press continues to run.

Diagrams PP-18 through PP-24, taken together, illustrate the case in which a first sheet is fed to the first revolution of the lower printing cylinder, no sheet is fed to the second revolution of the lower printing cylinder, and a second sheet is fed to the third revolution of the lower printing cylinder; and in which both sheets pass through the bite of the printing couple one time.

Diagram PP-18 shows the cylinder grippers open, and the leading edge of the first sheet has entered the bite of the grippers. There is no sheet in position, behind the first one, to reach the grippers on the next revolution of the lower printing cylinder, but there is a second sheet in position, following the first sheet, and timed to reach the grippers on the third revolution of the lower printing cylinder. A previously printed sheet is falling into the delivery tray.

Diagram PP-19 illustrates the positions of the elements approximately 120° after diagram PP-18. The grippers have closed and carried the leading edge of the first sheet through the bite of the printing couple and are open again to release the leading edge of the sheet. The first sheet is passing through the bite of the printing couple and is being printed. The following sheets continue their movement toward the bite of the printing couple, maintaining the spaced relationship previously described. The previously printed sheet has settled onto the top of the sheets in the delivery tray.

Diagram PP-20 shows the relationship of the elements approximately 240° after diagram PP-19 and 360° after diagram PP-18. The grippers have opened again to receive a sheet, but no sheet is in position to enter the grippers. There is a second sheet in position, however, to reach the grippers on the next revolution of the lower printing cylinder, and a third sheet, immediately following that one. The first sheet is falling into position on top of the sheets in the delivery tray.

Diagram PP-21 illustrates the relationship of the elements approximately 120° after diagram PP-20 and 360° after diagram PP-19. The grippers have closed and passed through the bite of the printing couple, and the grippers have now opened again but no sheet will be delivered since none was present. On this revolution of the lower printing cylinder the lower printing cylinder may roll in contact with a printing surface on the unmarked segment on the large printing cylinder. The second sheet is in position to reach the grippers on the next revolution of the lower printing cylinder and there is a third sheet immediately following it. The first sheet has settled on top of the sheets in the delivery tray.

Diagram PP-22 illustrates the relationship of the elements approximately 240° after diagram PP-21 and 360° after diagram PP-20. The cylinder grippers have again opened to receive a sheet and the leading edge of the second sheet has entered the grippers. There is a third sheet, immediately following, which will reach the grippers on the next revolution of the lower printing cylinder, but there is no sheet immediately following the third. The lower printing cylinder has completed its rolling contact with the unmarked segment on the large printing cylinder and any image on a printing surface on that segment has been transferred to the printing surface on the lower printing cylinder.

Diagram PP-23 illustrates the relationship of the elements approximately 120° after diagram PP-22 and 360° after diagram PP-21. The grippers have closed and carried the leading edge of the second sheet through the bite of the printing couple and have opened again to release the second sheet. The second sheet is passing through the bite of the printing couple. There is a third sheet immediately following it, in position to reach the grippers on the next revolution of the lower printing cylinder, there is no sheet in the next position but there is a fourth sheet in the position following that.

Diagram PP-24 illustrates the relationship of the elements approximately 240° after diagram PP-23 and 360° after diagram PP-22. The second sheet has passed through the bite of the printing couple and is falling into position on top of the sheets in the delivery tray. The cylinder grippers have again opened to receive a sheet and the leading edge of the third sheet has entered the bite of the grippers. The lower printing cylinder has completed three revolutions, the large printing cylinder has completed one revolution, and the relationship of the elements has returned to that shown in diagram PP-18. The process repeats itself as the press continues to operate.

Diagrams PP-25 through PP-31, taken together, illustrate the case in which a first sheet is fed to the first revolution of the lower printing cylinder, no sheet is fed to the second revolution of the lower printing cylinder, and a second sheet is fed to the third revolution of the lower printing cylinder; and in which the first sheet is carried through the bite of the printing couple two times.

Diagram PP-25 illustrates the relationship of the elements at the beginning of this cycle. The cylinder grippers are open to receive a sheet and the leading edge of the first sheet has entered the grippers. A previously printed sheet is falling into position on top of the sheets in the delivery tray.

Diagram PP-26 illustrates the relationship of the elements approximately 120° after diagram PP-25. The grippers have closed on the leading edge on the first sheet and carried it through the bite of the printing couple. The first sheet is in the process of passing through the bite of the printing couple for the first time. The grippers have not opened to release the sheet but have retained their grip on the leading edge of the sheet in order to carry the sheet around the lower printing cylinder, and through the bite of the printing couple a second time. The previously printed sheet has settled into position on top of the sheets in the delivery tray.

Diagram PP-27 illustrates the relationship of the elements approximately 240° after diagram PP-26, and 360° after diagram PP-25. The grippers have returned to the position, in the rotation of the lower printing cylinder, where they would ordinarily open to receive another sheet, but no other sheet is presented to the grippers and the grippers do not open, but retain their grip on the leading edge of the first sheet, which is being carried around the lower printing cylinder to be passed through the bite of the printing couple a second time.

Diagram PP-28 illustrates the relationship of the elements approximately 120° after diagram PP-27 and 360° after diagram PP-26. The grippers have carried the leading edge of the first sheet through the bite of the printing couple for the second time and have opened to release the sheet. The first sheet is in the process of making its second passage through the bite of the printing couple. The second sheet has moved forward and is in position to reach the cylinder grippers on the next revolution of the lower printing cylinder. There is a third sheet immediately following the second, but there is no sheet following immediately after the third.

Diagram PP-29 shows the relationship of the elements approximately 240° after diagram PP-28, and 360° after diagram PP-27. The grippers have again opened to receive a sheet and the leading edge of the second sheet has entered the grippers. There is a third sheet immediately following the second, and in position to reach the grippers on the next revolution of the lower printing cylinder. There is no sheet immediately following the third. The first sheet, which passed through the bite of the printing couple two times, is dropping into position on top of the previously printed sheets in the delivery tray.

Diagram PP-30 shows the relationship of the elements approximately 120° after diagram PP-29, and 360° after diagram PP-28. The grippers have closed on the leading edge of the second sheet and carried it through the bite of the printing couple and have now opened to release the sheet. The second sheet is in the process of passing through the bite of the printing couple. There is a third sheet immediately following the second and in position to reach the grippers on the next revolution on the lower printing cylinder. There is no sheet in the space immediately following the third sheet but there is a fourth sheet in the space following that. The first sheet, which passed through the bite of the printing couple two times, has settled into position on top of the sheets in the delivery tray.

Diagram PP-31 illustrates the relationship of the elements approximately 240° after diagram PP-30, and 360° after diagram PP-29. The lower printing cylinder has completed three revolutions, the large printing cylinder has completed one revolution, and the grippers are again open to receive a sheet. The third sheet has entered the bite of the grippers. There is no sheet in position to reach the grippers on the next revolution of the lower printing cylinder, but a fourth sheet is in position to reach them on the second following revolution. The second sheet is falling into position on top of the sheets in the delivery tray. The elements have returned to the positions which they occupied in diagram PP-25, and the process repeats itself as the press continues to operate.

Diagrams PP-32 through PP-38, taken together, illustrate the case in which a first sheet is fed to the first revolution of the lower printing cylinder, but no sheet is fed to the secod revolution, and no sheet is fed to the third revolution. The first sheet is carried through the bite of the printing couple three times.

Diagram PP-32 shows the cylinder grippers open to receive a sheet and the leading edge of the first sheet is in the bite of the grippers. A previously printed sheet is falling into position on top of the sheets in the delivery tray.

Diagram PP-33 shows the relationship of the elements approximately 120° after diagram PP-32. The grippers have closed and carried the leading edge of the first sheet through the bite of the printing couple. The grippers are in the position where they would normally open to release the sheet. However, they have not opened but have retained their grip on the leading edge of the sheet to carry it around the lower printing cylinder and through the bite of the printing couple again. The sheet is in the process of passing through the bite of the printing couple for the first time. The previously printed sheet has settled on top of the sheets in the delivery tray. There is no sheet in position to reach the grippers on the next revolution of the lower printing cylinder, nor on the second following revolution of the lower printing cylinder. However, there is a sheet in position following that, timed to reach the grippers on the third following revolution of the lower printing cylinder.

Diagram PP-34 shows the relationship of the elements approximately 240° after diagram PP-33 and 360° after diagram PP-32. The grippers have returned to the position in which they would normally be open to receive another sheet, but no other sheet is present and the grippers have not opened, but have retained their grip on the leading edge of the first sheet, which they have carried around the lower printing cylinder and will now carry through the bite of the printing couple for the second time.

Diagram PP-35 illustrates the relationship of the elements approximately 120° after diagram PP-34 and 360° after diagram PP-33. The grippers have again, for the second time, reached the position where they would normally open to release a sheet but again they have not opened but have retained their grip on the leading edge of the sheet to once more carry it around the lower printing cylinder. The sheet is passing through the bite of the printing couple for the second time. There is no sheet in position to reach the grippers on the next revolution of the lower printing cylinder, but there is a sheet in position to reach the grippers on the second following revolution of the lower printing cylinder.

Diagram PP-36 illustrates the relationship of the elements approximately 240° after diagram PP-35 and 360° after diagram PP-34. The grippers have again reached the point where they would normally open to receive another sheet, but again no other sheet is present and the grippers again have not opened but have retained their grip on the leading edge of the sheet and will now carry it through the bite of the printing couple for a third time.

Diagram PP-37 illustrates the relationship of the elements approximately 120° after diagram PP-36 and 360° after diagram PP-35. The leading edge of the sheet has been carried through the bite of the printing couple for the third time and the grippers have opened to release the sheet. The first sheet is making its third passage through the bite of the printing couple. There is a second sheet, in position following the first sheet, which will reach the grippers on the next revolution of the lower printing cylinder.

Diagram PP-38 shows the relationship of the elements approximately 240° after diagram PP-37 and 360° after diagram PP-36. The grippers have opened to receive a sheet and the leading edge of the second sheet is in the bite of the grippers. There are no sheets in position to reach the grippers on either of the next two following revolutions of the lower printing cylinder. The first sheet is falling into position on the top of the sheets in the delivery tray. The lower printing cylinder has completed three revolutions, the large printing cylinder has completed one revolution and the elements have returned to the positions in which they were shown in diagram PP-32. The process repeats itself as the press continues to operate.

The drive for the 3-R press is the same as illustrated in the HH series of diagrams on the 2-R press, in diagram HH-1 or diagram HH-2 in FIG. 7*c* and, therefore, no additional diagrams of the HH series are shown in FIG. 8*c*.

Figure 7D:
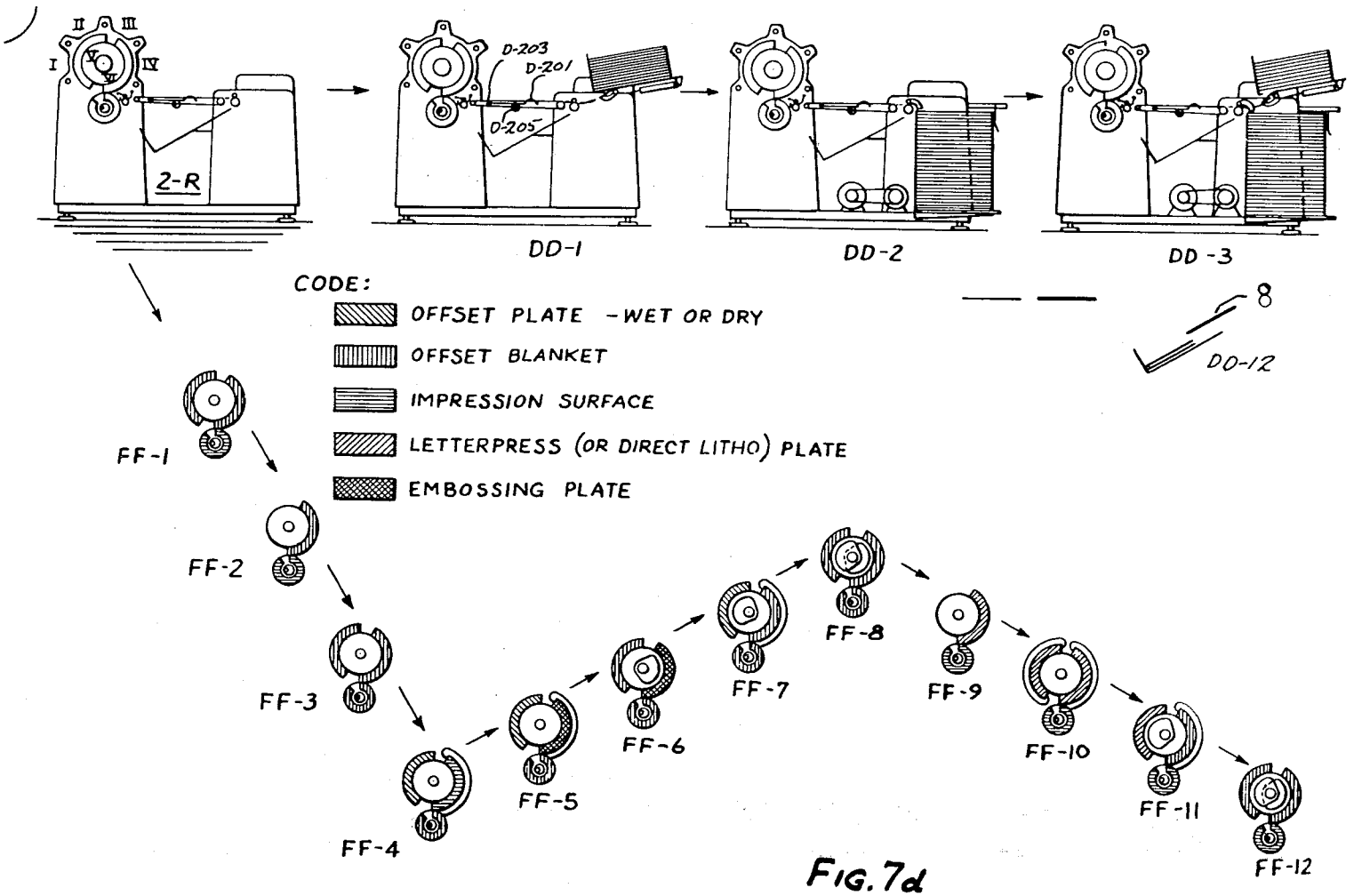
Figure 8D:
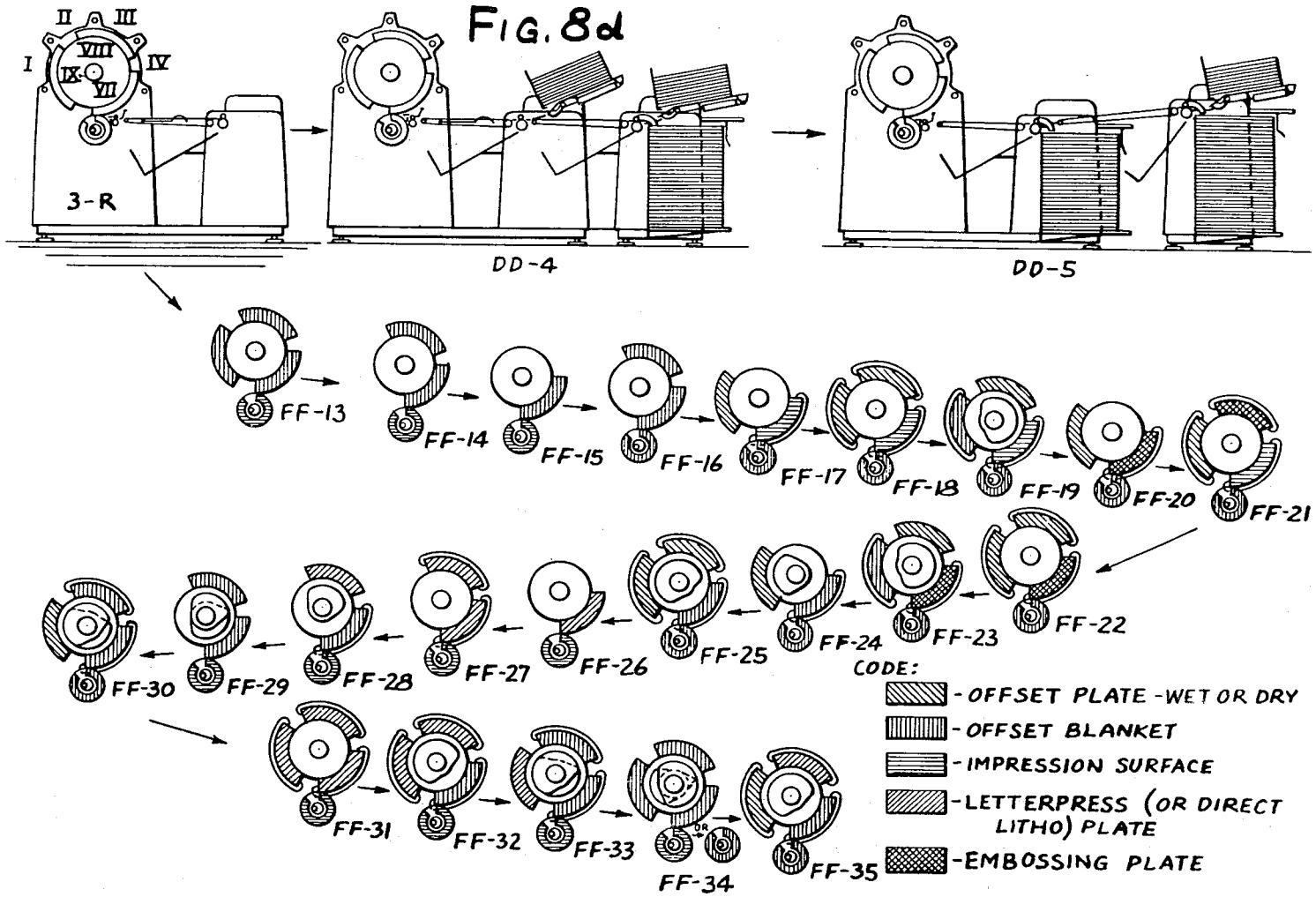

Turning now to FIG. 8*d*, diagrams DD-4 and DD-5 are a continuation of the DD series of diagrams shown in Figure 7*d* which illustrate various feeder combinations available for use with the press.

Any of the feeders, or feeder combinations, illustrated and described in diagrams DD-1 through DD-3 of FIG. 7*d*, for the 2-R press, may also be used with the 3-R press. Diagrams DD-4 and DD-5 illustrate two other feeder combinations which may be used with the 3-R press.

Diagram DD-4 illustrates a combination in which there are two "bottom" feeders and one "pile" feeder. Sheets may be fed from the "pile" feeder alone, from one of the "bottom" feeders alone, from the "pile" feeder and one "bottom" feeder in combination, from the two "bottom" feeders in combination, or from all three feeders in combination; all under the control of the feeder control mechanism, and as illustrated and described in the EE series of diagrams.

Diagram DD-5 illustrates the 3-R press equipped with two "pile" feeders and one "bottom" feeder. In this case, sheets may be fed from one "pile" feeder alone, from the "bottom" feeder alone, from the "bottom" feeder and a "pile" feeder in combination, from the two "pile" feeders in combination, or from all three feeders in combination; all under the control of the feeder control mechanism, and as illustrated and described in the EE series of diagrams.

The function and operation of the combined double sheet eliminator and "miss" detector, as illustrated and described in connection with diagram DD-12 in FIG. 7*d*, applies alike to both the 2-R press and the 3-R press and is, therefore, not repeated in FIG. 8*d*.

Diagrams FF-13 through FF-35 illustrate a number of the more important combinations of printing surfaces which may be mounted in the work area on the lower printing cylinder and in various work areas on the large printing cylinder (by means of removable segments or other devices for mounting printing surfaces on the large printing cylinder), together with various combinations of control cams for lifting selected plate cylinders out of contact with printing surfaces in selected work areas on the large printing cylinder, and of form roll lifter cams for lifting selected form rollers out of contact with printing surfaces in selected work areas on the large printing cylinder.

Diagram FF-13 illustrates a case in which the lower printing cylinder carries an "impression" or platen surface and in which there are offset blankets on each of three segments, in each of the three work areas, on the large printing cylinder. There are no cams to lift either plate cylinders or form rollers out of contact with printing surfaces in any of the work areas on the large printing cylinder.

Diagram FF-14 illustrates a similar arrangement, but in which there are only two segments, carrying offset blankets, in only two of the work areas on the large printing cylinder, and there is no printing surface in the third work area.

Diagram FF-15 illustrates a similar arrangement, but with only one segment, carrying an offset blanket, in only one work area on the large printing cylinder and there are no printing surfaces in the other two work areas on the large printing cylinder.

Diagram FF-16 illustrates a case in which there are offset blankets on two segments in two of the work areas on the large printing cylinder, and there is no printing surface in the third work area; and the lower printing cylinder carries another offset blanket. There are no cams for lifting either plate cylinders or form rollers out of contact with printing sufaces in any of the work areas on the large printing cylinder.

Diagram FF-17 illustrates a case in which the lower printing cylinder carries an offset blanket and there are two segments, in two of the work areas on the large printing cylinder. There is an offset plate (either wet or dry) on one of these segments and an "impression" or platen surface on the other. The segment carrying the "impression" or platen surface is equipped with form roll lifter cams to lift form rollers equipped with cam follower discs in alignment with these lifter cams out of contact with the printing surface on this segment. There is no printing surface in the third work area on the large printing cylinder.

Diagram FF-18 llustrates a case in which the lower printing cylinder carries an offset blanket and there are segments in all three work areas on the large printing cylinder. Two of these segments carry first and second offset plates (either wet or dry) and the third carries an "impression" or platen surface. All three segments carry form roll lifter cams. The lifter cams carried by the first offset plate segment are in different lateral planes from the lifter cams carried by the second offset plate segment so that one set of form rollers will be lifted out of contact with the first offset plate but contact the second, and another set of form rollers will contact the first plate, but be lifted out of contact with the second. The "impression" or platen segment carries two sets of form roll lifter cams, one set is in alignment with the lifter cams on the first offset plate segment and the other set is in alignment with the lifter cams on the second offset plate segment so that both sets of form rollers will be lifted out of contact with the "impression" or platen surface on this segment.

Diagram FF-19 illustrates a case in which the lower printing cylinder carries an offset blanket and there are three segments in the three work areas on the large printing cylinder. One of these segments carries an "impression" or platen surface, one carries an offset blanket, and one carries an offset plate (wet or dry). The segment carrying the offset blanket and the segment carrying the "impression" or platen surface both carry form roll lifter cams. These lifter cams are in the same planes and lift the form rollers which roll in contact with the offset plate out of contact with the printing surfaces on both these segments which have lifter cams. There is a plate cylinder control cam on the shaft of the large printing cylinder, which lifts any plate cylinders, mounted in any of the module mounting positions, out of contact with both the offset plate segment and the "impression" or platen segment, but allows them to contact the offset blanket on the offset blanket segment on the large printing cylinder.

Diagram FF-20 illustrates a case in which the lower printing cylinder carries an offset blanket and there are two segments mounted in two work areas on the large printing cylinder. One of these segments carries an offset plate (wet or dry) and the other segment carries an embossing plate. The segment carrying the embossing plate also has form roll lifter cams to lift the form rollers that contact the offset plate out of contact with the embossing plate. There is no printing surface in the third work area on the large printing cylinder.

Diagram FF-21 illustrates a case in which the lower printing cylinder carries an offset blanket and there are three segments in the three work areas on the large printing cylinder. One of the segments carries an offset plate, one segment carries an "impression" or platen surface, and one segment carries an embossing plate. There are form roll lifter cams on the offset plate segment to keep form rollers which contact the embossing plate out of contact with the offset plate; and there are form roll lifter cams (in different lateral planes) on the embossing plate segment to keep form rollers which contact the offset plate out of contact with the embossing plate; and there are two sets of form roll lifter cams on the impression segment to keep both sets of form rollers out of contact with the impression segment. Alternatively the lifter cams may be left off the offset plate segment and the embossing plate segment and only a single set of lifter cams may be mounted on the impression segment. The same form rollers will then contact both the offset plate and the embossing plate but be lifted out of contact with the impression segment. In another alternative, lifter cams in the same lateral planes are mounted on both the embossing plate segment and the impression segment but none are mounted on the offset plate segment. The form rollers that contact the offset plate segment are then lifted out of contact with both the embossing plate segment and the impression segment.

Diagram FF-22 illustrate a case in which the lower printing cylinder carries an offset blanket and there are three segments in the three work areas on the large printing cylinder. One of these segments carries an embossing plate and the other two segments carry first and second offset plates (wet or dry). There are form roll lifter cams on each of the two offset plate segments, but the cams at the ends of the first offset plate segment are in different planes from the cams at the ends of the second offset plate segment, so that a first set of form rollers may contact the first offset plate, but be lifted out of contact with the second offset plate and a second set of form rollers may contact the second offset plate, but be lifted out of contact with the first offset plate. The embossing plate may carry one or two sets of form roll lifter cams at its ends so that one or both sets of form rollers may be lifted out of contact with the embossing plate.

Diagram FF-23 illustrates a case in which there is an offset blanket on the lower printing cylinder and there are three segments in the three work areas on the large printing cylinder. One of the segments carries an embossing plate, one segment carries an offset plate (wet or dry) and the other segment carries an offset blanket. There are form roll lifter cams, in the same lateral planes, on both the offset blanket segment and the embossing plate segment, to lift the form rollers which contact the offset plate out of contact with the other two segments. There is a plate cylinder control cam on the shaft of the large printing cylinder, which lifts any plate cylinders, mounted in any of the module mounting positions, out of contact with both the offset plate segment and the embossing plate segment, while allowing them to roll in contact with the offset blanket segment.

Diagram FF-24 illustrates a case in which there is an offset blanket on the lower printing cylinder and there are two segments in two of the work areas on the large printing cylinder. One of the segments carries an offset blanket and the other segment carries an offset plate (wet or dry). The offset blanket segment carries form roll lifter cams so that form rollers which roll in contact with the offset plate are lifted out of contact with the offset blanket segment. There is a plate cylinder control cam which lifts any plate cylinders, mounted in any of the module mounting positions, out of contact with the offset plate segment, while allowing them to roll in contact with the offset blanket segment. There is no printing surface in the third work area on the large printing cylinder.

Diagram FF-25 illustrates a case in which there is an offset blanket on the lower printing cylinder and there are three segments in the three work areas on the large printing cylinder. One of the segments carries an offset blanket and the other two segments carry first and second offset plates (wet or dry). There are form roll lifter cams at the ends of each of the two offset plate segments, but in different lateral planes so that form rollers that contact the first offset plate will not contact the second, and form rollers that contact the second offset plate will not contact the first. There are two sets of form roll lifter cams at the ends of the offset blanket segment so that neither set of form rollers will contact the offset blanket segment. There is a plate cylinder control cam on the shaft of the large printing cylinder which lifts any plate cylinders, mounted in any of the module mounting positions, out of contact with both of the offset plate segments, but allows them to roll in contact with the offset blanket segment.

Diagram FF-26 illustrates a case in which the lower printing cylinder carries an "impression" or platen surface and there is one segment (or other image carrying device) in one of the work areas on the large printing cylinder. The one "segment" carries a letterpress plate or a direct litho plate. There are no form roll lifter cams nor plate cylinder control cams. There are no printing surfaces in the other two work areas on the large printing cylinder.

Diagram FF-27, illustrates a case in which the lower printing cylinder carries an "impression" or platen surface and there are two segments (or other image carrying devices) in two work areas on the large printing cylinder. The two "segments" carry first and second letterpress (or direct litho) plates. Both "segments" have form roll lifter cams at their ends, but in different lateral planes so that form rollers that roll in contact with the printing surface on the first "segment" are lifted out of contact with the printing surface on the second "segment" and form rollers that roll in contact with the printing surface on the second "segment" are lifted out of contact with the printing surface on the first "segment". There is no printing surface in the third work area on the large printing cylinder.

Diagram FF-28 illustrates a case in which the lower printing cylinder carries an "impression" or platen surface and there are two segments (or one segment and one other image carrying device) in two of the work areas on the large printing cylinder. One "segment" carries a letterpress (or direct litho) plate and the other segment carries an offset blanket. The offset blanket segment carries form roll lifter cams at its ends so that form rollers that roll in contact with the letterpress plate will be lifted out of contact with the offset blanket. There is a plate cylinder control cam on the shaft of the large printing cylinder that lifts any plate cylinders, mounted in any of the module mounting positions, out of contact with the letterpress, but allows them to roll in contact with the offset blanket. There is no printing surface in the third work area on the large printing cylinder.

Diagram FF-29 illustrates a case in which the lower printing cylinder carries an "impression" or platen surface and there are two segments mounted in two work areas on the large printing cylinder. The two segments carry first and second offset blankets. There are two plate cylinder control cams on the shaft of the large printing cylinder, in two different lateral planes, so that plate cylinders, in any of the module mounting positions, may be selectively controlled so that certain of them roll in contact with the first offset blanket segment but are lifted out of contact with the second offset blanket segment, whereas others roll in contact with the second offset blanket segment, but are lifted out of contact with the first offset blanket segment. Still other selected plate cylinders (or a cylinder) may roll in contact with both the first and second offset blanket segments. There is no printing surface in the third work area on the large printing cylinder.

Diagram FF-30 illustrates a case in which the lower printing cylinder carries an offset blanket and there are three segments in the three work areas on the large printing cylinder. Two of these segments carry first and second offset blankets and the third segment carries an offset plate (wet or dry). The two offset blanket segments both carry form roll lifter cams at their ends, and these cams are in the same lateral planes so that the form rollers that contact the offset plate on the third segment will be lifted out of contact with both of the offset blanket segments. There are first and second plate cylinder control cams on the shaft of the large printing cylinder, in two different lateral planes. The first control cam lifts any plate cylinders, mounted in any of the module mounting positions, and which have cam followers aligned with the first control cam, out of contact with both the second offset blanket segment and the offset plate segment but allows them to roll in contact with the first offset blanket segment. The second control cam lifts any plate cylinders, mounted in any of the module mounting positions, and which have cam followers aligned with the second control cam, out of contact with both the first offset blanket segment and the offset plate segment but allows them to roll in contact with the second offset blanket segment. Alternatively, a third plate cylinder control cam, in a third lateral plane, may be added to allow a selected plate cylinder, or cylinders, to roll in contact with both offset blanket segments, but be lifted out of contact with the offset plate segment.

Diagram FF-31 illustrates a case in which the lower printing cylinder carries an "impression" or platen surface and there are three segments (or other image carrying devices) in the three work areas on the large printing cylinder. Each of these three "segments" carries a letterpress (or direct litho) plate and each "segment" carries form roll lifter cams at its ends. Each of these three sets of form roll lifter cams are in different lateral planes so that three sets of form rollers, each with two sets of cam follower discs at their ends, will each roll in contact with the printing surface on one of these "segments" and be lifted out of contact with the printing surface on the other two "segments", so that a different set of form rollers contacts the printing surface on each of the three "segments".

Diagram FF-32 illustrates a case in which the lower printing cylinder carries an "impression" or platen surface and there are three segments (or one segment and two other image carrying devices—or two segments and one other image carrying device) in the three work areas on the large printing cylinder. Two of the "segments" carry letterpress (or direct litho) plates and the third segment carries an offset blanket. Each of the letterpress "segments" has form roll lifter cams at its ends and these cams are in different lateral planes so that each letterpress plate is contacted by a different set of form rollers, but is not contacted by the form rollers contacting the other plate. The offset blanket segment carries two sets of form roll lifter cams at its ends so that both sets of form rollers are lifted out of contact with the offset blanket segment. There is a plate cylinder control cam on the shaft of the large printing cylinder that lifts any plate cylinders, mounted in any of the module mounting positions, out of contact with both of the letterpress plate "segments", but allows them to roll in contact with the offset blanket segment.

Diagram FF-33 illustrates a case in which the lower printing cylinder carries an "impression" or platen surface and there are three segments (or two segments and one other image carrying device) in the three work areas on the large printing cylinder. One "segment" carries a letterpress (or direct litho) plate and the other two segments carry first and second offset blankets. There are form roll lifter cams at the ends of both of the offset blanket segments and these lifter cams are in the same lateral planes so that form rollers which contact the letterpress plate, may be lifted out of contact with both of the offset blanket segments. There are first and second plate cylinder control cams on the shaft of the large printing cylinder in two different lateral planes. The first control cam lifts any plate cylinders, mounted in any of the module mounting positions, and having cam followers aligned with the first control cam, out of contact with both the second offset blanket segment and the letterpress plate "segment", but allows them to roll in contact with the first offset blanket segment. The second control cam lifts other plate cylinders, mounted in other module mounting positions, and having cam followers aligned with the second control cam, out of contact with both the first offset blanket segment and the letterpress plate "segment", but allows them to roll in contact with the second offset blanket segment. Alternatively, a third plate cylinder control cam, in a third lateral plane, may be added to allow a selected plate cylinder, or cylinders, to roll in contact with both offset blanket segments but be lifted out of contact with the letterpress plate "segment".

Diagram FF-34 illustrates a case in which the lower printing cylinder carries either an "impression" or platen surface, or, alternately, an offset blanket, and there are three segments in the three work areas on the large printing cylinder. These three segments carry first, second and third offset blankets. There are first, second and third plate cylinder control cams, in three lateral planes, on the shaft of the large printing cylinder, so that plate cylinders, mounted in the various module mounting positions, may have cam followers aligned in at least one instance with the first of these control cams, and in at least another instance with the second of these control cams, and in at least another instance with the third of these control cams, so that at least one plate cylinder may roll in contact with each offset blanket segment but be lifted out of contact with the other two offset blanket segments, in each case. Alternatively, the control cams and followers may be arranged to cause any plate cylinder to contact any offset blanket segment or segments selectively and/or to be lifted out of contact with any offset blanket segment or segments selectively.

Diagram FF-35 illustrates a case in which the lower printing cylinder carries an offset blanket and there are three segments (or two segments and one other image carrying device) in the three work areas on the large printing cylinder. One segment carries an offset blanket, one segment carries an offset plate (wet or dry), and the third "segment" carries a letterpress (or direct litho) plate. Both the offset plate segment and the letterpress plate "segment" carry form roll lifter cams at their ends, but in different lateral plates, so that form rollers that contact the letterpress plate may be lifted out of contact with the offset plate and, conversely, form rollers that contact the offset plate may be lifted out of contact with the letterpress plate. The offset blanket segment carries two sets of form roll lifter cams at its ends so that both sets of form rollers may be lifted out of contact with the offset blanket segment. There is a plate cylinder control cam on the shaft of the large printing cylinder that lifts any plate cylinders, mounted in any of the module mounting positions, out of contact with both the offset plate segment and the letterpress plate "segment", but allows them to roll in contact with the offset blanket segment.

In the above descriptions, the term "segment" includes any imaging device, or any device for carrying a printing surface, in a work area on the large printing cylinder.

While FIGS. *7a*, *7b*, *7c* and *7d* together with FIGS. 8*a*, 8*b*, 8*c* and 8*d* illustrate certain major functional areas of the press under a variety of circumstances, the descriptions of various adjustments and combinations of elements will suggest still other functional combinations to those skilled in the art. A review of the choices illustrated of printing modules available for mounting in the four module mounting positions, together with the range of choices illustrated of different combinations of printing surfaces in the various work areas on the cylinders of the printing couple (as illustrated in the FF series of diagrams), combined with the flexibility provided by the feeder control mechanism (as illustrated in the DD series of diagrams) and by the gripper control mechanism (as illustrated in the PP series of diagrams), makes it apparent that the press may be used for an extremely wide variety of printing, or printing and collating, functions. These eight figures also illustrate how appropriate mechanical supporting functions, and devices to perform "back-up" mechanical functions, from the simplest to the most complex, have been provided in major functional areas of the press, to compliment the wide variety of basic press component combinations.

It will be apparent that configurations of the press may be assembled, from standardized components, to perform single simple, or specialized, printing functions; and that other configurations may be assembled, also from standardized components, which may be adjusted by the user to perform a very wide range of different printing functions.

The manufacturer is thereby enabled to assemble, from a group of standardized press components, an extremely wide range of press configurations, suitable for use, in some cases, for highly specialized printing functions, and, in other cases, for broad ranges of printing functions, to meet the varied requirements of users in various areas of the graphic arts.

The range of the configurations that may be provided is so great that even in this field, with its great and growing diversity of functional requirements, it will be possible to assemble, from the standardized components, a configuration almost ideally suited to most individual users specialized requirements.

FIGS. 9*a* through 9*t* and 10*a* through 10*f* show in diagrammatic form a number of typical printing functions which may be performed on various embodiments of the press of this invention. Each function diagram shows the major elements of the press involved in the performance of the particular printing function illustrated and shows the part that each of these press elements plays in the performance of that printing function. Any embodiment of the press that includes the press elements shown in a particular function diagram may be adjusted to perform that printing function, even though the embodiment may also contain other press elements not required in the performance of that particular printing function. Those press elements not required in the performance of a particular printing function may simply be rendered inoperative whenever their use is not required.

Figures 9A, 9B, 9C, 9D:
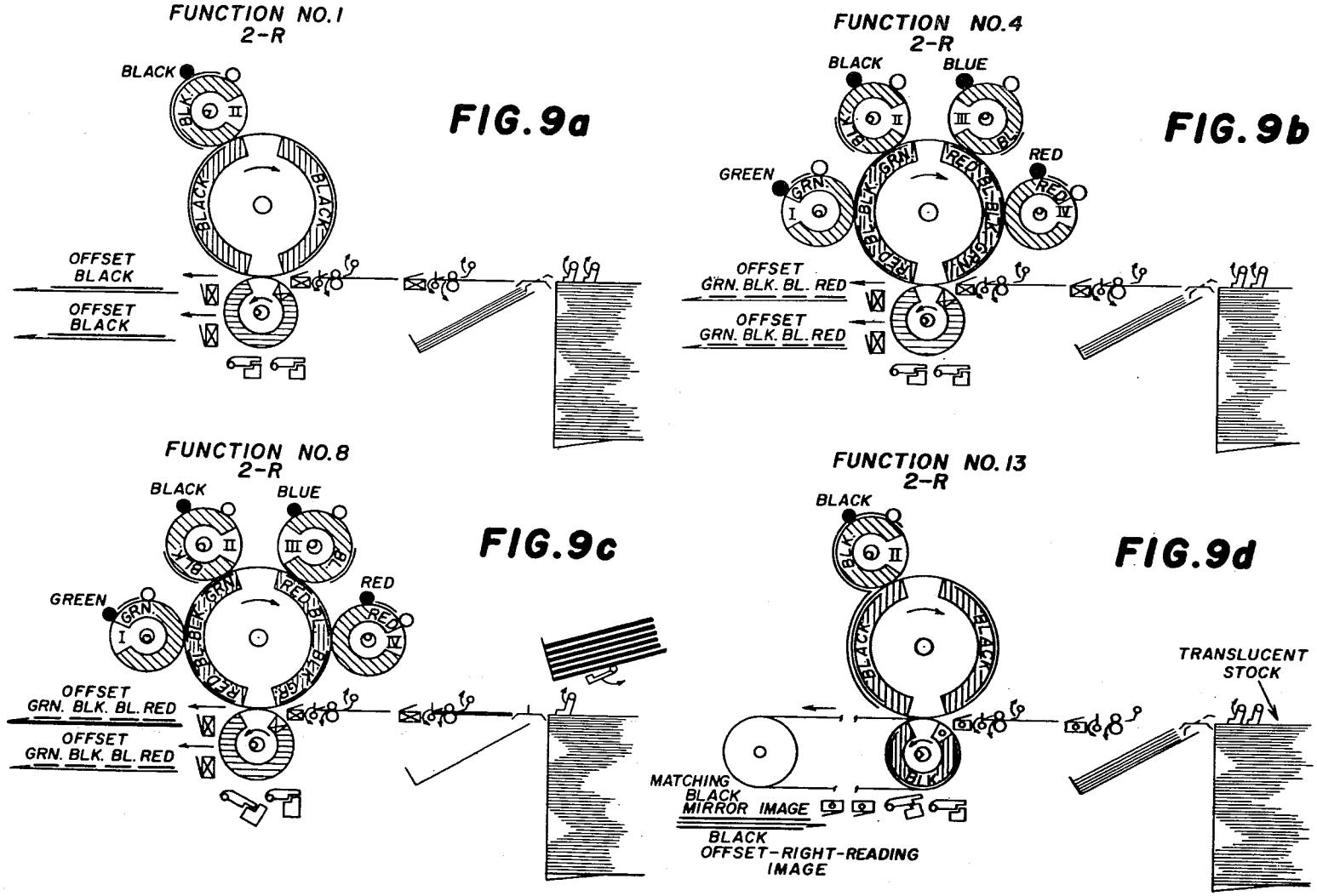
Figure 9J:
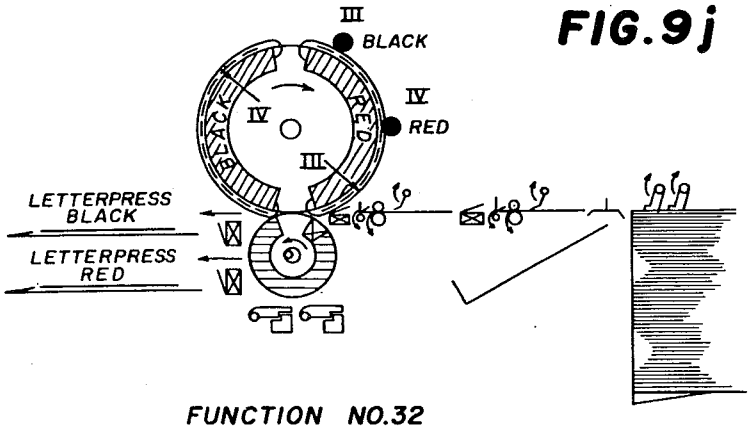
Figure 9I:
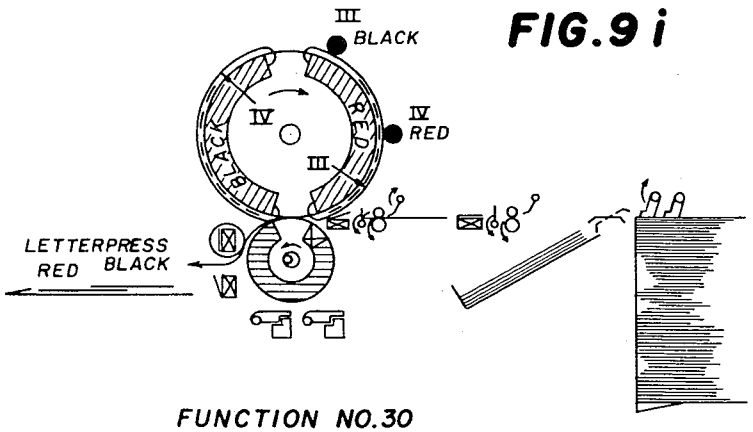
Figure 9M:
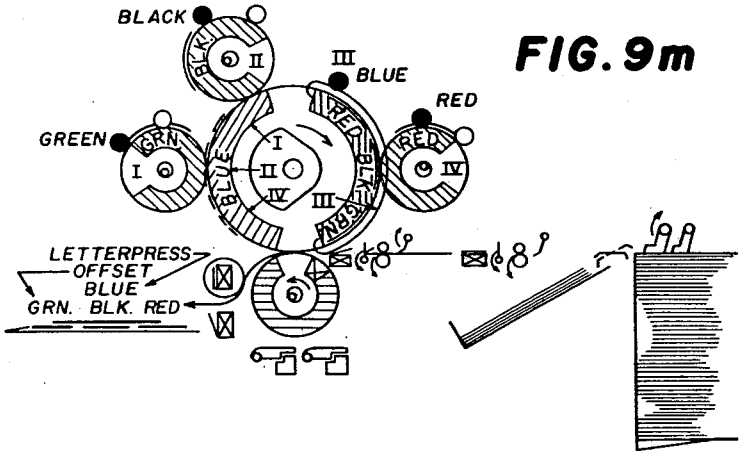
Figure 9K:
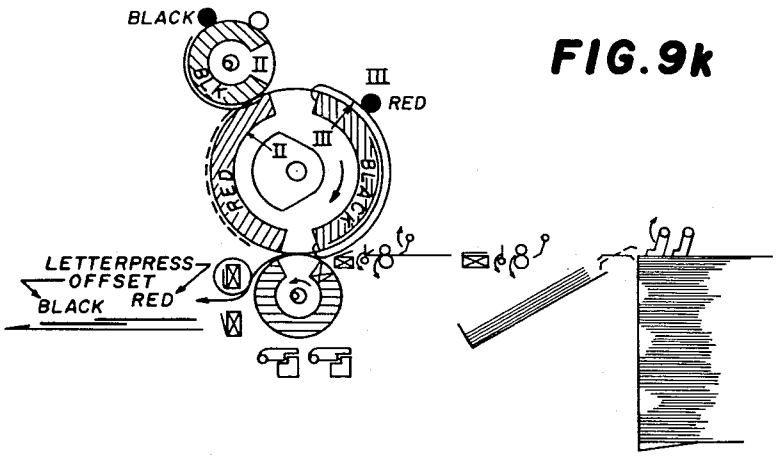
Figure 9P:
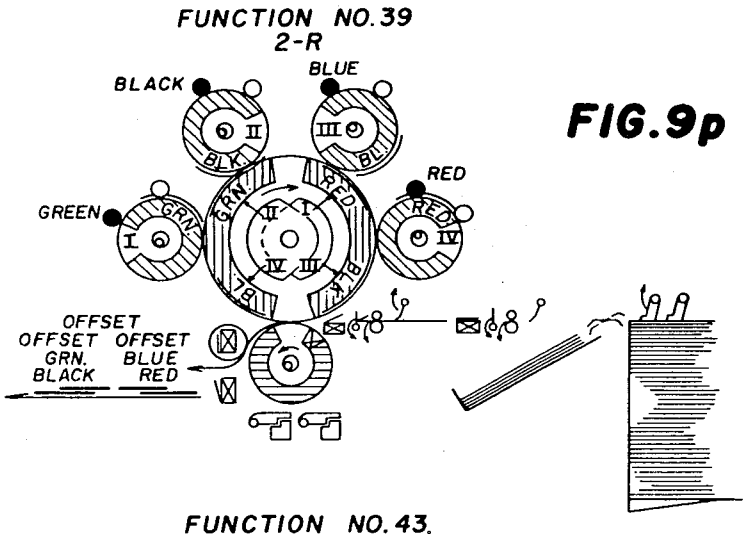
Figure 9R:
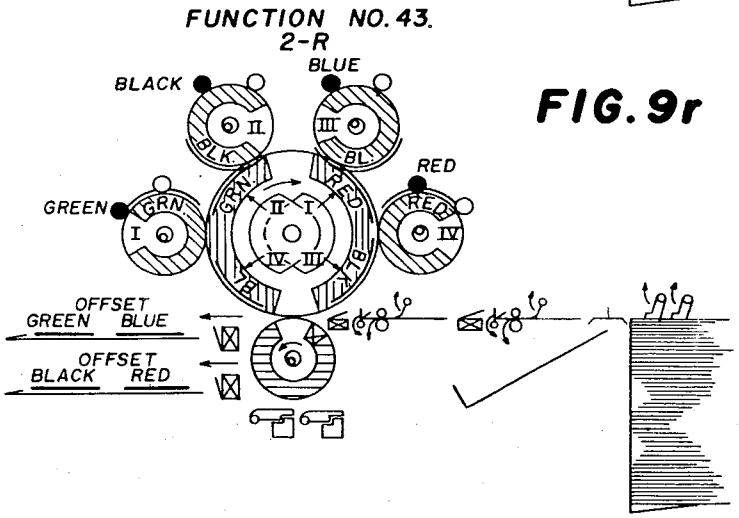
Figure 9N:
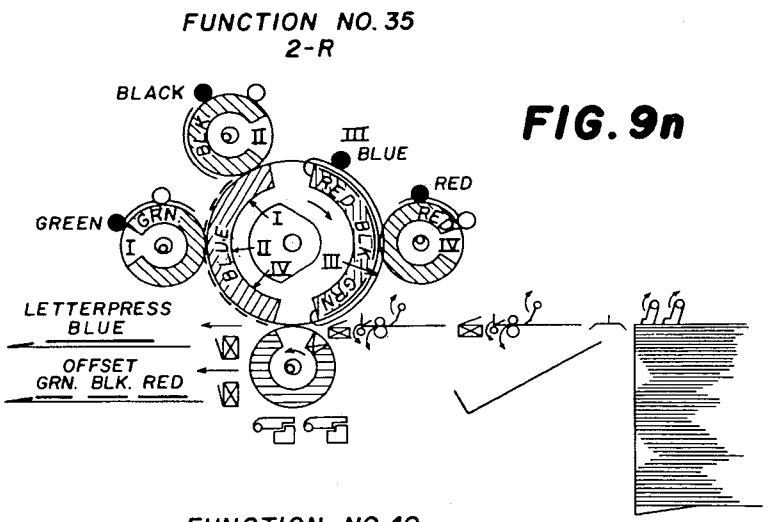
Figure 9Q:
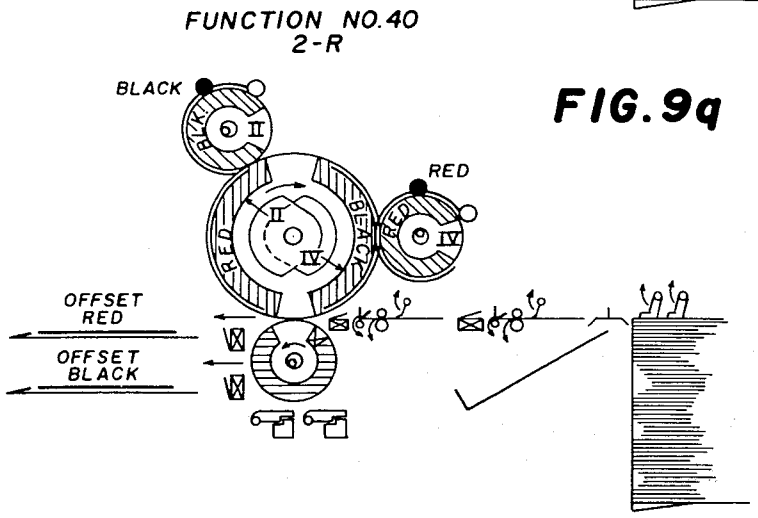
Figures 9S, 9T, 10A, 10B:
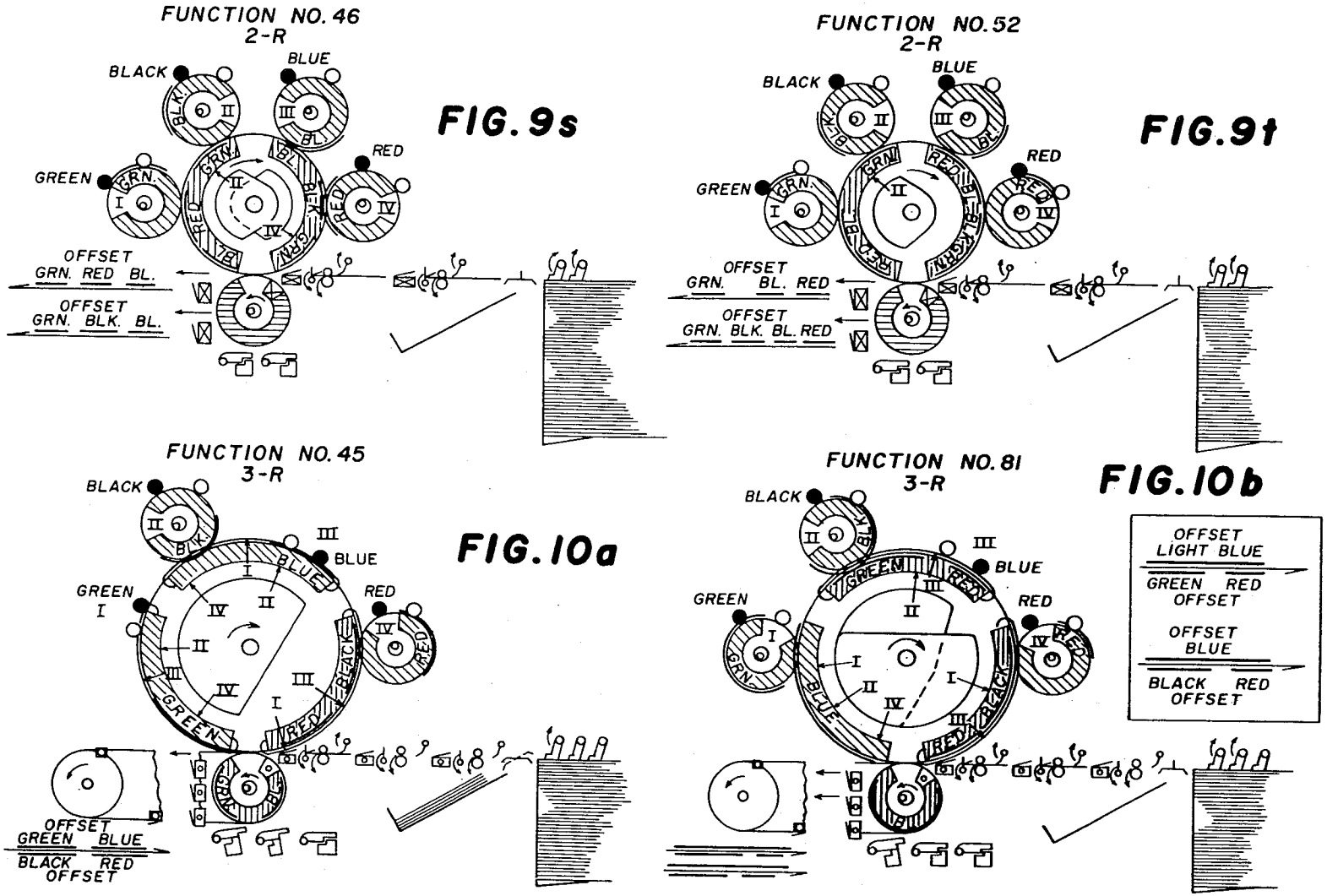

Out of more than 52 printing functions that may be performed on the 2-R press, 18 representative printing functions have been selected, and are illustrated in diagrammatic form in FIGS. 9*a* through 9*t*.

Any printing function that can be performed on the 2-R press can also be performed on the 3-R press. Six additional representative printing functions that may be performed on the 3-R press are illustrated in diagrammatic form in FIGS. 10*a* through 10*f* (out of a total of more than 129 printing functions that may be performed on the 3-R press). The over 129 printing functions that may be performed on the 3-R press includes 52 printing functions that may also be performed on the 2-R press.

To make these function diagrams more easily understood, all plate cylinder modules shown in position I are shown as carrying green ink, all plate cylinder modules shown in position II are shown as carrying black ink, all plate cylinder modules shown in position III are shown as carrying blue ink and all plate cylinder modules shown in position IV are shown as carrying red ink. This also illustrates one way in which users of press embodiments with printing modules mounted in two or more positions may take advantage of one of the design features of the press. By leaving specific colors of ink in specific modules, it is possible not only to run multicolor jobs involving these particular colors, but also to run jobs involving a lesser number, or a single one, of the colors standardized upon. By simply using the particular module or modules carrying the required color or colors in the production of the job at hand, the need to clean up the ink rollers and change inks in order to run jobs in any one, or in other combinations, of the colors standardized upon may be avoided.

It will be apparent, of course, that any color of ink may be used in any of the printing modules in any of the module mounting positions, and the same color ink may be used in more than one of the printing modules when more than one image is to be printed in the same color. Thus in all cases where different images are shown as being printed in different colors, they may also be printed in the same color if desired.

The function diagram shown in FIG. 9*a* illustrates the operation of the 2-R press in printing by wet offset, on one side of a sheet of paper, in one color.

This function diagram shows diagrammatically a plate cylinder module in position II, with an offset plate on the plate cylinder. Black ink on the ink rollers (shown diagrammatically as a solid circle) is applied to a right-reading image on the plate, and dampening rollers (shown diagrammatically as an open circle) also contact the plate. There are two segments on the large printing cylinder, one in each of the work areas, and each segment carries an offset blanket. Each offset blanket, successively, rolls in contact with the plate cylinder in position II, and has deposited on it an inked "mirror" image of the right-reading image on the plate. The lower printing cylinder acts as a platen to press each sheet against the surface of one of the blankets as the sheets pass through the bite of the printing couple. (The same cross hatching code as that used in FIGS. 7*d* and 8*d* is used to show the type of printing surface in each work area on each of the printing cylinders.)

The inked image on the plate is shown diagrammatically as a line extending part way around the plate cylinder above the surface of the plate; the inked image transferred to each offset blanket is shown diagrammatically as a line extending part way around each segment below the surface of the blanket; and the inked image printed on each sheet (which in this case is transferred, or offset, from the surface of one of the blankets) is shown diagrammatically as a line above each delivered sheet, extending part of the length of the sheet.

At the right hand side of the function diagram in FIG. 9*a* there is a "pile" feeder, shown diagrammatically, and at the top of the pile there is a diagrammatic showing of two suction feet for separating sheets from the pile. (Each of these function diagrams illustrates what takes place during one complete revolution of the large printing cylinder and, therefore, in these function diagrams, certain press elements which operate, or may operate, once for each revolution of the lower printing cylinder are shown diagrammatically as many times as there are work areas on the large printing cylinder; and these repetitious small diagrams, within each function diagram, illustrate the action or position of these individual press elements on successive revolutions of the lower printing cylinder. The number of sheets shown in the delivery position in each function diagram represents the number of sheets delivered for each revolution of the large printing cylinder. Since the function diagram in FIg. 9*a* shows the 2-R press, there are two work areas on the large printing cylinder and the lower printing cylinder makes two revolutions for each revolution of the large printing cylinder. Therefore, in this function diagram certain press elements which operate, or may operate, once for each revolution of the lower printing cylinder are shown twice, and these small repetitious diagrams illustrate the action taken, or the mechanical function performed, by each of these press elements, on each successive revolution of the lower printing cylinder.)

Thus, in FIG. 9*a* the two suction feet at the top of the pile of sheets in the "pile" feeder are there for the purpose of indicating the action taken by the suction "foot" on the two successive revolutions which the lower printing cylinder makes during one revolution of the large printing cylinder. The arrow on the suction foot at the left indicates that the suction "foot" operates to separate a sheet from the top of the pile on the first revolution of the lower printing cylinder and the arrow on the suction foot at the right indicates that the suction "foot" operates to separate a sheet from the top of the pile on the second revolution of the lower printing cylinder.

Just to the left in the diagram is the deflector plate, shown in full and in dotted line positions, which, together with the sheets shown in the tray for receiving rejects, below, indicates diagrammatically that the double sheet eliminator mechanism operates to eject any but single sheets from the path of sheets being fed to the stop fingers of the press.

Moving again to the left in FIG. 9*a* the series of small diagrams nearest to the bite of the printing couple shows diagrammatically that on the first revolution of the lower printing cylinder the first sheet is fed to the stop fingers with its original top surface face-up (this is shown by the presence of the sheet and the half arrow at the leading edge of the sheet), the detector finger moves to detect the presence or absence of a sheet (as indicated by the arrow) and, after the sheet has been registered, the feed rolls operate to advance the sheet into the cylinder grippers and, as they do so, the stop fingers move out of the path of the sheet (as indicated by the arrows) and the cylinder grippers are open to receive the sheet. (The open gripper is shown diagrammatically.) The duplicate series of diagrams, just to the right, shows the action of these same elements on the second revolution of the lower printing cylinder. In this case, on the second revolution of the lower printing cylinder, a second sheet is fed to the stop fingers with its original top surface face-up, the detector finger moves to detect the presence or absence of a sheet and, after the sheet has been registered, the feed rolls operate to advance the sheet into the cylinder grippers and, as they do so, the stop fingers move out of the path of the sheet and the cylinder grippers are open to receive the sheet. The position of the cylinder grippers in the lower printing cylinder is indicated diagrammatically by the X in the square at the leading edge of the work area on the lower printing cylinder. A corresponding X identifies the cylinder grippers in the series of small diagrams just described.

The eccentric mounting of the shaft of the lower printing cylinder is shown diagrammatically, and the two small diagrams below the lower printing cylinder illustrate diagrammatically the mechanism for controlling the distance between the fixed center of the large printing cylinder and the center of the lower printing cylinder, and thereby controlling the pressure between the lower printing cylinder and each of the segments on the large printing cylinder, independently. The one of these small diagrams at the right illustrates the setting during the first revolution of the lower printing cylinder and the one at the left illustrates the setting during the second revolution of the lower printing cylinder. In this case the two settings are the same since sheets of the same thickness are passing through the bite of the printing couple on both revolutions of the lower printing cylinder. The fact that there may be minor differences in these pressure settings to compensate for differences in the thicknesses of the two offset blankets on the two segments on the large cylinder is not shown in these diagrams.

To the left of the lower printing cylinder, the lower series of diagrams illustrates diagrammatically that the cylinder grippers open to release the first sheet at the delivery position after they have carried its leading edge through the bite of the printing couple on the first revolution of the lower printing cylinder. The arrow shows that a sheet is delivered on the first revolution of the lower printing cylinder. The first sheet is shown with a right-reading image printed by offset, in black ink, on its top surface. The half arrow at the leading edge of the sheet shows diagrammatically that the sheet is delivered with its original top surface face-up.

The upper series of diagrams to the left of the lower printing cylinder illustrate that the cylinder grippers open to release the second sheet at the delivery position on the second revolution of the lower printing cylinder. The arrow shows that a sheet is delivered on the second revolution of the lower printing cylinder. The second sheet is shown with a right-reading image printed by offset, in black ink, on its top surface. The half arrow at the leading edge of the sheet shows that the sheet is delivered with its original top surface face-up.

This function diagram, in total, thus illustrates diagrammatically the operation of the 2-R press in printing one sheet on one side, in a single color, by wet offset, for each revolution of the lower printing cylinder, or two such identical sheets for each revolution of the large printing cylinder.

If the sheets are to be printed by dry offset the operation is the same except that the dampening rollers are omitted.

If this printing function is performed on the 3-R press, the operation is similar and one sheet is fed to each revolution of the lower printing cylinder as described above; but there are three blankets, on three segments, in the three work areas on the large printing cylinder; and the lower printing cylinder makes three revolutions, and three identical sheets are printed and delivered, for each revolution of the large printing cylinder.

The function diagram in FIG. **9*b* illustrates the operation of the 2-R press in printing four non-overlapping colors, on one side of a sheet, by wet offset, with one sheet being delivered for each revolution of the lower printing cylinder (i.e., two sheets are delivered for each revolution of the large printing cylinder.) The operation is similar to that shown and described in FIG. 9*a*** with the exception that there are four plate cylinder modules (one in each of the four module mounting positions and each carrying a different color ink) with each plate cylinder carrying an offset plate with a different non-overlapping right-reading image, which rolls in contact successively with each of the blankets carried by each of the segments in the two work areas on the large printing cylinder. As the large printing cylinder revolves, in the direction shown by the arrow, the plate cylinder shown in position I first deposits a green "mirror" image on each blanket successively, the plate cylinder mounted in position II then deposits a non-overlapping black "mirror" image on each of the blankets successively, the plate cylinder mounted in position III then deposits a non-overlapping blue "mirror" image on each of the blankets successively, and the plate cylinder mounted in position IV finally deposits a non-overlapping red "mirror" image on each of the blankets successively. A sheet is fed to each revolution of the lower printing cylinder. Each sheet is pressed against one of the blankets (which carry identical four color "mirror" images) as it passes through the bite of the printing couple, and identical right-reading images, in four non-overlapping colors, are thus printed on each sheet successively. (For purposes of convenience in the function diagrams the green image is shown in the first quarter of the first plate, the black image in the second quarter of the second plate, the blue image in the third quarter of the third plate, and the red image in the fourth quarter of the fourth plate. In actual practice, however, each image may be in any area, or in all areas of the plate, so long as the images do not actually overlap each other.)

In this, and in all of the other function diagrams herein, all other elements of the operation of the press which are illustrated, but not specifically described, are in conformity with the explanations given with respect to previously described function diagrams.

The function diagram in FIG. **9*c*** illustrates the operation of the 2-R press in printing and concurrently collating two different sheets of different thickness, and/or of different color, with identical four color, non-overlapping images, printed by wet offset, on one side of each sheet. In this function diagram, sheets of two different thicknesses, one from the "pile" feeder and one from the "bottom" feeder are fed alternately to alternate revolutions of the lower printing cylinder. Each of the sheets is thus printed on its top surface with the same four non-overlapping right-reading images in four colors; and the sheets as delivered have thus been concurrently printed and collated. The operation is similar to that shown and described in FIGS. 9*a* and 9*b* except that both a "pile" and a "bottom" feeder are used and the suction foot on the "pile" feeder feeds a sheet to the first revolution of the lower printing cylinder and the suction foot of the "bottom" feeder feeds a sheet to the second revolution of the lower printing cylinder. The vertical bar on the deflector plate for the double sheet eliminator, together with the fact that no sheets are shown in the tray for receiving rejects, below, is a diagrammatic indication that in this instance, in which sheets are concurrently printed and collated, both the "miss" detector and the double sheet eliminator are used together, and if either feeder feeds more than a single sheet, or if either feeder misses (or fails to feed), then, in either case, the sheet deflector mechanism operates to deflect both any sheets fed to that revolution and any sheets fed to the next revolution of the lower printing cylinder, so that, in either case, one complete "set" of two sheets fails to pass through the bite of the printing couple, thereby retaining the proper order of the printed and collated sheets in the receiving hopper.

A sheet from the "pile" feeder is shown in position against the stop fingers, fed to the first revolution of the lower printing cylinder, and a thicker sheet from the "bottom" feeder is shown in position against the stop fingers, fed to the second revolution of the lower printing cylinder. The small diagram on the right below the lower printing cylinder indicates that the pressure between the lower printing cylinder and the first blanket on the large printing cylinder is appropriate to the thickness of the first sheet, and the small diagram on the left below the lower printing cylinder indicates that the pressure between the lower printing cylinder and the second blanket on the large printing cylinder is appropriate to the greater thickness of the second sheet, with the two pressure settings having been made independently, based on the different thicknesses of the two sheets being fed to alternate revolutions of the lower printing cylinder. At the delivery end of the press the first sheet delivered is shown as being the sheet that came from the "pile" feeder, and above it the second sheet delivered is shown as being the thicker sheet that came from the "bottom" feeder.

The function diagram in FIG. 9*d* illustrates the operation of the 2-R press in printing matching right-reading and "mirror" images, in perfect register, on both the front and the back of a translucent sheet, to form a single image of maximum opacity for use in later copying and duplicating processes. A plate cylinder module is shown in position II. The plate cylinder carries a wet offset plate and black ink is applied to a right-reading image on this plate. This plate rolls in contact successively with each of two blankets, on segments in the two work areas on the large printing cylinder, and the image is transferred to each of these two blankets successively, where it then appears as an inked mirror image of the image on the plate, in each case. The lower printing cylinder also carries an offset blanket, and on one revolution of the lower printing cylinder it rolls in contact with one of the offset blankets on the large printing cylinder, without paper being interposed. This causes the inked mirror image on this blanket on the large printing cylinder (shown diagrammatically as two lines, one above and one below the surface of the segment, to indicate the double transfer) to be transferred, again, (double offset) to the blanket carried by the lower printing cylinder, where it then appears as an inked right-reading image. A sheet of translucent paper is fed to the next revolution of the lower printing cylinder, and as the translucent sheet passes through the bite of the printing couple, it is squeezed between the other blanket on the large printing cylinder and the blanket on the lower printing cylinder. The inked mirror image on this other blanket on the large printing cylinder is thus printed onto the top surface of the translucent sheet as a right-reading image, and simultaneously, the inked right-reading image on the blanket on the lower printing cylinder is printed onto the bottom surface of the translucent sheet as an identical, matching, mirror image of the image printed simultaneously on the top of the sheet, and in perfect register with it. These two matching images, together, form an extremely opaque rendering of the image, on the translucent sheet.

The function diagram shows the translucent stock in the "pile" feeder. It shows that the suction foot only feeds a sheet to the first revolution of the lower printing cylinder. (This is shown diagrammatically by the arrow on the suction foot at the left and the absence of an arrow on the suction foot at the right.) It shows that the double sheet eliminator operates to deflect the sheets if more than a single sheet is fed. It shows a sheet fed to the first revolution of the lower printing cylinder in position against the stop fingers. The diagram shows (by the arrow) that the sheet detector acts to sense the presence or absence of a sheet on the first revolution of the lower printing cylinder; and that the feed rolls then advance the sheet into the grippers as the stop fingers move out of the path of the sheet, and it shows that the grippers are open to receive the sheet and carry it through the bite of the printing couple. The diagram also shows that on the second revolution of the lower printing cylinder no sheet is fed into position against the stop fingers, and (by the absence of an arrow on the sheet detector) it shows that the sheet detector does not move to detect the presence or absence of a sheet on the second revolution of the lower printing cylinder. (This causes the lower printing cylinder to remain in printing relationship with the large printing cylinder, even though no sheet is present on the second revolution of the lower printing cylinder, so that the inked mirror image, on the blanket on the large printing cylinder which is in coincidence with the lower printing cylinder on its second revolution, is pressed against, and transferred to, the blanket on the lower printing cylinder.) The diagram also shows that, notwithstanding the fact that no sheet is fed to the second revolution of the lower printing cylinder, the feed rolls still operate as if to advance a sheet, the stop fingers still move out of the path a sheet would follow, and the grippers still open, as though to receive a sheet.

The small diagram on the right, below the lower printing cylinder, indicates that on the first revolution of the lower printing cylinder, when a sheet passes through the bite of the printing couple, the pressure between the lower printing cylinder and the corresponding segment on the large printing cylinder is set to compensate for the thickness of the sheet passing between the cylinders, whereas the small diagram on the left, below the lower printing cylinder, indicates that on the second revolution of the lower printing cylinder, when no paper is present, the setting is such that the center of the lower printing cylinder is raised and the blanket on the lower printing cylinder rolls in contact with the image on the opposed segment on the large printing cylinder, with the proper pressure to transfer the image onto the blanket on the lower printing cylinder.

This function diagram also shows that the grippers in this instance are carried by chains which encircle the shaft of the lower printing cylinder; so that after passing through the bite of the printing couple a gripper bar, carried by the chains, moves directly out from the bite of the printing couple, while retaining its grip on the leading edge of the sheet, and thereby strips the sheet from the inked images on both the lower and the large printing cylinders. The small circle in the gripper bars in this case identifies them diagrammatically as being chain carried gripper bars as opposed to the X in the grippers of the function diagrams in FIGS. 9*a*, 9*b* and 9*c* which identified them diagrammatically as being cylinder grippers. As shown in this diagram the sheet is carried out around the shaft of the delivery sprockets at the left, and is turned over, and delivered beneath the delivery chains with its original bottom surface face-up, so that the right-reading offset image is on the bottom of the sheet and the mirror image, printed by double offset, is on the top of the sheet. The position of the half arrow at the leading edge of the delivered sheet indicates diagrammatically that it was delivered with its original bottom surface face-up. The diagram also shows that the grippers of each gripper bar open to release a sheet as they reach the delivery position (on each revolution of the lower printing cylinder); although as previously indicated, a sheet is carried (and therefore released) only by those grippers which received it on the first revolution of the lower printing cylinder.

Since it is only when an image is printed on the original bottom surface of the sheets (which, of course, includes the case in which images are printed simultaneously on both the top and bottom surfaces of the sheets), that a chain delivery mechanism is neeeded irrespective of the degree of ink coverage, or of the type of paper stock being printed, a chain delivery mechanism is shown in these function diagrams only when an image is printed on the original bottom surface of the sheets. In all other cases the showing of a chain delivery mechanism is omitted from the function diagrams; although any of the delivery mechanisms of the GG series of diagrams shown in FIGS. 7*c* and 8*c* may be used whenever needed. In all embodiments of the press, and in these function diagrams, provision is always made for delivering all sheets with a printed surface face-up.

The function diagram in FIG. 9*e* illustrates the operation of the 2-R press in printing four non-overlapping images in four colors on one side of a sheet and simultaneously embossing all, or selected areas, of the four images, as well as "blind" embossing non-image areas as desired. In this function diagram plate cylinder modules carrying four different colors of ink are mounted in the four module mounting positions, and each plate cylinder carries a "mirror" image wet offset plate. Non-overlapping inked mirror images on these four plates are transferred (offset) successively onto an offset blanket carried on a segment mounted in one of the work areas on the large printing cylinder, where they appear as non-overlapping, right-reading inked images, in four colors. The lower printing cylinder makes one revolution with no paper in the bite of the printing couple, during which it rolls in contact with this blanket on the large printing cylinder and the images on this blanket are again transferred (double ofset) onto an offset blanket on the lower printing cylinder, where they appear as non-overlapping inked mirror images, in four colors.

An embossing plate with a raised right reading image of the material to be embossed is mounted on a segment in the other work area on the large printing cylinder; and, on the revolution of the lower printing cylinder on which this segment is in coincidence with the lower printing cylinder, a sheet of paper is passed through the bite of the printing couple. The raised image on the embossing plate is of such a height that it applies pressure to the top surface of the sheet in excess of that normally applied; with the result that the raised image of the embossing plate actually deforms, or embosses, the sheet in the pattern of the image on the embossing plate by pressing the paper into the resilient surface of the offset blanket on the lower printing cylinder. The deformation is sufficient to permanently emboss the sheet of paper in the pattern of the image on the embossing plate. This pressure also causes the paper to be pressed into contact with those portions of the four color, non-overlapping, inked mirror images on the blanket on the lower printing cylinder that coincide with the raised image on the embossing plate, so that these mirror images are printed on the bottom surface of the paper as right-reading images. In those areas where an image on the blanket on the lower printing cylinder is to be printed on the bottom surface of the paper without embossing, the embossing plate carries a plain, smooth area of the proper height to apply the necessary pressure to cause the inked image to be transferred to the paper without embossing the paper. Where the raised image on the embossing plate does not coincide with an inked image on the blanket on the lower printing cylinder, "blind" embossing results.

A plate cylinder control cam, shown diagrammatically on the shaft of the large printing cylinder in the function diagram, together with the Roman Numerals and arrows thereon, indicates diagrammatically that the plate cylinders in positions I, II, III and IV are each successively lifted out of contact with the segment on the large printing cylinder which carries the embosssing plate. No ink is applied to the surface of the embossing plate in this example. The raised image of the embossing plate and the raised character of the embossed images on the printed sheets are both shown diagrammatically. In the manner previously described, the function diagram illustrates that the feeder feeds a sheet to the first revolution of the lower printing cylinder but not to the second; and the sheets are carried through the bite of the printing couple, stripped, and delivered with the printed surface (which was the original bottom surface of the sheet) face-up. The pressure settings between the lower printing cylinder and the two work areas of the large printing cylinder are different, allowing for the presence of paper in the bite of the printing couple on the first revolution of the lower printing cylinder, and causing the distance between the center of the lower printing cylinder and the fixed center of the large printing cylinder to be decreased on the second revolution of the lower printing cylinder so that the blanket on the lower printing cylinder is pressed to contact with the blanket on the corresponding segment on the large printing cylinder to effect the transfer of the inked images from the segment on the large printing cylinder onto the blanket on the lower printing cylinder.

The function diagram in FIG. 9*f* illustrates the operation of the 2-R press in printing one image on one side of a sheet in one color and simultaneously printing three non-overlapping images in three colors on the other side of the sheet. There are three plate cylinder modules, carrying three different colors of ink, mounted in module mounting positions I, II and IV. Each plate cylinder carries a wet offset plate with a right-reading image, which does not overlap either of the other two images, and each plate cylinder rolls in contact successively with an offset blanket on a blanket segment in one work area on the large printing cylinder, thereby depositing on this blanket a composite inked "mirror" image in three non-overlapping colors.

There is an ink/dampening module mounted in module mounting position III, the ink and dampening rollers of which roll in contact with an offset plate, with a right-reading image, on a plate segment in the other work area on the large printing cylinder. This inked right-reading image is transferred onto an offset blanket on the lower printing cylinder as the plate segment rolls in contact with the lower printing cylinder during a revolution of the lower printing cylinder when no paper is passing through the bite of the printing couple. This image appears on the blanket on the lower printing cylinder as an inked mirror image of the image on the plate segment on the large printing cylinder.

On the next revolution of the lower printing cylinder a sheet of paper is passed through the bite of the printing couple and the composite non-overlapping three color image on the blanket segment on the large printing cylinder is printed on its top surface; and, simultaneously, the single color image on the blanket on the lower printing cylinder is printed on the bottom surface of the sheet.

The function diagram shows that the feeder feeds a sheet to the first revolution of the lower printing cylinder but not to the second. It shows that the pressure settings between the lower printing cylinder and the two work areas of the large printing cylinder are different, to correspond to the passage of a sheet through the bite of the printing couple on the first revolution of the lower printing cylinder but not on the second, as previously described. The function diagram also shows the sheet delivered with its original bottom surface, printed with the single color image, face-up.

The function diagram shows, in the manner previously described, that the plate cylinders in positions I, II, and IV are lifted out of contact successively with the plate segment on the large printing cylinder; and form roll lifter cams are shown diagrammatically on the blanket segment in the other work area on the large printing cylinder, and these cams lift the form rollers of the ink/dampening module in position III out of contact with the blanket segment.

The function diagram in FIG. 9*g* illustrates the operation of the 2-R press in printing two non-overlapping images in two colors on one side of a sheet and simultaneously printing two other non-overlapping images in two colors on the other side of the sheet. The function diagram shows that there are four plate cylinder modules, carrying four different colors of ink, mounted in the four module mounting positions. The plate cylinders in positions I and III each carry a wet offset plate with a mirror image which does not overlap the other image; and each of these two plate cylinders rolls in contact successively with a first offset blanket on a first blanket segment in one work area on the large printing cylinder, thereby depositing on this blanket a composite inked right-reading image in two non-overlapping colors. These two plate cylinders, in positions I and III, are lifted out of contact with the segment in the other work area on the large printing cylinder.

This two color inked right-reading image on the first blanket segment on the large printing cylinder is again transferred (double offset) onto an offset blanket on the lower printing cylinder, as this first blanket segment rolls in contact with the lower printing cylinder during a revolution of the lower printing cylinder when no paper is passing through the bite of the printing couple. This image then appears on the blanket on the lower printing cylinder as a composite inked mirror image in two non-overlapping colors.

Each of the plate cylinders in positions II and IV carries a wet offset plate with a right-reading image which does not overlap the other image and each of these two plate cylinders rolls in contact successively with a second offset blanket on a second blanket segment in the other work area on the large printing cylinder, thereby depositing on this blanket a composite inked mirror image in two non-overlapping colors. These two plate cylinders, in positions II and IV, are lifted out of contact with the first blanket segment in the first work area on the large printing cylinder.

A sheet of paper passes through the bite of the printing couple on the revolution of the lower printing cylinder when the second blanket segment on the large printing cylinder is in coincidence with the lower printing cylinder; and the inked mirror image in two non-overlapping colors on the second blanket segment on the large printing cylinder is printed onto the top surface of the sheet, and, simultaneously, the inked mirror image in two non-overlapping colors which was double offset onto the blanket on the lower printing cylinder is printed onto the bottom surface of the sheet.

The function diagram shows, in the manner previously described, that the feeder feeds a sheet to the first revolution of the lower printing cylinder but not to the second. It shows that the pressure settings between the lower printing cylinder and the two work areas of the large printing cylinder are different to correspond to the passage of a sheet through the bite of the printing couple on the first revolution of the lower printing cylinder but not on the second. The function diagram also shows a sheet delivered with its original bottom surface, printed with the double offset two color image, face-up, and with the other two color image printed on the other side of the sheet.

The function diagram in FIG. 9*h* illustrates the operation of the 2-R press in printing by letterpress, on one side of a sheet of paper, in one color.

This function diagram shows an ink/dampening module, with ink rollers only, mounted in module mounting position III. A segment, or other image carrying device, carrying a letterpress plate is mounted in one of the work areas on the large printing cylinder. There is nothing mounted in the other work area on the large printing cylinder. The ink rollers ink the raised mirror image of the letterpress plate. (The broken line outside the surface of the "segment" and extending around most of its length indicates diagrammatically that this is a raised letterpress image.) The feeder feeds a sheet to the first revolution of the lower printing cylinder but not to the second. As the sheet passes through the bite of the printing couple on the first revolution of the lower printing cylinder, the lower printing cylinder acts as a platen and presses the sheet into contact with the surface of the letterpress plate carried on the "segment" on the large printing cylinder. The top surface of the sheet is thus printed in one color by letterpress and the sheet is delivered with this printed surface face-up. No sheet passes through the bite of the printing couple on the second revolution of the lower printing cylinder and no transfer of an image takes place.

The function diagram shown in FIG. 9*i* illustrates the operation of the 2-R press in printing two images, which may overlap each other, in two colors on one side of a sheet by letterpress. The function diagram shows an ink/dampening module, with ink rollers only, and carrying black ink, mounted in module mounting position III. It also shows another ink/dampening module, with ink rollers only, and carrying red ink, mounted in module mounting position IV. There are two plate segments, or other image carrying devices, each carrying a different letterpress plate, in the two work areas on the large printing cylinder. Each of these "segments" has form roll lifter cams at its ends, but the form roll lifter cams on the two "segments" are in different lateral planes so that the form rollers carrying red ink contact the first letterpress plate but are lifted out of contact with the second, and the form rollers carrying black ink contact the second letterpress plate but are lifted out of contact with the first.

The feeder feeds a sheet to the first revolution of the lower printing cylinder but not to the second. The sheet enters the bite of the grippers and is carried through the bite of the printing couple; and as the sheet passes through the bite of the printing couple on the first revolution of the lower printing cylinder the first letterpress image is printed on the top surface of the sheet in red ink. When the grippers reach the point at which they would normally open to release the sheet, they do not open, but retain their grip on the leading edge of the sheet and carry it around the lower printing cylinder. When the grippers then reach the point at which they would normally open to receive a second sheet, no second sheet is present and the grippers do not open, but continue to grip the leading edge of the first sheet which they then carry through the bite of the printing couple for a second time. As the sheet passes through the bite of the printing couple for the second time a second letterpress image, which may overlap the first image, is printed on the top surface of the sheet in black ink. When the grippers reach the delivery position on the second revolution of the lower printing cylinder they open to release the sheet, and the sheet is delivered, printed face-up, with a two color letterpress image printed on its top surface.

The sequence of the opening and closing of the cylinder grippers is shown diagrammatically; and a line passes around the upper diagrammatic showing of the cylinder grippers at the delivery position to indicate diagrammatically that the sheet is carried around the lower printing cylinder by the closed cylinder grippers and through the bite of the printing couple a second time, and this line ends with an arrow to show that a sheet is delivered on the second revolution of the lower printing cylinder. The pressure settings between the lower printing cylinder and the two work areas of the large printing cylinder are shown to be the same since the sheet of paper passes through the bite of the printing couple on both revolutions of the lower printing cylinder. The two images, in two colors, on the printed and delivered sheet are shown as overlapping.

The function diagram shown in FIG. 9*j* illustrates the operation of the 2-R press in printing and concurrently collating two sheets of paper, each of which is printed by leterpress on one side of the sheet but on which two different images in two different colors are printed. The set-up of the press is similar to that illustrated in the preceding function diagram in FIG. 9*j* insofar as the mounting and inking of the two letterpress plates in the two work areas on the large printing cylinder is concerned. In this case, however, the feeder feeds a sheet to each revolution of the lower printing cylinder, and the sheet fed to the first revolution of the lower printing cylinder passes through the bite of the printing couple only once and is printed on its top surface by letterpress in red ink and is then delivered. The second sheet, fed to the second revolution of the lower printing cylinder, also passes through the bite of the printng couple once and is printed on its top surface, with a different image, by letterpress in black ink and is then delivered.

(If the two letterpress are identical instead of different, and if both are inked with the same color ink, then identically printed sheets will be delivered on each revolution of the lower printing cylinder; and the operation will be similar to that illustrated in FIG. 9*h* with the exception that two printed sheets will be delivered for each revolution of the large printing cylinder instead of one.)

Since in the function diagram of FIG. 9*j* the sheets are concurrently printed and collated, tfhe combined "miss" detector and double sheet eliminator is used to assure the maintenance of the proper sequence in the printed and collated sheets delivered. This is shown diagrammatically in the manner previously described.

In this function diagram the two sheets making up the printed and collated set are both fed from the same feeder and the paper stock is therefore the same for both sheets, the difference being that different images are printed on the first and second sheets. It will be clear that, alternatively, the two sheets could be fed from two separate feeders, as illustrated in FIG. 9*c* for example, and in this case the two sheets making up the collated set would not only be printed with different images in different colors but the paper stock of the two sheets could also differ in weight and/or color.

The function diagram shown in FIG. 9*k* illustrates the operation of the 2-R press in printing two images, which may overlap each other, in two colors on one side of a sheet, with one of the images being printed by offset and the other of the images being printed by letterpress. The function diagram shows a plate cylinder module mounted in module mounting position II. The plate cylinder carries a wet offset plate, with a right-reading image inked with black ink. This plate cylinder rolls in contact with an offset blanket on a blanket segment in one work area on the large printing cylinder and the inked image on the plate is transferred onto the offset blanket where it appears as a black, inked mirror image. There is a segment, or other image carrying device, carrying a letterpress plate, in the other work area on the large printing cylinder. The raised "mirror" letterpress image on this letterpress plate is inked with red ink by the form rollers of an ink/dampening module, equipped with ink rollers only, which is mounted in module mounting positions III.

Form roll lifter cams on the blanket segment lift the form rollers which ink the letterpress plate out of contact with the offset blanket, and a plate cylinder control cam on the shaft of the large printing cylinder lifts the plate cylinder out of contact with the letterpress plate. The feeder feeds a sheet to the first revolution of the lower printing cylinder but not to the second. The sheet is carried through the bite of the printing couple two times, and on its first passage through the bite of the printing couple the black offset image is printed onto its top surface from the blanket segment on the large printing cylinder. On its second passage through the bite of the printing couple the red letterpress image, which may overlap the black offset image, is printed on the top surface of the sheet from the letterpress "segment" on the large printing cylinder. The sheet is then delivered with its printed surface face-up.

The function diagram shown in FIG. *9m* illustrates the operation of the 2-R press in printing three non-overlapping images in three colors by offset and a fourth image, which may overlap any of the other three images, in a fourth color by letterpress, all on one side of a sheet of paper.

There are plate cylinder modules mounted in module mounting positions I, II and IV. These plate cylinder modules carry green, black and red ink respectively and each of the plate cylinders carries a wet offset plate with a right-reading image which does not overlap the images on the other two offset plates. Each of these plate cylinders rolls in contact successively with an offset blanket on a segment in one of the work areas on the large printing cylinder, and transfers its image to the blanket. A composite inked mirror image in three non-overlapping colors is thereby produced on the offset blanket. A plate cylinder control cam on the shaft of the large printing cylinder lifts each of the plate cylinders, successively, out of contact with the other work area of the large printing cylinder. There is an ink/dampening module, with ink rollers only, mounted in position III. This module carries blue ink and the form rollers of this module contact the raised mirror image of a letterpress plate in the other work area on the large printing cylinder. Form roll lifter cams on the offset blanket segment lift these form rollers out of contact with the blanket segment. The feeder feeds a sheet to the first revolution of the lower printing cylinder but not to the second. The sheet is carried around the lower printing cylinder, and passes through the bite of the printing couple two times. On the first passage of the sheet through the bite of the printing couple the non-overlapping three color offset image is printed on its top surface and on its second passage through the bite of the printing couple the single color letterpress image, which may overlap any of the other three images, is also printed on its top surface. The sheet is delivered with its printed surface face-up.

The function diagram in FIG. *9n* illustrates the operation of the 2-R press in printing and concurrently collating two sheets of paper with three non-overlapping images in three colors being printed by offset on the top surface of the first sheet and a single image in a single color being printed by letterpress on the top surface of the second sheet. The operation is similar to that shown and described in the function diagram in FIG. *9m* with the exception that a sheet is fed to each revolution of the lower printing cylinder and each sheet passes through the bite of the printing couple one time. Since the sheets are being concurrently printed and collated the double sheet eliminator and the "miss" detector are used in combination as previously described.

The function diagram shown in FIG. *9p* illustrates the operation of the 2-R press in printing four images in four colors on one side of a sheet of paper; with two non-overlapping images in two colors being printed first, by offset; and with two other images, in two other colors, which do not overlap each other (but either or both of which may overlap either or both of the other two images) than being printed by offset on the same side of the sheet. Four plate cylinder modules are mounted in the four module mounting positions. The four modules carry green, black, blue and red ink respectively and each plate cylinder carries a right-reading wet offset plate. The black image on the plate in position II does not overlap the red image on the plate in position IV; and the green image on the plate in position I does not overlap the blue image on the plate in position III. However, the green image and/or the blue image may each overlap the black image and/or red image. The plate cylinder carrying the black image and the plate cylinder carrying the red image roll in contact successively with an offset blanket on a first segment in one work area on the large printing cylinder but are lifted out of contact with a second segment in the other work area on the large printing cylinder. The plate cylinder carrying the green image and the plate cylinder carrying the blue image roll in contact successively with another offset blanket on the second segment in the other work area on the large printing cylinder but are lifted out of contact with the first segment in the first work area on the large printing cylinder. The feeder feeds a sheet to the first revolution of the lower printing cylinder but not to the second. The sheet is carried around the lower printing cylinder, and passes through the bite of the printing couple two times. On its first passage through the bite of the printing couple the non-overlapping black and red images are printed on the top surface of the sheet. On its second passage through the bite of the printing couple the non-overlapping blue and green images are printed on the top surface of the sheet, and either or both of these images may overlap either or both of the first two images. The sheet is then delivered with its printed surface face-up.

The function diagram shown in FIG. *9q* illustrates the operation of the 2-R press in printing and concurrently collating two sheets, the first of which is printed with a single image in a single color on the top side of the sheet by offset and the second of which is printed with another single image, in a different color, on the top side of the sheet by offset. There is a plate cylinder module carrying black ink mounted in module mounting position II and a plate cylinder module carrying red ink mounted in module mounting position IV. The two plate cylinders carry different right-reading wet offset plates. The plate cylinder carrying the black image rolls in contact with an offset blanket on a first segment in a work area on the large printing cylinder but is lifted out of contact with a second segment in the other work area on the large printing cylinder. The plate cylinder carrying the red image rolls in contact with another offset blanket on the second segment in the other work area on the large printing cylinder but is lifted out of contact with the first segment in the first work area on the large printing cylinder. The feeder feeds a sheet to each revolution of the lower printing cylinder and each sheet passes through the bite of the printing couple one time. The first sheet delivered has a black image printed by offset on its top surface and the second sheet delivered has a different, red image printed by offset on its top surface. Since the sheets are being concurrently printed and collated the double sheet eliminator and the "miss" are used in combination as previously described.

The function diagram shown in FIG. *9r* illustrates the operation of the 2R press in printing and concurrently collating two sheets, one of which is printed by offset with two non-overlapping images in two colors on the top side of the sheet, and the second of which is printed by offset with two other non-overlapping images in two other colors on the top side of the sheet. The operation is similar to that shown and described in the function diagram in FIG. 9*q* except that in this case there are four plate cylinder modules mounted in the four module mounting positions and carrying green, black, blue and red ink respectively. Non-overlapping black and red images on the plate cylinders in positions II and IV are transferred successively to the first offset blanket on the first segment in one work area on the large printing cylinder and these plate cylinders are lifted out of contact with the second segment in the second work area on the large printing cylinder. The non-overlapping green and blue images on the plate cylinders in positions I and III are transferred successively to the second offset blanket on the second segment in the other work area on the large printing cylinder and these plate cylinders are lifted out of contact with the first segment in the first work area on the large printing cylinder. The first sheet therefore has two non-overlapping images in red and black printed by offset on its top surface and the second sheet has two non-overlapping images in green and blue printed by offset on its top surface.

The function diagram shown in FIG. 9*s* illustrates the operation of the 2-R press in printing and concurrently collating two sheets of paper, with the first sheet being printed on one side by offset with three non-overlapping images in three colors, and with the second sheet being printed on one side by offset with three non-overlapping images in three colors, and with two of the images printed on the second sheet being identical to two of the images printed on the first sheet, and in the same colors, but with the third image printed on the second sheet being different from the third image printed on the first sheet, and in a different color. There are four plate cylinder modules mounted in the four module mounting positions and carrying green, black, blue and red ink respectively. Each plate cylinder carries a wet offset plate with a different right-reading image. The plate cylinders carrying the green, black and blue images roll in contact successively with a first offset blanket on a first segment in one work area on the large printing cylinder. The plate cylinder carrying the black image is lifted out of contact with a second segment in the other work area on the large printing cylinder. The plate cylinders carrying the green, blue and red images roll in contact successively with a second offset blanket on the second segment in the other work area on the large printing cylinder. The plate cylinder carrying the red image is lifted out of contact with the first segment in the first work area on the large printing cylinder. The feeder feeds a sheet to each revolution of the lower printing cylinder. The first sheet has the green, black and blue images printed by offset on its top surface and the second sheet has the green, red and blue images printed by offset on its top surface. The images in green and blue on both sheets are identical but the images in black and red on the two sheets are different.

The function diagram illustrated in FIG. 9*t* illustrates the operation of the 2-R press in concurrently printing and collating two sheets of paper, with the first sheet being printed by offset with four non-overlapping images in four colors on one side of the sheet, and with the second sheet being printed by offset with three non-overlapping images in three colors on one side of the sheet, and with the three images printed on the second sheet being identical to three of the images printed on the first sheet, and in the same colors. The operation is similar to that described in connection with the function diagram in FIG. 9*a* with the exception that all four plate cylinders roll in contact successively with the first offset blanket on the segment in the first work area on the large printing cylinder. The plate cylinder in position II, which carries a black image, is lifted out of contact with the second offset blanket on the segment in the second work area on the large printing cylinder, but the other three plate cylinders roll in contact successively with this second offset blanket. The first sheet is printed on its top surface, by offset, with four non-overlapping images in four colors and the second sheet is printed on its top surface, by offset, with three non-overlapping images in three colors, and these three images and the colors in which they are printed are identical to three of the images printed on the first sheet.

The function diagram shown in FIG. 10*a* illustrates the operation of the 3-R press in printing both sides of a sheet simultaneously by offset, with two non-overlapping images in two colors being printed on one side of the sheet and two other non-overlapping images in two other colors being printed simultaneously on the other side of the sheet.

(Since the function diagram in FIG. 10*a* shows the 3-R press, there are three work areas on the large printing cylinder and the lower printing cylinder makes three revolutions for each revolution of the large printing cylinder. Therefore, in this function diagram, certain press elements which operate, or may operate, once for each revolution of the lower printing cylinder are shown three times, and these small repetitious diagrams illustrate the action taken, or the mechanical function performed, by each of these press elements on each successive revolution of the lower printing cylinder. Also, as in the case of the 2-R press, the number of sheets shown in the delivery position in each function diagram represents the number of sheets delivered for each revolution of the large printing cylinder.)

In the function diagram shown in FIG. 10*a* there is a plate cylinder module carrying black ink in module mounting position II and a plate cylinder module carrying red ink in module mounting position IV. There is an ink/dampening module carrying green ink in module mounting position I and an ink/dampening module carrying blue ink in module mounting position III. There are two plate segments, in two of the work areas, on the large printing cylinder and each of these segments carries a right-reading wet offset plate with an image which does not overlap the image on the other plate. Each of these plate segments carries form roll lifter cams at its ends, positioned so that the form rollers of the ink/dampening module in position III, which carry blue ink, roll in contact with one of these wet offset plates but are lifted out of contact with the other, and the form rollers of the ink/dampening module in position I, which carry green ink, roll in contact with the second wet offset plate but are lifted out of contact with the first. There is a blanket segment, carrying an offset blanket, in the third work area on the large printing cylinder and this segment carries two sets of form roll lifter cams at its ends, positioned so that the form rollers of both ink/dampening modules, in positions I and III, are lifted out of contact with this blanket segment. The plate cylinders in positions II and IV each carry a right-reading wet offset plate with an image which does not overlap the image on the other plate.

These two plate cylinders each roll in contact successively with the offset blanket on the blanket segment in the third work area on the large printing cylinder, so that there is then a composite non-overlalpping two color inked mirror image on this blanket. Each of these plate cylinders is lifted out of contact with both of the plate segments in the other two work areas on the large printing cylinder. On one revolution of the lower printing cylinder, when no paper is present, the blue image on one of the plate segments on the large printing cylinder is transferred onto an offset blanket on the lower printing cylinder, and on the next revolution of the lower printing cylinder, also with no paper present, the non-overlapping green image on the other plate segment on the large printing cylinder is transferred onto the offset blanket on the lower printing cylinder; so that there is then a composite non-overlapping two color inked mirror image on the blanket on the lower printing cylinder. A sheet is fed to the next revolution of the lower printing cylinder, and as the sheet passes through the bite of the printing couple it has the red and black non-overlapping images from the blanket on the large printing cylinder printed on its top surface and, simultaneously, has the blue and green non-overlapping images from the blanket on the lower printing cylinder printed on its bottom surface. The sheet is then stripped and delivered, as previously described, by the encircling chain delivery mechanism, which (in this case) turns it over so that it is delivered with the composite green and blue image (on its original bottom surface) face-up and the composite red and black image (on its original top surface) face-down. The gripper bars are diagrammatically indicated to be chain carried gripper bars, as previously described. As shown in the function diagram the feeder feeds a sheet to the first revolution of the lower cylinder but not to the second or third. The sheet passes through the bite of the printing couple one time. On the second and third revolutions of the lower printing cylinder the pressure adjustment is such that the lower printing cylinder rolls in contact successively with first the plate segment carrying the blue image and then the plate segment carrying the green image.

The function diagram shown in FIG. 10*b* illustrates the operation of the 3-R press in printing and concurrently collating two sheets of paper, each printed simultaneously on two sides by offset. The first sheet is printed on one side with two non-overlapping images in two colors by offset and simultaneously printed on the other side with a single image in a single color by offset. The second sheet is printed on one side with the two non-overlapping images in two colors by offset, one of the images being identical to and in the same color as one of the non-overlapping images printed on the first sheet, and the second image being a different image and in a different color from the second non-overlapping image printed on the first sheet; and simultaneously the same single image that was printed on the second side of the first sheet is also printed on the second side of the second sheet, by offset, in the same color (but lighter). In this function diagram three plate cylinder modules carrying green, black and red ink respectively are mounted in module mounting positions I, II and IV. There is a right-reading wet offset plate on each of the plate cylinders. There is an ink/dampening module, carrying blue ink, mounted in module mounting position III. The form rollers of this ink/dampening module contact the surface of a right-reading wet offset plate mounted on a plate segment in one work area on the large printing cylinder. This plate segment rolls in contact with an offset blanket on the lower printing cylinder on a revolution of the lower printing cylinder when no paper is present, and transfers a blue inked mirror image onto the blanket on the lower printing cylinder. Form roll lifter cams lift the form rolls of the ink/dampening module in position III out of contact with blanket segments in the other two work areas on the large printing cylinder. The plate cylinders in positions II and IV each contact a first offset blanket, on the first of these blanket segments successively and transfer to it a composite non-overlapping two color inked mirror image in red and black. The plate cylinders in positions I and IV each contact a second offset blanket on the other blanket segment on the large printing cylinder successively and transfer to it a composite non-overlapping two color inked mirror image in red and green. Plate cylinder control cams lift the plate cylinder in position I out of contact with the first blanket segment (on which the red and black images appear) and lift the plate cylinder in position II out of contact with the second blanket segment (on which the red and green images appear); they also lift all three plate cylinders (in positions I, II and IV) out of contact with the plate segment (carrying the plate with the blue image) in the other work area on the large printing cylinder. The feeder feeds a sheet to the first and second revolutions of the lower printing cylinder but not to the third. Each sheet passes through the bite of the printing couple one time. As the first sheet passes through the bite of the printing couple it has the two non-overlapping images in red and black printed on its top surface by offset from the first blanket on the large printing cylinder, and simultaneously has the single blue image on the blanket on the lower printing cylinder printed on its bottom surface, by offset. As the second sheet passes through the bite of the printing couple it has the two non-overlapping images in red and green printed on its top surface by offset from the second blanket on the large printing cylinder, and simultaneously has a lighter rendering of the blue image on the blanket on the lower printing cylinder printed on its bottom surface, by offset. On the third revolution of the lower printing cylinder, when no paper is present, the pressure setting is such as to cause the blanket on the lower printing cylinder to roll in contact with the plate (carrying the blue image) on the plate segment on the large printing cylinder. The sheets are stripped and delivered by the grippers of an encircling chain delivery mechanism and, as shown in this function diagram, are turned over and delivered with their original bottom surfaces face-up. The first sheet is thus delivered with the single blue image printed by offset on its upper surface and the two color non-overlapping images in red and black printed by offset on its lower surface; and the second sheet is delivered with a lighter rendering of the same single blue image printed by offset on its upper surface and the non-overlapping two color green and red images printed by offset on its lower surface. The red images on both sheets are identical, and the blue images on both sheets are identical except that the blue image on the second sheet is lighter than the blue image on the first sheet.

Figures 10C, 10D, 10E, 10F:
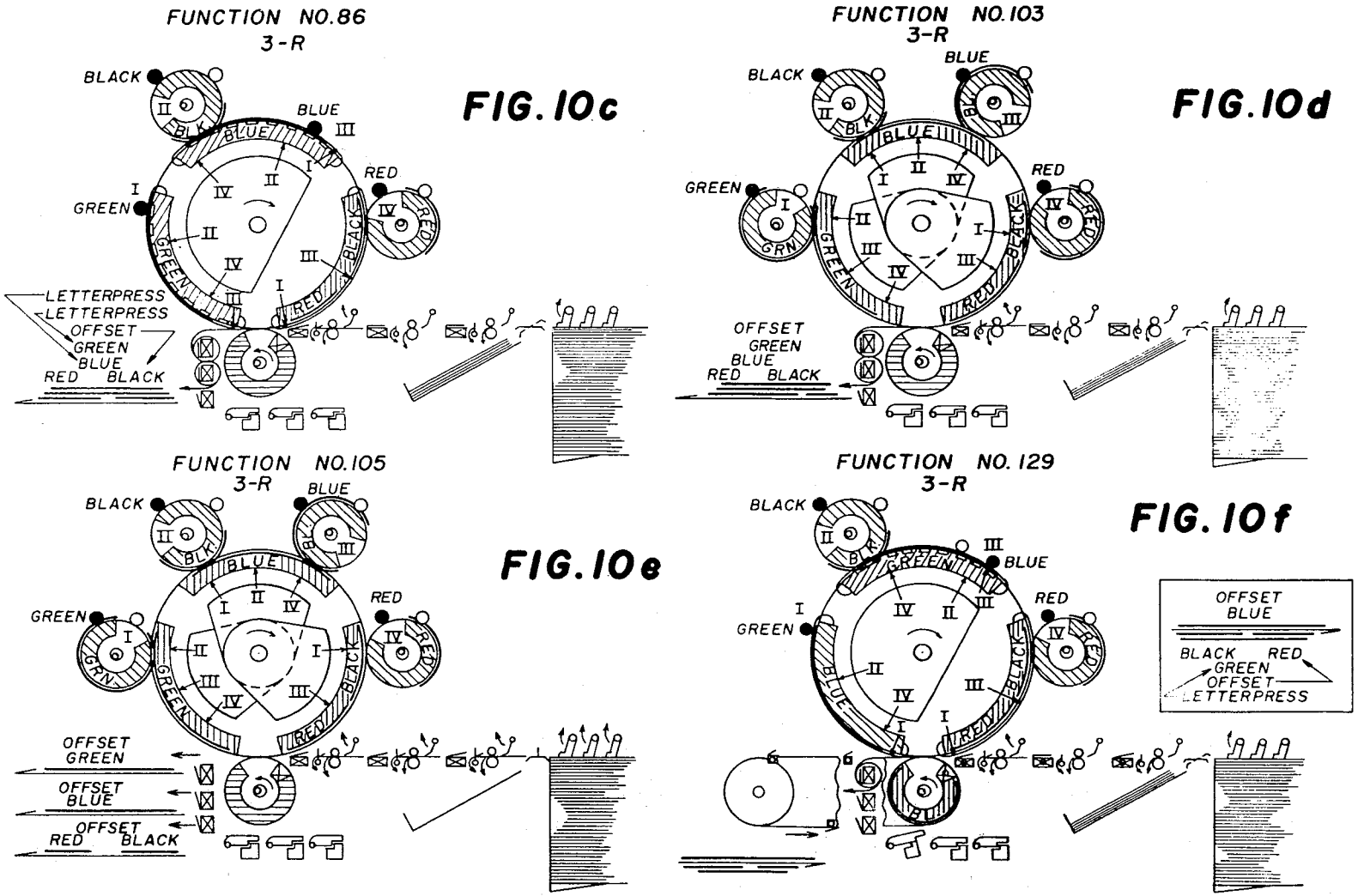

The function diagram shown in FIG. 10*c* illustrates the operation of the 3-R press in printing a four color image on one side of a sheet of paper, with the four color iamge made up of two non-overlapping images in two colors printed by offset and two additional images in the two additional colors printed by letterpress, either or both of which letterpress images may overlap each other and/or one or both of the offset images. There are plate cylinder modules, carrying black and red ink respectively, mounted in module mounting positions II and IV. Each of the two plate cylinders carries a wet offset plate with a right-reading image which does not overlap the other image. These two non-overlapping black and red images are transferred successively to an offset blanket on a blanket segment in one work area on the large printing cylinder. Both plate cylinders are lifted out of contact with the other two work areas on the large printing cylinder. There is an ink/dampening module, with ink rollers only, (and carrying green ink) mounted in module mounting position I and there is an ink/dampening module, with ink rollers only, (and carrying blue ink) mounted in module mounting position III. These are letterpress plate segments, or other image carrying devices, in the other two work areas on the large printing cylinder; and form roll lifter cams, in different lateral planes on these two letterpress plate "segments", cause the form rollers in position I, which apply green ink to the raised mirror image of one of the letterpress plates, to be lifted out of contact with the other; and cause the form rollers in position III, which apply blue ink to the raised mirror image of the other letterpress plate, to be lifted out of contact with the letterpress plate to which green ink was applied. The blanket segment (carrying the non-overlapping red and black mirror images) is equipped with two sets of form roll lifter cams in two lateral planes, positioned so that both the form rollers in positions I and the form rollers in position III are lifted out of contact with the blanket segment. The feeder feeds a sheet to the first revolution of the lower printing cylinder but not to the second or third revolutions of the lower printing cylinder. The sheet is carried around the lower printing cylinder twice and passes through the bite of the printing couple three times. On its first passage through the bite of the printing couple the sheet has the non-overlapping red and black images printed on its top surface by offset from the blanket on the large printing cylinder. On its second passage through the bite of the printing couple it has the blue letterpress image, which may overlap either or both of the offset images; printed on its top surface. On its third passage through the bite of the printing couple the sheet has the green letterpress image printed on its top surface, and this image may overlap any or all of the three previously printed images. The sheet is then delivered with its printed surface face-up.

The function diagram shown in FIG. 10*d* illustrates the operation of the 3-R press in printing three overlapping images in three colors by offset, together with a fourth image (in a fourth color) which may overlap two of the other images but not the third. There are plate cylinder modules (carrying green, black, blue and red ink respectively) mounted in the four module mounting positions. The plate cylinder in each of these plate cylinder modules carries a right-reading wet offset plate. There are three offset blankets, on three blanket segments, in the three work areas on the large printing cylinder. Plate cylinder control cams cause the plate cylinders in positions II and IV to contact the first blanket segment successively, and transfer to it a composite two color non-overlapping red and black inked mirror image. The plate cylinder in position III transfers a blue inked mirror image to the surface of the second blanket segment and the plate cylinder in position I transfers a green inked mirror image to the surface of the third blanket segment. The plate cylinders in positions I and III are lifted out of contact with the first blanket segment (with the red and black non-overlapping mirror images); the plate cylinders in positions I, II and IV are lifted out of contact with the second blanket segment (carrying the blue inked mirror image); and the plate cylinders in positions II, III and IV are lifted out of contact with the third blanket segment (carrying the green inked mirror image). The feeder feeds a sheet to the first revolution of the lower printing cylinder but not to the second or third revolution of the lower printing cylinder. The sheet is carried around the lower printing cylinder twice and passes through the bite of the printing couple three times. On its first passage through the bite of the printing couple the sheet has the non-overlapping two color red and black image printed on its upper surface by offset from the first blanket. On its second passage through the bite of the printing couple it has the blue image, which may overlap either of the other two images, printed on its upper surface by offset from the second blanket. On its third passage through the bite of the printing couple the sheet has the green image, which may overlap any of the three previously printed images, printed on its upper surface by offset from the third blanket. The sheet is then delivered with its printed surface face-up.

The function diagram shown in FIG. 10*a* illustrates the operation of the 3-R press in printing and concurrently collating a set of three sheets, with the first sheet being printed by offset on one side with the two non-overlapping images in two colors, and with the second sheet being printed by offset on one side with a single different image in a third color, and with the third sheet being printed by offset on one side with a still different single image in a fourth color. The operation is similar to that illustrated and described in the function diagram in FIG. 10*d* except that the feeder feeds a sheet to each revolution of the lower printing cylinder and each sheet passes through the bite of the printing couple one time. The first sheet has two non-overlapping images in red and black printed on its upper surface by offset. The second sheet has a different image printed in blue on its upper surface by offset. The third sheet has still another image printed in green on its upper surface by offset. Since sheets are being concurrently printed and collated the double sheet eliminator and the "miss" detector are used in combination, as previously described.

The function diagram shown in FIG. 10*f* illustrates the operation of the 3-R press in printing a sheet on two sides with one image in one color being printed by offset on one side and three images in three colors being printed on the other side, two by offset and one by letterpress. A single image in one color is printed on one side of the sheet by offset and two non-overlapping images in two colors are simultaneously printed by offset on the other side of the sheet; and then a third image in a third color, which may overlap either of the first two, is printed on the second side by letterpress. There are plate cylinder modules (carrying black and red ink respectively) mounted in module mounting positions II and IV. Each of the two plate cylinders carries a wet offset plate with a right-reading image that does not over-lap the image on the other plate. These two plate cylinders, successively, contact an offset blanket mounted on a blanket segment in one work area on the large printing cylinder, and transfer to it a two color non-overlapping inked mirror image in red and black.

There is an ink/dampening, module, with ink rollers only, (and carrying green ink) in module mounting position I. The form rollers of this ink/dampening module deposit green ink on the raised mirror image of a letterpress plate, or other imaging device, in a second work area on the large printing cylinder. There is an ink/dampening module (carrying blue ink), and complete with both ink and dampening rollers, mounted in module mounting position III. The form rollers of this ink/dampening module roll in contact with a wet offset plate on a plate segment in the third work area on the large printing cylinder and deposit blue ink on the right-reading image on this plate. On a revolution of the lower printing cylinder when no paper is present the offset plate segment rolls in contact with an offset blanket on the lower printing cylinder and transfers to it a blue inked mirror image. Form roll lifter cams are provided to lift the form rollers carrying green ink (in position I) out of contact with both the offset blanket segment (carrying the red and black inked mirror images) and the offset plate segment (with the blue image). Form roll lifter cams are also provided to lift the form rollers of the ink/dampening module carrying blue ink (in position III) out of contact with both the blanket segment (carrying the red and black inked mirror images) and the letterpress plate "segment" (with the raised green mirror image). A plate cylinder control cam lifts the plate cylinders in positions II and IV out of contact with both the letterpress plate "segment" (with the green image) and the offset plate segment (with the blue image). The feeder feeds a sheet to the first revolution of the lower printing cylinder but not to the second or third revolutions of the lower printing cylinder. The sheet is carried around the lower printing cylinder once and passes through the bite of the printing couple two times. On its first passage through the bite of the printing couple the two color non-overlapping red and black images are printed by offset on the top surface of the sheet from the blanket segment on the large printing cylinder, and, simultaneously, the blue image is printed by offset onto the bottom surface of the sheet from the blanket on the lower printing cylinder. Cylinder grippers carry the sheet around the lower printing cylinder and back to the bite of the printing couple, and meantime the leading edge of the sheet is transferred to encircling chain carried grippers and the sheet passes through the bite of the printing couple a second time. On its second passage through the bite of the printing couple the sheet has the green letterpress image (which may overlap either or both of the red and black images) printed on its top surface. The sheet is stripped and delivered by the chain carried encircling grippers and, as shown in the function diagram, is turned over and delivered with its original bottom surface face-up. On the third revolution of the lower printing cylinder no paper is present in the bite of the printing couple and the pressure setting is such as to cause the blanket on the lower printing cylinder to contact the offset plate on the offset plate segment on the large printing cylinder. The pressure adjustments between the lower printing cylinder and the three different work areas of the large printing cylinder take account of the fact that the same sheet of paper passes through the bite of the printing couple on the first and second revolutions of the lower printing cylinder but that no paper is present on the third revolution of the lower printing cylinder.

Both cylinder grippers and gripper bars carried by encircling chains are used in combination. Cylinder grippers are provided to carry the sheet around the lower printing cylinder; and encircling chain carried grippers are provided since the top and bottom surfaces of the sheet are both printed and chain carried grippers are therefore needed to properly strip the sheet from the printing surfaces on both cylinders of the printing couple. One sheet is delivered for each revolution of the large printing cylinder and the sheet is delivered with the single blue image printed by offset facing up and with the two non-overlapping offset images in red and black and the third green letterpress image (which may overlap either or both of the offset images) facing down.

FRAMES, SPREADERS, GEARS

GENERAL

Figure 12:
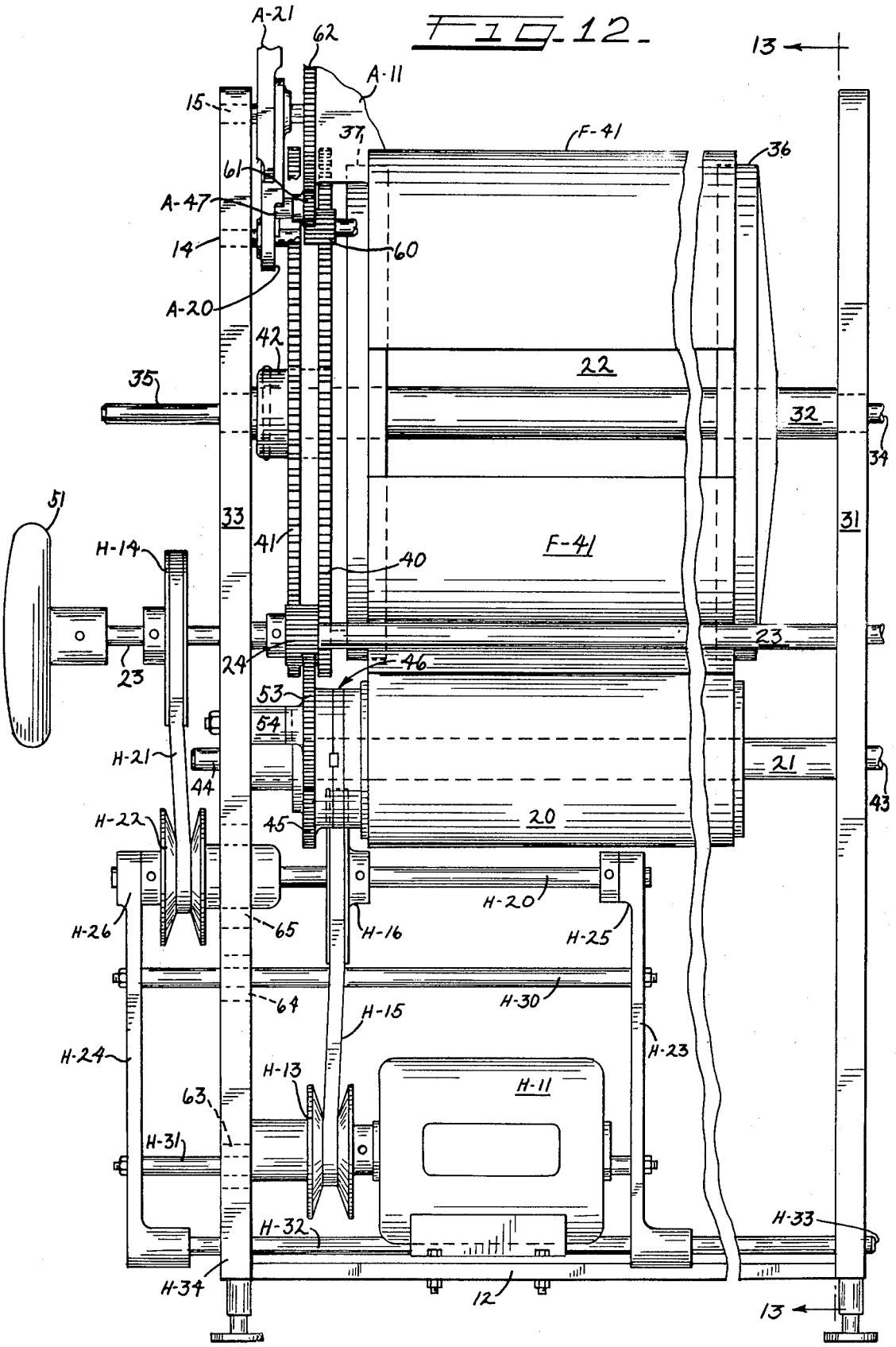
FIG. 12, is a somewhat more detailed view of the frame structure and associated parts seen in FIG. 11 looking from the back of the frame as seen in FIG. 11.

As seen in FIGS. 11, 12 and 13, the press frame structure 11 consists of two main frames, 31 and 33, which are held in fixed parallel spaced relationship to each other by five spreader bars, 13, 14, 15, 16, and 17. A main cylinder shaft 32 is journaled in bearings in the two main frames and has two projecting portions 34 and 35 of smaller diameter which project from either side of the two main frames. This shaft 32 carries two parallel disk members 36 and 37 spaced apart from each other and rigidly attached to the shaft 32.

Figure 14:
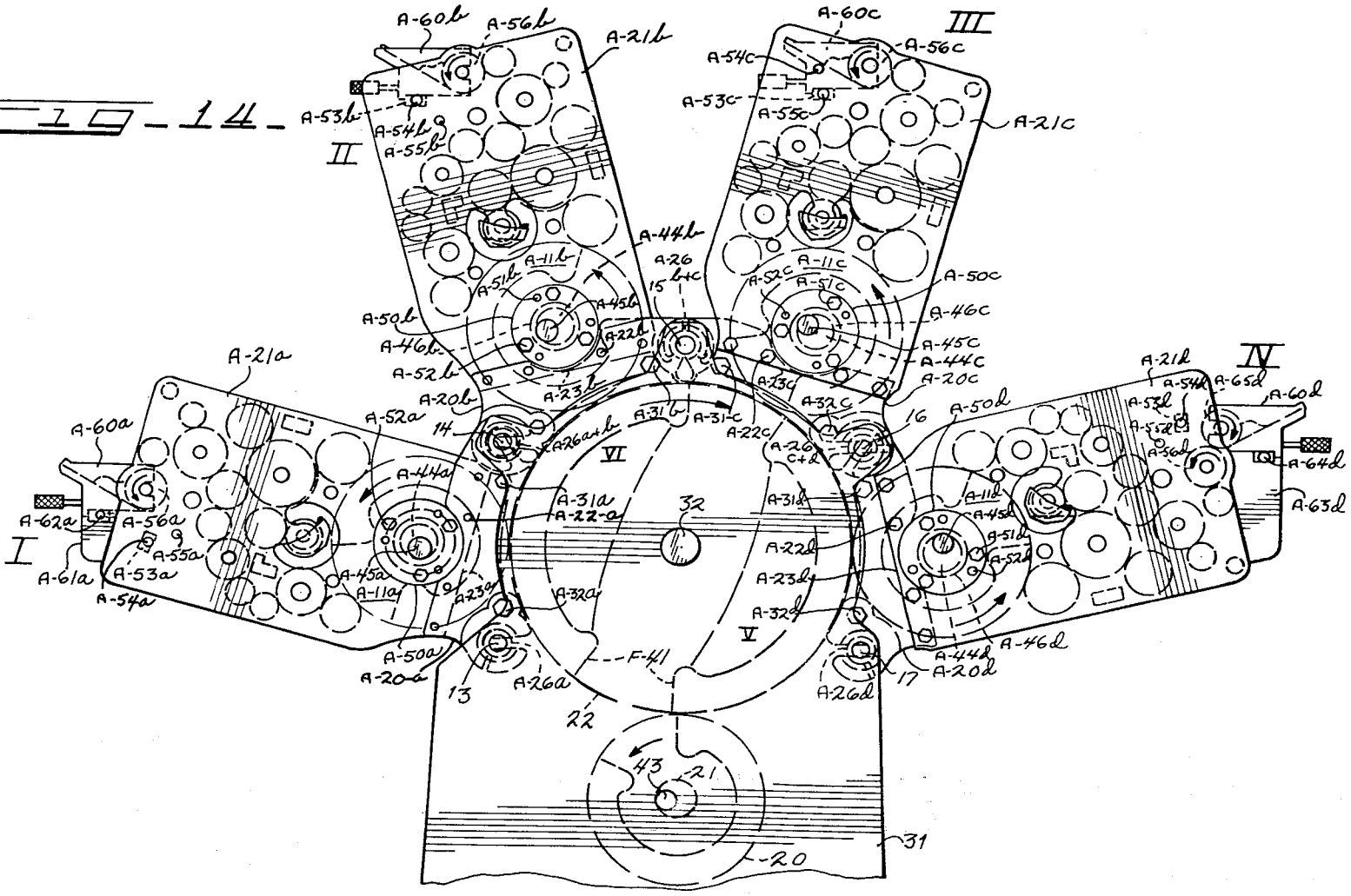
FIG. 14, illustrates in detail the manner in which four plate cylinder modules are mounted at the four module mounting station I, II, III, and IV of the 2-R press.

The large cylinder 22 includes the disk members 36 and 37 and the shaft 32 and one or more (customarily two in the 2R model) interchangeable and removable segments F-41 which are mounted on disks 36 and 37. In FIG. 11 the removable segments are not shown and have been removed in order to reveal other details of the mechanism which they would hide were they shown mounted on the disks 36 and 37. A pair of the removable and interchangeable segments F-41 are shown in FIGS. 12 and 14.

The five spreaders 13, 14, 15, 16 and 17 are equidistant from the center of shaft 32 and spaced about the upper portion of the main frames 31 and 33 and the spreaders are also equidistant from each other.

There are two gears 40 and 41 mounted on the hub 42 of the disk member 37. These two gears are independently fastened to turn with the disk 37 and the shaft 32 but are circumferentially adjustable about the shaft in a manner which will be disclosed hereafter. The disk or ring members 36 and 37 and the gears 40 and 41 are therefore affixed to and turn with the shaft 32 which in turn is journaled in bearings mounted in the two main frames 31 and 33.

A lower cylinder 20 is mounted on a shaft 21. The shaft 21 is held in the two main frames 31 and 33 and the shaft 21 does not turn with the cylinder 20 but the cylinder 20 carries bearings at either end which allow it to turn about the shaft 21. The shaft 21 is substantially stationary but is journaled in the main frames 31 and 33 in such manner that it may rock back and forth through a small arc. There are eccentric end portions 43 and 44 projecting from either end of the shaft 21 and beyond the two main frames 31 and 33. There is a gear 45 mounted at one end of the cylinder 20 and engaged to turn with the cylinder 20 through an Oldham coupling 46. There are hand wheels 50 and 51 at either side of the machine, both affixed to a shaft 23 which is journaled in the main frames 31 and 33. The printing cylinders of the press are driven by a motor H-11 rigidly mounted to the base 12 which is supported between the two main frames 31 and 33.

VARIABLE SPEED DRIVE

The shaft of the motor H-11 carries a spring-loaded variable speed pulley H-13 and a pulley H-16 mounted on a jackshaft H-20 is driven by a V-belt H-15 which interconnects the variable speed pulley H-13 on the motor shaft and the fixed diameter pulley H-16 which is keyed to the jackshaft H-20. The jackshaft H-20 is journaled in two swinging arms H-23 and H-24 and turns in bearings mounted in these arms at H-25 and H-26. These two arms are rigidly interconnected by two spreader bars H-30 and H-31 and at their lower ends are keyed to another shaft H-32 which in turn is journaled in the two main frames 31 and 33 at H-33 and H-34. The fixed diameter pulley H-16 which is keyed to the shaft H-20 drives the shaft H-20 and there is also another spring-loaded variable speed pulley H-22 also keyed to shaft H-20. This pulley drives another fixed diameter pulley H-14 which is mounted on the hand-wheel shaft 23 through a V-belt H-21.

The two swinging arms H-23 and H-24 may be caused to swing about the center of shaft H-32 under the control of a mechanism that may be used to fix the angular position of the frame carried by arms H-23 and H-24 with the result that the jackshaft H-20 may be positioned at any of an infinitely variable number of positions about the center of shaft H-32. As seen, for instance, in FIG. 13, when jackshaft H-20 is moved to the right and positioned in the solid line position, the distance between the center of the jackshaft H-20 and the center of the motor shaft drive pulley H-13 is increased and at the same time the distance between the center of the jackshaft H-20 and the center of the hand wheel shaft 23 is also increased. This causes the V-belts H-15 and H-21 to force open the spring-loaded variable speed pulleys H-13 and H-22, thereby decreasing the effective diameter of both of these variable speed pulleys and causing the hand wheel shaft 23 to be driven at a slower speed.

Conversely, when the jackshaft H-20 is moved to the left into the dotted line position as shown in FIG. 13, the distance between the center of the jackshaft H-20 and the center of the motor pulley H-13 will be decreased and simultaneously the distance between the jackshaft H-20 and the hand wheel shaft 23 will be decreased. This will cause the spring-loaded variable speed pulleys H-13 and H-22 to compress forming a larger effective fixed diameter in each case and this will cause the speed at which the hand wheel shaft 23 is driven, to increase.

The speed range through which a spring-loaded variable speed pulley of the type used at H-13 and H-22 may be varied is approximately 2 to 1, under normal circumstances. It will thus be seen that the method of mounting the jackshaft H-20 to be adjustably swung about the center of shaft H-32 allows these two spring-loaded variable speed pulleys to work in concert in a manner which permits the drive transmitted from the motor pulley H-13 to the hand wheel shaft 23 to be varied in the ratio of 4 to 1.

The adjustment of the swinging arms H-23 and H-24 about the shaft H-32 is accomplished by turning either of two hand wheels H-35 and H-36 each of which is keyed to a shaft H-40. Shaft H-40 has a threaded portion as seen in FIG. 13, which is in engagement with the threaded portion of a swinging block H-41 which is attached to the arm H-23. At the end nearest the hand wheel H-36 the shaft H-40 is free to rotate in a pivoted block H-42 which is attached to one of the main frames. There are two collars, H-43, pinned to the shaft H-40 on either side of the pivoting block H-42. Thus, when either of the two adjusting hand wheels H-35 or H-36 are turned the threaded portion of shaft H-40 which engages the internally threaded portion of the block H-41 attached to the arm H-24 causes the swinging arms H-23 and H-24 to swing about an arc centered at the center of the shaft H-32 and depending upon the direction in which the adjusting hand wheels are turned, the swinging arms H-23 and H-24 may be caused to move either in the direction of the solid line position or in the direction of the dotted line position as shown in FIG. 13. The hand wheel shaft 23 (FIG. 12) which is driven in the manner just described has keyed or pinned to it a pinion gear 24 which in turn drives an idler gear 53 (see FIG. 13) which is journaled to turn on a fixed stud 54 attached to the main frame 33. This idler gear 53 in turn drives the gear 45 which is in driving engagement with the lower cylinder 20 through the Oldham coupling 46. The pinion gear 24 also drives the gear 41 which, as previously described, is attached to the mounting ring or disk 37 on the main shaft 32. Since, as previously described, the gear 41 and the gear 40 are both rigidly fixed to the ring or disk 37 on the main shaft 32, the gear 40 is also caused to rotate with shaft 32 when the gear 41 is driven by the pinion 24. The gear 40 in turn drives a pinion 60 which in turn drives another pinion 61 which is in engagement with gear 62 which is mounted on a plate cylinder A-11 mounted in a plate cylinder module in a manner which will be hereinafter described.

As seen in FIG. 13, the motor pulley H-13 is driven in a counter-clockwise direction and in turn drives the pulley H-16 and the jackshaft H-20 in a counter-clockwise direction and through pulley H-22 also drives pulley H-14 and hand wheel shaft 23 and pinion 24 in a counter-clockwise direction. The pinion 24 drives the idler gear 53 in a clockwise direction and it in turn drives the gear 45 and the lower cylinder in a counter-clockwise direction. The pinion 24 which is turning in a counter-clockwise also drives the main cylinder in a clockwise direction together with gears 40 and 41 so that gear 40 drives the pinion 60 in a counter-clockwise direction and it in turn drives the pinion 61 in a clockwise direction and finally pinion 61 drives gear 62 and the plate cylinder A-11 in a counter-clockwise direction.

AVOIDING GEAR STREAKS

One of the recurrent problems in conventional printing presses is the occurrence of what are known as "streaks". Such "streaks" when they occur normally appear in a regular pattern, horizontally across the cylinders of the press. A number of methods of minimizing such streaks have been suggested in the past and these include various means for taking up the backlash in the gears of the press. Another common method has been to make the ink rollers in the inking mechanism of such diameter that any pair of rollers which contact each other are of different size so that any pattern will not tend to be carried through the inking mechanism in a repetitive fashion.

I have found that a great improvement in controlling the tendency of a press to streak can be accomplished by designing the train of gears that transmit the drive throughout the press in such manner that no two gears which mesh with each other are the same size and further that no two gears which mesh with each other contain numbers of teeth that are evenly divisible one into the other.

This principle has been carried out throughout the preferred form of the press illustrated herein as will be pointed out in more detail in connection with each of the portions of the gear drive as they are described hereinafter. With respect to the gears in the gear train shown in FIGS. 12 and 13, the gear pinion 24 has 37 teeth and it in turn meshes with the idler gear 53 which has 53 teeth. The idler gear 53 in turn meshes with the gear 45 on the lower cylinder 20 and the gear 45 has 112 teeth. Going back to the pinion 24 it will be noted that the pinion 24 also meshes with the gear 41 on the large cylinder shaft 32 and the gear 41 has 224 teeth. Fastened to gear 41 and turning with it on large cylinder Shaft 32 is gear 40 which also has 224 teeth. Gear 40 in turn meshes with an idler pinion 60 which has 20 teeth which in turn meshes with another idler pinion 61 which has 19 teeth which in turn meshes with gear 62 which has 112 teeth which drives the plate cylinder A-11.

It should be noted that whereas in FIG. 13 it would appear that the gear 45 on the lower cylinder 20 meshed with one of the gears 40 or 41 on the large cylinder shaft 32 and that in turn one of these gears meshed with the gear 62 on the plate cylinder A-11, this is not the case as will be apparent in FIG. 12 in which it may be seen that gears 40 and 41 on the large cylinder shaft 32 are spaced apart from each other in different vertical planes and that the gear 45 for the lower cylinder 20 is spaced between the two gears 40 and 41 and in mesh with neither. Similarly, the gear 62 on the plate cylinder A-11 is spaced between the two gears 40 and 41 on the large cylinder shaft 32 and is in mesh with neither.

It will thus be seen that each of the gears in the gear train described above meshes only with gears having a number of teeth such that the number of teeth in any two gears which mesh together is such that in no case is the number of teeth in one gear of a pair evenly divisible into the number of teeth in the other gear of the pair.

As seen in FIG. 12, there are two segments, F-41 mounted on the rings 36 and 37 on shaft 32.

It will be noted in FIGS. 11 and 12 that there are three slots 63, 64 and 65 cut in the main frame 33 to allow the jackshaft H-20 and the two tie-bars H-30 and H-31 which connect the swinging arms H-23 and H-24 to project through the main frame 33 and yet allow the jackshaft H-20 and the frame which supports it to be swung about the center of shaft H-32.

Certain other elements that will be shown and described in greater detail hereafter may be seen in FIG. 11. These include a paper support plate 66 with projecting fingers 67 along its leading edge to support a sheet of paper as it enters gripper bars carried around the lower cylinder 20. This paper support plate 66 is also cut out to provide for the lower feed roll 27 and the upper feed roll 28. A portion of the sheet detector mechanism may also be seen and this consists of a detector finger M-11 which may also project down through a slot in the paper support plate 66 and which is carried in a rocker arm M-12 which in turn is rigidly fixed to a rocker shaft M-13 which is journaled for rocking movement in the two side frames 31 and 33. Certain portions of the interconnecting linkage between this detector rocker arm and other portions of the sheet detecting and cylinder latching mechanisms are also shown in the isometric view in FIG. 11.

MODULE MOUNTING STATIONS

While in FIG. 11, the spreader bars 13, 14, 15, 16 and 17 are all shown as bars extending from frame 31 to frame 33 and acting to secure these frames in rigid spaced parallel relationship to each other, one of these spreader bars, as for instance 17, could be removed and simply replaced by two studs, one projecting a short distance in from frame 31 and the other projecting a short distance in from frame 33. These two studs would then serve the purpose to be later described with respect to the mounting of printing modules around the upper portion of the main frame structure, while at the same time leaving greater access to the surface of segments to be mounted on the disks 36 and 37 affixed to shaft 32 and would also facilitate the removal and attachment of such segments to disks 36 and 37.

FIG. 14, illustrates in somewhat more detail one manner in which four plate cylinder modules may be mounted at the four module mounting positions I, II, III, and IV of this embodiment of the 2R model press. In addition to the details shown in FIG. 14, the method by which these modules are so mounted is shown and will be described in more detail in FIGS. 15 through 24.

It should be noted that in all cases the large printing cylinder is journalled to turn about a fixed center while the lower printing cylinder and each plate cylinder are each journalled about an eccentrically mounted shaft which allows them to be moved toward and away from the large printing cylinder.

As seen in FIG. 14 the spreader bars 13, 14, 15, 16, and 17 which act together to tie the main frames 31 and 33 of the press together in fixed rigid parallel spaced relationship are each spaced the same distance from the center of the shaft 32 for the large printing cylinder. Also each of the spreaders 13, 14, 15, 16 and 17 is spaced from the adjacent spreader by an equal distance. The five spreaders thus form four module mounting positions or stations, I, II, III and IV each of which consists of a pair of spreader bars spaced an equal distance from each other and each spaced equidistant from the center of shaft 32.

Thus the pair of spreaders 13 and 14 form module mounting position I. The pair of spreaders 14 and 15 form module mounting II. The pair of spreaders 15 and 16 form module mounting III and the pair of spreaders 16 and 17 form module mounting IV.

The means by which ink or ink/dampening modules may be attached at various of these module mounting stations and the means by which dampening attachments may be affixed at various of these mounting positions will be described in greater detail hereafter.

For preset purposes, FIG. 14 through 24 illustrate the means by which plate cylinder modules are mounted at any one, at any two, at any three, or at all four of the module mounting positions.

A bracket A-20 is attached to each of the side frames A-21 of a plate cylinder module and forms the means Ly which the plate cylinder module is attached and mounted at any one of the module mounting positions.

Figure 15:
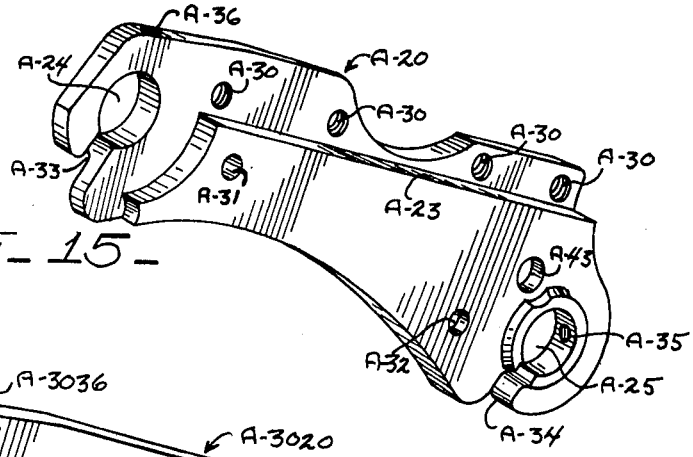
FIG. 15 is a perspective view of a plate cylinder module mounting bracket for a 2-R press.

The mounting bracket A-20 for the 2-R press is illustrated in greater detail in FIG. 15 and is so constructed that identical mounting brackets may be mounted to each of the two side frames of a plate cylinder module and if any number of plate cylinder modules up to four are to be mounted at any of the module mounting stations I, II, III and IV, identical mounting brackets A-20 may be attached to the two side frames A-21 of each plate cylinder module and the plate cylinder modules thereby attached at any or all or any combination of the mounting positions and when so mounted each of the frames of the plate cylinder modules will lie in the same vertical plane with each of the other comparable side frames of each other plate cylinder module.

The means by which this is accomplished is illustrated in considerable detail in FIGS. 14 through 24.

In FIG. 14 the comparable parts of the plate cylinder module and mounting brackets carry a suffix "a" after each number designation for the plate cylinder module shown mounted in mounting position I. The comparable parts for the plate cylinder module and mounting bracket mounted in mounting position II carry the suffix "b" after the number designation. Similarly, the plate cylinder module and mounting bracket arrangement mounted in mounting position III carries the suffix "c" after the number designation of the comparable parts and similarly with respect to the plate cylinder module mounted in mounting position IV the comparable parts carry the suffix "d".

Starting with the plate cylinder module mounted in position I, as seen in FIG. 14, the side frame A-21-*a* of the plate cylinder module are fastened to the mounting bracket A-20*a* by means of four screws A-22*a* with the base of the frames A-21*a* resting on the ledge A-23*a* of the mounting bracket A-20*a*.

MOUNTING BRACKETS

Figure 19:
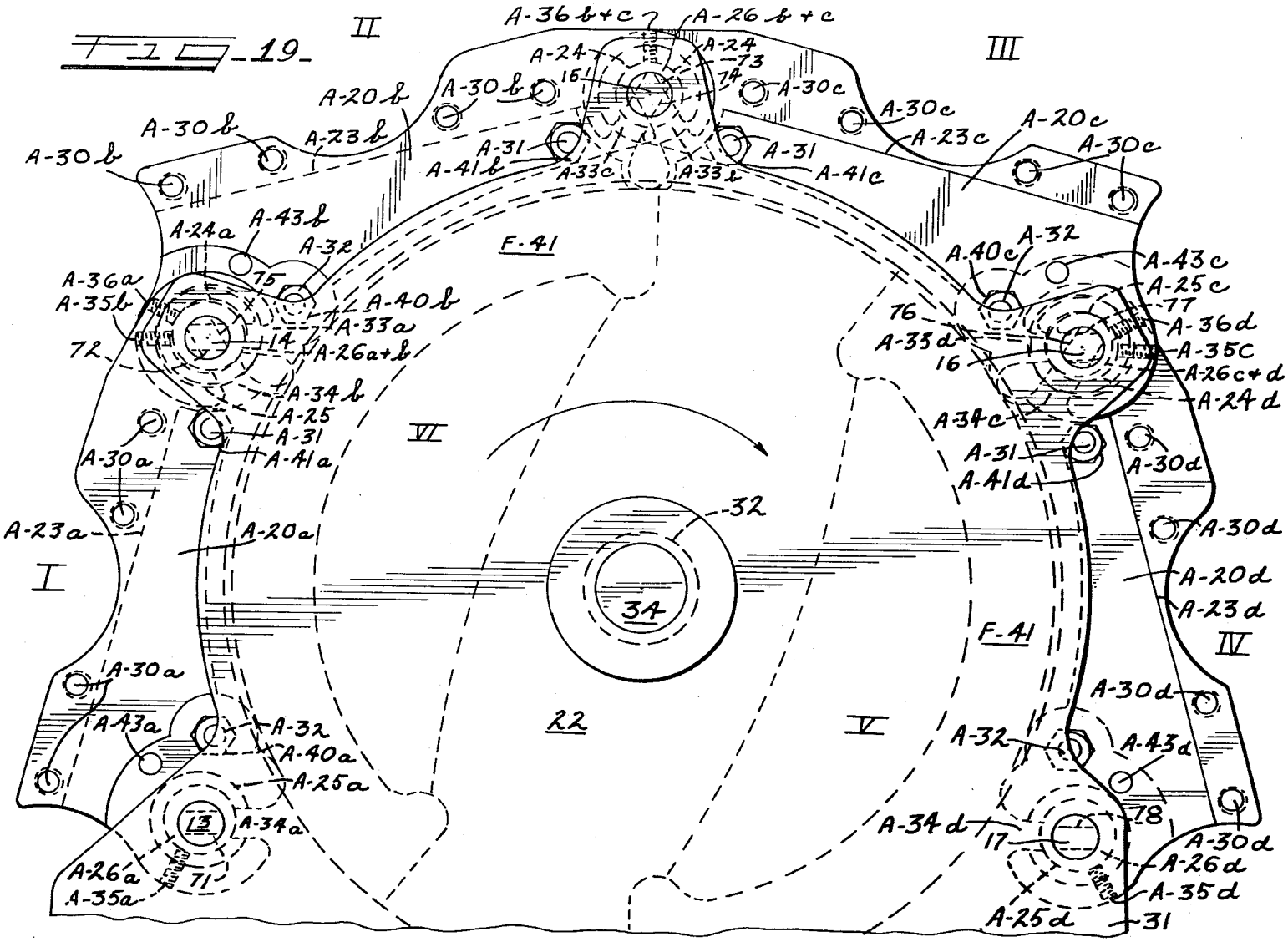
FIG. 19 is a view to larger scale showing the installation of plate cylinder module supporting brackets at all four of the mounting stations I, II, III and IV.
Figure 21:
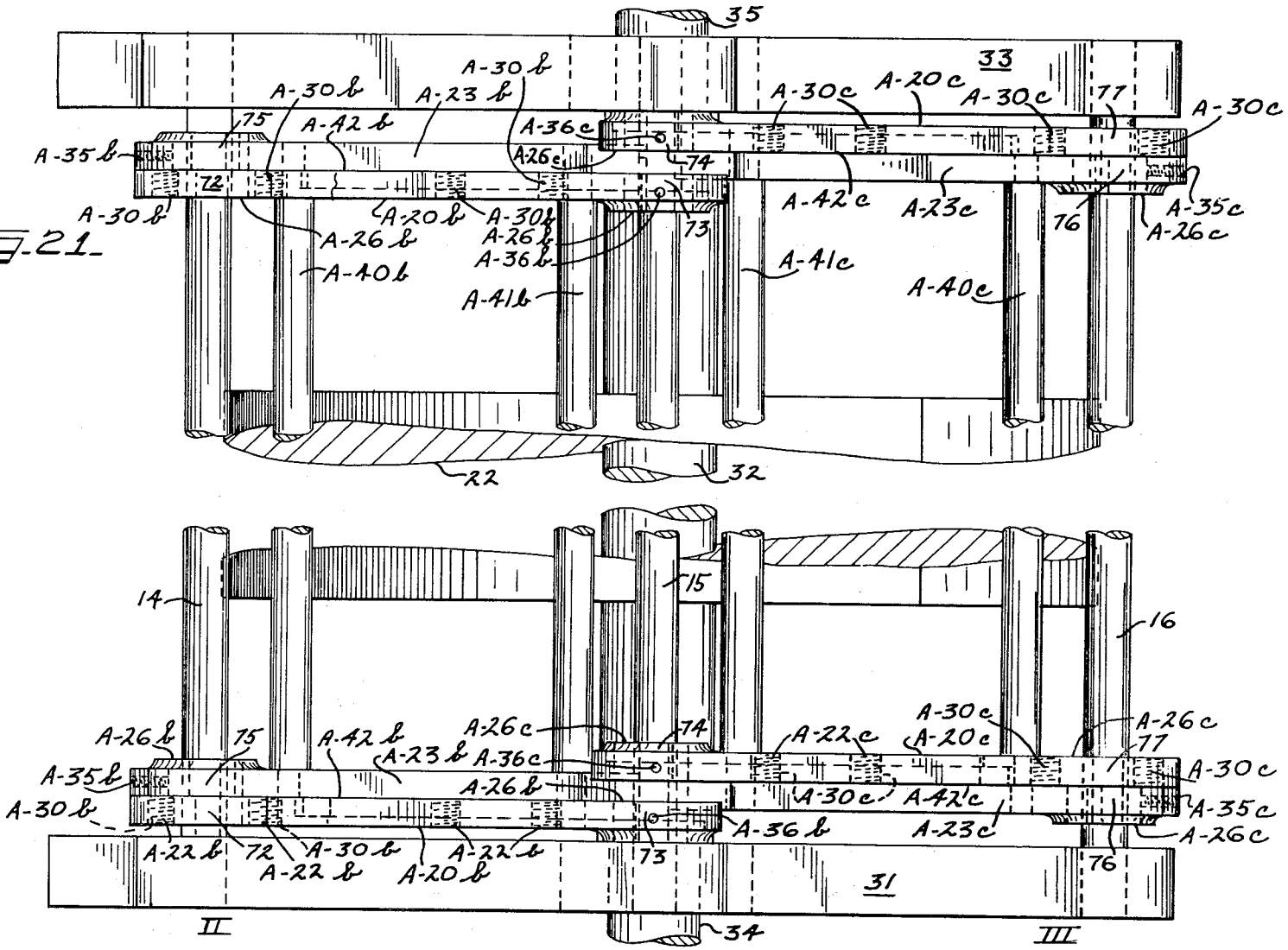
FIG. 21 is a top view of the press frame structure and plate cylinder module mounting brackets.
Figure 22:
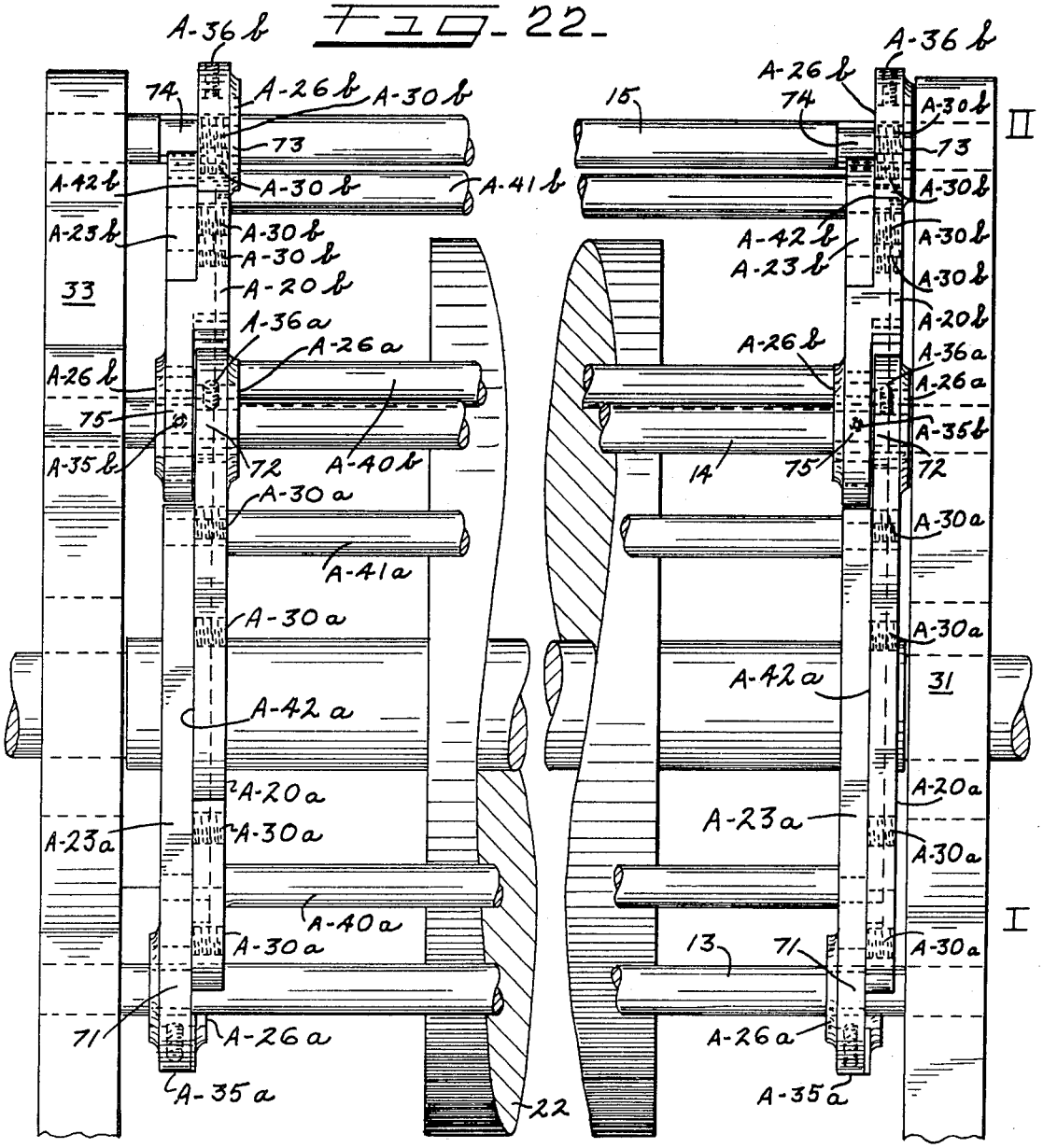
FIG. 22 is a view similar to FIG. 20 but showing the press frame structure and plate cylinder module mounting brackets as seen from the left side of FIG. 19.

FIG. 15 shows the mounting bracket A-20 in more detail. At either end of the mounting bracket there is a cylindrical shaped recess A-24 and A-25 into which a sleeve A-26 fits snugly. There is an off-center hole through the sleeve A-26 which in turn fits over one of the cross-members 13, 14, 15, 16 or 17 thereby forming an eccentric sleeve which may be rotated about the tie-bar on which it fits to adjust the position of the bracket A-20 toward and away from the large cylinder. The distance between the center of the cylindrical opening A-26 and the center of the cylindrical opening A-25 is identical to the distance between any adjacent pair of spreader bars, as for example 13 and 14. There is a shelf portion A-23 on which the base of one of the frames A-21 of a plate cylinder module may rest with four holes along the base of the plate cylinder module A-21 being in alignment with the four tapped holes A-30 of the mounting bracket A-20 so that screws may be passed through each of the holes in the base of the frame of the plate cylinder module and threaded into the holes A-30 in the mounting bracket to secure the mounting bracket to the base of the frame of the plate cylinder module. In each case each pair of mounting brackets A-20 is in turn tied together by means of two spacer bars A-40 and A-41 which pass through the two holes A-31 and A-32 in each of the mounting brackets with a threaded portion of each spacer bar projecting through each of the holes A-31 and A-32 and a nut securing the spacer bar by threading over the threaded portion thereof from the outside of the mounting bracket A-20. Referring particularly to FIG. 19 and as detailed in FIG. 18 each of the spreader bars, as for instance 13 and 14, has a flat portion milled therein as at 71 and 72. The thickness of this flat portion is such as to allow the bracket A-20 to be placed over the spreader bars 13 and 14 with the two clearance slots A-33 and A-34 being just wide enough to slide over the flats 71 and 72 on the spreader bars 13 and 14. The eccentric sleeves A-26 are assembled onto the spreader bars 13 and 14 before the spreader bars themselves are assembled into the frames. After the bracket A-20 has been slid over the two spreader bars 13 and 14 in the manner described, the eccentric sleeves A-26 are slipped into the cylindrical openings A-24 and A-25 in the mounting brackets. The sleeves A-26 at either end of the mounting bracket may then be rotated by spanner wrench A-27 to align the mounting brackets properly so that the frames of the plate cylinder module A-21 are in proper alignment with the main frames of the press 31 and 33. Set screws A-35 and A-36 are then locked into position against these eccentric sleeves A-26 to secure them in their adjusted position, and in this manner the plate cylinder module shown in mounting position I is secured in position. Any one or all of the plate cylinder modules may be attached in mounting positions II, III and IV in similar fashion, and the construction of the mounting bracket A-20 is such that the identical mounting brackets will then overlap each other and provide a mounting surface for each of the frames of each of the plate cylinder modules in such manner that the frames of the plate cylinder modules so mounted will be in alignment with each other in the same vertical plane. The means by which this is accomplished is illustrated in FIGS. 19, 20, 21 and 22, in which FIG. 19 is a side view of the press frame structure showing four of the mounting brackets mounted in the four module mounting stations in the manner previously described. FIG. 20 shows the press frames and the mounting brackets A-20 as seen from the right side of FIG. 19. FIG. 21 shows the press frame structure and the plate cylinder mounting brackets A-20 as seen from the top looking down on FIG. 19, and FIG. 22 shows the press frame structure including the plate cylinder mounting brackets A-20 as seen from the left side of FIG. 19. Since the mounting brackets on both sides of the press are in alignment with each other, FIG. 19 shows only the four mounting brackets that appear at the front side of the press, whereas the other FIGS. 20, 21 and 22 show each pair of mounting brackets at each side of the press that are used to support the two frames of each plate cylinder module. The two mounting brackets A-20*b* and A-20*c* as seen in FIG. 19 are mounted in such fashion that the cylindrical hole A-24 of each has been slid over spreader bar 15 with the opening A-33*b* of bracket A-20*b* passing over the flats 73 of spreader bar 15 and the slot A-33*c* of bracket A-20*c* passing over the flats 74 of spreader bar 15. Similarly, the cylindrical opening A-25*b* in bracket A-20*b* is around spreader bar 14 with the slot A-34*b* having passed over the flat 75 of spreader bar 14. Similarly, the cylindrical opening A-25*c* of mounting bracket A-20*c* surrounds spreader bar 16 with the slot A-34*c* having passed over the flats 76 in spreader bar 16.

Mounting bracket A-20*a* has its cylindrical portion A-24*a* surrounding spreader bar 14 with the slot A-33*a* having passed over the flats 72 and the cylindrical portion A-25*a* surrounds spreader bar 13 with the slot A-34*a* having passed over flat 71 in spreader bar 13.

Similarly, mounting brackets A-20*d* has its cylindrical portion A-24*d* surrounding spreader bar 16 with a slot A-33*d* having passed over the flats 77 on spreader bar 16 and the cylindrical portion A-25*d* of bracket A-20*d* surrounds spreader bar 17 with the slot A-34*d* having passed over the flats 78 in spreader bar 17.

In each case, eccentric sleeve A-26 surrounds the spreader bar and is slid into position in a cylindrical opening at either end of each of the mounting brackets and after having been rotated to accomplish the alignment of each of the mounting brackets with the main frames of the press are secured in position by locking set screws A-35 and A-36. In FIG. 20 it will be seen that the mounting brackets A-20*d* on either side of the press are held together by tie bars A-40*d* and A-41*d* which are secured through holes A-32 and A-31 in the mounting brackets in the manner previously described. The same is true of tie bars A-41*c* and A-40*c* which tie together with two mounting brackets A-20*c* and similarly, as seen in FIG. 22 tie bars A-41*b* and A-40*b* tie together the mounting brackets A-20*b* and tie bars A-41*a* and A-40*a* tie together the mounting brackets A-20*a*.

FIG. 21 shows mounting brackets A-20*b* and A-20*c* as seen from above.

When one of the plate cylinder module frames A-21 is secured to a mounting bracket A-20 as previously described by means of bolts A-22 the adjoining face of the plate cylinder module frames A-21 is held securely in contact with the face A-42 of the bracket A-20. As seen in FIG. 21, each of the mounting brackets A-20*b* and the mounting brackets A-20*c* are spaced apart from each other so that the distance from the face A-42*b* of each of the mounting brackets A-20*b* to the face A-42*c* of each of the mounting brackets A-20*c* is exactly equal to the thickness of the base portion of the plate cylinder module frame A-21. Considering frame 31 to be the front of the press, each of the bolts A-22*c* which holds the frame A-21*c* to the mounting brackets A-20*c* comes from the front of the frame through the frame and into the threaded hole A-30*c* in the mounting bracket.

Conversely, each of the bolts A-22*b* which holds each frame A-21*b* to the mounting bracket A-20*b* comes from the back of the frame through the hole in the frame and is threaded into the threaded portion A-30*b* in the mounting bracket A-20*b*.

The result is that each of the frames A-21*b* and A-21*c* is held in the same vertical plane as its counterpart, although in the case of the frames A-21*d*, the bracket is at the back of the frames and in the case of the frames A-21*c* the bracket A-20*c* is in front of the frames A-21*c*.

Referring to FIG. 20, it will be seen that the faces A-42*d* of the bracket A-20*d* are in alignment with the faces A-42*c* of the brackets A-20*c* and therefore the frames A-21*d* affixed to the brackets A-20*d* will in turn be in vertical alignment with the frames A-21*c* affixed to the brackets A-20*c*.

Similarly, referring to FIG. 22 it will be seen that the faces A-42*a* of the brackets A-20*a* are in alignment with the faces A-42*b* of the brackets A-20*b* and therefore the frames A-21*a* affixed to the brackets A-20*a* will be in alignment with the frames A-21*b* affixed to the brackets A-20*b*.

It will thus be seen that the mounting bracket A-20 may be used in any of eight different positions to accomplish the mounting of plate cylinder modules in any or all or any combination of the four module mounting positions I, II, III and IV with the mounting brackets being affixed in turn to the spreader bars 13, 14, 15, 16 and 17 which form the four module mounting positions as previously described. It will also be seen that each of these mounting brackets may be aligned by means of the eccentric sleeves A-26 to align the frames of each of the plate cylinder modules with the main frames 31 and 33 of the press.

MODULE STATIONS AND MOUNTING BRACKETS—3R PRESS

As has previously been pointed out, the module mounting stations I, II, III and IV for the 3R press are similarly formed with the exception that the uniform distance from the center of the shaft 32 to the center of each of the spreader bars 13, 14, 15, 16 and 17 is greater in the case of the 3R press and the uniform distance between pairs of the spreader bars is greater in the case of the 3R press.

Figure 16:
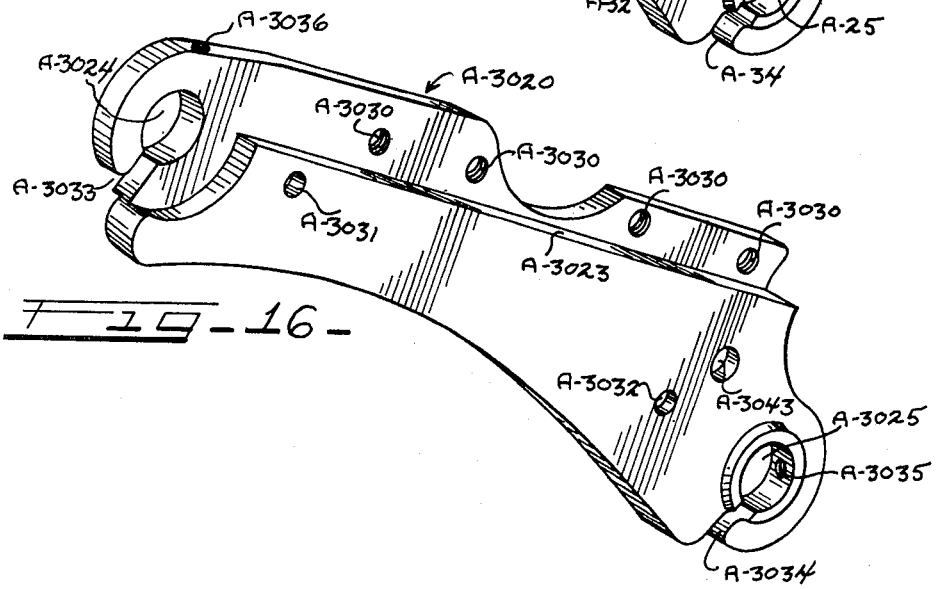
FIG. 16 is a perspective view of a plate cylinder module mounting bracket for a 3-R press.

FIG. 16 illustrates the mounting bracket A-3020 which is used for mounting the same plate cylinder modules as are used on the 2R press on the 3R press. The difference between the mounting bracket A-20 for the 2R press as shown in FIG. 15 and the mounting bracket A-3020 for the 3R press as shown in FIG. 16 lies in the fact that the distance between the centers of the cylindrical openings A-24 and A-25 in the bracket A-20 are spaced apart by the distance by which the spreader bars on the model 2R press are spaced apart, whereas on the mounting bracket A-3020 for the model 3R press as shown in FIG. 16, the centers of the cylindrical openings A-3024 and A-3025 are spaced apart identically to the spacing of the spreader bars on the model 3R press.

It should be noted that the shelf portion A-23 and the size and positioning of the threaded holes A-30 are identical on both the mounting bracket A-20 for the 2R press and the mounting bracket A-3020 for the 3R press. The design of the mounting bracket A-20 for the 2R press is such that when a plate cylinder module is mounted on the shelf A-23 and secured to the bracket with bolts threaded into the holes A-30 the plate cylinder module as a whole is held in such a position that the plate cylinder A-11 mounted therein is held in rotational tangential relationship to the large printing cylinder 22. Similarly, the construction of the mounting bracket A-3020 for the 3R press is such that when the same plate cylinder module is secured thereto with the frames A-21 thereof resting on the ledge A-3023 and secured by the mounting bracket by bolts threaded into the holes A-3030 the plate cylinder module is held in proper relationship to the large printing cylinder of the 3R press so that the plate cylinder A-11 in the module is held in rotational tangential relationship to the large printing cylinder of the 3R press.

In both cases the basic plate cylinder module itself, including the frames A-21 and the plate cylinder A-11 is the same whether used on the 2R press and mounted on the mounting bracket A-20 or whether used on the 3R press and mounted on the mounting brackets A-3020.

In the case where the idler gears 60 and 61 as shown in FIG. 13 are used, the idler gear 60 is journaled about the tie-bar A-40, and the idler gear 61 is journaled on a stud A-47 which is affixed to the mounting bracket through the mounting hole A-43.

PLATE CYLINDER MODULES

Figure 17:
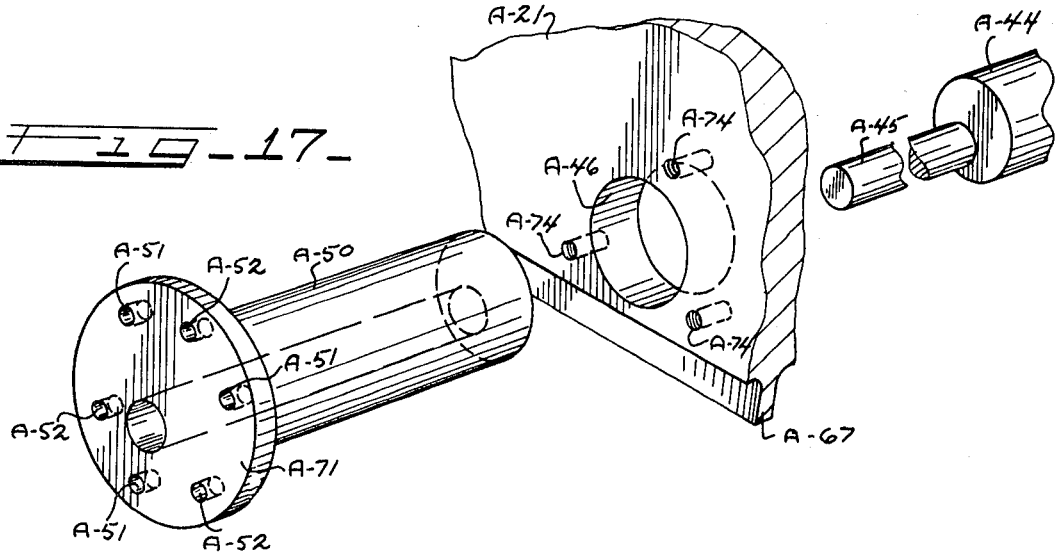
FIG. 17 is an exploded perspective view of a portion of a plate cylinder module frame showing the mounting of an eccentric sleeve in the frame for receiving an eccentric end portion of the plate cylinder shaft.

Referring to FIGS. 14 and 17 it will be seen that there is plate cylinder A-11 mounted in each of the plate cylinder modules. Each plate cylinder A-11 is journaled to rotate about a shaft A-44. Each of the plate cylinder shafts A-44 has eccentric end portions A-45 extending outwardly at either end of the plate cylinder shaft A-44. Each of the plate cylinder module frames A-21 has a hole A-46 bored therein concentric with the plate cylinder shaft A-44 and the plate cylinder A-11. An eccentric sleeve member A-50 projects into the hole A-46 in the frame A-21 and receives the eccentric projection A-45 at the front end of the plate cylinder shaft A-44 and a somewhat similar eccentric sleeve member A-71, shown in FIG. 26, receives the similar eccentric projection A-45 at the back end of the plate cylinder shaft A-44 thereby supporting the plate cylinder shaft A-44 between the frames A-21. Each of the eccentric sleeves A-50 has a flange portion A-71 which lies in contact with the face of the frame A-21. There are three threaded holes A-74 in the frame A-21 spaced 120 degrees from each other and equidistant from the center of the shaft A-44 within the area of the flange portion of the eccentric sleeve A-50. The eccentric sleeve A-50 has two sets of three holes each through the flange portion, each spaced, in each case, 120 degrees from each other and at a distance from the center of shaft A-44 equal to the distance of the threaded holes in the frame A-21 from the center of shaft A-44. One set of three such holes is numbered A-51 and the other set of three such holes is numbered A-52. The two sets of holes are aligned with respect to each other and with respect to the eccentric holes for receiving the end portions A-45 of shaft A-44 in such manner that when the eccentric sleeve for the plate cylinder modules mounted in mounting positions III and IV are aligned so that the holes A-51 are in alignment with the tapped holes A-74 in the frame A-21, the eccentric sleeves may be fastened to the frames A-21 by means of bolts passing through the flange of the eccentric sleeve A-50 and through the holes A-51 and into the threaded holes in the frame A-21, and when so aligned a line drawn from the center of the large cylinder shaft 32 to the center of the eccentric projection A-45 will be approximately at right angles to a line drawn between the center of the eccentric projection A-45 and the center of the plate cylinder shaft A-44.

Thus, when the eccentric end portions A-45 of the shaft A-44 are rotated in a counter-clockwise direction as seen in FIG. 14, the center of the plate cylinder shaft A-44 and therefore the center of the plate cylinder A-11 will be moved away from the center of the large cylinder shaft 32 and when the eccentric end portions A-45 of the plate cylinder shaft A-44 are rotated in a clockwise direction as seen in FIG. 14, the center of the plate cylinder shaft A-44, and therefore the center of the plate cylinder A-11, will be moved toward the center of the large cylinder shaft 32.

With respect to plate cylinder modules mounted in mounting positions I and II, the same result is achieved by aligning the holes A-52 with the tapped holes in the frames A-21 and then affixing the eccentric sleeves A-50 to the frames A-21 by passing bolts through the holes A-52 in the flanges of the eccentric sleeves A-50 and securing them into the threaded portion of the holes in the frames A-21.

INK FOUNTAIN MOUNTING

Each of the plate cylinder modules also includes a rectangular spreader bar A-53 which, together with other spreader bars, holds the frames A-21 of the plate cylinder modules in parallel fixed spaced relationship to each other.

There are two holes in each of the frames A-21, these holes being designated A-54 and A-55, either of which may be used to secure the ends of the rectangular spreader bar A-53. The centers of these holes are equidistant from the center of the ink fountain roll A-56. When the plate cylinder module is affixed in mounting position I, the rectangular spreader bar A-53 may be secured through either holes A-54 or A-55. When the plate cylinder module is mounted in mounting position III, the rectangular spreader bar A-53 is mounted through the holes A-55. When the plate cylinder module is mounted in module mounting position II, the rectangular spreader bar A-53 is mounted through the holes A-54. When the plate cylinder module is mounted in module mounting position I, the rectangular spreader bar A-53 may be mounted through either holes A-54 or A-55.

When the plate cylinder module is mounted in either module mounting position II or mounting position II the ink fountain A-60 rests on and is supported by the rectangular spreader bar A-53 and the position of this spreader bar in each case is such as to support the ink fountain A-60 in a substantially horizontal position.

When the plate cylinder module is mounted at module mounting position I an additional pair of brackets A-61 are attached to the plate cylinder module frames A-21 and these brackets A-61 carry another rectangular spreader bar A-62 on which the ink fountain A-60 rests in a substantially horizontal position. It will be noted that the ink fountain roller A-56 turns in a counter-clockwise direction as seen in FIG. 14 and in each of the module mounting positions I, II and III the direction of the rotation of the ink fountain roller is such as to pull the ink inwardly of the fountain.

When the plate cylinder module is attached at mounting position IV additional brackets A-63 are affixed to the plate cylinder module frames A-21 and they in turn support another rectangular spreader bar A-64 which in turn supports the ink fountain A-60 in a substantially horizontal position and in this case an additional roller A-65 is added which in this case becomes the ink fountain roller and this roller turns in a clockwise direction thereby urging the ink inwardly of the fountain and ink fountain roller A-65 rides in contact with roller A-56 which as in all other cases, turns in a counter-clockwise direction as seen in FIG. 14.

Thus the ink fountain is supported in a substantially horizontal position irrespective of which of the four module mounting positions I, II, III or IV are used and in each case the ink fountain roller turns in a direction such as to cause the ink to be urged inwardly of the fountain.

SELECTIVELY ASSEMBLED CONFIGURATIONS

One of the important freatures of the press of the present invention is that the various parts, assemblies, printing modules and other components of the press are so constructed that a manufacturer of such presses need only provide tooling for, and manufacture and carry in inventory a comparatively limited number of standardized parts, assemblies, components, and modules and may then assemble from these a wide range of different press models having widely varied printing function capabilities. In addition to the inherent advantages that this has for the manufacturer of such presses, it also provides important advantages for the purchaser and user of such equipment. Different users of sheet-fed presses of the general type disclosed herein have widely differing requirements and one of the advantages that accrues to such users from the structures and combinations disclosed herein is that the manufacturer may offer a sufficiently wide range of models with differing printing function capabilities so that each user or class of users need purchase only a model having those printing function capabilities required by the specific application or applications involved, while other models having different and/or additional printing function capabilities may be offered to other users or classes of users to fulfill their specific requirements without the need to resort to tooling, manufacturing and carrying inventory of all of the many parts, assemblies, components, etc. which would be required were these different press mdels constructed in the conventional manner with each constituting a separate press structure.

The manner in which this is accomplished is most apparent with respect to the manner disclosed by which various different printing modules may be selectively assembled into a wide range of different combinations and figurations to provide different printing function capabilities. However, this principle of construction which centers about the provisions of standardized components and parts and assemblies which may be assembled together in different configurations to meet the requirements of different classes of users will also be found in many other areas of the design and construction of the presses disclosed herein. One example of this is illustrated in FIG. 23, 24, and 25 which illustrate three alternate means by which the drive transmitted to the pinion 24 on the hand wheel shaft 52 from the drive motor as previously described in detail is in turn transmitted to the large and lower cylinders of the press, to the plate cylinders of such plate cylinder modules as may be used in any particular model and to the gearing for such inking modules, ink/dampening modules or dampening modules as may be used in any particular model of the press. As will be pointed out, FIGS. 23, 24 and 25 illustrate a number of elements which are common to the construction shown in all three figures and which represent identical parts irrespective of which of the three alternate constructions shown in FIGS. 23, 24, and 25 is employed.

FIG. 26 shows the mounting mechanism for the large printing cylinder 22, the lower printing cylinder 20 and one of the plate cylinders A-11 as seen from outside of main frame 33 and plate cylinder module frame A-21. FIG. 26 serves as a side view of the mounting arrangements for the three cylinders 20, 22 and A-11 of either FIGS. 23, 24, or 25, and each of FIGS. 23, 24 and 25 are seen along the line 23—23, 24—24 and 25—25 of FIG. 26.

PRINTING CYLINDERS, MOUNTING AND ADJUSTMENT

The following is a description of the mounting of the three cylinders of FIGS. 23, 24 and 25 each taken with FIG. 26 as a side view thereof. The lower cylinder 20 is journaled on and turns about shaft 21. Shaft 21 in turn has eccentric projecting end portions 43 and 44 at either end, one of which such projecting end portions 44 is seen in FIGS. 23, 24, 25 and 26. This eccentric projecting end portion 44 of the shaft 21 is held for rocking motion within an eccentric hole within an eccentric sleeve 82. The outside portion of eccentric sleve 82 fits snugly within a hole in main frame 33 and may be rotated within a small angle within said hole in the main frame 33 for purposes of adjustment that will be hereinafter described. Eccentric sleeves 82 has a flange portion 82 integral therewith. There are three slots 84 spaced equidistant from each other and equidistant from the center of the sleeve 82 through which pass three bolts 85, each of which is threaded into a tapped hole in the main frame 33. The lower cylinder 20 may be made parallel to the large cylinder 22 by raising or lowering the projecting eccentric end portion 44 of the shaft 21 which passes through main frame 33 in the following manner:

When the bolts 85 are loosened the flange 83 and with it the eccentric sleeve 82 may be rotated either clockwise or counter-clockwise as seen in FIG. 26. When rotated in a counter-clockwise direction the hole in the eccentric sleeve 82 in which the eccentric projection 44 of shaft 21 is held is raised and thereby the end of the shaft 21 and of the cylinder 20 closest to the frame 33 is lifted bringing the center of cylinder 20 at the end nearest frame 33 closer to the center of the large cylinder 22.

Similarly when the flange portion 83 and with it the eccentric sleeve 82 is rotated in a clockwise direction the eccentric hole within the sleeve 82 and the projecting eccentric end portion 44 of the shaft 21 is moved downwardly away from cylinder 22 and thereby the end of cylinder 20 nearest the main frame 33 has the distance between its center and the center of cylinder 22 increased. Throughout this adjustment the other end of cylinder 20 nearest main frame 31 remains stationary and therefore cylinder 20 may be brought into parallelism with cylinder 22 and when this has been accomplished the bolts 85 are tightened and the adjustment is thereafter maintained.

After the cylinder 20 has been brought into parallelism with cylinder 22 as described above the distance between the center of cylinder 20 and the center of the large cylinder 22 may be increased or decreased by rotating the eccentric end portion of shaft 21 in a counter-clockwise or a clockwise direction as viewed in FIG. 26. The manner in which this is accomplished and the purpose for which it is used will be described in greater detail hereafter. It will be noted that the line connecting the center of shaft 21 and the center of the eccentric projecting portion 44 is approximately at right angles to the line connecting the center of shaft 21 with the center of shaft 32. Thus when the projecting end portion 44 of shaft 21 is moved slightly in either a clockwise or a counter-clockwise direction the axis of shaft 21 moves through a small arc which lies very close to the line connecting the centers of the large cylinder 22 and the lower cylinder 20.

At one point of the rocking motion of the eccentric end portion 44 the axis of the shaft 21 is in alignment with the axis of the sleeve 82.

The gear 45 for the lower cylinder 20 is journaled on the outside of the sleeve 82. The gear 45 has two hubs 86 and 87 and is journaled to turn about the outer portion of the sleeve 82. The center of the hole in the main frame 33 into which the sleeve 82 is fitted is spaced away from the center of the hole in main frame 33 into which the bearing 92 for shaft 32 of cylinder 22 is fitted by one-half the sum of the pitch diameters of the gear 45 for the lower printng cylinder 20 and the gear 41 for the large printing cylinder 22. Gear 45 drives lower printing cylinder 20 through an Oldham coupling 46. A sprocket 88 is shown affixed to the lower printing cylinder 20 and a similar sprocket is affixed to the other end of lower printing cylinder 20 nearest main frame 31. These sprockets are used to carry chains which in turn carry the gripper bars of an encircling chain delivery mechanism. The pitch diameter of the sprockets 88 is substantially equal to the pitch diameter of the gear 45.

The large printng cylinder 22 comprises a shaft 32 on which are mounted the two disc members 36 and 37 as previously described and on which may be mounted one or two printng segments as for instance F-41 as seen in FIGS. 23, 24 and 25, or, in the 3R model one, two, or three printing segments. The disc member 37 as seen in FIGS. 23, 24, and 25 has a hub portion 42 which is fastened to the shaft 32 by a taper pin 55 or which may be keyed to the shaft 32 if preferred. Concentric end portions 34 and 35 of shaft 32 are journaled in ball or roller bearings 92 in main frame 33 and there is a projecting concentric portion 34 of the large cylinder shaft 32 which projects beyond the main frame 33. It will be noted that whereas the lower cylinder 20 was journaled about and turned about the substantially stationary shaft 21, the shaft 32 of the large cylinder turns with the large cylinder and is journaled in the main frames of the press.

The ball or roller bearings 92 are held in position within the main frame 33 by means of two capping rings 93 and 94 which are in turn bolted to the main frame 33. The manner in which the capping ring 93 is bolted to the main frame 33 may be seen in FIG. 26, in which there are three bolts 95 equidistant from each other and equidistant from the center of the shaft 32 which pass through holes in the retaining ring 93 and are secured in threaded holes in the main frame 33.

The frame A-21 of the plate cylinder module shown in part in FIG. 23, 24, 25 and 26 is secured to the main frame 33 in the manner previously described in which the mounting portion A-67 of the frame A-21 is attached to a mounting bracket A-20 as hereinbefore described. The plate cylinder A-11 of FIGS. 24, 25 and 26 is mounted in mounting position III. The mounting for the plate cylinder A-11 in the frames A-21 is in many ways similar to the mounting for the lower cylinder 20 in the frames 33. The plate cylinder A-11 is journaled to rotate about a substantially stationary shaft A-44 which has projecting eccentric end portions A-45 which in turn fit snugly into an eccentric hole in sleeve A-707. Sleeve A-707 has an integral flange portion A-708 which in turn has three slots A-72 spaced equidistant from each other and equidistant from the center or concentric axis of the sleeve A-707 and of the flange A-708. The flange is bolted to the frame A-21 by means of three bolts A-73 which pass through the slots A-72 and into threaded holes A-74 in the frame A-21. When the flange A-708 is rocked so that the bolts A-73 are approximately in the center of the slots A-72 the axis of the shaft A-44 and of the plate cylinder A-11 is aligned with the concentric axis of the sleeve A-707.

The plate cylinder A-11 may be brought into parallelism with the large printing cylinder 22 by moving the end of the cylinder nearest to the main frame 33 toward or away from the center of the large cylinder 22 by turning the flange A-708 of the sleeve A-707 with the bolts A-73 loosened. When the flange A-708 is turned in a clockwise direction the center of the eccentric projection A-45 of shaft A-44 is moved toward the center of the large printing cylinder 22 and when the flange A-708 is rotated in a counter-clockwise direction the center of the eccentric projection A-45 of shaft A-44 is moved away from the center of the large printing cylinder 22. Since the end of the plate cylinder A-11 closest to main frame 31 is held in a stationary position this adjustment therefore accomplishes the paralleling of plate cylinder 20 with the large printing cylinder 22 and when this has been accomplished the bolts A-73 are locked in position and the adjustment thereby maintained. The threaded holes A-74 in the frame A-21 into which the bolts A-73 are secured are so located that when the flange A-708 is rotated so that the bolts A-73 are at the center of the slots A-72, the line connecting the center of the large printing cylinder 22 with the center of the sleeve A-707 is approximately at right angles to the line connecting the center of the sleeve A-707 with the center of the eccentric hole in the sleeve A-707 when the plate cylinder module is mounted in either mounting position IV or mounting position III.

When the plate cylinder module is mounted in mounting position II or mounting position I the same result is achieved by rotating the flange A-708 so that the bolts A-73 may be threaded into holes A-75 in the frame A-21.

The gear 62 and 68 for the plate cylinder A-11 is journaled about and revolves about the outer surface of sleeve A-707 and drives the plate cylinder A-11 through an Oldham coupling 56.

When the plate cylinder module has been mounted on the main frames 31 and 33 and aligned therewith as previously described the distance between the center of the sleeve A-707 and the center of the large printing cylinder 22 is equal to one-half the sum of the pitch diameters of the large cylinder gear 41 and the plate cylinder gear 62 and 68. The pitch diameter of the gear 45 on the lower printing cylinder 20 is equal to the effective printing diameter of lower printing cylinder 20. The pitch diameters of gears 40 and 41 are equal to each other and are each equal to the effective printing diameter of large printing cylinder 22. The pitch diameters of gears 62 and 68 are equal to each other and each equal to the effective printing diameter of plate cylinder A-11.

When the eccentric projection A-45 of the shaft A-44 is rotated in a counter-clockwise direction as seen in FIG. 26 the center of shaft A-44 and plate cylinder A-11 is moved closer to the center of large printing cylinder 22, and conversely when the eccentric projection A-45 of shaft A-44 is rotated in a clockwise direction as viewed in FIG. 26 the center of shaft A-44 and plate cylinder A-11 is moved away from the center of large printing cylinder 22. As in the case of the lower printing cylinder 20 the axis of the plate cylinder A-11 moves through a small arc about the center of the eccentric end projections A-45 of shaft A-44, which approximates motion in a straight line toward and away from the center of large printing cylinder 22.

The purpose that this serves and the means by which it is accomplished will be described in more detail hereinafter.

FIGS. 23, 24 and 25 illustrate three different means by which the drive may be transmitted from the pinion 24 to cause the large printing cylinder 22 the lower printing cylinder 20 and the plate cylinder or cylinders A-11 to be driven so they rotate together, with the surface speeds of all cylinders being equal.

GEARING ARRANGEMENT AND VERTICAL IMAGE ADJUSTMENT

The three gearing arrangements illustrated in FIGS. 23, 24 and 25 are useful for different configurations of the press and may be accomplished by assembling the various components described in the three configurations illustrated to match the gearing to the requirements of the application, in providing different models to accomplish a variety of different printing functions or combinations of printing functions.

In FIG. 23 the pinion 24 meshes with the gear 41 for the large printing cylinder 22. The gear 41 fits over the hub 42 of the disc 37 which is secured to the shaft 32. The gear 41 is secured to the disc 37 by means of bolts which pass through it and are threaded into the disc member 37 in a manner which will be described in more detail hereinafter. The hub 91 of gear 41 faces the disc 37 and spaces the gear 41 from disc 37 so that gear 41 is in vertical alignment with the gear 45 of the lower printing cylinder 20, and gear 41 meshes with and drives gear 45. Gear 41 also meshes with and drives gear 62 for the plate cylinder A-11. Gear 62 is held in vertical alignment with gear 41 by the dimension of its two hubs 96 and 97. Gear 62 is adjustably secured to disc member 57 which forms a portion of Oldham coupling 56 in a manner which will be described in more detail hereinafter and which allows for the circumferential adjustment of plate cylinder A-11 with respect to the gear 62 for the purpose of making vertical image position adjustments of the image from a plate carried on plate cylinder A-11.

With the structure shown in FIG. 23, if the press model involved includes more than one plate cylinder module and therefore more than one plate cylinder A-11, the image carried by the plate on each plate cylinder A-11 is individually adjusted to position the image vertically. If, after the vertical position of each such image has been adjusted, in relation to each other such image, it should then be found that the position of such combined images must be adjusted vertically, either upward or downward, on the paper sheets being printed, then each plate cylinder A-11 together with the plate which it carries must be again adjusted as previously described to move each image vertically either upward or downward as required and to again secure the vertical registration between the images involved.

The segments F-41 are attached to the discs 36 and 37 of large cylinder 22 in the manner shown and described in considerable detail in U.S. Pat. No. 2,387,750 issued Oct. 30, 1945. Vertical adjustment of an image from a plate carried on one of such segments, as for instance, segment F-41 on large cylinder 22 may be made in the manner illustrated and described in detail in that same patent.

Gear 41 is rotatably mounted on the hub 42 of the disc. member 37 and is held in clamped rigid engagement with the face of disc member 37 by adjustable means which will be described in detail hereafter which allow the disc members 36 and 37 and the shaft 32 and any printing members carried thereby to be adjusted circumferentially with respect to gear 41 and then locked in the adjusted position.

In cases where more than a single plate is carried on the disc members 36 and 37, individual vertical adjustments of each of the images from such plates may first be made as described in the above named patent to register the images vertically with respect to each other, and thereafter, if it is desired to make further vertical adjustments the images from such two or more plates may be adjusted vertically with respect to their position on the sheets to be printed without disturbing the vertical relationship between the images by adjusting the large cylinder 22 as a whole, circumferentially with respect to gear 41 in the manner to be described in more detail hereinafter.

The gearing arrangement illustrated in FIG. 23 is intended for those models of the press which employ only a single plate cylinder module.

The gearing arrangement illustrated in FIG. 24 is intended for applications which requires a press model which includes more than one plate cylinder module.

In the gearing structure of FIG. 24, gear 41 is assembled with its hub portion 91 facing toward the frame 33 rather than toward the disc 37, as was the case in the FIG. 23 construction. Gear 40 is added between the disc 37 and the gear 41 and the total thickness of gear 40 including its small hub portion is exactly equal to the thickness of the hub portion 91 of gear 41 so that gear 40 spaces gear 41 away from the face of disc 37 by exactly the same distance as was the case in the FIG. 23 Construction. Gear 41 is therefore in vertical alignment with and meshes with gear 45 on the lower printing cylinder 20. Gear 68 is substituted in FIG. 24 for gear 62 of the FIG. 23 construction, and the total width of gear 68 including its hubs 98 and 99 is identical to the width of gear 62 of the FIG. 23 construction, including its hubs 96 and 97. However, the dimensions of the hubs 98 and 99 of gear 68 are such as to position gear 68 in vertical alignment with gear 40, with which it meshes. Gear 40 and gear 41 are each rotatively mounted on hub 42 of disc 37 and each of the two gears 40 and 41 is independently secured to disc 37 in a manner which allows each gear to be independently circumferentially adjusted with respect to disc 37, without disturbing the circumferential adjustment of the other gear. The detail of the manner in which this is accomplished will be described and illustrated in more detail hereinafter. When not being circumferentially adjusted both gear 40 and gear 41 are independently secured to and turn with disc. member 37. The drive is therefore transmitted from pinion 24 to gear 41 with which it meshes. Gear 41 transmits the drive to gear 45 with which it meshes. Since gear 40 and gear 41 are each secured to and turn the disc member 37, gear 40 turns with gear 41 and in turn transmits the drive to gear 68 on plate cylinder A-11, with which it meshes, and gear 40 similarly meshes with and drives any other gears 68 on any other plate cylinders A-11 in any other plate cylinder modules included in the particular press model involved.

Individual vertical adjustments of images from any one plate on a single plate cylinder A-11 are made as described for the FIG. 23. construction, and when more than a single plate cylinder, in more than a single plate cylinder module, is involved the individual images from each of the plates on each of the plate cylinders is brought into vertical registration with each of the other images in this manner.

However, in the FIG. 24 construction as opposed to that shown in FIG. 23 it is then possible to make further vertical image adjustments of the images from all plate cylinders involved without disturbing the vertical relationship of these images to each other.

This is accomplished by loosening gear 40 from the disc 37 and then rotating the machine to rotate the large cylinder 22 and the lower cylinder 20 while gear 40 and the gears 68 which mesh with it are held stationary. When the vertical adjustment of all of the images from all of the plate cylinders A-11 involved has thus been accomplished, the gear 40 is again secured to the disc 37 in the manner which will be described in more detail hereinafter and the vertical position of all of these images will thus have been adjusted with respect to the sheets of paper to be printed without disturbing the relationship of these images, from the plural plate cylinders A-11, to each other.

Images from plates carried by a segment or segments on large printing cylinder 22 may be adjusted singly or together in the manner described with respect to the FIG. 23 construction, since it is possible to adjust gear 41 circumferentially with respect to disc 37 without disturbing the circumferential adjustment of gear 40 with respect to disc 37. The manner in which this is accomplished will also be described in detail hereinafter.

The gearing arrangement illustrated in FIG. 25 may best be understood by also viewing FIG. 13 which is a side view of the same gearing arrangement. The FIG. 25 construction employs the same gear 62 for the plate cylinder A-11 as was employed in the FIG. 23 construction, so that in FIG. 25 the gear 62 on the plate cylinder A-11 is in vertical alignment with the gear 45 on lower cylinder 20. The same is true of any other plate cylinder A-11 with its gears 62 which may be assembled in a particular press model which includes more than a single plate cylinder module.

In the FIG. 25 construction, gear 40 abuts the disc member 37, as was the case in the FIG. 24 construction, but the gear 41 has been turned around so that its hub 91 abuts the small hub of gear 40. Thus, neither gear 40 nor gear 41 meshes with either gear 45 on lower cylinder 20 or with gear 62 on plate cylinder A-11. The pinion 24 meshes with and drives gear 41 and, as in the FIG. 24 construction, the two gears 40 and 41 are each rotatively supported on the hub 42 of the disc member 37, and each is independently secured to disc member 37 in the same manner described in the FIG. 24 construction so that each of gears 40 and 41 is individually circumferentially adjustable with respect to disc member 37 without disturbing the circumferential adjustment of the other. Also, when so adjusted, each of gears 40 and 41 is independently secured to disc member 37 so that each turns with disc member 37 and therefore with each other. An idler gear 53 is mounted and journalled on a stud member 54 secured to the main frame 33 by means of a concentric cylindrical projection 58 which is pressed into a hole in frame 33. Idler gear 53 is thus positioned to mesh with the pinion 24 and with the gear 45 on lower cylinder 20, and in this manner lower cylinder 20 is driven at the same surface speed as large cylinder 22, but without gear 45 on lower cylinder 20 meshing directly with either gear 40 or gear 41.

Idler gear 60 is mounted and journaled on tie-bar A-40*c* and meshes with gear 40 on large cylinder 22. Idler gear 60 also meshes with another idler gear 61 which is mounted and journaled on stud A-47 which in turn is carried by mounting bracket A-20 by means of cylindrical projection A-48 which is pressed into the hole A-43 in the mounting bracket A-20. Idler gear 61 meshes with both idler 60 and with gear 62 on plate cylinder A-11 and in this manner plate cylinder A-11 is driven at the same surface speed as large cylinder 22 without gear 62 meshing directly with either gear 40 or gear 41.

Since, as has previously been pointed out, the effective printing diameter of plate cylinder A-11 and lower cylinder 20 are equal and therefore the pitch diameter of gears 62 and 45 are equal and since, as has been previously pointed out, the effective printing diameter of cylinder 22 is a whole multiple, greater than one of the effective printing diameter of either lower cylinder 20 or plate cylinder A-20 and since, as has heretofore been pointed out, gears 40 and 41 each have a pitch diameter equal to the effective printing diameter of large cylinder 22 it follows that the number of teeth in gear 62 and the number of teeth in gear 45 are of necessity evenly divisible into the number of teeth in gear 40 or 41. As has been previously described, it has been found that gear streaks which show in the printed copy can be minimized by so constructing the gear train of the press that no gear which meshes with another gear has a number of teeth which is evenly divisible into the number of teeth in a gear with which it meshes. This prevents any repetitive pattern of wear from occurring as the gears which mesh with each other run in and this greatly reduces the tendency of the gearing in the press to form a pattern which is then transferred into the printed copy in the form of what are known as "gear streaks".

In the FIG. 25 construction it will be noted that the pinion 24 which has 37 teeth meshes with the large gear 41 which has 224 teeth and with idler gear 53 which has 53 teeth. It will be noted that 37 is not evenly divisible into either 224 or 53. Similarly idler gear 53 which has 53 teeth meshes with gear 45 on lower cylinder 20 which has 112 teeth and 53 is not evenly divisible into 112. Similarly idler gear 60 which has 20 teeth meshes with large gear 40 which has 224 teeth and with idler gear 61 which has 19 teeth. It will be noted that 20 is not evenly divisible into 224 or 19. Similarly idler gear 61 which has 19 teeth meshes with idler gear 60 which has 20 teeth and with gear 62 on plate cylinder A-11 which has 112 teeth. And it will be noted that 19 is not evenly divisible into either 20 or 112.

It will thus be noted that with the gearing of FIG. 25 lower cylinder 20, large cylinder 22 and plate cylinder, or plate cylinders A-11 are all driven in rotational tangential relationship to each other and at the same surface speed but by means of a gear train which contains no pair of gears in which one gear has a number of teeth that is evenly divisible into the number of teeth in an adjacent gear.

Nevertheless, gear 45 on lower cylinder 20 is linked by gearing to gear 41 on large cylinder 22 and the gear or gears 62 on plate cylinder or cylinders A-11 are linked by gearing to gear 40 on large cylinder 22. Vertical image adjustments may therefore be made in the same manner as described for the FIG. 24 construction.

The more detailed illustrations and descriptions which will follow with respect to the detail of construction of the plate cylinder modules, the ink/dampening modules, and the dampening modules will point out the manner in which the same gearing principle is carried throughout each of these modules so that in the press as a whole there is no pair of meshing gears in which the number of teeth in one of the gears is evenly divisible into the number of teeth in the other gear of the pair.

SHEET DETECTING, CYLINDER LATCHING AND PRINTING PRESSURE ADJUSTMENTS

FIGS. 27, 27A, 27B, 28, 29, 29A, 30, 31, 32, 32A and 33 illustrate the mechanisms which detect the presence or absence of a sheet at the time in the cycle of operation of the press when a sheet should be present at the stop fingers, ready to be fed by the feed roll mechanism into the cylinder grippers of the press. In response to the detection of the presence or absence of such a sheet, the mechanisms illustrated then cause lower printing cylinder 20 to come into, or to remain in, latched printing relationship with large printing cylinders 22 if a sheet is detected to be present, or cause lower printing cylinder 20 to drop into, or to remain in, an unlatched position, out of printing contact with large printing cylinder 22, if the absence of such a sheet is detected. These Figures illustrate the sheet detecting and cylinder latching mechanism of the 2R version of the press.

These Figures also illustrate the dual means by which the distance between the center of lower printing cylinder 20 and the center of large printing cylinder 22 may be adjusted so that the distance between these centers will be one distance when lower printing cylinder 20 rolls against one work area of large printing cylinder 22 and may be independently adjusted to be the same or a different distance when lower printing cylinder 20 rolls in contact with the other work area of large printing cylinder 22.

Referring to FIGS. 27 through 31 and the solid line portion of FIGS. 32 and 33, the mechanism as shown is set for the operation in which sheets are fed to the stop fingers 25 of the press on each revolution of lower printing cylinder 20. Sheets are fed in timed relationship to the stop fingers 25, with one sheet being fed for each revolution of lower printing cylinder 20. The stop fingers and upper and lower feed rolls are not shown in these Figures but are illustrated and described in detail hereinafter. For purposes of describing the mechanism of these Figures, suffice it to say that during the proper portion of the rotation of the cylinders described in connection with these Figures if a sheet has in fact been properly fed, it will come to rest with its leading edge in contact with the stop fingers 25 and the body of the sheet will then be at rest on paper support plate 66, which may also be seen in FIG. 11, and the feeler finger M-11 will be resting on, and supported by, the sheet.

There are three cams mounted about the projecting end portion 34 of the large printing cylinder shaft 32. The outermost cam M-14 controls the sensing means, the innermost cam M-15 actuates the movement of lower printing cylinder 20 in the latching and unlatching, and the center cam M-16 actuates the locking latch M-20 so that it is moved alternately into two latching positions, as first one and then another of the work areas of large printing cylinder 22 roll in contact with lower printing cylinder 20.

These three cams are mounted in a manner which allows each one to be individually adjusted circumferentially about shaft 34 without disturbing the adjustment of either of the other two, and in a manner which allows the adjustment to be made entirely from outside of the face of the outermost cam without having to reach in and behind any one of the cams to tighten or loosen the bolts which lock each of the cams in its adjusted position.

This is accomplished in the following manner. A disc member M-21 with an outwardly projecting hub M-22 fits snugly over shaft 34 and is either keyed thereto or fastened to shaft 34 with a taper pin M-23, which does not project beyond the outer surface of hub M-22. The innermost cam M-15 has an outwardly projecting integral hub M-24 and is bored to fit snugly over sleeve M-22 and the innermost face of cam M-15 lies in contact with the outer face of disc M-21. There are three circumferential slots M-26 in the face of cam M-15 and these slots are spaced 120 degrees from each other and are equidistant from the center of the shaft 34. The width of each slot is just sufficient to clear the threaded portion of a socket head bolt M-25, one of which passes through each slot M-26 and is threaded into one of three corresponding threaded holes in hub M-21 which are also spaced the same distance from the center of shaft 32 and are spaced 120 degrees from each other. The length of each slot M-26 defines the extent of the circumferential adjustment of cam M-15. Each of the socket head bolts M-25 has a larger head portion which bears against the outer face of the cam M-15 and locks it against circumferential movement when the three bolts M-25 are tightened. The outer face of the head portion of the bolts M-25 contains a hexagonal recess or socket to receive an "Allen" wrench. The length of the head portion of each of the bolts M-25 is such that they extend through slots in the two cams M-16 and M-14 and beyond the outer face of the outer cam M-14. There are three such slots M-30 in the face of each of the cams M-16 and M-14. Each of these slots is positioned similarly to slots M-26 in cam M-15, but the width of the slots M-30 is sufficient to clear the head portion of the bolts M-25. Thus, cam M-15 may be adjusted circumferentially by loosening the three bolts M-25 which may be reached with an "Allen" wrench from outside the front surface of cam M-14. The desired circumferential adjustment of cam M-15 is then accomplished and the three bolts M-25 are then tightened to maintain this adjustment. The length of each of the three slots M-30 in the face of each of the cams M-16 and M-14 is such as to make is possible to adjust either of these cams circumferentially without disturbing the adjustment of cam M-15.

Cam M-16 has an integral outwardly facing hub M-31 and is bored to fit snugly over sleeve M-22 and the inner face of cam M-16 is opposite the outer face of hub M-24 on cam M-15. There are three circumferential slots M-32 in the face of cam M-16 and these slots are equidistant from the center of shaft 34 and spaced apart from each other by 120 degrees. The center of each of these slots is 40 degrees counterclockwise away from the center of the corresponding slots M-30. There is a spacer sleeve member M-33 positioned in back of each of the slots M-32. The length of each of these spacer sleeves M-33 is slightly more than the combined thickness of cam M-15 and its hub M-24. The hole through the center of each sleeve M-33 has a diameter approximately equal to the width of the slot M-32. There are three slots M-34 in the face of cam M-15 which are just wider than the outside diameter of the spacer sleeves M-33 and in corresponding position to the slots M-32. Three socket head bolts M-35 have a threaded portion M-36 which extends through cam M-16 through the spacer sleeve M-33 and threads into a threaded hole in the disc member M-21. The threaded holes to receive the threaded portion of the bolts M-35 are spaced at the same distance from the center of shaft 34 as the center of the slots and are spaced 120 degrees from each other, and are spaced 40 degrees counterclockwise from the similar threaded holes which receive the threaded portions of bolts M-25. The head portion of the bolts M-35 is of larger diameter so that when the bolts M-35 are tightened against the face of cam M-16, the cam M-16 is seized between the shoulders formed by the heads of bolts M-35 and outer face of the spacer sleeves M-33, which are in turn pressed against the face of disc member M-21, so that cam M-16 is then secured circumferentially with respect to disc member M-21.

The head portions of the bolts M-35 project outwardly through slots M-40 in cam M-14 so that the outer faces of the heads of the bolts M-35 project outwardly beyond the face of cam M-14. There is an "Allen" socket in the face of the head portion of each of the bolts M-35 to receive an "Allen" wrench. The three slots M-40 in the face of cam M-14 are just wide enough to clear the head portion of bolts M-35 and are located similarly to the slots M-32 and M-34, in the cams M-16 and M-15. Thus, cam M-16 may be circumferentially adjusted by loosening the three bolts M-35 and accomplishing the desired circumferential adjustment of cam M-16, which is then free to slide about sleeve M-22 to the extent of the length of the slots M-32 in its face. Once this circumferential adjustment has been made, the bolts M-35 are secured, which tightens the cam M-16 against the disc member M-21 through the spacer sleeves M-33. Cam M-15 may be independently adjusted circumferentially because the slots M-34 in the face of cam M-15 clear the spacer sleeve members M-33, and similarly cam M-14 may be circumferentially adjusted independently because the slots M-40 in its face clear the head portion of the bolts M-35.

Cam M-14 has an integral outwardly projecting hub portion M-41 and is bored to fit snugly over sleeve M-22. The inner face of cam M-14 is opposite the outer face of hub M-31 of cam M-16. There are three slots M-42 in the face of cam M-14, each spaced the same distance from the center of shaft 34 as the previously described slots, each spaced 120 degrees from the other and the center of each slot is 40 degrees from the center of a slot M-40 and 40 degrees from the center of a slot M-30. In back of each slot M-42 is a spacer sleeve member M-43 whose length is slightly greater than the combined length of the spacer sleeves M-33 plus the thickness of cam M-16 and its hub M-31. The inner face of each spacer sleeve M-43 thus bears against the outer face of disc member M-21 and the outer face of each sleeve member M-43 bears against the inner face of cam M-14. There are slots M-44 in the faces of both cams M-15 and M-16 which are just wider than the outside diameter of spacer sleeves M-43 and whose position corresponds to that of the slots M-42. The hole through the center of spacer sleeves M-43 is approximately equal in diameter to the width of slot M-42. Three hex-head bolts M-45 pass through each of the slots M-42 and each of the spacer sleeves M-43, and are threaded into the disc member M-21 which contains three threaded holes to receive them, each spaced equidistant from the center of shaft 34 and 120 degrees from the other, and each of which is 40 degrees away from the similar holes to receive bolts M-25 and M-35. The hex-heads on bolts M-45 are sufficiently larger than the width of the slots M-42 (and washers may be placed between the face of cam M-14 and the head of each bolt M-45) so that when the bolts M-45 are tightened, they clamp the cam M-14 and the three spacer sleeves M-43 against the face of disc member M-21, thereby securing cam M-14 in circumferentially adjusted position with respect to disc member M-21.

To adjust cam M-14 circumferentially, the bolts M-45 are loosened and the cam M-14 may be turned circumferentially in either direction to the extent permitted by the slots M-42. When the desired circumferential adjustment has been achieved, the bolts M-45 are tightened and the adjustment is thus maintained. The slots M-44 in the faces of cams M-16 and M-15 permit each of these cams to be independently adjusted circumferentially, as previously described, without disturbing the adjustment of cam M-14.

It will thus be seen that each of these three cams M-15, M-16 and M-14 is individually secured to disc member M-21 which in turn is fixed to the projecting end portion 34 of the large printing cylinder shaft 32, as previously described.

Furthermore, any one of these three cams may be independently circumferentially adjusted in the manner described, and in each case the bolts to be loosened and tightened may be reached from the outside of the outer face of cam M-14, which is the outermost cam, and in each case the circumferential adjustment of each individual cam may be made independently of, and without disturbing the adjustment of either of the other two cams.

Cam M-14 has two dwells M-46 and M-47. A removable filler piece M-47*a* is secured in the manner shown in FIG. 29B and in dotted lines in FIGS. 32 and 33 when a sheet is to be fed to every alternate revolution of lower printing cylinder 20, but is removed when a sheet is to be fed to each revolution of lower printing cylinder 20. This removable filler piece is located by two dowel pins M-50 and held in position by two bolts M-51.

With reference particularly to FIGS. 27 and 27A, lower printing cylinder 20 is journalled to rotate about stationary shaft 21. Shaft 21 has eccentric projecting end portions 43 and 44 which are concentric to each other, but are eccentric with respect to shaft 21. These eccentric end portions 43 and 44 are supported and journalled for rocking motion in the two main frames 31 and 33. The method by which the projecting end portion 44 is supported in frame 33 at the far end of the machine, as seen in FIGS. 11 and 26, has been previously described and illustrated.

On the near side of the machine, the eccentric shaft portion 43 is journalled for rocking movement in a bearing 104 in frame 31.

If the eccentric end portion 43 of the shaft 21 is rotated in a counterclockwise direction, as seen in FIG. 27, the center of shaft 21, and therefore the center of lower printing cylinder 20, moves away from the center of large printing cylinder 22, and conversely, if the eccentric end portion 43 of shaft 21 is rotated in a clockwise direction, as seen in FIG. 27, the center of shaft 21, and therefore the center of lower printing cylinder 20, is moved toward the center of large printing cylinder 22.

There are three plate members M-100, M-108 and M-109 located about the portion of eccentric shaft 43 which extends beyond the frame 31.

Plate member M-109 is the outermost of these three plate members and fits snugly over shaft extension 43 and is pinned thereto by a taper pin 109 thru its hub portion. Bearing 104, which is pressed into frame 31, extends from the innermost face of frame 31 out beyond the outer face of frame 31 to the inner face of plate member M-109. The outer face of the middle plate member M-108 engages the inner face of the outer plate member M-109. Plate member M-108 has an integral hub portion 113 which extends inwardly, and plate member M-108 and its integral hub 113 are bored to fit snugly over the outside diameter of bearing 104. The total width of plate member M-108 and its integral hub 113 is equal to the distance between the inner face of plate member M-109 and the outer face of frame 31.

There is a bearing 114 pressed into inner plate member M-100 and its integral hub. The width of plate member M-100 and its integral hub is equal to the distance between the inner face of plate member M-108 and the outer face of frame 31. The inner bore of bearing 114 fits snugly over the hub portion 113 of plate member M-108, to allow for rocking movement of the plate member M-100 about the hub 113 of plate member M-108.

Outer plate member M-109 is secured to middle plate member M-108 by means of a bolt 115 which passes through a slot 116 in plate member M-109 into a threaded hole in plate member M-108. The arcuate center line of slot 116 is at all points the same distance from the center of shaft 43 as the center of the threaded hole for bolt 115, so that, to the extent of the length of the slot 116, outer plate member M-109 and middle plate member M-108 may be slidably adjusted with respect to each other about shaft extension 43, and then locked in fixed position with respect to each other by tightening bolt 115.

In order to make such adjustment in controlled minute increments, there is a block 117 rigidly affixed to the outer face of plate member M-109. A thumbscrew 118 is threaded through a threaded hole in the center of block 117, and its point bears against the surface of another block 119 which is rigidly affixed to plate member M-108. The teeth of a ratchet 123, which forms a portion of thumbscrew 118, are engaged 180 degrees apart by two prongs of a flat spring member (not shown) which, in turn, is affixed to block 117. The prongs of this spring member drop into the spaces between the ratchet teeth of the ratchet member 123 and secure the thumbscrew 118 against turning, unless a sufficient pressure is exerted to overcome the spring pressure. It is thus possible to turn the thumbscrew 118 in extremely small increments and to keep track of the increments by which it is turned by counting the clicks as the prongs of the spring member drop into one after another of the spaces between the ratchet teeth of the ratchet member 123. In addition, the spring member secured the thumbscrew 118 from turning further due to vibrations of the machine.

A spring 125 has one of its ends secured to a stud 128 in plate member M-108, and the other of its ends secured to a similar stud 127 in plate member M-109. Thus, spring 125 acts to urge plate member M-108 to move in a clockwise direction with respect to plate member M-109, as seen in FIG. 27, and when bolt 115 is loosened, holds the point of thumbscrew 118 against the surface of block 119. Thus, the block 119 is yieldably held in contact with the point of thumbscrew 118 and the left projecting arm of plate member M-108 is caused to move away from or toward the left projecting arm of plate member M-109 as thumbscrew 118 is turned inwardly or outwardly.

There is a marker point scribed on the face of plate member M-109 at approximately the midpoint of slot 116, and, opposite this, a scale is scribed on the face of plate member M-108. This makes it possible to observe the accuracy the relative position of plate member M-108 with respect to plate member M-109.

When the desired adjustment has been made, bolt 115 is tightened and plate member M-109 and plate member M-108 are thereby locked together.

Since plate member M-109 is pinned to eccentric shaft extension 43, as previously described, and since plate members M-109 and M-108 are locked together by bolt 115, moving these plate members in a counterclockwise direction, with shaft extension 43, as seen in FIG. 27, will cause the center of lower printing cylinder 20 to be moved away from the center of large printing cylinder 22, or, in other words, lower printing cylinder 20 will drop out of printing engagement with large printing cylinder 22. Conversely, if the plate members M-109 and M-108 are rotated in a clockwise direction, as viewed in FIG. 27, the effect will be to move the center of lower printing cylinder 20 toward the center of large printing cylinder 22.

At the outer end of the arm of plate member M-108 which projects to the left as seen in FIGS. 27 and 29, is a stud 128. There is another stud 129 affixed to main frame 31, and these two studs are drawn together by a spring 133. The action of this spring, plus the weight of lower printing cylinder 20, itself, tends to cause shaft 21 to be rotated in a counterclockwise direction, as seen in FIGS. 27, 27B and 29, about the center of eccentric shaft extensions 43, thus yieldably urging the center of lower printing cylinder 20 to drop away from lage printing cylinder 22.

As best seen in FIGS. 29 and 30 there is a rigid stud member M-52 secured to frame 31 by means of a nut M-224. A rocking latch member M-20 fits snugly over the outwardly projecting portion of stud M-52 and is laterally secured in position by a washer M-54 and a retaining ring M-55 which fit over the outwardly projecting portion of stud M-52. The rocking latch member M-20 is thus secured against lateral movement but free to rock about the stud M-52.

An arcuate support face M-56 of rocking latch member M-20 provides a support for a projecting nose portion M-53 of plate member M-108 when work area VI of large printing cylinder 22 is opposed to lower printing cylinder 20. When plate members M-109 and M-108 have been rocked in a clockwise direction sufficiently to move the nose portion M-53 of plate member M-108 below the level of the surface of the arcuate support face M-56, the rocking latch member M-20 may then be rotated in a clockwise direction until the arcuate support face M-56 is above the projecting nose portion M-53 of plate member M-108. The plate members M-109 and M-108 may then be rotated in a counterclockwise direction only so far as to bring the nose portion M-53 into contact with the arcuate support face M-56, and in that position lower printing cylinder 20 is latched in printing engagement with work area VI of large printing cylinder 22.

The distance between the centers of the large and lower printing cylinders, and therefore the magnitude of the printing pressure between lower printing cylinder 20 and work area VI of large printing cylinder 22 may be controlled by loosening bolt 115 and adjusting thumbscrew 118 in the manner previously described. Since plate member M-108 is prevented from turning in a counterclockwise direction when "latched" with its nose portion M-53 in contact with the arcuate support face M-56 of the latch member M-20, any relative motion created by adjusting screw 118 and spring 125 between plate member M-109, which is pinned to shaft extension 43, and plate member M-108 will thus increase or decrease, in minute increments, the printing pressure between lower printing cylinder 20 and work area VI of large printing cylinder 22. When the desired printing pressure has thus been obtained, bolt 115 is tightened and the adjustment is secured, since plate members M-109 and M-108 are thereby locked together. Thus, in actual operation, the latched printing pressure is borne by the locking action between the two plate members M-108 and M-109, and not by the adjusting screw 118.

As best seen in FIGS. 27B, 29 and 31, a motion-limiting roller M-57 rides along the bottom face M-118 of the left projecting arm of plate member M-108, and is rotatably mounted on a stud affixed to an arm M-61. Arm M-61, in turn, is rotatably mounted on a stud M-62 secured to main frame 31. The projecting portion of stud M-62, about which arm M-61 rotates, is eccentric to the body portion which passes through the frame 31, and is secured in position by nut M-63 on the inside of frame 31, as seen in FIGS. 29 and 31. This eccentric mounting of stud M-62 allows for adjustment of the projecting portion about which arm M-61 rotates. When the nose portion of plate member M-108 is not supported by the latch member M-20, the plate member M-108 rotates in a counterclockwise direction, thereby dropping lower printing cylinder 20 away from large printing cylinder 22. The extent of this motion is controlled and limited by the motion-limiting roller M-57. When the cylinders are in the latched position, as seen in FIGS. 27 and 29, motion-limiting roller M-57 is held against the lower surface M-118 of the left projecting arm of plate member M-108 by the action of spring M-64, one end of which is connected to a stud M-65 in main frames 31, and the other end of which is connected to a stud M-66 in arm M-61.

When the cylinders are unlatched, as seen in FIG. 27B, the left projecting arm of plate member M-108 drops until the motion-limiting roller M-57 prevents the plate member M-108 from moving farther in a counterclockwise direction. The simple harmonic rocking action of motion-limiting roller M-57 and arm M-61, under the control of spring M-64, causes this stop and limiting action to be smooth, whereas it would be abrupt if the arm simply came to rest against a fixed stop.

There is a nose plate M-67 affixed to the outer surface of plate member M-108 which provides a second latching nose M-71 in a different plane from latching nose M-53. Nose plate M-67 is held in position by, but may rotate about, a stud M-72 affixed to plate member M-108. Nose plate M-67 is urged to move in a clockwise direction by a spring M-73 which connects a stud M-74 on the face of plate member M-108 and a stud M-75 on the face of nose plate M-67. As seen in FIG. 27 spring M-73 acts to hold the shoulder M-76 of nose plate M-67 against the point of thumbscrew M-77, which is mounted in a block M-81 affixed to the face of plate member M-108, and is adjustable in minute increments by means of a control spring M-82 and a cooperating ratchet in the manner previously described with respect to thumbscrew 118. After the desired adjustment has been made, a bolt M-83 is tightened to lock nose plate M-67 firmly to plate member M-108. Bolt M-83 passes through a slot M-84 in the nose plate M-67 and into a threaded hole in plate member M-108. There is a pointer on the face of stud M-72 and a scale on the face of nose plate M-67 to indicate the position of adjustment.

As has been pointed out, the arcuate support face M-56 of rocking latch member M-20 is in alignment with the nose portion M-53 of plate member M-108. There is another arcuate support face M-85 of latch member M-20 which is in alignment with the nose portion M-71 of nose plate M-67.

Rocking latch member M-20 may be rocked into three basic positions. In the first, in which lower printing cylinder 20 rolls in contact with work area VI of large printing cylinder 22, nose portion M-53 of plate member M-108 is supported on the arcuate support face M-56 of rocking latch member M-20. In the second, in which lower printing cylinder 20 rolls in contact with work area V of large printing cylinder 22, nose portion M-71 of nose plate M-67 is supported on the arcuate support face M-85 of rocking latch member M-20. In the third position, rocking latch member M-20 is moved far enough in a counterclockwise direction so that neither arcuate support face M-56 nor arcuate support face M-85 supports either of the nose portions M-53 or M-71. With the rocking latch member M-20 in this position, the plate member M-108 is not supported from turning in a counterclockwise direction and drops into the position previously described, with its lower surface M-118 supported by motion-limiting roller M-57, thereby dropping lower printing cylinder 20 out of printing contact with large printing cylinder 22, as seen in FIG. 27B.

At the right side of the upper arm of plate member M-100, a stud M-86 supports a rocking arm M-87 which carries at its outer end a roller M-93, mounted for rotation about a stud M-92. Stud M-92 is secured to arm M-87 and projects in both directions therefrom. On the inner side and in a recessed portion of arm M-87, stud M-92 carries roller M-93, and on the outer side of arm M-87, stud M-92 projects outwardly considerably beyond the extent of the outward projection of shaft extension 43. A spring M-94 connects the inner end of stud M-92 and a stud M-95 on the inner face of plate member M-100. This spring acts to urge the arm M-87 to turn in a clockwise direction until roller M-93 rests against the face M-96 of plate member M-108. Roller M-93 is in the same plane with plate member M-108, and when roller M-93 is against face M-96, as seen in FIG. 27, roller M-93 is pulled into alignment with the crotch portion M-97 of plate member M-108. With roller M-93 in this position, any clockwise motion of plate member M-100 causes roller M-93 to become wedged in crotch M-97, and such clockwise motion is then transmitted through the stud M-86, the arm M-87 and roller M-93, which bears against plate member M-108 and causes it to move in a clockwise direction to a similar extent.

The left side of the upper arm of plate member M-100 is connected by an adjustable linkage to the lower end of cam-follower arm M-101. This adjustable linkage consists of two brackets M-102 and M-103 which, together with member M-104 which has two oppositely threaded portions and a central hexagonal nut integral therewith, form a turnbuckle arrangement. Member M-104 threads into the brackets M-102 and M-103, and is held in adjusted position by the lock nuts M-105, which bears against the faces of brackets M-102 and M-103. At one end, this adjustable linkage carries a pin M-106 rotatably supported in a hole at the left side of the upper arm of plate member M-100, and at the other end it carries a pin M-107 rotatably supported in a hole in the lower end of cam-follower arm M-101. Cam-follower arm M-101 pivots about a stud M-111 which is affixed to main frame 31, and carries a cam-follower roller M-112 at its upper end. A spring M-113 is affixed to a stud M-114 in main frame 31, at one end, and to a stud M-115 in arm M-101, at the other end. Thus, spring M-113 urges the cam-follower arm M-101 to turn in a clockwise direction about pivot M-111, and urges cam-follower roller M-112 toward cam M-15. A motion-limiting roller M-121 rotates about a stud M-122 at the end of an arm M-123, which in turn rotates about a stud M-124 in main frame 31. A spring M-125 connects one end of stud M-122 with a stud M-126 in main frame 31, and holds motion-limiting roller M-121 in contact with the left-hand surface of arm M-101. Stud M-124 is eccentrically mounted in main frame 31 and held in position by a nut M-127. Motion-limiting roller M-121 thus acts to limit the clockwise motion of cam-follower arm M-101 in the same manner described with respect to motion-limiting roller M-57 and the counterclockwise motion of the left projecting arm of plate member M-108, and for the same purpose. When properly adjusted, motion-limiting roller M-121 holds cam-follower arm M-101 in such position that cam-follower roller M-112 clears the lower portion of cam M-15 when lower printing cylinder 20 is in the unlatched position, as seen in FIG. 27B.

There are two lobes M-131 and M-132 on cam M-15. These lobes are 180 degrees apart from each other and so located that they contact cam-follower roller M-112 and move it to the left during the time that the gap in lower printing cylinder 20 is opposed to one of the two gaps between the work areas of large printing cylinder 22. As either lobe M-131 or M-132 forces the cam-follower roller M-112 to the left, the lower end of arm M-101 is forced to the right, and, through the action of the connecting linkage, pin M-106 in the upward projecting portion of plate member M-100 is forced to the right, thus forcing plate member M-100 to be rotated in a clockwise direction.

If roller M-93 is in the crotch M-97 of plate member M-108, and if latch member M-20 is in the latched position so that either nose portion M-71 of nose plate M-67 is resting on arcuate support face M-85, or nose portion M-53 of plate member M-108 is resting on arcuate support face M-56, all as seen in FIG. 27, then the result of moving plate member M-100 in a clockwise direction will be to cause whichever nose portion is resting on an arcuate support face of latch member M-20 to be lowered slightly therefrom, thereby relieving the pressure on latch member M-20 and leaving it free to be rocked into another position.

In order to relieve the pressure on latch member M-20, the center of lower printing cylinder 20 must be moved closer to the center of large printing cylinder 22 than its distance therefrom in either of the latched positions. This should only be done when the gap in lower printing cylinder 20 is opposed to one of the gaps of large printing cylinder 22. The lobes M-131 and M-132 of cam M-15, which forces cam-follower M-112 to the left, to either relieve the pressure on the latch M-20, or to bring lower printing cylinder 20 into position to be latched, are therefore properly positioned (and of proper circumferential length), so that they only act to move lower printing cylinder 20 into this position when its gap is opposed to one of the gaps of large printing cylinder 22.

Before the gap in lower printing cylinder 20 and the corresponding gap in large printing cylinder 22 have passed out of coincidence with each other, the one of the two lobes of cam M-15 (M-131 or M-132) will have passed out from under roller M-112, allowing spring M-113 to move arm M-101 in a clockwise direction, and in turn moving plate member M-100 in a counterclockwise direction. If latch member M-20 has not been rocked out of latching position, one of the nose portions M-71 or M-53 will come to rest on one of the arcuate support faces M-85 or M-56, thereby latching lower printing cylinder 20 into printing engagement with large printing cylinder 22, and the counterclockwise motion of plate member M-100 will be limited by stop pin M-223 in plate member M-108.

If, on the other hand, latch member M-20 has been rocked in a counterclockwise direction far enough to be completely free of nose portions M-53 and M-71, then plates M-108 and M-109 will be rocked in a counterclockwise direction by the action of spring 133 and the weight of lower printing cylinder 20 until that rotation is stopped by the action of motion-limiting roller M-57, and plate member M-100 will be rocked in counterclockwise direction until the motion of arm M-101 is stopped by the motion-limiting roller M-121 and by stop pin M-223. Lower printing cylinder 20 will then be in the unlatched position, out of printing contact with large printing cylinder 22, as seen in FIG. 27B.

If lower printing cylinder 20 is in the unlatched position at the time either of the lobes M-131 or M-132 pushes cam-follower roller M-112 to the left, and in turn rocks plate M-100 in a clockwise direction, and if roller M-93 is caught in the crotch M-97 of plate member M-108, then plate member M-108 and M-109 will in turn be rocked in a clockwise direction; and when cam-follower roller M-112 is on the high portion of either lobe M-131 or M-132, the nose portions M-71 and M-53 will have been lowered to the point where latch member M-20 may be freely rocked in above them.

If latch member M-20 is then rocked in a clockwise direction, either arcuate support face M-85 will be in alignment with nose portion M-71, or arcuate support face M-56 will be in alignment with nose portion M-53, and when lobe M-131 or M-132 passes out from under cam-follower roller M-112, lower printing cylinder 20 will then be in latched printing relationship to large printing cylinder 22.

There is a cam-follower arm M-133 rigidly affixed to, and extending upwardly and to the left from latch member M-20. At the upper end of this arm M-133 is a cam-follower roller M-134 which acts in cooperation with cam M-16. One end of spring M-136 is attached to pin M-135 on arm M-133, and the other end of spring M-136 is attached to a stud M-137 in frame 31. Spring M-136 thus acts to urge latch member M-20 to move in a clockwise direction and to urge cam-follower roller M-134 to follow the surface of cam M-16.

In normal operation, if the action of the detector mechanism and associated linkage (to be described) does not interfere, the action is as follows:

When the first gap between the work areas on large printing cylinder 22, which is at approximately 4 o'clock, as seen in FIG. 27, comes into coincidence with the gap in lower printing cylinder 20, lobe M-132 of cam M-15 will contact cam-follower M-112 and cause nose portion M-71 to be moved down slightly, off arcuate support face M-85, as previously described, thereby leaving latch member M-20 free to rock. Immediately following this the point M-142 on cam M-16 will reach cam follower M-134 and it will be free to move up onto the dwell of cam M-116. Spring M-136 will then rock arm M-133 latch member M-20 in a clockwise direction until roller M-134 comes in contact with the low portion, or dwell, of cam M-16. This will cause arcuate support face M-56 to move into position above nose portion M-53, and shortly thereafter lobe M-132 will pass out from under cam-follower M-112, and nose portion M-53 will come up into contact with arcuate support face M-56 and be supported thereby. This will have been accomplished while this gap in large printing cylinder 22 was in coincidence with the gap in lower printing cylinder 20. Lower printing cylinder 20 will then be latched in printing relationship with segment F-41*a* in work area VI on large printing cylinder 22, and with the printing pressure therebetween determined by the adjustment made with thumbscrew 118 and locked into position by bolt 115.

As lower printing cylinder 20 completes its next revolution, and the gap in lower printing cylinder 20 comes into coincidence with the second gap on large printing cylinder 22, which is seen approximately 10 o'clock, as viewed in FIG. 27, lobe M-131 of cam M-15 will contact cam-follower M-122, causing nose portion M-53 to be lowered slightly, out of contact with arcuate support face M-56, leaving latch member M-20 free to rock. Shortly thereafter, point M-145 on cam M-16 will reach cam-follower roll M-134, and thereafter nose portion M-71 will come to rest on arcuate support face M-85, which will have been brought into position above it. This will be accomplished while the gap in lower printing cylinder 20 is in coincidence with this second gap in large printing cylinder 22.

Lower printing cylinder 20, will then make one revolution in printing contact with segment **F-41*b* in work area V on large printing cylinder 22, and the printing pressure between lower printing cylinder 20 and the surface of segment F-41*b* on large printing cylinder 22 will be determined by the adjustment previously made with the thumbscrew M-77 and locked into position by tightening bolt M-83**.

Thus, the pressure between lower printing cylinder 20, and each of the work areas of large printing cylinder 22, is independently determined and independently adjustable, but is latched through solid linkage throughout each revolution of lower printing cylinder 20.

Shaft M-13, as seen also in FIGS. 11 and 33, extends across the machine and is journalled in frames 31 and 33 for rocking motion. In the center of the machine, there is a slot in paper support plate 66, and in line with this slot an arm M-12 is pinned to shaft M-13, and at the lower end of arm M-12 a detector finger M-11 is pivotally mounted about a shaft M-146. The leading edge of detector finger M-11 rests on paper support plate 66 when arm M-12 is at the back, or the right-hand end, of its stroke, and when arm M-12 and detector finger M-11 move forward, to the left, the leading edge of detector finger M-11 is either supported on the top surface of a sheet, if one is present, or, in the absence of a sheet, drops through the slot in plate 66 and contacts catch member 147.

Shaft M-13 projects outwardly through frame 31, and at its outer end there is an arm M-152 affixed thereto. The upper end of arm M-152 carries a cam-follower roller M-153 which rolls in contact with cam M-14. On the lower portion of arm M-152 there is a stud M-177 to which is attached one end of a heavy spring M-154, the other end of which is attached to a spring pin M-155 in the outer end of stud M-52. Spring M-154 thus acts to urge arm M-152 and shaft M-13 to be turned in a clockwise direction, and acts to hold cam-follower M-153 in contact with the surface of cam M-14. At the time when a sheet should be in position on paper support plate 66, with its leading edge in contact with stop fingers 25, either dwell M-46 or dwell M-47 of cam M-14 allows cam-follower roller M-153 to move up, thereby rotating shaft M-13 in a clockwise direction, and causing the end of arm M-12 to move forward, to the left, carrying with its detector finger M-11. As previously stated, if a sheet of paper is in fact present, detector finger M-11 is supported on the paper and does not drop through the slot in paper support plate 66 and does not contact catch member M-147.

There is another shaft M-151 extending across the machine and journalled for rocking motion in frames 31 and 33 and extending outwardly beyond frames 31. This shaft M-151 has the catch member M-147 affixed to it, in line with detector finger M-11, underneath the slot in paper support plate 66. There is an angular notch in the top surface of catch member M-147, shaped to receive the leading edge of detector finger M-11 if it drops through the slot in paper support plate 66.

At the outer end of shaft M-151 there is an arm M-156 rigidly pinned thereto, which also has an upwardly extending portion M-212. Affixed to arm M-156 there is a stud M-157 which rides in a slot M-211 at one end of a link member M-210, the other end of which is attached to stud M-162 in rocking latch member M-20. There is a lighter spring M-205 which interconnects a stud M-204 on arm M-212 with a stud M-203 in main frame 31 and acts to hold arm M-156 in contact with a stop pin M-163 in frame 31, in which position catch member M-147 is in an upright position, as seen in either FIG. 27 or FIG. 29. It should be noted that the top surface of catch member M-147 is beneath the slot in paper support plate 66 and below the line of travel of paper sheets moving across support plate 66. Thus, catch member M-147 in no way interferes with the passage of such sheets, and the only way in which catch member M-147 is contacted is when, in the absence of a sheet of paper to support it, detector finger M-11 drops through the slot in support plate 66 and engages catch member M-147.

At the top of arm M-212 is another stud M-172 which projects through a hole in a connecting link M-166. There is another stud M-167 at the other end of connecting link M-166, and a spring M-171 connects stud M-167 on connecting link M-166 and a stud M-164 on a rocking retainer arm M-173, which projects through a slot M-165 in connecting link M-166, thus tending to hold connecting link M-166 and rocking retainer arm M-173 in the position shown in FIGS. 27 and 29, with the left-hand end of slot M-165 in contact with stud M-164. Rocking retainer arm M-173 pivots about a shaft M-174 projecting outwardly from a stud M-175 in main frame 31. In the position shown in FIGS. 27 and 29, the working face M-176 of rocking retainer arm M-173 is spaced to the left of stud M-92 on which roller M-93 is mounted.

At the lower end of arm M-152 there is a pin M-206 which projects through a hole at one end of a link M-208. The other end of link M-208 pivots about a pin M-215 secured in another rocking retainer arm M-214. Rocking retainer arm M-214 pivots about stub shaft M-216 projecting outwardly from a stud M-217 in the frame 31.

If the feeder has been set to feed a sheet to each revolution of lower printing cylinder 20, then filler piece **M-47*a* as seen in dotted lines in FIG. 32 and 33 is not attached to cam M-14, and cam M-14 has two dwells, M-46 and M-47. Cam-follower roller M-153 is of a width sufficient that it spans the width of both the body of cam M-14 and filler piece M-47*a***, when used.

With filler piece **M-47*a* removed, and with the feeder set to feet a sheet to each revolution of lower printing cylinder 20: - at the time in the cycle when a sheet should be present with its leading edge against the stop fingers 25 (not shown in these views), and resting on paper support plate 66, the cam-following roller M-153 enters one or the other of the dwells M-46 and M-47 of cam M-14, and moves up, under the force of spring M-154. This, in turns, moves the lower portion of arm M-152 to the left, causing pin M-206 to move link M-208 to the left and, in turn, causing the rocking retainer arm M-214 to pivot in a clockwise direction about pin M-216, and moving its working face M-201** to the left.

At the same time, arm M-12 is rocked to the left and carries with it detector finger M-11.

If a sheet of paper is, in fact, present, the leading edge of detector finger M-11 simply slides along the surface of the sheet and is held by the paper cout of contact with catch member M-147.

As the dwell, M-46 or M-47, of cam M-14, passes the position of cam-following roller M-153, the rise in cam M-14 causes arm M-152 to rotate in a counterclockwise direction, rocking the lower portion of arm M-152 to the right, thereby returning rocking retainer arm M-214 to the position seen in FIGS. 27 and 32. As arm M-12 rocks back to the position shown in FIGS. 27 and 32, it carries with it the detector finger M-11.

Catch member M-147 has been undisturbed and therefore latch member M-20 has remained under the control of spring M-136, with cam follower M-134 following of the contour of cam M-16.

If a sheet is, in fact, present, with its leading edge against the stop fingers 25, at the proper time in the cycle, on each successive revolution of lower printing cylinder 20, then lower printing cylinder 20 will remain in the latched position with respect to large printing cylinder 22, and this condition will prevail for as long as a sheet is thus properly fed to each successive revolution of lower printing cylinder 20, thereby keeping detector finger M-11 out of contact with catch member M-147, each time detector finger M-11 is rocked forward.

While lower printing cylinder 20 thus remains in the latched position with respect to large printing cylinder 22, the pressure on the support faces M-56 and M-85 of latch member M-20 is relieved as previously described each time the gap in lower printing cylinder 20 comes into coincidence with a gap in large printing cylinder 22 and the alternate support face is moved into position as previously described.

If, for any reason, a sheet of paper is not present at the stop fingers 25 at the time in the cycle when it should be, i.e., when one of the dwells M-47 or M-46 of cam M-14 allows spring M-154 to rock shaft M-13 in a clockwise direction and move detector finger M-11 forward, then the leading edge of detector finger M-11 drops through the slot in paper support plate 66, and as it moves forward it makes contact with catch member M-147. As spring M-154 continues to force detector finger M-11 forward, it drives catch member M-147 ahead of it, thereby rocking shaft M-151 in a counterclockwise direction and moving arm M-156 to the right. This causes the pin M-154 to move into contact with the right-hand end of slot M-211 in link M-210, and causes it to exert a force on latch member M-20, attempting to withdraw it from above either nose portion M-53 or M-71, which it is supporting. However, the pressure of nose portion M-53 or M-71 on arcuate support face M-56 or M-85 is, at this point, too great to allow spring M-154 to succeed in rocking the latch member M-20 to the right, and this temporarily limits the counterclockwise rotation of shaft M-151 and the clockwise rotation of shaft M-13.

As arm M-156 moves to the right, its upper extension M-212, with pin M-172, moves to the left. This moves link M-166 and pin M-167 at its other end to the left. Spring M-171 acts to pull pin M-164 on rocking retainer arm M-173 to the left. The working face M-176 of rocking retainer arm M-173 moves to the right but does not come in contact with projecting stud M-92, on which roller M-93 is mounted while the counterclockwise rotation of shaft M-151 is limited as described.

While this condition prevails, the gap in lower printing cylinder 20 comes into coincidence with one of the gaps on large printing cylinder 22 and one of the lobes M-131 or M-132 of cam M-15 contacts cam follower M-112 forcing roller M-93 into the crotch M-97 of plate member M-108 and lowering nose portion M-53 or M-71 out of contact with arcuate support face M-56 or M-85, as previously described.

This relieves the latching pressure which was holding latch member M-20 in position, and immediately the force of heavy spring M-154 rocks arm M-152, detector finger M-11, and catch member M-147 farther to the left, thereby moving arm M-156, pin M-157 and link M-210 to the right, and rotating latch member M-20 in a counterclockwise direction, until arm M-156 contacts limit pin M-207, in which position the arcuate support faces M-56 and M-85 have been moved to the right out of alignment with the nose portions M-53 and M-71 of plate member M-108, and nose plate M-67. This leaves plate member M-108 free to rotate in a counterclockwise direction unimpeded by the latch member M-20.

As this takes place arm M-212 and link M-166 move farther to the left and this causes rocking retainer arm M-173 to rotate farther in a counterclockwise direction until its working face contacts stud M-92 on which roller M-93 is mounted. Since roller M-93 is wedged into the crotch M-97 this temporarily limits the counterclockwise motion of rocking retainer arm M-173 and spring M-171 is extended.

Then, as lobe M-131 or M-132 of cam M-15 passes out from under cam follower M-112, spring M-113 pulls arm M-101 to the left until its motion is stopped by the action of motion-limiting roller M-121. This rocks plate member M-100 in a counterclockwise direction, and as this takes place, the weight of lower printing cylinder 20, together with the force of spring 133, rocks plate members M-108 and M-109, together, in a counterclockwise direction until motion-limiting roller M-57 limits the downward motion of the left extending arm of plate member M-108. This happens before the leftward motion of arm M-101 is limited by motion-limiting roller M-121 and, therefore, plate member M-100 continues to move a bit farther in a counterclockwise direction until it contacts Pin M-223 in plate member M-108 and arm M-101 is also stopped by motion-limiting roller M-121. This moves roller M-93 up out of the crotch M-97 of plate member M-108, and, the instant it is freed, the force of spring M-171 rocks rocking retainer arm M-173 still further in a counterclockwise direction and its working face M-176 which bears against extending stud M-92, on which roller M-93 is mounted, thereby causes arm M-87 to be rocked to the right, carrying roller M-93 out above surface M-202 of plate member M-108, and with spring M-94 extended.

Lower printing cylinder 20 is now in the unlatched position, separated from and out of printing contact with large printing cylinder 22.

As the cylinders rotate further, cam follower M-153 follows the contour of cam M-14 out of dwell M-46 or M-47 and onto the high portion of cam M-14, and arm M-12 rocks back to the right, carrying detector finger M-11 with it, back into the position shown in FIGS. 27, 27B and 32. At the same time, the lower portion of arm M-152 rocks to the right, and link M-208 moves rocking retainer arm M-214 to the right, with its working face M-201 in contact with extending stud M-92, as seen in FIG. 27B.

As detector finger M-11 returns to the right, away from catch member M-47, spring M-205 causes arm M-156 and shaft M-151 to rock in a clockwise direction and returns catch member M-147 to its upright position, with arm M-156 resting against stop pin M-163. Pin M-157 moves towards the left end of slot M-211 and spring M-136 causes latch member M-20 to rotate in a clockwise direction until the face of latch member M-20 rests against the right-hand face of plate member M-108, as seen in FIG. 27B.

If the filler piece M-47*a* is not attached to cam M-14 and if, on the next revolution of lower printing cylinder 20, there is again no sheet present with its leading edge in contact with the stop fingers 25 at the proper time in the cycle then, when detector finger M-11 is rocked forward, it drops through the slot in paper support plate 66 into contact with catch member M-147, again moving arm M-156 to the right and causing latch member M-20 to be rocked again in a counterclockwise direction, until arm M-156 contacts stop pin M-207. Since roller M-93 is now not caught in the crotch M-97 of plate member M-108, spring M-171 holds rocking retainer arm M-173 with its working face M-176 against extending stud M-92, on which roller M-93 is mounted, holding roller M-93 out of crotch M-97, so that now, when lobe M-131 or M-132 of cam M-15 forces cam follower M-112 to the left, plate member M-100 is rotated in a clockwise direction, but the extending stud M-92 first slides along the working face M-176 of rocking retainer arm M-173 and then roller M-93 simply slides along the surface M-202 of plate member M-108, and, therefore, does not act to rotate plate members M-108 and M-109 in a clockwise direction. Thus lower printing cylinder 20 remains separated from large printing cylinder 22, and in an unlatched position.

On the next revolution of lower printing cylinder 20 to which a sheet is properly fed, so that its leading edge contacts the stop fingers 25 at the proper time in the cycle, detector M-11 is held up by the sheet, out of contact with catch member M-147 as the detector M-11 rocks forward. Thus, arm M-156 remains in contact with stop pin M-163, and rocking retainer arm M-173 remains in the position shown in FIGS. 27 and 29. As detector M-11 rocks forward arm M-152 carries link M-208 to the left and it in turn rocks rocking retainer arm M-214 to the left, moving its working face M-201 to the left out of contact with stud M-92, and spring M-94 then holds arm M-87 to the left, with roller M-93 against face M-96.

Thus, when lobe M-131 or M-132 of cam M-15 forces cam follower M-112 to the left and rocks plate member M-100 in a clockwise direction, roller M-93 is again wedged into the crotch M-97 of plate member M-108, and the clockwise rotation imparted to plate member M-100 thus carries with it plate member M-108, plate member M-109 and eccentric shaft portion 43, so that lower printing cylinder 20 is lifted to the point where the nose portions M-53 and M-71 are below the level of arcuate support faces M-85 and M-56. Pin M-157 is near the left end of slot M-211, leaving spring M-136 free to cause latch member M-20 to move into latching position, with follower M-134 in contact with the surface of cam M-16.

Latch member M-20 thus rocks into latched position with either nose portion M-71 aligned with arcuate support face M-85, or nose portion M-53 aligned with arcuate support face M-56, and as lobe M-131 or M-132 of cam M-15 passes out from under cam-follower roller M-112, one of the nose portions contacts the corresponding arcuate support face and lower printing cylinder 20 is in latched printing position with respect to large printing cylinder 22.

Thus, it will be seen that, when the printing cylinders are in latched printing position, they remain in this condition for so long as a sheet is properly fed to each revolution of lower printing cylinder 20. They drop out of latched position into the unlatched position, with the printing cylinders out of printing contact with each other, on the first revolution of lower printing cylinder 20 to which a sheet is not properly fed. If the printing cylinders then continue to rotate without sheets being fed, the printing cylinders remain in the unlatched, or separated, position until a sheet is again properly fed to a revolution of lower printing cylinder 20, at which time they return to latched printing position.

If the feeder is set to feed a sheet only to every other revolution of lower printing cylinder 20, then the filler piece M-47*a* is attached to cam M-14, as previously described, and the operation is as follows and as illustrated in FIGS. 27 and 27B:

On the revolution of lower printing cylinder 20, to which a sheet is intended to be fed, cam follower M-153 drops into the dwell M-46 of cam M-14, and the operation of the sheet-detecting, latching and unlatching mechanism is exactly as heretofore described. On the revolution of lower printing cylinder 20, to which no sheet is to be fed, the action is as follows, with particular reference to FIGS. 27 and 27B:

If the cylinders are in the unlatched position as seen in FIG. 27B, as the result of the failure to properly feed a sheet to the stop fingers 25 at the proper time in the cycle on the previous revolution of lower printing cylinder 20, to which it was intended that a sheet be fed, then on the next revolution of lower printing cylinder 20, to which it is intended that no sheet be fed, the detector finger M-11 will not be rocked forward since the filler piece M-47*a* has been added to cam M-14, preventing follower M-153 from entering dwell M-47. Thus, arm M-152 remains in the position shown in FIG. 27B and rocking retainer arm M-214 is held to the right by link M-208. In this position the working surface M-201 of rocking retainer arm M-214 prevents extending stud M-92 from being rocked into a position in which roller M-93 would nest in the crotch M-97 of plate member M-108. Therefore, when lobe M-132 of cam M-15 forces cam follower M-112 to the left, thereby rocking plate member M-100 in a clockwise direction, roller M-93 merely rolls out along the surface M-202 of plate member M-108. Thus, plate members M-108 and M-109 are left undisturbed and lower printing cylinder 20 remains in the unlatched position and out of contact with large printing cylinder 22. On the next revolution of lower printing cylinder 20, the sheet detecting and latching mechanism operates exactly as previously described, and in the absence of a sheet properly fed to the stop fingers 25 at the proper time in the cycle the printing cylinders remain separated and unlatched, and in the presence of such a sheet the printing cylinders are relatched, as described previously.

If sheets are then fed in a continuous sequence to the stop fingers 25 on every other revolution of lower printing cylinder 20, the sheet detector M-11 detects their presence on each such alternate revolution of lower printing cylinder 20 and retains the printing cylinders in latched position, as previously described. On the alternate revolutions of lower printing cylinder 20, when no sheet is fed, nor is intended to be fed, the filler piece M-47*a* on cam M-14 prevents the detector finger M-11 from being rocked forward. Detector finger M-11 therefore remains at rest, supported on plate 66, and the mechanism therefore responds as it would in the presence of a sheet, and the printing cylinders remain latched.

When sheets are being fed only to alternate revolutions of lower printing cylinder 20, the lobes M-131 and M-132 of cam M-15 nevertheless act upon cam-following roller M-112 on each revolution of lower printing cylinder 20 at the time when the gap in lower printing cylinder is in coincidence with corresponding gap of large printing cylinder 22, thereby relieving the pressure on the latch member M-20 and allowing it to rock in response to the interaction of cam M-16 and cam-following roller M-134, so that alternate revolutions of lower printing cylinder 20 are controlled first by the latching of nose portion M-53 onto arcuate support face M-56, and then by the latching of nose portion M-71 onto arcuate support face M-85, so that in this case, too, the pressure adjustment between lower printing cylinder 20 and each of the segments F-41*a* and F-41*b* in work areas VI and V respectively on large printing cylinder 22 is independently controlled and independently adjustable.

It will thus be seen that, when the press is adjusted for the feeding of sheets to every other revolution of lower printing cylinder 20, and such feeding continues in an uninterrupted sequence, the printing cylinders remain latched until that sequence is broken.

When the presence of a properly fed sheet is detected on a revolution of lower printing cylinder 20 to which it is intended that a sheet be fed, the printing cylinders remain latched for that revolution of lower printing cylinder 20, and the subsequent revolution of lower printing cylinder 20 in any case. In the absence of a properly fed sheet on a revolution of lower printing cylinder 20 to which a sheet should have been fed, the printing cylinders move into unlatched position and remain separated in the unlatched position for at least that revolution of lower printing cylinder 20 and the subsequent revolution of lower printing cylinder 20. Also, if the printing cylinders revolve continuously without sheets being fed thereto, the printing cylinders remain separated and in the unlatched position until such time as a properly fed sheet reaches the stop fingers at the proper time in the cycle on a revolution of lower printing cylinder to which it is intended that a sheet be fed, and the printing cylinders then move into printing position and relatch, as previously described.

Thus, whether sheets are being fed to each revolution or to every other revolution of lower printing cylinder 20, if the cylinders are separated and unlatched, roller M-93 must return to crotch M-97 in order for the action of cam M-15 on cam-follower roller M-112 to cause lower printing cylinder 20 to return to printing position and relatch.

However, if the cylinders are separated and unlatched and a sheet is detected to be absent on a revolution of lower printing cylinder 20 when one should be present, the working face M-176 of rocking retainer arm M-173 is moved into position to contact extending stud M-92 and prevent roller M-93 from returning to the crotch M-97, and, on a revolution of lower printing cylinder 20 to which no sheet was intended to be fed, the working face M-201 of rocking retainer arm M-214 is held in position to contact extending stud M-92 and prevent roller M-93 from returning to the crotch M-97.

Therefore, a sheet must be detected to be present on a revolution of lower printing cylinder 20 to which it was intended that a sheet be fed, in order to hold both rocking retainer arms M-214 and M-173 out of the way of extending stud M-92, thereby allowing spring M-94 to return roller M-93 to the crotch M-97 so that the action of cam M-15 on follower M-112 will lift lower printing cylinder 20 into latched printing position.

It should be noted that detector finger M-11 is balanced so that its nose rests very lightly on a sheet of paper when one is present and it therefore does not interfere in any way with the passage or proper registration of such a sheet. As has been described, its action to detect for the presence or absence of a sheet at times when such a sheet should be present, and only at such times, is controlled by a single cam. The latched distance between the center of the lower printing cylinder and each work area of the large printing cylinder is independently controlled and independently adjustable. When the lower printing cylinder is unlatched it moves away from the large printing cylinder to be out of contact with all work areas thereof and it stays in this position until the presence of a sheet at the time in the cycle when one should be present is detected and causes the lower printing cylinder to be raised into printing position with respect to the large printing cylinder, and latched in this position.

This is most important to the operation of other control mechanisms of the press and to the coordinated operation of the press as a whole. In this connection it is most important to note that when the lower printing cylinder moves into the unlatched position stub shafts 43 and 44 at either end of lower printing cylinder shaft 21 are rocked into a position which moves the center of shaft 21 and of lower printing cylinder 20 away from the center of large printing cylinder 22 by an amount sufficient to accomplish the separation of the printing cylinders into a non-printing position. For so long as the printing cylinders remain in the unlatched position as described, the position of shaft 21 and the stub shafts 43 and 44 at either end thereof remain stationary, and this condition prevails throughout each full 360° revolution of lower printing cylinder 20 as both the single work area thereon and the gap between the ends thereof move past the position of the bite of the cylinders of the printing couple.

This is most important to the overall operation of the press because it not only means that the unlatched lower printing cylinder is not raised and lowered each time the gap therein passes the position of the bite of the printing couple but also because the angular position of the stub shaft 44, on the other side of the machine, during the time that the gap in the lower printing cylinder passes the position of the bite of the printing couple, determines whether each of the plate cylinders which roll in contact with the large printing cylinder will be latched or unlatched as the corresponding gap in the large printing cylinder passes the point of tangency with each such plate cylinder. The method by which this is accomplished will be illustrated and described in detail hereinafter.

It is important to note however that the lower printing cylinder shaft and the stub shafts at either end thereof remain stationary in one position throughout the time that the cylinders of the printing couple remain unlatched and they remain substantially stationary in another position through the time that the cylinder of the printing couple remian latched.

This is accomplished while still causing the distance from the center of the lower printing cylinder to the center of the large printing cylinder to assume an independently adjusted value as the latched lower printing cylinder rolls in contact with each of the separate work areas of the large printing cylinder. These independently adjusted values may be the same or different. Their greatest difference however is extremely small as compared to the difference represented by the latched and unlatched positions and therefore the ramge of positions representing the latched condition, including the small motion involved in relieving the pressure on the latch when the gaps roll in coincidence while the cylinders of the printing couple remain in the latched position, represent one substantially stationary position for the shaft 21 and its stub shafts 43 and 44 as compared to the other stationary position which they assume and maintain while the cylinders of the printing couple remain in the unlatched position.

In summary, it will thus be seen that the mechanism as described, and as illustrated in FIGS. 27 through 33, may be set so that, irrespective of whether a sheet is fed for each revolution of lower printing cylinder 20, or for every other revolution of lower printing cylinder 20, the presence or absence of a sheet, in proper position whith its leading edge in contact with the stop fingers 25 and supported by paper support plate 66, will be detected for at those times when a sheet should be present, and only at such times.

If a sheet is detected to be present, the printing cylinders latch, or remain latched, and in printing position, at least until such time as the next sheet should be present.

Similarly, should a sheet be detected to be missing, the printing cylinders unlatch and separate, or remain separated and unlatched at least until such time as the next sheet should be present.

Detector M-11 acts to detect the presence or absence of a sheet first approaching the bite of the printing couple only on those revolutions of lower printing cylinder 20 to which a sheet is intended to be fed. If the printing cylinders are in the unlatched position, they remain separated and in the unlatched position until such time as a sheet is detected to be present at the proper time in the cycle on a revolution of lower printing cylinder 20 to which a sheet is intended to be fed. Similarly, if the printing cylinders are latched in the printing position, they remain is that position so long as a sheet is detected to be present at the proper time in the cycle on each subsequent revolution of lower printing cylinder 20 to which a sheet is intedned to be fed.

Further, it will be noted that this is accomplished while also providing means by which the pressure between lower printing cylinder 20 and each of the work areas of large printing cylinder 22 is independently set, independently controlled and independently adjustable, so that, whenever lower printing cylinder 20 is latched in the printing position, the distance from its center to the center of large printing cylinder 22 has one independently adjusted value while lower printing cylinder 20 rolls in coincidence with one work area of large printing cylinder 22, and another independently adjusted value (which may be the same or different) while lower printing cylinder 20 rolls in coincidence with the other work areas of large printing cylinder 22.

It should be further noted that, in each case, when lower printing cylinder 20 rolls in coincidence with either of the work areas of large printing cylinder 22, the members which carry the load, to provide the printing pressure between the two printing cylinders, are firmly locked in relation to each other and solidly supported by a solid latch member. The threaded members, which provide the micrometer fine adjustment in each case, come into play only when the adjustment is being made, and do not carry any of the load under actual operating conditions.

The similar mechanism on the 3R model is essentially the same as that illustrated and described above for the 2R model, with the following differences:

For purposes of description and discussion we have given similar parts and components of the 3R model similar numbers but in the 3,000 series, for example, plate member M-108 on the 2R model being designated M-3108 on the 3R model.

There are three work areas and three gaps on the large printing cylinder 3022 of the 3R model. Therefore cam M-3015 (not shown) on the 3R model has three lobes whereas cam M-15 on the 2R model has two. Cam-M-3016 (not shown) on the 3R model has three levels whereas the cam M-16 on the 3R model has two. Cam M-3014 (not shown) on the 3R model has three dwells (to any of which may be added a filter piece) whereas cam M-14 on the 2R model has two dwells (to one of which may be added a filler piece (M-47/a).

Latch member M-3020 (not shown) on the 3R model has three arcucate support sufaces whereas latch member M-20 on the 2R model has two, and there are three corresponding independently adjustable nose members on the 3R model whereas on the 2R model there are two.

Thus, on the 3R model the detector may be caused to detect for the presence or absence of a sheet either on each of the three revolutions which the lower printing cylinder 20 makes for each revolution of the large printing cylinder 3022, on any one of the three revolutions or on any two of the three revolutions.

Also on the 3R model the distance of the center of the lower printing cylinder 20 from the center of the large printing cylinder 3022 may be independently controlled and independently adjusted to be the same or different when the lower printing cylinder 20 rolls in printing contact with each of the three separate work areas of the large printing cylinder 3022.

In other respects the operation of the sheet detecting and latching mechanism for the 3R model is similar to the operation of the similar mechanism for the 2R model just illustrated and described.

Also the differences in the latching mechanism for the lower printing cylinder in the 2R and 3R models are also similar to differences in the similar parts of the latching mechanisms for the plate cylinders in the 2R and 3R models which are shown in detail in FIGS. 46 through 52 for the 2R model and in FIGS. 53 through 63 for the 3R model.

CYLINDER GRIPPERS AND CHAIN DELIVERY

One form of delivery that may be used with the press of this invention involves the use of what is known as a chain delivery mechanism and a receding pile stacker. Such delivery mechanism is shown in FIG. 34 in which the frame members 31 support the large cylinder 22 amd the lower cylinder 20. Lower cylinder 20 carries a blanket F-45 on its surface and rotates about fixed eccentrically mounted shaft 43. Gripper fingers 30 at the leading edge of the work area on lower cylinder 20 are caused to open and close by the action of cam follower G-40 coacting with cams G-41 and G-42.

When cam follower G-40 reaches the lobe of cam G-41, gripper fingers 30 are caused to open to receive the sheet from the feed rollers 27 and 28 which has been registered against stop finger 25. The grippers 30 close to seize the sheet as follower G-40 leaves the lobe of cam G-41. The leading edge of the sheet is then carried through the bite of cylinders 22 and 23, and, as cam follower G-40 rides up on the lobe of cam G-42, gripper fingers 30 open to release the leading edge of the sheet.

As shown in FIG. 34, there is a cooperating chain delivery mechanism which consists of a pair of chains G-14, each mounted on a pair of sprockets G-24 and G-25, which in turn are mounted on shafts G-18 and G-17, respectively. Shaft G-18 is journaled to turn in the frames 31 and shaft G-17 is journaled to turn in a pair of frames G-43 secured to frames 31.

A gear (not shown) on the shaft G-18 meshes with gear on lower printing cylinder 20. The gear on shaft 18 and the sprockets G-24 and G-15 each have a pitch diameter equal to one-half the pitch diameter of the gear on lower printing cylinder 20. Thus the chains G-14 move at the same surface speed as the surface speed of lower printing cylinder 20. The chains G-14 are equal in length to twice the effective printing circumference of the lower printing cylinder 20 and carry between them two delivery grippers bars G-20 and G-67 spaced from each other by a distance equal to the effective printing circumference of lower printing cylinder 20.

Delivery gripper bars G-20 and G-67, each include gripper fingers G-13 which are controlled by cam followers G-44. There is a cam G-45 which cause each delivery gripper, as it passes, to open as it approaches the point of tangency between lower printing cylinder 20 and sprockets G-24, and then to close to seize the leading edge of a sheet as cylinder grippers 30 open to release the leading edge. Thus, as a chian carried delivery gripper bar leaves the point of tangency, it has the leading edge of the sheet in its grip and causes the sheet to follow the path of the chains G-14 to the point where stripper fingers G-46 pass over the leading edge of the sheet between the individual grippers G-13, and at this point the cam follower G-44 controlling the grippers G-13 contacts cam G-50 and causes the grippers to open to release the leading edge of the sheet, whereupon the sheet falls onto the pile G-29 and its forward momentum urges its leading edge against back stop G-51 and it is jogged in position by jogger plate G-52 and by side joggers, not shown.

Thus, on each revolution of lower printing cylinder 20, cylinder grippers 30 open to release a sheet as they reach the point of tangency with the sprockets G-24 and the chain carried delivery grippers G-13 close to seize the leading edge of each such sheet.

If a sheet has been fed to each revolution of lower printing cylinder 20, each such sheet is thus transferred to the chain carried delivery grippers and stripped and delivered as described above.

If, on the other hand, sheets are being fed to every other revolution of lower printing cylinder 20, the action of the cylinder grippers 30 and the chain carried delivery grippers G-13 is nevertheless the sme as described above on each passage of the point of tangency between lower printing cylinder 20 and sprockets G-24, but, since a sheet is only present on every other revolution of lower printing cylinder 20, it is only on this revolution that a sheet is in fact stripped and delivered.

If, on the other hand, the interaction of cam follower G-40 and lobes G-41 and G-42 of cam 271 is controlled as described elsewhere herein to cause the cynlinder grippers 30 to carry the sheet around lower printing cylinder 20 and through the bite between cylinder 20 and 22 twice, instead of once, these sheets are fed to lower printing cylinder 20 on every other revolution thereof and time so that at their first passage by the point of tangency between the lower printing cylinder 20 and sprockes G-24, delivery gripper bar G-20 is at this point of tangency, and when the leading edge of the sheet reaches this point of tangency of the second time, the second delivery gripper bar G-67 is at the point of tangency.

When this operation is to be performed, delivery gripper bar G-20 is locked open by manually rotating the arm G-53 which carries cam follower G-44 until the hole G-54 in this arm is in aligment with the hole G-55 in the body of the gripper bar G-20, and a pin is then inserted through holes G-54 and G-55 thus locking the grippers G-13 of gripper bar G-20 in the open position. In this position cam follower G-44 of gripper bar G-20 is held off the surface of cams G-45 and G-50, and the gripper fingers G-13 of this gripper bar G-20 do not close to seize the leading edge of the sheet as delivery gripper bar G-20 passes the point of tangency with lower printing cylinder 20. Since delivery gripper bar G-20 is always at the point of tangency on the first passage of a sheet by that point, and since cylinder grippers 30 do not open to release the leading edge of the sheet at that time, the sheet is carried on around lower printing cylinder 20, and through the bite between cylinders 20 and 22 a second time; and then as the leading edge of the sheet reaches the point of tangency between lower printing cylinder 20 and sprockets G-24 for the second time delivery gripper bar G-67 has approached the point of tangency and cylinder grippers 30 open to release the leading edge of the sheet and the grippers G-13 of delivery gripper bar G-67 close to seize the leading edge of the sheet, and the sheet is thus stripped and delivered as previously described; p The pile G-29 is supported on a dolly G-56 which has pairs of casters G-64 and G-65 which contact the floor when the pile is full. The dolly G-56 in turn is supported on frames G-60, which in turn are supported for vertical movement be means of rollers G-61 and G-62 which are secured to frame G-60 and which slide in track suports G-63.

The raising and lowering of the pile support and the control of its descent are of the type well known in the art.

There is a micro-switch G-68 fastened to the frame 31 in such a position that it will be contacted by and actuated by the dolly G-56 when the pile is full and the casters G-64 and G-65 are resting on the floor.

As will be illustrated and described elsewhere herein the actuation of micro-switch G-68 stops the feeding of sheets by the feeder or feeders.

When the pile G-29 is full, the casters G-64 and G-65 are resting on the floor, the back support G-51 may be pivoted up out of the way, and the dolly G-56 removed from the supports G-60, another similar dolly inserted therein and the pile supports G-60 raised to the proper height to again begin receiving sheets as previously described.

DAMPENING FLUID STORAGE AND LEVEL CONTROL

FIGS. 35 and 36 illustrate the mounting for the dampening fountain tray, the means by which the fluid is placed in the dampening fountain tray and is then held at a constant level therein, and means by which the fluid may be drained from the dampening fountain tray and stored when the machine is not in operation.

While the numbers assigned (with "B" prefixes) would indicate that the dampening fountain tray and associated mechanism is shown mounted in an ink-/dampening module, the arrangement is the same when mounted in connection with a plate cylinder module.

Frames B-13*a* and B-13*b* between which the dampeing rollers are supported and in which certain of them are journaled are seen in FIG. 35 wherein the dampening fountain roller B-11 turns in journals B-14. and B-15 in frames B-13*a* and B-13*b*, respectively. Dampening fountain roller B-11 may be caused to rotate intermittently by any of several means known in the art as, for instance, by the action of a pawl against ratchet B-16 which is secured to the shaft B-20 of fountain roll B-11. The dampening fountain tray B-21 is removably secured between the frames by means of two pins B-22 attached thereto and which fit in corresponding holes in frame B-13*a* and two pins B-23 slideably mounted in frame B-13*b* and which are yieldably held in position by two springs B-24 in corresponding holes in a plate B-25 attached to the opposite end of fountain tray B-21. Thus, the fountain tray B-21 may be removed by sliding it to the right, as seen in FIG. 35, causing pins B-23 to move to the right against the force of springs B-24 until the pins B-22 are removed from the holes in the opposite frame B-13*a*. The fountain tray B-21 may then be rocked down and removed entirely by removing the plate B-25 from the pins B-23. Fountain tray B-21 may be reinstalled by following the reverse of the above described procedure.

The bottom of the dampening fountain tray B-21 slopes downwardly to the left, as seen in FIG. 35, and similarly from side to side so that draining tube B-26 is at the lowest point of the tray.

On the outside of frame B-13*a* there is another smaller tray B-30 secured to frame B-13*a* by screws B-31 and B-32. The top of tray B-30 is level with the top of the dampening fountain tray B-21, and the bottom of tray B-30 is below the level of the bottom of dampening fountain tray B-21 and also slopes to a drainage tube B-33 which is at the lowest point in tray B-30. There is another drainage tube B-34 on the side of tray B-30 just above the level of the bottom of tray B-30 but below the level of drainage tube B-26 in dampening fountain tray B-21. Drainage tube B-26 in dampening fountain tray B-21 and tube B-34 in tray B-30 are connected by a short flexible tube of rubber or plastic B-35. Tube B-35 is short enough so that it does not sag but flows uniformly downwardly from tube B-26 to tube B-34. Tube B-35 may be disconnected from drainage tube B-26 in dampening fountain tray B-21 when dampening fountain tray B-21 is removed as described previously. At the top of tray B-30 there is an open tubular support member B-36 for supporting the bottle B-41 which contains the supply of dampening fluid.

The bottle B-41 has a cap B-42 which screws onto the neck of bottle B-41 and is sealed with a rubber or cork washer B-43. The inside surface of cap B-42 is shaped to form a valve seat at B-44 against which a valve member B-45 is seated by the action of spring B-46 which is held at its other end by a retaining clip B-47. Retaining clip B-47 is made of a perforated material so that liquid can flow through it into and out of the bottle B-41. There is also a hole at the center of retaining clip B-47 which guides the inner stem B-57 of the valve member B-45.

There is a metal tube B-51 which extends through the cap B-42 almost to the bottom of the interior of bottle B-41. Tube B-51 is sealed against the leakage of liquid at the point where it passes through the cap member B-42. The outer end B-52 of tube B-51 is engaged by a flexible tube B-53 of rubber or plastic, the other end of which engages the drainage tube B-33 at the lowest point of tray B-30.

When bottle B-41 is in its upright position with the cap B-42 removed, it is filled with the dampening fluid and then screwed into the cap B-42 to the point where engagement with the sealing washer B-43 is accomplished. Spring B-46 holds the valve B-45 seated against the valve seat B-44 so that when the bottle is inverted the fluid does not leak out. The cap B-42 of the bottle B-41 is then inserted into the tubular support member B-36 which then supports the bottle in an inverted position with the top surface B-54 of cap B-42 held at the level at which it is desired to maintain the fluid level in trays B-30 and B-21.

A Z-shaped member B-55 is welded to the bottom of tray B-30 in position to engage the outer stem B-56 of the valve member B-45 when the cap B-42 is supported, as above described, in the tubular support member B-36. This pushes the valve member B-45 upwardly against the force of spring B-46 causing the valve portion B-45 to be disengaged from the seat B-44 and opening the bottle so that the fluid may flow therefrom. The fluid then flows from the bottle until both trays B-30 and the dampening fountain tray B-21 have been filled up to the level of the top surface B-54 of the cap B-42 of the bottle, the fluid seeking its own level through tube B-35 between trays B-30 and B-21.

As fluid is consumed from the dampening fountain tray B-21 and the level thereby lowered, the levels in trays B-21 and B-30 remain equal, and as the level in tray B-30 drops below the surface B-54 of the cap B-42, air is admitted into the bottle and fluid flows from the bottle until the level in the two trays B-21 and B-30 is again brought to the level of the top face B-54 of the cap B-42.

Thus, the level of the dampening fluid in the two trays is maintained constant for so long as there is fluid remaining in the bottle.

At the end of the day, or whenever the press is to be cleaned up at the end of a run, the bottle B-41 is lifted out of the tubular support member B-36, and, as it is lifted, stem B-56 of the valve B-45 is lifted off member B-55 in tray B-30 and the spring B-46 causes the valve B-45 to seat against the seat B-44 so that fluid does not escape from the bottle while it is in an inverted position.

Below the level of tray B-30 there is a bottle supporting bracket B-61 attached to frame B-13*a* and there is a slot B-62 in this supporting bracket into which the neck of the bottle B-41 may be slid between the top of the bottle and the cap B-42. The width of the slot B-62 is such that when the bottle B-41 is thus inserted into slot B-62 with the bottle in an upright position, as seen in the dotted line position in FIG. 35 and as seen in FIG. 36, the bottle is then supported by the bracket B-61 in an upright position.

Also attached to frame B-13*a* is a valve opening bracket B-63 spaced above bracket B-61 by a distance such that when the bottle is supported in an upright position, as shown in FIGS. 35 and 36, the valve stem B-56 is depressed by the bracket B-63 so that the valve is held open and air may enter or leave the bottle B-41.

When the bottle is thus supported in this position and with the valve held open, as described, the fluid in tray B-30 drains into the bottle and the fluid in the dampening fountain tray B-21 in turn drains first into tray B-30 and then into the bottle, so that, while the press is not being operated, both trays B-21 and B-30 are drained into the bottle and the fluid is retained in the bottle B-41.

If it is then desired to remove the dampening fountain tray B-21 for cleaning, this may be done by simply detaching tube B-35 from drainage tube B-26 and removing the dampening fountain tray B-21, as previously described.

When the press is again to be used, if the fountain tray B-21 has been removed, it is reinstalled and tube B-35 reconnected to drainage tube B-26 and the bottle B-41 is then removed from the support bracket B-61, inverted, and reinserted in the tubular support member B-36, as previously described, and once again the dampening fluid flows from the bottle B-41 until the level in dampening tray B-21 and tray B-30 has reached the desired level coincident with the top face B-54 of cap B-42.

Thus, by simply inserting the bottle in the operative or inoperative position, the dampening fluid is caused to seek and maintain the desired level in the dampening fountain tray B-21 during operation and is drained from the dampening fountain tray B-21 during periods when the press is not in operation.

INK DUCTOR ROLL, OSCILLATING DISTRIBUTOR ROLLER, INK FOUNTAIN ROLLER AND ROCKER ARM

As seen in FIG. 37, a portion of the frames B-13 are shown together with certain elements of the inking mechanism of either an inking module or a plate cylinder module. As shown and described herein, structure is provided by means of which the ink ductor roll B-64 is yieldably held in contact with the driven oscillating distributor roller B-65 so that the ductor roll B-64 is frictionally driven at the same surface speed as oscillating distributor roll B-65 through its frictional contact therewith. Also, as shown and described herein, driven oscillating distributor roller B-65 is journaled to turn about shaft B-66 and receives its oscillating or side-to-side motion, in and out as seen in FIG. 37, from the oscillating or side-to-side motion imparted to shaft B-66 through means illustrated elsewhere herein.

The frames B-152, by means of which ductor roll B-64 is held in yieldable contact with oscillating distributor roll B-65, comprise frames B-152 at either end of rollers B-64 and B-65, which frames are secured to shaft B-66 at one of their ends and support roller B-64 at their other end. Springs B-153 carried by frames B-152 hold ductor roll B-64 in yieldable contact with oscillating distributor roll B-65. Thus, as side-to-side motion, in and out as seen in FIG. 37, is imparted to shaft B-66, it is also imparted to both rollers B-65 and B-64. If shaft B-66 is rotated or rocked back and forth, the frames B-152 that are secured to shaft B-66 and carry ductor roller B-64 cause ductor roller B-64 to move about the circumference of oscillating distributor roller B-65 while still maintaining its yieldable contact therewith and being driven thereby at the same surface speed as distributor roller B-65.

On the outside of the frame B-13, as seen in FIG. 37, a rocker arm B-67 is rigidly affixed to shaft B-66. Thus, as rocker arm B-67 is rocked back and forth, ductor roll B-64 is similarly rocked back and forth while maintaining its engagement with distributor roller B-65.

The ink fountain roller B-11 and the ink fountain associated therewith, which is not shown in FIG. 37, as shown and described elsewhere herein, and ink fountain roller B-11 is driven at a slow constant speed, in the direction shown. Ink fountain roller B-11 is driven at a much slower speed than the surface speed of the other ink rollers, including ductor roller B-64 and oscillating distributor roller B-65 which are driven at the surface speed of the plate on the plate cylinder, not shown in FIG. 37.

When rocker arm B-67 is rocked in a clockwise direction, as seen in FIG. 37, to bring ductor roller B-64 into contact with fountain roller B-11, ink is supplied from the fountain roller B-11 onto the ductor roller B-64 from which it is thus fed to oscillating distributor roller B-65 and then throughout the inking system. Since fountain roller B-11 is continuously supplied with ink from the ink fountain, as illustrated and described elsewhere herein, the amount of ink picked up by ductor roller B-64 and transferred throughout the inking system may be controlled by controlling the length of time the ductor roller remains in contact with the fountain roller B-11. Since, as has previously been described, ductor roller B-64 normally remains in contact with distributor roller B-65 and is frictionally driven thereby, the surface speed of the ductor roller B-64 is much greater than the surface speed of the fountain roller B-11. Thus, when ductor roller B-64 contacts fountain roller B-11, a certain skidding occurs between the two, notwithstanding which ink is transferred from fountain roller B-11 to ductor roller B-64 in proportion to the time that the contact between the two is maintained.

Two alternative methods are envisioned for preventing this skidding where desired. One of these, which is illustrated and described herein, involves breaking the contact between ductor roller B-64 and distributor roller B-65 as ductor roller B-64 approaches fountain roller B-11. This is accomplished by lifting levers B-154 which pivot about pins B-156 in arms B-152. As the ductor roll B-64 moves into contact with the ink fountain roll B-11 the upper end of lifting lever B-154 strikes a pin B-155 in frame B-13 and this causes the lifting lever B-154 to pivot about the pin B-156 lifting the bearings B-157 in which the ductor roller B-64 is journalled thus lifting the ductor roll B-64 out of contact with the distributor roll B-65 while the ductor B-64 remains in contact with the ink fountain roller B-11. In this case, the ductor roller B-64 is free to adjust its speed to that of fountain roller B-11 when frictional contact between the two is made, and then, as the ductor roller B-64 leaves the fountain roller B-11, it again contacts distributor roller B-65 and once again adjusts its speed to that of distributor roller B-65.

The alternative method involves providing adjustable stops in the same members B-152 which support form roller B-64 about shaft B-66 so that these adjustable stops contact a portion of the ink fountain itself as ductor roller B-64 approaches fountain roller B-11, thereby preventing ductor roller B-64 from actually physically contacting fountain roller B-11, while still allowing it to come close enough to fountain roller B-11 so that the ink film thereon is transferred to the ductor roller B-64 during the time that the two are in this close proximity. In this case, ductor roller B-64 remains in contact with distributor roller B-65 at all times and is frictionally driven thereby at the surface speed of distributor roller B-65. In any case, the amount of ink transferred from the fountain roller B-11 to the ink system through the ductor roller B-64 is controlled by controlling the time the ductor roller B-64 remains in ink receiving proximity to fountain roller B-11. This is accomplished by adjustable automatic means as illustrated in FIG. 37, and which operates as follows:

A cam shaft B-71 is driven at comparatively slow speed, as for instance one revolution of cam shaft B-71 being made for each two revolutions of the large printing cylinder illustrated elsewhere herein. This is accomplished through reduction gearing in which shaft B-72 is driven with gear B-73, (48 teeth) which in turn derives its drive indirectly from the plate cylinder, as is illustrated and described elsewhere herein, whereby the surface speed of the pitch diameter of the gear B-73 is equal to the surface speed of the plate. A smaller gear B-74 (18 teeth), also affixed to shaft B-72, drives a large outer gear B-75 (70 teeth), which is journalled to turn about shaft B-76. Also journalled about shaft B-76, and rigidly affixed to large gear B-75 is a small gear B-77 (20 teeth), which in turn meshes with a larger gear B-81 (48 teeth) on cam shaft B-71. The numbers of teeth in gears B-74, B-75, B-77 and B-81 are such that cam shaft B-71 rotated once for each revolution of the large printing cylinder, (whose gear has 224 teeth) and also the number of teeth in each of these gears is such that the number of teeth in any gear is not evenly divisible into the number of teeth of the gear with which it meshes.

There is a heart-shaped cam B-82 affixed to and driven by cam shaft B-71. A control arm B-83 is journalled to rock about shaft B-71 and may be held in any of a number of calibrated positions by conventional clamping means, not shown, at any of the calibrated positions, as shown on the scale at B-84. An upwardly extending arm B-85 of control arm B-83 carries a stud B-86 about which a rocking frame B-87 is journalled for rocking motion. Rocking frame B-87 carries a cam follower roll B-88 mounted on stud B-91 in frame B-87 and aligned to roll in the same plane as heart-shaped cam B-82. An angular projection B-92 of rocking arm B-87 has a stud B-93 affixed thereto, which in turn carries a ball bearing follower B-101, the outer race B-94 of which is radially shaped instead of being flat.

A spring, not shown, acts upon rocker arm B-67 to draw it in a clockwise direction, as seen in FIG. 37, or in a direction to urge ductor roller B-64 into contact with fountain roller B-11. There is an outwardly projecting surface B-95 projecting out from rocker arm B-67 at right angles thereto and extending for a distance greater than the length of the in and out motion imparted by shaft B-66. Since, as previously described, shaft B-66 moves in and out, as seen in FIG. 37, and since rocker arm B-67 is rigidly secured to shaft B-66, rocker arm B-67 thus moves in and out as shaft B-66 moves. A helical spring B-96 encircles stud B-86 and has one of its projecting arms affixed to a pin B-97 secured in rocker arm B-87, and the other of its projecting arms secured to a pin B-98, which in turn is secured to the arm B-85 of control arm B-83. This helical spring B-96 thus acts to urge rocker frame B-87 to move in counterclockwise direction about stud B-86 and thus holds bearing follower B-101 against the face B-95 of rocker arm B-67. The bearing follower B-101 thus rolls against the face B-95 of rocker arm B-67 as rocker arm B-67 and shaft B-66 move in and out, as seen in FIG. 37.

If control arm B-83 is moved all the way up against stop pin B-102, into the dotted line position as shown in FIG. 37, cam follower B-87 remains in contact with the surface of heart-shaped cam B-82 as the cam revolves, the follower B-101 remains in contact with face B-95 of rocker arm B-67, but the position of the parts is such that, while rocker arm B-67 is moved back and forth, it never moves far enough in a clockwise direction to allow ductor roll B-64 to contact fountain roll B-11. Thus, no ink is fed into the system, although ductor roll B-64 continues to remain in contact with distributor roll B-65 and acts as an additional ink distributor. As the control arm B-83 is lowered into position 1 on the calibrated scale B-84, which is the solid line position, as shown in FIG. 37, a point is reached where ductor roll B-64 contacts fountain roll B-11, but only for the instant that the cam follower B-87 is in the dwell at the top of heart-shaped cam B-82. At any other position in the rotation of heart-shaped cam B-82, follower B-87 is lifted enough so that follower B-101 lifts surface B-95 sufficiently to hold ductor roll B-64 out of contact with fountain roller B-11.

As adjusting control arm B-83 is moved down to successive calibrated positions, cam follower B-87 remains out of contact with the surface of heart-shaped cam B-82 for successively longer periods of time since, when ductor roll B-64 contacts fountain roll B-11, the clockwise rotation of shaft B-66 and of rocker arm B-67 is limited thereby and spring B-96 acts to hold rocker frame B-87 in a position to maintain follower B-101 in contact with face B-95. Thus, depending upon the position of adjustable control arm B-83, the time that roller B-87 is in contact with some portion of heart-shaped cam B-82 is decreased and, thus, the time that ductor roll B-64 is in contact with fountain roll B-11 is increased. When control arm B-83 is moved down to position 9 on the calibrated scale, it contacts pin B-103 which limits its further movement, and, at this point, ductor roll B-64 is in contact with fountain roller B-11 for all but the short interval when the high portion of the heart-shaped cam, which is 180° away from the dwell, momentarily lifts follower B-88 to momentarily break the contact between ductor roll B-64 and fountain roller B-11.

It will thus be seen that simple and effective means have been provided whereby the control of the feeding of ink into the rollers of the basic ink system may be controlled by varying the time that the ductor roll is in contact with the fountain roll while allowing the ductor roller to remain in contact with the associated distributor roller all, or substantially all, of the time, thus in turn acting itself as an additional ink distributor roller, and while allowing the fountain roller to turn continuously at a slower speed, thus providing continuous agitation for the ink in the ink fountain. The slow speed at which cam shaft B-71 is driven also causes all of these motions to take place at relatively slow speed, thus reducing to the point of practical elimination any shocks resulting from the customary rapid motion of an ink ductor.

TIMING DIAGRAM

FIG. 38 is a timing diagram which shows the sequence of actions of the stop fingers 25, the upper and lower feed rolls 28 and 27, all as seen in FIG. 39, and the cylinder gripper fingers 30, as seen in FIGS. 34, 39, 76, 78 and 79*a*. The cylinder gripper fingers 30 and the cylinder stops 29 are mounted at the leading edge of the lower printing cylinder 20 and the opening of the gripper fingers to receive a sheet, and the closing of the gripper fingers after the sheet has been received, are shown on this timing diagram and thereby related to the action of the stop fingers 25 and the upper and lower feed rolls 28 and 27 as seen in FIGS. 39 thru 45. The cylinder grippers and cylinder stops themselves and the mechanism for actuating the cylinder grippers are shown in FIGS. 34, 76, 77, 78 and 79*a*.

The drawings of FIGS. 39, 40 and 43, to which the timing diagram of FIG. 38 relates, are made looking at the right-hand side of the machine, from which point of view the lower printing cylinder rotates in a clockwise direction. Zero degrees on the timing diagram represents the point at which the cylinder stops 29 mounted at the leading edge 710 of the lower printing cylinder 20 are at the bite or point of tangency between the lower printing cylinder 20 and the large printing cylinder 22, or at 12 o'clock, as seen from the right-hand side of the machine, which is shown in FIG. 39. The degree designations on the timing diagram trace the cylinder stops 29 at the leading edge of the lower printing cylinder through one complete revolution in a clockwise direction from zero degrees to 360 degrees and relate the action of the mechanisms diagrammed to the various positions of the cylinder stops 29 at the leading edge of the lower printing cylinder 20 as thus defined.

At the top of the timing diagram, the action of the stop fingers 25 is diagrammed, and the stop fingers are in the "down" position, out of the path of the travel of sheets, at zero degrees and remain "down" to 160 degrees. They then rise from 160 degrees to 200 degrees, and at 200 degrees are in the "up" position. They remain in the "up" position from 200 degrees to 294 degrees. At 294 degrees, they start to move down and are again in the "down" position at 310 degrees where they remain for the balance of the rotation of the lower printing cylinder, or to 360 degrees.

The next mechanism diagrammed is the upper feed roller 28 and, as shown by the diagram, the upper feed roller is in the "up" position at zero degrees and remains in the "up" position to 270 degrees. From 270 degrees to 290 degrees the upper feed roll descends and makes contact with the paper or with the lower feed roll 27 and is in a "down" position at 290 degrees. It stays in the "down" position from 290 degrees to 335 degrees and then rises again to the "up" position from 335 degrees to 355 degrees where it remains to the 360 degree point, which is the start of another revolution of the lower printing cylinder.

The next item that is diagrammed is the action of the lower feed roller 27. The solid line shows the action of the lower feed roller itself, which only moves in a clockwise direction, and the diagram charts the relative surface speed of the lower feed roll 27 in relation to the surface speed of the lower printing cylinder 20. The dotted line charts the action of the mechanism which drives the lower feed roll, which returns to position to again drive the lower feed roll after each operation thereof. The lower feed roll is stationary at zero degrees, and remains stationary to 296 degrees. It then starts to rotate slowly and picks up speed gradually to 320 degrees, at which point its surface speed is equal to the surface speed of the lower printing cylinder. From 320 degrees to 330 degrees it accelerates more rapidly and moves at a surface speed greater than the surface speed of the lower printing cylinder, so that the leading edge of the sheet is moved into the cylinder grippers 30 and against the cylinder stops 29. At 330 degrees, its acceleration ceases and it drops back to the surface speed of the lower printing cylinder 20 from 330 to 336 degrees, at which point it ceases its clockwise revolution and remains stationary from 336 degrees to 360 degrees. The mechanism which drives the lower feed roll is returning at zero degrees and continues to return until approximately 255 degrees, at which point it moves with the described motion of the lower feed roll up to 330 degrees and then levels off to 336 degrees, and then begins its return which carries on to 360 degrees where the start of another revolution begins.

The last item diagrammed is the action of the cylinder gripper fingers 30 mounted at the leading edge 710 of the lower printing cylinder 20. Since the opening and closing of the gripper fingers to release a sheet is timed to correspond with the type of delivery mechanism used, this timing diagram shows only the action of the gripper fingers in opening to receive a sheet and closing upon having received the sheet. The detail of the mechanism which controls the action of the gripper fingers is illustrated and described elsewhere herein. As will be seen from the timing diagram, the gripper fingers are closed as they approach 265 degrees, and they then gradually open and are open at 310 degrees. They remain open to 322 degrees and then close on the leading edge of a sheet from 322 degrees to 332 degrees, and remain closed at 360 degrees, at which point they carry the leading edge of the sheet into the bite between the lower and the large printing cylinders.

Referring now to the diagram as a whole, and relating it to the manner in which a sheet is received from the feeder and delivered in register to the cylinder stops 29, at which point it is seized by the grippers 30 and carried to and through the bite of the large and lower printing cylinders:

At point No. 1 (200 degrees) the stop fingers 25 are in the "up" position, the upper feed roll 28 is in the "up" position, and the lower feed roll 27 is stationary. The leading edge of a sheet proceeding down the conveyor board from the feeder may reach the raised stop fingers 25, and be registered against the stop fingers 25 and the conveyor side guide, at any point between 200 degrees and 270 degrees. At 270 degrees the sheet is in proper registered position with its leading edge against the stop fingers 25 and its side edge in register with the conveyor side guide, and at this point, the upper feed rolls 28 begin to descend and contact the upper surface of the sheet at some point between 270 degrees and 290 degrees, depending upon the thickness of the sheet.

The sheet is then held firmly between the stationary lower feed roll 27 and the stationary upper feed roll 28, with the upper feed roll being yieldably urged to hold the sheet in firm contact with the lower feed roll. This is represented by point No. 2 (290 degrees) on the timing chart.

At point No. 3 on the timing chart, or 294 degrees, the stop fingers 25 begin to move away from the leading edge of the sheet and pass out of the path of the sheet at a faster rate than the sheet is moved forward, and are completely out of the path of the sheet by 310 degrees.

At point No. 4 on the timing chart, or 296 degrees, the lower feed roll 27 begins to move in a clockwise direction very slowly at first and gradually accelerating so that the sheet is moved gradually from a stationary position until it is moving at the same surface speed as the lower printing cylinder 20 by the time it reaches point No. 5 on the timing chart, or 320 degrees. By this time, the cylinder gripper fingers 30 at the leading edge 710 of lower printing cylinder 20 have opened (at 310 degrees) and moved into position ahead of the leading edge of the sheet, at 322 degrees.

From point No. 5 to point No. 6 on the timing chart, or from 320 degrees to 330 degrees, the leading edge of the sheet moves into the cylinder grippers 30 and against the cylinder stops 29, and to accomplish this is accelerated to a speed greater than the surface speed of the lower printing cylinder 20.

Meantime, starting at 322 degrees, the cylinder grippers 30 have begun to close, and throughout point 7A on the chart (325 degrees to 332 degrees) the leading edge of the sheet is held against the cylinder stops 29.

The cylinder grippers 30 close at point No. 7 on the chart or at 332 degrees.

At point No. 8 on the chart, or 355 degrees, the upper feed roll 28 lifts, releasing the sheet from the control of the upper and lower feed rolls and the sheet is carried by the cylinder grippers 30 to point No. 9, or 360 degrees, at which the leading edge of the sheet enters the bite between the large and lower printing cylinders, and the stop fingers 25, upper feed roll 28 and lower feed roll 27 are again in position, as shown at zero degrees, at the start of the next revolution of the lower printing cylinder 20. The operation of the upper and lower feed rollers 28 and 27 and the stop fingers 25 is as described herein on each revolution of the lower printing cylinder 20, irrespective of whether a sheet is fed to each revolution of the lower printing cylinder or not.

LOWER PRINTING CYLINDER MOUNTING

Referring to FIG. 39, the lower printing cylinder 20 is journalled to turn about a stationary shaft 21 which has eccentric and stub portions 43 and 44 at either end thereof. The eccentric end stub portion 44 at the right end of shaft 21 is journalled for rocking motion in an eccentric hole in flanged sleeve member 82. Flanged sleeve member 82 extends through frame 33 and is secured thereto by three bolts 85 passing through slots 84 in flange 83 of the sleeve member 82. When lower printing cylinder 20 is in its operative (or printing) position, shaft 21 and the outer surface of lower printing cylinder 20 are concentric with the outer sleeve portion of flanged sleeve member 82. The eccentricity of the hole through the center of flanged sleeve member 82 is the same as the eccentricity of the eccentric end stub portion 44, of shaft 21, which is journalled in sleeve member 82. In this embodiment of the press the other eccentric end stub portion 43 of shaft 21, at the left end of shaft 21, is journalled in hole (in the left-hand press frame 31) which is in line with the eccentric hole in flanged sleeve member 82, and eccentric from the center of shaft 21 and lower printing cylinder 20 by exactly the same amount as the eccentric end portion 44 at the right end of shaft 21.

Thus, while lower printing cylinder 20 is journalled to turn about shaft 21, its center may be raised or lowered by rocking the eccentric end stub portion 43 which protrudes through the left-hand frame 31 of the press, as has previously been described with respect to the latching mechanism. Also, as previously described with respect to the latching mechanism, the center of shaft 21 and lower printing cylinder 20 may be adjusted up or down to secure the proper printing pressure between lower printing cylinder 20 and a working surface on the large printing cylinder 22. Also, the center of shaft 21 and lower printing cylinder 20 may be dropped down to move the lower printing cylinder 20 out of printing contact with the larger printing cylinder 22 when no sheet is fed, all as previously described in connection with the latching mechanism.

There are three slots 84 in the flanged portion 83 of flanged sleeve member 82 and three bolts 85 which hold the flanged sleeve member is position against frame 33. Each passes through one of these slots 84 and is threaded into a corresponding threaded hole in main frame 33. When the bolts 85 are loosened, the flanged sleeve member 82 may be rotated in a clockwise direction to raise the center of eccentric shaft projection 44 journalled therein, thereby raising the right-hand side of lower printing cylinder 20; or flanged sleeve member 82 may be rotated in a counterclockwise direction to lower the center of eccentric shaft projection 44, thereby lowering the right end of lower printing cylinder 20. Two dowel pins 89 project from the outer face of flange 83 on sleeve member 82 and provide a purchase by means of which the flanged sleeve member may be slightly rocked in either counterclockwise or clockwise direction as described. By means of this adjustment, which either raises or lowers the right-hand end of lower printing cylinder 20, lower printing cylinder 20 may be brought into perfect parallelism with the larger printing cylinder 22, at which point bolts 85 are tightened and the adjustment is thus maintained.

The gear 45, by means of which lower printing cylinder 20 is driven, is journalled at 81 about the outer surface of flanged sleeve member 82. Thus gear 45 is at all times on a fixed center which holds it in perfect mesh with gear 41 on large printing cylinder 22. Lower printing cylinder 20 is driven by gear 45 through an Oldham coupling 46 which compensates for the difference in alignment between the fixed center of gear 45 and the center of shaft portion 21 and lower printing cylinder 20, whose center is in alignment with the center of gear 45 when lower printing cylinder 20 is in printing position, but whose center is not in alignment therewith when lower printing cylinder 20 drops into non-printing position.

FEED ROLL CONTROLS

As illustrated in FIGS. 39, 40, 40A, 40B, 41, 42, 43, 44 and 45 the upper and lower feed rolls 28 and 27 and the stop fingers 25 operate on each revolution of lower printing cylinder and synchronized therewith, and their operations are controlled by three cams which are fixed to and turn with lower cylinder gear 45. Cam 106 controls the action of the lower feed roll 27, cam 107 controls the action of the stop fingers 25, and cam 108 controls the action of the upper feed roll 28. There is a sleeve member 134 rigidly fixed to the outer face of gear 45 by means of six screws 135. The inside diameter of cam 108 fits snugly over sleeve portion 136 of sleeve member 134, and cam 108 is held firmly against face 137 of sleeve member 134 by means of three hex head bolts 138, each of which passes through a slot 139 in the face of cam 108, and into a threaded hole in sleeve member 134. The slots 139 allow for angular adjustment of cam 108 and the bolts 138 hold it rigidly in place against sleeve member 134 when such adjustment has been accomplished.

The inside diameter of cam 107 fits snugly about sleeve portion 143 of sleeve member 134, and cam 107 is held rigidly against face 144 on sleeve member 134 by means of three Allen head bolts 148 which pass through slots 145 in the face of cam 107, thereby providing for both the angular adjustment of cam 107 and for holding it securely to sleeve member 134, once the adjustment has been accomplished. There are also three slots 146 in both spacer member 149 and cam 106 and in alignment with the slots 145. The slots 146 are large enough to accommodate the head of the Allen bolts 148 and to provide access thereto from the outside.

A spacer flange 149 fits snugly over the sleeve portion 143 of sleeve member 134 fits between cam 106 and cam 107.

The inside diameter of cam 106 fits snugly about sleeve portion 143 of sleeve member 134, and cam 106 is held rigidly against the faces of three spacer rings 155 which space it from the face 144 of sleeve member 134. Cam 106 is held in position by three Allen head bolts 153 which pass through slots 154 in the face of cam 106 and through spacer rings 155 and thread into the body of sleeve member 134. The length of the spacer rings 155 is slightly greater than the combined width of cam 107 and spacer flange 149. Both cam 107 and spacer flange 149 have slots 156 therein which are in alignment with the slots 154 but large enough to clear the spacer rings 155. Thus, cam 106 may be adjusted angularly and then clamped in fixed position against sleeve member 134 without disturbing the adjustment of cam 107, and similarly, cam 107 may be adjusted angularly and then clamped in position against sleeve member 134 without disturbing the adjustment of cam 106. The three Allen head bolts 153 that hold cam 106 in position and the three Allen head bolts 148 that hold cam 107 in position are each spaced equidistant from the center of gear 45 and sleeve member 134, which supports the cams and turns with the gear. There is a hole 157 through the frame 33, also the same distance from the same center, through which an Allen wrench may be inserted from outside frame 33 to loosen or tighten any one of the Allen head bolts 48 and/or 153, that are brought into alignment with it, from outside the frame 33. There is also a slot 158 in the flanged portion 83 of sleeve member 82 which straddles the hole 157 and leaves it exposed in any position of adjustment of the flanged sleeve member 82.

The inside face 163 of sleeve member 134 acts as a locating flange to hold the outer race of the bearing 164, on which the gear 45 is journalled, in position. The inside diameter 159 of sleeve member 134 is slightly larger in diameter than the outer diameter of the sleeve portion of flanged sleeve member 82 so that there is no contact between surface 159 of sleeve member 134 as it turns with gear 45 and the stationary sleeve portion of flanged sleeve member 82.

LOWER FEED ROLL CONTROL

The lower feed roll 27 is integral with its shaft 47, which in turn is journalled in the two side frame member 31 and 33. The lower feed roll 27 is driven intermittently in a clockwise direction and is prevented from turning in a counterclockwise direction by the action of a spring 102. One end of spring 102 is fastened to a spring pin 122 in the left-hand main frame 31 and the spring 102 then wraps snugly around shaft 47 in a counterclockwise direction. Thus, when shaft 47 is rotated in a clockwise direction, the friction between the shaft and the spring tends to free the grip of the spring upon the shaft and allow it to turn, whereas any effort to turn the shaft in a counterclockwise direction tightens the spring and causes it to grip the shaft and prevent it from turning in the counterclockwise direction.

At the right end of shaft 47 outside of frame 33, there is a gear 132 pinned to the end of shaft 47. Gear 132, in turn, meshes with a gear 152. Gear 152, in turn, is mounted to the housing portion of a Formsprang clutch 162, the inner portion of which is pinned to shaft 165. Shaft 165 is journalled in frame member 33, and at the other end of shaft 165, just inside frame member 33, there is a gear 166 also pinned to shaft 165. The gear face of a gear sector 167 meshes with gear 166. Gear sector 167 is pivoted about a stud 168 which is secured to frame member 33. A cam follower 169 is affixed to gear sector 167 and held in position by a nut 183. Cam follower 169 follows the face of cam 106 and is held in contact with the face of cam 106 by the action of the spring 173 which connects spring stud 174 in frame 33 with another spring stud 175 on sector 167.

As lower cylinder 20 revolves in a clockwise direction, and as cam 106 forces cam follower 169 and with it sector 167, to pivot upwardly about stud 168 against the action of spring 173, gear 166 is driven in a counterclockwise direction and, in turn, drives shaft 165, and through the Formsprang clutch 162 drives gear 152 in a counterclockwise direction as well, thereby driving gear 132, shaft 47 and lower feed roll 27 in a clockwise direction. The steepness of the rise in cam 106 determines the speed at which lower feed roll 27 is driven in a clockwise direction. When follower 169 reaches the high point of cam 106, sector 167, gear 166, gear 152, gear 132, and the lower feed roll 27 cease turning.

As the spring 173 causes the follower 169 to follow the cam 106 back down to the low point on cam 106, sector 167 moves downwardly and gear 166 is driven in a clockwise direction, and with it shaft 165 is driven in a clockwise direction. However, the Formsprang clutch 162 drives in only one direction and, therefore, gear 152 is not driven in a clockwise direction, and consequently, gear 132 and shaft 47 are not driven in a counterclockwise direction. Any tendency of shaft 47 to turn in a clockwise direction is counteracted by the action of spring 102, as previously described.

PLATE SEGMENT MOUNTING ON LARGE PRINTING CYLINDER

The large printing cylinder shaft 32 is journalled in the side frames 31 and 11. At either end of shaft 32 within the frames, ring members 36 and 37, a right-hand one of which 37 is seen in FIG. 41, are pinned to shaft 32 and may carry a removable segment or segments F-41. A plate segment F-41 is secured to the ring members 36 and 37 in substantially the same manner as the plate segment, shown in W. W. Davidson U.S. Pat. No. 2,387,750 of Oct. 30, 1945, and may be removed, attached and adjusted circumferentially about the ring members 36 and 37, in substantially the same manner as shown and described in the above-named patent. However, the press of this invention, the leading edge 712 of plate segment F-41, as the large printing cylinder rotates in a counterclockwise direction, is slightly ahead of the leading edge 710 of lower printing cylinder 20, when the two leading edges are at the point of tangency, as seen in FIG. 39. The slots 711 for slidably positioning plate segment F-41 on rings 36 and 37 are so located that segment F-41 may be adjusted, from the position shown, in a counterclockwise direction, but not in a clockwise direction, with the result that the leading edge 712 of plate segment F-41 will always overlap the leading edge 710 of lower printing cylinder 20 by an amount which may be adjusted to be greater than that shown in FIG. 39, but not less, with the result that plate segment F-41 may not be adjusted to a position where its leading edge 712 is even with or trailing the leading edge 710 of lower printing cylinder 20.

The leading edges of the segment F-41 and the lower printing cylinder 20 would not be in the positions shown in FIG. 39 at the time in a normal cycle of operation when the stop fingers 25 and the upper and lower feed rolls 28 and 27 were in the position in which they are shown in FIG. 39. They are shown as seen in FIG. 39 for convenience in showing and describing the various elements, and their relative positions with respect to each other throughout a cycle are adequately shown and described in connection with the timing chart of FIG. 38.

The ring members 36 and 37 are deeply undercut, as at 38, in the spaces between the work areas of the large printing cylinder 22, or in the spaces which constitutes the gaps between adjacent work areas. This facilitates the attachment and removal of segments F-41 without requiring as long a circumferential area about the large printing cylinder to be left unencumbered in order to make it possible to attach and remove a segment. In the case where the ring members 36 and 37 are continuous, as for instance as shown in the above-mentioned patent, a longer circumferential area about the large printing cylinder must be left unencumbered to allow for the attachment and removal of segments.

With the present construction, the large printing cylinder 22 can be rotated so that one of the cut-out portions 38 is opposite the point of tangency with the lower printing cylinder 20 and the segment to be removed may then have its attaching bolts removed and the segment may be slid circumferentially around the supporting rings 36 and 37 until one end of the segment is in the center of the corresponding cut-out portion 38. At this point, the segment can be rocked about the edge 48 of the cut-out portion 38, with the result that the over-hanging portion of the segment pivots up into the cut-out portion 38 and the segment is swung out of contact with the surface of the rings 36 and 37 and may thus be removed in a much shorter circumferential length of the large printing cylinder 22, thus a much smaller portion of the circumferential area about the large printing cylinder need be left unencumbered in order to permit the removal or attachment of segments.

CYLINDER GEAR ADJUSTMENT

As seen in FIG. 41, there are two gears 40 and 41 mounted on the hub 42 of ring member 37. The pitch diameter of gears 40 and 41 is equal to the effective printing diameter of the large printing cylinder 22 and the pitch diameter of gear 45 is equal to the effective printing diameter of lower printing cylinder 20.

As previously pointed out in this embodiment of the press, gear 45 meshes with gear 41. Gear 41 is driven by a pinion which, in turn, is driven from the source of power which drives the machine. Gear 41 is rigidly affixed to ring member 37, with which it is secured in face-to-face contact by means of six bolts 69 which are countersunk into the face of gear 41 and threaded in the corresponding tapped holes in ring member 37.

Gear 40 is also located on the hub 42 of ring member 37 and is in face-to-face slidable contact with the outer face of gear 41. Gear 40 is secured to gear 41 by three hex head bolts 172 spaced 120° from each other, and which pass through slots 178 in the face of gear 40, and are threaded into holes tapped into the face of gear 41. By loosening the three hex head bolts 172, the gear 40 may be rotated about hub 42 to adjust it angularly to the extent of the length of slots 178, and then held in the secured adjusted position by tightening the three bolts 172. Each of the three bolts 172 is located equidistant from the center of shaft 32 and there is a hole 179 in frame member 33, also located the same distance from shaft 32, so that the bolts 172 may be reached with a socket type wrench from outside frame 33 through the hole 179 by bringing each of the bolts 172 in succession into alignment with hole 179.

The socket head wrench for this purpose may be a separate wrench, or may be built into the frame 33, so that it is held in position opposite hole 179, and in retracted position by means of a spring, and may then be pressed into position to contact each of the bolts 172 in succession as each is moved into position in alignment with the socket head wrench.

Plate cylinder modules which are mounted at one or more module mounting positions about the main press frames as illustrated elsewhere herein are driven by gears which mesh with gear 40. As described elsewhere herein, the plate cylinder of each such plate cylinder module has means by which the image on the plate carried thereby may be individually adjusted vertically, or in other words, circumferentially, by moving the individual plate cylinder angularly with respect to the gear by which it is driven and, once made, these adjustments may be locked in position. By this means the images from two or more plates carried on two or more plate cylinders in two or more plate cylinder modules may be adjusted vertically (or circumferentially) to be brought into register with each other.

After this has been accomplished, it may be found that the combined images from these two or more plates must, in turn, be adjusted vertically with respect to the position at which these combined images will appear on the sheets being printed. By adjusting gear 40 angularly as described, the positions of these two or more combined images may thus be simultaneously adjusted with respect to the vertical position in which they will appear on the sheets being printed without disturbing the vertical relationship of one image to the other, and without the need to again make individual vertical adjustments of each image, with the consequent need which would arise to locate each image properly on the paper and once again bring each image into register with each other image.

STOP FINGER MECHANISM

Referring to the stop finger-feed roller mechanism, as seen in FIGS. 39 and 41, it will be seen that the lower feed roll 27, as previously described, is an integral part of its shaft 47 which is journalled in the side frames and is positively driven intermittently, as previously described. As seen in FIGS. 39 and 44, upper feed roll 28 is journalled to idle, or be frictionally driven, about a shaft 182 which is carried in the arms of a bracket 176. Bracket 176 is secured to the center portion of a shaft 177 which is journalled in the side frames and caused to rock in a manner which will hereinafter be described, with the result that upper feed roll 28 is positively lifted out of contact with lower feed roll 27 and then yieldably brought into contact either with lower feed roll 27 or with the upper surface of a sheet of paper resting on lower feed roll 27.

The stop fingers 25 are securely fixed to a separate shaft 110 and spaced across its face, as seen in FIG. 44. Stop fingers 25 are separate and distinct from lower feed roll shaft 47 and spaced closer to lower printing cylinder 20.

When the stop fingers 25 are in the "up" position, as seen in FIG. 44, a sheet of paper having been fed from the feeder at the proper time in the cycle, and carried down the conveyor, is stopped when its leading edge comes in contact with stop fingers 25. This registers the sheet longitudinally and it is then registered laterally against a side guide by well known means, not shown herein. The upper feed roll 28 then drops into the down position shown in FIG. 39 and bites the sheet between the upper and lower feed rolls.

The fact that the stop fingers 25 are mounted independently on shaft 110, and not as a part of the lower feed roll shaft 47, allows the leading edge of the sheet to be close to lower printing cylinder 20 when it is registered against the stop fingers 25 so that the sheet does not have to be driven far by the upper and lower feed rolls in order to enter the cylinder grippers 30 and be registered against the cylinder stops 29. Also, this arrangement allows the stop fingers 25 and the lower feed roller 27 to be independently controlled. This allows great flexibility in controlling the time when the stop fingers 25 come up to receive the leading edge of the next sheet, and it also eliminates any need to have the lower feed roll 27 turned first clockwise and then counterclockwise. Mounting the stop fingers 25 separate from the lower feed roll shaft 47 also makes for great flexibility in supporting the lower feed roll shaft 47 and in locating the shaft M-151 for the catch member M-147 of the latch mechanism.

In prior art structures in which stop fingers are on integral part of a lower feed roll shaft, the lower feed roll and its shaft have a rocking motion, forward and back again and the upper feed roll, when it is in the "down" position, is always in contact with the same circumferential portion of the lower feed roll. This has been found to cause wear on the lower feed roll in the area where it is repetitively contacted by the upper feed roll.

With the present arrangement, in which the lower feed roll 27 rotates only clockwise, intermittently, by the amount required to drive the leading edge of the sheet from is position in contact with the stop fingers 25 into the cylinder grippers 30 and into register with the cylinder stops 29, the area of the lower feed roll 27 contained by the upper feed roll 28 varies in a random manner so that any wear is spread uniformly around the circumference of the lower feed roll 27 and is not concentrated in a fixed portion of this circumference.

When the leading edge of a sheet stops in contact with the stop fingers 25 and is registered with respect thereto and with respect to the side guide, it is held in that position by the conveyor tapes and the side registering means until the upper feed roll 28 comes down and seizes the sheet against the then stationary lower feed roll 27. Since the upper feed roll 28 is urged downwardly against the upper face of the sheet by yieldable spring action, the action is the same irrespective of the thickness of the sheet involved, and no adjustment is required irrespective of the thickness of the sheets being handled. This not only makes for ease of operation and setting from one job to another, but is especially important where sheets of different thickness may be fed alternately.

Once the sheet is seized in the bite between the upper and lower feed rolls, its registered position is maintained thereby and the side register means on the conveyor may retract and the stop fingers 25 may begin to move out of the path of the sheet, notwithstanding which the registered position of the sheet is still maintained by the bite between the upper and lower feed rolls.

Thus, the stop fingers 25 may be rocked forward and down and out of the path the leading edge of the sheet will follow, ahead of the movement of the leading edge of the sheet itself, so that no nicking can occur through the leading edge of the sheet being driven against the stop fingers 25.

Since the lower feed roll 27 is stationary when the sheet is seized between the upper and lower feed rolls, and since the mechanism that controls the driving of the lower feed roll 27 causes it to start to move slowly and accelerate uniformly, any tendency to create slippage in overcoming the inertia of the standing sheet and bringing it up to the speed necessary to register it against the cylinder stops 29 is reduced to an absolute minimum. The action of the lower feed roll 27 in driving the sheet is such that the leading edge of the sheet just reaches a point adjacent the surface of lower printing cylinder 20 as the cylinder grippers 30 pass this point, the cylinder grippers 30 having been opened as they approached that point. The lower feed roll 27 then accelerates so that the sheet is driven at a speed above that of the surface speed of the lower printing cylinder 20, whereby the leading edge of the sheet enters the cylinder grippers 30 and is pressed into register position against the cylinder stops 29. The speed at which the lower feed roll 27 is driven then drops back to equal the surface speed of the lower printing cylinder 20, thus holding the leading edge of the sheet in register against the cylinder stops 27 as the cylinder grippers 30 close.

Immediately after the cylinder grippers 30 have closed and seized the leading edge of the sheet in its registered position against the cylinder stops 29, the upper feed roll 28 lifts to release the sheet from the control of the upper and lower feed rolls and the speed of the lower feed roll 27 is reduced to zero and it remains stationary.

The leading edge of the sheet is then carried by the cylinder grippers 30 into the bite at the point of tangency between the lower and large printing cylinders, at which point the pressure between the opposed work areas of the lower and large printing cylinders seizes the sheet and maintains it in registered position, and thereafter the function of the cylinder grippers 30 is simply to carry the leading edge of the sheet to the point at which it is stripped and delivered and to perform a part of the function of stripping and delivering the sheet.

In the meantime, the stop fingers 25 have begun to rise, and they rise into the "up" position just as the trailing edge of the longest sheet which can be handled by the press passes the position of the stop fingers 25. Once the upper feed roll 28 has released the sheet, it remains in the "up" position until the next sheet has come into position against the stop fingers 25 and the process is repeated, as previously described.

STOP FINGER CONTROL

The action of the stop fingers 25 is controlled as follows:

The stop fingers 25 are spaced across the stop finger shaft 110 and secured thereto. When the stop fingers 25 with shaft 110 are rotated into the "up" position, as seen in FIG. 39, the stop fingers protrude into the path of sheets being fed from the conveyor board into the press and cause the leading edge of a sheet thus fed to come to rest against the stop fingers 25, at which point the sheet is registered longitudinally against the stop fingers themselves and laterally against a side guide on the conveyor.

Although the sheets are fed by the feeder in timed relationship to the action of the stop fingers 25, the sheets being fed by the feeder and down the conveyor board do not arrive at the position of the stop fingers 25 with absolute precision, the stop fingers therefore remain in the "up" position for a sufficient period of time to compensate for the inaccuracies that may be expected in receiving sheets from the feeder, the function of the stop fingers 25 being chiefly to remove such inaccuracies and to accomplish the accurate registration of the leading edge of each sheet so that it, in turn, may be accurately registered against the cylinder stops 29 carried by the lower printing cylinder 20.

At the right-hand end of stop finger shaft 110, which is journalled in the main frames of the press, there is a lever cam 184, outside the right-hand main frame 33, which is securely pinned to stop finger shaft 110. At the end of lever arm 184 and secured thereto is a pin 185 which acts both as a pivot point for link 186 and as a spring stud for one end of spring 187, the other end of which is affixed to spring stud 188 secured in frame member 33. There is an adjustable eccentric stop pin 189 which limits the upward movement of lever arm 184 and, when the stop fingers 25 are in the "up" position, lever arm 184 is held in engagement with stop pin 189 by spring 187. Stop pin 189 is an eccentric projection of a stud 192 which has a reduced portion which, in turn, extends through frame 33 and is secured in position on the inside of frame 33 by a nut and lock washer not shown. The exact position of stop pin 189 can thus be adjusted and thereby the exact position of the stop fingers 25 in the "up" position may be adjusted. There is an actuating lever arm 194 which is pinned to the outer end of shaft 195 which, in turn, is jounalled in frame member 33. Shaft 195 passes through frame 33 and, at its other end, another lever arm 196 is securely pinned to shaft 195. Lever arm 196 carries cam follower 197 which follows the contour of cam 107. Follower 197 is yieldably held against the surface of cam 107 by the action of spring 198, one end of which is secured to a spring stud 199 in lever arm 194 and the other end of which is secured to a spring stud 201 in frame 33. There is a link pin 202 secured in the outer end of lever arm 194 and link 186 fits over and connects pin 202 at the outer end of lever arm 194 and pin 185 at the outer end of lever arm 184.

Thus, as lower printing cylinder 20 and cam 107 revolve in a clockwise direction, when cam follower 197 is driven outwardly by the face of cam 107, shaft 195, and with it, lever arm 194 are driven in a counterclockwise direction, pin 202 is moved downwardly and, through link 186, pin 185 is also moved downwardly. This rocks lever arm 184, and with it the stop finger shaft 110 and the stop fingers 25 in a clockwise direction, thus moving the stop fingers 25 out of the path of a sheet being advanced by the previously described action of the upper and lower feed rolls.

As lower printing cylinder 20 and cam 107 revolve, and the follower 197 follows the face of the cam to the dwell on the cam, shaft 195 and lever arm 194 revolves in a clockwise direction, lifting pin 202 and carrying with it link 186, pin 185, lever arm 184 and stop fingers 25. The follower 197 does not actually ride on the low portion of the cam at the dwell of the cam because, when the stop fingers 25 are in the "up" position, lever arm 184 contacts top pin 189 and is held rigidly in that position by the action of spring 187, irrespective of any play in the linkage from pin 185 back to the cam follower 197. Any play in the linkage is taken up by the action of spring 198 which urges cam follower 197 in the direction of the dwell of the cam, but the arrangement is such that cam follower 197 does not actually ride on the low part of the cam, and the fixed "up" position of the stop fingers 25 is determined absolutely by the fixed link 184 pinned to the end of stop finger shaft 110 being held in rigid engagement with stop pin 189 by the action of spring 187, so that the sheets are registered against the rigidly controlled top fingers, irrespective of any play that may exist in the linkage, as previously described.

UPPER FEED ROLL CONTROL

The action of the upper feed roll 28 is controlled by a mechanism which operates as follows: The shaft 177 is journalled in the side frames and has fixed to it at its center portion a bracket 176, the two arms of which carry the shaft 182 about which the upper feed roll 28 is journalled to be free to turn. The bracket 176 is located so as to position the upper feed roll 28 directly in line above the lower feed roll 27, and includes means (not shown) for paralleling the upper feed roll 28 in relation to the lower feed roll 27.

Outside the frame 33 there is a lever arm 203 securely pinned to the protruding end of the shaft 177. This lever arm carries a spring stud 204 to which a spring 205 is secured, the other end of which is secured to a spring stud 206 in the face of the flanged sleeve member 82. Thus, spring 205 acts to rotate lever arm 203 and with it shaft 177 and upper feed roll 28 in a counterclockwise direction, so that the action of the spring 205 causes the upper feed roll 28 to be yieldably drawn into contact with either lower feed roll 27 or the upper surface of a sheet of paper lying above upper feed roll 28, except at such times as the rest of the mechanism to be hereinafter described causes the upper feed roll 28 to be lifted out of contact with lower feed roll 27.

There is a shaft 207 jounalled in frame 33 and extending therethrough, and at the outer end of shaft 207 there is a lever arm 208 rigidly pinned thereto. At the outer end of lever arm 208 there is a roller 211 which is in alignment with the extended face of lever arm 203. Roller 211 is mounted on a stud 214 which, in turn, is eccentrically mounted at the end of lever arm 208 and held in adjusted position by nut 212. When the nut 212 is loosened, the eccentric stud 214 may be turned by a screw driver inserted in the slot 213 to adjust the position of roller 211, and the nut 212 may then be retightened to maintain the adjustment. At the other end of shaft 207, inside frame 33, there is another lever arm 215 securely pinned to shaft 207 and carrying at its outer end cam follower roller 216 which follows the surface of cam 108.

A spring 217 between spring stud 218 on arm 208 and spring stud 219 in the flanged sleeve member 82 acts to cause the cam follower roller 216 to follow the surface of cam 108. When lower printing cylinder 20 and cam 108 have rotated to a position such that cam follower 216 is in the dwell (or on the low part) of cam 108, roller 211 moves to the right as arm 208 rocks in a clockwise direction and releases lever arm 203 which, under the action of spring 205, moves in a counterclockwise direction until upper feed roll 28 contacts either feed roller roll 27 or the upper surface of a sheet resting above lower feed roll 27. In either case, roller 211 moves out of contact with the face of lever arm 203 when cam follower 216 is on the low part, or the dwell, of cam 108, so that during that time upper feed roll 28 is completely under the control of spring 205.

As lower printing cylinder 20 and cam 108 revolve in a clockwise direction and cam follower 216 follows the surface of cam 108 up onto the high portion of the cam, it causes lever arms 215 and 208 to rotate in a counterclockwise direction, bringing roller 211 into contact with the extended face of lever arm 203 and rocking lever arm 203 and with it shaft 177, bracket 176 and upper feed roll 28 in a clockwise direction against the action of spring 205, so that upper feed roll 28 is lifted out of contact with lower feed roll 27 and/or out of contact with a sheet resting on lower feed roll 27.

The shape and contours of cams 106, 107, and 108, as shown, and their angular adjustability, as illustrated and described, allows them to be set to cause the actions of the upper and lower feed rolls 28 and 27 and the stop fingers 25 to occur in the order and sequence illustrated and described in the timing diagram in FIG. 38, with the result that the leading edge of each sheet is first accurately registered against the stop fingers 25 and the side guide of the conveyor board and thereafter accurately moved into the cylinder grippers 30 and first brought to and then held in registered contact with the cylinder stops 29 while the cylinder grippers 30 close to seize the sheet in said registered position, at which point the sheet is released by the upper and lower feed rolls. The action of the cylinder gripper fingers 30 and the mechanism that controls them is illustrated and described in detail elsewhere herein.

It should be noted that the action of the upper and lower feed rolls and the stop fingers is controlled by cams which are rigidly secured to and turn with the lower printing cylinder 20, and these actions occur on each revolution of the lower printing cylinder 20, irrespective of whether a sheet is being fed to each revolution of the lower printing cylinder, to every other revolution of the lower printing cylinder, to every third revolution of the lower printing cylinder, or in some other rhythm as determined by means for controlling the feeding of sheets, and there is no purpose or need to have these actions occur other than on each revolution of the lower printing cylinder 20, irrespective of whether a sheet has been fed to the lower printing cylinder on that revolution or not.

INDEPENDENT PRESSURE ADJUSTMENT AND AUTOMATIC LATCHING OF PLATE CYLINDER RELATIVE TO WORK AREAS OF THE LARGE PRINTING CYLINDER—2R PRESS

The following comprises a description of the mechanism on the 2R model to provide independent pressure adjustment of each plate cylinder in each plate cylinder module with each separate work area on the large printing cylinder and to cause each plate cylinder to roll in printing contact with both work areas of the large printing cylinder or with one or the other of the work areas only; and to cause each plate cylinder to be tripped out of contact with any work area which it otherwise would have contacted, if the lower printing cylinder was tripped out of contact with that work area.

FIGS. 46 through 52 show this operation most clearly. FIG. 46 shows the right-hand side of the model 2R press with three plate cylinder modules mounted in three module mounting positions I, II and III. In this preferred embodiment of the 2R press, there are three module mounting positions instead of four, whereas in the 3R model there are four module mounting positions, as hereinbefore disclosed.

As has previously been described, there is a latching mechanism on the left, or operator's, side of the press which is associated with detecting means which detects the presence or absence of a sheet at the stop fingers at each revolution of the lower printing cylinder 20 to which a sheet is intended to be fed. As previously described, whenever a sheet is thus detected to be present, the lower printing cylinder 20 is either brought into or maintained in a latched printing position with the large printing cylinder 22, and then maintained in that position at least until the next revolution of the lower printing cylinder 20 to which a sheet is intended to be fed, and if at that time the detector finds that no sheet is present at the stop fingers, the lower printing cylinder 20 moves into an unlatched non-printing position with respect to the large printing cylinder 22 and is maintained in that position, at least until the next revolution of the lower printing cylinder 20 to which a sheet is intended to be fed, and until a sheet is in fact detected to be present at the stop fingers at such a revolution of the lower printing cylinder.

This latching and unlatching of the lower printing cylinder 20 is accomplished, on the left side of the press, by rotating the stub shaft projection 43 of the shaft 21 about which the lower printing cylinder 20 is journalled so that the true center of the lower printing cylinder 20 is moved away from the center of the large printing cylinder 22 in the unlatched position, or towards the center of the large printing cylinder 22 in the latched position.

While this action is initiated by rotating the stub shaft 43 on the left or operator's side of the machine, as previously described, the stub shaft 44 which supports the lower printing cylinder shaft 21 in the right-hand frame 33, on the side of the press opposite the operator's side, is thereby rotated with stub shaft 43.

FIG. 46 shows the right side of the press and includes the details of the means for adjusting the pressure between a plate cylinder and the two separate work areas of the large printing cylinder 22. FIG. 48 reveals details of the cam mechanism which carries two adjustable cam lobes, each of which can independently be locked in either operative or inoperative position by the cam-setting mechanism illustrated in FIG. 47, dependent upon whether the lower printing cylinder 20 is in latched or unlatched position. It is by means of these adjustable cam lobes that information, as to whether the lower printing cylinder 20 is in latched or unlatched position, is carried around and transmitted into action that causes each successive plate cylinder, in turn, to be latched or unlatched in similar manner. Some of the details of the mechanism included in FIG. 46 can be seen more clearly in FIGS. 46A through 52. This mechanism is generally designated KK-2 and KK-3. However, since it is associated with the plate cylinder module the individual parts have been given numbers with the prefix "A".

The eccentric end stub portion 44 of the shaft 21, about which the lower printing cylinder 20 rotates, projects through the right-hand frame 33 and has affixed thereto an upwardly projecting arm A-76, the hub portion of which is secured to the projecting portion of stub shaft 44 by taper pin A-77. Beyond that there is a second upwardly projecting arm member A-81 whose hub portion A-82 is journalled for rocking motion about stub shaft 44 with a sleeve bearing A-84. This upwardly projecting arm A-81 carries a cam surface A-83 at its upper end. There is a spacer member A-85 affixed to arm A-76 which in turn carries a pin A-86 that projects through a slot A-87 in arm A-81, and the larger head A-91 of the pin A-86 retains the arm A-81 against the face of the spacer member A-85. A spring A-92 connected between a spring stud A-93 in the main frame 33 of the press and a spring stud A-94 in arm A-81 acts to urge arm A-81 into the full line position, as seen in FIG. 47, at which point it rests against an eccentrically adjustable stop pin A-95.

There is a cam follower roller A-96 mounted at the end of an arm A-97 which is journalled on sleeve bearing A-102 for rocking movement about a stud A-101 bolted to frame 33. There is a second, downwardly projecting, arm A-103 also journalled on sleeve bearing A-102 for rocking motion about stud A-101, and a bolt A-104 passes through a slot A-105 in arm A-103 and into a threaded hole A-106 in arm A-97. It is thereby possible to adjust the angular position of cam follower A-96 with respect to arm A-103 and arm A-97 together by tightening bolt A-104, and thereafter the position of cam follower A-96 may be moved from the solid line position to the dotted line position by similarly moving arm A-103 from the solid line position to the dotted line position. There is a pin A-107 at the upper end of arm A-76 and a pin A-111 at the lower end of arm A-103, and these two pins are interconnected by a link A-112.

Thus, when lower cylinder 20 is in the latched or solid line position, arm A-76 which is pinned to stub shaft 44 is in the solid line position, as is the link A-112, the arm A-103, the arm A-97 and cam follower A-96. Similarly, arm A-81 is held in the solid line position against stop A-95 by the action of spring A-92, and the length of the slot A-87 in arm A-81 is sufficient that the position of pin A-86 in slot A-87 does not impede the arm A-81 from assuming the solid line position. Thus, as long as the lower cylinder 20 remains in the latched or solid line position, the arm A-81 with its cam face A-83 and the arm A-97 with its cam follower A-96 remain in the solid line position.

When the lower cylinder 20 moves into the unlatched or dotted line position, arm A-76, which is pinned to it, moves into the dotted line position, and through the action of link A-112 moves the arm A-103, the arm A-97 and the cam follower A-96 into the dotted line position. Similarly, pin A-86, which is carried by arm A-76, moves to the right and contacts the right-hand end of slot A-87 and, thereafter, as it continues to move to the right into its final dotted line position, it carries arm A-81 with it against the action of spring A-92 into the dotted line position of arm A-81 and cam surface A-83.

There is a concentric projecting portion 35 of large cylinder shaft 32 which revolves with the large cylinder 22. A disc member A-113, having an inwardly projecting hub A-114 and an outwardly projecting hub A-115, is secured to the shaft 35 by means of a taper pin A-116 through the outwardly projecting hub A-115 and the shaft 35. As best seen in FIGS. 48 and 46c, this disc member A-113 carries two cam lobes A-117 and A-117A spaced at 180 degrees from each other, and each of which is mounted on the inner face of disc A-113 by means of mounting studs A-121 and A-121A, respectively, about which each lobe is free to rock on sleeve bearing A-122 and A-122A, respectively. The extent of this rocking motion is limited by limit pins A-123 and A-123A, each of which is secured to disc member A-113 and which project through slots A-124 and A-124A (in lobes A-117 and A-117A) which describe an arc centered on pins A-121 and A-121A, respectively. Guide pins A-125 and A-125A, respectively, are affixed to disc member A-113 at A-126 and A-126A, respectively, and support compression springs A-127 and A-127A which bear against washers A-131 and A-131A, thereby urging cam lobes A-117 and A-117A into an outer position in which the pins A-123 and A-123A contact the innermost end of slots A-124 and A-124A, thereby limiting the extent of the outward motion of the lobes A-117 and A-117A. As seen in FIG. 48 the lobe A-117 projects beyond the periphery of disc A-113. Either cam lobe may be forced into a position below the periphery of disc A-113, against the action of the respective springs A-127 or A-127A, and latched in that inner position as is lobe A-117A in FIG. 48.

For each lobe A-117 and A-117A there is a pair of latching pawls A-131 and A-132 and A-131A and A-132A to latch the lobe either in the outer extended position or the inner position. Referring to the position of lobe A-117 in FIG. 48, the latching pawls A-131 and A-132 are mounted about a shaft A-133 which projects through disc member A-113. Latching pawl A-131, which is adjacent the inner face of disc member A-113, is pinned to shaft A-133, whereas latching pawl A-132 is journalled about a sleeve bearing A-134 for rocking motion about shaft A-133. As stated, shaft A-133 projects through the disc member A-113, and on the outer face of the disc member A-113 there is a lever arm A-135 pinned to shaft A-133. One end of lever arm A-135 carries a spring stud A-136 which is connected by a spring A-137 to another spring stud A-141 mounted on the outer face of disc member A-113. At the other end of lever arm A-135, there is a cam follower A-142. The action of spring A-137 urges shaft A-133 to turn in a clockwise direction as seen in FIG. 48. This urges the face of pawl A-131 into contact with the tip A-143 projecting from the end of cam lobe A-117.

A torsion spring A-144 is wrapped around shaft A-133 with one end secured on the inner face of pawl A-131 and the other end secured on the outer face of pawl A-132. This urges pawl A-132 to rotate in a clockwise direction as seen in FIG. 48 and causes the latching face A-145 of pawl A-132 to be brought into position under the projecting face A-146 of cam lobe A-117 so that, as long as pawl A-132 remains in the position shown, cam lobe A-117 is supported and latched in its outer operative position. Pawl member A-132 also has mounted on it a cam follower A-147, and pawl member A-132A has a follower A-147A. Cam lobe A-117A as seen in FIG. 48 is in the inner position in which it is held entirely within the periphery of disc A-113. In this case, spring A-127A has been compressed and spring A-137A has caused pawl A-131A to move into position so that the projecting tip A-143A at the end of cam lobe A-117A has been caught and retained by surface A-151A on the pawl A-131A. Pawl A-132A is simply held at rest against a projecting square end which protrudes from cam lobe A-117A in line with pawl A-132A and a lower surface of which is labeled A-146A. Pawl A-132A is held in this position by the action of the torsion spring A-144A.

As seen in FIGS. 47 and 46B and 46C there is a cam A-152 mounted to a mounting disc A-153, which in turn is affixed to the side frame 33 by three bolts A-154. The cam followers A-147 and A-147A carried by pawls A-132 and A-132A are in alignment with the fixed cam A-152 so that, as the disc A-113 revolves in a counterclockwise direction as seen in FIG. 46, each of the pawls A-132 and A-132A is pushed out against the action of the torsion springs A-144 and A-144A, respectively, into an unlatched position, as each follower A-147 and A-147A successively passes over the lobe portion A-714 of stationary cam A-152.

As the disc member A-113 revolves with shaft 35 in a counterclockwise direction, as seen in FIG. 46, the cam followers A-142 and A-142A are in alignment with the cam surface A-83 of the arm A-81 previously described. If the lower printing cylinder 20 is in the latched, or solid line, position as seen in FIG. 47, and the arm A-81 of the cam surface A-83 is therefore in the solid line position, neither of the followers A-142 or A-142A contacts the cam surface A-83 as it passes adjacent to it.

However, if the lower printing cylinder 20 is in the unlatched or dotted line position, then the arm A-81 and the cam surface A-83 are in the dotted line position, and if either of the cam followers A-142 or A-142A is in the position of cam follower A-142A of FIG. 48, with pawl A-131A acting to hold the cam lobe A-117A latched in its inner position, then, as the cam follower A-142A passes the cam surface A-83, it is forced inwardly thereby, and this in turn moves the corresponding pawl A-131A out away from, and clear of, the projecting point A-143A of lobe A-117A, thereby unlatching it and allowing it to move to its outward position under the action of spring A-127A. The action would be the same with respect to the lobe A-117 if it were latched in its inner position when it passed cam surface A-83 in its dotted line position.

The cam follower A-96 on arm A-97 is in alignment with the face of the cam lobes A-117 and A-117A.

If the lower printing cylinder 20 is in the latched or solid line position as seen in FIG. 47, then arm A-81 and cam surface A-83 are in the solid line position, and, similarly, arm A-97 and cam follower A-96 also are in the solid line position. As disc member A-113 revolves in a counterclockwise direction as seen in FIG. 46 a cam lobe in its outer position and its associated mechanism, as for instance lobe A-117 and associated mechanism, first passes the position of cam surface A-83 and since follower A-142 is below the periphery of the disc A-113, and since cam surface A-83 is in the solid line position, follower A-142 therefore passes the position of cam surface A-83 without being contacted thereby.

As follower A-47 on pawl A-132 reaches the high portion A-714 of cam A-152, it causes the supporting face A-145 of pawl A-132 to be withdrawn from under the surface A-146 on the corresponding projection at the outer end of cam lobe A-117. Notwithstanding the fact that pawl A-132 has been withdrawn from its supporting position in which it held cam lobe A-117 in its outer position, the cam lobe A-117 is nevertheless held in this outer extended position by the action of spring A-127.

However, in the case being described, while the follower A-147 is still on the hight portion A-714 of cam A-152, and pawl A-132 is therefore held out of supporting position with respect to cam lobe A-117, cam lobe A-117 is contacted by the follower A-96 which, as previously described, is in the solid line position. As cam lobe A-117 revolves past the follower A-96, the follower A-96 pushes lobe A-117 in, against the action of spring A-127. By the time follower A-147 reaches the end of the high portion A-714 of stationary cam A-152, cam lobe A-117 has been pushed in far enough so that supporting surface A-145 can not fall in place under the projection A-146, but the outer surface of the square projection A-146 simply rides along the inner surface of pawl A-132, which is held against it by the action of torsion spring A-144. When cam lobe A-117 has been pushed all the way in, into its inner position, spring A-137 causes pawl A-131 to move into latched position so that the face A-151 of pawl A-131 overlaps the projection A-143 at the end of cam lobe A-117.

Thus, under these circumstances, as cam lobe A-117 passes the position of follower A-96, it is latched into position below the periphery of disc A-113.

On the next revolution of disc A-113, when cam lobe A-117 and its associated mechanism again approaches the position of cam surface A-83 and the high portion A-714 of cam A-152, if lower printing cylinder 20 is still in the latched position (the solid line position), then cam follower A-142, although it is extending slightly beyond the periphery of disc A-113, is not contacted by cam surface A-83, which is still in the solid line position, and therefore cam lobe A-117 is not unlatched to return to its outer extended position but is retained in its inner position below the periphery of disc A-113. Thus, in either case, if lower printing cylinder 20 is in the latched position as the leading edge of lower printing cylinder 20 meets the leading edge of a work area of large printing cylinder 22, then, as the cam lobe A-117, or the cam lobe A-117A as the case may be, moves beyond the position of Follower A-96, it is latched in the inner position, in which it is entirely below the periphery of disc A-113.

When a cam lobe A-117 or A-117A and its associated mechanism, as for instance cam lobe A-117, approaches the position of cam surface A-83 and the high portion A-714 of stationary cam A-152 when the lower printing cylinder 20 is in the unlatched or dotted line position and therefore both cam surface A-83 (and follower A-96 are in the dotted line position) then if the lobe A-117 is in the outer extended position, the follower A-142 will be below the periphery of disc A-113, and although follower A-142 will, under these circumstances, roll in contact with the cam surface A-83, this will merely lift the pawl A-131 out of contact with projecting point A-142 until the follower A-142 passes by the area of cam surface A-83, at which time the face of the pawl A-131 will again drop back into contact with the point A-143. As the follower A-147 reaches the raised portion A-714 of stationary cam A-152, this will cause pawl A-132 to be pulled out so that its supporting surface A-145 is withdrawn from under the projecting surface A-146 of lobe A-117. Notwithstanding the fact that this support member has been withdrawn, spring A-127 will still keep the cam lobe A-117 in its outer extended position, and, as the cam lobe reaches and passes the position of follower A-96, it will not be contacted thereby since follower A-96 is in its dotted line position, which is beyond the surface of the extended lobe A-117. Therefore, as follower A-147 reaches the end of the high portion A-714 of stationary cam A-152 and returns to the low portion thereof, the supporting surface A-145 of pawl A-132 will again drop into position under the projection A-146 at the end of lobe A-117, under the action of torsion spring A-144, so that, as the cam lobe A-117 passes by the position of follower A-96, it will be in its outer extended position and will be supported in this position by the pawl A-132.

If one of the cam lobes A-117 or A-117A is latched in its inner position, as is the case with lobe A-117A in FIG. 48, as it and its associated mechanism approach cam surface A-83 and the high portion A-714 of stationary cam A-152, at a time when the lower printing cylinder 20 and the other members shown in FIG. 47 are in the unlatched or dotted line position, then the follower A-142A, which is in its outermost position slightly beyond the periphery of disc A-113, will be moved inwardly as it rolls in contact with cam surface A-83, thus causing pawl A-131A to move away from projecting point A-143A of cam lobe A-117A, thereby releasing lobe A-117A to return to its extended position beyond the periphery of disc A-113, under the action of spring A-127A.

Follower A-147A will be moved out as it follows the high portion A-714 of stationary cam A-152, thus moving pawl A-132A outwardly. Since follower A-96 is in the dotted line position, it will not contact the surface of the extended cam lobe A-117A, and spring A-127A will hold it in this position, and as follower A-147A comes to the end of the high portion A-714 of stationary cam A-152 and drops onto the lower portion of that cam, torsion spring A-144A will cause pawl A-132A to drop into position so that the supporting surface A-145A is under the projection A-146A at the end of cam lobe A-117A; and therefore as the cam lobe A-117A passes by the position of follower A-96, it will be in its extended position beyond the periphery of disc A-113 and supported in that position by pawl A-132A.

Thus, each revolution of the lower printing cylinder 20, as the leading edge of the work area of lower printing cylinder 20 comes into coincidence with the leading edge of a work area of large printing cylinder 22 at the point of tangency of these two cylinders, the corresponding cam lobe A-117 or A-117A will be in its extended position beyond the periphery of disc A-113 and supported in that position by eighter pawl A-132 or A-132A, as the case may be, whenever lower printing cylinder 20 is in the unlatched position, and similarly the corresponding cam lobe A-117 or A-117A will be in the inner or withdrawn position below the periphery of disc A-113 and be latched in that position if lower printing cylinder 20 is in the latched position.

Also, the cam lobes A-117 and A-117A will only move from their inner latched position below the periphery of disc A-113 to their outer extended position beyond the periphery of disc A-113 when lower printing cylinder 20 has just moved from its latched to its unlatched position. Similarly, the cam lobes A-117 and A-117A will only be returned from their extended position beyond the periphery of disc A-113 to their inner position below the periphery of disc-A-113 when lower printing cylinder 20 has just moved from the unlatched to the latched position. As long as lower printing cylinder 20 remains in the latched position for a number of successive revolutions thereof, the cam lobes A-117 and A-117A will remain latched in their inner positions below the periphery of disc A-113. Similarly, when lower printing cylinder 20 remains in the unlatched position for a succession of revolutions of lower printing cylinder 20, the cam lobes A-117 and A-117A will remain to their extended positions beyond the periphery of disc A-113 and supported in this position by pawls A-132 and A-132A.

As seen in FIG. 46, each of the plate cylinders, as for example plate cylinder A-11 in the plate cylinder module mounted at module mounting position I, is journalled for rotation about a shaft A-44 which is supported by end stub portions A-45 which extend through the frames A-333 of the plate cylinder module. These end stub portions A-45 are eccentric to the center of shaft A-44 and therefore to the center of plate cylinder A-11 and are supported in such a manner that if the end stub portion A-45, which extends through the righthand frame A-333, is rotated in a clockwise direction, the center of plate cylinder A-11 and shaft A-44 will be moved away from the center of large printing cylinder 22, and if said end stub portion A-45 is rotated in a counterclockwise direction, the center of plate cylinder A-11 and shaft A-44 will be moved toward the center of large printing cylinder 22.

As best seen in FIGS. 46A and 46B, on the end stub portion A-45 there is mounted a plate member A-161 which has an integral hub A-162 which fits snugly about end stub shaft A-45 and is secured thereto by a taper pin A-163. Still farther out on end stub shaft A-45 and journalled thereon is another longer hub portion A-164 at the inner end of which, and integral therewith, is a plate portion A-165, the inner surface of which lies in contact with the outer surface of plate member A-161. There is a block A-166 affixed to plate member A-161 on the inner face thereof, and a block A-167 attached to the inner face of plate member A-165 has a threaded hole therein through which extends a thumb screw A-171 which bears upon the upper face of block A-166. There is a spring pin A-172 in plate member A-165 and a spring pin A-173 in plate member A-161, and a spring A-174 connecting these two pins urges plate member A-165 to turn in a counterclockwise direction with respect to plate member A-161. This tendency is limited by the point of the thumb screw A-171 which bears on the upper surfaces of the block A-166 and adjustably limits the angular relationship of the two plates A-165 and A-161. There is a spring clip A-175 which has two pawl portions which seat in a ratchet member which is integral with the thumb screw A-171 so that the thumb screw may be turned by increments equal to the spacing of the ratchet teeth and retained in any one of these positions by the action of the pawl portion of the spring clip A-175.

This constitutes a micrometer adjustment means for varying the angularity between plates A-165 and A-161.

There is a circumferential slot A-176 in plate member A-165 and a corresponding threaded hole in plate member A-161 into which a bolt A-177 is threaded. When the bolt A-177 is loosened, the angular relationship of plate A-165 to plate A-161 can be adjusted by micrometer increments as previously described, and when the desired adjustment is attained, this can be locked into position by tightening bolt A-177 so that the maintenance of the relationship between the two plates is solidly locked and not dependent upon the action of spring A-174 or thumb screw A-171, except during periods of adjustment.

There is a spring pin A-181 at the outer end of plate A-165 and a corresponding spring pin A-182 in the module frame A-333, and a spring A-183 connects these two spring pins. The action of this spring is to urge the plat A-165, and plate A-161 to which it is secured together with the stub shaft A-45 to which plate A-161 is dependent upon the position of cam lobe A-117 which determines and controls this as described above.

The third element of control member A-245 consists of a hub member A-293 which contains therein a sleeve bearing A-294 journalled on stud A-246. Integral therewith is an arm member A-295, a portion of which lies in contact with the surface of fan-shaped member A-265, and which carries at its outer end a thumb screw A-296 which may be threaded alternatively into either threaded hole A-266 or threaded hole A-267. Also integral with hub member A-293 is an arm A-297 which carries cam follower A-253 which as has previously been described, is in alignment with cam A-242. If the thumb screw A-296 is threaded into the upper threaded hole A-267, cam follower A-253 is maintained in a position which it never contacts cam A-242. However, if thumb screw A-296 is threaded into the lower threaded hole A-266, cam follower A-253 is maintained in a positinin which it follows the contour of cam A-242. Since the lobe on cam A-242 is 180° away from the lobe on cam A-241, if thumb screw A-296 is threaded into the lower hole A-266 and thumb screw A-291 is threaded into the upper hole A-271, the plate cylinder A-11 is caused to remain in the unlatched non-printing position, out of contact with the second work area of large printing cylinder 22, but remains in the latched printing position, and rolls in contact with, the first work area of large printing cylinder 22, except as it may be moved into the unlatched non-printing position before it rolls opposite the first work area of large printing cylinder 22 by the action of cam lobe A-117A, which is controlled as previously described.

Thus, by the proper adjustment of the arms A-295 and A-287, the plate cylinder A-11 may be caused to remain unlatched and out of printing contact with either the first or second work area of large printing cylinder 22 while remaining latched and rolling in printing contact with the other work area of large printing cylinder 22. In either case it will in fact be latched and roll in printing contact with the selected work area of large printing cylinder 22 only if the latching mechanism which controls the latching and unlatching of the lower printing cylinder 20 caused the lower printing cylinder 20 to be latched when it rolled opposite the corresponding work area of large printing cylinder 22.

If it is desired to have plate cylinder A-11 roll in printing contact with both work areas of large printing cylinder 22, then thumb screw A-291 is threaded into upper hole A-271 and thumb screw A-296 is threaded into upper hole A-267, in which position of adjustment both cam followers A-252 and A-253, are held completely out of contact with cams A-241 and A-242. In this case, plate cylinder A-11 rolls in printing contact with both work areas of large printing cylinder 22, with the pressure in each case being independently maintained through the adjustment of thumb screws A-171 and A-194, as previously described, and the action of the cam lobes A-117 and A-117A being such as to cause plate cylinder A-11 to be latched and roll in printing contact with any work area of large printing cylinder 22 with respect to which lower printing cylinder 20 was latched and rolled in printing contact, while also causing plate cylinder A-11 to be unlatched and out of printing contact with any work area of large printing cylinder 22 with respect to which lower printing cylinder 20 was unlatched and rolled out of printing contact.

It it is desired to keep plate cylinder A-11 out of contact with both work areas of large printing cylinder 22, this may be accomplished by first unthreading thumb screw A-206 from threaded hole A-207, and then moving it into alignment with hole A-211 and threading thumb screw A-206 into threaded hole A-211. Arm A-202 may then be manually moved to the right slightly to relieve the pressure from the latch A-212. The arm A-217 may then be lifted into contact with stop pin A-227 and arm A-202 allowed to move to the left until plate member A-165 contacts adjustable stop pin A-284. The machine may then be operated and plate cylinder A-11 will remain out of contact with both work areas of large printing cylinder 22.

As seen in FIG. 46 the plate cylinder module at module mounting position II, with plate cylinder A-11A would have an arm similar to arm A-202, and all its associated mechanism, similarly affixed to stub shaft A-45A. A latching mechanism similar to A-212 and arm A-217 would be journalled on stud member A-215A and a control member similar to A-245 would be journalled on stud member A-304. These additional members have not been shown in FIG. 46 to avoid complication of that drawing. The various control functions for plate cylinder A-11A would then be accomplished in exactly the same manner described with respect to the control of plate cylinder A-11, with the same cams on shaft 35 performing the identical function. In the same manner, similar members for controlling plate cylinder A-11B in the plate cylinder module in module mounting position III would be secured to the stub shaft A-45B and mounted on stud A-215B and stud A-311; and again the same cam members on shaft 35 would perform the identical functions in controlling the relationship of plate cylinder A-11B to the work areas of large printing cylinder 22.

It will thus be seen that the mechanism, as illustrated and described, provided means for independent pressure adjustment of each plate cylinder, in each plate cylinder module, with each work area of large printing cylinder 22. Means have also been provided to selectively cause each plate cylinder either to roll in printing contact with both work areas of the large printing cylinder 22, with neither work area, or with the first work area only, or with the second work area only. Means have also been provided whereby each plate cylinder will be tripped out of contact with any work area with which it would otherwise have rolled in contact whenever the lower printing cylinder 20 was tripped out of contact with that work area of the large printing cylinder 22.

INDEPENDENT PRESSURE ADJUSTMENT AND AUTOMATIC LATCHING OF PLATE CYLINDERS RELATIVE TO WORK AREAS OF THE LARGE PRINTING CYLINDER -3R PRESS

FIGS. 53 through 63 illustrate mechanism, generally designated KK4 thru KK8, employed to perform the same functions on the 3R model printing press as is performed by the mechanism illustrated in FIGS. 46 through 52, as just described in respect to the 2R printing press.

Parts that are identical on the 2R press and the 3R press have been given the same number in both cases. In the case of parts that perform similar functions, but are different dimensionally, these have been given similar numbers but in the 3,000 series. For instance, the cam that performs the same function on the 3R press as cam A-233 on the 2R press has been identified as A-3233 on the 3R press.

The basic operation of the mechanism on the 3R press is the same as the basic operation of the similar mechanism on the 2R press. However, since the large printing cylinder 3022 on the 3R press has an effective diameter three times the effective diameter of lower printing cylinder 20, and since the circumference of large printing cylinder 3022 is divided into three work areas and three gaps, it is necessary that each plate cylinder, such as plate cylinder A-11 shown at mounting position II, be equipped with mechanism which allows the pressure with which it rolls against each of the three work areas of large printing cylinder 3022 to be independently adjustable.

Therefore, in addition to plate member A-3165, latch contacting nose A-3184 and adjusting screw A-3171 which are similar to plate member A-165, latching contacting nose A-184 and adjusting screw A-171; plate member A-3186, latch contacting nose A-3201 and adjusting screw A-3194, which are similar to plate member A-186, latch contacting nose A-201 and adjusting screw A-194; there is provided a third combination of plate member A-3312, latch contacting nose A-3313, and adjusting screw A-3314, which together provide means by which a third independent pressure adjustment may be accomplished. The latch member A-3212 has three latching surfaces A-3231, A-3232 and A-3315. These three latch supporting surfaces are brought into alignment successively with the three latch contacting nose members A-3201, A-3184 and A-3313 by the action of cam A-3225 acting on follower A-221 on arm A-3217 of the latch mechanism. It will be seen that in the case of the 3R press, cam A-3225 has three support levels A-3316, A-3317 and A-3318, one for each of the three work areas of the large printing cylinder 3022, which control the latch member A-3212, so that the three latching surfaces thereof are brought into alignment successively with the three latch contacting nose members A-3201, A-3184 and A-3313.

Similarly, since there are three gaps instead of two, cam A-3233 has three lobes A-3321, A-3322 and A-3323, each of which act successively on follower A-204 carried by arm A-3202 to release the pressure on latch member A-3212.

Thus, as each gap in large printing cylinder 3022 comes into coincidence with the gap in plate cylinder A-11, arm A-3202 is moved to the right, slightly lifting whichever one of the latch contacting noses is in contact with latch member A-3212 and leaving latch member A-3212 free to be moved to the next successive position as determined by cam A-3225, or to be moved out from under the latch contacting noses completely if a signal is received through control member A-3245, initiated as previously described, and indicating that lower printing cylinder 20 was unlatched when its gap was in coincidence with the corresponding gap of large printing cylinder 3022 which is now in coincidence with the gap of plate cylinder A-11.

Cam A-3241 corresponds to cam A-241 on a 2R press. Cam A-3242 corresponds to cam A-242 on the 2R press, and on the 3R press there is a third cam A-3324 whose lobe corresponds to the third gap in large printing cylinder 3022. Nevertheless, the control member A-3245 in each case has three cam follower supporting arms A-3256, A-3292 and 3297, with arm A-3256 in all cases supporting follower A-251 which is in alignment with the adjustable lobes A-3117, A-3117A and A-3117B. Follower A-252 may be attached to either the back side of arm A-3292, in which case it is in alignment with cam A-3241, or it may be placed on the front side of arm A-3292, in which case it is in alignment with cam A-3324. Similarly, follower A-253 may be attached on the front side of arm A-3297, in which case it is in alignment with cam A-3242, or it may be attached to the back side of arm A-3297, in which case it is in alignment with cam A-3324.

The control mechanisms A-3245 for plate cylinders mounted at module mounting positions I or II have cam followers A-252 and A-253 positioned in alignment with cams A-3241 and A-3242 as seen in FIG. 54. Such plate cylinders mounted in positions I or II thus normally roll in printing contact at all times with the first work area of large printing cylinder 3022, unless they are set not to roll in contact with any of the work areas of large printing cylinder 3022, in the manner previously described. Each of these plate cylinders mounted in positions I and II may thus be independently adjusted by the positioning of thumb screw A-3291 controlling the follower A-253 in alignment with cam A-3242 to cause each of them to normally roll in printing contact also with the second work area but out of printing contact with the third work area. Similarly, by the adjustment of thumb screw A-3296 controlling the follower A-252 in alignment with cam A-3241, each of these plate cylinders may be adjusted to normally roll in printing contact with the third work area, but out of printing contact with the second work are. Also thumb screws A-3291 and A-3296 may be set to cause each such plate cylinder to normally roll in printing contact with both the second and third work areas.

The arrangement of the cam followers A-252 and A-253 on control member A-3245 is illustrated for a plate cylinder mounted in station III in FIG. 58. With a plate cylinder thus mounted in station III, the location of the followers A-252 and A-253 is such that the plate cylinder will normally always roll in contact with the second work area of large printing cylinder 3022 but may be adjusted to selectively roll in contact also with the first work area but not the third work area, or with the third work area but not the first work area, or to roll in contact with all three work areas, or with none.

The control mechanism A-3245 for a plate cylinder mounted in position IV, as illustrated in FIG. 57, has the followers A-252 and A-253 arranged so that such a plate cylinder will normally always roll in contact with the third work area of large printing cylinder 3022 but may be adjusted to roll in contact also with the first work area but not the second work area, or also with the second work area but not the first work area, or to roll in contact with all three work area, or with none.

As shown, in FIG. 56, disc member A-3152 is affixed to frame 3033 in a manner similar to that in which disc member A-153 is affixed to frame 33, and disc member A-3153 supports Cam A-3152 just as disc member A-153 supports cam A-152. In this case, however, cam A-3152 is an internal cam and follower A-3147 is carried at the end of an arm A-3325 which is integral with pawl A-3132 pivoting about shaft A-3133. Also, the spring A-3144 in this case is a tension spring, whereas spring A-144 is a torsion spring.

Figures 59, 60, 61, 62, 63:
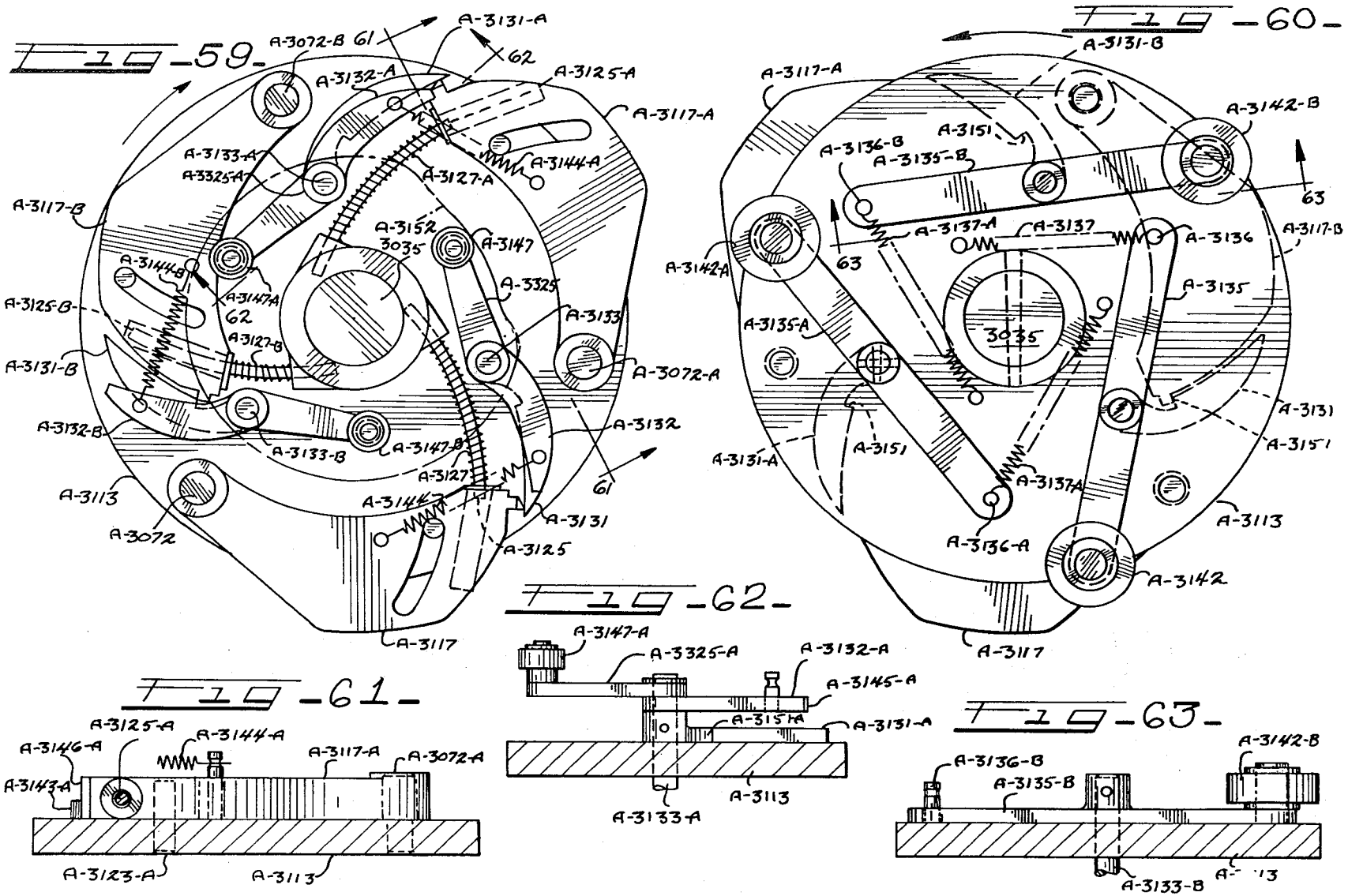

The mechanism carried by disc member A-3113 corresponds to similar disc member A-113 in the 2R press. In this case, however, as seen in FIGS. 59 thur 63, instead of there being two lobe members A-117 and A-117A as in the 2R press, there are three such lobe members A-3117, A-3117A and A-3117B on the 3R press. The rest of the supporting and controlling mechanism is similar to that shown and described for the similar device on the 2R press, and similar parts carry similar numbers, except where the numbers of the parts of the 3R press are identified in the 3000 series of numbers, as hereinbefore referred to.

Cam surface A-3083 on the 3R press corresponds to cam surface A-83 on the 2R press, and performs the same function. Similarly, cam follower A-3096 corresponds to cam follower A-96 on the 2R press, and it in turn performs the same function described for follower A-96 with respect to the 2R press.

As was described with respect to the 2R press, plate cylinder modules may be attached at positions I, III and/or IV in addition to, or alternately to the plate cylinder module shown mounted in position II. In this case, each such plate cylinder module will carry its own latching mechanism similar to that described for the plate cylinder A-11 at position II and including the two actuating arms A-3202 and A-3217.

For each such plate cylinder module, there will also be added a control member A-3245 which will be pivoted about stud A-3326 for a plate cylinder module mounted in position I, about stud A-3304 for a plate cylinder module mounted in position III, and about stud A-3311 for a plate cylinder module mounted in position IV, whereas control member A-3245 for the plate cylinder module mounted in position II is pivoted about stud A-3246.

All of the cam members located about shaft 3035, including stationary cam member A-3152 and all of the other cams which are fastened to and turn with shaft 3035, will then actuate the control mechanism for each plate cylinder, in each plate cylinder module, at each module mounting position, at the proper time and in the proper sequence, all as previously described with respect to the similar mechanism on the 2R press, and as described herein with respect to the plate cylinder A-11 in the plate cylinder module A-21 at module mounting position II.

It will thus be seen that the mechanism illustrated and described for the 3R press permits each plate cylinder to be independently adjusted so that the pressure with which it rolls against each of the three work areas of large printing cylinder 3022 is independently controlled. Also, each plate cylinder may be set not to roll in printing contact with any of the work areas of large printing cylinder 3022, or to roll in printing contact with only one of the work areas of large printing cylinder 3022, and selectively with that one and either of the other two work areas, or with all three of the work areas of large printing cylinder 3022.

Also, whenever lower printing cylinder 20 is unlatched with respect to particular work area of large printing cylinder 3022 each plate cylinder is also unlatched with respect to that work area as it successively passes each plate cylinder. Similarly, if lower printing cylinder 20 is latched to roll in printing contact with a work area of large printing cylinder 3022, then each successive plate cylinder is also latched to roll in printing contact with that work area, as it passes its mounting position, unless the other mechanisms described herein have been preset to cause that particular plate cylinder to remain unlatched with respect to that particular work area of large printing cylinder 3022.

In the particular configuration of the 3R press illustrated in FIGS. 53 thru 63, the eccentricity of stub shaft 44 with respect to the shaft 21 about which lower printing cylinder 20 revolves is opposite to that shown in the configuration of the 2R press, illustrated in FIGS. 46 thru 52 and therefore the linkage which positions cam surfaces A-3083 and follower A-3096 differs somewhat from the similar linkage shown for the 2R press, but accomplishes the positioning of cam surface A-3083 and cam follower A-3096 as described for the 2R press.

The 3R press may be constructed with the eccentricity of stub shaft 44 in relation to shaft 21, about which lower printing cylinder 20 revolves, identical to that shown for the 2R press, in which case the mechanism shown for positioning cam A-83 and follower A-96 would be used in the 3R press for positioning cam surface A-3083 and follower A-3096, with dimensional adjustment being made in proportion to the larger radius of large printing cylinder 3022 of the 3R press as opposed to the smaller radius of large printing cylinder 22 of the 2R press.

TYPICAL 2R PRESS CONFIGURATIONS

FIGS. 64–72 illustrate a number of typical configurations of the 2R model of the press. They show a preferred embodiment of the press and illustrate the main frame structure with three module mounting stations I, II and III and show the manner in which plate cylinder modules and/or ink modules and/or ink/dampening modules would be mounted in various combinations at these three module mounting positions.

Figure 64:
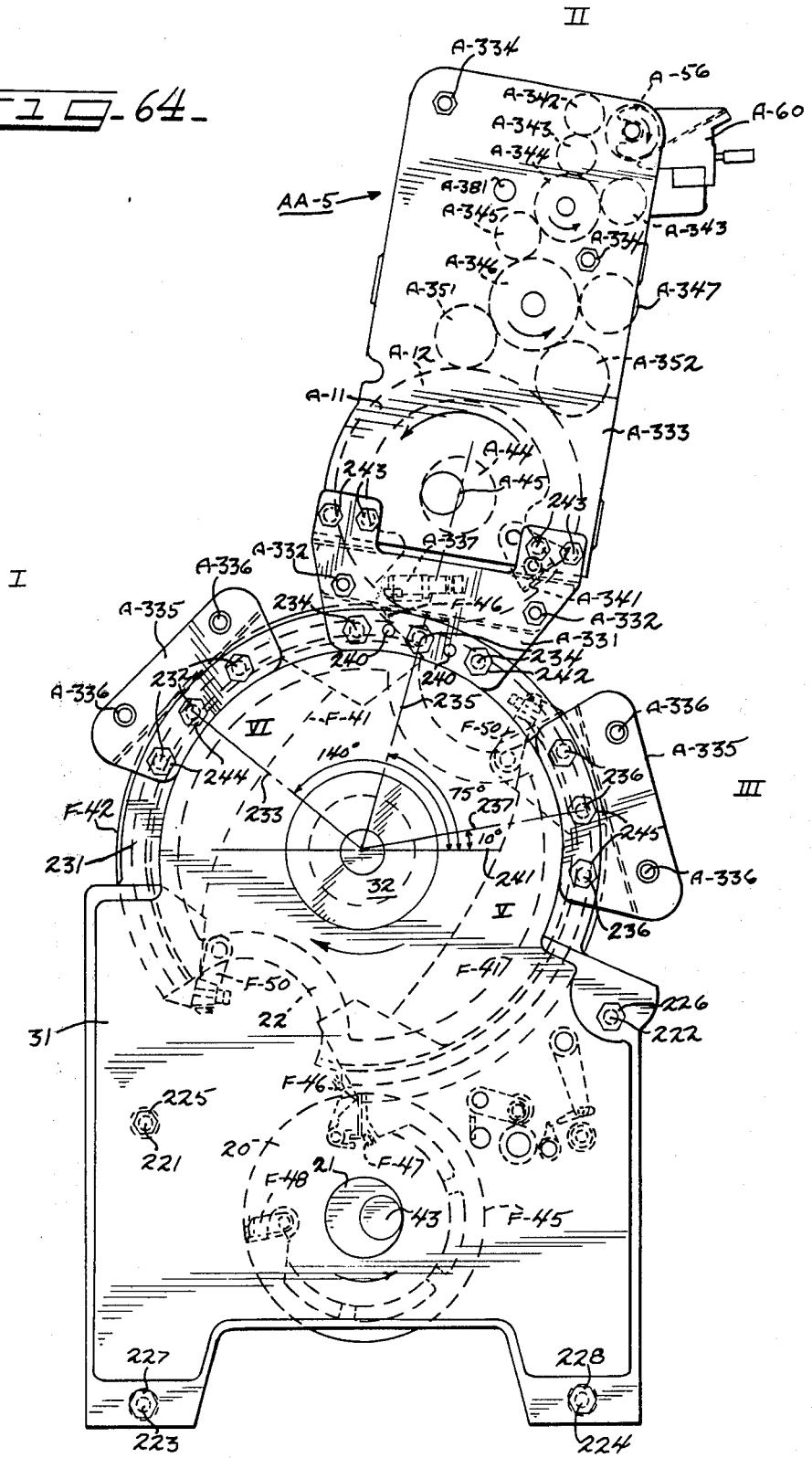

As seen first in FIG. 64, the main frames 31 and 33 are mounted on a box-like base structure (not shown in these figures) and spaced apart in fixed parallel relationship by means of four spreader bars 221, 222, 223 and 224, which are in turn secured at the outside of each main frame by bolts 225, 226, 227 and 228, respectively.

Large printing cylinder 22, which is constructed in a manner described in more detail elsewhere herein, provides two work areas or segment mounting positions, and the shaft 32 of large printing cylinder 22 rotates with the cylinder and is journalled in bearings mounted in the side frames 31, and 33, all as described in more detail elsewhere herein. Lower printing cylinder 20 is mounted for rotation about shaft 21 in the manner described in considerable detail elsewhere herein.

The upper portion of each of the frames 31 and 33 consists of a flanged portion 231 concentric with the center of large printing cylinder shaft 32. Grouped about the flanged upper portion 231 are three sets of three mounting holes. The spacing between the mounting holes in each set of three holes is identical to the spacing between the holes in each of the other two sets of three holes. All of the mounting holes are equidistant from the center of the shaft 32 of large printing cylinder 22. Each group of three mounting holes defines a module mounting station, and the center of the center hole of each group defines the location of that module mounting position.

As seen in FIG. 64, the location of each module mounting station is defined by a line passing through the center of large printing cylinder shaft 32 and the center of the central one of the three mounting holes. As seen in this figure, module mounting station I is defined by three mounting holes 232 located in flange 231. The line 233 connecting the center of shaft 32 with the center of the central one of these mounting holes 232 in station I is located 140 degrees counterclockwise from horizontal line 241 through the center of shaft 32. Module mounting station II is defined by three mounting holes 234 in flange 231, and line 235 between the center of the central one of these holes 234 and the center of shaft 32 is located 75 degrees counterclockwise from horizontal line 241 through the center shaft 32. Module mounting station III is defined by three mounting holes 236 in flange 231, and a line 237 connecting the center of the central one of these holes 236 with the center of shaft 32 is ten degrees counterclockwise from horizontal line 241 through the center of shaft 32. All of these mounting holes 232, 234 and 236 are equidistant from the center of shaft 32, and the spacing between the three holes 232 is identical to the spacing between the three holes 234 and the three holes 236. There are identical sets of three mounting holes in alignment with each other in each of the frames 31 and 33, for each of the module mounting stations.

A single plate cylinder module generally designated AA-5 is shown mounted at module mounting station II. Fastened to each frame 31 and 33 on either side of the press is a plate cylinder module mounting bracket A-331.

Each of these module mounting brackets A-331 has three holes which are in alignment with the three mounting holes 234 and is secured to the frames 31 and 33 by three bolts 242 which pass through the holes in the bracket A-331 and are threaded into the mounting holes 234 in the flange 231. The two module mounting brackets A-331 at either side of the press are held together in rigid spaced relationship to each other by means of two spreader bars A-332. The plate cylinder module frames A-333 are each held to their respective module mounting bracket by means of four bolts 243 which pass through the mounting brackets A-331 and into corresponding threaded holes in the plate cylinder module frames A-333. The plate cylinder module frames A-333 at either side of the press are further held in rigid spaced relationship to each other by means of two additional spreader bars A-334. The box-like structure of the plate cylinder module frames which consists of the two frames A-333 at opposite sides of the press, together with the two mounting brackets A-331 bolted thereto, all of which are held in rigid spaced relationship to each other by the four spreaders A-332 and A-334, thus lends rigidity to the two frames 31 and 33 at either side of the basic press structure when the two mounting brackets A-331 are bolted to the frames 31 and 33 by means of the bolts 242.

Since, in the configuration shown, there is a single plate cylinder module which is mounted at module mounting station II, additional rigidity is given to the basic frame structure, consisting of the two frames 31 and 33 at respectively opposite sides of the press, by adding a spreader mounting bracket A-335 at either side of the press held in rigid spaced relation by spreader bars A-336 and fastened to the frames 31 and 33 at module mounting station I by means of the bolts 244, and a similar spreader structure mounted at module mounting station III by means of bolts 245.

The plate cylinder module mounted at module mounting station II comprises the frames A-333 between which is supported a plate cylinder shaft A-44 about which is journalled a plate cylinder A-11 which carries on its surface a lithographic (or a dry offset) plate A-12 secured in leading edge clamps A-337 and trailing edge clamps A-341. The image on the surface of plate A-12 is inked by what is referred to as the basic inking unit, which comprises an ink fountain A-60, an ink fountain roller A-56, a ductor roll A-342, a distributor roll A-343, an oscillating distributor roll A-344, a distributor roll A-345, and oscillating distributor roll A-346, a distributor roll A-347 and two form rollers A-351 and A-352.

The large printing cylinder 22 carries a blanket segment F-41 in one of its two work areas in position V with an offset blanket F-42 attached to the surface thereof by means of a leading edge clamp F-46 and a trailing edge clamp F-50. The other work area of large printing cylinder 22 also carries another blanket segment F-41 in position VI with another offset blanket F-42 secured thereto by means of leading edge clamps F-46 and trailing edge clamps F-50.

Lower printing cylinder 20 has an offset blanket F-45 secured to the surface thereof by means of leading edge clamps F-47 and trailing edge clamps F-48. This offset blanket F-45 may act either as a combined transfer surface and pressure-applying platen for printing an image on the bottom of a sheet as it passes through the bite between large printing cylinder 22 and lower printing cylinder 20, or it may act solely as a pressure-applying platen surface to apply pressure, as a sheet passes through the bite between large printing cylinder 22 and lower printing cylinder 20, and as an image is transferred to the top surface of the sheet from blanket F-42 on one segment or from the other blanket F-42 on the other segment.

It will be noted that the top surface of the ink fountain A-60 of this plate cylinder module, mounted at module mounting station II, is horizontal. It should be also noted that the center of shaft A-44 and of plate cylinder A-11 of this plate cylinder module, mounted at module mounting station II, lies on line 235 which passes through the center of shaft 32 of large printing cylinder 22 and is 75 degrees counterclockwise from the horizontal line 241 which also passes through the center of shaft 32 of large printing cylinder 22.

Figure 65:
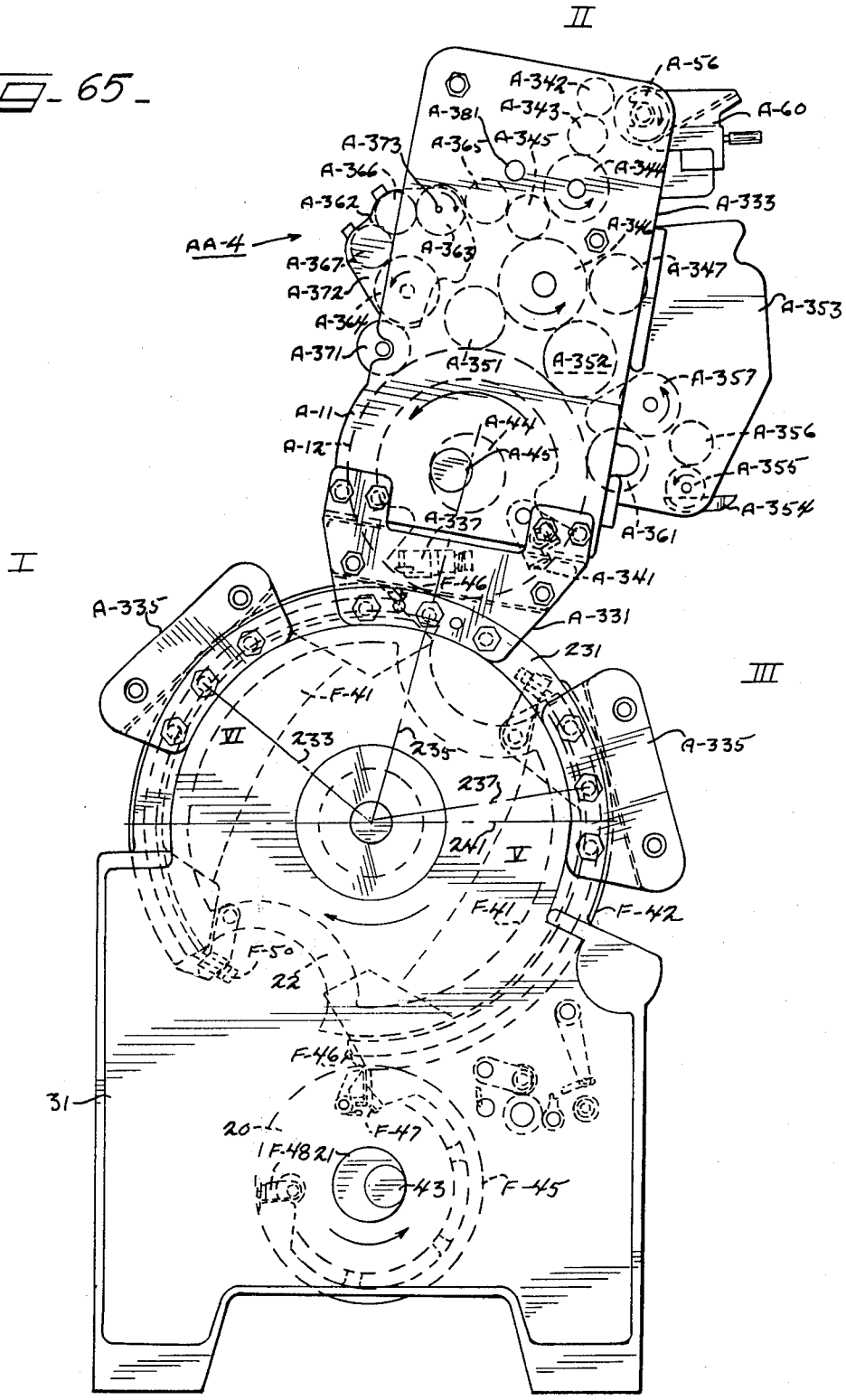

FIG. 65 illustrates a somewhat similar configuration of the 2R model press with a single plate cylinder module generally designated AA-4 mounted at module mounting station II. In this module, a dampening attachment, generally designated A-353, has been added which comprises a dampening fountain tray A-354, the top and bottom surfaces of which are horizontal, a dampening fountain roller A-355, a dampening ductor roller A-356, a dampening distributor roll A-357 and a dampening form roller A-361. Dampening fluid from the fountain tray A-354 is distributed by means of these rollers and applied to the surface of lithographic plate A-12 mounted on plate cylinder A-11 by dampening form roll A-361 prior to the time when the plate is contacted by the ink form rollers.

In addition to the basic inking unit as previously described, an auxiliary ink attachment, generally designated A-362, has also been added. Auxiliary ink attachment A-362 comprises two oscillating distributor rollers A-363 and A-364, three non-oscillating distributors A-365, A-366 and A-367 and an ink form roll A-371. It will be seen that distributor roll A-365 contacts distributor A-345 of the basic ink unit and oscillating distributor roll A-363 of the auxiliary ink attachment, thereby feeding ink from the basic inking unit through the auxiliary inking attachment to the third ink form roll A-371 and thus onto the surface of the plate A-12.

The basic inking unit, previously described in more detail, is equivalent to the inking unit generally furnished with conventional sheet-fed small offset presses. It provides adequate inking capacity for the requirements of many users of such equipment. However, many users of such equipment find that their requirements change, or are such initially as to require greater inking capacity than can be furnished by the basic inking unit system. The design of these conventional systems is generally such that the only addition which can be made to them to increase their capacity consists of an additional rider roller, or a group of rider rollers, which may be added to the basic unit. While such additional rider rollers provide additional nips between rollers for milling the ink, the ink is still fed to the plate by the same two form rollers with the result that the addition of such auxiliary rider rollers produces only a slight effect in terms of the quantity and quality of the application of the ink to the plate. In the press of this invention, the basic inking unit and the module frames A-333 are so constructed that only the basic inking unit need be furnished when such a system is adequate to the customer's requirements. However, the construction is such that if the customer's requirements, either initially, or at a later date, require significantly increased inking capacity, the auxiliary ink attachment, generally designated A-362, may also be furnished, and the construction is such that the addition of the auxiliary ink attachment A-362 provides a marked increase in the quantity and quality of the ink which may be applied to the surface of the plate.

This improvement is accomplished since addition of the auxiliary ink attachment provides not only six additional ink rollers, including two oscillating distributors A-363 and A-364, but an additional, or third, form roller A-371. It is important to note that form roll A-371 is the last of the three ink form rollers to contact the plate A-12 and that the path which the ink must follow from the ink fountain A-60 to the third ink form roller A-371 requires that the ink pass through a greater number of nips between adjacent ink rollers in reaching this third form roller A-371 than must be passed through by the ink in reaching either of the first two form rollers A-352 or A-351.

The arrangement and size of all of the rollers in this system is such that no two adjacent rollers are of the same diameter and, as explained and illustrated in more detail elsewhere herein, all of the gears in the gear train that drives the driven rollers are of such size that no two gears which mesh with each other have teeth such that the number of teeth in one gear of the pair is evenly divisible into the number of teeth in the other gear of the pair. The combination of this arrangement with respect to the gears and the arrangement described with respect to the relative diameters of adjacent ink rollers creates an unusually smooth and even distribution of the ink and aids in preventing the creation or transmission of either roller streaks or gear streaks.

All of the hard rollers in the system are gear driven, and all of the soft rollers are driven frictionally. All of the hard rollers are in fixed positions and journalled in the frames, and all of the soft rollers are easily removable. The hard rollers in the ink system are the ink fountain roller A-56 and the four oscillating distributors A-344, A-363 and A-364. The soft rollers are the three form rollers A-352, A-351 and A-371, and the soft distributors A-367, A-366, A-365, A-345, A-347 and A-343 and ductor A-342. The detail of the mountings for all of these rollers is illustrated and described elsewhere herein. Rollers A-363, A-366, A-367 and A-364 of the auxiliary ink attachment A-362 are mounted in a separate frame A-372 which pivots about the center A-373 of oscillating distributor roll A-363. Form roller A-371 is supported in brackets which pivot about the center of oscillating distributor roller A-364, and this construction is illustrated and described in detail elsewhere herein. It is thus possible to swing the auxiliary ink attachment A-362 about the center A-373 of roller A-363, thereby providing easy access to form roller A-351.

In the dampening attachment A-353, the distributor roll A-357 and the fountain roll A-355 are driven rollers journalled in the frames and are hard surfaced rollers having a surface of aluminum or similar material, whereas the ductor roller A-356 and the form roller A-361 are soft rollers which may be covered with molleton or paper sleeve covers, or similar material, and are removable from the press as shown elsewhere herein. Both the ink fountain A-60 and the dampening fountain A-354 are removable from the press as shown elsewhere herein.

Figure 66:
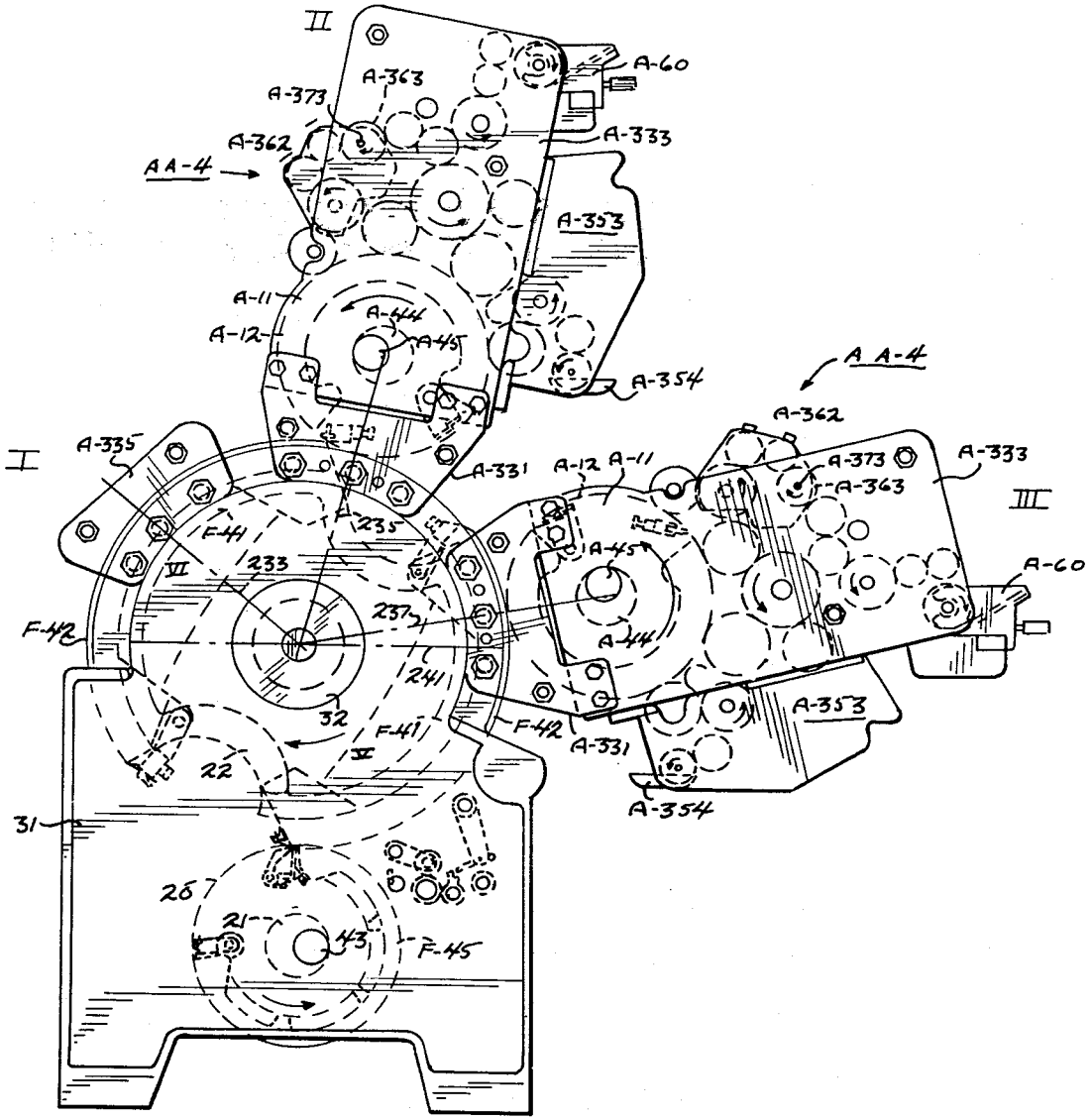

FIG. 66 illustrates another configuration of the 2R press in which there are two plate cylinder modules each generally designated AA-4, one mounted at module mounting station II and the other mounted at module mounting station III. There is a spreader bracket A-335 mounted at module mounting station I.

The large printing cylinder 22 carries two blanket segments F-41 in its two work areas V & VI, with one segment carrying an offset blanket F-42, and the other segment carrying a similar offset blanket F-42. Plate cylinder A-11 at module mounting station II carries a lithographic plate A-12, and plate cylinder A-11 at module mounting station III also carries a lithographic plate A-12. Both plate cylinder modules are shown equipped with dampening attachments A-353 and with auxiliary ink attachments A-362 in addition to the basic inking units. It will be noted that both of the ink fountains A-60 in the respective plate cylinder modules are mounted with their top surface in a horizontal plane. Similarly, both of the dampening fountain trays A-354 are respectively mounted with their top and bottom surfaces in horizontal planes.

It will be noted that the center of shaft A-44 and of plate cylinder A-11 of the plate cylinder module at module mounting station III lies on line 237 which passes through the center of shaft 32 of large printing cylinder 22 and is located ten degrees counterclockwise from horizontal line 241 which also passes through the center of shaft 32 of large printing cylinder 22. Similarly, as previously described, the center of shaft A-44 and of plate cylinder A-11 in the plate cylinder module mounted at module mounting station II lies on line 235 which passes through the center of shaft 32 of large printing cylinder 22 and is located 75 degrees counterclockwise from horizontal line 241 which also passes through the center of shaft 32 of large printing cylinder 22.

Figure 67:
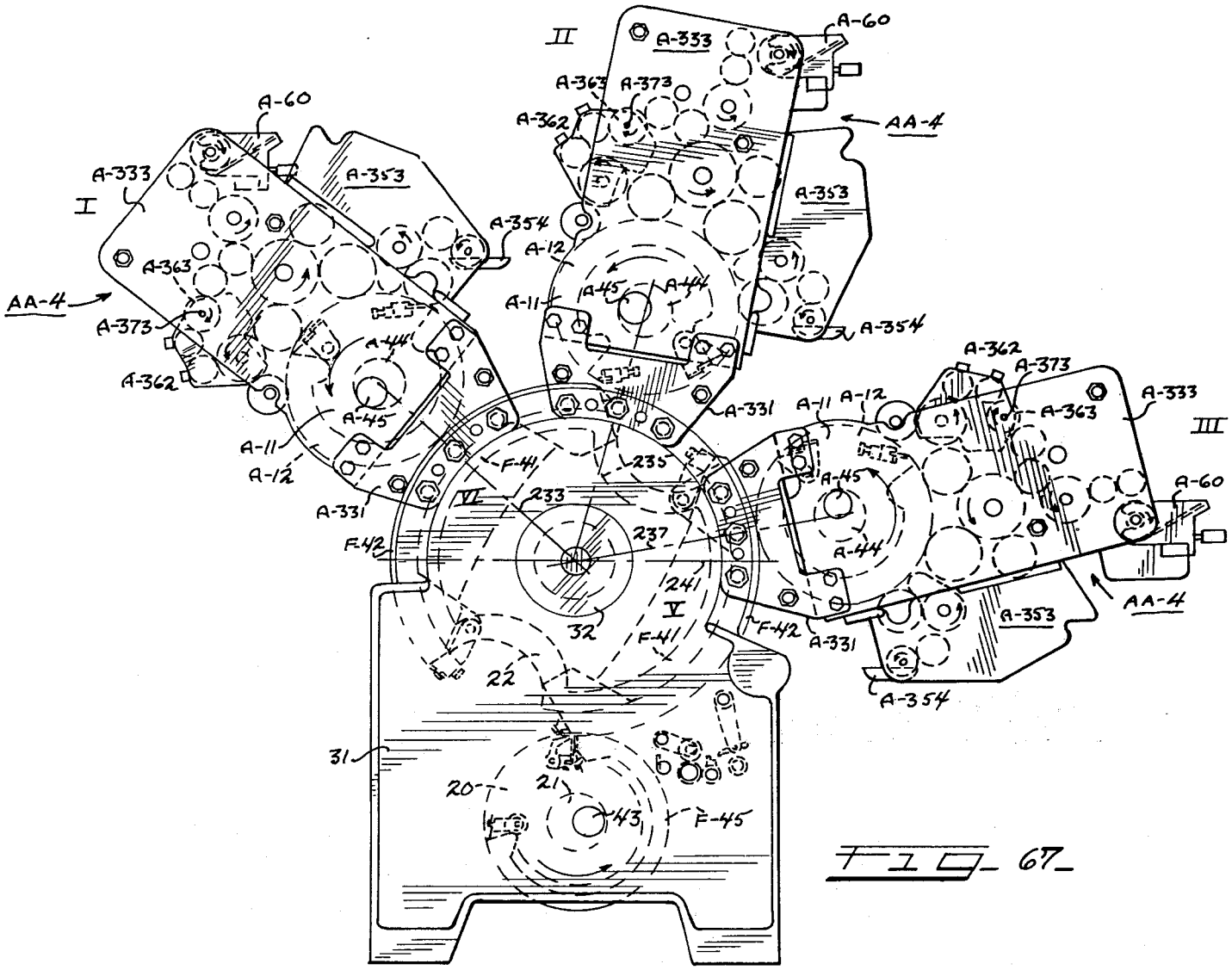

FIG. 67 illustrates another configuration of the 2R press in which there are three plate cylinder modules each generally designated AA-4 mounted at the three module mounting station I, II and III. Each of these plate cylinder modules is equipped with a dampening attachment and an auxiliary ink attachment in the manner previously described.

The plate cylinder modules mounted at module mounting stations II and III are located as previously described. Similarly, the center of shaft A-44 and of plate cylinder A-11 of the plate cylinder module mounted at module mounting station I lies on line 233 which passes thru the center of large printing cylinder shaft 32 and which is 140 degrees counterclockwise from horizontal line 241.

Each of the dampening fountain trays A-354 for these three plate cylinder modules is mounted with its top and bottom surfaces in horizontal planes, and, similarly, each of the ink fountains A-60 on these modules is mounted with its top surface in a horizontal plane.

There are two blanket segments F-41 mounted in the two work areas V and VI of large printing cylinder 22 in this configuration, each carrying offset blankets F-42. The rest of the structure is as previously described.

It should be noted that the location of the lower printing cylinder 20 and the plate cylinder A-11 in the plate cylinder module mounted at module mounting station I is such as to leave sufficient room between these two cylinders, around the circumference of large printing cylinder 22, for the removal or attachment of a segment F-41 on either of the work areas V and VI of large printing cylinder 2.

Figure 68:
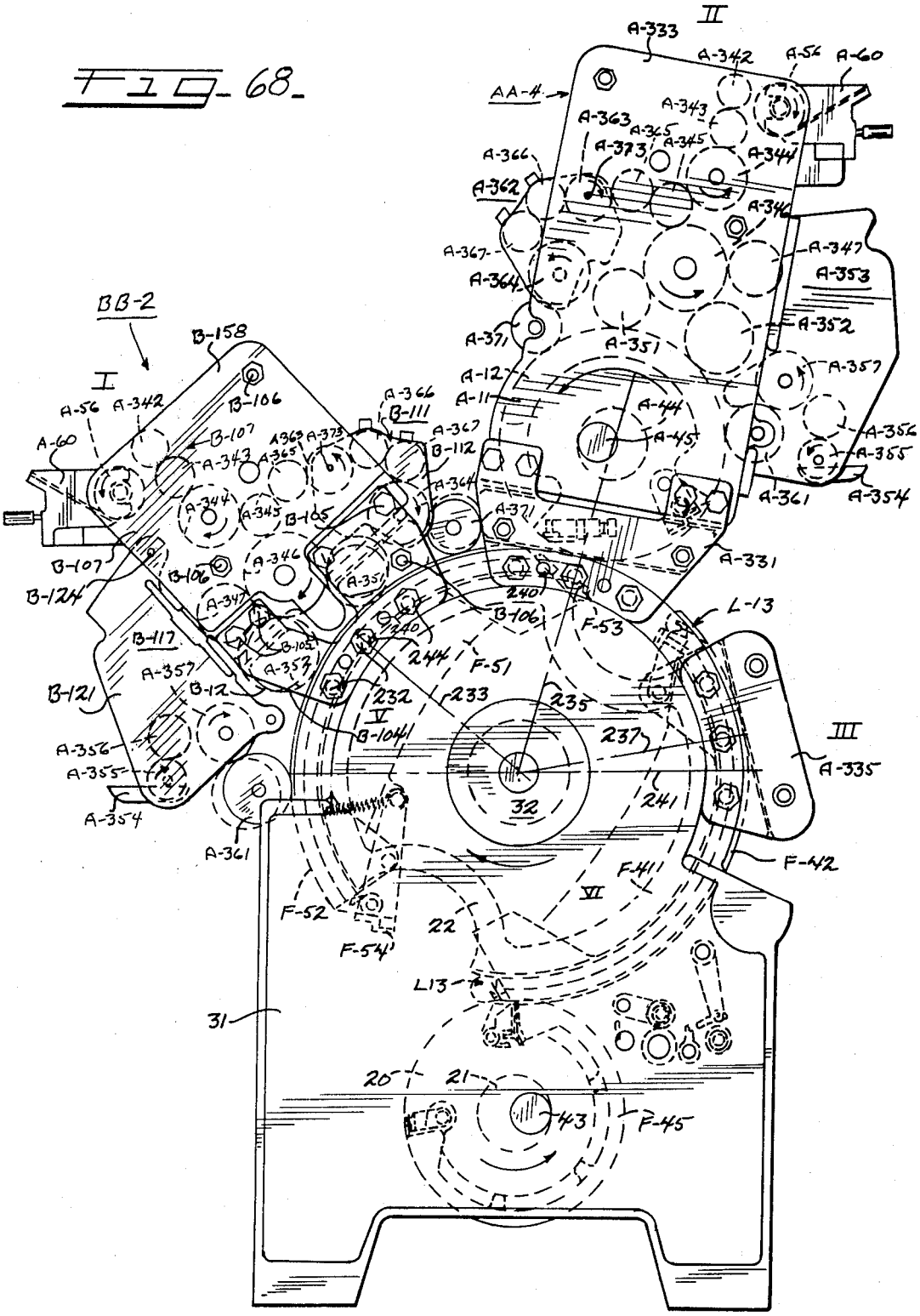

FIG. 68 illustrates another configuration of the 2R model press in which there is a plate cylinder module generally designated AA-4 mounted at module mounting station II, an ink/dampening module generally designated BB-2 mounted at module mounting station I, and a spreader bracket A-335 mounted at module mounting station III. Lower printing cylinder 20 carries an offset blanket F-45, as previously described. Large printing cylinder 22 carries a blanket segment F-41 with an offset blanket F-42 on its surface in work area VI and a plate segment F-51 with a lithographic plate F-52 carried on its surface in work area V. Plate F-52 is held at its leading edge in clamps F-53 and at its trailing edge in clamps F-54. The plate cylinder module mounted at module mounting station II is equipped with a dampening attachment A-353 and an auxiliary ink attachment A-362, all as previously described. The center of shaft A-44 and of plate cylinder A-11 of the plate cylinder module at module mounting station II is located as previously described.

Plate cylinder A-11, which carries a lithographic plate A-12 on its surface, is mounted and controlled in a manner described in detail elsewhere herein, so that it rolls in contact with the blanket F-42 on blanket segment F-41 in work area VI of large printing cylinder 22, but is separated from and does not contact the surface of plate F-52 mounted on plate segment F-51 in work area V of large printing cylinder 22.

The ink/damp module BB-2 mounted at module mounting station I comprises a pair of frame members B-158 at either side of the press, each of which is bolted to a mounting bracket B-104 by means of four bolts B-105, and the two completed frame structures thus formed are held in rigid parallel spaced relationship to each other by three spreader bars B-106. There are three holes in each of the mounting brackets B-104, located identically to the similar holes in the mounting brackets A-331, for fastening the mounting brackets to the flanged portion 231 of the frames 31 and 33. These holes, therefore, align perfectly with the three threaded holes 232 in the flange 231 at module mounting station I, and the mounting brackets B-104 are thereby secured to the frames 31 and 33 by the three bolts 244 that pass through the holes in the mounting brackets B-104 and into the threaded holes 232 in the flange portion 231 of the frames 31 and 33.

The frames B-158 of the inking module portion of the ink/damp module are so constructed as to support the ink rollers of the basic ink unit, generally designated B-107, and the auxiliary ink attachment, generally designated B-111. The rollers which make up the basic ink unit B-107 and the auxiliary ink attachment B-111 of this inking module are identical to the corresponding rollers that make up the basic inking unit and the auxiliary ink attachment A-362 of the plate cylinder module, but the inking units of the plate cylinder module are applying ink to the surface of a plate mounted on plate cylinder A-11, turning in a counterclockwise direction, whereas the rollers of the inking units B-107 and B-111 of the ink module are applying ink to the surface of a plate mounted on large printing cylinder 22, turning in a clockwise direction. The frames B-158 of the inking module are so constructed that the arrangement of the rollers therein is an exact mirror image of the arrangement of the like rollers in the frames A-333 of the plate cylinder module.

Similarly, the position of the auxiliary ink attachment B-111, the construction of its frames B-112 and the arrangement of the rollers, therein, and the positioning of this attachment with respect to the basic ink unit B-107 is an exact mirror image of the similar arrangement of the auxiliary ink attachment A-362 in respect to the basic ink unit of the plate cylinder module.

As is illustrated and explained in more detail elsewhere herein, the two form rollers A-351 and A-352 in the plate cylinder module are mounted to pivot about the center of oscillating distributor roll A-346, and each of the form rollers A-351 and A-352 swings independently about the center of oscillating distributor roll A-346 into contact with the plate A-12. Similarly, from rollers A-351 and A-352 in the ink/damp module mounted at module mounting station I are mounted to pivot, each independently, about the center of oscillating distributor roll A-346, and thus contact the surface of the plate F-52 carried on plate segment F-51 on large printing cylinder 22. Thus, notwithstanding the fact that the diameter of large printing cylinder 22 is twice the diameter of plate cylinder A-11, the form rollers A-351 and A-352 in the plate cylinder module, and A-351 and A-352 in the ink/damp module, each pivot about the respective oscillating distributor rolls A-346 into contact with the respective plates A-12 and F-52. In like fashion, form roller A-371 pivots about the center of oscillating distributor roll A-364 into contact with the surface of plate A-12, and form roller A-371 pivots about the center of oscillating distributor roll A-364 into contact with the surface of plate F-52. Thus, the frame structure B-158, the basic inking unit B-107 and the auxiliary ink attachment B-111 of the ink module is an exact mirror image of the like portion of the frame structure A-333, the basic ink unit and auxiliary ink attachment A-362 of the plate cylinder module.

It thus follows that the rotation of the oscillating ink distributor rollers A-344 and A-346 in the plate cylinder module is counterclockwise, as is the rotation of plate cylinder A-11, whereas the rotation of the oscillating ink distributor rollers A-344 and A-346 in the ink module is clockwise, as is the rotation of large printing cylinder 22.

The difference in diameters between large printing cylinder 22 and plate cylinder A-11 makes it impractical to make the dampening unit B-117 as an exact mirror image of the damping unit A-353. Nevertheless, the dampening rollers employed in the dampening rollers employed in the dampening unit B-117 of the ink/damp module are identical to the corresponding dampening rollers of the dampening attachment A-353 for the plate cylinder module.

The frames B-121 of the dampening attachment B-117 for the ink/dampening module are so constructed that the dampening form roller A-361 pivots about the center of dampening distributor roll A-357 and contacts the surface of plate F-52 carried on plate segments F-51 of large printing cylinder 22. In addition, the frames B-121 pivot about point B-124 on the frames B-158 of the ink module to allow the entire dampening attachment B-117 to be swung out of the way, illustrated in more detail hereinafter, in a manner that will be to provide room for removing and attaching segments in the work areas V and VI of large printing cylinder 22.

It should be noted that the top and bottom surfaces of both the dampening trays A-354 are in horizontal planes, as are the top surfaces of both the ink fountains in both the ink module and, the plate cylinder module. Also the rotation of both the respective ink fountain rollers A-56 is correct for the construction and mounting position of the respective fountains A-60.

It should further be noted that the center of oscillating ink distributor roller A-346 of the inking module mounted at module mounting station I lies on line 233 which passes through the center of shaft 32 of large printing cylinder 22 and is located 140 degrees counterclockwise from horizontal line 241 which also passes through the center of shaft 32 of large printing cylinder 22.

The dampening form roll A-361 and the three ink form rollers A-352, A-351 and A-371 of the ink/dampening module BB-2, roll in contact with the plage F-52 on plate segment F-51 in work area V of large printing cylinder 22, but are lifted out of contact with the surface of offset blanket F-42 mounted on blanket segment F-41 in work area VI of large printing cylinder 22. The manner in which this is accomplished is illustrated and described in greater detail elsewhere herein, but as seen in FIG. 68 there are lifter cams L-13 mounted at either side of blanket segment F-41 which carries offset blanket F-42. There are corresponding cam follower rollers (not shown in FIG. 68) at either end of each of these form rollers, and these cam follower rollers are in alignment with the lifter cams L-13 so that, as large printing cylinder 22 revolves and brings blanket segment F-41 into position under the respective form rollers of the ink/damp module at module mounting station I, first damping form roll A-361 is lifted out of contact with offset blanket F-42, pivoting about the center of dampening distributor roll A-357 into the dotted line position. Then successively, form rolls A-352 and A-351 are lifted into the dotted line positions, and finally form roll A-371 is lifted into the dotted line position shown.

Figure 69:
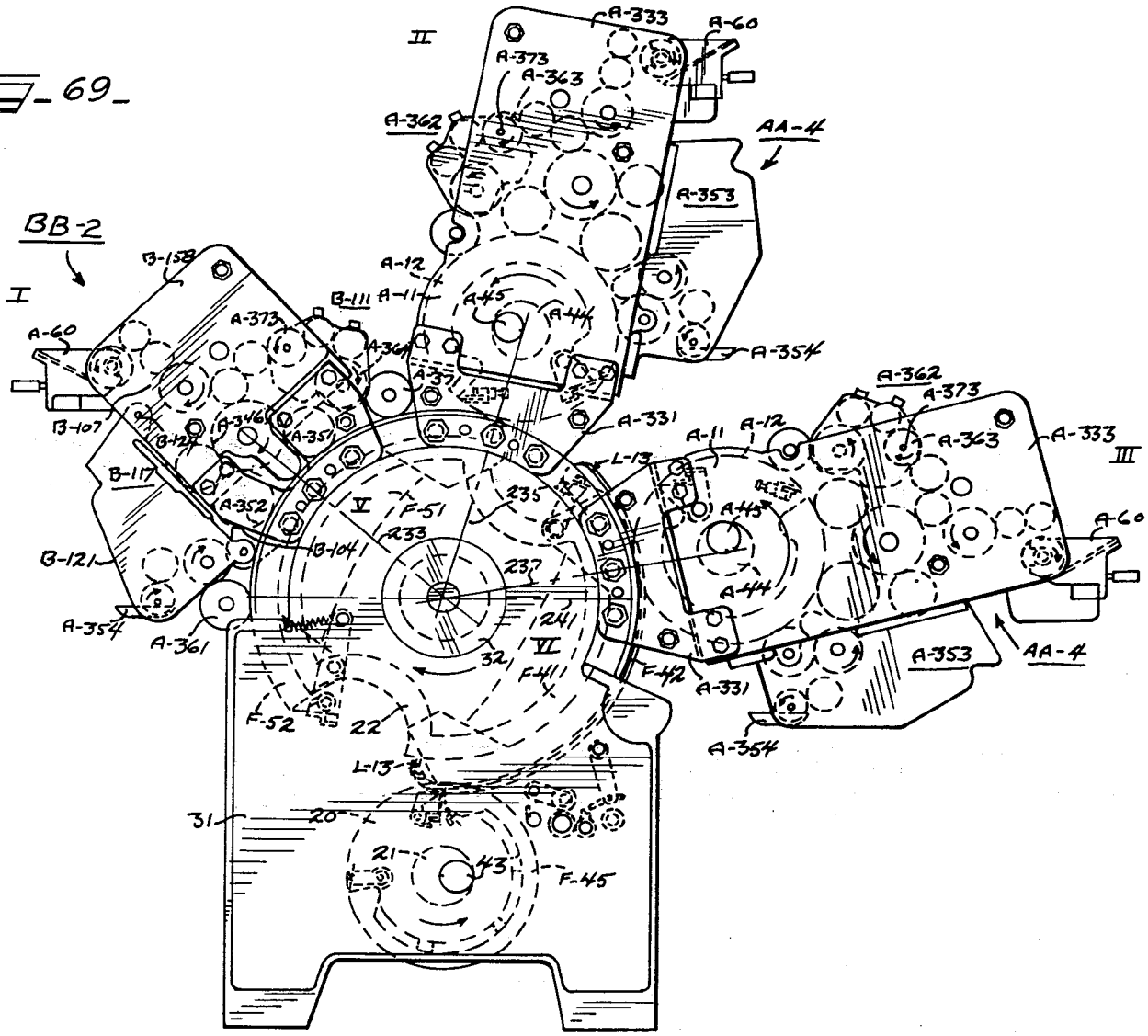

FIG. 69 illustrates a configuration of the 2R press in which there is an ink/dampening module generally designated BB-2 at module mounting station I, a plate cylinder module AA-4 at module mounting station II, and a second plate cylinder module AA-4 at module mounting station III. The ink/damp module at module mounting station I includes the basic inking unit B-107, the auxiliary ink attachment B-111 and the dampening attachment B-117. Each of the plate cylinder modules at module mounting stations II and III include, in addition to the basic inking units, the auxiliary ink attachment A-362 and the dampening attachment A-353. It will be noted that the top surfaces of each of the ink fountains A-60 are all in horizontal plans and that the top and bottom surfaces of each of the dampening trays A-354 are also in horizontal planes.

There is a blanket segment F-41, carrying an offset blanket F-42, mounted in work area VI of large printing cylinder 22, and both plate A-12 on the plate cylinder A-11 at module mounting station II and plate A-12 on the other plate cylinder A-11, at module mounting station III may roll in contact with offset blanket F-42. Blanket segment F-41 carries lifter cams L-13, as previously described, so that the dampening form roll A-361 and the ink form rolls A-352, A-351 and A-371 of the ink/dampening module at module mounting station I are lifted out of contact with the surface of offset blanket F-42. In work area V of large printing cylinder 22, there is a plate segment F-51 carrying a lithographic plate F-52 which is contacted by the dampening form roll A-361 and the ink form rolls A-352, A-351 and A-371 of the ink/damp module at module mounting station I.

By means illustrated and described elsewhere herein, the two plates A-12 carried on plate cylinders A-11 of the respective plate cylinder modules are held out of contact with the surface of plate F-52 on plate segment F-51, but either or both of them may roll in contact with offset blanket F-42 on blanket segment F-41. By feeding a sheet of paper to every other revolution of lower printing cylinder 20, blanket F-45 on lower printing cylinder 20 may be allowed to roll in contact with the surface of lithographic plate F-52 on segment F-51, whereby the image on plate F-52 will be transferred onto offset blanket F-45. Meanwhile, the two images from the plates A-12 are each successively transferred onto the surface of blanket F-42. A sheet fed to the revolution of lower printing cylinder 20 when lower printing cylinder 20 is in coincidence with blanket segment F-41 will therefore be simultaneously printed on both sides of the sheet, with the image from plate F-52, which was previously transferred to blanket F-45 on lower printing cylinder 20, being printed on the bottom of the sheet and the combined image from plates A-12 being printed from blanket F-42 onto the top surface of the sheet.

As has previously been described elsewhere herein, a wide variety of other combinations of printing functions may also be performed by this configuration of the 2R model press. It will be noted that each of the printing modules is positioned, as previously described, in one of the three fixed module mounting stations.

Figure 70:
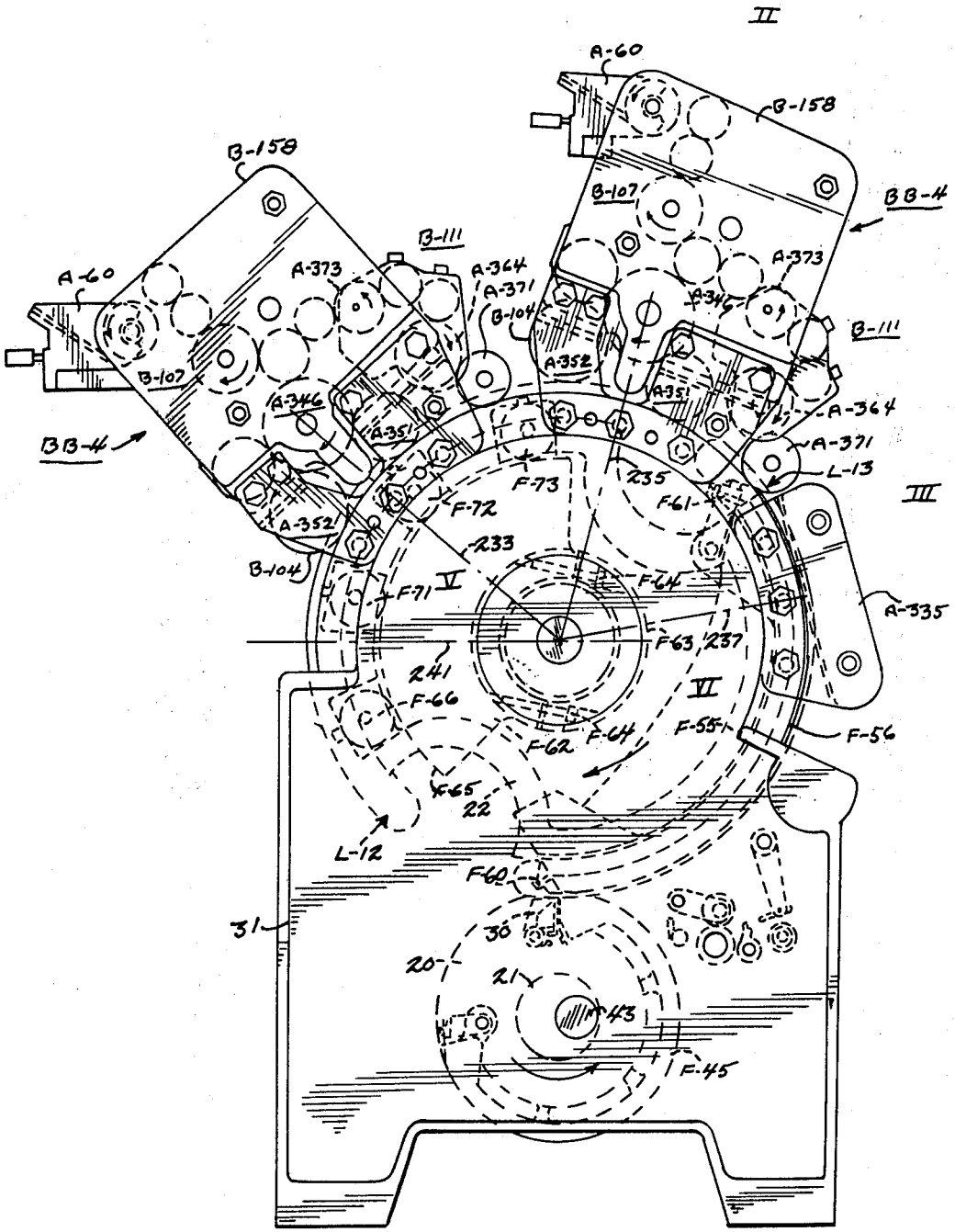

FIG. 70 illustrates another configuration of the 2R model press in which an inking module only generally designated BB-4 is mounted at module mounting station I, a second inking module only BB-4 is mounted at module mounting station II, and a spreader bracket A-335 is mounted at module mounting station III. Each of the inking modules at module mounting stations I and II is shown equipped with an auxiliary ink attachment B-111. It will be noted that the top surface of each of the ink fountains A-60 lies in a horizontal plane.

As described and illustrated in more detail elsewhere herein, there are cam follower discs at either end of the three ink form rollers A-352, A-351 and A-371 of the inking module at module mounting station I. These cam follower discs are located in vertical planes which are in alignment with two lifter cams L-13 affixed to either side of a rubber plate segment F-55 located in work area VI of large printing cylinder 22. Rubber plate segment F-55 carries on its surface a rubber plate F-56 vulcanized to a brass draw sheet which is held in leading edge clamps F-60 and trailing edge clamps F-61; or which may be of the sticky back variety which is held to the surface of segment F-55 by an adhesive.

In the other work area V of large printing cylinder 22, there is a sector F-62 for the mounting of numbering machines. The inner surface of sector F-62 is a half circle machined to fit over shaft 32 of large printing cylinder 22, and is then clamped in position by means of another half ring F-63 and bolts F-64 which, when tightened, clamp the sector F-62 to shaft 32. The sector F-62 may be clamped to shaft 32 at any position across the width of the machine. The outer surface F-65 of sector F-62 is concentric with the shaft 32 and formed to receive one or more numbering machines, such as shown at F-66, F-71, F-72 and F-73. Each of these numbering machines may be located at any point circumferentially around the surface F-65 of sector F-62. These numbering machines may be either of the non-indexing type, which may be set by hand to print a given number and will continue to print that number until reset, or may be of the indexing type, in which case they will be tripped in the conventional manner, by cams provided for that purpose, on each revolution of large printing cylinder 22.

In work area V of large printing cylinder 22, occupied by the numbering machine mounting sector F-62, there is another pair of lifter cams L-12, with one such lifter cam being located at either side of the cylinder. Lifter cams L-12 are in different vertical planes from lifter cams L-13 previously described. The form rollers A-352, A-351 and A-371 of the ink module mounted at module mounting station II carry cam follower discs, at either end of each form roller, which are located to lie in the same vertical planes with lifter cams L-12 so that these form rolls will be lifted out of contact with the surface of the numbers on the numbering machines F-66, F-71, F-72 and F-73. It will thus be seen that the form rollers of the ink module at module mounting station II will ink the surface of the rubber plate F-56 mounted on rubber plate segment F-55 in work area VI, but will not contact the numbering machines mounted in work area V of large printing cylinder 22, whereas the form rollers of the ink module mounted at module mounting station I will ink the numbers of the numbering machines F-66, F-71, F-72 and F-73 in work area V of large printing cylinder 22, but will be lifted out of contact with the surface of rubber plate F-56 on rubber plate segment F-55 in work area VI.

Thus, if one color ink is placed in the fountain A-60 of the ink module at module mounting station I, and another color ink is placed in the ink fountain A-60 of the module mounted at module mounting station II, the surface of the rubber plate F-56 in work area VI will be inked with one color ink and the numbers of the numbering machines in work area V of large printing cylinder 22 will be inked with another color ink.

If a sheet is then fed to every other revolution of lower printing cylinder 20 and seized by cylinder grippers 30 and retained in the cylinder grippers for two revolutions of lower printing cylinder 20, the sheet will first be printed with the image from the rubber plate in the first color ink and will then be numbered by the numbering machines, in the second color ink, and then delivered, all in the manner illustrated and described in more detail elsewhere herein.

Figure 71:
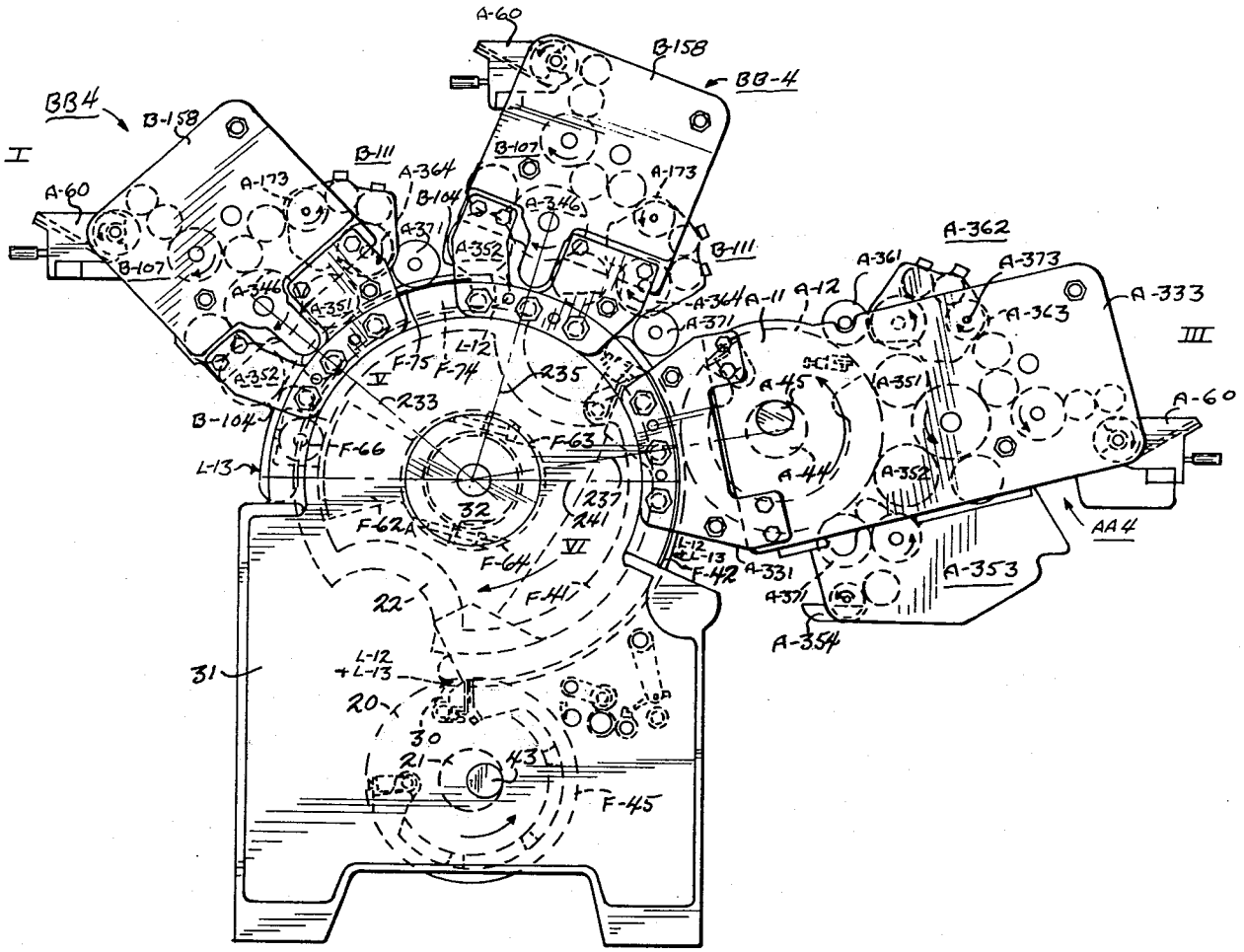

FIG. 71 illustrates another configuration of the 2R model press in which there is an ink module only BB-4, mounted at module mounting station I, an ink module only BB-4, mounted at module mounting station II, and a plate cylinder module AA-4 mounted at module mounting station III. Each of the ink modules BB-4 at module mounting stations I and II is equipped with an auxiliary ink attachment B-111. The plate cylinder module AA-4 mounted at module mounting station III is shown equipped with an auxiliary ink attachment A-362 and a dampening attachment A-353. It should be noted that the top surface of each of the three ink fountains A-60 in the two ink modules and in the plate cylinder module all lie in horizontal planes. Also, the top and bottom surfaces of the dampening tray A-354 in the plate cylinder module at module mounting station III lie in horizontal planes.

There are two imaging means mounted in work area V of large printing cylinder 22. A portion of that work area is occupied by a small rubber plate segment F-74 which carries a sticky backed rubber plate F-75 on its surface. The surface of this rubber plate is contacted by the form rollers A-352, A-351 and A-371 of the inking module mounted at module mounting station I, and there are lifter cams L-12 at either side of rubber plate segment F-74, and extending only throughout its length, which lie in the same vertical planes with cam follower rollers mounted at either end of the form rollers A-352, A-351 and A-371 of the ink module mounted at module mounting station II. Thus, the surface of rubber plate F-75 is inked by the ink form rollers of the inking module mounted at module mounting station I, but is not contacted by the ink form rollers of the ink module mounted at module mounting station II.

There is a numbering machine F-66, mounted in the other portion of work area V of large printing cylinder 22, which is mounted on a small mounting sector F-62A, which in turn is secured to shaft 32 in the manner previously described. At either side of large printing cylinder 22, this other portion of work area V, there are two other lifter cams L-13, extending only throughout the length of this other portion which lie in different vertical planes from the previously described lifter cams L-12 carried by rubber plate segment F-74. There are cam follower discs at either end of each of the ink form rolls A-352, A-351 and A-371 of the inking module mounted at module mounting station I, and these cam followers are aligned in the same vertical plane with the lifter cams L-13 so that these form rollers do not contact the numbering machine F-66 but do roll in contact with the surface of rubber plate F-75 on rubber plate segment F-74.

Thus, if one color ink is placed in the ink fountain A-60 of the inking module mounted at module mounting station I, and another color ink is placed in the ink fountain A-60 of the inking module mounted at module mounting station II, the rubber plate F-75 will be inked only with the first color ink, and the numbering machine F-66 will be inked only with the second color ink.

In work area VI of large printing cylinder 22, there is a blanket segment F-41 which carries an offset blanket F-42 in the manner previously described. At each side of blanket segment F-41, there are two lifter cams L-12 and L-13. One pair of these lifter cams L-13 at either side of blanket segment F-41, is aligned with the cam follower discs on the form rollers of the inking module mounted at module mounting station I, and the other pair of these lifter cams L-12, at either side of blanket segment F-41, is aligned with the cam follower discs on the form rollers of the inking module mounted at module mounting station II. Thus, all of the form rollers of both the inking modules mounted at module mounting stations I and II are held out of engagement with the surface of blanket F-42 on blanket segment F-41 in work area VI.

The plate A-12, on plate cylinder A-11, in the plate cylinder module AA-4 mounted at module mounting station III, rolls in contact with the surface of offset blanket F-42 in work area VI, but is held out of contact with both of the imaging devices in work area V of large printing cylinder 22, by means which have been illustrated and described in considerable detail elsewhere herein. Thus, if a sheet is fed to every other revolution of lower printing cylinder 20 and is seized by the cylinder grippers 30 and carried around lower printing cylinder 20 and through the bite between lower printing cylinder 20 and large printing cylinder 22 two times, it will be printed on its upper surface on its first passage through the bite between the large and lower printing cylinders with the image from offset blanket F-42, which originated from lithographic plate A-12, and on its second passage through the bits between large printing cylinder 22 and lower printing cylinder 20, it will be printed on its upper surface with the image from rubber plate F-75, and numbered by numbering machine F-66. These three images may, of course, be printed in three different colored inks if desired.

Figure 72:
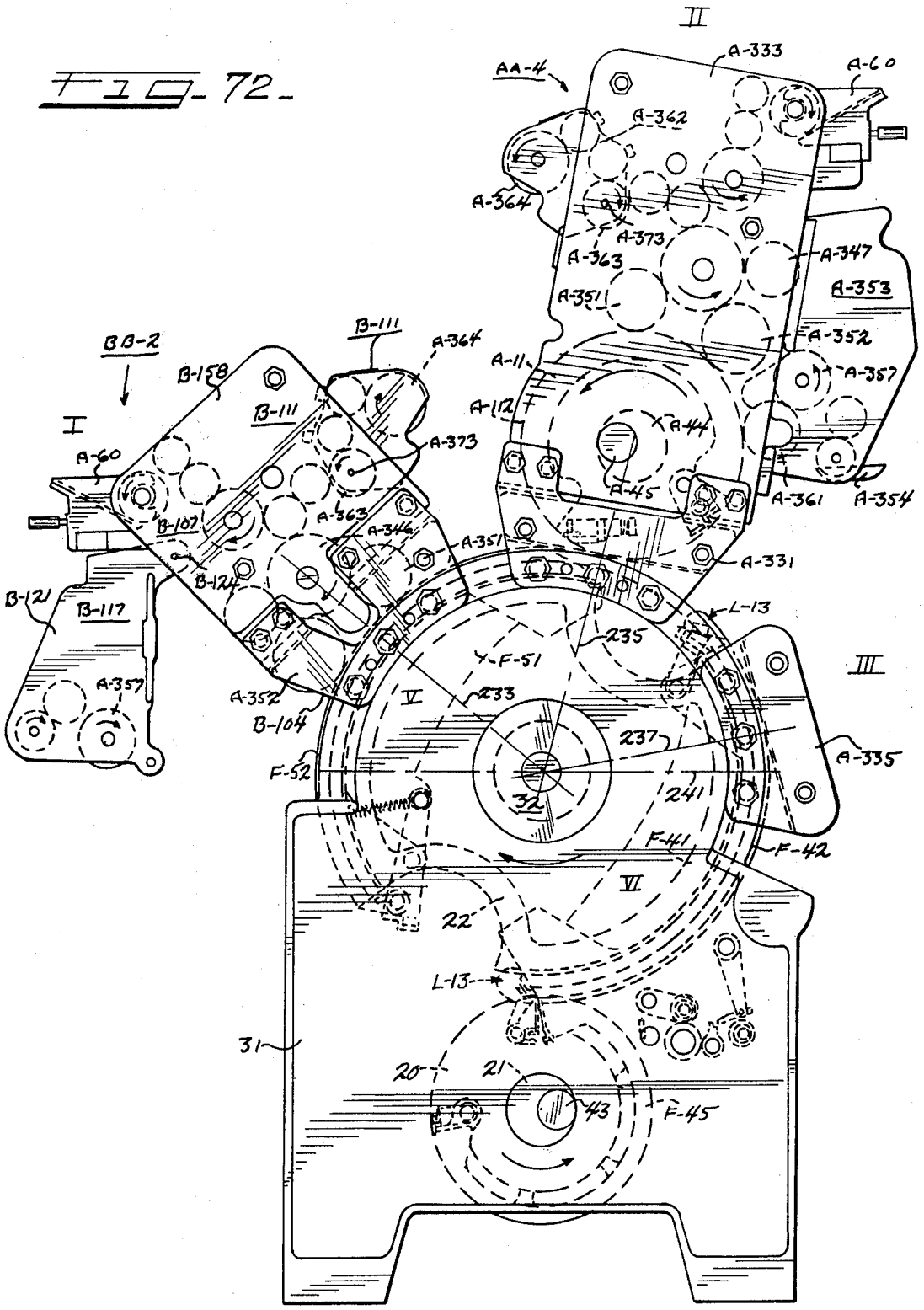

FIG. 72 illustrates the same configuration of the 2R model press as is shown in FIG. 68, but in this figure the dampening attachment B-117 of the ink/damp module BB-2 mounted at module mounting station I is shown swung out, about center B-124 about which it is hinged and dampening form roller A-361 has been removed, all to provide easy access for the attachment or removal of segments in either of the work areas of large printing cylinder 22, and also to provide easy access to ink form roller A-352.

Also, the auxiliary ink attachment B-111 has been swung up about its pivot point A-373 at the center of oscillating distributor roll A-363, and ink form roller A-371 has been removed, thus providing access for the removal of reinsertion of form roller A-351.

Similarly, the auxiliary ink attachment A-362 of the plate cylinder module AA-4 mounted at module mounting station II has been swung up about pivot point A-373 to provide access for the removal or replacement of form roller A-351, and form roller A-371 has been removed.

The other ink form roll A-352 may be removed by first removing soft distributor roll A-347. Dampening form roll A-361 may also be removed, so that it is not necessary to provide means to swing the dampening attachment A-353 of the plate cylinder module AA-4 out of the way.

Alternative constructions for FIGS. 64 thru 72 within the scope of this invention would include a one piece side frame for the plate cylinder module including in the one frame the elements of frame A-333 and the mounting bracket A-331; and a one piece side frame for the ink module including in the one frame the elements of frame B-158 and the mounting bracket B-104, either of which could be mounted on either the 2R model or the 3R model.

Another alternative construction would include one printing module frame, as for instance the plate cylinder module frame A-333, the mounting bracket A-331 and the main frame 31 (or 33) of FIG. 64 or 65, all incorporated in a single frame, while still providing the additional module mounting stations, and the additional printing modules as disclosed, for mounting in the additional module mounting stations, to produce various configurations.

FIGS. 64–72 have thus illustrated and the foregoing description has described the means, and a preferred basic frame structure and related printing modules by means of which a variety of configurations of the 2R model press may be assembled from standardized components by mounting selected combinations of standardized plate cylinder modules, ink dampening modules and/or inking modules at various of the module mounting positions of the basic frame structure, thus creating a variety of different models of the 2 R press, each capable of performing a different combination of printing functions, and each therefore having the ability to fill the requirements of a different segment of the overall market for sheet-fed small offset printing equipment. It is thus apparent that a manufacturer, by first manufacturing quantities of each of the basic standardized components, in accordance with the teachings of this disclosure will thus be enabled to assemble these components into a variety of different configurations, and thus be in a position to offer a variety of both standard and specialized models, each capable of performing a different group of printing functions, to different segments of the printing industry.

It is not contemplated that a user of such equipment will interchange printing modules at a module mounting station between the running of different jobs.

It is contemplated, however, that a purchaser of one of the configurations that does not include a printing module of some sort at each of the module mounting stations can at a later date purchase an additional selected printing module or modules and have it, or them, mounted at the appropriate unused module mounting station, or stations.

Any reference herein to a particular printing function that can be performed by any one of these configurations shown in FIGS. 64 through 72 is purely by way of illustration, since the entire subject of the variety of printing functions which can be performed by various configurations of the press has been dealt with in considerably more detail elsewhere herein.

INKING AND INK/DAMPENING MODULES

FIG. 73 illustrates the manner in which a combined inking and dampening module generally designated BB-2 may be mounted at any required module mounting stations on the basic press structure of the type illustrated in FIGS. 1, 2A and 11. As in those Figures, the spreader bars 13, 14, 15, 16 and 17 are equidistant from each other, and all are the same distance from the center of large printing cylinder 22. Thus, while this combined inking and dampening attachment, as seen in FIG. 73, is mounted at module mounting station III, it can also be mounted at module mounting stations II or IV.

The lower portion of the frame B-11 of this combined inking and dampening module BB-2 is shaped in a manner similar to that of the mounting bracket illustrated in FIG. 15. Frame B-11 mounts on and is affixed to spreader bars 15 and 16 in the same fashion as the mounting bracket for the plate cylinder module illustrated in FIG. 15, which mounts on these same spreader bars, as illustrated and described in detail in reference to FIGS. 19 thru 22. Specifically, there are two slots B-33 and B-34 in the frame B-11 which correspond with the similar slots in the mounting bracket of FIG. 15, and which allow the module to be placed in position over the two spreader bars 15 and 16. The eccentric sleeve member A-26c on spreader bar 15 and the eccentric sleeve member A-26c on spreader bar 16 locate and position the module frame and hold it in fixed relationship to the main frame 31 and to the large printing cylinder 22, and these sleeves are held in position by set screws A-36c and A-35c.

The combined dampening system comprises an ink fountain B-126, and ink fountain roller B-134 and an ink ductor roller B-64, and a series of distributor rollers, generally designated B-65, which distribute the ink and carry it to the form rollers B-12. The dampening system consists of a dampening tray B-136, a dampening fountain roll B-135, a wiper blade B-137 and a dampening ductor roll B-141 which feeds the dampening solution onto the surface of distributor roller B-142, at which point it is combined with the ink and fed to the first two of the form rollers B-12, which are in contact with distributor roll B-142.

FIG. 74 illustrates a somewhat similar module BB-4 which is attached in a similar manner, but in this case the module is mounted at module mounting station IV. In this case, the dampening rollers have been omitted so that the module BB-4 seen in FIG. 74 constitutes an inking module, as opposed to the combined inking and dampening module, as seen in FIG. 73. It will be noted that the ink fountain B-126 of the inking module mounted at module mounting station IV has been fastened in position with respect to the frames B-11 of the module so that the top surface of the ink fountain B-126 is in a horizontal position, notwithstanding the fact that the module is mounted at a different module mounting position.

Both FIGS. 73 and 74 illustrate inking modules mounted on a 2R model press, whereas FIG. 4a illustrates a similar module mounted on a 3R model press. The basic construction of the module is the same in both the 2R press and the 3R press, but in the case of this configuration of the 3R press, the lower portion of the frame of the module is extended to span the greater distance between the spreader bars 13, 14, 15, 16 and 17 on the 3R press, just as the brackets for mounting the plate cylinder modules on the 3R press, as seen in FIG. 16, differ from the similar brackets in FIG. 15 which serve the same purpose on the 2R press.

FIG. 75 illustrates a separate dampening module CC-2 mounted at module mounting station III on a 2R press having a frame structure similar to that illustrated in FIGS. 1, 2a and 11. The portion of the frames C-11 of this module which mount to the spreader bars 15 and 16 is shaped and formed similarly to the like portion of the frames B-11 in FIG. 73, and this dampening module C-2 is mounted and supported on the spreader bars in exactly the same manner as previously described with respect to the inking and dampening module seen in FIG. 73.

In FIG. 75, the dampening module CC-2 consists of a dampening fountain tray C-601 and a fountain roller C-602, a doctor roll C-603, a dampening ductor roll C-604, dampening distributor rolls, generally designated C-605, and two dampening form rolls C-606.

A dampening module CC-2 may be similarly attached at module mounting stations I or II. It could physically be attached at module mounting station IV, but, as a practical matter, this would not be done since the rotation of cylinder 22 is clockwise, as seen in FIG. 75, and a dampening module, such as here illustrated, would always be used in conjunction with an inking module, such as seen in FIG. 74, the form rollers of which should contact a lithographic plate after they have been moistened by the form rolls of a separate dampening module.

A similar dampening module for this configuration of the 3R model press would be constructed as previously described with respect to an inking module for this configuration of the 3R model press.

CYLINDER GRIPPERS AND EJECTION MECHANISM

FIG. 76 illustrates the action of the cylinder grippers and ejector fingers generally designated GG-1 for the operation of the mechanism wherein the sheets are ejected and delivered directly into a receiving hopper. In FIG. 76, the cylinder grippers are illustrated in three different positions in relation to the rotation of lower printing cylinder 20. In FIG. 77, the gripper mechanism and the means by which the leading edge of the blanket is attached to the lower printing cylinder is shown in somewhat more detail.

Referring now to FIG. 76, the cylinder grippers 30 are shown in solid lines at position A, which is the point at which the leading edge of a sheet enters the cylinder grippers under control of the upper and lower feed rolls, as previously described. The cylinder grippers 30 are in phantom lines at position B, which is the position that they would occupy as the leading edge of a sheet first enters the bite between the lower printing cylinder 20 and the large printing cylinder 22. Finally, the cylinder grippers 30 are shown again in phantom lines, at position C, which is the point at which the leading edge of the sheet is released by the cylinder grippers 30 and stripped, and delivered into a receiving tray.

As seen in FIGS. 77, and 78 there are three bosses 246, across the width of the inner surface of the leading edge 710 of lower printing cylinder 20, against which the body of the gripper bar 247 rests, and to which the body 247 of the gripper bar is secured by bolts 251, seen also in FIG. 79a. There is a gripper shaft 252 which is journalled in both ends of lower printing cylinder 20. Across the width of the body of the gripper bar 247 there are five projections 253 which encircle the gripper shaft 252. When the bolts 251 are removed, the body of the gripper bar 247 may thus be swung around the gripper shaft 252 to allow the leading edge of an offset blanket 257 to be inserted, so that the holes across the leading edge of the offset blanket 257 may be engaged on the pins 254 on the blanket clamping member 255. There are three slots just back of the leading edge of the offset blanket through which the bosses 246 project.

When the leaading edge of an offset blanket has been thus secured on the blanket holding pins 254, the trailing edge of the blanket is attached to corresponding pins 256 in the trailing edge clamp 261, and the offset blanket 257 is then drawn tight by taking up on the bolts 262 which cause the trailing edge clamp 261 to pivot about its supporting shaft 263 until the blanket 257 has been brought under proper tension. The offset blanket having been thus attached, the body of the gripper bar 247 is swung back into position, so that its face contacts the bosses 246, and the bolts 251 are inserted and drawn up tight. When this has been accomplished, the body of the gripper bar 247 is secured to the leading face 710 of the lower printing cylinder 20, and the encircling projections 253 of the griupper bar body 247 act as additional supports for the gripper bar shaft 252. Integral with the body of the gripper bar 247 are the cylinder paper stops 29, against which the leading edge of a sheet is registered by the action of the upper and lower feed rolls as previously described, and the fixed anvil 264, against which the sheet is clamped by the action of the cylinder gripper fingers 30.

When the machine is furnihsed with stripper fingers and a tray delivery, the construction is as shown in FIGS. 76 and 77, and includes a series of ejector fingers 265 which are spaced across the width of the leading edge 710 of lower printing cylinder 20 adjacent to the cylinder gripper fingers 30 and the anvil members 264. These ejector fingers 265 are normally held in the position shown in FIG. 77 by the action of springs 266, which hold them in the withdrawn position below the periphery of lower printing cylinder 20. There is an actuator arm 267 pinned to the projecting portion of gripper shaft 252 which extends beyond the left-hand side of lower printing cylinder 20. Actuator arm 267 carries a cam follower G-40 which, as lower printing cylinder 20 rotates, follows the surface of stationary cam member 271. The lobes G-41 and G-42 of cam 271 lift the cam follower G-40, and thereby open the cylinder gripper fingers 30, or raise them off the surface of the anvil 264, while at other times the springs 272, as seen in FIG. 78 and 79, hold the cylinder gripper fingers 30 in contact with the anvil 264 and urge the cam follower G-40 toward the lower portion of cam 271. Integral with the cylinder gripper fingers 30 is a lifter portion 273. When the cylinder gripper fingers 30 are opened, the lifter portion 273 first moves into contact with the bottom plate 274 of the If the gripper fingers are then opened wider, the lifter portion 273 presses against the bottom plate 274 and raises the ejector fingers 265 against the action of spring 266.

Referring now to FIG. 76, position A shows the cylinder gripper fingers 30 in position to receive the leading edge of a sheet presented along the support plate 66 by the action of the uper and lower feed rolls, as previously described. The lobe G-41of cam 271 is of the proper height to open ghe cylinder gripper fingers 30 just enough to receive the leading edge of a sheet against the cylinder stops 29. In this position the cylinder gripper fingers 30 do not rise above the top of the cylinder stops 29, and this prevents a sheet from being driven over the top of the cylinder stops 29. Also, the cylinder grippers 30, when opened only this far, cause the lifter members 273 to approach the bottom plate 274 of the ejector fingers 265, but the lifter members 273 do not quite contact the lifter plate 274, and therefore the ejector fingers 265 remain below the periphery of the lower printing cylinder 20.

As lower printing cylinder 20 rotates in a counterclockwise direction, as seen in FIG. 76, the cylinder grippers 30 close against the anvil 264 and seize the leading edge of the sheet therebetween, whereupon the sheet is released by the upper and lower feed rolls, as previously described, and the sheet is securely held between the anvil 264 and the inner surface of the cylinder gripper fingers 30, and with its leading edge registered in contact with the cylinder stop 29. In this manner, the leading edge of the sheet is carried through the bite between the lower printing cylinder 20 and the large printing cylinder 22, as shown at position B in FIG. 76. The leading edge of the sheet continues to be carried in this manner past the point where it passes under the first ejector rollers 275, which are carried at the end of arms 276 which pivot about shaft 277.

When the inner faces of the cylinder gripper fingers 30 rest against the anvil 264, the cam follower roll G-40 is just above the surface of the low portion of stationary cam 271. After the leading edge of the sheet has passed under first ejector rolls 275, the cam follower G-40 engages the lobe G-42 of cam 271 and the cylinder grippers 30 open into the position shown at position C. In this position, the cylinder gripper fingers 30 have opened to release the leading edge of the sheet. Lobe G-42 is sufficiently higher than lobe G-41 so that the cylinder gripper fingers 30 are opened wider, at position C, with the result that the fingers themselves are opened sufficiently to allow the leading edge of the sheet to move outwardly past the cylinder stops 29. Also, the lifter portions 273 of the fingers 30 have been brought into contact with the bottom plate 274 of the ejector fingers 265, so that the ejector fingers themselves have been moved out beyond the periphery of lower printing cylinder 20, thereby forcing the leading edge of the sheet into the position shown in FIG. 76 at position C. The lobe G-42 is sufficiently long so that the ejector fingers 265 are held in this position until the lower printing cylinder 20 has revolved to the point where the leading edge of the sheet has passed over the stripper fingers 281, which project between the open cylinder gripper fingers 30 and the ejector fingers 265, and strip the sheet from the surface of lower printing cylinder 20, directing it into the bite of the second and third ejector rollers 283 and 284, which then eject it into a receiving hopper, not shown in this Figure.

SEPARATE CHAIN DELIVERY MECHANISM

The delivery mechanism shown in FIG. 78, 79*a* and 79*b* differs from that shown in FIGS. 76 and 77 in that the sheet, instead of being stripped and delivered by stripper fingers and ejector rollers, has its leading edge transferred from the cylinder grippers 30 into the bite of chain-carried delivery grippers of a separate chain delivery mechanism generally designated GG-2. The separate chain delivery mechanism comprises a pair of roller chains 285, each of which runs on a sprocket 286, and a guide wheel 287. The sprockets 286 are affixed to a shaft 291 which is journalled in the main press frames 31 and 33, and is driven by a gear 292 which is pinned thereto and which meshes with the gear 45 of lower printing cylinder 20. The pitch diameter of the gear 292 and of the sprockets 286 is equal so that the surface speed of the chains 285 is equal to the surface speed of lower printing cylinder 20. The pitch diameter of gear 292 is one half the pitch diameter of gear 45. The length of each of the chains 285 is equal to twice the effective circumference of lower printing cylinder 20.

The chains 285 carry between them two delivery gripper bars 294A and 294B which are spaced apart from each other by a distance equal to the effective circumference of lower printing cylinder 20. The guide wheels 287, about which the outer loops of the chains 285 are supported, are in turn supported in frames 295 secured to the base frame and to the main frames 31 and 33 of the press. The delivery grippers 294A and 294B carry delivery gripper fingers 294 which are held closed by the action of springs similar to the springs 272 of the cylinder grippers 30 and which are opened by the action of cams 297 and 301 acting against cam followers 302. The sprockets 286 are positioned tangent to lower printing cylinder 20, and the shape of cam 297 and the shape of lob G-42 on cam 271 are such that the chain-carried delivery grippers 296 pass in behind the leading edge of the sheet and seize the leading edge of the sheet at the point of tangency between sprockets 286 and lower printing cylinder 20, at the same instant that the cylinder grippers 30 release the leading edge of the sheet. The sheet is then stripped and delivered and pulled away from lower printing cylinder 20 by the chain-carried delivery grippers 296 which hold on to the leading edge of the sheet until cam follower 302 contacts cam 301, at which point the delivery grippers 296 release the sheet and it is dropped on a delivery pile. Guiding retainers 303 and 304 hold the roller chain 285 in contact with the sprockets 286 and the guide wheels 287, respectively, against the twisting action which occurs when the delivery grippers 296 are opened by the action of cams 297 and 301, respectively, on cam followers 302.

There are two or more sheet guiding wheels 715 on shaft 291, which may be placed at any point across the width of the machine, and which have a sharp, pointed outer surface 717, which may be coated with teflon to repel ink, and which cause a sheet carried by delivery grippers 296 to follow the path of the chains 285. Sheet guiding wheels 715 turn with shaft 291 and are cut out at 716 to receive the delivery gripper bars 294.

The cylinder grippers 30 of FIGS. 78 and 79*a*, which are used in combination with the separate chain delivery mechanism GG-2, are the same as those of FIGS. 76 and 77 used with the stripper fingers and ejector wheels and try delivery, with the exception that in the construction shown in FIGS. 78 and 79*a* the ejector fingers 265 are omitted, together with the spring 266, and the cylinder gripper fingers 30 need not have the lifter portion 273 as shown in FIG. 76 and 77. The mounting of the cylinder gripper fingers 30 on the gripper shaft 252 can best be seen in FIG. 79*a* in which the actuating arm 267 which carries cam follower G-40 is pinned to shaft 252 with taper pin 305, and shaft 252 is journalled in the two ends of lower printing cylinder 20 in bearing 306 at the left end and bearing 307 at the right end. Bearing 307 being secured in place by a washer 311 in a slot in the side bearing 307, and bearing 307 having a sufficiently large outside diameter that shaft 252 may be withdrawn therethrough when the bearing is removed.

There are six cylinder gripper fingers 30 located along gripper shaft 252, and associated with each of the cylinder gripper fingers 30 is a spring 272 which wraps around shaft 252 on either side of the gripper finger 30. The two ends 312 of each spring 272 bear against the body of the gripper bar 247, on either side of the gripper finger 30, and the center portion 313 bears on the top surface pof the gripper finger 30, thereby forcing it into contact with the anvil 264. The cylinder stops 29 are located alongside each cylinder gripper finger 30, and there are cutouts 314 in the body 247 of the gripper bar mechanism to allow for the entry of the chain-carried gripper fingers 296, to seize the sheet at the point of tangency between the sprockets 286 and the lower printing cylinder 20, as previously described.

The cylinder gripper finger 30 at the left as seen in FIG. 79*a*, is securely and tightly pinned to gripper shaft 252 by taper pin 315. Each of the other five cylinder gripper fingers 30 is located by means of a similar taper pin 315 secured in gripper shaft 252, but in the case of these five gripper fingers, the holes 316 in the gripper fingers 30, through which the pins 315 project, are somewhat larger than the pin 315. This allows each individual finger 30 to be held in contact with its own anvil 264, under the action of its own individual spring 272 without regard to the exact alignment of all six of the pins 315. When the cam follower G-40 is lifted by either lobe G-41 or lobe G-42 of cam 271, the slack between pin 315 and hole 316 is taken up and each pin acts to open each gripper finger 30 against the action of spring 272.

As explained in detail elsewhere herein, sheets are sometimes fed to the stops and grippers in lower printing cylinder 20 on every revolution of the cylinder, and each sheet passes through the bite between lower printing cylinder 20 and large printing cylinder 22 one time; and is then stripped and delivered by either the mechanism illustrated in FIGS. 76 and 77, or by that illustrated in FIG. 78, 79*a* and 79*b*. Under other circumstances, a sheet is fed to the stops and grippers of lower printing cylinder 20 on every other revolution of that cylinder, but is still passed through the bite between lower printing cylinder 20 and large printing cylinder 22 only once, and then stripped and delivered, as previously set forth. In the latter case, the grippers in lower printing cylinder 20 open and close on each revolution of lower printing cylinder 20, even though a sheet is fed only to every other revolution of that cylinder, and similarly, in the construction shown in FIGS. 78, 79*a* and 79*b*, the grippers 294A and 294B carried by the chains 285 also open and close each time they pass the cams 297 and 301, even though a sheet will only be transferred to grippers 294B and none will be present when grippers 294A are at the point of tangency between sprockets 286 and lower printing cylinder 20.

FEED AND STRIP SHEET ON EVERY OTHER REVOLUTION

Under other circumstances, a sheet will be fed to every other revolution of lower printing cylinder 20, but will be seized by the cylinder grippers 30 and retained thereby until it has passed through the bite between lower printing cylinder 20 and large printing cylinder 22 two times. The manner in which is is accomplished is illustrated in FIGS. 78, 79*a* and 79*b* 80 and 81, as will now be described.

With respect to the stripping and delivery of such a sheet in the construction shown in FIGS. 76 and 77, the cylinder grippers 30 open to receive a sheet at position A in FIG. 76, carry it through the bite, as shown at position B in FIG. 76, and thenpass position C and position A without opening, pass through position B a second time, and then open to release the sheet at position C, and again open to receive a sheet at position A.

The sequence of a opening and closing of the cylinder grippers 30 in similar circumstances is the same in the construction illustrated in FIGS. 78, 79*a* and 79*b*, but delivery gripper 294A, which passes the point of tangency between the sprockets 286 and lower printing cylinder 20 on the revolution of lower printing cylinder 20 when the sheet is carried past this point without being released, is held open at all times. This is accomplished by securing a link (not shown) over a pin 322, extending outwardlyfrom the arm that carries cam follower 302, and a pin 323, projecting outwadly from a link in the chain 285. This link, when thus secured, holds the fingers 296 of delivery gripper 294A in an open position, and holds its cam follower 302 out of contact with cams 297 and 301, so that delivery gripper 294A does not open or close, and makes no effort to seize the leading edge of a sheet held in cylinder grippers 30 on the revolution of lower printing cylinder 20 when delivery gripper 294A is in coincidence with the leading edge of the sheet and cylinder gripper 30 does not open to release the sheet. Delivery gripper 294B, is left free to operate in the normal fashion, as previously described, and comes into coincidence with cylinder grippers 30 at the point of tangency between the sprockets 286 and lower printing cylinder 20 on the revolution of lower printing cylinder 20 on which cylinder grippers 30 open to release sheet.

PASS SHEET THROUGH BITE ONCE OR MORE THAN ONCE

The mechanism generally designated PP-1 as seen in FIGS. 78, 79*a*, 80 and 81, illustrates the manner in which a sheet is caused to be retained by the cylinder grippers 30 for a single passage through the bite between the cylinders of the printing couple, lower printing cylinder 20 and large printing cylinder 22, or to be retained by those cylinder grippers for two passages through the bite between lower printing cylinder 20 and large printing cylinder 22.

As previously described and illustrates, lower printing cylinder 20 rotates about stationary shaft 21 which is supported in the side frames 31 and 33 by end stub members 43 and 44 which are journalled in the main frames for rocking motion, all under control of the cylinder latching mechanism previously described and illustrated in detail. Thus, the center of shaft 21 and of lower printing cylinder 20 moves up and down slightly as the cylinder is moved into latched or unlatched position, pivoting about the center of end stubs 43 and 44, but, except for this slight rocking motion, shaft 21 is stationary and lower printing cylinder 20 is journalled to rotate about it, and at all times shaft 21 itself is concentric with lower printing cylinder 20.

As shown in FIGS. 79*a*, 80 and 81, there is a flanged collar 324 secured to shaft 21, between the left end of lower printing cylinder 20 and the left-hand frame 31, by means of a taper pin 325. The outer surface of sleeve 324 is formed as a male spline 326. There is another sleeve member, generally designated 327, with a matching female sline on its inside diameter mounted for back and forth sliding motion on sleeve 324. Cam 271 is integral with sleeve member 327. Spaced at 120° intervals around the outer face of sleeve member 327 are three wedge-shaped cuts 331. There is another sleeve-like member 332 located about sleeve member 324 and journalled for rocking motion thereabout through a bearing 333. Sleeve member 332 is secured from sliding motion on sleeve 324 by flange portion 334 of sleeve 324 on one side, and by retaining ring 335 on the other side.

There are three cam following rollers 336 located at 120° intervals around the outer face of sleeve member 332 and so located that, by rocking sleeve member 332 through an arc about sleeve member 324, the cam followers 336 may be brought into coincidence with the flat outer face 337 of sleeve member 327, or may be brought into coincidence with the three cut-out angular portions 331 thereof. There is a coil spring 341 wrapped around sleeve member 324 and bearing upon the flanged portion thereof at one end, and upon the face of sleeve member 327 at the other, thereby urging sleeve member 327 to move to the left, as seen in FIG. 81. When sleeve member 332 is rocked into position so that the cam followers 336 are opposite the flat outer face 337 of sleeve member 327, sleeve member 327 is held in the inner position shown in FIGS. 79*a*, 80 and 81, and when it is in this position, cam 271 is held in alignment with cam follower G-40 on arm 267 of gripper shaft 252.

When sleeve 332 is rocked into position to bring cam follower 336 into coincidence with the bottom portion of the slanted cut-out portions 331 of sleeve member 327, the spring 341 forces splined sleeve member 327 to move to the left as viewed in FIG. 81, on splined sleeve 324. Cam 271 is thereby moved to the right as viewed in FIGS. 79*a*, in which position it is out of aligment with cam follower G-40 so that, as lower printing cylinder 20 rotates to bring the cam follower G-40 past the position of lobe G-41 or lobe G-42 while cam 271 is in this position, cam follower G-40 will not contact lobe G-41 or G-42, and the cylinder gripper fingers 30 will therefore remain closed.

There is a stud 342, secured to the inner side of main frame 21, about which an arm 343 is mounted for rocking motion. There is also an arm 344 pivoted about stud 342. Arm 343 has a fan-shaped portion in which there is an arcuate slot 345, and arm 344 is secured to arm 343 by means of a bolt 346 which passes through the slot of 345 and is threaded into arm 343. The other end of arm 344 carries a cam following roller 347. There is a spring 351 which links a spring 352 in frame 31 with a spring pin 353 on arm 343, so that spring 351 to urges arm 343 to move in a clockwise direction about stud 342, as shown in FIG. 80. The outher end of arm 343 carries a pin 354 which is engaged in a slot 355 in a projection 356 which is integral with sleeve member 332. There is a cam member 357 mounted on the hub 361 of large printing cylinder 22 by means of three locating pins and bolts 362. Cam 357 is in alignment with cam follower 347, as seen in FIG. 81.

When arm 344 is secured to arm 343 in the manner seen in FIG. 80, cam follower 347 is so positioned that when the large printing cylinder 22 rotates, cam 357 contacts follower 347 and causes arms 344 and 343 together to move in a counterclockwise direction, and this in turn, through the action of pin 354 in slot 355, causes sleeve member 332 to rock in a clockwise direction, as seen in FIG. 80. This, in turn, brings cam followers 336 in alignment with the cut-out portions 331 of sleeve member 327, thereby allowing spring 341 to move sleeve member 327, and with it integral cam 271 to the left as viewed in FIG. 81 or to the right as viewed in FIG. 79*a*, out of alignment with cam follower G-40 for the cylinder grippers 30.

DESCRIPTION OF OPERATION

When it is desired to carry a sheet through the bite between lower printing cylinder 20 and large printing cylinder 22 two times, the relationship between arm 344 and arm 343 is locked in the position shown in FIG. 80 by means of bolt 346. Then, as the cylinder grippers 30 approach the position shown at A in FIG. 76, the cylinder grippers open to receive a sheet and close as the leading edge of the sheet is registered against the cylinder stops 29. As follower G-40 passes between lobe G-41 and lobe G-42, cam 357 contacts follower 347 causing the cam 271 to be moved to the right, as seen in FIG. 79*a*, out of the path of cylinder gripper follower G-40, and cam 271 is held in this position as follower G-40 passes first the position of lobe G-42 and then the position of lobe G-41, and thus the cylinder grippers 30 remain closed and carry the sheet around lower printing cylinder 20 and thru the bite between the cylinders of the printing couple two times. Then, as follower G-40 is passing between the position from lobe G-41 to lobe G-42 a second time, follower 347 passes off of cam 357, and cam 271 is moved back into position in alignment with follower G-40, as seen in FIG. 79*a*, so that, as follower G-40 reaches lobe G-42 the second time, the cylinder grippers 30 open to release the sheet and it is stripped and delivered either as shown and described in FIG. 76 and 77, or as shown and described in FIGS. 78, 79*a*, and 79*b*. Follower 347 has still not reached the position of cam 357 again at the time cylinder gripper follower G-40 reaches lobe G-41, so that once again the cylinder grippers 30 open to receive a sheet and close on the leading edge of that sheet, and then once again, as follower G-40 passes between the position of lobe G-41 and lobe G-42, follower 347 is contacted by cam 357, and cam 271 is again moved out of alignment with follower G-40, and the process is repeated.

If it is desired to set the mechanism so that sheets will be carried through the bit between lower printing cylinder 20 and large printing cylinder 22 only once, then bolt 346 is loosened and arm 344 is swung counterclockwise, as viewed in FIG. 80, until bolt 346 is at the other end of slot 345, and then bolt 346 is tightened again. In this position, cam follower 347 is held out of contact with the cam 357, and therefore spring 351 holds the arm 343 and the pin 354 in the position shown in FIG. 80, in which position the cam 271 is held in alignment with the cylinder gripper follower G-40 at all times, and the cylinder grippers 30 then open and close to receive a sheet, and open and close to release the sheet on each revolution of lower printing cylinder 20.

It will be noted that the entire mechanism, beginning with sleeve 324 and working through arms 343 and 344, stud 342, cam 357, etc., is constructed in such manner that on a model of the press on which it is not desired to have the ability to carry a sheet around lower printing cylinder 20 and through the bite, between lower printing cylinder 20 and large printing cylinder 22 more than once, none of this mechanism need be furnished, and a simpler cam 271 may be permanently affixed to shaft 21 in permanent alignment with cylinder gripper follower G-40. Then, if it is desired at a later date to convert such a press in the field, after it has been in operation, to add to it the ability to carry a sheet through the bite between the cylinders of the printing couple, selectively either once or more than once, then the mechanism just described may be furnished and installed on the press in a customer's place of business.

It should be noted that the number of delivery gripper gars carried by the extension chain delivery GG-2 is equal to the number of work areas on the large printing cylinder 22, and the length of the chains 285 is equal to the effective circumference of the large printing cylinder 22. Thus, each individual delivery gripper bar always comes into coincidence with the same rotation of lower printing cylinder 20 in relation to its coincidence with the work areas of large printing cylinder 22. It is this fact that makes it possible to simply lock one delivery gripper in the open position as described above when sheets are being carried through the bite between lower printing cylinder 20 and large printing cylinder 22 two times.

In like fashion, on the 3R model in which there are three work areas on the large printing cylinder, the length of the delivery chains is equal again to the effective circumference of the large printing cylinder, which in thise case is equal to three times the effective circumference of the lower printing cylinder 20, and there are three delivery gripper bars carried by the extension delivery mechanism. This makes it possible to lock two delivery gripper bars open, in the manner described above, if a sheet is to be carried through the bite between the large and lower printing cylinders three times, or to lock one delivery gripper bar open if a sheet is to be carried through the bite between the large and lower printing cylinders two times.

Also, on the 3R model, the cam which corresponds to cam 357 in FIG. 80 will correspond in length to one work area if the sheet is to be carried through the bite between the large and lower printing cylinders two times and will be equal in length to the angular extent of two work areas if the sheet is to be carried through the bite between the large and lower printing cylinders three times. In other respects, the mechanism on the 3R model would be the same as shown and described herein.

PLATE CYLINDER MODULES

FIGS. 82 and 83 illustrate a portion of plate cylinder module and show the manner in which the hard ink distributor rollers are driven and caused to oscillate. The plate cylinder A-11 is journalled to rotate about the shaft A-44 on two ball bearings A-39 one at either end of the plate cylinder, and one of which is shown in FIG. 82. The eccentric stub shaft A-45 is journalled for rocking motion in two sleeve bearings A-57 and A-58 in a flanged sleeve member A-50 which is secured in a bore in the module frame A-333 and which may be rotated to raise or lower the stub shaft A-45 of plate cylinder shaft A-44 to bring plate cylinder A-11 into parallelism with the large printing cylinder 22 below it; after which the flange portion of flanged sleeve A-50 is bolted to the frame A-21 by means shown in FIG. 26. The center portion of shaft A-44, and with it the associated plate cylinder A-11, may then be moved toward and away from large printing cylinder 22 by turning stub shaft A-45 in the manner illustrated and described in connection with the means for latching and unlatching the plate cylinders.

Plate cylinder A-11 is driven by means of gear 62 whose pitch diameter is equal to the effective printing diameter of plate cylinder A-11. Gear 62 is journalled by means of a ball bearing A-68 about the outer surface of sleeve A-50, and gear 62 meshes with large ring gear 40 on large printing cylinder 22, as seen in FIG. 41. Gear 62 is fastened to a cylinder disc member 57 which is also journalled on sleeve A-50 through a sleeve bearing A-78, and gear 62 is attached to disc member 57 by means of three bolts A-88 spaced equidistant from the center of shaft A-44 and spaced 120° from each other, and which pass through arcuate slots 79 in gear 62 and are threaded into disc member 57.

Disc member 57, in turn, drives cylinder A-11 through Oldham coupling 56. The Oldham coupling 56 compensates for slight differences in the center of gear 62 which, as described, is on a fixed center, and the center of cylinder A-11, which is in alignment with the fixed center of gear 62 when in the latched printing position, but which moves away from that position of alignment when in the unlatched non-printing position.

Vertical adjustments of an image on a plate carried by plate cylinder A-11 may be made by loosening the bolt A-88, which may be brought successively in line with a hole A-69 in frame A-333, which provides access to these bolts. Plate cylinder A-11 may then be rotated with respect to gear 62 to raise or lower the position in which an image on a plate on cylinder A-11 is printed, and then, when the desired position is achieved, the three bolts A-88 may be tightened and the adjustment secured and maintained.

Gear 62, in turn, drives an idler gear A-37 which is journalled on bushings A-79 to turn on shaft A-89, and which is held in position laterally by two retaining rings A-98.

OSCILLATING DISTRIBUTOR ROLLERS

Hard ink distributor roller A-346 is made integral with gear A-348 whose pitch diameter is equal to the diameter of roller A-346, and the roller and gear, in turn, are pinned to shaft A-340 by means of a taper pin A-339. Shaft A-340 is journalled in the frames A-333 by means of bushing A-349. Gear A-348 meshes with, and is driven by, idler gear A-37. The shaft A-340 is caused to ocsillate or move from side to side by means which will be described hereinafter, and the width of idler gear A-37 is sufficient to engage it on the one hand with plate cylinder gear 62, and also with gear A-348 through-out the extent of its ocsillation or side-to-side movement. Gear A-348, in turn, drives another idler A-368 which is journalled, by means of a bushing A-369, on shaft A-334 and retained in position laterally by retaining rings A-375.

Idler gear A-368 meshes with and drives gear A-376 which is integral with hard ink distributor roller A-344, and which, together with gear A-376, is pinned to shaft A-377 by means of taper pin A-378. Shaft A-377, and with it distributor roller A-344 and gear A-376, are also caused to oscillate or move from side to side, in a manner to be hereinafter described, and the width of gear A-368 is such as to span the side-to-side movement of both gear A-348 and of gear A-376. The side-to-side motion, or oscillation of gears A-348 and A-376, is 180° out of phase, so that, when gear A-376 is at the far right-hand position of its oscillation, gear 348 is at the far left end of its oscillation. Shaft A-377 is journalled for both rotational and side-to-side motion in a bushing A-379 in frames A-333, just as shaft A-340 is similarly journalled in bushing A-349. Shaft A-381 is a cam shaft which is driven at comparatively slow speed, and journalled in the two frames A-333 in angular contact ball bearings, so that it is journalled for turning and held by the bearings against any side-to-side movement resulting from thrust. Pinned to the outer end of shaft A-381 is a barrel cam A-382. Pinned to the outer end of shafts A-340 and A-377 are cylindrical yokes A-383 and A-384, respectively, held in position by taper pins A-385 and 386, respectively. The barrel cam A-382 is pinned to shaft A-381 by taper pin A-387.

As seen in FIG. 83, there is another shaft A-373 which carries a third hard ink distributor roller A-363, which will be illustrated and described elsewhere herein, and there is also a cylinderical yoke A-392 pinned to the outer end of shaft A-373 by means of taper pin A-393.

Also as seen in this Figure, there is a pivot casting A-394 secured to frame A-333 and supporting a pivot pin A-395. Rocker arm A-396 is free to rock about pivot pin A-395, which is at the center of rocker arm A-396. Rocker arm A-396 carries a cam follower A-397 at one end which rides in the groove of barrel cam A-382. At its other end rocker arm A-396 carries another cam follower A-398 which rides in the groove of cylindrical yoke A-383 on shaft A-340. Thus, as shaft A-381 and barrel cam A-382 are rotated, the follower A-397 is caused to move in and out in relation to frame A-333 by the action of the barrel cam A-382, and since rocker arm A-396 is pivoted about pin A-395 at its center, follower A-398 at the other end of rocker arm A-396 is moved through an equal, but opposite, distance in and out from the frame and carries with it cylindrical yoke A-383, shaft A-340, gear A-348 and distributor roller A-346.

In like manner, there is another pivot casting A-401 carrying pivot pin A-402 and rocker arm A-403 with follower A-404 at one end, which rides in barrel cam A-382, and a follower A-405 at the other end which rides in cylindrical yoke A-392, so that shaft A-373, and the distributor roller A-363 which it carries, is similarly caused to move back and forth by the action of barrel cam A-382, but somewhat out of phase with the motion of shaft A-340 and roller A-346. There is another pivot casting A-406 secured to main frame A-333 and carrying a pivot pin A-407, about which rocker arm A-408 rocks, carrying a follower A-411 at one end which rides in cylindrical yoke member A-383, and a follower A-409 at its other end which rides in cylindrical yoke member A-384 on shaft A-377. Thus, as cylindrical yoke A-383 is caused to move in and out in the manner previously described, it, in turn, carries with it follower A-411 and through rocker arm A-408, and follower A-409 causes cylindrical yoke member A-384, shaft A-377 and distributor roller A-344 affixed thereto to move from side to side. This oscillating movement is 180° out of phase with the similar movement of the shaft A-340 and roller A-346.

FORM ROLLERS

FIGS. 84, 85, 86 and 87 illustrate the manner in which the ink form rollers are mounted so that the pressure with which they bear against the adjacent ink distributor roll, and the pressure with which they bear on the surface of the plate, may each be independently adjusted and maintained, with the adjusting means being easily accessible and easy to adjust. As shown in these Figures, form roll A-351 is journalled to rotate about shaft A-412, and the two ends of shaft A-412 are held in two brackets A-413 which allow the shaft A-412 and the form roll A-351 to pivot about distributor roll A-346. The upper end of each of the brackets A-413 comprises a hub A-414 which fits snugly on the outside diameter of one of the bushings A-349 which are pressed into the frames A-333 and in which shaft A-340 is journalled for rotational and sliding motion. The bushings A-349 project inwardly from frames A-333 to form a stationary support about which the hubs A-414 may rotate.

At the position on bracket A-413 where the shaft A-412 is supported, there is a hub member A-415 with a hole A-416 bored therein and a bushing A-417 pressed into the hole A-416. A flanged sleeve member A-418 is journalled in the bushing A-417. There is a hole through flanged sleeve member A-418 which is eccentric to its outer sleeve portion. This eccentric hole is of the proper size to snugly receive and hold the ends of the shaft A-412 for form roller A-351.

There is an upwardly projecting arm A-419 integral with the flange portion of flange sleeve member A-418, and a bolt A-421 is threaded through arm A-419. The point of the bolt A-421 bears against the face A-422 of an upwardly projecting portion of the bracket A-413. There is a spring pin A-423 in the arm A-419 and another spring pin A-424 in the hub portion A-414 of bracket A-413. A spring A-425 connects the two spring pins A-423 and A-424, and this spring thus acts to hold the point of the bolt A-421 against the face A-422 of bracket A-413. There is a ratchet toothed ring A-426 integral with the head of bolt A-421 and a spring-retaining clip A-427 which seats itself between the ratchet teeth of the ring A-426, thereby preventing bolt A-421 from turning under the forces of vibration and holding bolt A-421 in whatever position of adjustment it is placed with an adjusting wrench.

The eccentricity of the hole which carries the shaft A-412 in the flanged sleeve A-418 is such that, if the projecting arm A-419 of the flange portion of sleeve A-418 is caused to rotate in a clockwise direction as seen in FIGS. 84 or 86, the center of the form roll A-351 will be moved toward the center of the distributor roll A-346 and the pressure between the two rolls will be increased. On the other hand, if the arm A-419 is rotated in a counterclockwise direction, the center of the form roll A-351 will be moved away from the center of the distributor roll A-346 and the pressure between the two rollers will be decreased.

The spring A-425 is sufficiently strong to hold the point of the bolt A-421 against the face of A-422 of bracket A-413, and therefore, as the bolt A-421 is turned so that it is screwed inwardly, the pressure between the form roll A-351 and the distributor roll A-346 is decreased, and if bolt A-421 is screwed out, the pressure between the form roll A-351 and the distributor roll A-346 is increased, and when the desired pressure is achieved, the spring clip A-427, resting between two of the ratchet teeth of the ratchet wheel A-426, holds the bolt A-421 from further rotation. The spring A-425 holds the point of bolt A-421 against face A-422 on bracket A-413, and thereby maintains the desired pressure adjustment. Since the structure that holds each end of the shaft A-412 for the form roll A-351 is similarly constructed, it is thus possible to adjust the pressure between form roll A-351 and distributor roll A-346 so that it is uniform at each end, and therefore throughout the length of the two rollers, and so that the desired degree of pressure is attained between the two rollers.

The position of the brackets A-413 and the length of the hubs A-415 thereon is such that the form roll A-351 just fits snugly between the two hub members A-415 on the two brackets A-413, which thus secure the form roller A-351 and prevent it from moving from side to side, notwithstanding the fact that distributor roller A-346, with which it is in contact, is being oscillated as previously described. Since the hub members A-414 of brackets A-413 pivot about the center of the shaft A-340 of roller A-346, the form roll A-351 may thus be pivoted about roller A-346 without disturbing the adjustment between form roller A-351 and distributor roller A-346, which has been made as described above.

The brackets A-413 include an arm which extends downwardly and to the side, and ends in a pad A-428. There is another bolt A-429, having an integral ratchet toothed collar A-431, threaded through the pad A-428 and held in position by a spring clip A-432 in a manner similar to that just described with respect to bolt A-421. The point of bolt A-429 bears on the face of a bearing pad A-433 integral with the side frame A-333. There is a spring pin A-434 in the arm of the bracket A-413 and a spring pin A-435 on the inner face of the frame A-333. A spring A-436 connects the two spring pins A-434 and A-435 and acts to hold the point of bolt A-429 against the bearing pad A-433. As the bolt A-429 is screwed inwardly, it lifts the pad A-428 at the outer end of bracket A-413 causing the bracket to pivot on its hub A-414 about the center of distributor roll A-346, carrying form roll A-351 with it, and thereby increasing the distance between the center of form roll A-351 and the center of plate cylinder A-11, while not disturbing the adjustment between the form roll A-351 and distributor roll A-346. Conversely, when bolt A-429 is screwed out, the pad A-428 at the end of bracket A-413 is caused to move downwardly by the action of spring A-436, thus bringing the center of form roll A-351 closer to the center of plate cylinder A-11, again without disturbing the adjustment between form roller A-351 and distributor roll A-346. Spring A-436 is sufficiently strong and acts at all times to hold the point of bolt A-429 against the bearing pad A-433, and the spring clip A-432, resting between two of the ratchet teeth of ratchet ring A-431, holds the bolt A-429 in whatever position of adjustment it is placed in, so that, by adjusting bolt A-429, the pressure between the form roll A-351 and the surface of a plate carried on plate cylinder A-11 may be adjusted and maintained.

As previously stated, the brackets A-413 at either side of the module, which hold the two ends of form roll shaft A-412, are similarly constructed and similarly adjusted, so that the form roll A-351 may be adjusted to be parallel to the surface of a plate carried by plate cylinder A-11, and also adjust it to bear against the plate with the desired degree of pressure throughout its length, and this adjustment may be made independently of and without disturbing adjustment of the form roll A-351 to distributor roll A-346.

The other form roller A-352 and its shaft A-437 are similarly mounted and supported in brackets A-438 whose hubs A-439 also are mounted on the projections of bushings A-349, and the mechanism for adjusting form roller A-352 with respect to distributor roll A-346, and with respect to a plate on the surface of plate cylinder A-11, is the same as that described above with respect to the adjustment of form roll A-351 in relation to distributor roll A-346 and a plate on the surface of plate cylinder A-11.

The shaft A-89, on which idler gear A-37 is journalled, has two cam members A-446 pinned thereto at both sides of the module adjacent to the inner face of the frames A-333. The shaft A-89 then is journalled for rocking motion in bushings A-442 in the frames A-333, and there is a handle A-443 secured to the outer end of shaft A-89 which may be moved from its full line to its dotted line position and back again, as shown in FIG. 84, to rotate shaft A-89. There is a cam following roller A-444, mounted on a stud A-445 in bracket A-413 and bearing on cam A-446, and there is a cam follower roller A-447, mounted on stub A-448 in bracket A-438, and also bearing on cam A-446. In the position seen in FIG. 84, the surface of the cam A-446 below the two cam followers A-444 and A-447 is cut sufficiently low so that neither of the cam followers contacts the surface of the cam, and the point of the bolt A-429 rests on the bearing block A-433 under the action of spring A-436, and the corresponding condition exists with respect to the bracket A-438. As the handle A-443 is moved from its full line to its dotted line position, the cam A-446 is so shaped that it first contacts and then lifts the two cam follower rollers A-444 and A-447, thereby causing the two brackets A-413 and A-438 to be rotated outwardly about the center of shaft A-340, and thereby lifting the two form rollers A-351 and A-352 out of contact with a plate carried on plate cylinder A-11.

There are two slight depressions A-451 and A-452 on the surface of cam A-446, on its higher portion, and when the handle A-443 has reached the dotted line position seen in FIG. 84, the cam follower roll A-444 rests in depression A-451, and the cam follower A-447 rests in despression A-452, but the distance of the sufficient that the two form rollers A-351 and A-352 still remain out of contact with a plate on the surface of plate cylinder A-11. It will be noted that when the form rollers A-351 and A-352 are thus lifted out of contact with a plate on the surface of plate cylinder A-11, they are swung about the center of distributor roll A-346, and their adjustment with respect to distributor roll A-346 is unaffected.

There is also a pair of arms A-453 affixed to shaft A-89, on either side of the module each of which carries a pin A-454 at its outer end. Pin A-454 rides in a slot A-455 in a link member A-456, the other end of which is snugly fitted over a pin A-457 at the end of a rocking arm A-458 which is journalled about a spreader A-459 and which carries a lifter pad A-461. When the handle A-443 is moved from its full line position to its dotted line position, pin A-454 first passes to the left along A-455 and then engages the left-hand end of slot A-455 and thereafter forces link A-456 to the left, causing rocking arm member A-458 to be rotated in a clockwise direction, thereby causing lifter pad A-461 to be moved to the left and slightly upwardly. The purpose of lifter paid A-461 is to lift a third form roller in an auxiliary ink attachment, which will be illustrated and described hereinafter, out of contact with the surface of a plate on plate cylinder A-11 whenever form rolls A-351 and A-352 are so lifted.

It will be noted that of the four bolts that must be reached at each side of the module to accomplish the adjustment of both form rolls with respect to both the distributor roll A-346 and the surface of a plate carried by plate cylinder A-11, three of the bolts are easily accessible from outside the frames A-333 of the module, and there is a slot A-462 in each of the frames A-333 to provide easy access to the other adjusting bolt A-421, from the outside of the two frames.

INK/DAMPENING MODULE

FIGS. 88, 89, 90 and 91 illustrate how the similar rollers of the ink module, or ink/dampening module, are similarly mounted and adjusted. It should be noted, as previously set forth, that the identical ink rollers are used in both the plate cylinder module and the ink module, but that the arrangement of the rollers in the ink module is a mirror image of their arrangement in the plate cylinder module, since the direction of rotation of the plate cylinder which the ink form rollers of the plate cylinder module contact is the reverse of the direction of rotation of the large printing cylinder which the ink form rollers of the inking module contact.

FIGS. 88 and 89 illustrate an inking module generally designated BB-3 to which a dampening attachment may be added to create an ink dampening module. This inking module BB-3 is mounted, as previously described, at one of the module mounting positions on the main press frames 31, 33, for the purpose of inking the surface of a printing plate mounted in one of the work areas of large printing cylinder 22.

By constructing the frames B-158 of the inking module BB-3 so that the arrangement of the ink rollers therein is a mirror image of their arrangement in the plate cylinder module, it is possible to use the great majority of all the other components, in addition to the ink rollers, interchangeably between the ink module and the plate cylinder module. However, since the diameter of the large printing cylinder 22 on the 2R model is twice the diameter of the plate cylinder, the brackets for mounting the form rollers are different on the inking module from those used for the similar purpose on the plate cylinder module. This difference lies entirely in the shape of these brackets, and the principle by which the form rolls are mounted and adjusted with respect to the distributor roller, and by means of which they are separately and independently adjusted with respect to a plate carried on a plate segment in one of the work areas of the large printing cylinder 22, is the same as the principle involved in similarly mounting and adjusting the form rollers of the plate cylinder module with respect to a plate mounted on the plate cylinder.

Since the parts which make up the inking module shown in FIGS. 88, 89, 90 and 91 are in many cases identical to, and in all cases similar to their counterparts in the plate cylinder module illustrated and described in FIGS. 82, 83, 84, 85, 86 and 87, such parts in FIGS. 88, 89, 90 and 91 have been given reference numbers similar to reference numbers asigned to their corresponding parts in FIGS. 82 through 87 whereever possible but using a prefix B. Thus, the form roller bracket B-413 in FIGS. 88 and 89 is the counterpart of the similar form roll bracket A-413 of FIGS. 82 through 87, and the spreader shaft B-459 of FIGS. 88, 89, 90 and 91 is the counterpart of the spreader bar A-459 of FIGS. 82 through 87. The identical rollers, such as distributor roller A-346, have been given the same number throughout FIGS. 82 through 91.

There is a cylindrical portion A-414 at one end of bracket B-413 which is journalled about bushing B-349, and the hub portion B-415 of bracket B-413 carries a flanged sleeve member B-418, which in turn has an eccentric hole therein which supports the shaft B-412 on form roller A-351. Similarly, adjusting bolt B-421 is threaded through the upwardly projecting arm B-419 of flanged sleeve member B-418 and the pointed end of bolt B-421 bears against the face B-422 of the projection of bracket B-413 and is held in contact therewith by the action of spring B-425, all in the manner described in connection with the comparable parts illustrated and described in FIGS. 82 through 87.

The two form rolls A-351 and A-352 are each mounted in supporting brackets B-413 and B-438, respectively, so that they each pivot about distributor roll A-346, with their relationship to distributor roll A-346 independently adjustable and unaffected by their being swung about the center of shaft B-340, all as previously described with respect to the structures of FIGS. 82 through 87. Similarly, the means by which the pressure with which each of the two form rolls A-351 and A-352 bears against the surface of a plate carried on a plate segment mounted in a work area of large printing cylinder 22 is controlled in a manner like that described with respect to the control of the pressure of the two form rollers of FIGS. 82 through 87 with respect to a plate mounted on the plate cylinder A-11. Specifically, spring B-436 acts to draw the bracket B-413, which carries form roller A-351, inwardly in a direction which will cause form roller A-351 to bear against the surface of a plate mounted in a work area of large printing cylinder 22, whereas bolt B-429, threaded through the outer end of the bracket B-413 and bearing on fixed pressure plate B-433, affixed to the frame 33, offsets the action of spring B-436 and allows the pressure to be regulated, controlled and maintained, all in the manner previously described.

Form roller A-352 is similarly supported and adjusted in bracket B-438, the upper hub portion B-439 of which is also rotatably mounted about bushing B-349, and as is seen in FIG. 89, the two hubs B-414 and B-439 of brackets B-413 and B-438, respectively, are retained on bushing B-349 by means of retaining ring B-430 which is an alternate and preferred structure to that illustrated in FIGS. 82 through 87. FIGS. 90 and 91 illustrate in somewhat more detail, the structure for lifting the two form rolls A-351 and A-352 out of contact with large printing cylinder 22 by means of the handle B-443. While the structure illustrated in FIGS. 90 and 91 is shown specifically as it relates to the inking module BB-3 of FIGS. 88 and 89, it also constitutes a more complete showing of the like structure of the plate cylinder module of FIGS. 82 through 87.

Shaft B-89 is journalled for rocking motion in the frames B-158 by means of bushings B-79. Idler gear B-37 is journalled to rotate about shaft B-89, as previously described, and is held in place laterally by thrust washers B-463 at opposite sides of the gear and by a collar B-464, which is held in position by taper pin B-465 on one side and by a collar B-466, which is held in position by taper pin B-467 on the other side.

Lifter cams B-446 are continguous to the inner faces of the frames B-158 and integral with the downwardly extending arms B-453 and also integral with hubs B-466, which in turn are affixed to shaft B-89 by means of taper pins B-467.

Shaft B-89 carries operating arm B-443 at its outer end, to which it is rigidly affixed through hub member B-468 so that, when handle B-443 is moved from its full line to its dotted line position as seen in FIG. 88, the cams B-446 lift the lifter follower rollers B-444 and B-447 mounted on the brackets B-413 and B-438, respectively, thereby causing form rollers A-351 and A-352, respectively, to be lifted out of contact with the surface of large printing cylinder 22.

As previously described in connection with the configuration illustrated in FIGS. 82 through 87, when handle B-443 is in its dotted line position, the lifter follower roll B-444 rests in the depression B-452 on cam B-446, and lifter follower roll B-447 rests in depression B-452 on cam B-446. When shaft B-89 is rocked in a counterclockwise direction, as seen in FIGS. 88 and 90, the arms B-453 at either end of the shaft are similarly rocked causing pin B-454 at the end of arm B-453 to first move to the right in slot B-455 and then to contact the right-hand end of that slot, and then to cause link B-456 to move to the right, thereby rocking arm B-458 through pin B-457,and thereby rocking the cam member B-461 which is integral with arm B-458, and both of which are journalled for rocking motion about spreader bar B-459.

The two arms B-458, together with their integral cams B-461 at either side of the module, are held in position laterally by means of a spacer B-471 between the face of the adjacent frame and the face of cam B-461, on the one side, and by a collar B-472 pinned to spreader bar shaft B-459 by means of a taper pin B-473, on the other side.

When thus rotated, cam B-461 acts to lift the bracket which carries a third ink form roller in an auxiliary ink attachment, which will be illustrated and described in detail hereafter.

As is illustrated and described in detail elsewhere herein, separate and independent means are provided for automatically lifting the form rolls of the ink module out of contact with a selected work area or areas of large printing cylinder 22, while allowing them to roll in contact with a plate mounted in another work area of large printing cylinder 22. This is accomplished by the interaction of cam follower discs, selectively mounted on the hubs at either end of the form rolls, with lifter cams mounted at the ends of a segment or segments carried in the work areas of large printing cylinder 22.

It should be noted that the means for lifting the form rollers manually, by means of handle B-443, lifts the form rollers out of contact with all surfaces of large printing cylinder 22, or when they are dropped manually by handle B-443 leaves them in position to contact any surface in any work area of large printing cylinder 22, from which they are not then lifted automatically by means of the lifter cams and cam follower discs on the segments and form rollers themselves, as described elsewhere herein.

It should also be noted that the means by which the form rollers are mounted so that they may be independently adjusted and maintained in position in relation to the pressure with which they bear against distributor roller A-346, while still leaving each form roll free to swing about the center of its adjacent distributor roller without disturbing such adjustment, makes it possible to provide both the manual means for lifting and dropping the form rollers, as illustrated and described in connection with FIGS. 88, 89, 90 and 91, while also making it possible to lift selective form rollers in selected inking modules out of contact with the surface of selected work areas of large printing cylinder 22, automatically, as the machine runs, in the manner described in detail elsewhere herein.

The drive for the distributor rollers of the inking module is similar to that previously illustrated and described for the distributor rollers of the plate cylinder module, except that in this case the idler gear B-37 meshes with and is driven by the inner gear 41 (of the two large gears on large printing cylinder 22). Idler gear B-37 in turn drives gear B-348, on distributor A-346, which in turn drives idler B-368, which drives gear B-376 on distributor A-344, with all of this mechanism being a mirror image of that illustrated and described in the plate cylinder module.

HARD AND SOFT ROLLERS

FIG. 92 shows the arrangement of the soft distributor rollers to the hard distributor rollers as seen in a plate cylinder module, and their arrangement in an inking module would be an exact mirror imate of the arrangement seen in FIG. 92. As seen in this Figure, the frames A-333 of the plate cylinder module support the plate cylinder A-11 which rotates about shaft A-44 which is supported in the frames A-333 by eccentric end portions A-45, as previously described. The hard ink distributors A-346 and A-344 are secured to their shafts A-340 and A-377, respectively, which are in turn journalled in the frames A-333 and are driven and caused to oscilate in the manner previously illustrated and described.

The basic inking unit also includes a soft distributor roll A-345 integral with its shaft A-358 which nests between hard distributors A-344 and A-346. Also, included in the basic inking system are two soft ink idler rollers, A-347 which rests in contact with hard distributor A-346, and A-343 which rests in contact with hard distributor A-344. The means by which these rollers are mounted and held in position are illustrated in more detail in FIGS. 93, 94, 95 and 96. FIG. 92 illustrates two rollers which are a part of the supplemental ink system, these being hard ink distributor roller A-363 with its shaft A-373, and soft ink distributor A-365 together with its shaft A-463. These rollers are shown here because there is a similarity between the manner in which soft rollers A-347 and A-343 of the basic inking system are mounted and the manner in which soft roller A-365 of the supplemental inking system is mounted, as will be described in more detail.

ADJUSTMENT AND REMOVAL OF ROLLERS

Referring now to FIGS. 92, 93 and 94, soft distributor roll A-345 nest between the two hard distributors A-346 and A-344, and is held in nesting relationship between these two hard ink distributors in a manner which allows for the quick and easy removal of the roller A-345, and which provides for the adjustment of the pressure with which roller A-345 bears against hard distributors A-346 and A-344, between which it nests, and which holds roller A-345 in this position with uniform pressure between hard distributors A-346 and A-344, irrespective of the position in which the module of which it forms a part may be mounted, and irrespective also of whether this be a plate cylinder module or an inking module. Shaft A-358 is integral with roller A-345 and projects beyond the roller at either end thereof. Each end of shaft A-358 is journalled in a flanged bushing A-464 which is retained on shaft A-358 by means of retaining ring A-465. There is also a thrust washer A-466 between each face of rollers A-345 and flanged bushing A-464.

There are flats A-467 milled on the sides of each of the flanged bushings A-464, and these flats fit loosely into a sliding support member A-468. The flanged bushings A-464 are then retained within the sliding support member A-468 by pivoted arm A-469 which pivots about pin A-471 over the outer surface of bushing A-464, and thumb screw A-472 is then tightened into the opposite arm of sliding support member A-468 to captivate the bushing A-464. Each sliding support A-468 is in turn held in sliding position within the projecting arms of fixed bracket A-473 secured to one of the side frames A-333. Retainers A-474 retain the sliding member A-468 within the projecting arms of fixed bracket A-473. At the bottom of sliding member A-468 there is a hole A-475 to which one end of a spring A-476 is secured, with the other end of the spring being secured in a hole A-477 in a tensioning bracket A-478 which surrounds spreader A-334 and is free to move back and forth on spreader A-334 within limits of slot A-481 in the tensioning bracket A-478, A thumb screw A-482 projects through a hole in a fixed bracket A-483, which is secured to the frame A-333, and is threaded into an angular projection A-484 at the outer end of tensioning bracket A-478.

When thumb screw A-482 is loosened, the tension on spring A-476 is relaxed, the slide member A-468 is free to slide to the left as seen in FIG. 93, and thus the pressure between roller A-345 and the hard distributors A-346 and A-344, between which it nests, is relaxed. In this state, thumb screw A-472 may be unscrewed, retaining arm A-469 swung out of the way about pivot pin A-471, and roller A-345 may then be removed by sliding the flanged bushings A-464 out of the sliding support member A-468. The retaining rings A-465 act to hold the flanged bushings A-464 on either end of shaft A-358 after the roller has been removed. The roller A-345 may be replaced by reversing the procedure, and after thumb screw A-472 has been tightened and the flanged bushing-captivated within the sliding support member A-468, thumb screws A-482 may then be tightened to take up a spring A-476 and apply the desired pressure between the soft distributor roll A-345 and the two hard distributor rolls A-346 and A-344 between which it nests.

FIGS. 92, 95 and 96 illustrate the manner in which the soft idler distributor rollers A-347 and A-343 are retained in contract with the hard distributors A-346 and A-344 with which they roll in contact, respectively. FIGS. 95 and 96 show the mounting of roller A-343 in relation to hard distributor A-344, and the mounting of soft roller A-347 with respect to hard roller A-346 is similar. Shaft A-385 is integral with soft roller A-343 and projects beyond the body of the soft roller A-343 at either end. On either end of shaft A-485 there is a flanged bushing A-486 with flats A-487 milled on either side thereof. Each bushing A-486 is spaced from roller A-343 by a thrust washer A-488 and retained on shaft A-485 by retainer rings A-489. A mounting bracket A-491 is secured to each of the main frames A-333 and includes projecting fingers A-492 into which the flats A-487 of flange bushing A-486 fit loosely.

Brackets A-491 are secured to the frames A-333 oriented in such a manner that, when the flanged bushing A-486 slides within the fingers A-492 of bracket A-491, the center of shaft A-485 of roller A-343 moves directly toward or away from the center of shaft A-377 of roller A-344. Bracket A-491 also comprises an outwardly projecting portion A-493 about which a pivoted arm A-494 is mounted on pivot pin A-495. A pressure pad A-496, whose inner face is curved to fit the contour of bushing A-486, is secured to a pin A-497 which passes through a hole in pivoted arm A-494, and is retained in position by a head A-498 which is integral with pin A-497. There is a spring member A-499 between the inner face of pivoted arm A-494 and the outer surface of pressure plate A-496.

Thumb screw A-501 is passed through hole A-502 in pivoted arm A-494 and threaded into hole A-503 in bracket A-491. It may be tightened to apply pressure to spring A-499, thereby controlling the pressure with which roll A-343 bears against adjacent hard roller A-344. Since there is a similar arrangement at either end of roller A-343, the pressure between soft roller A-343 and hard roller A-344 may be adjusted to be uniform through-out its length and the degree of pressure may be controlled. Also, the pressure with which roller A-343 bears against roller A-344 may be controlled independently of the position in which the module of which it forms a part is mounted, and irrespective of whether it be a plate cylinder module or an inking module. The roller may be removed by removing the thumb screws A-501 and pivoting the arm A-494 up to provide clearance so that the bushings A-486 may be slid out of the fingers A-492 of brackets A-491. The retaining rings A-489 retain the bushings A-486 at either end of shaft A-485 while the roller is removed. The roller may be replaced by reversing the process. Similar means retain soft roller A-347 in rolling contact with hard distributor A-346.

Referring again to FIG. 92, when the supplemental ink system is also furnished, it includes hard ink distributor A-363 which is integral with its shaft A-373, and the soft bridging distributor roller A-365 integral with its shaft A-463. The mounting brackets A-504 for soft roller A-365, which correspond to the mounting brackets A-491 for soft roller A-343, instead of being secured to the frames A-333 in a fixed position, are mounted to pivot about the shaft A-373 of hard distributor A-363, and may be secured in the position shown in FIG. 92 or released to pivot about the center of shaft A-373, so that both soft roller A-365 and its supporting brackets A-504 are swung out of the way to provide access for the removal or insertion of roller A-345.

When the mounting brackets A-504 for roller A-365 are secured in the position shown in FIG. 92, they secure roller A-365 in nesting engagement between hard roller A-363 and soft roller A-345. The details of the mechanism by which this is accomplished are similar to that illustrated and described in FIGS. 95 and 96 for securing soft roll A-343 in relation to hard roll A-344, there being, however, slightly more play between the bushings on the ends of shaft A-463 and the projecting fingers of bracket A-504 so that roller A-365 may be free to locate itself in nesting engagement with both hard roller A-363 and soft roller A-345.

AUXILIARY INK ATTACHMENT

As in the basic inking system, the auxiliary ink system, as applied to the plate cylinder module of FIG. 97, is a mirror image of the auxiliary ink system as applied to the ink module of FIG. 98, the only difference being that the angle at which the upwardly projecting arm A-505 attached to the basic form roll bracket A-506 in FIG. 98 is different from the angle at which the similar upwardly projecting arm A-505 attaches to the basic form roll bracket A-506 of FIG. 97. The difference is to accomplish the mounting of the form roller A-371 in the proper position in relation to the smaller plate cylinder A-11 in the FIG. 97 configuration and in relation to the large printing cylinder 22 in the FIG. 98 configuration. FIG. 97 is viewed from the right side of the press and FIG. 98 is viewed from the left side of the press. For purposes of clarity, certain items that are adequately illustrated in FIG. 97 and FIG. 98, and in more detail elsewhere herein, are omitted from FIG. 99.

The auxiliary ink attachment, as seen in FIGS. 97 through 100 comprises six rollers including bridging roller A-365 which is a soft ink roller, a hard oscillating ink distributor A-363, two soft ink distributors A-366 and A-367, another hard oscillating distributor A-364, and the form roller A-371. As has previously been pointed out, when the auxiliary ink attachment is used, form roller A-371 becomes the last roll to contact the plate, on either the plate cylinder A-11 as seen in FIG. 97, or on a segment carried in a work area of large printing cylinder 22, as seen in FIG. 98. Also, as has previously been pointed out, the number of nips between adjacent ink rollers through which the ink must pass in moving from the ink fountain to ink form roller A-371 is greater than the number of nips between adjacent ink rollers through which the ink must pass to reach either of the two ink form rollers of the basic ink system. Thus, the ink applied to the plate by the last ink form roll to contact it, form roll A-371, has been more thoroughly milled and more uniformly and smoothly distributed than the ink applied to the plate by the two form rolls of the basic ink system. Thus, the ink applied by form roller A-371 not only adds to the ink previously applied to the image, but aids in assuring that the image has been uniformly and smoothly inked as possible before the ink from the image on the plate is in turn transferred to an offset blanket.

The hard oscillating ink distributor roll A-363 is securely affixed to its shaft A-373 and this shaft is journalled in bushings A-509 in the main frames A-333 or B-158, respectively, of the configurations shown in FIGS. 97 and 98. Bushings A-509 extend inwardly along shaft A-373 from the module frames, and the frames A-372 of the auxiliary ink attachment are supported by their hub portions A-511 about the outer diameter of bushings A-509.

The two frames A-372 of the auxiliary ink attachment are held in rigid spaced relationship to each other by means of three spreaders A-512, A-513 and A-514. The entire frame structure thus formed may be pivoted about the bushings A-509 about the center of shaft A-373, as previously described. In normal operation the frame structure is secured to the frames A-333 or B-158, respectively, in the positions shown in FIGS. 97 and 98, respectively, by means not shown in these Figures.

The hard ink oscillators A-363 and A-364 are gear driven, in the direction shown. A pinion A-515 is journalled on a stud A-516 in the frame on the right-hand side of the press, and pinion A-515 meshes with gear A-348 which is integral with the ink oscillator A-346 of the basic inking system, whose drive has been illustrated and described elsewhere herein.

There is a gear A-518 integral with hard oscillating ink roller A-363, both of which are rigidly secured to shaft A-373, and this gear in turn meshes with a pinion A-519 journalled on spreader A-512. Pinion A-519 in turn meshes with another pinion A-521 which is journalled on a stud A-522 in the right-hand frame of the auxiliary ink attachment. Pinion A-521 in turn meshes with gear A-523, which is integral with the hard oscillating ink roller A-364, both of which are journalled to turn about spreader shaft A-513. When the frame structure comprising auxiliary ink attachment frames A-372 and associated spreaders is secured in the position shown in FIG. 97 and 98, pinion A-519 meshes with pinion A-515, and is driven thereby, and transmits the drive to the hard oscillators A-363 and A-364. When the auxiliary ink attachment is pivoted upwardly about shaft A-373, as previously described, and as seen in FIG. 72, pinion A-519 is separated from pinion A-515, and the drive is not transmitted through the rollers of the auxiliary in attachment when it is thus swung into an upward position. When it is again returned and secured in the operative position, as shown in FIGS. 97 and 98, pinion A-519 again meshes with pinion A-515 and the rollers of the auxiliary ink attachment are driven as described.

The soft idling distributor roll A-365, which acts as a bridging roll with the basic ink system, and the two soft idlers A-366 and A-367 are mounted in the positions shown, and secured therein, by means similar to that previously described with respect to the soft idler rollers of the basic inking system. The brackets A-504 which support the bridging roller A-365 as has previously been described, also pivot about the bushings A-509, and when the bridging roller A-365 is in operative portion, the brackets A-504 are held in the position shown in FIG. 97 by means of bolts (not shown) which pass through the slots A-524 in the ears A-525 which form part of the brackets A-504, and are threaded into holes in the main frames A-333 or B-158.

The mounting for the form roller A-371, which is journalled about shaft A-526, is similar to that previously illustrated and described with respect to the mounting of the form rolls of the basic inking system. The ends of the shaft A-526 are held in eccentric sleeves A-527 which are in turn supported in the bore A-528 in the hubs A-506 of the form roll supporting brackets A-505. The form roll brackets A-505 in turn pivot about spreader Shaft A-513 by being rotationally mounted about bushings A-531 which are pressed into the hub portions A-532 of frames A-372. The bushings A-531 and shaft A-513 are pinned in place in the frames A-372 by means of taper pins A-533.

PRESSURE ADJUSTMENT

The pressure of the form roller A-371 against the oscillating distributor roll A-364 is adjustably secured and maintained, as described with respect to the similar adjustment for the form rolls of the basic inking system, by means of springs A-534, one end of which is secured to spring pin A-535 in the form roll brackets A-505, and the other end of which is secured to spring pin A-536 in the outwardly projecting arms A-537 of the eccentric sleeves A-527, which carry the ends of the shaft A-526 about which the form roll A-371 is journalled. Bolts A-538 carried in the arms A-537 bear against the face A-539 of the brackets A-505 and maintains the desired degree of pressure by means described heretofore. Similarly, since the form roll brackets A-505 may rotate about the bushings A-531 on which their hub portion A-529 is mounted, the form roll A-371 may be rotated about the oscillating roll A-364 without disturbing the adjustment of the pressure between form roll A-371 and distributor roll A-364.

The pressure between form roll A-371 and a plate carried on plate cylinder A-11, or on large printing cylinder 22, as the case may be, may be adjusted and maintained by means similar to that described with respect to the form rolls of the basic inking system. Specifically, in this case, springs A-541 are secured to spring pin A-542 in frames A-372 and to spring pin A-543 in form roll brackets A-505 and act to urge the form roll A-372 against the surface of a plate on the surface of plate cylinder A-11 of FIG. 97, or carried in a work area of large printing cylinder 22 in FIG. 98. The degree of pressure with which form roll A-371 bears against the surface of such a plate is adjustable and is controlled and secured by means of bolts A-544 which are threaded through rectangular bosses A-545 of frames A-372 and bear against the faces A-546 of the form roll brackets A-505. The bolts A-544 have an integral ratchet collar A-547 and are held in any given position of adjustment by means of spring clips A-548 which are secured to the bosses A-545 and seat between a pair of the ratchet teeth of the ratchet wheel A-547, the construction being similar to that previously illustrated and described with respect to the similar adjustment to the form rolls of the basic inking system.

The lifter pads A-549 of the form roll brackets A-505 are adjacent to the cams B-461 previously described in connection with the manual raising and lowering of the form rolls, and the pressure exerted by cams B-461 of FIG. 90 against the lifter pads A-549 acts to rock the form roll bracket A-505 in a counterclockwise direction about the bushing A-531, thereby lifting form roll A-371 out of contact with the plate with which it normally rolls in contact.

OSCILLATION OF ROLLERS

FIG. 99 and 100 illustrate the means by which the two hard oscillating distributors A-363 and A-364 caused to oscillate or move from side to side, in opposite phase with each other. Oscillating distributor A-363 and its gear A-518 are secured to shaft A-373 as has previously been described and are journalled in bushings A-509 in the frames A-333. At the outer end of shaft A-373 there is a flanged yoke member A-392 secured to shaft A-373 and by means of which the shaft A-373, distributor roller A-363 and gear A-518 are caused to oscillate or move from side to side, as has been illustrated and described in FIG. 83.

At the opposite end of distributor roll A-363 from the gear A-518, there is another flanged yoke A-552 secured to shaft A-373 and to roller A-363. The right-hand frame A-372, as seen in FIGS. 99 and 100 includes an integral pivot support member A-553 about which a rocker arm A-554 is pivoted at pivot A-555. Rocker arm A-554 carries a cam follower A-556 at one end thereof which is engaged within the flanged yoke member A-552, and a similar cam follower A-557 secured to its other end. Follower A-557 is engaged within another flanged yoke member A-558 which is secured to distributor roller A-364. Gear A-523 at one end of roller A-364 and flanged yoke member A-558 at the other end of roller A-364 are both integral with distributor roller A-364, and are journalled as a unit for rotational and sliding movement about spreader shaft A-513. Thus, as shaft A-373 is caused to oscillate by means of the external mechanism, previously described, acting upon flanged yoke A-392, the oscillating motion thus imparted to distributor roller A-363 and flanged yoke A-552 is transmitted by means of rocker arm A-554 to the flanged yoke A-558 on distributor roll A-364, which is thus caused to oscillate by an equal amount, but in an opposite phase, from distributor roll A-363; so that, when roller A-363 is at the right end of its oscillating stroke, distributor roll A-364 is at the left end of its stroke, and vice versa.

With reference to FIGS. 98 and 99, it will be noted that the mounting of form roller A-371 is such that cam follower discs may be positioned on the hubs of form roller A-371 and that form roller A-371 may thus be automatically lifted out of contact with any desired work area of large printing cylinder 22 by affixing lifter cams to the ends of a segment mounted in such work area, which lifter cams are in alignment with the cam-following discs carried at the ends of form roller A-371. In this case the lifter cam working in cooperation with the cam-follower discs, cause form roll A-371 to be automatically lifted out of contact with any such work area of large printing cylinder 22, and form roller A-371 swung about distributor roll A-364 without disturbing its adjustment with respect thereto.

This is accomplished without interference with the ability to manually lift form rollers A-371, along with the form rollers of the basic inking systems, out of contact with all work areas of large printing cylinder 22 whenever desired.

It will also be noted that the construction of the auxiliary ink attachment is such that it may be swung upwardly in a counterclockwise direction, as seen in either FIGS. 97 or 98, to provide access to either the plate cylinder A-11 or the large printing cylinder 22, and to provide access to the innermost form roller of the basic inking system. Form roll A-371 may also be removed by withdrawing shaft A-526, and when replaced the adjustments of form roll A-371 with distributor A-364, and with the plate, will not have been disturbed.

It should also be noted that the structure of the basic inking system and of the auxiliary ink attachment in both the plate cylinder modules and the inking modules is such that any of the modules may be furnished with only the basic inking system, whenever the application involved is such that the basic inking system thus provided is adequate initially, and the auxiliary ink attachment may be added at a later time if the application develops to the point where such an inking system is required.

While auxiliary ink attachments, as such, are widely offered and used, their construction and the construction of the basic inking systems to which they are attached are generally such that they only accomplish the provision of additional milling rollers to the basic inking system, and do not accomplish the addition of an additional form roll with a separate longer path to that form roll, and with the added form roll being the last roller to contact the plate on each revolution.

DAMPENING ATTACHMENT

As has previously been pointed out, the inking module for use with large printing cylinder 22 may be used for letter press printing, or imprinting, in which no dampening is required. It is also contemplated that "dry offset" or "letter set" plates, in which the image area is raised with respect to the non-image area, may be used on either the plate cylinder, or cylinders, or on a segment carried in a work area of the large printing cylinder, and in either of these cases no dampening is required. It is also contemplated that recently developed lithographic inks for use with planographic lithographic plates may be used, wherein the ink, or compound, distributed by the inking rollers is of such nature that it will adhere only to the image areas and not to the non-imate areas of the planographic lithographic plate, and therefore no dampening is required. For these reasons, the dampening system both for the plate cylinder module and the ining module is, in each case, made as an attachment which may be furnished, or not, as the requirements of the applicate dictate.

Because of the differences in the geometry created by the fact that the large printing cylinder 22 is at least twice the diameter of the plate cylinder A-11, the dampening attachment shown in FIG. 102 for use with the inking module is not an exact mirror image of the dampening attachment shown in FIG. 101 for use with the plate cylinder module. Nevertheless, the rollers are the same and the fountain tray, gears and many of the other parts are similar in both attachments, and the basic operation is the same in both cases.

In both FIGS. 101 and 102, the dampening attachment is shown as seen from the left-hand side of the press.

As seen in FIG. 101, the rotation of the plate cylinder A-11 is counterclockwise, and as seen in FIG. 102 the rotation of large printing cylinder 22 is clockwise, and in both cases the dampening form roller is the first form roller to contact the plate.

The frames A-353 of the dampening attachment for the plate cylinder module are bolted to the frames A-333 of the plate cylinder module itself by means of two bolts A-561 for each of the frames A-353, and, in addition, there are two spreaders A-562 and A-563 which hold the frames A-353 in rigid spaced relationship to each other. There are inwardly projecting ears A-564 on each of the frames A-353 which, in turn, are jointed together by another spreader bar A-565, on which is journalled a gear A-566 which meshes with the gear 62 on the plate cylinder A-11.

In the configuration seen in FIG. 102, the similar frames B-121 for the dampening attachment B-117 for the inking module are held in rigid spaced relationship to each other by spreaders B-147, B-148 and B-149. In this configuration, there are similar ears B-151 on each of the frames B-121, which are joined together by spreader B-149 on which pinion gear B-152 is journalled. As illustrated and described elsewhere herein, the dampening attachment for the inking module of FIG. 102 is constructed so that it may be pivoted about studs B-124 in the frames of the inking module. An ear B-128 of each of the frames B-121 is journalled about one of the studs B-124.

When in operative position, as seen in FIG. 102, the dampening attachment is also secured to the frames of the inking module by means of bolts B-129 in each of the frames B-121 which secures the dampening attachment frame in fixed relation to the inking module frame. When in this position, and so secured, pinion gear B-152 meshes with and is driven by the gear 41 of large printing cylinder 22. Form roll A-361 may be removed by withdrawing shaft B-138, and when bolts B-129 are removed, the entire dampening attachment may be pivoted about studs B-124 disengaging pinion B-152 from the large printing cylinder gear 41 and allowing the entire dampening attachment to be swung away from the inking module as seen in FIG. 72.

In all other respects the dampening attachment for the plate cylinder module, as shown in FIG. 101, and the dampening attachment for the inking module, as shown in FIG. 102, are functionally and operationally the same, and therefore the description of the function and operation of the dampening attachment which follows will refer only to FIG. 101, but the same description would apply to the function and operation of the dampening attachment, as shown in FIG. 102. For this reason also, the dampening attachment as shown in FIG. 101 is shown in more detail, and the similar attachment as shown in FIG. 102 is shown somewhat more diagrammatically.

As seen in FIG. 101, the dampening fountain tray A-354 is held in position beneath the dampening fountain roller A-355, and the level of the dampening fluid in the dampening fountain tray A-354 is maintained by means which are illustrated and described in greater detail in FIGS. 35 and 36. Regardless of the position in which the plate cylinder module or inking module may be secured, the dampening tray A-354 is mounted so that its top and bottom surfaces are horizontal. The phantom positions A-567 and A-568 illustrate the extremes of the positions in which the dampening fountain tray A-354 is mounted in relation to the dampening attachment frames A-353 to maintain the fountain tray A-354 in a horizontal position in all positions in which either plate cylinder modules or inking modules may be attached on both the 2R and 3R modes of the press.

DUCTOR, DISTRIBUTOR AND FOUNTAIN ROLLERS OF THE DAMPENING ATTACHMENT

The ductor roller A-356 is rocked about shaft A-568 and is in contact first with fountain roller A-355 and then with distributor roller A-357 to feed the dampening solution from the surface of dampening fountain roller A-355 to the surface of dampening distributor roller A-357. From there the dampening solution is fed to the surface of dampening form roller A-361 which also rolls in contact with the surface of the printing plate, thereby applying dampening solution to the surface of the plate. The dampening fountain roller A-355 and the dampening distributor roller A-357 are hard metallic rollers having either an aluminum or chrome plated surface. The doctor roller A-356 and dampening form roller A-361 each have a molleton cover over a relatively soft rubber roller. It is also contemplated that a paper cover may be used instead of a molleton cover on either the ductor roller A-356 or the dampening form roller A-361, or alternatively either may be an uncovered roller of the type commonly referred to as a "bareback" roller. Gear A-571 is integral with dampening distributor roll A-357 and both are secured to shaft A-572 which is journalled in the frames A-353. A flanged yoke of the type previously described may also be affixed to shaft A-572, and through it the dampening distributor roller A-357 may be caused to oscillate in the same manner previously described with respect to the oscillating ink distributor rollers.

The pitch diameter of gear A-571 is equal to the diameter of dampening distributor roll A-357, and gear A-571 meshes with the pinion A-566, which in turn also meshes with the gear 62 on the plate cylinder A-11, so that dampening distributor roll A-357 is driven in the direction shown, and its surface speed is equal to the surface speed of a plate mounted on plate cylinder A-11. At the far end of shaft A-572 there is a smaller gear A-573, secured on shaft A-572, which in turn meshes with a larger gear A-574 secured to the far end of shaft A-575, thereby causing shaft A-575 to rotate in the direction shown and at a much slower speed than shaft A-572. At the near end of shaft A-575, as seen in FIG. 101, there is a cam A-576 secured to shaft A-575.

The shaft A-577 of the dampening ductor roller A-356 is journalled in bushings A-578 on which flats A-579 have been milled and by means of which the bushings A-578 are held snugly in the arms A-581 of the mounting bracket which is secured to and pivots with shaft A-569. A spring clip A-582 pivots about pin A-583 and acts to hold the bushings A-578 securely in the arms A-581. There is an arm A-584, secured to the near end of shaft A-569, which carries at its outer end a cam follower roll A-585 journalled on stud A-586. A spring A-587 has one end secured to a spring pin A-588 in frame A-353 and the other end secured to a spring pin A-589 in the stud A-586 of arm A-584. Thus, spring A-587 acts to urge the cam follower A-585 against the face of cam A-576. As the cam A-576 revolves, when the cam follower roll A-585 is on the high portion of the cam A-576, the ductor roll A-356 is held in contact with the dampening distributor roll A-357. When the low portion of cam A-576 is in line with cam follower roll A-585, the ductor roller A-356 is held in contact with the surface of dampening fountain roller A-355 by the action of spring A-587 and cam follower roll A-585 does not, in fact, contact the low portion of cam A-576.

DAMPENING FOUNTAIN ROLLER CLUTCH OPERATION

There is a one-way clutch A-591 affixed to the near end of shaft A-592 of dampening fountain roller A-355. An arm A-593 is affixed to clutch A-591 in such a way that, when the arm A-593 is rotated in a counterclockwise direction, it acts through the clutch to also rotate shaft A-592 and fountain roller A-355 in a counterclockwise direction, whereas, when the arm A-593 is rotating in a clockwise direction, the clutch disengages and neither the shaft A-592 nor the fountain roller A-355 is rotated. There is also a friction brake (not shown) at the other end of shaft A-592 to prevent it from turning in a clockwise direction.

There is a pin A-594 at the end of arm A-593 to which is also secured one end of a link member A-595. At the other end of link member A-595 there is a slot A-596 in which rides a pin A-597 which extends outwardly from the outer face of cam A-576. There is a spring A-598, one end of which is secured to a spring pin A-599 in the frames A-353, and the other end of which is secured to pin A-594 in arm A-593. There is adjusting member A-601 pivoted about shaft A-592 between the frame A-353 and the clutch member A-591. There is an adjusting arm A-602 projecting outwardly from the adjusting member A-601 and which includes a spring loaded locking means (not shown) by means of which the adjusting arm A-602 may be secured at any position of adjustment between the two extremes representated by stops A-603 and A-604. Adjusting means A-601 also comprises an arm A-605 which carries an adjustable stop pin A-606 threaded through the arm A-605 and locked in position by a lock nut A-607. The spring A-598 urges the arm A-593 in a clockwise direction until the pin A-594 is engaged by the stop pin A-606. If the adjusting arm A-602 is rotated in clockwise direction until it is at the one extreme position A-604, the stop pin A-606 is moved out of the path of the pin A-594, and as the cam member A-576 rotates, the spring A-598 holds the link member A-595 in position so that the bottom portion of slot A-596 is held against pin A-597. In this position of adjustment, as pin A-597 moves upwardly, spring A-598 causes arm A-593 to rock upwardly to the full extent of the travel pin A-597. Then, as cam A-597 is moved downwardly, it acts against the bottom portion of slot A-596 in link A-595 to drive the link downward and thereby through pin A-594 causes arm A-593 to move in a counterclockwise direction to the full extent of the travel of the pin A-597, thus imparting a maximum counterclockwise rotation to fountain roller A-355 for each revolution of shaft A-575.

Conversely, if adjusting arm A-602 is moved in a counterclockwise direction to its extreme position of adjustment A-603, stop pin A-606 acts against pin A-594 and pulls the arm A-593 into an extreme clockwise position against the action of spring A-598 and holds it in this position. When held in this position, pin A-597 simply slides from one end of slot A-596 in link A-595 to the other as shaft A-575 and cam A-576 rotate, with the result that there is no motion imparted to arm A-593, and therefore dampening fountain roller A-355 remains stationary.

At various intermediate positions of adjusting arm A-602, pin A-597 acts to contact the bottom of slot A-596 and force link A-595 downward, always to the bottom of the stroke, thereby rotating arm A-593 in a counterclockwise direction and with it dampening fountain roller A-355. As pin A-597 moves upwardly, spring A-598 causes pin A-594 to follow it until pin A-594 is stopped by stop pin A-606, and from there on pin A-597 simply moves upwardly in slot A-596 in link A-595, and then on its downward strokes moves downward again in slot A-596 until it reaches the bottom of the slot, at which point it again drives link A-595 downwardly and drives pins A-594 away from stop pin A-606.

It will thus be apparent that, dependent upon the position in which adjusting arm A-602 is fixed, the amount of movement between stop pin A-606 and the extreme downward position to which pin A-594 is driven will be varied and therefore the amount of counterclockwise rotation imparted to the clutch A-591, and thereby to the shaft A-592 and the dampening fountain roller A-355 will be varied. Since adjusting arm A-602 may be positioned at any point between the two extremes A-603 and A-604, the amount of counterclockwise motion imparted to the dampening fountain roller A-355 on each revolution of shaft A-575 may be varied infinitely between zero movement and the amount represented by the total stroke of pin A-597.

DAMPENING FORM ROLL ADJUSTMENT

The form roll shaft A-611 is supported at either end in eccentric sleeve A-608 rotationally mounted in the hubs A-609 of form roll brackets A-612, which in turn are pivoted through hubs A-613 about bushings A-614 in which the shaft A-572 is journalled.

The pressure with which the dampening form roller A-361 bears against the dampening distributor roller A-357 is adjustably controlled through the control of the eccentric bushings A-608 in exactly the same manner illustrated and described with respect to the mounting of the ink form rollers. Thus, as the form roll brackets A-612 are pivoted about the bushing A-614, the form roll A-361 may be moved into and out of contact with a plate carried on plate cylinder A-11 or on large printing cylinder 22 without disturbing the adjustment between the dampening form roller A-361 and the distributor roller A-357.

The pressure with which the dampening form roller A-361 bears against the plate is similarly controlled by adjusting means at the end of arm A-615 of form roll bracket A-612 with spring A-616, between spring pin A-617 in frame A-353 and spring pin A-618 in arm A-615, acting to urge the form roller A-361 into contact with the plate, and with the pressure being adjusted and maintained in the same manner illustrated and described with respect to the similar adjustment of the pressure of the ink form rollers to the plate. The arms A-615 of the form roll brackets A-612 also carry a cam follower roller A-619, which is in alignment with a lifter cam A-621, on a shaft A-622 journalled in the frames A-353. The shaft A-622 may be rotated manually by means of a handle similar to that previously described and illustrated for manually lifting the ink form rollers, and, when so rotated, the cams A-621 contact the follower rolls A-619 and move the arms A-615 of the form roll bracket A-612 in a counterclockwise direction against the action of springs A-616, thereby manually lifting the dampening form roll A-361 out of contact with the plate.

As in the case of the similar ink form rollers, the dampening form roller A-361, as seen in FIG. 102, may also carry form roll lifter discs on the hubs at either end of the form roller in line with lifter cams carried at either end of a segment mounted in a work area of large printing cylinder 22, in the manner previously decribed. Thus, dampening form roller A-361 may be automatically lifted out of contact with selected work areas on large printing cylinder 22 and allowed to roll in contact with other selected work areas on large printing cylinder 22 in exactly the same manner previously described with respect to the ink form rollers. Notwithstanding the operation of such automatic means, dampening form roller A-361 may also be lifted manually, as described, so that it stays out of contact with any work area of large printing cylinder 22 while so lifted.

INK DUCTOR CONTROL MECHANISM

FIGS. 103, 104, 105, 106 and 107 illustrate the means by which cam shaft A-381 is driven so that it makes one-half revolution for each revolution of the large printing cylinder 22, or for each two revolutions of the plate cylinder A-11, and show the means by which the ink fountain roller A-56 is driven continually but at a much slower speed than the speed of cam shaft A-381.

These Figures illustrate a preferred construction with respect to the position in which the ink fountain A-60 and the ink fountain roller A-56 are mounted and with respect to the mounting and control of the ink ductor roll A-342. These five Figures illustrate a plate cylinder module, but exactly the same parts mounted in an arrangement which constitutes a mirror image of that seen in FIG. 103 constitutes the same mechanism as used in the inking module with the only other difference being that the pinion A-37 which drives gear A-348 on the oscillating distributor A-346 is driven by gear 62 on plate cylinder A-11 in FIG. 103, whereas in the comparable mechanism in the inking module the pinion B-37 meshes with and is driven by ring gear 41 on large printing cylinder 22.

In order not to obscure the ink ductor control mechanism, as seen in FIG. 103, the reduction gearing for driving the cam shaft A-381 is superimposed on this Figure in dotted line form to indicate its relative position. This mechanism is seen in more detail in FIGS. 104 and 105.

As has previously been described and illustrated, oscillating ink distributor A-346 is secured to its shaft A-340 and is integral with a gear A-348 which is driven by pinion A-37. At the left-hand end of shaft A-340, as seen in FIG. 104, there is another gear A-718 keyed to shaft A-340. Large gear A-623 and small gear A-624 are constructed as a single unit and together journalled on a stud A-625 secured in frame A-333. Gear A-718 meshes with and drives gear A-623 and since, as has already been illustrated and described, the shaft A-340, and gear A-718 with it are oscillating, the width of gear A-718 is such as to keep it in mesh with gear, A-623 throughout the extent of its oscillation.

Pinned to the outer end of cam shaft A-381 is a large gear A-626 wich meshes with gear A-624. The relationship of the size of the gears in this train is such that cam shaft A-381 is driven through one-half revolution for each revolution of large printing cylinder 22, or for each two revolutions of plate cylinder A-11.

Pinion A-37 meshes with the plate cylinder gear 62 which has 128 teeth, or pinion B-37 meshes with large printing cylinder gear 41 which in the 2R model has 256 teeth, or which on the 3R model has 384 teeth. Pinions A-37 and B-37 each have 20 teeth, and gear A-348 on oscillating distributor roll A-346, with which it meshes, has 48 teeth.

Gear A-718 at the left-hand end of shaft A-340 has 21 teeth, and gear A-623, with which it meshes, has 64 teeth. The small gear A-624, which is integral with gear A-623, has 20 teeth, and the gear A-626 affixed to the cam shaft A-381, with which gear A-624 meshes, has 70 teeth.

At the other end of shaft A-381, gear A-627 is pinned to shaft A-381, and gear A-627 having 32 teeth meshes with gear A-628 having 78 teeth. Gear A-628 is journalled on stud A-629 in frame A-333 and is integral with a sprocket A-631 having 17 teeth. Another sprocket A-632 on the shaft A-635 for the ink fountain roller A-56 has 25 teeth , and sprockets A-631 and A-632 are joined by a chain A-633 having 45 pitches. A chain tightener roll A-634 is provided to take up any slack in chain A-633. It will thus be seen that throughout this gear train that drives the cam shaft A-381 and then the ink fountain roller A-56, as in the case of the other gear trains previously illustrated and described, in both the inking modules and the plate cylinder modules, there are no two gears meshed together in which the number of teeth in one of the gears is evenly divisible into the number of teeth of the other. The purpose of this, as previously stated, is to prevent a pattern of wear from forming, as the gear teeth run together, which might then be transmitted into the inking and dampening system rollers and show up in the printed copy as what are known as "gear streaks".

Sprocket A-632 is affixed to one member of a one-way clutch, the other member of which is affixed to the shaft A-635 of the ink fountain roller A-56, with the clutch driving in such direction that when the press is turned, or runs under power, in a forward direction, the ink fountain roller is driven in a counterclockwise direction, as seen in FIG. 106, or in a clockwise direction as seen in FIG. 103. When the press is turned in reverse the clutch A-636 slips and the ink fountain roller A-56 is not driven.

The barrel cam A-382 which originates the oscillating motion in the various ink and dampening distributor rollers, as previously set forth and described in detail, is firmly affixed by being either pinned or keyed to the right end of shaft A-381. The force created by the barrel cam A-382 in operating the oscillating mechanisms, as previouslly described, creates a thrust load in first one direction, and then the other, on cam shaft A-381. Therefore, the cam shaft A-381 is journalled in the frame A-333 in a pair of angular contact ball bearings A-637 which carry both the radial and thrust loads.

The ink fountain roller A-56 is a hard roller which is driven continuously at a relatively slow speed, as described, and in the direction indicated. The end plates A-638 of the ink fountain A-60 fit snugly against the ends of roller A-56 and about the shaft A-635. The doctor blade A-639 is adjustable across its width by means of adjusting screws A-641, thus controlling the flow of ink that is carried around the surface of ink fountain roller A-56. The shaft A-635 of ink fountain roller A-56 is journalled in the two frames A-333 in two bushings A-642 and A-643. The bushing A-643 in the right-hand frame has an outside diameter larger than the outside diameter of ink fountain roller A-56, and is fitted into the right-hand frame with a slip fit so that it may be withdrawn and the ink fountain roll A-56 removed through the hole in the right-hand frame. The bushing A-643 is secured in place by means of washer A-644 which fits in a slot in the slip bushing A-643 and is held in place in frame A-333 by screw A-645.

At either end of the ink ductor roller A-342, there are bushings A-646 retained on the shaft A-647 by means of retaining rings A-648. Flats on bushings A-646 snugly between the arms A-649 of the U-shaped ink ductor bracket A-651, which is mounted to the rectangular ink ductor shaft A-652 by means of a pin A-653 at its center point, and about which it is free to pivot. At either end of the U-shaped ink ductor bracket A-651, there are two pins (shown at one end only in FIG. 104) A-654 which carry spring clips A-655 which snap over the top of the bushings A-646 to retain the bushings securely in the arms A-649. When the spring clips A-655 are swung out of engagement with the bushings A-646, the ink ductor roll may be removed from the arms A-649, but the bushings A-646 are nevertheless retained on the ductor roll shaft A-647 by the retaining rings A-648.

The two ends A-656 and A-657 of the rectangular ductor roll shaft A-652 are cylindrical in shape and are journalled in bushings A-658 and A-659 in the right and left-hand frames A-333, respectively. The bushing A-659 in the left-hand frame A-333 has an outside diameter larger than the diagonal of the rectangular ductor bar A-652 so that, when bushing A-659 is withdrawn, the ductor shaft A-652 may be withdrawn through the frame. Bushing A-659 is slotted and is retained in position by a washer A-661 held in place against frame A-333 by a screw A-662. The left-hand cylindrical end A-656 of shaft A-652 extends through and beyond the left-hand frame member A-333, and, immediately adjacent the outside face of frame A-333 there is an arm A-663 rigidly secured to the stub shaft A-656 by means of a taper pin A-664 which secures the hub of arm A-663 to the stub shaft A-656.

Beyond the hub of the arm A-663, there is a hub member A-665 journalled about stub shaft A-656, by means of bushing A-666, and which is retained on shaft A-656 by retaining ring A-667. This hub member A-665, which is free to rotate about the stub shaft A-656, has two arms, A-668 which projects upwardly, and A-669 which projects to the left, as seen in FIG. 103. Both of these arms A-668 and A-669 are integral with the hub member A-665 and with each other. The upwardly extending arm A-668 carries a spring pin A-671, and there is a spring A-672 connecting spring pin A-671 and arm A-668 with another spring pin A-673 in arm A-663.

There is also a stud A-674 secured in arm A-663 and in alignment with arm A-668 so that spring A-672 normally acts to keep the arm A-668 in contact with the stud A-674 in arm A-663. At the outer end of arm A-669, there is a spring pin A-675 to which is secured one end of a spring A-676, the other end of which is secured to a spring pin A-677 in frame A-333.

Pressed into frame A-333 about the left-hand end of shaft A-381 is a flanged bushing A-687, the inside diameter of which is larger than the portion of shaft A-381 which projects through it, and it therefore does not contact that portion of shaft A-381. There is a member A-679 which rests against the outer face of frame A-333 and whose hub is journalled on the outside diameter of flanged bushbing A-678, and which is retained between the outer face of frame A-333 and the inner face of the flange portion of flange bushing A-678. This member A-679 is thus free to rotate about the flanged bushing A-678 whose center is identical with the center of shaft A-381. There are two arms integral with member A-679, and one of these arms A-681 projects upwardly, as seen in FIG. 103, while the other arm A-682 projects to the left, as seen in this Figure. The arm A-682 forms the control lever for the ink ductor control mechanism. At its outer end, there are two ears A-683 which support a pivot pin A-684 about which a brake member A-685 is pivoted.

Arm A-682 may be moved up and down between the outer face of frame A-333 and the inner face of a calibrated plate A-686, which is held in position and spaced from frame A-333 by two mounting studs A-687 and A-688. At the outer end of brake member A-685, there is a pin A-689 secured thereto which projects through a larger hole A-691 in arm A-682 and about which a coil spring A-692 is secured. At the other end of member A-685, there is a brake shoe A-693, and the action of spring A-692 causes brake member A-685 to pivot about pivot pin A-684 and forces the brake shoe A-693 against the face of the calibrated plate A-686. The stud A-688, which forms a part of the mounting of plate A-686, also acts as a bottom stop for the adjustment of arm A-682 and the other mounting stud A-687 for calibrated plate A-686 similarly acts as a top stop for the adjustment of arm A-682. When the outer end of the brake member A-685 is squeezed against the arm A-682, the brake shoe A-693 is released from the face of the calibrated plate A-686 and the arm A-682 may be moved to any desired position along the calibrated scale A-694. The calibration A-694 acts to identify various positions of adjustment of the arm A-682.

The other, upwardly projecting arm A-681, of member A-679 carries a pivot stud A-695 secured therein about which is pivoted a rocking arm A-696 which carries at its outer end two cam follower rollers A-697 and A-698. There is a cam A-699, pinned to shaft A-381 by taper pin A-701 which passes through its hub. Cam A-699 is located betweeen the outer face of flanged bushing A-678 and the inner face of gear A-626. Cam A-699 therefore rotates in the counterclockwise direction indicated as cam shaft A-381 turns. There is a helical spring A-702 wrapped around stud A-695 in arm A-681, one end of which is secured to a spring pin A-703 in arm A-681, and the other end of which is secured to a spring pin A-704 in rocker arm A-696. Spring A-702 acts to urge rocker Arm A-696 in a counterclockwise direction, as seen in FIG. 103, and to hold cam follower A-698 in contact with the surface of cam A-699, as it rotates.

As cam follower A-698 rollows the surface of cam A-699 it lifts rocker arm A-696 and with it cam follower roller A-607. Cam follower roller A-697 is in alignment with arm A-669. When arm A-682 is in the "off" position, as seen in FIG. 103, cam follower roller A-697 is not lifted high enough to contact the bottom face of arm A-669, even when the cam follower roll A-698 is on the high part of cam A-699. Under these circumstances, spring A-676 acts to hold arm A-669 in the position shown in FIG. 103, and the face of arm A-668 is in contact with pin A-674 in arm A-663, and therefore the pressure exerted by spring A-676 holds the ink ductor roller A-342 in engagement with the adjacent ink distributor A-343.

The ink ductor roller A-342 and ink distributor A-343 are both soft rollers, and ink distributor A-343 is held in contact wtih the hard oscillating ink distributor A-344 by means mountings for its shaft ends A-705 in the brackets A-706. The detail of this mounting is the same as that previously illustrated and described for the mounting of other similar soft ink distributors held in contact with hard oscillating ink distributors and is therefore not shown in detail in these Figures.

OPERATION OF INK DUCTOR CONTROL

When adjusting lever A-682 is moved upwardly so that the arrow above brake shoe member A-693 is in line with oen of the calibrations A-694 on the calibrated scale plate A-686, the action of cam A-699 in lifting cam follower roller A-698 and rocker arm A-696 is such as to lift cam follower roll A-697 into contact with the bottom face of arm A-669 and to lift arm A-669, thereby rocking arm A-668 to the right. When this occurs, spring A-672 holds pin A-674 in contact with the face of arm A-668, causing arm A-663 and with it the shaft A-652 and the ink ductor roll A-342 to rock in a clockwise direction until ductor roll A-342 contacts the ink fountain roller A-56. If, after this has happened, arm A-669 is lifted still further, and arm A-668 is therefore rocked further to th right, the face of the arm a-668 then moves away from pin A-674, and the spring A-672, acting through pin A-673 in arm A-663, holds the ductor roll A-342 in contact with ink fountain roller A-56.

When the arrow on the brake shoe A-693 is opposite the lowest calibration on the calibrated scale A-694, cam follower roll A-697 is lifted just enough to cause ductor roll A-342 to contact ink fountain roller A-56 for an extremely short interval of time, after which follower A-697 moves downwardly and spring A-676 causes arm A-669 to follow it down, moving arm A-668 to the left, and the face of arm A-668 bears against pin A-674 and moves the ink ductor A-342 back into the position seen in FIG. 103, in which it is in contact with ink distributor roll A-343.

As the adjusting arm A-682 is moved up the calibrated scale A-694 to successive points thereon, the pin A-695, about which arem A-696 pivots, is thereby moved into positions such that the action of cam A-699 on follower. A-698 causes follower A-697 to lift arm A-669 higher, and hole it up for a longer period of time, so that arm A-668 moves to the right, first to the point where ductor A-342 contacts ink fountain roller A-56, and then, as arm A-669 is lifted higher, arm A-668 moves farther to the right, disengaging itself from pin A-674 amd causing spring A-672 to be extended, and through the action of spring A-672 holding the ductor A-342 in contact with ink fountain roller A-56 for longer periods of time.

The top position on calibrated scale A-694 on plate A-686 represents a position of adjustment for arm A-682 in which the ink ductor roll A-342 is held in contact with ink fountain roller A-56 for more than half the revolution of cam A-699, and is in contact with distributor roll A-343 for approximately one-third the revolution of cam A-699. Intermediate points on the calibrated scale A-694 represent varying periods of contact between ductor roll A-342 and ink fountain roller A-56. Since the adjusting arm A-682 may be placed at any one of the calibrated positions, or at any point between within the range of adjustment between the two extremes the adjustment is infinite, and the time that the ductor A-342 remains in contact with the ink fountain roll A-56, during each revolution of cam shaft A-381, may therefore be adjusted exactly as desired.

At any position of adjustment, the ductor A-342 returns to contact distributor roll A-343 during at least a third of the rotation of cam A-699.

Soft distributor A-343 is frictionally driven by its contact with the gear-driven hard oscillating distributor A-344, and at the same surface speed as the hard oscillator A-344, which, as previously explained, is equal to the surface speed of a plate carried on plate cylinder A-11 or in a work area of the large printing cylinder 22. The ink ductor roll A-342 is free to turn in its bushings A-646, and therefore, when it is in contact with distributor roll A-343, it assumes the surface speed of roll A-343, and when it is in contact with the ink fountain roller A-56, it assumes the surface speed of the ink fountain roller A-56, which as has been set forth, is much slower. The direction of rotation of ink fountain roll A-56 and distributor roll A-343 is the same, so that the ductor roll A-342 is frictionally driven in the same direction irrespective of whether it is being driven at relatively high speed when it is in contact with distributor A-343, or at relatively low speed when it is in contact with ink fountain roller A-56.

Neither fountain foller A-56 nor distributor roll A-343 oscillates from side to side, although distributor roll A-343 is in contact with oscillating distributor roll A-344. The fact that the ink fountain roll A-56 is driven continuously at slow speed keeps the ink in the fountain A-60 agitated without the need for external ink agitating mechanisms.

The device illustrated and described for varying the time that the ink ductor remains in contact with the ink fountain roller provides extremely find and infinitely variable control over the amount of ink transferred by the ink ductor from the ink fountain roll to the other rollers of the ink system.

If desired, similar means may be employed to control the dampening ductor in the dampening attachment.

The fact that the cam shaft A-381, and therefore the cam A-699, is driven at a slow speed in relation to the other shafts and rollers in the system, one revolution of cam shaft A-381 for every four revolutions of the plate cylinder A-11, causes ducting action to be smooth and free from bouncing. The fact that the barrel cam A-382, which initiates the oscillating action of the various oscillators throughout the system, is secured to slow moving shaft A-381 causes the oscillating motions to be comparatively slow and smooth and reduces the abruptness of the change in direction at each end of the oscillating strokes.

BLANKET AND PLATE ATTACHMENT AND ADJUSTMENT ON LARGE PRINTING CYLINDER

FIG. 108 illustrates the large printing cylinder 22 of the 2R model press with a blanket segment F-41 mounted in work area VI and a plate segment F-51 mounted in work area V. The means by which an offset blanket is attached and held in position on the lower printing cylinder 20 has been illustrated and described hereinbefore. The means for securing a plate to the plate segment F-52 and for making various adjustments of the plate is the same as the means used to secure a plate to a plate cylinder in a plate cylinder module. While there may be dimensional differences, the principles involved are identical, and therefore only the mechanism as it relates to the plate segment F-51 will be described. Similar mechanism for the plate cylinders in the plate cylinder modules is illustrated in FIGS. 64 through 72, though shown in less detail.

With reference particularly to FIG. 108, a blanket segment F-41 is secured in work area VI on large printing cylinder 22 of the 2R model press by means of four bolts F-130, two on each side, which are threaded into the mounting rings 36 and 37.

There is a row of holes across the leading edge of the offset blanket F-42 and another row of holes across the trailing edge of the offset blanket. The leading edge of the offset blanket F-42 is attached to the leading edge of the blanket segment F-41 by inserting the row of hooks F-76, which make up the leading edge blanket clamp affixed to the leading edge of the blanket segments F-41, into the holes along the leading edge of the offset blanket F-42.

The trailing edge blanket clamp consists of a pair of arms F-77 at either side of the segment F-41, each of which pivoted about a stud F-78 at either side of the segment. These two arms B-77 support the trailing edge blanket clamp F-81 between them, and the clamp has affixed thereto a similar row of blanket attaching hooks F-76 which are inserted into the holes along the trailing edge of the offset blanket F-42. The offset blanket is then drawn taut on the surface of the segment F-41 by tightening the screws F-82 which bear against the trailing edge of segment F-41 and thread through the clamp member F-81. This causes the clamp member to be drawn away from the trailing edge of the segment F-41, pivoting about the studs F-78, until the offset blanket has been drawn taut, and at this point the lock nuts F-83 are secured, against the face of the blanket clamp F-81, and the adjustment is secured. If desired, a spring may be provided to hold the blanket clamp snug against the trailing edge of the segment F-41 when no offset blanket is, in fact, affixed thereto.

In work area V of large printing cylinder 22, there is a plate segment F-51 which is mounted by means which have been described in detail elsewhere herein. A plate F-52 is secured to plate segment F-51 by inserting its leading edge between the anvil F-84 of member F-85 and the clamp bar F-53 until the leading edge of plate F-52 is uniformly in contact with the angular stop F-86 which extends across member F-85. The plate is then clamped in this position by tightening the two screws F-87 which clamp the clamp bar F-53 against the anvil portion F-84 of member F-85, thereby securing a solid grip across the leading edge of the plate F-52.

The trailing edge of the plate F-52 is then secured in the trailing edge clamp F-54 by slipping it between the fixed plate F-88 and a series of eccentrically mounted rollers F-89, mounted across the width of shaft F-91 and spring loaded, by means not shown, to cause the eccentric rollers F-89 to be urged to turn in a counterclockwise direction, as seen in FIG. 108, thus causing the trailing edge of the plate to be seized in the bite between the series of eccentric rollers F-89 and the fixed plate F-88. The trailing edge clamp F-54 is moved in toward the trailing edge of segment F-51 as the trailing edge of the plate is inserted. Springs F-93, connects spring pin F-92 in the frame of segment F-51 to spring pin F-94 at the outer end of arm F-95, which is integral with the plate clamp F-54. This entire assembly is mounted to swing about shaft F-96, carried in the plate segment F-51 and spring F-93 exerts a force to cause the trailing ede of the plate F-52 to be drawn taut, thereby holding the plate F-52 in intimate contact with the surface of plate segment F-51.

This clamp for securing the trailing edge of the plate is similar to that shown in Breman U.S. Pat. No. 2,309,161, issued Jan. 26, 1943. However, the trailing clamp illustrated in FIG. 108 includes an improvement which is important to the overall method of mounting the plate and adjusting its position. This improvement lies in the fact that each of the eccentric rollers F-89 across the width of the shaft F-91 includes a projecting lever arm F-97 which lies adjacent the face F-98 of the trailing edge of plate segment F-51.

Thus, when the plate clamp F-54 is drawn in toward the trailing edge of plate segment F-51, each of the lever arms F-97 contacts the trailing face F-98 of segment F-51, causing the eccentric rollers F-89 to be rocked in a clockwise direction, as seen in FIG. 108, about shaft F-91, with the result that the grip of the eccentric rollers holding the plate F-52 against the fixed bar F-88 is relaxed, and the trailing edge of the plate F-52 is free to be moved from side to side, or angularly, so that it lies smoothly in contact with the surface of plate segment F-51. Then, when the plate clamp F-54 is released, it is drawn away from the trailing edge F-98 of the segment F-51 by the action of spring F-93. The lever arms F-97 move out of contact with the face F-98, and each of the eccentric rollers F-97 again acts to bite the plate between its surface and the surface of fixed bar F-88, so that once again the plate is held securely in the trailing edge clamp F-54.

The member F-85, to which the leading edge of the plate F-52 is clamped by clamp bar F-53, as previously described, is dovetailed as shown, to be held within a mating dovetail slot in clamp bar F-99. Thus, member F-85 may slide from side to side laterally within the dovetail slot in clamp bar F-99, and when thus moved from side to side carries with it the clamp bar F-53 and the leading edge of the plate F-52. At the left-hand end of member F-85, as seen in FIG. 110, there is a projecting tongue F-101 into which is secured an adjusting pin F-102, which is pressed into the tongue F-101 of member F-85, and which projects outwardly through a slot F-103 in adjusting link F-104. The adjusting link F-104 has an arm F-105 projecting at right angles therefrom and pivots about a pin F-106 and is secured in position by the head F-107 of the pin F-106. At the outer end of tongue F-101 of member F-85 is a spring pin F-108 to which is affixed one end of spring F-111, the other end of which is affixed to spring pin F-109 which is secured in the clamp frame F-99. The spring F-111 acts to draw member F-85, and with it clamp bar F-53 and the leading edge of plate F-52 to the left, as seen in FIG. 110. Threaded through clamp frame F-99 is an adjusting thumb screw F-112, the nose of which bears against the arm F-105 of adjusting link F-104.

The spring F-111 draws member F-85, and with it pin F-102, to the left, as seen in FIG. 110, until the arm F-105 rests against and is held against the nose of thumb screw F-112. Then, as thumb screw F-112 is screwed in, it presses arm F-105 downwardly, thereby moving arm F-104, and with it pin F-102 and member F-85, to the right against the action of spring F-111. Conversely, if thumb screw F-112 is unscrewed or backed out, spring F-111 acts to keep arm F-105 in contact with the nose of thumb screw F-112, thus moving pin F-102 and member F-85 to the left in proportion as thumb screw F-112 is backed out. Thereby the lateral or side-to-side position of the leading edge of plate F-52 may be adjusted to the right by turning thumb screw F-112 inwardly, and to the left by backing thumb screw F-112 out. Spring F-111 acts to hold member F-85 and therefore the leading edge of plate F-52 in any position of lateral adjustment thus achieved.

The clamp frame F-99 is secured between the face F-113 along the leading edge of segment F-51 and the three heads F-114, F-115 and F-116 of the three pins F-117, F-118 and F-119, each of which is secured in the leading edge of segment F-51. The clamp frame F-99 pivots about pin F-117 and pin F-118 projects through a slot F-121 in clamp frame F-99, and pin F-119 projects through a slot F-122 in clamp F-99. Both slots F-121 and F-122 are radial slots about the center of pin F-117 so that the clamp frame F-99 is free to swivel about pin F-117 to the extent of the length of the two slots F-121 and F-122. Thumb screw F-123 threaded through clamp frame F-99 has its nose bearing against a flat on the side of pin F-118. A spring F-124 connects a spring pin F-125 in the side of the segment F-51 with a spring pin F-126 in clamp frame F-99, thereby urging the clamp frame F-99 to rotate in a counterclockwise direction about the pivot pin F-117, as seen in FIG. 110. This motion is then limited by the nose of thumb screw F-123 bearing against pin F-118. Thus, when the thumb screw F-12 is screwed inwardly, the leading edge of the plate F-52 is caused to swivel in a counterclockwise direction, as seen in FIG. 110, and, when the thumb screw F-123 is screwed outwardly, the leading edge of plate F-52 is caused to swivel in a clockwise direction.

Under some circumstances, it may be desirable to locate the pivot pin F-117 at the center laterally of the clamp frame F-99 beneath the bottom surface of the member F-85 instead of at the right-hand side, as seen in FIG. 110.

Similar clamping means is provided for the leading and trailing edges of each plate on each plate segment in any work area of the large printing cylinder, or on any plate cylinder in any plate cylinder module.

If a large lateral or skew adjustment of the leading edge of a plate is required, it may be made by loosening the clamping bolts F-87 so that the leading edge of the plate F-52 is released by the clamping bar F-53, and the plate may then be released from the trailing edge clamp and its leading edge moved to the right or the left, or twisted, by approximately the amount required, after which the clamping bolts F-87 may be retightened so that the plate will be seized again between the clamping bar F-53 and anvil portion F-84 of member F-85. Small lateral adjustments, or small twisting or skew adjustment, may then be made with micrometer accuracy to secure the final accurate registration of the plate F-52, both laterally and in skew, by the use of the thumb screws F-123 and F-112, as described.

In all cases, the plate F-52 may then be smoothed to conform to the surface of the plate segment F-51, and its trailing edge then resecured in the trailing edge clamp F-54, as previously described. This may be accomplished either by removing the trailing edge of the plate from the clamp F-54 and then reinserting it, or, when the adjustments to the leading edge of the plate, either laterally or in skew, are of small dimension, the trailing edge of the plate may be released from the trailing edge clamp by simply drawing the trailing edge clamp F-54 toward the trailing edge of the segment F-51, in the manner described, to release the plate F-52 from the bite of the eccentric rollers F-89 while the plate F-52 is smoothed into conformity with the surface of segment F-51, after which the trailing edge clamp F-54 is released and again seizes the trailing edge of plate F-52 and holds it smoothly in its new position of adjustment.

While the plate clamping means described is illustrated in FIGS. 108, 109 and 110 in connection with a plate segment carried in a work area of the large printing cylinder 22, similar mechanism adapted dimensionally to conform to the dimensions and geometry of a plate cylinder is used to secure plates to each of the plate cylinders of each of the plate cylinder modules and to provide for lateral and skew adjustments of these plates, as shown at various positions in FIGS. 64 through 72.

It is intended that the lateral adjustments, as provided for and described herein, are primarily for the purpose of registering the image on one plate cylinder or segment, with the image on another plate cylinder or segment, and once this registration has been achieved, if the lateral position of the composite image on the sheets to be printed is to be changed, this may be accomplished by moving the path of the sheets to the right or to the left on the feeder conveyor board. The means by which vertical image position adjustments may be made, both as between individual plates on individual plate segments or plate cylinders, or as a composite image, has been illustrated and described in considerable detail elsewhere herein.

AUTOMATIC FORM ROLL LIFTING MEANS 2R MODEL PRESS

As has been illustrated and described in detail elsewhere herein, each of the ink and/or dampening form rollers of each ink and/or dampening module is adjustably supported and held in relation to the adjacent distributor roller in the system. The support means is such that each such form roller may pivot about the center of the adjacent distributor roller without disturbing the relationship between the form roller and the distributor roller. Also illustrated and described have been the means by which each such form roller is yieldably but adjustably held in contact with a plate mounted in a work area of the large printing cylinder, and means by which such form rollers may be manually lifted out of contact with any work area of the large printing cylinder.

FIGS. 111, 112, 113 and 114 illustrate the means by which such form rollers may be automatically and selectively lifted out of contact with any selected work area or work areas of the large printing cylinder 22 on the 2R model press. FIGS. 115, 116 and 117 illustrate how this is accomplished on the 3R model press.

FIG. 111 is a view from the line 111—111 of FIG. 112, and these Figures together show the large printing cylinder 22 with a segment F-41 mounted in one work area thereof. There are form roll lifter cams B-131 secured to each of the outer faces F-127 of the flanged portions F-128 of the segment F-41. These form roll lifter cams are secured in position by a series of screws B-108 and thereby become an integral part of the segment F-41.

A typical form roller generally designated B-114 comprises a rubber sleeve B-119 (which in the case of a dampening form roll may be covered with a molleton or paper sleeve cover) molded onto a core B-109 into which are pressed bearings B-99 which journal the form roller as a whole for rotation about a typical shaft B-118 which is supported as previously described and illustrated in detail.

As seen in FIGS. 111 and 112, the core portion B-109 of the form roll B-114 extends beyond the rubber body portion B-119 of the roller, on either side, to form two hub portions B-88. As shown in these Figures, a cam follower disc B-78 with a hub B-69 is rotatably mounted on each of these hub portions B-88 and journalled thereon by means of a bushing B-68 which is pressed into the cam follower disc B-78 and its hub portion B-69. The hubs B-69 are adjacent to the body B-119 of the form roller. Each of these cam follower discs B-78 is secured in place on the hubs B-88 by means of a retaining ring B-58. When assembled as shown in FIGS. 111 and 112, the cam follower discs B-78 are each in alignment with one of the form roll lifter cams B-131 mounted on segment F-41. Thus, as large printing cylinder 22 revolves in the direction indicated, the form roll lifter cams B-131 contact the cam follower discs B-78 which are lifted thereby, and thereby automatically lift the surface of the form roller B-114 out of contact with the surface of segment F-41 as the segment passes beneath the form roller B-114.

The position of the cams B-131 as seen in FIG. 111 is generally designated L-13. The position in which the cam follower discs B-73 and their hubs B-69 are installed on the hubs B-88 at either end of the form roller B-114, as seen in FIG. 111, is generally designated L-14. The combination of the position in which the cams are installed (L-13) and the position in which the cam follower discs are installed (L-14), all as seen in FIG. 111, is generally designated LL-3.

FIGS. 113 and 114 illustrate another segment F-41 mounted in another work area of the large printing cylinder 22. This segment has another pair of form roll lifter cams B-132 secured to face F-129 of the segment proper by means of mounting screws B-108, this mounting position for the cams being generally designated L-12. The form roll lifter cams B-132 thereby become an integral part of this segment F-41. Another typical form roller generally designated B-114 is shown in association with this latter segment F-41. In this case, the cam follower discs B-78 have been mounted on the hubs B-88 with their hub portion B-69 facing outwardly from the rubber body portion B-119 of form roller B-114, this mounting position for the cam follower discs being generally designated L-11 whereas in FIGS. 111 and 112 the hub portion B-69 of the cam follower discs B-78 faced inwardly toward the rubber portion B-119 of the form roller B114 (L-14).

The combination of the position in which the cams are installed (L-12) and the position in which the cam follower discs are installed (L-11), all as seen in FIG. 113, is generally designated LL-12.

In FIGS. 113 and 114, also, the cam follower discs B-78 are similarly retained on the hubs B-88 by means of retaining rings B-58. When the cam follower discs B-78 are mounted as shown in these Figures, they are each in alignment with the form roll lifter cams B-132 on the segment F-41. It will thus be apparent that if this segment, as seen in FIG. 113, and the first segment F-41, as seen in FIG. 111, are mounted in the two work areas of large printing cylinder 22 on a 2R model press, which includes two inking modules and/or inking and dampening modules, with the form rollers of one of these modules equipped with cam follower discs B-78 mounted (L-14) as shown in FIGS. 111 and 112, and with the form rollers of the other module equipped with cam follower discs B-78, mounted (L-11) as seen in FIGS. 113 and 114, then, as large printing cylinder 22 revolves, the form rollers in the module whose form rollers are equipped (L-14), as seen in FIGS. 111 and 112, will be lifted out of contact with the surface of the first segment F-41, as seen in FIG. 111, but will roll in contact with the surface of the second segment, as seen in FIG. 113. Similarly, the form rollers of the module whose form rollers are equipped (L-11), as seen in FIGS. 113 and 114, will be lifted out of contact with the surface of the second segment F-41, as seen in FIG. 113, but will roll in contact with the surface of the first segment F-41, as seen in FIG. 111.

If the cam follower discs B-78 are removed from the form rollers of one of the inking and/or dampening modules, (as at LL-1 as seen in FIG. 7*b*) then the form rollers of that module will roll in contact with both the surface of the first segment F-41 and with the surface of the second segment F-41. If the form roll lifter cams are removed from either segment as at LL-1 as seen in FIG. 7b, then the form rollers of any ink, or inking and dampening, or dampening module on the press will roll in contact with the surface of this segment.

It will also be apparent that if either of the segments, as for instance the first segment F-41, is equipped with two pairs of form roll lifter cams, with one pair of form roll lifter cams B-131 mounted (L-13), as seen in FIGS. 111 and 112, and with the other pair of form roll lifter cams B-132 mounted (L-12), as seen in FIGS. 113 and 114, then the form rollers of any inking or inking and dampening module whose form rollers are equipped (L-14) as seen in FIGS. 111 and 112, or equipped (L-11) as seen in FIGS. 113 and 114, will be held out of contact with the surface of that particular segment.

It will thus be seen that by selectively mounting L-13 or L-12 the form roll lifter cams B-131 and B-132 on selected segments, and by selectively mounting the cam follower discs B-78 with their hubs B-69 facing inwardly (L-14) as seen in FIG. 111, or outwardly (L-11) as seen in FIG. 113, or by leaving the cam follower discs B-78 off the form rollers of a particular inking and/or dampening module completely, the form rollers of any particular inking and/or dampening module may be caused automatically and selectively to be disengaged from the surface of any selected segment mounted in any work area of large printing cylinder 22 while such form rollers are nevertheless free to roll in contact with the surface of another segment mounted in another work area of large printing cylinder 22, or to roll in contact with the surfaces of all such segments.

In FIGS. 111, 112, 113 and 114, the form roll lifter cams B-131 and B-132 extend the entire circumferential length of each segment to which they are attached, and thereby a form roller lifted from the surface of one of these segments is held out of contact with the surface of that segment throughout its entire extent.

It is also contemplated that form roll lifter cams, such as B-131 or B-132 may be mounted as seen in FIG. 111 or in FIG. 113, with such form roll lifter cams spanning only a portion of the circumferential length of the segment or work area to which they are mounted, as seen in FIG. 71, for instance. In this case, it will be apparent that form rolls equipped with appropriately oriented cam follower discs B-78 will be lifted out of contact with a portion of the surface of a segment or work area so equipped, and allowed to roll in contact with the remainder of the surface of such a segment or work area. Similarly, form roll lifter cams which extend only a portion of the circumferential length of a segment or work area may be mounted in the position of alignment of form roll lifter cams B-132 on FIG. 113 on one portion of a segment or work area, and other form roll lifter cams, which span a different circumferential portion of the same segment or work area, may be mounted in the position of alignment of the form roll lifter cams B-131 as shown in FIG. 111. In this case, the form rollers of an inking and/or dampening module, whose form rollers were equipped with cam follower discs B-78 and mounted (L-11) as seen in FIG. 113, would be lifted out of contact with that portion of the surface of a segment or work area spanned by form roll lifter cams mounted in the position (L-12) of cams B-132 of FIG. 113, but would contact the balance of the surface of the segment or work area, whereas the form rollers of another such module, whose form rollers were equipped with cam follower discs B-78 mounted (L-14) as seen in FIG. 111, would be lifted out of contact with that portion of the surface of the segment or work area spanned by form roll lifter cams mounted in the position (L-13) of cams B-131 of FIG. 111, but would roll in contact with the balance of the surface of that segment or work area.

AUTOMATIC FORM ROLL LIFTER MEANS 3R MODEL PRESS

FIGS. 115, 116 and 117 illustrate the manner in which the form rolls of inking, dampening or inking and dampening modules of the 3R model press may be selectively lifted out of contact with a segment or segments or a portion of a segment, mounted in one or more work areas of the large printing cylinder 3022, while being allowed to roll in contact with the surface of another segment or segments or portion of a segment in the same or other work areas of large printing cylinder 3022.

In FIG. 115, form roll lifter cams B-3132 are mounted against the outer faces F-3129 of the body of segment F-3041 and this mounting position is generally designated L-3012. In FIG. 116, form roll lifter cams B-3131 are mounted against the outer faces F-3127 of the flange portions F-3128 of segment F-3041 and this mounting position is generally designated L-3013. In FIG. 117, form roll lifter cams B-3159 include a hub portion B-3139, the inner face of which is mounted against the outer face F-3129 of the body of segment F-3041 and this mounting position is generally designated L-3014. It will thus be seen that the respective segments F-3041 of FIGS. 115, 116 and 117 are each fitted with form roll lifter cams B-3132, B-3131 and B-3159, respectively, mounted in different vertical planes at each side of each of the three segments.

The same form rollers are used on the 3R model press, and therefore the same typical form roll B-114 having hub portions B-88, as previously described, is shown in FIGS. 115, 116 and 117. In this case, the cam follower discs B-3078 have thinner hub portions B-3069, and a spacer disc B-3059 is also furnished. The combined width of cam follower disc B-3078, including hub B-3069, plus the width of spacer B-3059, is equal to the width of each of the hub portions B-88 of form roller B-114, between the rubber portion B-119 and the retaining rings B-58, at each end of each form roll B-114.

As shown in FIG. 115, cam follower discs B-3078 are mounted in alignment with form roll lifter cams B-3132, in position L-3012, by mounting the cam follower discs B-3078, as shown, with their hub portions B-3069 facing outwardly and the spacers B-3059 being placed on the outside next to the retaining rings B-58. This mounting arrangement is generally designated L-3011. The combined relationship between the mounting of the cam follower discs (L-3011) and the mounting of the form roll lifter cams (L-3012), as seen in FIG. 115, is generally designated LL-5.

As shown in FIG. 116, cam follower discs B-3078 are aligned with form roll lifter cams B-3131, in position L-3013, by placing the spacers B-3059 next to the rubber portion B-119 of form roll B-114 and placing the cam follower discs B-3078 with their hub portions facing inwardly. This mounting arrangement is generally designated L-3014. The combined relationship between the mounting of the cam follower discs (L-3014) and the mounting of the form roll lifter cams (L-3013), as seen in FIG. 116, is generally designated LL-7.

As shown in FIG. 117, cam follower discs B-3078 are aligned with form roll lifter cams B-3159 in position L-3015, by mounting the cam follower discs B-3078, as shown, with their hub portions B-3069 facing inwardly and next to the rubber portion B-119 of the form roll B-114, and with the spacers B-3059 outside the cam follower discs B-3078. This mounting arrangement is generally designated L-3016. The combined relationship between the mounting of the cam follower discs (L-3016) and the mounting of the form roll lifter cams (L-3015), as seen in FIG. 117, is generally designated LL-6.

FIG. 116A shows a segment F-3041 with two form roll lifter cams B-3132 and B-3131 mounted in positions L-3012 and L-3013 respectively.

Form roll lifter cams B-3132 are mounted against the faces F-3129 of the body of segment F-3041, in position L-3012; and form roll lifter cams B-3131 are mounted against the outer faces F-3127 of the flange portions of segment F-3041, in position L-3013.

This is the arrangement shown and described in FIG. 4*a* with respect to the segment F-3041 mounted in work area VIII of large printing cylinder 3022.

It will thus be apparent that form roll lifter cams may be placed in any of three vertical planes at each side of a segment, and cam follower discs at each end of the form rollers of a particular inking, dampening or ink-/dampening module may be aligned to be in the same vertical plane. Similarly, cam follower discs B-3078 may be left off the form rollers of any particular inking, dampening or ink/dampening module, Similarly, for roll lifter cams may be left off any particular segment in a particular work area of large printing cylinder 3022, or a segment may be equipped with form roller lifter cams in any one, two or three of the vertical planes.

As previously described with respect to the 2R model press, an individual segment may be equipped with form roll lifter cams that span only a portion of the circumferential length of the segment in one plane, to span a different circumferential portion of the length of the segment in another plane, and to span still another circumferential portion of the length of the segment in the third plane.

It will thus be apparent that any desired combination of such form roll lifter cams and cam follower discs may be furnished so that the form rollers of any particular inking, dampening or ink/dampening module may be selectively caused to roll in contact with the surface of any segment, segments, or portion of a segment, in any work area or work areas of the large printing cylinder 3022 while being lifted out of contact with any selected segment, segments, or portion of a segment in the same or another work area of the large printing cylinder.

It should also be noted that the form roll lifter cams, in every case, and the cam follower discs, in every case, are of such nature that they only need be furnished on those models equipped to perform applications which require their use, and then only to the extent of the required application, or applications, to be performed on that machine. Notwithstanding which, they may be made available, as needed, for use in any combination, as hereinbefore described.

It will be apparent that, whereas the form roll lifter cams themselves have been illustrated and described as being mounted in connection with a segment mounted in a work area of the large printing cylinder, on either the 2R press of the 3R press, there will be cases where a printing surface, such for instance as a numbering machine, may be mounted in a work area of the large printing cylinder without its constituting a "segment", as herein illustrated and described. In such cases only that portion of the "segment" to which the form roll lifter cams would be affixed need be furnished and mounted on the mounting rings 36, 37, 3036 and 3037 in the same manner in which a complete segment would be mounted.

SEPARATE DAMPENING MODULE

In FIG. 118, a separate dampening module generally designated CC-2 is shown mounted in module mounting station I on the 2R model of the press. The frames C-13 of the module are secured to mounting brackets C-104 by means of bolts C-105. The mounting brackets C-104 are the same as the mounting brackets B-104 used for the ink module or combined inking and dampening module, as previously illustrated and described. The mounting brackets C-104 are secured to the main frames 31 and 33 by means of bolts 244 threaded into holes 232 in the flanged portion 231 of the main frames 31 and 33, in the same manner as described for the inking module. The dampening module, generally designated CC-2, while shown here mounted on a 2R model press, may also be mounted on a 3R model press, in the same manner as will be shown and illustrated for the inking module in FIG. 119.

The dampening module CC-2 comprises a dampening tray C-21 which is mounted in a horizontal position and which contains the dampening fluid, the level of which within the tray is maintained, as illustrated and described in connection with FIGS. 35 and 36.

The dampening fountain roller C-11 is driven, in the direction shown, intermittently and in adjustable increments in exactly the same manner as previously described with respect to the similar construction in the dampening attachments for the plate cylinder module and for the inking module. A pin C-597 mounted on the face of cam C-576 slidably engages in the slot C-596 in link C-595. One end of link C-595 is secured to pin C-594 at the outer end of arm C-593 which is secured to one member of a one-way clutch C-591, the other member of which is secured to the shaft C-20 of dampening fountain roller C-11. Each of these elements performs exactly the same function as the like elements previously illustrated and described in detail in connection with the dampening attachments for the plate cylinder module and the inking module, and the control means, which is not shown here, is the same as described therein.

The dampening ductor roll C-144 is free to rotate about shaft C-577 and is secured in mounting bracket C-581 which pivots with shaft C-569. Arm C-584 is secured to shaft C-569 and carries cam follower C-585 at its outer end. Cam follower C-585 is urged against the surface of cam C-576 by a spring (not shown), and thereby the ductor roll C-144 is moved alternately into contact with the fountain roller C-11 and the dampening distributing roller C-113. In this case, too, the operation is the same as that described in more detail herein in connection with the dampening attachments for the plate cylinder module and the inking module. Also, as in the case of the dampening attachments previously described, a gear C-77 on the end of shaft C-76 of dampening distributor roll C-113 drives a gear C-571 on shaft C-71 on which cam C-576 is mounted. In this manner, shaft C-71 and with it cam C-576, are driven in the direction indicated at comparatively slower speed than the speed of the shafts of the dampening rollers themselves. Not only is the operation of this mechanism similar to that previously illustrated and described for the dampening attachments on the plate cylinder module and the inking module, but many of the parts involved are the same.

The dampening distributor roll C-113 is driven by pinion C-152 which is journalled on shaft C-149 and, in turn, secured its drive from the gear 41 for large printing cylinder 22. Dampening distributor roll C-113 is the same size as the similar ink distributor roll in the inking module, and the two dampening form rolls C-12 and C-17 are the same size as the comparable inking form rolls in the inking module. The only difference is that dampening distributor roll C-113 is made of aluminum or has a chrome-plated surface, whereas the comparable ink distributor roller is made of hard rubber or plastic, and the dampening form rolls C-12 and C-17 are covered with molleton sleeve covers or paper sleeve covers, whereas the comparable ink form rolls are made of soft rubber or plastic. The size and the geometry of this portion of the dampening module is therefore identical to the similar portion of the inking module and all of the parts for supporting the two form rollers in relation to distributor roller C-113 and in relation to the surface of a plate carried in a work area of a large printing cylinder 22, together with the means for adjusting the form rollers with respect to the distributor roller C-113 and with respect to a plate on large printing cylinder 22, are identical to the like parts in the ink module.

The means for lifting the form rollers C-12 and B-17 out of contact with large printing cylinder 22 are also identical to the similar means used for lifting the similar form rolls of the ink module out of contact with large printing cylinder 22, including both the automatic means for lifting the form rollers out of contact with certain work areas of the large printing cylinder, and the manual means, including the handle C-443 for manually lifting the form rollers C-12 and C-17 out of contact with all areas of large printing cylinder 22. Since the structure is identical and the same parts are used, FIG. 118 does not repeat the detail of all this structure which is illustrated and described in detail in connection with the inking module, FIG. 118, therefore, shows the relative size and geometric relationship between the various parts, which is identical to the similar parts of the inking module.

Fountain roller C-11 is made of aluminum, or is chromeplated, and the ink ductor roll C-144 is covered with either a molleton sleeve cover or paper sleeve cover. A coarse grain uncovered rubber ductor roll of the type known in the trade as a "bareback" roll may also be used for ductor C-144. Dampening distributing roll C-113 may also be given an oscillating motion similar to that imparted to the comparable ink distributor in the inking module by attaching a barrel cam to shaft C-71 and a flanged yoke to shaft C-76, and interconnecting the two by a rocking arm carrying two cam follower rollers, one at either end, in the manner illustrated and described in connection with the plate cylinder module and the inking module.

3R PRESS—PREFERRED FORM

FIG. 119 illustrates one configuration of the 3R model press that may be constructed from the various standarized components. The lower printing cylinder (not seen in FIG. 119) is identical to the lower printing cylinder of the 2R press. The large printing cylinder, generally designated 3022, has an effective printing diameter which is three times the effective printing diameter of lower printing cylinder 20. The circumference of large printing cylinder 3022 is divided into three work areas VII, VIII and IX, separated by three gaps. In the configuration shown in FIG. 119 there is a blanket segment F-3042 mounted in work area VII, a plate segment F-3041 mounted in work area VIII, and another plate segment F-3041 mounted in work area IX. Also, in the configuration shown, lower printing cylinder 20 carries an offset blanket on its surface, in the manner previously described and illustrated.

In this preferred embodiment of the 3R model press, the main frames, generally designated 3031 and 3033, are similar to the comparable frames previously illustrated and described with respect to the preferred embodiment of the 2R model press, with the exception that the size of the frames is appropriate to the larger size of the large printing cylinder 3022 of the 3R model press. The shaft 3022 of large printing cylinder 3022 is journalled in the main frames 3031 and 3033, and lower printing cylinder 20 is mounted in rotational tangential relationship to large printing cylinder 3022 and supported and driven in exactly the same manner as the similar cylinder in the 2R model press.

There are four module mounting stations about the upper portion of the frames 3031 and 3033, and these are designated I, II, III and IV. In the configuration of the 3R model press shown in FIG. 119, there is an ink-/dampening module BB-2 mounted at module mounting station I. There is a plate cylinder module AA-4 mounted at module mounting station II. There is an ink/dampening module BB-2 mounted at module mounting station III. There is a plate cylinder module AA-4 mounted at module mounting station IV.

The frames of the two plate cylinder module AA-4 mounted at module mounting positions II and IV are disgnated A-333. Each of these plate cylinder modules AA-4 is secured to the flange portions 3231 of the main frames 3031 and 3033 by means of mounting brackets A-331 located on dowel pins 240 and secured by bolts 242. Each of these plate cylinder modules AA-4, and its associated mounting bracket A-331, is identical to the comparable plate cylinder modules and mounting brackets used on the 2R model press and described in considerable detail elsewhere herein. As in the case of the similar plate cylinder modules when used on the 2R model press, the construction is such that the ink fountain A-60 and the dampening fountain tray A-354 of each of the plate cylinder modules AA-4 are each mounted in a horizontal position.

The frames of the ink/dampening modules BB-2 mounted at module mounting station I and III are designated B-158. Each of these ink/dampening modules is secured to the flange portions 3231 of main frames 3031 and 3033 by means of mounting brackets B-104, located by dowel pins 240 and secured by bolts 242. Ink module BB-2 and the mounting brackets B-104 are identical to the similar inking module and mounting brackets used on the 2R model press, as previously illustrated and described in detail.

There are small difference in the auxiliary ink system and in the dampening system of the ink/dampening modules BB-2 to adapt these to the larger size of large printing cylinder 3022 in the 3R model press. The form roll brackets B-3506 of the auxiliary ink systems in ink-/dampening modules BB-2, differ slightly from the similar brackets used when the inking module is to be mounted on the 2R model press.

The dampening attachment frames B-3117 and the dampening form roll brackets B-3609 used with the ink/dampening modules BB-2 differ slightly from th same parts which are used when the ink/damp module is to be mounted on the 2R model press.

As previously described and illustrated with respect to the 2R model press, the dampening attachment frames B-3117 of ink/damp module BB-2 may be pivoted about studs B-3124 to swing the dampening attachment out of the way, to provide access for the attachment and removal of the segments to be mounted on large printing cylinder 3022 in the case of the module mounted at module mounting station I, and to provide access to the adjacent form roller. The construction is such that the ink fountain A-60 and the dampening modules BB-2 are all mounted in a horizontal position.

The positions of the holes for bolts 242 and dowel pins 240 in the mounting bracket B-104 for the ink module or ink/dampening module BB-2 are identical to the positions for the holes for bolts 242 and dowel pins 240 in the mounting brackets A-331 for the plate cylinder modules AA-4 and are identical for the 2R and 3R presses. These holes, in turn, line up exactly with the mating holes which constitute each module mounting station in the flanged portion 3231 of the frames 3031 and 3033. In the case of the 2R model press, each of these holes in the main frames is equidistant from the center of the large printing cylinder. In the case of the 3R model press, each hole in each group of three holes in the frames 3031 and 3033, which three holes constitute an individual mounting station, is equidistant from a point located on a line connecting the center of the center hole with the center of large printing cylinder 3022, and spaced from the center of large printing cylinder 3022 by a distance equal to the effective printing radius of lower printing cylinder 20.

As seen in FIG. 119, a plate cylinder module mounted at module mounting station IV is centered about horizontal center line 3241. Horizontal center line 3241 passes through the center of large printing cylinder 3022, through the center of the central hole for mounting bolts 242 at module mounting station IV, and through the center of plate cylinder A-11.

Point 3101 lies on center line 3241 and is spaced away from the center of large printing cylinder 3022 by a distance equal to the effective printing radius of lower printing cylinder 20. The center of each of the holes for bolts 242 and dowel pins 240, which make up module mounting station IV, is equidistant from point 3101.

Center line 3121 of mounting station III is a radial line extending outwardly from the center of large printing cylinder 3022 and located 52 degrees and 30 minutes counterclockwise from horizontal center line 3241. Center line 3121 passes through the center of the hole for the central bolt 242 and through the center of oscillating ink distributor A-346 of the inking module BB-2 mounted at module mounting station III. Point 3131 lies on center line 3121 and is spaced from the center of large printing cylinder 3022 by a distance equal to the effective printing radius of lower printing cylinder 20. The center of each of the holes for the three bolts 242 and for the two dowel pins 240 that make up module mounting station III has its center located equidistant from point 3131.

The center line 3141, which similarly defines the center line of module mounting station II, is located 112 degrees and 30 minutes counterclockwise from horizontal center line 3241. Center line 3151, which defines the center line of module mounting station I, is located 165 degrees counterclockwise from horizontal center line 3241. Point 3161, which lies on center line 3141, and point 3171, which lies on center line 3151, are each spaced from the center of large printing cylinder 3022 by a distance equal to the effective printing radius of lower printing cylinder 20.

The holes in the frames 3031 and 3033 for the bolts 242, and the dowel pins 240 of module mounting station II, have their centers equidistant from point 3161. Similarly, the holes in the frames 3031 and 3033 for the bolts 242, and the dowel pins 240 of module mounting station I, have their centers equidistant from point 3171.

It is thus apparent that an inking module with its associated mounting bracket B-104 may be attached at any one of the four module mounting stations I, II, III or IV, and when so attached, the center line of that module mounting position will pass through the center of the distributor roll corresponding to distributor A-346 in inking module BB-2. Similarly, any plate cylinder module and its mounting brackets A-331 may be attached at any one of the module mounting stations I, II, III or IV, and when so attached, the center line of the module mounting position will pass through the center of the plate cylinder A-11.

Since, as a practical matter, there would be no occasion for mounting more than two ink/dampening modules on the 3R model press, nor more than a single ink/dampening module on the 2R press, the spacing of the module mounting stations is such that ink/dampening modules may be mounted in module mounting stations I and III on the 3R model press, and in module mounting station I on the 2R model press. Inking modules, without the dampening attachment, may be mounted at any of the four module mounting stations on the 3R model press, and at module mounting stations I and II on the 2R model press, in the preferred embodiments of the press. Plate cylinder modules may be mounted at any of the four module mounting stations of the 3R press, or at any of the three module mounting stations of the 2R press, in the preferred embodiments of the press. The dampening module may be mounted at module mounting station I on the 2R press, or at module mounting station I or module mounting station II on the 3R press, in the preferred embodiments of the press. The dampening module and its mounting bracket are identical whether mounted on the 2R press or the 3R press.

The direction of rotation of each of the printing cylinders and of each of the hard rollers is shown in FIG. 119.

INK DUCTOR ROLL FOR PLATE CYLINDER MODULE AT STATION I OR INKING MODULE AT STATION IV ON 3R MODEL

The standard plate cylinder module may be mounted at any of the three module mounting stations on the preferred embodiment of the 2R model press and may be mounted at module mounting stations II, III and IV on the preferred embodiment of the 3R model press; and with the ink fountain mounted in a horizontal position without creating any interferences. Similarly, the standard inking module may be mounted at module mounting station I or II on the 2R model press, or at module mounting stations I, II or III on the 3R model press; and with the ink fountain mounted in a horizontal position, without creating any interferences.

FIG. 120 illustrates the arrangement used in order to mount the ink fountain in a horizontal position when a plate cylinder module is mounted at module mounting station I on the 3R model press. While, as a practical matter, it is not anticipated that a need will arise for mounting an inking module at module mounting station III on the preferred embodiment of the 2R model press, or at module mounting station IV on the preferred embodiment of the 3R model press, nevertheless this could be done and the ink fountain would then be mounted in a horizontal position by making the same modifications in the inking module as in the plate cylinder module shown in FIG. 120, but in mirror image, as with the entire inking module.

FIG. 120 shows a plate cylinder module mounted at module mounting station I on a 3R model press of the preferred type illustrated in FIG. 119. The direction of rotation of the ink fountain roller A-56 has been reversed by substituting a pair of gears for the sprockets A-632 and A-631 and the chain A-633 in the drive previously illustrated in FIG. 106 and 107 for driving the ink fountain roller A-56. The ink fountain A-3060 is then mounted in a horizontal position, supported on spreader A-3062 held by brackets A-3061.

The ink ductor roll A-3342 is slightly smaller in size than ductor A-342, but is mounted in the same mounting bracket A-651 which pivots with shaft A-652. Shaft A-652 and mounting bracket A-651 are identical to the parts previously described for the standard plate cylinder module, and the means by which the action of the ductor roll is controlled is exactly as previously illustrated and described. However, arm A-663 of FIG. 103, 104 and 105 is pinned to shaft end A-656 of shaft A-652 at a different angle.

Elongated mounting brackets A-3706 have been substituted for the similar standard shorter brackets A-706 which normally position a single soft distributor roller A-343 in contact with oscillating distributor roller A-344, and which roller A-343 is then normally contacted by the ink ductor A-342.

In the construction shown in FIG. 120, there is a somewhat smaller soft ink distributor A-3343 whose shaft A-3705 is journalled in bearings A-3707, retained in mounting brackets A-3706. There is also a second small hard rubber distributor A-3330 whose shaft A-3327 is journalled in bearings A-3328 which are also slidably retained in the brackets A-3706. This hard distributor roll A-3330 is yieldably urged in the direction of the center of oscillating distributor A-344 by spring means similar to that previously illustrated and described elsewhere herein. Thus, hard distributor A-3330 bears against soft distributor A-3343 and presses it, in turn, against the surface of oscillating distributor A-344. The ductor A-3342 ducts between the ink fountain roll A-56 and the hard distributor A-3330.

The ink fountain roller A-56, the hard distributor A-3330, and the hard oscillating distributor A-334 are all driven in a counterclockwise direction, as seen in FIG. 120. The oscillating distributor A-344 and the ink fountain roller A-56 are driven by gears, as previously illustrated and described, and hard distributor roll A-330 is frictionally driven. Soft distributor A-3343 is frictionally driven in a clockwise direction through its contact with oscillating distributor A-344 and, in turn, frictionally drives hard distributor A-3330 in a counterclockwise direction.

The ink ductor A-3342, which is a soft roller, is frictionally driven at a relatively slow speed by the ink fountain roller A-56 when it is in contact therewith, and is frictionally driven at a relatively higher speed by its contact with hard distributor roll A-3330 when it is in contact with that roller.

PILE AND BOTTOM FEEDERS

FIG. 121 illustrates a model 2R press, generally designated 10, with a "pile" suction feeder, generally designated D-15, (and so called because the sheets are loaded into the feeder in a pile from which the top sheet is separated and fed to the press), in combination with a "bottom" feeder, generally designated D-14, (and so called because the bottom sheet of the stack is separated from the stack and fed to the press). A conveyor, generally designated D-21, is shown for conveying the sheets from one or both of the feeders to the press. The combination of the two feeders and the conveyor is generally designated DD-3.

As will be illustrated and described in detail in FIGS. 121 through 139, the operation of the feeders is timed and coordinated with the drive of the press in such a way that sheets fed from either of the feeders are fed in timed relationship with the operation of the press. The timing of the feeders with the press is synchronized so that the leading edge of each sheet, whether fed from the pile feeder D-15, or the bottom feeder D-14, reaches the stop fingers 25 in the press when the stop fingers are in the "up" position and during the interval provided for the leading edge of a sheet to reach this point in the press as previously described. FIG. 121 through 139 illustrate in detail the operation of each of these feeders, both individually and together, and the means by which their operation is synchronized and timed with that of the press.

Sheets may be fed from the pile feeder A-15, only, with one sheet being fed to each revolution of lower printing cylinder 20, or to each revolution of large printing cylinder 22. Alternatively, sheets may be fed from the bottom feeder D-14 only, with sheets being fed to each revolution of lower printing cylinder 20, or to each revolution of large printing cylinder 22. Alternatively, sheets may be fed from both pile feeder D-15 and the bottom feeder D-14, with the sheets from the two feeders alternating. In this case also, the timing may be such that a sheet is fed to each revolution of lower printing cylinder 20, or a sheet is fed to each revolution of large printing cylinder 22, and with the sheets from feeder D-15 and feeder D-14 alternating in either case.

FIG. 121 shows the interrelationship of a number of the basic components of the two feeders, and when taken with the other FIGS. 122 through 139 illustrates the interrelationship of the basic feeder components, each of which is shown and will be described in more detail in connection with other Figures in this group.

BOTTOM FEEDER

The bottom feeder, generally designated D-14, is located above the pile feeder D-15, but is referred to as the "bottom" feeder because it separates and feeds each sheet from the bottom of the stack. It comprises a magazine D-13 on which a stack of sheets to be fed D-11 may be laid. The leading edge of such a stack of sheets is supported by front guide D-22 which includes a lip member D-23 which projects under the leading edge of the bottommost sheet. At the leading edge of the magazine support plate D-13, there is a bar D-24 which extends across the width of the magazine. The bottommost sheet D-25 in the stack is unsupported from the point D-26 at the top of bar D-24 forward to the point where its leading edge is supported by lip D-23. At either side of the magazine, there is a stud D-27 whose center coincides with the point D-26. As will be illustrated and described in more detail hereinafter, sucker feet are pivoted about the stud D-27 and act to bend the leading edge of the bottommost sheet D-25 down into the position shown at D-17, at which point its bottom surface is in contact with lower pull-out rolls D-30 mounted on shaft D-31, which is driven continuously in the direction shown. Upper pull-out rollers D-32 are mounted on shaft D-33, which in turn is journalled in arms D-34 secured to rocker shaft D-35. The upper feed rolls D-32 then press the sheet D-25 (in position D-17) against the driven lower feed rolls D-30, and the sheet is withdrawn from the bottom of the stack. Its direction of travel is then guided by the fingers of the lower feed plate D-36 and those of an upper feed plate which consists of stationary fingers D-37 and movable fingers D-41.

The leading edge of sheet D-25 is thus moved forward into the bite D-42 of the main pull-out rollers, which consist of a driven steel lower pull-out roll D-43 and rubber upper pull-out rolls D-44. The lower steel pull-out roller D-43 is driven continuously in the direction indicated, and the rubber upper feed rolls D-44 are yieldably held in contact with the lower feed roller D-43 by means of springs D-45. Each upper feed roll D-44 is journalled about a shaft D-46 which is held in a pair of support arms D-47 which are pivoted about a pin D-48 secured at the lower end of mounting bracket D-49.

The mounting bracket D-49 may be secured at any point across the width of spreader D-51 and is locked in position by means of thumbscrews D-52 which press against wedge-shaped member D-53 to lock the mounting bracket D-49 against the spreader D-51 in the desired position. The springs D-45 exert pressure to turn the brackets D-47 in a counterclockwise direction, thereby yieldably urging the upper pull-out roller D-44 into contact with the lower pull-out roller D-43. There is a pawl D-54 at the outer end of brackets D-47, and a lever arm D-55, which is an extension of brackets D-47, extends upwardly above the top surface of mounting bracket D-49. When the lever D-55 is manually moved to the right, the upper pull-out roll D-44 is lifted out of contact with lower pull-out roller D-43 against the action of springs D-45 and pawl D-54 is raised until it catches above latch pawl D-56 on latching arm D-57 which pivots about pin D-58. Spring D-59 acts to keep latching arm D-57 in contact with the nose of pawl D-54. Thus, when pawl D-54 is raised above latching pawl D-56, the latching pawl moves in below pawl D-54 and holds it in a raised position, thus holding the upper pull-out roll D-44 out of contact with lower pull-out roll D-43, when the machine is not in operation. A pin D-61 extends out from the side of latching arm D-57 and may be raised to disengage the latching pawl D-56 from the pawl D-54 and allow the upper pull-out roller D-44 again to move into contact with lower pull-out roller D-43 under the action of spring D-45.

As the sheet moves toward the press, it is supported first by a lower support plate D-62, and then by a continuously driven conveyor roll D-63 mounted on shaft D-64 which is driven continuously in the direction indicated. A sheet passing over conveyor roll D-63 is held in contact therewith by a series of spherical roller members D-65 which are held in position across the width of conveyor roll D-63 by holes in upper guide plate D-66. The sheet then passes over a double sheet deflector plate D-67 which pivots about pins D-68, and the operation of which will be described in more detail hereinafter. The sheet then passes onto a series of conveyor tapes D-71 of the conveyor D-21. The conveyor tapes D-71 are kept snugly in contact with conveyor roller D-72 by means of a tightener D-75. Conveyor tape roller D-72 is mounted on shaft D-74 which is driven continuously in the direction indicated, and thereby drives the conveyor tapes D-71.

PILE FEEDER

The pile of sheets D-20 in the pile feeder, generally designated D-15, is held in position so that the top sheet lies in the position shown at D-75. There is a sensor which senses the height of the pile and a raising mechanism which acts in response to the signal received from the sensor so that the height of the pile is raised as sheets are fed off the top of the pile, thereby maintaining the top sheet on the pile at approximately the level of sheet D-75. The pile raising mechanism includes means by which the level of the top of the pile may be adjusted upwardly or downwardly to properly handle the feeding of various types of paper stock. The pile raising mechanism is not shown in these drawings, since it is intended that well known apparatus may be used for this purpose such for example as that shown in Davidson U.S. Pat. No. RE 21,707.

The leading edge of the pile is held in alignment by conventional side guides and corner guides, not shown, so that the leading edges of the top sheets on the pile contact leading edge guide D-76, which is fastened to a bracket D-77. Bracket D-77, in turn, may be positioned at any point across the width of spreader D-78 and held in position by thumbscrew D-79. The bracket D-77 also carries what is commonly referred to as a "cat's whisker" D-81 which is a think flexible finger of copper or brass fastened on the top of bracket D-77 and projecting through a slot in leading edge guide D-76 so that its top surface projects over the leading edge of the top sheet, D-75, of the pile.

Air is blown between the top sheets on the pile through slots D-82 and D-83 in blower tubes D-84 and D-85, respectively, at the front and sides of the pile. This causes the top sheets on the pile to be fluttered or floated upwardly on a cushion of air, to the point where the top surface of the top sheet D-75 is in contact with the cat's whisker D-81. The suction foot D-86 for the pile feeder moves down into the position shown in FIG. 121 and 121A, through slots between the upper guide plate fingers D-37 and the fingers D-278 of lower guide plate D-36. At the time when suction foot D-86 contacts the top surface of the top sheet D-75, suction is drawn through the suction tube D-87 causing the top sheet to be held in contact with the suction foot D-86, and the suction foot D-86 then rises to place the leading edge of the sheet D-75 in the bite D-42 between the main pull-out rollers D-44 and D-43, at which point the path of travel of the body of the sheet D-75 is shown at D-88.

In order to provide clearance for the sheet D-75 to move along this path, the lower guide fingers D-36 for the bottom feeder are pivoted upwardly about shaft D-35, as will be illustrated and described hereinafter. As the leading edge of sheet D-75 is seized in the bite D-42 of the main pull-out rollers, the suction in the foot D-86 is cut off so that it releases the sheet, and the sheet is then drawn onto the conveyor and into the press, as previously described for a sheet coming from the bottom feeder. The sucker foot D-86 for the pile feeder then rises into a position in which it is above the upper support fingers D-37 and out of the path of a sheet next to be fed from the bottom feeder D-14. The detail of how these functions are performed and timed and coordinated will be illustrated and described in the following Figures.

ACTUATION AND TIMING OF COMBINED FEEDERS

As will be seen in FIGS. 122 through 138, camshaft carries all of the cams by which the actuation and timing of the various elements of the combined feeders is accomplished. FIG. 121 also shows the position of camshaft D-91. One complete 360 degree revolution of camshaft D-91 represents one complete cycle of operation of the combined pile and bottom feeders. FIGS. 121, 122, 123 and 124, taken together, illustrate the means by which camshaft D-91 is driven in synchronization with the press.

Camshaft D-91 may be driven so that it makes one-half revolution for each revolution of large printing cylinder 22; it may be driven so that it makes one revolution for each revolution of large printing cylinder 22; or it may be driven so that it makes two revolutions for each revolution of large printing cylinder 22.

The right-hand portion of FIG. 121, taken together with FIG. 122, illustrates the drive of the press itself and the way it is transmitted into the drive for camshaft D-91. The drive is transmitted from the motor H-11, as seen in FIG. *2a*; 12 and 13, to a variable speed V-belt pulley H-22 which drives V-belt H-21, which in turn drives V-belt pulley H-14 on drive shaft 23. Also secured to drive shaft 23 is a pinion gear 24, which in turn drives large gear 41 of large printing cylinder 22.

Large printing cylinder 22 is integral with its shaft 32, and secured to shaft 32 is a gear 18 which in turn meshes with a gear 181 whose pitch diameter is twice the pitch diameter of gear 18. Gear 181 is journalled on a stub shaft 191, which in turn is mounted in a plate 229 which pivots about shaft 32 and is secured in position by a bolt 238 which passes through an arcuate slot 258 in plate 229 and is threaded into the main frame of the press. Bolt 238 may be tightened to secure the plate 229 and the stub shaft 191 in the solid line position, as shown in FIG. 121, or the plate 229 may be swung to the phantom line position illustrated in FIG. 121 with the bolt 238 at the other end of slot 258, and bolt 238 may then be tightened to hold the plate 229 and the stub shaft 191 in the phantom line position.

Gear 181 has a splined hub on which are mounted two sprockets 268 and 269. Sprockets 268 and 269 are integral with each other and may be moved in and out on the splined hub of gear 181.

When plate 229 and shaft 191 are in the solid line position, as shown in FIG. 121, the sprocket 268 is moved into alignment to mesh with and drive chain 259. When plate 229 and stub shaft 191 are in the phantom line position, as shown in FIG. 121, the sprockets 268 and 269 are moved in on the splined hub of gear 181 so that sprocket 269 is aligned with and meshes with chain 259, which it then drives.

Sprocket 268 has twice the pitch diameter and twice the number of teeth of sprocket 269. When the chain 259 is meshed with and driven by sprocket 268, there is a marked link 288 on chain 259 which is placed opposite the timing marker 289 on the face of sprocket 268. When the chain 259 is meshed with and driven by sprocket 269, the marked link 288 is placed opposite the timing mark 298 on the face of sprocket 269. Thus the gear 181 and the two sprockets 268 and 269 are linked together and journalled about stub shaft 191 and driven by gear 18 acting through gear 181. Thus, when large printing cylinder 22 makes one complete revolution, gear 181 and sprockets 268 and 269 each make one-half revolution.

Chain 259 is thus driven in the direction indicated, and, as seen in FIG. 122, first passes over and drives a sprocket D-92, and also drives a sprocket D-93 integral therewith, both of which sprockets are journalled to turn freely about a shaft D-64. Sprocket D-92 is of the same pitch diameter and has the same number of teeth as sprocket 269, and has half the pitch diameter and half the number of teeth of sprocket 268. Thus, if chain 259 is being driven by sprocket 269, sprocket D-92, like sprocket 269, makes one-half revolution for each revolution of large printing cylinder 22. However, if chain 259 is being driven by sprocket 268, sprocket D-92 makes one complete revolution for each revolution of large printing cylinder 22.

Chain 259 then passes about and drives sprocket D-95, which is equal in pitch diameter to sprocket 269 which has the same number of teeth. Chain 259 then passes around an idler sprocket D-94 and then passes about another driven sprocket D-96, which also has the same pitch diameter as sprocket 269 and the same number of teeth. Chain 259 then returns and passes over either sprocket 268 or sprocket 269, as the case may be.

There is a stub shaft D-97 secured to the frame D-101 of the feeder, and there is a boomerang-shaped plate D-102 pivoted about the outer end of stub shaft D-97. Outside of the plate D-102, idler sprocket D-94 is journalled on the outer projecting portion D-98 of stub shaft D-97 and retained in place by a retaining ring D-99. There is a stub shaft D-103 affixed to the upper portion of plate D-102. A gear D-104 is affixed to the hub of sprocket D-96 so that gear D-104 is driven by sprocket D-96, and together they are journalled on stub shaft D-103 by means of bearing D-105 and held in place by retaining rings D-106. There is another stub shaft D-107 secured to plate D-102 on its downwardly projecting arm. The centers of stub shaft D-103 and stub shaft D-107 are equidistant from the center of the projecting portion D-98 of shaft D-97 about which idler sprocket D-94 is journalled on bearing D-108.

Gear D-109 is mounted on and secured to the hub of sprocket D-95, and together they are journalled on stub shaft D-107 through bearing D-103 and held in position by retaining ring D-89. Gear D-109 has twice the pitch diameter and twice the number of teeth as gear D-104. There is a gear D-111 secured to the outer end of camshaft D-91 by means of a taper pin D-99. The gear D-111 secured to camshaft D-91 has the same pitch diameter and the same number of teeth as gear D-104, and therefore has half the pitch diameter and half the number of teeth as gear D-109.

The boomerang-shaped plate D-102 may be pivoted about the stub shaft D-98 to bring gear D-109 into mesh with gear D-111, in which case gear D-104 is moved out of contact with gear D-111 and merely idles. Alternatively, plate D-102 may be rocked about stub shaft D-98 so that gear D-104 is brought into mesh with gear D-111 on camshaft D-91, and in this case gear D-109 moves out of mesh with gear D-111. There is an arm of plate D-102 which projects downwardly and to the left, and at the outer end of which is mounted a locating pin D-112 with a knurled head D-113.

There is a triangular support D-114, secured to the frame D-101 of the feeder by means of three bolts D-115. The outer face of support D-114 contacts the inner face of the downwardly projecting arm of plate D-102, and there are locating holes D-116 and D-117 in support D-114 into one or the other of which the locating pin D-112 may be inserted. There is a retaining pin D-118 projecting out from the side of the knurled knob D-113 of locating pin D-112, and once the locating pin D-112 has been inserted in either hole D-116 or D-11y, the knurled knob D-113 is turned counterclockwise to secure the pin D-118 under retaining spring clip D-119. When the locating pin D-112 is inserted in the hole D-117, gear D-109 is in mesh with gear D-111 on camshaft D-91. When the locating pin D-112 is inserted in the hole D-116, gear D-104 is in mesh with gear D-111 on camshaft D-91.

There is a marked link D-121 on chain 259 which is aligned with a timing pointer D-122 on the face of sprocket D-96. There is another marked link D-123 on chain 259 which is aligned with a timing mark D-124 upon the face of sprocket D-95. For convenience, timing mark D-124 also appears on the inner face of gear D-109. There is a timing mark D-125 on the face of gear D-111 on camshaft D-91. When gear D-111 is meshed with gear D-109, timing mark D-125 is aligned between dual timing marks D-126 on the face of gear D-109 if sheets are to be fed from the pile feeder only. Timing mark D-125 is aligned between dual timing marks D-127 on the face of gear D-109 if sheets are to be fed from the bottom feeder only. When gear D-111 on camshaft D-91 is in mesh with gear D-104, timing mark D-125 is aligned between dual timing marks D-128 if sheets are to be fed from the pile feeder first. Timing mark D-125 is aligned with dual timing marks D-129 on the face of gear D-104 if sheets are to be fed from the bottom feeder first.

If the plate 229 and the stub shaft 191 are in the solid line position, as shown in FIG. 121, and chain 259 is driven by sprocket 268, sprockets D-95 and D-96 and gears D-109 and D-104 will each make one revolution of each revolution of large printing cylinder 22. If gear D-104 is then in mesh with gear D-111 on camshaft D-91, camshaft D-91 will make one revolution for each revolution of large printing cylinder 22. On the other hand, if gear D-109 is then in mesh with gear D-111 on camshaft D-91, camshaft D-91 will then make two revolutions for each revolution of large printing cylinder 22, or camshaft D-91 will make one revolution for each revolution of lower printing cylinder 20.

If plate 229 and stub shaft 191 are in the dotted line position, as shown in FIG. 121, and chain 259 is being driven by sprocket 269, then sprockets D-96 and D-95 and gear D-104 and D-109 will each make one-half revolution for each revolution of large printing cylinder 22. In this case, if gear D-104 is then in mesh with gear D-111 on camshaft D-91, the camshaft will be driven through one-half revolution for each revolution of large printing cylinder 22. On the other hand, if gear D-109 is then in mesh with gear D-111 on camshaft D-91, the camshaft will be driven through one revolution for each revolution of large printing cylinder 22.

FEEDING SHEETS FROM PILE FEEDER AND BOTTOM FEEDER

The manner in which each revolution of camshaft D-91 is related to the feeding of sheets from the pile feeder D-15 and from the bottom feeder D-14 will be described in more detail in connection with the following Figures.

Shaft D-131 has a sprocket D-132 secured to it by taper pin D-133 and is driven by chain D-134 from sprocket D-93. The function and operation of shaft D-131 will be illustrated and described in detail in connection with FIG. 127. The manner in which shaft D-131 is driven is illustrated in FIGS. 122, 124, 125 and 126. Sprocket D-93 has twice the pitch diameter and twice the number of teeth of sprocket D-132, and therefore shaft D-131 makes two revolutions for each revolution of sprocket D-93. As previously noted, sprocket D-93 and sprocket D-92 are secured to a common hub D-135 and journalled to turn about shaft D-64 on a bearing D-136, and sprocket D-92 is driven by chain 259. If chain 259 is being driven by sprocket 269 which has the same pitch diameter as sprocket D-92, sprocket D-92 and therefore sprocket D-93 make one-half revolution for each revolution of large printing cylinder 22, and therefore sprocket D-132 and shaft D-131 make one revolution for each revolution of large printing cylinder 22. On the other hand, if chain 259 is being driven by sprocket 268 which has twice the pitch diameter and twice the number of teeth as sprocket D-92, then sprocket D-92, and with it sprocket D-93, make one revolution of each revolution of large printing cylinder 22, and therefore sprocket D-132 and shaft D-131 make two revolutions for each revolution of large printing cylinder 22.

When gear D-109 is in mesh with gear D-111 on camshaft D-91, the center of gear D-109 is at point D-137. When gear D-104 is in mesh with gear D-111 on camshaft D-91, the center of gear D-109 is at point D-138. The center D-139 of stub shaft D-97 is the point about which the center of gear D-109 pivots. There is another stub shaft D-141 secured to the feeder frame D-101 and positioned so that its center D-142 lies on a line passing through center D-139 of stub shaft D-97 and bisecting the angle between points D-137, D-139 and D-138.

There are two gears D-143 and D-144 mounted on a common hub and journalled through bearings D-145 and D-146 on the outer end of stub shaft D-141, and secured in place thereon with a retaining ring D-147. Gear D-143 meshes with and is driven by gear D-109. The exact position of the center D-142 of stub shaft D-141 along the line D-139--D-142 is such that the center of gear D-109 may be moved back and forth between positions D-137 and D-138 without the teeth of gear D-109 bottoming between the teeth of gear D-143, but so that gear D-109 is in mesh with gear D-143, regardless of whether its center is located at point D-137 or at point D-138. Thus, gear D-143 is driven by gear D-109 at all times and in the direction shown, and, since gear D-144 is mounted on a common hub with gear D-143, gear D-144 is similarly driven.

There is another stub shaft D-148 secured to the frame D-101 of the feeder. A gear D-151 and a sprocket D-152 mounted on a common hub D-153 are journalled to turn about stub shaft D-148 on bearings D-154, and are secured in place thereon by a retaining ring D-155. Stub shaft D-148 is located so that gear D-151 will mesh properly with gear D-144 and be driven thereby. There is a sprocket D-156 secured to shaft D-64 by taper pin D-157, and a chain D-158 connects sprocket D-152 and sprocket D-156 so that sprocket D-152 drives sprocket D-156 and shaft D-64 in the direction shown. The relative size of gear D-143 to gear D-109, of gear D-143 to gear D-144 to gear D-151, of gear D-151 to sprocket D-152, of sprocket D-152 to sprocket D-156, and of sprocket D-156 to the diameter of the conveyor roller D-63 are all such as shown as to drive the conveyor roller D-63 at the proper surface speed to accomplish the delivery of sheets from the feeders to the stop fingers 25 of the press.

As shown in FIGS. 121, 122 and 125, shaft D-64 and conveyor roller D-63 are driven in a clockwise direction, which is the direction in which they must be driven to properly convey the sheets. Notwithstanding this fact, the sprockets D-92 and D-93 and their common hub D-135, which are journalled through bearing D-136 to turn freely about shaft D-64 and secured thereon by retaining ring D-159, are driven in a counterclockwise direction, as shown in FIGS. 122 and 125.

FIGS. 125 and 126 illustrate the manner in which the conveyor tape roller D-72, the main lower pull-out roller D-43, and the shaft D-31 for the lower pull-out rollers of the bottom feeder, are driven. The conveyor tape roll D-72 is secured to shaft D-74 which is journalled in bearings D-161 mounted in the feeder side frames D-101 or in the conveyor frames D-194 as seen in FIG. 127. A sprocket D-162 is secured to shaft D-74 by means of a taper pin D-163. A sprocket D-164 is secured to shaft D-64 by means of a taper pin D-165. A chain D-166 connects sprockets D-164 and D-162, thereby driving sprocket D-162 and shaft D-74 and conveyor tape roll D-72, in the direction shown.

As shown in FIG. 126, conveyor tape roller D-72 is set diagonally to the conveyor roll D-63 and to the frames D-101. If a straight tape conveyor is used, shaft D-74 and conveyor tape roller D-72 will be parallel to shaft D-64 and to roller D-63, and perpendicular to the feeder frames D-101.

The main lower pull-out roller D-43 is journalled to turn about a shaft D-167 on bearings D-169. The shaft D-167 does not itself turn, but is journalled for rocking motion about the center of eccentric stub shafts D-168 which are integral with the shaft D-167 and project from either end thereof and are, in turn, journalled in bearings D-171 in the feeder frames D-101. The purposes of this mounting arrangement and the result accomplished thereby are illustrated and described in detail in FIG. 135.

There are two sprockets D-172 and D-173 secured to a hub member D-174 which, in turn, is secured to the main lower pull-out roller D-43. Sprocket D-173 is driven by a chain D-175 which, in turn, is driven by a sprocket D-176 secured to shaft D-64 by means of taper pin D-177. Sprocket D-172, in turn, drives a chain D-178 which, in turn, drives another sprocket D-179 secured to the lower pull-out roll shaft D-31 of the bottom feeder, to which the lower pull-out rollers D-30 of the bottom feeder are in turn secured, by means of taper pin D-181. Thus, the drive imparted to shaft D-64, as previously described, is, in turn, transmitted to conveyor tape roller D-72, to main lower pull-out roller D-43, and to the lower pull-out rollers D-30 of the bottom feeder, all of these rollers being driven in a clockwise direction as shown in FIG. 125. The pitch diameters of the various sprockets involved are matched to each other and to the diameters of the rollers being driven (as shown) to obtain the proper surface speeds for the conveying of sheets fed from either of the feeders.

CONVEYING SHEETS TO STOP FINGERS

FIG. 127 shows additional details of the conveyor board by means of which sheets are conveyed from the main upper and lower pull-out rolls D-44 and D-43 to the point where the leading edge of each sheet contacts the stop fingers 25, at a time when the stop fingers 25 are in the "up" position, ready to receive such a sheet, and the upper feed roll 28 has been raised out of contact with lower feed roll 27. Such sheets, as they emerge from the bite D-42 and the main pull-out rollers, pass over support plate D-62, conveyor roller D-63, double sheet eliminator plate D-67, and are then conveyed by the conveyor tapes D-71 to the point where their leading edge is in engagement with stop fingers 25.

Throughout this passage, the sheets are held in frictional engagement with the conveying means by spherical roller members D-65 and D-69. If double sheets have been presented to the bite D-42, the double sheet deflector plate D-67 is raised into the path of the sheets and they are deflected into the tray D-29. The means by which this is accomplished is illustrated and described in connection with FIG. 135. Guide D-183 for the spherical roller members and side guides D-182 are provided for guiding the sides of the sheets and retaining the spherical members in position, and these may be adjusted from side to side and lengthwise by conventional adjusting means including thumbscrews D-184 and D-185 for coarse adjustments and a micrometer screw D-186 and a large adjusting knob D-187 and retaining spring D-188 for control of minute side to side adjustments.

As previously referred to, the conveyor tapes D-71 are driven by the conveyor tape roll D-72 and are guided and held taut by guiding and tightening means D-73 and D-191. The conveyor, as a whole, comprises two side frames D-194 which are tied together by a series of spreaders D-195. The conveyor is mounted so that it may be pivoted about shaft D-64 to drop into a lower position, in contact with tray D-29, to provide more ready access to lower printing cylinder 20.

UNDERLAPPING SHEETS

When extremely long sheets are being fed, the overall smoothness of operation of the press and feeder may be improved, and the press may be operated at higher speeds, if the timing and speed of conveying of the sheets fed is such that the leading edge of one sheet catches up to the trailing edge of a previously fed sheet which is still in position on the conveyor board, with its leading edge in contact with the stop fingers 25. Under normal circumstances, if this were done, the leading edge of the sheet catching up to the trailing edge of the one ahead of it would simply cause a jam-up, and the operation of the press would have to be stopped.

However, it has been found that if the trailing edge of a sheet in position on the conveyor board, and with its leading edge in contact with stop fingers 25, is lifted slightly, the leading edge of a following sheet will then simply insert itself below the lifted trailing edge of the sheet which is momentarily standing on the conveyor, with its leading edge against the stop fingers 25. When this occurs, the forward motion of the second sheet is slowed somewhat as its leading edge underlaps the trailing edge of the first sheet.

As the stop fingers 25 move out of the path of the first sheet the first sheet is then driven ahead by the action of the upper and lower feed rolls 28 and 27, as previously described. Depending upon the length of the sheets, the trailing edge of the first sheet will then either pull ahead of the leading edge of the second sheet, or the second sheet will continue to move down the conveyor board with its leading edge underlapping the trailing edge of the first sheet. In either case, the stop fingers 25 will return to the "up" position before the leading edge of the second sheet reaches them. If the trailing edge of the first sheet has not passed the position of the stop fingers 25, it will simply be lifted slightly by the ascending stop fingers until its trailing edge has passed this position and, in any case, the leading edge of the second sheet will come into contact with the raised stop fingers in the normal fashion.

To provide for the lifting of the trailing edge of the first sheet, to allow the leading edge of the second sheet to underlap it, a lifter plate D-196 extends across the width of the conveyor board below the upper level of the conveyor tapes D-71. secured to the top surface of plate D-196 is a lifter finger plate D-197 which has a forward flat section D-198 which lies in contact with the top surface of plate D-196. Projecting backwardly from the flat portion D-198 of lifter plate D-197 is a series of fingers D-199 which are bent upwardly in a curve, as shown, to a high point D-201, and then curve down to a nose portion D-202 which rests in contact with the back portion D-204 of plate D-196. These backwardly projecting lifter fingers D-199 are spaced between the individual conveyor tapes D-71.

The plate D-196 is hinged about a rod D-203 which also acts as a spreader bar for the conveyor frames D-194. The back portion D-204 of plate D-196 rests on two lifter cams D-205, affixed to shaft D-131. The cams D-205 are shaped to lift the rear portion D-204 of the lifter plate D-196 sufficiently so that the lifter fingers resting on the top of plate D-196 project between the conveyor tapes D-71 and above the level of these tapes, at point D-201, when the cams D-205 are in the position shown in FIG. 127 with lifter plate D-196 in the lifted position. The lifter finger plate D-197 has a pair of guide screws D-206 and another pair of thumbscrews D-207 which project through two longitudinal slots D-208 in lifter plate D-196.

By loosening the thumbscrews D-207, the lifter finger plate D-197 may be moved toward the front or the back of the conveyor board. To properly position the lifter plate D-197, a sheet of the length to be run is moved into position so that its leading edge is in contact with stop fingers 25. Thumbscrews D-207 are then loosened and lifter plate D-197 is moved into position so that high point D-201 is approximately three-quarters of an inch to an inch and a quarter forward of the trailing edge of the sheet, and thumbscrews D-207 are then locked to hold the lifter plate D-197 in this position.

Shaft D-131 is driven in synchronization with the feeding of sheets, as previously indicated, and is timed so that as the leading edge of the sheet is stopped against the stop fingers 25, the trailing edge is lifted slightly by the action of the top portion D-201 of the lifter fingers D-199 and is held in this position until the stop fingers move out of the way and the sheet is advanced by the action of the upper and lower feed rolls 28 and 27. Thus, if the leading edge of a second sheet reaches the position of the trailing edge of the first sheet thus supported, the leading edge of the second sheet will underlap the trailing edge of the first sheet without causing a jam-up. The timing is such that as the stop fingers 25 move forward and the leading edge of such a first sheet is advanced by the upper and lower feed rolls 28 and 27, the cams D-205 revolve to the point where the high point D-201 of the lifter finger D-199 is dropped below the level of the tapes D-71 and the two sheets are conveyed together by the tapes D-71, with the leading edge of the second sheet underlapping the trailing edge of the first sheet. If the lengths of the sheets are such that the first sheet has started to move forward under the action of the upper and lower feed rolls 28 and 27 before the leading edge of the second sheet has caught up with the trailing edge of the first sheet, there will be no interference between the two sheets, and while the leading edge of the second sheet will not underlap the trailing edge of the first sheet, there will be no paper jam-up caused.

The guide D-182 for the spherical roller members toward the back end of the conveyor is held in position by thumbscrew D-185 which clamps it to fixed guide D-211. There is a slot D-212 in the fixed guide D-211 through which the screw portion of thumbscrew D-185 passes, and this allows the guide D-182 to be moved forward and backward throughout the extent of the length of slot D-212. The length of the slot D-212 is greater than the center distance between the successive spherical members D-69. Therefore, regardless of where the high point D-201 of the lifter fingers D-199 may be placed, from the position shown in FIG. 127 to the back of the conveyor board, the spherical members may be so placed as to work with the lifter fingers D-199 in lifting the trailing edge of a first sheet while urging the leading edge of a second sheet to move into underlapped position with respect to the trailing edge of the first sheet.

As has previously been described, shaft D-131 is driven in timed relationship with the printing cylinders of the press and makes one revolution for each revolution of the large printing cylinder under circumstances where a sheet would be fed once for each revolution of the large printing cylinder 22. Similarly, shaft D-131 is caused to make two revolutions for each revolution of the large printing cylinder 22, or in other words, one revolution for each revolution of lower printing cylinder 20 in circumstances where a sheet would be fed to each revolution of lower printing cylinder 20. There are circumstances under which a sheet might be fed to each revolution of large printing cylinder 22 only, whereas shaft D-131 would be set to make one revolution for each revolution of lower printing cylinder 20. This does no harm, however, because on the revolution of shaft D-131 when a sheet is in position on the conveyor board, the cam D-205 is properly timed to perform its function and, on the revolution of shaft D-131 when no sheet is present the lifter fingers D-199 are, nevertheless, lifted into the position shown in FIG. 127, even though there is no sheet in position on the conveyor board.

SHEET SEPARATION-PILE FEEDER

FIG. 128 illustrates the sheet separating mechanism of the pile suction feeder. One or more suction feet generally designated D-16 are provided, each of which comprises a foot portion D-86 which is connected to a vacuum source through a vacuum hose D-87 in a manner which will by illustrated and described in connection with FIGS. 131 through 134. Each such suction foot D-16 is basically supported and positioned by a bracket D-49A which may be clamped at any point across the width of the machine on spreader D-51 by means of thumbscrew D-52 pressing wedge-shaped member D-53 into contact with spreader D-51.

At the lower portion of bracket D-49A, there is a support plate D-213 affixed thereto. The rearward, upward facing, surface of support plate D-213 forms a stationary cam surface D-214. There is a shaft D-215 journalled in support plate D-213, and projecting therethrough. On the front side of shaft D-215 there is a sprocket D-216 for a silent cog timing belt D-231 engaged thereon. At the other end of shaft D-215, which projects behind support plate D-213, there is an arm D-217 affixed thereto. There is a pin D-218 projecting through the outer end of arm D-217 and extending beyond the width of the arm on either side thereof. On either side of sucker foot D-86 there is an upwardly projecting arm D-219 with a hole at the upper end thereof which fits over and is journalled about pin D-218.

At the far side of suction foot D-86 there is an arm D-221 which projects forward therefrom and which carries the small cam follower D-222 at its outer end. Arm D-221 and cam follower D-222 are on the far side of sucker foot D-86, as shown in FIG. 128, and in a plane beyond the far end of shaft D-215. There is another small cam follower D-223 on the near side of arm D-219 and in alignment with the stationary cam surface D-214 of support arm D-213. A spring D-224 acts to turn shaft D-215 and arm D-217 in a clockwise direction. A spring D-225 acts to urge support arms D-219, carrying sucker foot D-86, to move in a counterclockwise direction around pin D-218.

There is a shaft D-226 journalled in the frame D-101 of the feeder and extending therebetween and projecting outwardly beyond the near frame. Each bracket D-49A carries a pair of guide arms D-227 which extend upwardly around shaft D-226. Between these guide arms D-227 there is a sprocket D-228 for a silent cog belt D-231 and the silent cog belt connects sprockets D-216 and D-228. Any motion imparted to sprocket D-228 is therefore transmitted through the silent cog belt D-231 to the sprocket D-216 which is affixed to shaft D-215. There is a keyway D-229 across the length of shaft D-226 between the feeder frames, and there is a key D-209 secured to each sprocket D-228, which is slidable in the keyway D-229, and which causes any rotational motion of shaft D-226 to be transmitted to sprocket D-228. Thus, each bracket D-49A may be moved from side to side to any position across spreader D-51, and it carries with it, through guide plates D-227, the associated sprocket D-228 which is thus kept in alignment with sprocket D-216, at any position across the width of shaft D-226. At the near end of shaft D-226, outside the near side frame of the feeder, there is another sprocket D-232 for a silent cog belt D-233. Sprocket D-232 is secured to shaft D-226, and there is a spring D-234 between sprocket D-232 and the near side frame D-101 of the feeder which acts to urge sprocket D-232 and shaft D-226 to turn in a clockwise direction.

There is a stub shaft D-235 secured in the near frame of the feeder. A cam follower arm D-236 is integral with a hub D-237 which is journalled for rocking motion about stub shaft D-235. Cam follower arm D-236 carries cam follower roller D-238 at its outer end. Cam follower roller D-238 rotates about a shaft D-239 which is held in position at the outer end of cam follower arm D-236 by a set screw D-241. A spring D-242 connects a spring pin D-243 in cam follower arm D-236 with a spring pin D-244 in the frame D-101 of the feeder, thus urging cam follower D-238 into contact with the surface of cam D-245 which is secured to camshaft D-91 by taper pin D-246. A sector portion D-247 is also integral with hub portion D-237. Sector D-247 is a section of a sprocket for silent cog belt D-233. A section of silent cog belt D-233 wraps around a portion of sprocket D-232 on shaft D-226 and has one end secured to the far end of sector D-247 at D-248, and the other end secured to a fastener D-249 which is also secured to a spring D-251, the other end of which is secured to a spring pin D-252 in the frame D-101 of the feeder. Spring D-251 thus holds the silent cog belt D-233 in intimate contact with the teeth of sprocket D-232 and also acts to turn shaft D-226 in a clockwise direction. Thus, springs D-251, D-234 and D-224 all work together to turn shafts D-226 and D-215 in clockwise direction.

As cam D-245 rotates with camshaft D-91 in the direction shown, the cam follower D-238 follows the surface of cam D-245 downwardly under the action of spring D-242 and spring D-251, and as this occurs the combined action of springs D-251 and D-234 causes shaft D-226 to be rotated in a clockwise direction. This rotation, in turn, is transmitted through cog belt D-231 to sprocket D-216 and shaft D-215, and combines with the force of spring D-224 to cause shaft D-215 to rotate in a clockwise direction. As this occurs, pin D-218 moves upwardly along the path D-253 and suction foot D-86 is lifted and carries with it the top sheet D-75 on the pile feeder, through the action of the suction drawn through sucker foot D-86 and suction hose D-87. As suction foot D-86 rises, it is urged to rotate in a counterclockwise direction about pin D-218 by spring D-225. This urges follower D-222 into contact with the surface of lower pull-out roll D-43. The lifting of the center of pin D-218 along path D-253, and the action of spring D-225 in holding follower D-222 in contact with the surface of lower pull-out roll D-43 causes sucker foot D-86 to rise vertically so that the leading edge of the top sheet is flicked past the cat's whisker D-81, the action of which is to hold back a second sheet and let only one sheet pass.

Follower D-222 remains in contact with the surface of lower pull-out roller D-43 until follower D-223 engages the surface of stationary cam D-214. Thereafter, as the center of pin D-218 follows the path D-253, spring D-225 acts to hold follower D-223 in contact with the surface of cam D-214, and follower D-222 moves out of contact with the surface of lower pull-out roller D-43. When the center of pin D-218 has reached point D-254, the leading edge of the sheet D-75 has been inserted into the bite D-42 between lower pull-out roll D-43 and upper pull-out roll D-44, as shown in FIGS. 121 and 130. At this point, the suction in suction hose D-87 and suction foot D-86 is broken, and suction foot D-86 releases the sheet D-75 which has now been moved into the path shown at D-88.

The sheet D-75 is now withdrawn by the pull-out rollers D-43 and D-44, and as the center of pin D-218 moves along path D-253 to point D-255, sucker foot D-86 is lifted above the path of sheets passing from the "bottom" feeder into the bite D-42 of the main pull-out rollers. Sucker foot D-86 is held in this raised position for approximately 300 degrees of the rotation of the camshaft D-91 and cam D-245, and, during this interval, the sheet D-75 is withdrawn from the pile feeder onto the conveyor board by the pull-out rollers D-43 and D-44, and a sheet is separated from the bottom of the stack in the "bottom" feeder and presented to the bite D-42 of the main pull-out rollers and drawn onto the conveyor board by the bite D-42 of the main pull-out rollers D-43 and D-44.

As the trailing edge of this sheet from the bottom feeder passes the downward path of sucker foot D-86, the lifting portion D-256 of cam D-245 reaches the cam follower D-238 and acts to lift cam follower arm D-236 against the action of spring D-242 and, through cog belt D-233, to turn shaft D-226 in a counterclockwise direction against the action of spring D-251 and spring D-234 and, through cog belt D-231 acting on sprocket D-216, similarly to turn shaft D-215 in a counterclockwise direction against the action of spring D-224. This causes pin D-218 to move downwardly along path D-253, and, as it does so, follower D-223 follows cam surface D-214, and at the point where follower D-223 leaves cam D-214, follower D-222 contacts the surface of lower pull-out roller D-43, and thus the downward motion of suction foot D-86 is controlled and it comes down vertically onto the top sheet D-75 of the pile.

As the cam D-245 reaches the point illustrated in FIG. 128, the suction foot D-86 also reaches the point shown in FIG. 128, and at this point suction is drawn in suction tube D-87 and sucker foot D-86, and the top sheet of the pile is seized by the suction in sucker foot D-86 and the process just described is repeated. This process is repeated continuously as each successive top sheet D-75 is separated from the sheets in the pile and fed to the bite D-42 of the main pull-out rollers, as described.

SHEET SEPARATION-BOTTOM FEEDER

FIG. 129 illustrates the mechanism by which sheets are separated from the bottom of the stack D-11 in the "bottom" feeder D-14 and similarly fed to the bite D-42 of the main pull-out rollers D-43 and D-44, with sheets being fed alternately from the top of the "pile" feeder D-15 and from the bottom of the "bottom" feeder D-14. As shown in FIG. 129, a stack of sheets D-11 in the bottom feeder D-14 rests on the magazine bottom plate D-13, as seen also in FIG. 121, with the sheets supported from their trailing edge to the point D-26, and with their leading edge supported by lip D-23 extending inwardly at the bottom of front guide D-22, and with the bottom sheet D-25 being exposed and unsupported from the lip D-23 to the point D-26.

A pluraiity of suction feed generally designated D-12 and each including a sucker D-257 and a mounting bracket D-258 are slidably mounted on shaft D-259 and secured in position thereon by means of a key D-261 which extends across the width of the feeder and the shaft D-259. The mounting brackets D-258 and suckers D-257 may, therefore, be positioned at any point across the width of shaft D-259. Each sucker D-257 is connected to a suction hose at D-262. The means by which the suction drawn in the sucker D-257 is controlled is illustrated and described in detail in FIGS. 131 through 134. Shaft D-259 also acts as a spreader between two arms D-263 which are also secured together by a spreader D-264 to form a rocking frame which carries shaft D-259. The arms D-263 and the shaft D-259 and spreader D-264 are all within the width of the feeder frames D-101.

The arms D-263 pivot about two stub shafts D-27, one of which is secured to the far feeder frame D-101, and the other of which projects through the near feeder frame and is journalled therein in a bushing D-265. The arm D-263 adjacent the near feeder frame is pinned to stub shaft D-27, and the arm D-263 adjacent the far feeder frame is journalled for rocking motion about the stub shaft D-27 secured to the far feeder frame. On the outside of the near feeder frame, there is a hub D-266 pinned to the outwardly projecting portion of stub shaft D-27 by means of taper pin D-287. There are two arms D-268 and D-269 integral with hub D-266. Arm D-268 carries a cam follower D-271 and a projection D-272 of arm D-268 carries a spring pin D-273. A spring D-274 connects spring pin D-273 with another spring pin D-275 secured to the feeder frame D-101. Spring D-274 acts to hold cam follower D-271 in contact with the surface of a cam D-276 which is secured to camshaft D-91 by means of taper pin D-277.

A series of lower paper support fingers D-278 integral with lower paper support plate D-36 are mounted across the width of a tubular member D-279 which extends between arms D-34 at either end of shaft D-35, and which is free to pivot about shaft D-35. The finger D-278 nearest to the near feeder frame, carries a pin D-281 which projects through a slot D-282 in a slotted link member D-283, the opposite end of which is secured to and pivots about a pin D-284 at the outer end of arm D-269. A spring D-285 connects pins D-281 and D-284 and acts to urge pin D-281 to the top of slot D-282. A dowel pin D-286 secured to the inner face of the near feeder frame projects over the top of the near finger D-278 and limits the upward movement of the fingers pivoted about shaft D-35.

Referring now to FIG. 129 and FIG. 130, lower pull-out rollers D-30, mounted on and secured to shaft D-31, are driven continuously in the direction shown, as previously described and illustrated in connection with FIGS. 125 and 126. There is a series of lower pull-out rollers D-30 spaced apart across shaft D-31, and the lower paper support fingers D-278 project upwardly between these lower pull-out rollers D-30. The suckers D-257 and their supporting brackets D-258 rock downwardly between the lower pull-out rollers D-30. A corresponding number of upper pull-out rollers D-32, of equal width, are journalled to turn freely about shaft D-33 and are located in alignment with lower feed rolls D-30.

Shaft D-33 is secured to two arms which are, in turn, secured to a shaft D-35 which is journalled in both feeder side frames D-101 and extends through the near feeder frame. A rear upper paper guide D-41 extends between the two arms D-34, and is secured thereto, and has a series of small upwardly projecting fingers which project between the upper feed rolls D-32 and a downwardly projecting series of fingers which project between a series of stationary upper paper guide fingers D-37. Each of the arms D-34 is secured to shaft D-35 by a taper pin D-287. Outside the near feeder frame there is an arm D-288 secured to shaft D-35 by means of taper pin D-289. A pin D-291 is carried at the outer end of arm D-288 and secured thereto by a set screw D-292. Pin D-291, in turn, carries a cam follower roller D-293 which is in alignment with a cam D-294 secured to camshaft D-91 by means of a taper pin D-295. A spring D-291 connects a spring pin D-297 in feeder frame D-101 and a spring pin D-298 in arm D-288. Spring D-296 thus acts to turn arm D-288 and shaft D-35 in a counterclockwise direction, as shown in FIG. 130. Cam D-294, in turn, acts to lift cam follower D-293, and with it arm D-288 on shaft D-35, against the action of spring D-296, thereby turning shaft D-35 in a clockwise direction.

In FIG. 130, the sucker feet D-86 for the pile feeder D-15 are shown in their highest raised position in which they are above the paper guiding surface of upper paper guide fingers D-37. When the sucker feet D-86 descend to the position shown in FIG. 128, they pass downwardly between the upper guide fingers D-37 and the lower guide fingers D-278 of lower guide plate D-36.

In the operation of the bottom feeder, as shown in FIGS. 129 and 130, the suckers D-257 pivot upwardly about shaft D-27 until they are in contact with the bottom surface of a sheet D-25 on the bottom of the stack held in the bottom feeder. As the suckers D-257 are thus rocked upwardly, the shaft D-33 of the upper pull-out rollers and the rear upper paper guide D-41 have been rocked forward into the position shown in FIG. 129, so that the suckers D-257 clear them both as they ascend into contact with the bottom sheet D-25. During this time, a sheet D-75 from the pile feeder is being lifted, as previously described, to place its leading edge in the bite D-42 of the main pull-out rollers, at which point the path of the sheet is along the line D-88. The forward edge of the lower guide fingers D-278 has been lifted to clear the path D-88 since pin D-284 at the outer end of arm D-269 has risen, thereby moving the top of slot D-282 out of contact with pin D-281 and allowing spring D-285 to act on pin D-281 to lift the fingers D-278 to the point where they are in contact with dowel pin D-286, as shown in FIG. 129.

When the suckers D-257 come in contact with the bottom sheet D-25, suction is drawn in the suckers, as will be described in detail in connection with FIGS. 131 through 134, and the suckers D-257 then rock downwardly, about the center D-26 of shaft D-27. This causes the bottom sheet in the stack to have its leading edge withdrawn from above the support lip D-23, and, as the suckers D-257 rock downwardly about the center D-26, they bend the leading edge of the sheet down about point D-26. Since the leading edge D-24 of the support D-13 for the sheet D-25, and the center of shaft D-27, about which the suckers D-257 rotate, is the same point D-26, the leading edge of the sheet is simply bent downward and no force is exerted to attempt to pull it out from under the stack of sheets.

As the leading edge of the sheet is carried downwardly past the position of the upper pull-out rolls D-32, shaft D-33 is rocked forward about shaft D-35 to a point where the upper pull-out rolls D-32 are out of the path of the leading edge of the sheet as it is pulled downwardly. As the leading edge of the sheet passes the positon of the upper pull-out rolls D-32, the shaft D-35 begins to rock in a counterclockwise direction, bringing the shaft D-33 and the upper pull-out rolls D-32 in, above the upper surface of the sheet. Suckers D-257 rock downwardly between the lower pull-out rolls D-30 until the upper surface of the suckers D-257 is just below the point of tangency with the lower pull-out rolls D-30. At this point, arm D-269 has rocked down to the point where the upper end of slot D-282 in link D-283 has contacted pin D-281 and forced the fingers D-278 down into the position shown in FIG. 130. At the same time, the upper pull-out rolls D-32 come into contact with the upper surface of the sheet which has now been bent down into the path shown at D-17, and, at this point, the cam follower D-293 rides off the lower surface of cam D-294 and spring D-296 acts to pull the upper pull-out rolls D-32 firmly into contact with the lower pull-out rollers D-30 with the sheet held therebetween. This causes the continuous rotation imparted to the lower pull-out rollers D-30 to pull the sheet out from the bottom of the stack.

The movable rear upper paper guide fingers D-41 have been moved into position, with the arms D-34 which carry them so that, together with the stationary upper guide fingers D-37, they define the upper guide path for the sheet being pulled out by the upper and lower pull-out rollers D-32 and D-30, whereas the lower guide fingers D-278 of lower guide plate D-36 form the lower portion of a chute through which the leading edge of the sheet must pass, and by which it is guided into the bite D-42 of the main pull-out rollers D-43 and D-44.

At the instant when the upper pull-out rollers D-32 press the sheet against the lower pull-out rollers D-30, the suction in the suckers D-257 is broken so that the sheet is released thereby, and it is free to be drawn out from under the stack by the action of the upper and lower pull-out rollers D-32 and D-30, and then by the action of the main pull-out rollers D-43 and D-44.

The sheet is then drawn onto the conveyor board in the manner described previously with respect to a sheet from the pile feeder. As the trailing edge of the longest sheet passes the bite of the pull-out rollers D-30 and D-32, the upper pull-out rollers D-32 begin to rock forward and the suckers D-257 begin to rock upwardly, and the process is repeated. As the trailing edge of the longest sheet passes the path of the suction feet D-86 for the pile feeder, they descend downwardly between the sheet guiding fingers D-37 and D-278 into the position shown in FIG. 128, and the fingers D-278 are lifted, as previously described, to clear the path D-88 to be followed by the next sheet separated from the top of the pile in the pile feeder. Thus, sheets are fed alternately from the "pile" feeder and the "bottom" feeder.

AIR AND SUCTION CONTROLS

FIGS. 131, 132, 133 and 134 are views of the feeders from the opposite side from which they were viewed in FIGS. 121 through 130. These Figures show the means by which suction is drawn at the suction feet D-86 for the pile feeder, and at the suckers D-257 for the bottom feeder. They illustrate the means by which the timing of making and breaking the suction at both sets of suction feet is controlled. They also show the means by which air is blown between the sheets at the top of the pile on the pile feeder.

A conventional suction pump (not shown) is provided with a suction inlet, and an outlet through which air is blown when the suction inlet is not closed. As seen in FIGS. 133 and 134 the suction inlet of the pump is connected by means of a suction hose D-301 to a nipple D-302 in the side of a control cylinder D-303. The outlet, or blow side, of the suction pump is connected to a relief valve D-304 by means of a connecting hose D-305, as seen in FIG. 131. Hoses D-306 lead from the relief valve to blower tubes D-85 at either side of the pile of sheets in the pile feeder. A similar hose or hoses D-308 lead to a blower tube or tubes D-84 placed in front of the leading edge of the pile of sheets in the pile feeder. Air is then blown through the slots D-82 and D-83 in the blower tubes D-84 and D-85, respectively, from the front and sides of sheets at the top of the pile in the pile feeder. When the suction line is cut off by a sheet of paper held by either the suction feet D-86 or the suckers D-257, the blowing of air through tubes D-84 and D-85 is temporarily cut off, but at all other times air is drawn in through the suction side of the pump and blown out through the blower tubes D-84 and D-85. Relief valve D-304 is of conventional design and may be adjusted to allow a portion of the air from the pump to be blown out at the relief valve, thereby reducing the volume of air blown between the sheets from the blower tubes D-84 and D-85, thus providing a means for adjusting the volume and intensity of the air blown through the blower tubes.

There are two suction control valves generally designated D-313 and D-314. Section control valve D-313 controls the making and breaking of the suction in the suction feet D-86 for the pile feeder, and suction control valve D-314 controls the making and breaking of the suction in the suckers D-257 of the bottom feeder. The control cylinder D-303 causes first one and then the other of these suction control valves to be placed in communication with the suction hose D-301 from the suction side of the pump. A nipple D-315 near the bottom of control cylinder D-303 is connected to suction control valve D-313 by means of a suction hose D-316. A nipple D-317 near the center of control cylinder D-303 is connected to suction control valve D-314 by means of a suction hose D-318.

The bottom end of control cylinder D-303 is pivoted about a stud D-319 on a stub shaft D-321 secured to the feeder frame D-101 by nut D-322. There are two plungers D-323 and D-324 which fit snugly within the inner bore of control cylinder D-303, and which are secured to a plunger rod D-325. Plunger D-324 is secured to the bottom of plunger rod D-325, and plunger D-323 is also secured to plunger rod D-325 but spaced above plunger D-324 by a distance equal to the center-to-center distance between nipples D-315 and D-317. The top of plunger rod D-325 is attached to a swivel bracket D-326 which is journalled about a pin D-327 secured in the outer face of a timing disc D-328 which is secured to the outer end of camshaft D-91 by taper pin D-329.

As camshaft D-91 and timing disc D-328 rotate in the direction shown, the plunger rod D-325 and the plungers D-323 and D-324 are drawn up and down within the control cylinder D-303. When the plunger D-324 is above nipple D-302, nipple D-302 and nipple D-315 are in direct communication, and suction is drawn through hose D-316 and suction control valve D-313. At this time in the cycle, there is no suction connection to hose D-318 or to suction control valve D-314. When plunger D-324 is below nipple D-302, nipple D-302 and nipple D-317 are in direct communication through the area of control cylinder D-303 sealed between plungers D-324 and D-323, and suction is drawn through suction hose D-318 and suction control valve D-314. During this portion of the cycle, no suction is drawn through hose D-316 or suction control valve D-313. The position of pin D-327 in relation to timing disc D-328 and camshaft D-91 is such as to cause suction to be drawn through suction hose D-316 and suction control valve D-313 during the interval when suction is to be drawn through suction feet D-86 of the pile feeder. Suction is drawn through hose D-318 and suction control valve D-314 during the time of the cycle when suction is to be drawn at the suckers D-257 of the bottom feeder.

There are a series of holes D-330 around the top of control cylinder D-303 to allow air to be drawn in and forced out of the area within the control cylinder above plunger D-323, thereby avoiding any buildup of pressure in the cylinder and consequent interference with the free up and down movement of the plunger rod D-325 and the plunger discs D-323 and D-324.

As shown in FIGS. 131 and 132, suction control valve D-313 has a nipple D-331 which is connected to suction hose D-316 and a nipple D-332 which is connected to suction hose D-87 which, in turn, is connected to one or more suction feet D-86.

The top of suction control valve D-313 forms a seat which may be sealed by a rubber gasket D-333 which is secured to the bottom face of a lid member D-334 by means of a nut and bolt D-335. The lide member D-334 is pivoted about a pin D-336 which is held in two upwardly projecting arms D-337 which are integral with the body of the suction control valve D-313. At the forward end of lid D-334, there is a projection D-338 which may be lifted by a follower roll D-339. There is also a rod D-341, extending outwardly from the side of projection D-338, which may be easily reached for the purpose of lifting the lid D-334 about the pin D-336 into the dotted line position shown at D-342. In this position, the rearwardly extending portion D-343 of the lid D-334 engages the back surface D-344 of the body of the valve D-313 and hold the lid member in the dotted line position shown at D-342.

When the lid is in the dotted line position shown at D-342, the top of the valve D-313 is left open to the atmosphere and air from the surrounding atmosphere is drawn into the valve by any suction drawn in the suction tube D-316. Under these circumstances, no suction is drawn in the tube D-87 or the suction feet D-86. The manual opening of this valve D-313 in this manner thereby acts as a means of stopping the feeding of paper from the pile feeder, even though the mechanism of the feeder is still being driven. When the lid D-334 is in the solid line position, as shown in FIG. 131, the basket D-333 seals the seat at the top of the control valve D-313 and suction drawn through hose D-316 is, in turn, drawn through hose D-87 and suction feet D-86.

There is a suction bleed valve D-345 in the side of the body of the suction control valve D-313 and, by opening and closing this bleed valve, varying amounts of air from the atmosphere may be bled into the suction line, thereby controlling the intensity of the suction at the suction feet D-86.

In similar fashion, suction control valve D-314 has its lower nipple D-346 connected to suction hose D-318 and its upper nipple D-347 is connected to suction hose D-348 which, in turn, connects with the suckers D-257 of the bottom feeder. Each branch of hose D-348 connects to a nipple D-262 on an individual sucker D-257.

The top seat of suction control valve D-314 may be similarly sealed by a rubber gasket D-349 attached to a lid member D-350 by means of a nut and bolt D-351. Lid D-350 is similarly pivoted about a pin D-336 in arms D-337 which form a part of the body of valve D-314 and a forward projection D-352 of the lid D-350 may be lifted by a follower roll D-353. Lid D-350 also carries an outwardly projecting rod D-354 by means of which it may be manually lifted into the dotted line position shown at D-342, with its back portion D-355 resting against the back face D-356 of the valve D-314. There is also a bleeder valve D-357 by means of which varying amounts of air may be bled into the valve D-314 from the surrounding atmosphere, thereby controlling the intensity of the suction at the suckers D-257.

There is a disc member D-357 on camshaft D-91 which has an inwardly projecting hub D-358 and an outwardly projecting hub D-359. This disc member D-357 is secured to camshaft D-91 by means of a taper pin D-361 through the outwardly projecting hub D-359. There is a pair of adjustable cams D-362 and D-363 adjustably secured to the outer face of disc D-357 by means of a bolt D-364 which passes through arcuate slots in the faces of the two adjustable cams D-362 and D-363. There are two other adjustable cams D-365 and D-366 adjustably secured to the inner face of disc D-357 by means of a bolt D-367 which passes through two arcuate slots in the faces of cam D-365 and D-366. Both bolt D-364 and bolt D-367 are threaded into the disc D-357.

There is a stub shaft D-368 secured to the frame of the feeder D-101 which has an outwardly projecting stud D-369 about which are journalled two rocking arms D-371 and D-372. At one end of arm D-371, there is a cam follower roller D-373 which is in alignment with cams D-362 and D-363. At the other end of arm D-371, there is follower D-339 which is in alignment with the outer projection D-338 of lid D-334. A Spring D-374 connects a spring pin D-375 on arm D-371 with another spring pin D-376 in the body of valve D-313.

At the outer end of arm D-372, there is a cam follower D-377 which is in line with cams D-365 and D-366, and at the other end of arm D-372 a follower D-353 is in line with the forward projection D-352 of lid D-350. There is a spring D-378 which connects a spring pin D-379 in arm D-372 with another spring pin in the face of valve D-314, similar to the pin D-376 on valve D-313. The springs D-374 and D-378 thus cause the followers D-373 and D-377 to remain in contact with the surfaces of the respective pairs of cams with which they are aligned.

When follower D-373 is on the low portion of the combined pair of cams D-362 and D-363, the follower D-339 at the other end of arm D-371 is below the level of projection D-338 of lid D-334, and therefore the rubber gasket D-333 rests on and seals the top of valve D-313. When the follower D-373 is on the high portion of the cams D-362 and D-363, follower D-339 is raised into contact with projection D-338 on lid D-334 and lifts it sufficiently to lift the gasket D-333 out of contact with the seat at the top of control valve D-313, thereby opening the top of control valve D-313 to the atmosphere and allowing air to be drawn into the valve in large volume, thereby cutting off the suction which had previously been drawn in the hose D-87 and the suction feet D-86.

Similarly, the action of cam follower D-377, interacting with cams D-365 and D-366, causes follower D-353 to intermittently lift projection D-352 of lid D-350, thereby automatically opening control valve D-314 to the atmosphere and cutting off the suction drawn in suction hose D-348 and suckers D-257, and alternately allowing gasket D-349 to rest upon the seat at the top of control valve D-314, thereby sealing it and allowing the suction drawn in hose D-318, in turn, to be drawn through hose D-348 and suckers D-257.

By loosening bolt D-364, the two adjustable cams D-362 and D-363 may be rotated about hub D-359 to position the point at which follower D-373 drops onto the low portion of the cams and to position the point at which follower D-373 is lifted onto the high portion of the cams, thereby adjusting the times at which the suction control valve D-313 is closed and suction is drawn in the suction feet D-86, and the time when the control valve D-313 is opened and the suction in the suction feet D-86 is broken.

The timing of the making and breaking of suction in the suckers D-257 of the bottom feeder is similarly adjustable by the use of bolt D-367 and the adjustment of cams D-365 and D-366.

By manually opening either lid D-334 or D-350 and moving it into the dotted line position shown at D-342, the suction may be cut off from either feeder, or from both feeders together, and thus the feeding of sheets from either feeder, or from both feeders, may be manually interrupted, even though the feeder mechanism continues to be driven through its normal operating cycle.

DETECTING AND DEFLECTING MULTIPLE SHEETS FED FROM TWO DIFFERENT FEEDERS

FIG. 135 is a view of the feeders from the same side as shown in FIGS. 121 through 130, and illustrates the means by which each sheet may be calipered to determine whether a single sheet has been fed, and including means for diverting sheets from the normal path whenever more than a single sheet has been fed.

FIG. 135 also illustrates a series of free turning rollers D-381 extending across the width of the support plate D-13 of the bottom feeder D-14 to make it easier for the pull-out rollers D-30 and D-32 of the bottom feeder to withdraw the bottom sheet from the stack. The thumbscrew D-382, by means of which each bracket D-258, for each of the sucker D-257, is secured in position across the rod D-259, is also shown.

Means for calipering the thickness of sheets as they are fed, and for diverting the sheets into a reject hopper whenever it is detected that more than a single sheet has been fed, while allowing single sheets to pass along a normal path onto a conveyor, are well known in the art and are disclosed in detail in W. W. Davidson U.S. Pat. No. 1,930,510, later reissued as U.S. Reissue Pat. No. 20,581. In such devices, however, sheets of a single thickness are fed from a single feeder and the calipers consist of two members, one of which is a rotating steel roller, in fixed position, which forms the bottom member of the caliper and a rockable upper member held in position above the lower roller. The upper rockable member is the upper member of the caliper and is mounted in such a manner that it may be adjustably spaced from the lower member and adjusted to and from the lower member by minute increments considerably smaller than the thickness of the thinnest sheet to be fed. The space between the calipers is then set so that a single sheet may pass through without moving the rockable member, but, if a plurality of sheets are presented to the caliper, the rockable member is rocked thereby, thus triggering the diversion of the sheets from their normal path into a reject hopper. This, essentially, is the arrangement disclosed in U.S. Reissue Pat. No. 20,581.

In the device disclosed herein, however, there are two feeders coordinated to feed sheets alternately to a common set of main pull-out rollers, and it is contemplated that the sheets fed from the pile feeder will not necessarily be of the same thickness as the sheets fed from the bottom feeder. The structure illustrated in FIG. 135 comprises an improvement over the device known in the art as shown for example in U.S. Reissue Pat. No. 20,581 in that it provides means by which the spacing of the calipers may be set to alternate between one spacing when sheets from the pile feeder pass through the main pull-out rollers, and another spacing when sheets from the bottom feeder pass between the main pull-out rollers.

The spacing between the calipers is independently adjustable for each circumstance and is set to allow the undisturbed passage of sheets from the pile feeder wil detecting the presence of more than a single sheet fed from the pile feeder, and is independently set to allow the undisturbed passage of sheets of the same or of a different thickness from the bottom feeder, while detecting the presence of more than a single sheet fed from the bottom feeder. The adjustments are made separately and independently and may be set to operate, as described, irrespective of whether the sheets fed from the pile feeder and the bottom feeder are of the same thickness, whether the sheets from the bottom feeder are thicker than the sheets fed from the pile feeder, or whether the sheets fed from the pile feeder are thicker than the sheets fed from the bottom feeder.

As seen in FIG. 135, the upper member of the caliper is a rockable member D-383 mounted for rotation about stationary shaft D-307 which is held in a mounting bracket D-49B which carries a pair of support brackets D-384 between which the member D-383 is secured. The assembly is in turn secured to a spreader D-51 and placed between two upper feed rolls D-44. The caliper member D-383 is normally held in the position shown by means of spring D-385 which connects the spring pin D-386 on the side of the caliper D-383 with a spring pin D-387 on the side of a bracket arm D-384, and thus holds the upper face of the caliper member D-383 against a limit pin D-309 which extends between the support brackets D-384. The calipering face D-383 of the rockable caliper D-383 is spaced apart from the surface of the lower pull-out roller D-43, which forms the other, adjustable calipher member, by a distance such that a single sheet may be drawn through the gap without disturbing the caliper D-383. There is a latch member D-389 carried by a forward projecting arm D-391 of caliper D-383, and, in its normal position, it engages another latching member D-392 mounted at the outer end of an arm D-393 which is pivoted about a pin D-394 which spans the support brackets D-384.

In a manner similar to that well known in the art and for example illustrated and described in detail in U.S. Reissue Pat. No. 20,581, the latch member D-392 is held out of contact with latch D-389 at the time the leading edge of a sheet or sheets enters the bite between the caliper face D-388 and the lower caliper member, roller D-43, so that caliper member D-383 is free to rock. If only a single sheet is present, the caliper D-383 remains undisturbed.

Before the leading edge of the sheet reaches the bite between conveyor roller D-63 and the spherical roller members D-65, a plunger attempts to move the deflector plate D-67 into sheet deflecting position. However, if only a single sheet had been fed, and caliper D-383 therefore remains undisturbed, the latch member D-392 engages latch member D-389 which prevents the deflector plate D-67 from moving into sheet deflecting position, and it remains in the position seen in FIG. 135 and the sheet passes over it and onto the conveyor tapes.

If more than a single sheet is presented to the bite between the caliper surface D-388 and the surface of roller D-43, the combined action of the upper pull-out rolls D-44 and the lower pull-out roller D-43 draws the leading edge of the multiple sheets through the bite D-42, and the force of the multiple sheets thus being drawn through the bite against the caliper surface D-388 causes the caliper member D-383 to be rocked in a counterclockwise direction against the action of spring D-385 and lifts the latch member D-389 above the position of the latch member D-392. Then, as the plunger attempts to move the sheet deflector plate D-67 into sheet deflecting position, the latch D-389 has been moved out of the path of the latch D-392 and the sheet deflector D-67 moves into sheet deflecting position, and the multiple sheets are deflected into the reject tray D-29. The manner in which the latch member D-392, the plunger (not shown), and the deflector plate D-67 are interconnected is well known in the arts, as for example as illustrated and described in U.S. Reissue Pat. No. 20,581. However, in the commonly used structure and as disclosed in that patent, the adjustment of the space between the two caliper members is accomplished by moving the rockable caliper member, such as D-383, upward or downward by minute increments. In the structure shown in FIG. 135, the position of the shaft D-307 about which the caliper D-383 rotates, is fixed.

The shaft D-167, about which the lower pull-out roller D-43 (which forms the lower member of the caliper) rotates, is mounted in the feeder frames by means of eccentric end stub shafts D-168 integral with shaft D-167 and which are journalled in the two feeder frames D-101. The means by which lower pull-out roller D-43 is driven about shaft D-167 is illustrated and described in FIGS. 125 and 126.

The end stub shaft D-168 at the near end of shaft D-167, and which projects through the near side frame D-101 as shown in FIG. 135, is journalled therein and projects through the frame and beyond, and at its lower end an arm D-396, with a hub portion D-397, is fitted to shaft projection D-168 and is secured thereto by means of a taper pin D-398. Thus, if the arm D-396 is moved in a counterclockwise direction, as seen in FIG. 135, it rotates eccentric end stub D-168 in a counterclockwise direction, thereby moving the center of shaft D-167 and lower feed roll D-43 downward, away from the calipering face D-388 of upper caliper member D-383. Conversely, if the arm D-396 is rotated in a clockwise direction, it rotates eccentric end stub shafts D-168 in a clockwise direction and causes the center of shaft D-167 and the center of lower feed roll D-43 to be moved upward, toward the caliper face D-388 of upper caliper member D-383.

There is a stud D-399 secured to the feeder frame D-101. A hub D-401 is journalled for rocking motion about stud D-399. Integral with hub D-401 is an arm D-402 which carries a cam follower roller D-403 at its outer end. Cam follower roller D-403 is in line with a cam D-404 which is secured to camshaft D-91 by means of taper pin D-405. Also inegral with hub D-401 are two arms of equal length D-406 and D-407. A shaft D-408 is bent into an arc and passes through a hole D-409 in arm D-396 and is secured at either end to arms D-406 and D-407 by means of two nuts D-411 and D-412. A spring D-413 encircles shaft D-408 between the arm D-407 and the adjacent face of arm D-396. Another spring D-414 encircles shaft D-408 between arm D-406 and the adjacent face of arm D-396. Thus, when cam follower D-403 is on the high portion of cam D-404, spring D-414 is compressed and urges shaft D-396 to move in a clockwise direction. When cam follower D-403 is on the low portion of cam D-404, spring D-413 is compressed and urges arm D-396 in a counterclockwise direction. A spring D-415 connects a spring pin D-416 on arm D-402 with another spring pin D-417 in the frame D-101 of the feeder, and thereby acts to hold cam follower D-403 in contact with the surface of cam D-404 at all times.

When arm D-396 is being urged in a clockwise direction by spring D-414, as seen in FIG. 135, its clockwise motion is limited by the nose D-418 of a thumbscrew D-419. Thumbscrew D-419 is threaded through a block D-421 which is secured to the feeder frame D-101. The threads in block D-421 and on thumbscrew D-419 are fine so that the position of arm D-396 may be varied by small increments. There is a spring clip D-422 secured to the block D-421 which has a projection which engages the teeth of a ratchet D-423, which is integral with the thumbscrew D-419. The projection on the spring clip D-422, fitting between the teeth of the ratchet D-423, thus acts to hold the thumbscrew D-419 in any given position of adjustment.

The cam D-404 is in the position shown in FIG. 135, and spring D-414 is compressed and arm D-396 is held in contact with point D-418 of thumbscrew D-419 at the time that a sheet from the "pile" feeder is presented to the bite D-42 of the main pull-out rollers.

Thus, thumbscrew D-419 is adjusted to create a gap between caliper surface D-388 of the upper caliper member D-383 and the surface of the lower caliper member, lower pull-out D-43, suffficient to allow a single sheet of the thickness being fed from the "pile" feeder to pass between the caliper members without disturbing the upper caliper member D-383, but small enough so that if more than a single sheet, of the thickness being fed from the "pile" feeder, is presented to the bite of the main pull-out rollers, the rockable caliper feeder D-383 will be rocked to raise latch D-389 above and out of the way of latch D-392, as previously described, and the reject gate D-67 will move into sheet deflecting position.

The cam follower D-403 is on the low portion of cam D-404, spring D-413 is compressed and arm D-396 is held against the point D-424 of thumbscrew D-425 at the time that a sheet from the "bottom" feeder is presented to the bite D-42 of the main pull-out rollers. Thumbscrew D-425 has similarly fine threads and is threaded into a block D-426 secured to the frame D-101 of the feeder. A projection of a similar spring clip D-427 bears between the teeth of a ratchet D-428 which is integral with the thumbscrew D-425, and thus holds it at any given position of adjustment. Thus, the thumbscrew D-425 is adjusted to create a gap between the calipering surface D-388 of the rockable caliper member D-383 and the surface of lower pull-out roller D-43 sufficient to pass a single sheet of the thickness being fed from the "bottom" feeder without disturbing the upper caliper member D-383, but small enough so that, if two or more sheets are fed from the "bottom" feeder, the rockable caliper member D-383 will be rocked upward in the manner previously described, and the reject gate D-67 will move into sheet deflecting position.

As the machine operates and cam D-404 rotates with camshaft D-91, the arm D-396 is held against the point D-418 of thumbscrew D-419 when sheets from the "pile" feeder are presented to the bite D-42 of the main pull-out rollers, and arm D-396 is held against the point D-424 of thumbscrew D-425 when sheets from the "bottom" feeder are presented to the bite D-42 of the main pull-out rollers.

If the sheets being fed from the two feeders are equal in thickness, the point D-418 of thumbscrew D-419 and the point D-424 of thumbscrew D-425 will both be adjusted to bear against the sides of arm D-396 and hold it in a fixed position. If the sheets are of different thickness, the thicker sheets must be fed from the "bottom" feeder and the thinner sheets must be fed from the "pile" feeder when the cam D-404 is affixed to cam shaft D-91 as shown in FIG. 135. The arm D-396 will therefore move in a clockwise direction into contact with point D-418 of thumbscrew D-419 to create the smaller gap between the caliper members necessary for the thinner sheets from the "pile" feeder and will move in a counterclockwise direction into contact with point D-424 of thumbscrew D-425 to create the wider gap required for the thicker sheets fed from the "bottom" feeder. The arrangement is normally set in this fashion since the "bottom" feeder is inherently able to handle thicker sheets and is somewhat limited in it's ability to handle very thin sheets, whereas the "pile" feeder will handle extremely thin sheets as well as thicker sheets. When sheets of different thickness are being fed, the thinner sheets are fed from the "pile" feeder, and the thicker sheets are fed from the bottom feeder.

Should a situation arise, however, in which it would become necessary to feed thicker sheets from the "pile" feeder and thinner sheets from the "bottom" feeder, the cam D-404 could be affixed to camshaft D-91 by means of a straight roll-pin or a "half-dog-point-set-screw" and then, by removing the roll-pin or set screw, cam D-404 may be rotated through 180 degrees and the roll-pin or set screw reinserted. The timing would then be reversed and thumbscrew D-419 would control the setting for the thinner sheets from the "bottom" feeder, and thumbscrew D-425 would then control the setting for the heavier sheets from the "pile" feeder.

CAMSHAFT AND ASSOCIATED MECHANISM

FIGS. 136, 137 and 138 show the camshaft D-91 as viewed from both sides and from above. FIG. 136 shows the camshaft D-91 and the various cams affixed thereto together with the cam followers for each, as seen from the right side of the feeder which is the same side seen in FIGS. 121, 121A, 128, 129, 130 and 135. FIG. 137 is a plan view of the entire camshaft D-91 and showing the gear D-111, the various cams and the timing discs affixed thereto. FIG. 138 is a view of the camshaft D-91 from the left side of the feeder and shows the timing disc D-328, the cams, and the cam followers which are located on the left side of the feeder and which are also seen in FIGS. 131, 132, 133 and 134. These three FIGS. 136, 137 and 138 show the interrelationship of all the elements affixed to camshaft D-91 to each other, to the gear D-111 by which the camshaft is driven, and to all of the new cam followers and cam followers and cam follower arms associated with the cam on camshaft D-91, all of which are shown in individual detail in FIGS. 128 through 135.

FIGS. 136 and 137 also illustrate the purpose of the slot D-189 in the stud D-97, as seen in FIG. 124. The purpose, as seen in FIGS. 136 and 137, is to clear cam D-404 as it revolves with camshaft D-91.

CHART OF OPERATING CYCLE OF FEEDERS

FIG. 139 is a chart showing the sequence of feeder operations for the "pile" and "bottom" feeders in combination. The operation of each of the major elements of the two feeders is chartered through one complete 360 degree cycle of rotation of feeder camshaft D-91. As shown on the chart, the following conditions prevail:

I. At zero degrees, at the start of cycle:

(a) The suction feet D-86 for the "pile" feeder D-15 are stationary above the line of paper travel D-17 for the sheets D-25 from the "bottom" feeder D-14, and have been in this position for 113 degrees of the previous cycle.

(b) The suckers D-257 for the "bottom" feeder D-14 are stationary in their "down" position, and have been in this position for 150 degrees of the previous cycle.

(c) The lower paper guide plate D-36 and its fingers D-278 are in the "down" position, and have been stationary in this position for 150 degrees of the previous cycle.

(d) The upper pull-out rollers D-32 for the "bottom" feeder, together with the back portion D-41 of the upper paper guide, are moving forward. They started forward from their rear position 25 degrees earlier in the previous cycle.

(e) The lower pull-out rollers D-30 from the "bottom" feeder are being driven at a constant rate of speed.

(f) A sheet D-25 from the "bottom" feeder is being delivered onto the conveyor board through the bite D-42 of the main pull-out rollers. Its trailing edge cleared the pull-out rollers D-30 and D-32 of the "bottom" feeder 9 degrees earlier in the previous cycle, but at this time has not yet cleared the downward path of the suction feet D-86 of the "pile" feeder, or of the leading edge of the lower paper guide fingers D-278, and it is still in the bite D-42 of the main pull-out rollers.

(g) The top sheet D-75 on the pile of sheets in the "pile" feeder is at rest on the top of the pile as it has been for 165 degrees of the previous cycle. Air is being blown between the sheets at the top of the pile in the "pile" feeder, and the top sheet D-75 is floating on this cushion of air, and has been blown upwardly thereby into contact with the cat's whisker D-81.

(h) There is no suction being drawn in either the suction feet D-86 of the "pile" feeder or the suckers D-257 of the bottom feeder.

II. At 7 degrees into the cycle, the trailing edge of the sheet D-25 from the "bottom" feeder clears the downward path of the suction feet D-86 of the "pile" feeder.

III. At 7 degrees into the cycle, the suction feet D-86 of the "pile" feeder start to move down to contact the next sheet D-75 on the top of the pile.

IV. At 11 degrees into the cycle, the trailing edge of the sheet D-25 from the "bottom" feeder clears the path of the fingers D-278 of the lower paper guide plate D-36.

V. At 14 degrees into the cycle, the trailing edge of the sheet D-25 from the "bottom" feeder clears the bite D-42 of the main pull-out rollers.

VI. At 14 degrees into the cycle, the suckers D-257 of the "bottom" feeder start to move upwardly toward the next bottom sheet D-25 in the stack D-11 of sheets in the "bottom" feeder.

VII. At 14 degrees into the cycle, the fingers D-278 of the lower guide plate D-36 start to move upwardly out of the path D-88, to be followed by sheet D-75 as it is presented to the bite D-42 of the main pull-out rollers.

VIII. At 27 degrees into the cycle, the suction feet D-86 of the "pile" feeder reach their "down" position and contact the top surface of the sheet D-75 on the top of the pile D-29.

IX. At 27 degrees into the cycle, suction is drawn in the suction feet D-86, causing the suction feet to seize the top sheet D-75 on the pile D-20.

X. At 27 degrees into the cycle, the drawing of suction in feet D-86, and their seizing of the top sheet D-75, blocks the air intake to the pump, and shortly thereafter causes the air to stop blowing between the sheets at the top of the pile.

XI. At 32 degrees into the cycle, the suction feet D-86 start to move upwardly.

XII. At 32 degrees into the cycle, the top sheet D-75 on the pile D-20, which has been at rest on the top of the pile for 165 degrees of the previous cycle, starts to be lifted off of the pile D-20 by the suction feet D-86, and the leading edge of the sheet D-75 is flicked over the cat's whisker D-81 which acts to hold back the next sheet.

XIII. At 48 degrees into the cycle, the upper pull-out rolls D-32 of the "bottom" feeder and the back portion D-41 of the upper paper guide have moved far enough forward so that the suckers D-257 can rise without interference with the shaft D-33 of the upper pull-out rolls D-32.

XIV. At 52 degrees into the cycle, the fingers D-278 of the lower paper guide plate D-36 have risen out of the path of travel D-88 of the sheet D-75 from the pile feeder.

XV. At 73 degrees into the cycle, the suction feet D-86 of the "pile" feeder have risen to a position just opposite the bite D-42 of the main pull-out rollers.

XVI. At 73 degrees into the cycle, the leading edge of the sheet D-75 carried by the suction feet D-86 is seized in the bite D-42 of the main pull-out rollers.

XVII. At 74 degrees into the cycle, the suction in the suction feet D-86 is broken, causing the suction feet to release the sheet D-75.

XVIII. At 74 degrees into the cycle, the release of the sheet by the suction feet D-86 opens the air inlet to the pump and causes air once again to be blown between the sheets at the top of the pile D-20.

XIX. At 76 degrees into the cycle, the suction feet D-86 start to move up, above the position of the bite D-42 of the main pull-out rollers.

XX. At 85 degrees into the cycle, the suction feet D-86 have risen completely out of the path D-88 of the sheet D-75 from the "pile" feeder, but not above the path of a sheet D-25 from the "bottom" feeder.

XXI. At 120 degrees into the cycle, the suckers D-257 of the "bottom" feeder have risen to their top position and are in contact with the bottom of the next sheet D-25 in the stack D-11.

XXII. At 127 degrees into the cycle, suction is drawn in the suckers D-257, causing them to seize the bottom sheet D-25 in the stack D-11.

XXIII. At 127 degrees into the cycle, the seizing of the sheet D-25 by the suckers D-257 cuts off the air intake to the pump, causing the air being blown between the sheets at the top of the pile D-20 to stop shortly thereafter.

XXIV. At 135 degrees into the cycle, the suckers D-257 start to move downwardly.

XXV. At 135 degrees into the cycle, the leading edge of the bottom sheet D-25 starts to be bent down, as it is pulled down by the suction in the suckers D-257. No force is exerted in a direction to pull the sheet from under the stack D-11 however.

XXVI. At 135 degrees into the cycle, the upper pull-out rolls D-32 and the back portion D-41 of the upper paper guide reach their forwardmost position out of the downward path of the leading edge of the sheet D-25.

XXVII. At 187 degrees into the cycle, the upper pull-out rolls D-32 and back portion D-41 of the upper paper guide start to move rearwardly and down, following in above the leading edge of the sheet D-25.

XXVIII. At 188 degrees into the cycle, the fingers D-278 of the lower paper guide plate D-36 start to move down to clear the path for the sheet D-25.

XXIX. At 191 degrees into the cycle, the trailing edge of the sheet D-75 from the "pile" feeder clears the path to be later followed by the downward movement of the suction feet D-86, and at 193 degrees it clears the downward path of the fingers D-278 of the lower paper guide plate D-36.

XXX. At 194 degrees into the cycle, the trailing edge of the sheet D-75 from the "pile" feeder clears the bite D-42 of the main pull-out rollers, and at 195 degrees into the cycle the next sheet D-75 is at rest on top of the pile, ready to be picked up by the suction feet D-86 later in the next cycle.

XXXI. At 210 degrees into the cycle, the suckers D-257 of the "bottom" feeder reach their down position.

XXXII. At 210 degrees into the cycle, the sheet D-25 has been bent down, as it has been pulled down by the suckers D-257, to the point where the bottom surface of the sheet D-25 just contacts the surface of the lower pull-out rollers D-30.

XXXIII. At 120 degrees into the cycle, the fingers D-278 of the lower paper guide plate D-36 have reached their down position, clearing the path for the sheet D-25, and acting as a guide to direct the sheet toward the bite D-42 of the main pull-out rollers.

XXXIV. At 230 degrees into the cycle, the upper pull-out rolls D-32 have moved down into contact with the upper surface of the sheet D-25 so that the sheet is seized between the upper pull-out rolls D-32 and the constantly driven lower pull-out rolls D-30.

XXXV. At 230 degrees into the cycle, the sheet D-25 starts to move forward as it is pulled out from the bottom of the stack D-11 by the pull-out rollers D-30 and D-32.

XXXVI. At 230 degrees into the cycle, the suction in the suckers D-257 is broken, causing them to release the sheet D-25.

XXXVII. At 230 degrees into the cycle, the release of the sheet by the suckers D-257 opens the air inlet to the pump, causing air again to be blown between the sheets at the top of the pile D-20.

XXXVIII. At 247 degrees into the cycle, the suction feet D-86 of the "pile" feeder reach their uppermost position out of the path D-17 of the sheet D-25 from the "bottom" feeder.

XXXIX. At 253 degrees into the cycle, the leading edge of the sheet D-25 from the "bottom" feeder enters the bite D-42 of the main pull-out rollers. This is exactly 180 degrees after the leading edge of the sheet D-75 from the "pile" feeder entered the bite D-42 of the main pull-out rollers, so that the two sheets from the two separate feeders are both presented to the conveyor at the same point in the cycle of revolution of the lower printing cylinder and therefore of the register stop fingers 25.

XL. At 331 degrees into the cycle, the trailing edge of the sheet D-25 from the "bottom" feeder clears the stack D-11 at point D-26.

XLI. At 335 degrees into the cycle, the upper pull-out rolls D-32 and the back portion D-41 of the upper paper guide start to move up and forward.

XLII. At 351 degrees into the cycle, the trailing edge of the sheet D-25 from the "bottom" feeder clears the pull-out rollers D-30 and D-32 of the "bottom" feeder.

XLIII. At 360 degrees into the cycle, the next cycle begins and the process is repeated.

There are a number of vertical lines drawn on the chart illustrated in FIG. 139 and labeled to represent different Figure numbers corresponding to the Figures showing various elements of the two feeders. The first line, labeled FIGS. 136, 137 and 138, defines the position in the cycle of the various elements seen in FIGS. 136, 137 and 138. The next line, labeled FIG. 128, defines the position in the cycle of the various elements as seen in FIG. 128. Similar vertical lines, labeled FIG. 129, FIG. 131, FIG. 135, FIG. 130 and FIG. 133, define the positions in the cycle of the various elements as seen in each of those Figures, and the 360 degree point again represents the position in the cycle of the various elements, as seen in FIGS. 136, 13*y* and 138.

COORDINATING FEEDERS RELATIVE TO PRINTING CYLINDERS

If the drive mechanism of FIGS. 121, 122, 123 and 124 has been set to cause camshaft D-91 to make one revolution for each revolution of large printing cylinder 22, and if sheets are loaded into both the "pile" feeder and the "bottom" feeder, then a sheet will be delivered to each revolution of lower printing cylinder 20, with the sheets coming alternately from the "pile" feeder and the "bottom" feeder.

If, on the other hand, the drive mechanism of FIGS. 121 through 124 has been set to cause camshaft D-91 to make one-half revolution for each revolution of large printing cylinder 22, and if sheets are loaded into both the "pile" feeder and the "bottom" feeder, then a sheet will be fed to every other revolution of lower printing cylinder 20, with the sheets coming alternately from the "pile" feeder and the "bottom" feeder.

If the camshaft D-91 is set to make one revolution for each revolution of large printing cylinder 22, sheets may be loaded into the "pile" feeder only, or into the "bottom" feeder only, and in either case one sheet will be fed to each revolution of large printing cylinder 22, or to every other revolution of lower printing cylinder 20.

If sheets are loaded into the "pile" feeder only, then the timing mark D-125 on gear D-111, as seen in FIG. 122, is placed between the timing marks D-126 which are marked "pile Only" on gear D-109. If sheets are placed in the "bottom" feeder only, then the timing mark D-125 on gear D-111 is placed between the timing marks D-127 which are marked "bottom only" on the face of gear D-109.

The camshaft D-91 may be set to make two revolutions for each revolution of large printing cylinder 22, or one revolution for each revolution of lower printing cylinder 20. In this case, sheets may be loaded into the "pile" feeder only, or into the "bottom" feeder only, but not into both.

If sheets are loaded into the "pile" feeder only, the cam follower D-293 of FIG. 130 is removed and the upper pull-out rolls D-32 are held in their down position against lower pull-out rolls D-30 by the action of spring D-296. Also, cam follower D-271 of FIG. 129 is removed and the suckers D-257 are held in their "up" position by the action of spring D-274. Thus, the way is clear for the operation of the suction feet D-86 for the "pile" feeder on each revolution of camshaft D-91 and a sheet from the "pile" feeder is thus fed to each revolution of lower printing cylinder 20.

In this case, the timing mark D-125 on the face of gear D-111, as seen in FIG. 122, should be placed between the timing marks D-126 which are marked "pile only" on the face of gear D-109.

If sheets are to be placed in the "bottom" feeder only, the timing mark D-125 on the face of gear D-111 should be placed between the timing marks D-127 where are marked "bottom only" on the face of gear D-109. In this case, the cam follower D-238 of FIG. 128 is removed, and the suction feet D-86 for the "pile" feeder are held in their maximum raised position by the action of springs D-242, D-234 and D-224, and sheets are then fed from the "bottom" feeder only, with one sheet being fed to each revolution of lower printing cylinder 20.

In each of the operations described, the sheets are fed in timed relationship with the rotation of the lower printing cylinder 20 and the large printing cylinder 22, and timed so that the leading edge of each sheet will reach the stop fingers 25 of the press when they are in the "up" position, and before the upper feed roll 28 moves down to grip the sheet against the lower feed roll 27.

PRINTING AND COLLATING ON 3R PRESS

The chart of FIG. 140 includes a diagram of a 3R model press showing the arrangement of three feeders mounted in cooperative relationship with each other and with the press itself. This diagram is directly comparable to the press and feeder arrangement of FIG. 141, and is for the purpose of relating the structure of FIG. 141 to the chart of FIG. 140. The feeding of sheets from the several feeders is represented by bars depicting the sheets fed from the respective feeders.

FIG. 141 shows the model 3R press, generally designated 3010, with a lower printing cylinder 20, referred to in the chart of FIG. 140 as LoC, and a large printing cylinder, generally designated 3022, which is referred to in the chart as LgC. The three work areas of the large printing cylinder are shown in FIG. 141 and are marked 1st, 2nd and 3rd to correspond to the revolutions of the lower printing cylinder in which the lower printing cylinder 20 contacts each of these work areas successively throughout one complete revolution of the large printing cylinder 3022. The direction of rotation of the cylinders is indicated by the arrows. There are two "bottom" feeders A and B and a "pile" feeder C shown in cooperative relationship with the press 3010.

BAR CHART

As shown in the legend which accompanies the chart of FIG. 140, sheets from feeder C are shown as a single thin bar, sheets from feeder B are shown as a single heavy bar, and sheets from feeder A are shown as elongated open bar or rectangle. This is used in the chart to illustrate various patterns of feeding from the three feeders, to produce various combinations of printed and collated sheets. The sheets from the three feeders may vary in thickness, as would seem to be implied by the legend used, but they also may all be of the same thickness and vary from each other in color, and/or material or texture, and/or length. When the sheets in the three feeders vary from each other in thickness, the thicker sheets may be placed in any one of the three feeders, the thinnest sheets may be placed in any one of the three feeders, and, if there are sheets intermediate in thickness between the thickest and thinnest, these in turn may be placed in any one of the three feeders.

The chart illustrates nine different patterns of feeding that may be presented to the press to be printed in various combinations, as previously described, thereby to produce various combinations of printed and collated sheets as they emerge from the press. In order to fully illustrate each pattern of sheets fed, the chart encompasses six revolutions of the large printing cylinder, and each of these revolutions of the large printing cylinder 3022 is broken down into the corresponding three revolutions of the lower printing cylinder 20.

In the three feeding patterns shown in the chart as I, II, and III, the feeder camshafts D-431, D-432 and D-433 each make one revolution for each revolution of the lower printing cylinder 20. Suction to each feeder is provided by a separate pump, and suction is drawn at the suction feet of each feeder on each revolution of the camshafts unless the suction valve for that feeder is held open, as indicated by the legend "hold suc.open". All feeders are timed to feed together in patterns I, II and III.

To accomplish the feeding pattern illustrated as I, sheets are loaded into "pile" feeder C only, and a sheet from "pile" feeder C is fed to each revolution of the lower printing cylinder throughout all revolutions of the large printing cylinder.

To accomplish the feeding pattern illustrated as II, sheets are loaded into "pile" feeder C only, and the suction valve of that feeder is held open on each second revolution of the lower printing cylinder 20 so that sheets are not picked up and fed on that revolution. The result is that a sheet from the "pile" feeder C is fed to the first revolution of the lower printing cylinder and to the third revolution of the lower printing cylinder on each revolution of the large printing cylinder. The sheet fed to the first revolution of lower printing cylinder 20 may pass thru the bite between the large and lower printing cylinders once or twice.

To accomplish the feeding pattern shown at III, sheets of one type are loaded into "pile" feeder C, and sheets of another type are loaded into "bottom" feeder B. The suction valve of "pile" feeder C is held open on each third revolution of lower printing cylinder 20, and the suction valve of "bottom" feeder B is held open on each second and third revolution of lower printing cylinder 20.

Thus, on the first revolution of lower printing cylinder 20 a sheet from the pile D-434 of "pile" feeder C is fed into position against the stop fingers D-435, and at the same time a sheet from the stack D-436 of "bottom" feeder B is fed into position against the stop fingers D-437.

On the second revolution of lower printing cylinder 20, the sheet whose leading edge was in position against the stop fingers D-437 advances to the point where its leading edge is in contact with the stop fingers of the press D-25, and the sheet whose leading edge was in contact with stop fingers D-435 advances to the point where its leading edge is in contact with stop fingers D-437. Another sheet is fed from the pile D-434 of "pile" feeder C and advances so that its leading edge is in contact with stop fingers D-435. No sheet is fed from "bottom" feeder B.

On the third revolution of lower printing cylinder 20, the sheet whose leading edge was in contact with the stop fingers D-25 of the press passes through the bite of the large and lower printing cylinders and is delivered into the receiving tray G-12. The sheet whose leading edge was in contact with stop fingers D-437, advances so that its leading edge is in contact with the stop fingers D-25 of the press. The sheet whose leading edge was in contact with stop fingers D-435, advances so its leading edge is in contact with stop fingers D-437. No sheet is fed from either "pile" feeder C or "bottom" feeder B.

On the first revolution of lower printing cylinder 20 corresponding to the second revolution of large printing cylinder 3022, the sheet whose leading edge was against the stop fingers D-25 of the press passes through the bite between the large and lower printing cylinders and into the receiving tray G-12. The sheet whose leading edge was in contact with stop fingers D-437, advances so that its leading edge is in contact with the stop fingers D-25 of the press. A sheet is fed from "pile" feeder C, and its leading edge advances into position against stop fingers D-435. A sheet is fed from "bottom" feeder B, and its leading edge advances into position against stop fingers F-437. This process then repeats, producing the pattern of feeding illustrated at III.

In the case of the three patterns IV, V and VI, the three feeder camshafts D-431, D-432 and D-433 each make one revolution for each revolution of the large printing cylinder 3022 and "pile" feeder C is timed to feed with the first revolution of lower printing cylinder 20. "Bottom" feeder B is timed to feed with the second revolution of the lower printing cylinder 20. "Bottom" feeder A is timed to feed with the third revolution of the lower printing cylinder 20.

To achieve the pattern of feeding illustrated at IV, the sheets are loaded into "pile" feeder C only. On the first revolution of the large printing cylinder 3022, a sheet is fed from "pile" feeder C at the time that the lower printing cylinder 20 is making its first revolution so that, as the lower printing cylinder comples its first revolution, the leading edge of the sheet comes in contact with the stop fingers D-435. As lower printing cylinder 20 completes its second revolution, the leading edge of the sheet moves from the stop fingers D-435 to the stop fingers D-437, but no additional sheet is fed. As lower printing cylinder 20 completes its third revolution, the leading edge of the sheet moves from the stop fingers D-437 to the stop fingers D-25 of the press, but no additional sheet is fed. On the second revolution of the large printing cylinder 3022, as lower printing cylinder 20 completes its first revolution, another sheet is fed from "pile" feeder C, and its leading edge comes into contact with stop fingers D-435. The sheet whose leading edge was in contact with the stop fingers D-25 of the press passes through the bite between the large and lower printing cylinders and is either delivered directly into the receiving tray G-12 or first carried around the lower printing cylinder and thru the bite between the large and lower printing cylinders one or two additional times. This process repeats and produces the pattern of feeding illustrated at IV on the chart.

To produce the pattern of feeding illustrated at V on the chart, sheets are loaded into "pile" feeder C and into "bottom" feeder B only. The suction valve is held open on the "bottom" feeder B on the second, fourth, sixth and succeeding even numbered revolutions of the large printing cylinder 3022. The suction valve is held open on the "pile" feeder C on the first, second, third and succeeding odd numbered revolutions of the large printing cylinder 3022.

On the first revolution of the large printing cylinder 3022, and timed with the second revolution of lower printing cylinder 20, a sheet is fed from "bottom" feeder B so that its leading edge contacts stop fingers D-437. Since the suction valve was held open on the "pile" feeder C, no sheet was fed therefrom. On the third revolution of lower printing cylinder 20, the leading edge of the sheet moves from the stop fingers D-437 to the stop fingers D-25 of the press.

On the second revolution of the large printing cylinder 3022, and during the first revolution of lower printing cylinder 20, a sheet is fed from "pile" feeder C so that its leading edge comes in contact with the stop fingers D-435. Since the suction valve is held open on "bottom" feeder B, no sheet is fed therefrom. The sheet previously fed from "bottom" feeder B moves from its position in contact with stop fingers D-25 through the bite between the lower printing cylinder and the first work area of the large printing cylinder and either directly into the receiving tray G-12, or is first carried thru the bite between the large and lower printing cylinders one or two additional times. On the second revolution of lower printing cylinder 20 the sheet from "pile" feeder C moves from stop fingers D-435 into position with its leading edge in contact with stop fingers D-437. On the third revolution of lower printing cylinder 20, this sheet moves from stop fingers D-437 into contact with the stop fingers D-25 of the press.

On the third revolution of the large printing cylinder 3022, and coincident with the first revolution of lower printing cylinder 20, no sheet is fed from "pile" feeder C, since the suction valve thereon is held open. The sheet previously fed from the "pile" feeder moves from its position in contact with the stop fingers D-25 thru the bite between the lower printing cylinder and the first work area of the large printing cylinder and either directly into the receiving tray G-12, or is first carried thru the bite between the large and lower printing cylinders one or two additional times. Coincident with the second revolution of lower printing cylinder 20 a sheet is fed from "bottom" feeder B into position with its leading edge in contact with stop fingers D-437. The process then repeats, as described, thereby creating the pattern of feeding illustrated at V in the chart of FIG. 140.

To produce the pattern of feeding illustrated at VI on the chart, sheets are placed in all three feeders and the suction valves are held open on "bottom" feeder A and on "pile" feeder C on the first and fourth revolutions of the large printing cylinder 3022. The suction valves are held open on "pile" feeder C and on "bottom" feeder B on the second and fifth revolutions of the large printing cylinder 3022. The suction valves are held open on "bottom" feeder A and on "bottom" feeder B on the third and sixth revolutions of the large printing cylinder 3022.

On the first revolution of the large printing cylinder 3022, no sheet is fed from "pile" feeder C or from "bottom" feeder A, since the suction valves are held open on both these feeders. However, a sheet previously fed from "pile" feeder C moves from a position with its leading edge in contact with stop fingers D-25 through the bite between lower printing cylinder 20 and the first work area of large printing cylinder 3022 and into the receiving tray G-12 on the first revolution of lower printing cylinder 20. During the second revolution of lower printing cylinder 20, a sheet is fed from "bottom" feeder B into position in contact with stop fingers D-437. During the third revolution of lower printing cylinder 20, this sheet moves from stop fingers D-437 into contact with stop fingers D-25.

On the second revolution of the large printing cylinder 3022, and coincident with the first revolution of lower printing cylinder 20, this sheet from "bottom" feeder B moves through the bite between lower printing cylinder 20 and the first work area of large printing cylinder 3022 and into the receiving tray G-12. No sheet is fed from "pile" feeder C or from "bottom" feeder B, since the suction valves on these two feeders are held open. Coincident with the third revolution of lower printing cylinder 20, a sheet is fed from "bottom" feeder A into contact with stop fingers D-25.

On the third revolution of the large printing cylinder 3022, coincident with the first revolution of lower printing cylinder 20, the sheet from "bottom" feeder A is fed from its position in contact with stop fingers D-25 through the bite between lower printing cylinder 20 and the first work area of large printing cylinder 3022 into the receiving tray G-12. Also coincident with the first revolution of lower printing cylinder 20, a sheet is fed from "pile" feeder C into contact with stop fingers D-435. No sheet is fed from either "bottom" feeder A or "bottom" feeder B, since the suction valves of these two feeders are held open. On the second revolution of lower printing cylinder 20, the sheet from "pile" feeder C moves from stop fingers D-435 to stop fingers D-437, and on the third revolution of lower printing cylinder 20, this sheet moves from stop fingers D-437 to stop fingers D-25. The process then repeats as large printing cylinder 3022 begins its fourth revolution, and the pattern of feeding illustrated at VI on the chart is thus produced. Any of the sheets passed thru the bite between the large and lower printing cylinders may be delivered directly into the receiving tray as indicated or may first be carried thru the bite between the large and lower printing cylinders one or two additional times and then delivered into the receiving tray G-12.

To produce the patterns of feeding illustrated at VII, VIII and IX on the chart, the feeder camshafts D-431, D-432 and D-433 are set to make one revolution for each revolution of the large printing cylinder 3022, and all three feeders are timed to feed together in coincidence with the third revolution of lower printing cylinder 20.

In order to produce the pattern of feeding illustrated at VI on the chart, sheets are placed in "bottom" feeder A and in "pile" feeder C only. At the start of the first revolution of the large printing cylinder 3022, a sheet previously fed from "bottom" feeder A is in position against stop fingers D-25, and a sheet previously fed from "pile" feeder C is in position against stop fingers D-435. On the first revolution of lower printing cylinder 20, the sheet from "bottom" feeder A moves from the stop fingers D-25 through the bite between lower printing cylinder 20 and the first work area of large printing cylinder 3022 and into the receiving tray G-12; and the sheet from "pile" feeder C moves from stop fingers D-435 into contact with stop fingers D-437. On the second revolution of lower printing cylinder 20, the sheet from "pile" feeder C moves from stop fingers D-437 into contact with stop fingers D-25. On the third revolution of lower printing cylinder 20, the sheet from "pile" feeder C moves from the stop fingers D-25 through the bite between lower printing cylinder 20 and the third work area of large printing cylinder 3022 and into the receiving tray G-12. Also on the third revolution of lower printing cylinder 20 another sheet from "pile" feeder C is fed and comes into contact with stop fingers D-435. At the same time a sheet from "bottom" feeder A is fed and comes into contact with stop fingers D-25. The process then repeats itself on each succeeding revolution of large printing cylinder 3022, producing the pattern of feeding shown at VII on the chart. Each of the sheets fed from "bottom" feeder A may be passed thru the bite between the large and lower printing cylinders one time or two times.

To produce the pattern of feeding shown at VIII on the chart, sheets are placed in "bottom" feeder A and B only. At the start of the first revolution of the large printing cylinder 3022, there is a previously fed sheet from "bottom" feeder A against the stop fingers D-25, and a previously fed sheet from "bottom" feeder B against stop fingers D-437. On the first revolution of lower printing cylinder 20, the sheet from "bottom" feeder A passes from the stop fingers D-25 through the bite between lower printing cylinder 20 and the first work area of large printing cylinder 3022 and into the receiving tray G-12, and the sheet from "bottom" feeder B moves from stop fingers D-437 into contact with stop fingers D-25. On the second revolution of lower printing cylinder 20, the sheet from "bottom" feeder B moves from the stop fingers D-25 through the bite between lower printing cylinder 20 and the second work area of large printing cylinder 3022 and into the receiving tray G-12. Alternatively this sheet may also be caused to pass thru the bite between the large and lower printing cylinders a second time before being delivered into the receiving tray G-12. On the third revolution of lower printing cylinder 20, a sheet from "bottom" feeder A is fed into contact with stop fingers D-25, and a sheet from "bottom" feeder B is fed into contact with stop fingers D-437. The process then repeats itself on the second and each succeeding revolution of large printing cylinder 3022, producing the pattern of feeding illustrated at VIII.

To produce the pattern of feeding shown at IX on the chart, sheets are loaded into all three feeders A, B and C. At the start of the first revolution of the large printing cylinder 3022, there is a previously fed sheet from "bottom" feeder A against the stop fingers D-25, a previously fed sheet from "bottom" feeder B against the stop fingers D-437, and a previously fed sheet from "pile" feeder C against the stop fingers D-435.

On the first revolution of lower printing cylinder 20, the sheet from "bottom" feeder A moves from stop fingers D-25 through the bite between lower printing cylinder 20 and the first work area of large printing cylinder 3022 and into the receiving tray G-12. Also, the sheet from "bottom" feeder B moves from stop fingers D-437 to stop fingers D-25, and the sheet from "pile" feeder C moves from stop fingers D-435 to stop fingers D-437.

On the second revolution of lower printing cylinder 20, the sheet from "pile" feeder B moves from stop fingers D-25 through the bite between lower printing cylinder 20 and the second work area of large printing cylinder 3022 into the receiving tray G-12, and the sheet from "pile" feeder C moves from stop fingers D-437 to stop fingers D-25.

On the third revolution of lower printing cylinder 20, the sheet from "pile" feeder C moves from stop fingers D-25 through the bite between lower printing cylinder 20 and the third work area of large printing cylinder 3022 and into the receiving tray G-12. Also on the third revolution of lower printing cylinder 20 a sheet from "pile" feeder C is fed into position against stop fingers D-435, a sheet from "bottom" feeder B is fed into position against stop fingers D-437, and a sheet from "bottom" feeder A is fed into position against stop fingers D-25. The process then repeats itself on the second and each succeeding revolution of large printing cylinder 3022, thereby producing the pattern of feeding illustrated at IX on the chart.

FEEDING, SEPARATING AND CONVEYING

The feeding and separating mechanism of each of the "bottom" feeders A and B is the same as that described previously in connection with the 2R model of the press, and similarly the feeding and separating means of the "pile" feeder C is similar to that previously illustrated and described in connection with the 2R model press. However, whereas in the 2R model press the "pile" feeder and the "bottom" feeder were mounted to feed to a common set of pull-out rollers, and controlled by cams mounted on a single camshaft, in the 3R model of the press as seen in FIG. 141 each feeder is mounted separately and each feeder is controlled by cams mounted on a camshaft associated with that individual feeder. Thus, cams mounted on camshaft D-433 control the operation of "bottom" feeder A, cams mounted on camshaft D-432 control the operation of "bottom" feeder B, and cams mounted on camshaft D-431 control the operation of "pile" feeder C. Suction for each feeder is supplied by a separate pump and is controlled as will be explained in connection with FIGS. 142 and 143.

Individual sheets separated from the pile D-434 of "pile" feeder C are presented to pull-out rollers D-439 and D-441, which then deliver each sheet onto a conveyor, generally designated D-442, which conveys the sheets to the press. "Bottom" feeders A and B are mounted astride the conveyor D-442. Sheets from "bottom" feeder B are delivered by primary pull-out rollers D-443 and D-444 and secondary pull-out rollers D-445 and D-446 onto the conveyor D-442. Similarly, sheets from the "bottom" feeder A are delivered by primary pull-out rollers D-447 and D-448 and secondary pull-out rollers D-449 and D-451 onto the conveyor D-442. The conveyor D-442 is divided into three parts. The first portion of the conveyor consists of tapes D-452*c* which travel over conveyor tape rollers D-453*c* and D-454*c* and convey the sheets past the position of stop fingers D-435. Just ahead of the conveyor tape roller D-453*c* there is a reject gate D-455*c*. Below the reject gate D-455*c* is a reject receiving tray D-29*c* mounted on shafts D-28*c*. The second portion of conveyor D-442 consists of conveyor tapes D-451B which are carried by conveyor tape rollers D-453B and D-454B, and which convey sheets past the position of stop fingers D-437. Just ahead of the conveyor tape roller D-453B there is a reject gate D-455B. Below the reject gate D-455B is a reject receiving tray D-29B mounted on shafts D-28B.

The third portion of the conveyor D-442 which comprises tapes D-452A and conveyor tape rollers D-453A and D-454A, and which conveys the sheets to the stop fingers D-25 of the press, is pivoted about the shaft of tape rollers D-453A so that it may be rocked down into a position to provide access to lower printing cylinder 20.

The conveyor tapes D-452A, D-452B and D-452C are driven in the manner illustrated and described in connection with the 2R press at a surface speed somewhat in excess of the surface speed of lower printing cylinder 20 and large printing cylinder 3022. The conveyor tapes are driven at this surface speed irrespective of whether the camshafts D-431, D-432 and D-433 are driven so that they make one revolution for each revolution of lower printing cylinder 20, or whether they are driven so that they make one revolution for reach revolution of large printing cylinder 3022.

The stop fingers D-25 are controlled, as previously illustrated and described, and operate once for each revolution of lower printing cylinder 20 of the 3R model press, generally designated 3010.

The other two sets of stop fingers D-437 and D-435, which extend across the conveyor D-442, project upwardly between the conveyor tapes D-452C and D-452B. The distance between the press stop fingers D-25 and the stop fingers D-437 is equal to the distance between the stop fingers D-437 and the stop fingers D-435, and this, in turn, is equal to the distance between the bite of the secondary pull-out rollers D-449 and D-451 of "bottom" feeder A and stop fingers D-25 which, in turn, is equal to the distance between the bite of the secondary pull-out rollers D-445 and D-446 of "bottom" feeder B and stop fingers D-437, and this, in turn, is equal to the distance between the bite of the pull-out rollers D-439 and D-441 of "pile" feeder C and stop fingers D-435, and this, in turn, is equal to the distance between the bite of the pull-out rollers D-439 and D-441 of "pile" feeder C and the bite of the secondary pull-out rollers D-445 and D-446.

There is a lever arm D-458 secured to the shaft of stop fingers D-25 in the press 3010 and there is a similar lever arm D-459 secured to the shaft of the stop fingers D-437 and another similar lever arm D-461 secured to the shaft of the stop fingers D-435. A link D-462 interconnects a pin D-463 on lever arm D-458, a pin D-464 on lever arm D-459, and a pin D-465 on lever arm D-461. The three sets of stop fingers D-25, D-437 and D-435 are thus interconnected so that they rise into position to engage and stop the leading edge of a sheet at the same time and drop away simultaneously below the path of the sheet to allow it to move forward. The action of the stop fingers D-25 of the press is controlled in rhythm with the rotation of lower printing cylinder 20, as previously illustrated and described, and this motion is simultaneously transmitted to the stop fingers D-438 and to the stop fingers D-435 by means of the link member D-462 as described.

As previously illustrated and described in connection with the 2R model, there is a series of spherical roller members (which are not shown in FIG. 141) resting on each of the conveyor tapes D-452A, D-452B and D-452C and these roller members therefore rest upon the top surface of sheets being conveyed by the conveyor tapes, and their weight is just sufficient to provide traction between the sheets and the conveyor tapes so that the sheets are, in fact, conveyed by the tapes.

When the leading edge of a sheet contacts one of the sets of stop fingers, the forward motion of the sheet is stopped thereby and the tapes slip under the bottom surface of the sheet until the stop fingers drop out of the path of the sheet, at which time the sheets again move forward with the conveyor tapes. In the case of a sheet whose leading edge is at rest against the stop fingers D-25 in the press, the forward motion of the sheet thereafter is controlled by the action of the upper and lower feed rolls, as previously illustrated and described in detail, but not shown in FIG. 141. Therefore, a sheet fed to pull-out rollers D-439 and D-441 of "pile" feeder C will have its leading edge reach the stop fingers D-435 at the same time that the leading edge of a sheet fed to the secondary pull-out rollers D-445 and D-446 of "bottom" feeder B reaches the stop fingers D-437, and also at the same time that the leading edge of a sheet fed to the secondary pull-out rollers D-449 and D-451 of "bottom" feeder A reaches the stop fingers D-25.

A shaft D-466 extends through the near frame of the press 3010 and is journalled in the press frames. On the inside of the near frame, there is a gear D-467 secured to shaft D-466 and gear D-467 meshes with gear 45 of lower printing cylinder 20. Gear D-467 has a pitch diameter equal to the pitch diameter of gear 45 for lower printing cylinder 20, and thus shaft D-466 makes one revolution for each revolution of lower printing cylinder 20. On the outside of the near frame there is a sprocket D-468 secured to shaft D-466. A stationary stub shaft D-469 is secured to the feeder frame and has a boomerang-shaped bracket D-471 journalled for rocking motion about it. On the outside of bracket D-471 an idler sprocket D-472 is journalled about shaft D-469. A stationary stub shaft D-473 is secured to the outer end of arm D-474 of bracket D-471, and another stationary stub shaft D-475 is secured to the center of arm D-476 of bracket D-471. Shaft D-473 and shaft D-475 are equidistant from shaft D-469. There is a sprocket D-477 journalled about shaft D-473, and there is a gear D-478 carried on the same hub as sprocket D-477 and secured thereto, so that sprocket D-477 and gear D-478 turn together and are both journalled about shaft D-473. There is another sprocket D-479 journalled about shaft D-475, and there is a gear D-481 secured to the same hub as sprocket D-479 so that sprocket D-479 and gear D-481 turn together and are both journalled about shaft D-475. Sprocket D-477 and sprocket D-479 and sprocket D-468 all have identical pitch diameters and identical numbers of sprocket teeth. Idler sprocket D-472 journalled about shaft D-469 may have the same pitch diameter as sprockets D-468, D-477 and D-479, but need not be identical in pitch diameter to these three sprockets D-468, D-477 and D-479. A chain D-482 interconnects sprockets D-468, D-477, D-472 and D-479, as shown in FIG. 141.

Shaft D-483 is journalled in the feeder frame, and secured to shaft D-483 is a gear D-484 which is in vertical alignment with gear D-478 on shaft D-473, and with gear D-481 on shaft D-475. The pitch diameter of gear D-484 is three times the pitch diameter of gear D-478, and the pitch diameter of gear D-484 is equal to the pitch diameter of gear D-481, the pitch diameter of which is also equal to three times the pitch diameter of gear D-478. Bracket D-471 may be rotated about shaft D-469 to bring gear D-478 into mesh with gear D-484, as shown in FIG. 141. In this case, gear D-481 is not in mesh with gear D-484. At the outer end of arm D-476 of bracket D-471 there is a thumbscrew D-485 carried by arm D-476. There are two threaded holes D-486 and D-487 in the feeder frame, so positioned that when gear D-478 is in mesh with gear D-484, the arrow D-488 at the end of arm D-476 is in alignment with the arrow D-489 on the feeder frame, and the thumbscrew D-485 may be threaded into hole D-486, thus securing the bracket D-471 in this position and maintaining gear D-478 in mesh with gear D-484, as seen in FIG. 141. When the arrow D-488 at the end of arm D-476 is brought into alignment with arrow D-509 on the feeder frame, gear D-481 meshes with gear D-484 and gear D-478 is moved out of engagement with gear D-484. In this position thumbscrew D-485 may be threaded into hole D-487, thus securing the bracket D-471 in this position and maintaining gear D-481 in mesh with gear D-484.

There are two sprockets D-491 and D-492 of equal pitch diameter also affixed to shaft D-483. Another sprocket D-493 of equal pitch diameter is affixed to camshaft D-433 of "bottom" feeder A, and a chain D-494 interconnects sprocket D-492 and sprocket D-493, thereby causing camshaft D-433 to be driven at the same speed and in the same direction as shaft D-483. There is another shaft D-495 journalled in the feeder frames forward of and below "bottom" feeder B. There are three sprockets D-496 and D-497 and D-498 secured to shaft D-495. Each of these sprockets has the same pitch diameter as the sprockets on shaft D-483. Sprocket D-497 on shaft D-495 is interconnected with sprocket D-491 on shaft D-483 by means of chain D-499, and thereby shaft D-495 is driven at the same speed and in the same direction as shaft D-483.

There is a sprocket D-501, the pitch diameter of which is equal to the pitch diameter of the sprockets on shaft D-495, and which is secured to camshaft D-432 of "bottom" feeder B. Sprocket D-501 on camshaft D-432 is interconnected with sprocket D-498 on shaft D-495 by means of chain D-502 so that camshaft D-432 is thereby driven at the same speed and in the same direction as shafts D-495 and D-483.

There is another shaft D-503 journalled in the feeder frames just ahead of the "pile" feeder C. There are two sprockets D-504 and D-505, each of which has a pitch diameter equal to the pitch of the sprockets on shafts D-495 and D-483, secured to shaft D-503. A chain D-506 interconnects sprocket D-504 on shaft D-503 with sprocket D-496 on shaft D-495, thereby causing shaft D-503 to be driven at the same speed and in the same direction as shafts D-495 and D-483.

There is a sprocket D-507, the pitch diameter of which is equal to the pitch diameter of the sprockets on shaft D-503, secured to camshaft D-431 of "pile" feeder C. Sprocket D-507 on camshaft D-431 is interconnected with sprocket D-505 on shaft D-503 by means of a chain D-508, and thereby camshaft D-431 is driven at the same speed and in the same direction as shafts D-503, D-495 and D-483. It will thus be seen that each of the camshafts D-431, D-432 and D-433 are at all times driven in the same direction and at the same speed as shaft D-483.

As has been previously pointed out, shaft D-466 and sprocket D-468 are driven with gear D-467 so that they make one revolution for each revolution of lower printing cylinder 20. Therefore sprocket D-477 and gear D-478 and sprocket D-479 and gear D-481 each make one revolution for each revolution of lower printing cylinder 20. Since the pitch diameter of gear D-478 is one-third the pitch diameter of gear D-484, when gear D-478 is in mesh with gear D-484, gear D-484, and therefore shaft D-483 and with it camshafts D-431, D-432 and D-433, are all driven one-third of a revolution for each revolution of lower printing cylinder 20, or, in other words, one revolution for each revolution of large printing cylinder 3022. Thus, when arrow D-488 on arm D-476 is held in alignment with arrow D-489 on the feeder frame, the three feeder camshafts D-431, D-432 and D-433 are making one revolution for each revolution of large printing cylinder 3022.

Since gear D-481 is equal in pitch diameter to gear D-484, when gear D-481 is in mesh with gear D-484 shaft D-483, and with it camshafts D-431, D-432 and D-433, each make one revolution for each revolution of lower printing cylinder 20 or three revolutions for each revolution of large printing cylinder 3022. Thus, when arrow D-488 on arm D-476 is locked in alignment with arrow D-509 on the feeder frames, each of the three feeder camshafts D-431, D-432 and D-433 is making three revolutions for each revolution of large printing cylinder 3022, or one revolution for each revolution of lower printing cylinder 20.

SETTING TIMING OF FEEDERS

Adjacent to sprocket D-493 on feeder camshaft D-433 is a disc member D-511. Disc member D-511 is pinned to feeder camshaft D-433. There are three threaded holes D-512, D-513 and D-514 equidistant from the center of shaft D-433 and spaced 120 degrees from each other in the face of the disc member D-511. There is a thumbscrw D-515 threaded into the face of sprocket D-493 and spaced from the center of shaft D-433 by a distance equal to the spacing of holes D-512, D-513 and D-514 from the center of shaft D-433. The sprocket D-493 is not secured directly to the shaft D-433 but may be secured thereto by threading the thumbscrew into either threaded hole D-512, D-513 or D-514. If feeder D-433 is driven so that it makes one revolution for each revolution of lower printing cylinder 20, the thumbscrew D-515 is threaded into hole D-512, and "bottom" feeder A is then timed so that it will feed a sheet on each revolution of the feeder camshaft D-433, or in other words, on each revolution of lower printing cylinder 20, timed so that its leading edge will reach the stop fingers D-25 at the proper time in the cycle.

If feeder camshaft D-433 is being driven so that it makes one revolution for each revolution of large printing cylinder 3022, and if thumbscrew D-515 is threaded into hole D-512, "bottom" feeder A will be timed so that the leading edge of a sheet fed it will reach the stop fingers D-25 at the proper time in the cycle as lower printing cylinder 20 makes its first revolution, in which it rolls in contact with the first work area of large printing cylinder 3022.

If the thumbscrew D-515 is threaded into the hole D-513, "bottom" feeder A will be timed so that the leading edge of a sheet fed therefrom will reach the stop fingers D-25 at the proper time in the cycle as lower printing cylinder 20 makes its second revolution, during which it rolls in contact with the second work area of large printing cylinder 3022.

If the thumbscrew D-515 is threaded into the hole D-514, "bottom" feeder A will be timed so that the leading edge of a sheet fed therefrom will reach the stop fingers D-25 at the proper time in the cycle as lower printing cylinder 20 makes its third revolution, during which it rolls in contact with the third work area of large printing cylinder 3022.

Similarly, disc D-516 is pinned to feeder camshaft D-432 of "bottom" feeder B, and the sprocket D-501, in turn, is secured thereto by means of a thumbscrew D-517. In like fashion, when feeder camshaft D-432 is being driven so that it makes one revolution for each revolution of lower printing cylinder 20, thumbscrew D-517 is threaded into hole D-518, and "bottom" feeder B is then timed so that the leading edge of a sheet fed therefrom will reach the stop fingers D-437 at the proper time in each cycle, on each revolution of lower printing cylinder 20.

Also, in like fashion, if feeder camshaft D-432 is being driven so that it makes one revolution for each revolution of large printing cylinder 3022, then, if thumbscrew D-517 is threaded into hole D-518, the leading edge of a sheet fed from "bottom" feeder B will reach the stop fingers D-437 at the proper time in the cycle, as lower printing cylinder 20 makes its first revolution, in which it rolls against the first work area of large printing cylinder 3022.

If thumbscrew D-517 is fastened into hole D-519, the leading edge of a sheet fed from "bottom" feeder B will reach the stop fingers D-427 at the proper time in the cycle as lower printing cylinder 20 makes its second revolution, in which it rolls against the second work area of large printing cylinder 3022.

Also, when feeder camshaft D-432 making one revolution to each revolution of large printing cylinder 3022, if thumbscrew D-517 is fastened into hole D-521, the leading edge of a sheet fed from "bottom" feeder B will reach the stop fingers D-437 at the proper time in the cycle as lower printing cylinder 20 makes its third revolution, in which it rolls against the third work area of large printing cylinder 3022.

In similar fashion, disc D-522 is pinned to feeder camshaft D-431 for "pile" feeder C, and sprocket D-507 is secured thereto by means of thumbscrew D-523. When feeder camshaft D-431 is being driven so that it makes one revolution for each revolution of lower printing cylinder 20, thumbscrew D-523 is secured in hole D-524, and on each revolution of lower printing cylinder 20 a sheet is fed from "pile" feeder C, timed so that its leading edge will reach the stop fingers D-435 at the proper time in the cycle.

Similarly, when camshaft D-431 is being driven so that it makes one revolution for each revolution of large printing cylinder 3022, thumbscrew D-523 may be secured in hole D-524, in hole D-525, or in hole D-526, and the leading edge of a sheet fed from "pile" feeder C will then be fed so that it reaches stop fingers D-435 at the proper time in the cycle, either as lower printing cylinder 20 makes its first revolution in contact with the first work area, or as lower printing cylinder 20 makes its second revolution in contact with the second work area, or as lower printing cylinder 20 makes its third revolution in contact with the third work area, of large printing cylinder 3022, respectively.

SETTING TIMING OF OPERATING MECHANISM

Timing marks are provided throughout the drive so that the proper timing of all the elements may be quickly and easily arrived at if any of the parts must be removed for servicing. The proper timing is secured when arrow D-527 on the face of gear 45 of lower printing cylinder 20 is between the timing marks D-528 on the face of the gear for large printing cylinder 3022; when arrow D-529 on the face of gear D-467 is between the timing marks D-531 on the face of gear 45 of lower printing cylinder 20; when the marked link D-532 of chain D-482 is placed on sprocket D-468 opposite arrow D-533; when arrow D-534 on the face of sprocket D-477 is placed opposite marked link D-535 in chain D-482; when arrow D-536 on the face of sprocket D-479 is placed opposite marked link D-537 in chain D-482; when gear D-478 is in mesh with gear D-484, arrow D-538 on the face of gear D-478 is placed between timing marks D-539 on the face of gear D-484; when gear D-481 is in mesh with gear D-484, arrow D-541 on the face of gear D-481 is placed between timing marks D-539 on the face of gear D-484; when arrow D-542 on the face of sprocket D-492 is placed opposite marked link D-543 on chain D-494; when arrow D-544 on the face of sprocket D-491 is placed opposite marked link D-545 on chain D-494; when arrow D-546 on the face of sprocket D-491 is placed opposite marked link D-547 on chain D-499; when arrow D-548 on the face of sprocket D-497 is placed opposite marked link D-549 on chain D-499; when arrow D-551 on the face of sprocket D-498 is placed opposite marked link D-552 on chain D-502; when arrow D-553 in the face of sprocket D-501 is placed opposite marked link D-554 on chain D-502; when arrow D-555 on the face of sprocket D-496 is placed opposite marked line D-556 on chain D-506; when arrow D-557 on the face of sprocket D-504 is placed opposite marked link D-558 on chain D-506; when arrow D-559 on the face of sprocket D-505 is placed opposite marked link D-561 on chain D-508; and when arrow D-562 on the face of sprocket D-507 is placed opposite marked link D-563 on chain D-508.

MAKING AND BREAKING SUCTION

FIGS. 142 and 143 illustrate the means by which the making and breaking of the suction which controls the feeding of sheets is controlled on each of the feeders. As previously stated, each feeder is served by a separate suction pump and by a separate vacuum control valve which, in turn, is controlled by mechanism timed from its own individual feeder camshaft. FIG. 142 and 143 are views looking at camshaft D-431 of "pile" feeder C from the opposite side of the machine from that shown in FIG. 141. While FIGS. 142 and 143 show the mechanism on the far end of feeder camshaft D-431 for feeder C, identical mechanism is attached to the far end of feeder camshaft D-432 for feeder B and to the far end of feeder camshaft D-433 for feeder A. Since the suction control mechanism for each of the "bottom" feeders A and B is identical to that for "pile" feeder C, only that for "pile" feeder C will be described.

There is a suction control valve, generally designated D-3313A, the lower nipple D-3346 of which is connected to a suction hose (not shown) which, in turn, is connected to the suction inlet of the indivdual suction pump for the feeder involved. A suction hose D-3316 attaches to upper nipple D-3347 and leads to the suction foot (or suction feet) of the feeder. The opening at the top of the suction control valve D-3313 may either be opened to the atmosphere or may be sealed by a rubber washer D-3333, which, in turn, is secured by a nut and bolt D-3335 to a hinged lid D-3334 pivoted about a pin D-3336. When the lid D-3334 is in the closed position, shown in dotted lines in FIG. 142, the rubber washer D-3333 seals the valve opening and suction is drawn through the hose D-3316 from the suction foot or feet into the inlet of the suction pump through nipple D-3346.

When it is desired to cut off feeding from the feeder, the lid D-3334 may be lifted into the full open position shown in phantom lines at D-3342 with its rear portion D-3343 resting against the back face of the valve at D-3344. When the lid is in this position the valve is completely open to the atmosphere and outside air is drawn through the valve and into the pump through the nipple D-3346, and no vacuum is drawn on the hose D-3316 or on the suction foot or feet of the feeder.

When the feeder is in operation, and the valve is controlled automatically, the lid D-3334 is swung into the full line position, as shown in FIG. 142, and is then controlled by the action of follower D-3339 acting upon the forward portion D-3338 of the lid D-3334.

There is a control arm, generally designated D-564 which pivots about a stud D-565 secured to the feeder frame. The forward arm D-566 of control arm D-564 carries a follower D-567 about a stud D-568 mounted at the outer end of arm D-566. Follower D-567 is a wide follower and is in alignment vertically with an adjustable multiple cam member generally designated D-569. The rearwardly extending arm D-571 of control arm D-564 carries a stud D-572 at its outer end, about which follower D-3339 is mounted. Follower D-3339 is in vertical alignment with the projecting arm D-3338 of lid D-3334.

There is also a combined link and spring pin D-573 on arm D-571, and a spring D-574 connects pin D-573 with a spring pin D-575 secured in the side of the feeder frame. The action of spring D-574 is to urge control arm D-564 into the dotted line position, as shown in FIGS. 142 and 143. As seen particularly in FIG. 143, there is another control arm, generally designated D-576, which, in turn, pivots about a stud D-577 secured to the feeder directly above stud D-565. The rearwardly extending arm D-578 of control lever D-576 carries a link pin D-579, and a link member D-581 connects link pin D-579 in control arm D-576 to link pin D-573 in control arm D-564. Control arm D-576 also has a forwardly extending arm D-582, at the outer end of which a pin D-583 carries a follower D-584. Follower D-584 is in line vertically with a double cam, generally designated D-585, which is secured to camshaft D-431. Follower D-584 is wider than the combined width of the two cams that make up cam member D-585.

Cam member D-585 comprises a disc member D-586 with a hub D-587 which is pinned or keyed to camshaft D-431. Rotatably mounted about the hub D-587 are two disc-like cams D-588 and D-589 which make up the two halves of the double cam. There is an arcuate slot D-591 in the face of cam D-589, and an arcuate slot D-592 in the face of cam D-588. A bolt D-593 passes through these two slots into a hole D-594 threaded into the face of disc member D-586. It is thus possible to adjust cam D-588 independently of cam D-589. The entire cam member D-585 turns in a counterclockwise direction, as shown in FIG. 143, and the position of cam D-588 determines the point at which follower D-584 rises into the dwell of the cam. When this occurs, follower D-584 moves upwardly against the dwell portion of the cam, arm D-578 moves downwardly, and with it, arm D-571 moves downwardly under the action of spring D-574, and control arm D-564 moves into the dotted line position, in which the position of follower D-3339 drops below the down position of arm D-3338 on lid D-3334, and the weight of lid D-3334 closes the valve, thereby causing a vacuum to be drawn in the hose line D-3316 to the suction foot or feet. A bleeder valve D-3345 is supplied by which the intensity of the suction may be controlled.

Cam D-589 then acts to push follower D-584 onto the high portion of the cam, lifting arm D-578, arm D-571, and follower D-3339, and thereby lifting the lid D-3334 into the solid line position, as shown in FIG. 142, and opening the valve to the atmosphere, thereby cutting off suction in the suction hose D-3316 to the suction foot or feet. Since cam D-588 which controls the making of the suction, and cam D-589 which controls the breaking of the suction, can be independently adjusted, the point in the cycle at which the suction is made, and the point in the cycle at which it is broken may be independently adjusted and then secured with bolt D-593.

The adjustable multiple cam member generally designated D-569 may be used to override the action of cam member D-585 and hold the suction valve D-3313 in the "open" position during certain preselected revolutions of the lower printing cylinder 20, or during certain preselected revolutions of the large printing cylinder 3022. The adjustable multiple cam member D-569 is journalled to rotate about a stub shaft D-595 secured to the feeder side frame. A common hub D-596 carries a disc member D-597 and a gear D-598, both of which are secured to the hub D-596 which, in turn, is journalled for rotation about shaft D-595. Gear D-598 meshes with a gear D-599 secured to the outer end of feeder camshaft D-431. The pitch diameter of gear D-598 is six times the pitch diameter of gear D-599. Feeder camshaft D-431 and gear D-599 are driven in the direction shown, and, in turn, drive gear D-598 and disc D-597 in a clockwise direction, as seen in FIG. 142.

There are six segmental cam sectors D-601, D-602, D-603, D-604, D-605 and D-606 mounted on the face of disc D-597. Each of these segmental cam sectors has a radial slot D-607 which fits over a pin D-608 and through which passes a thumbscrew D-609 which, in turn, threads into hole D-611 in the face of disc member D-597. The pin D-608 is secured in the face of disc member D-597. Each of these segmental cam sectors has a counterclockwise projecting nose D-612 which is slightly less than half the thickness of the sigmental cam sector itself, and which projects into a corresponding cutaway portion D-613 in the adjacent segmental cam sector. Each of these segmental cam sectors may be secured in the withdrawn position, shown in solid lines in FIG. 142, in which case the outer face of each of these segmental cam sectors is below the periphery of disc D-597.

Cam follower D-567 has a width greater than the combined width of disc D-597 and the segmental cam sectors, and when the segmental cam sectors are in the withdrawn position, as shown in solid lines in FIG. 142, the cam follower D-567 may assume either the dotted line position or the solid line position, as shown in FIG. 142, unaffected by the adjustable multiple cam member D-569. Under these circumstances, follower D-3339 which lifts lid D-3334 is automatically controlled entirely by the action of dual cam D-585, and makes and breaks the suction in suction control valve D-3313 on each revolution of feeder camshaft D-431, thus causing a sheet to be fed from the feeder on each revolution of feeder camshaft D-431, unless the lid D-3334 has been manually lifted into the dotted line position indicated at D-3342.

SETTING FEEDING PATTERNS

If feeder camshaft D-431 is being driven so that it makes one revolution for each revolution of lower printing cylinder 20, the suction in suction control valve D-3313 is made and broken at the proper time in each revolution of feeder camshaft D-431, and a sheet is fed from the feeder for each revolution of lower printing cylinder 20.

On the other hand, if feeder camshaft D-431 is being driven so that it makes one revolution for each revolution of large printing cylinder 3022, then the suction in the suction control valve D-3313, and in the suction hose D-3316 to the suction foot or feet, is made and broken once for each revolution of large printing cylinder 3022, thereby causing a sheet to be fed once to each revolution of large printing cylinder 3022. The position of suction control cams D-585, as well as the position of the other cams that control the action of the feeder and which are similarly secured to camshaft D-431, are timed in accordance with whether thumbscrew D-523 in FIG. 141 has been placed in hole D-524, in hole D-525, or in hole D-526, as previously described, thereby determining whether the one sheet fed for each revolution of large printing cylinder 3022 is timed so that its leading edge will reach the stop fingers D-435 at the proper time in the cycle during the first, second, or third revolution of lower printing cylinder 3022.

Since gear D-598 has a pitch diameter six times the pitch diameter of gear D-599, one of the segmental cam sectors passes the position of follower D-567 for each revolution of feeder camshaft D-431. If feeder camshaft D-431 is being driven so that it makes one revolution for each revolution of lower printing cylinder 20, then segmental cam sector D-601 passes the position of follower D-567 during the first revolution of lower printing cylinder 20. Segmental cam sector D-602 passes the position of follower D-567 during the second revolution of lower printing cylinder 20. Segmental cam D-603 passes the position of follower D-567 during the third revolution of lower printing cylinder 20. As the large printing cylinder 3022 makes a second revolution, segmental cam sector D-604 passes the position of follower D-567 as lower printing cylinder 20 again makes its first revolution. Segmental cam sector D-605 passes the position of follower D-567 as lower printing cylinder 20 makes its second revolution, and segmental cam sector D-606 passes the position of follower D-567 as lower printing cylinder 20 makes its third revolution.

If the feeding pattern illustrated at II in the chart of FIG. 140 is to be fed, sheets are placed in "pile" feeder C only, and segmental cam sector D-602 is moved out into the dotted line position, as seen in FIG. 142, and segmental cam sector D-605 is moved out into the dotted line position, as shown in FIG. 142. As lower printing cylinder 20 makes its first revolution, the action of suction control valve D-3313 is controlled by cam D-585 and a sheet is fed. As lower printing cylinder 20 makes its second revolution, the segmental cam sector D-602 holds follower D-567 in the solid line position, as shown in FIG. 142, holding the suction control valve D-3313 open so that no suction is made in hose D-3316 or in the suction foot or feet. Cam follower D-584 is held in the solid line position, as shown in FIG. 143, throughout the passage of the dwell on cam D-585. Thus, no sheet is fed on the second revolution of lower printing cylinder 20. On the third revolution of lower printing cylinder 20, the suction control valve D-3313 is again under the control of cam D-585 and a sheet is fed. Again, on the first revolution of lower printing cylinder 20 corresponding to the second revolution of large printing cylinder 2033, the suction valve D-3313 is under the control of cam D-585 and a sheet is fed. During the second revolution of lower printing cylinder 20, cam segment D-605 acts on follower D-567 to hold the valve D-3313 open and prevent the feeding of a sheet. Finally, on the third revolution of lower printing cylinder 20, cam D-585 again controls and a sheet is fed.

To secure the feeding pattern illustrated at III of the chart in FIG. 140, the feeder camshaft D-431 would be driven to make one revolution for each revolution of lower printing cylinder 20. Segmental cam sector D-601, representing the first revolution of lower printing cylinder 20 on the camshaft of "pile" feeder C, would be in the withdrawn or solid line position, and the segmental cam sector D-602, representing the second revolution of lower printing cylinder 20, would similarly be in the withdrawn or solid line position. However, segmental cam sector D-603 would be raised into the dotted line position and segmental cam sector D-606 would be similarly raised, thus holding the suction valve D-3313 open and preventing the feeding of sheets on each third revolution of lower printing cylinder 20. At the same time, the similar device associated with "bottom" feeder B would have the segmental cam sectors D-601 and D-604, representing the first revolution of lower printing cylinder 20 in each case, in the withdrawn or solid line position, whereas the segmental cam sectors D-602, D-603, D-605 and D-606, representing the second and third revolutions of the lower printing cylinder 20 in each case, would be in the extended, or dotted line, position and would thereby hold the suction valve D-3313 on "bottom" feeder B open on each second and third revolutions of lower printing cylinder 20, thereby preventing the feeding of sheets from this feeder on those revolutions of lower printing cylinder 20, whereas, on each first revolution of lower printing cylinder 20 the suction valve for "bottom" feeder B would be controlled by cam D-585 and a sheet would be fed therefrom.

When feeder camshaft D-431 is driven so that it makes one revolution for each revolution of large printing cylinder 3022, segmental cam sector D-601 represents the first revolution of large printing cylinder 3022, segmental cam sector D-602 represents the second revolution of large printing cylinder 3022, segmental cam sector D-603 represents the third revolution of large printing cylinder 3022, segmental cam sector D-604 represents the fourth revolution of large printing cylinder 3022, segmental cam sector D-605 represents the fifth revolution of large printing cylinder 3022, and segmental cam sector D-606 represents the sixth revolution of large printing cylinder 3022.

By setting the segmental cam sectors on each of the three feeders, A, B, and C, in accordance with the instructions on the chart in FIG. 140, sheets may be fed in the patterns illustrated at V or VI on the chart. All of the segmental cam sectors are in the withdrawn or solid line position when the patterns illustrated at IV, VII, VIII or IX on the chart are being fed.

It will thus be seen that the instructions accompanying the chart of FIG. 140 set forth the means by which any of the nine feeding and collating patterns may be fed. This may be accomplished by controlling the drive of the feeder camshafts D-431, D-432 and D-433 to make either one revolution for every revolution of lower printing cylinder 20, or one revolution for every revolution of large printing cylinder 3022 in accordance with the instructions which accompany the chart in FIG. 140; by setting the thumbscrews D-515, D-517 and D-523 in relation to the timing discs D-511, D-516 and D-522 to accomplish the timing called for in the instructions which accompany the chart of FIG. 140; and by setting the segmental cam sectors of the adjustable multiple cams D-569 in accordance with the instructions which accompany the chart of FIG. 140.

Associated with the pull-out rollers D-439 and D-441 of "pipe" feeder C is a double thickness detector which detects whether more than a single sheet has been fed and microswitch D-614 which detects if no sheet has been fed. Associated with the secondary pull-out rollers D-445 and D-446 of "bottom" feeder B is a thickness detector which detects whether more than a single sheet has been fed and a microswitch D-615 which detects if no sheet has been fed. Associated with the secondary pull-out rollers D-449 and D-451 of "bottom" feeder A is a thickness detector which detects whether more than a single sheet has been fed and a microswitch D-616 which detects if no sheet has been fed. The manner in which the signals received from these detectors is used to control the operation of the reject gates D-455A, D-455B and D-455C will be illustrated and described in detail hereinafter.

The same arrangement may be used when only one or two feeders are used.

Also, the same arrangement for mounting and controlling one or two feeders may be used on the 2R model in place of the arrangement shown in FIGS. 121 thru 139. In this case the adjustable multiple cam comparable to D-569 would carry four segmental cam sectors instead of six; and the gear comparable to gear D-598 would have a pitch diameter four times that of gear D-599 instead six times that of gear D-599.

MECHANISM FOR SENSING DOUBLES AND MISSES

FIGS. 142 through 147 illustrate the mechanical and electrical devices for detecting and eliminating "doubles" and "misses" and the electrical and mechanical interconnections therebetween. When feeding successive sheets from a single feeder, and with the press set to print the same image or images on each successive sheet, a double sheet eliminator of the type illustrated and described in W. W. Davidson U.S. Patent RE No. 20581 of Dec. 14, 1937 is sufficient to prevent any but single sheets from reaching the press, thereby preventing one sheet from passing through beneath another one and ending up as a blank sheet among the printed sheets in the receiving hopper. This is true irrespective of whether sheets are being fed to each revolution of the lower printing cylinder or to each revolution of the large printing cylinder. In addition, missed sheets cause no problem in this case since the press itself includes means, hereinbefore illustrated and described, for separating the printing cylinders of the press whenever a sheet is not present at the stop fingers at the time when a sheet should be so present.

However, when the press is being used to simultaneously print and collate sets of two or three sheets, and such sets consist either of the same paper stock with different images being printed on the different sheets of a set, or different paper stock with the same or different images being printed on each sheet of the set, it then becomes important that only complete sets be delivered into the delivery hopper, whether such sets consists of two sheets or three sheets.

This means that if one sheet of a set is missed or if one sheet of a set is ejected because a "double" was fed, then the other sheet or sheets of the set must also be ejected in order to ensure that only complete sets reach the delivery hopper. This must be accomplished whenever different images or combinations of images are being printed on the different sheets of a set and also in any case when one of the feeding patterns illustrated in diagrams DD-10 or DD-11 in FIG. 7*b* are being fed on the 2R model press, or when one of the feeding patterns illustrated in diagrams DD-14, DD-17 or DD-19 through DD-25 in FIG. 8*b* are being fed on the 3R model press.

The chart in FIG. 140 illustrates in somewhat more detail various feeding patterns which may be producted on the 3R model press. These patterns are also tied in with the mechanism illustrated and described herein for achieving these different patterns of feeding for the purpose of producting simultaneously printed and collated sets.

FIGS. 144A, 144B, 145 and 146 illustrate the means by which either the failure to feed a sheet or the feeding of a "double" is detected for each stroke of each feeder being used, and the means by which one complete set, and only one complete set, is ejected whenever either of these "faults" is detected. These Figures illustrate the electro-mechanical components employed to accomplish this, and include a wiring diagram showing the manner in which these components are electrically interconnected.

These Figures illustrate the means by which this would be accomplished on a 3R model press including three feeders, one being a "pile" feeder and two being "bottom" feeders. The illustration and description of how this mechanism operates, and how it may be employed when any of the various feeding patterns illustrated in the chart in FIG. 140 are being fed, will also be sufficient to teach anyone skilled in the art how various portions of this mechanism may be similarly employed when a lesser number of feeders is being used in combination with the 3R model press, or when a single feeder or two feeders are being used in combination with the 2R model press.

The basic feeding and conveying mechanism shown in FIGS. 144A and 144B, taken together, is the same as that illustrated and described in FIG. 141. The means by which the various feeding patterns illustrated in the chart of FIG. 140 may be achieved has already been described in connection with FIG. 141. The additional elements illustrated in FIGS. 144A and 144B constitute the means by which the feeding of a "double" from any of the feeders, or the failure to feed a sheet from any of the feeders, may be detected; and one complete set, and only one complete set, eliminated from the path normally followed by sheets being conveyed to the stop fingers of the press whenever any such "fault" is detected.

Each feeder is equipped with a double sheet detector and a miss detector, as for instance, feeder A as seen in FIG. 144B, is equipped with a double sheet detector D-641A, which is similar to the double sheet detector illustrated and described in W. W. Davidson U.S. Pat. RE No. 20581, and which may be similarly set to allow the undetected passage of single sheets and which will detect the passage of more than a single sheet. This double sheet detector D-641A is, in turn, interconnected with a normally open microswitch D-640A in such manner that the motion of the detector D-641A, created by the presence of more than a single sheet, will cause the contacts of the normally open microswitch D-640A to close.

Just beyond the pull-out roller and the double sheet detector D-641A, a light wire feeler finger D-643A of another microswitch D-642A lies across the path traversed by each sheet being fed. The contacts of microswitch D-642A are normally closed, but during the passage of a sheet the feeler finger D-643A of this microswitch is lifted by the passing sheet and, while held in this position, the contacts of microswitch D-642A are held open.

Just beyond this point, and across the surface of the conveyor which conveys the sheet to the press, there is a reject gate or deflector D-455A. When the reject gate D-455A is in the closed position, as seen in FIG. 144B, the sheet passes over the reject gate D-455A and is conveyed on to the stop FIGS. 25 of the press. However, if the reject gate D-455A is swung open, the sheet is deflected thereby into a reject tray D-29A.

There is a solenoid A-639A connected to the reject gate D-455A, and, when the solenoid is not energized, the gate remains in the closed position and sheets pass over it along the conveyor. However, when the solenoid D-639A is energized, it opens the reject gate D-455A, and, while the reject gate is held in this position, any sheet reaching it is deflected into the reject tray D-29A.

There are two cams D-644A and D-646A affixed to shaft D-483 which turns in synchronization with feeder camshaft D-433, as previously described. There is a normally open microswitch D-647A in alignment with the face of cam D-646A. When the high portion of cam D-646A contacts the follower of microswitch D-647A, the contacts of microswitch D-647A are closed. Similarly, there is a normally open microswitch D-645A in alignment with the face of cam D-644A. When the high portion of cam D-644A contacts the follower of microswitch D-645A, the contacts of microswitch D-645A are closed.

Feeders B and C are each similarly equipped with a double sheet detector and an associated microswitch with normally open contacts, a miss detector microswitch with normally closed contacts, a reject gate, a reject hopper, a solenoid for operating the reject gate, a cam and associated microswitch with normally open contacts similar to D-646A and D-647A, and another cam and associated microswitch with normally open contacts similar to cam D-644A and microswitch D-645A. Each of these components on feeder B is identified by a like number to the similar components on feeder A, but with the suffix B instead of the suffix A. Similarly, each of these components on feeder C is identified by a like number to its counterpart on feeder A, but with the suffix C instead of the suffix A.

FIGS. 142 and 143 illustrates the suction valves D-3313A, D-3313B and D-3313C for each of the three feeders A, B and C, which control the making and breaking of the suction to the suction feet on each of the three feeders, and the manner in which this is mechanically controlled has been previously described in connection with FIGS. 142 and 143. Each of the operative segments, as for instances D-602 and D-605 of the adjustable multiple cam members D-569A and D-569C, has a thickness sufficient to contact both the cam followers D-567, as previously described, and the followers D-637A, D-637B or D-637C, for microswitches D-638A, D-638B and D-638C mounted alongside the followers D-567.

The contacts of the microswitches D-638A, D-638B and D-638C are normally closed. However, when one or more of the segments of the adjustable multiple cam member involved are fixed in the outer or dotted line position, as seen for segments D-602 and D-605, the contacts of the associated microswitch D-638A, D-638B or D-638C will be opened while the associated follower D-637A, D-637B or D-637C is contacted by the raised segments, such as D-602 or D-605.

On each feeder there is a solenoid D-636 A, D-636B or D-636C connected to arm D-3343 of the lid D-3334 of the associated suction valve in such manner that, when the solenoid is not energized, the lid D-3334 of the suction valve will be opened and closed by the mechanical means already illustrated and described in connection with FIGS. 142 and 143. However, whenever the associated solenoid is energized, it will override the mechanical means by which the valve is controlled and hold lid D-3334 of the valve in the open or solid line position, as seen in FIG. 142, for as long as the solenoid remains energized.

FIG. 145 illustrated a single cam generally designated D-631 which is also affixed to shaft D-595A only and which has six lobes D-632 and six dwells D-633. The six lobes D-632 correspond to the six segments of the adjustable multiple cam member D-569A. There is a microswitch D-635 mounted so that its follower D-634 is in alignment with the face of cam D-631. When the follower D-634 is opposite the dwells D-633, the common lead of microswitch D-635 is connected to the normally closed contact. When the follower D-634 is in contact with the lobes or raised portions D-632 of the cam, the common lead of microswitch D-635 is connected to the normally open contact.

FIG. 146 illustrates the control panel on which are seen a toggle switch D-623 by which feeder A may be turned on or off, a toggle switch D-624 by which feeder B may be turned on or off, and a toggle switch D-625 by means of which feeder C may be turned on or off. Also shown, are a "hold" button D-627, a "reset" button D-629. A "reset selector" D-688 and a "misfeed selector" D-628. Also shown is a toggle switch D-630 labeled "A-gate only" by means of which the reject gate for feeder A may be actuated without actuating feeder A itself.

The way in which these various elements are interconnected is illustrated in the wiring diagram of FIG. 147, which includes certain other components not illustrated in FIGS. 142, 144A, 144B, 145 or 146, but which will be described in connection with the description of the wiring diagram itself. Also, certain of the mechanical components of FIGS. 142 through 146 are shown diagrammatically in connection with the wiring diagram of FIG. 147 in order to make clear the interconnection between the electrical and the mechanical components.

WIRING DIAGRAM INTERRELATING ELECTRICAL AND MECHANICAL COMPONENTS

FIG. 147 is a wiring diagram showing the interrelationship between the electrical and mechanical components. The line of travel of sheets along the conveyor board D-442 is shown diagrammatically, and the relative position of each of the three feeders, feeder C, feeder B and feeder A, is indicated. The suction feet for each of the feeders are diagrammatically shown at D-665C, D-665B and D-665A, and each of these is in turn diagrammatically shown as being connected to an associated suction pump and motor D-654C, D-65B and D-654A. Similarly, the suction valves D-3313C, D-3313B and D-3313A, by means of which the suction in the suction lines may be made or broken, are shown diagrammatically. Similarly, the reject gates D-455C, D-455B and D-455A together with the reject trays D-29C, D-29B and D-29A also shown diagrammatically.

A 220 volt three-phase A.C. power input is shown at the left side of FIG. 147 with the three input lines L-1, L-2, and L-3 being designated D-650, D-651 and D-652, respectively. A neutral or ground line is designated D-653. 110-volts AC flows between line D-652 and the neutral D-653 when a connection is made between them. Ahead of the pump motor for feeder C there is a four-pole single-throw toggle switch D-625. When the contacts of this switch are closed, the first three poles of the switch connect the three power leads, D-650, D-651 and D-652, with the input leads of the motor D-654C for the suction pump on feeder C, causing the motor and pump to operate. Also, when the contacts of this toggle switch are closed (or when the switch is in the "on" position) the fourth contact D-667C in the switch connects the neutral line D-653, through the solenoid D-639C which operates the double sheet eliminator reject gate D-455C for feeder C, to the normally open contact D-663 of the sheet eliminator cam microswitch D-635. It follows, of course, that, when toggle switch D-625 is in the off position, all of these contacts are broken.

Similarly, toggle switch D-624, which is also a four-pole single-throw toggle switch, controls the starting and stopping of the pump and motor D-654B of feeder B. Also, in similar fashion, the fourth pole D-667B of this toggle switch D-624, when closed, connects the neutral line D-653 through the double sheet eliminator solenoid D-639B for feeder B with the normally open contact D-663 of the sheet eliminator cam micro-switch D-635.

Also, in similar fashion, the four-pole single-throw toggle switch D-623 controls the starting and stopping of the pump and motor D-654A for feeder A. And, similarly, the fourth pole D-667A of toggle switch D-623, when the contacts are closed, connects the neutral line D-653 through the double sheet eliminator solenoid D-639A of feeder A with the normally open contact D-663 of the double sheet eliminator cam switch D-635.

On feeder A, there is also a single-pole single-throw toggle switch D-630 which may be closed or opened independently of the toggle switch D-623. When the contacts of toggle switch D-630 are closed, the neutral line D-653 is connected through the double sheet eliminator solenoid D-639A of feeder A with the normally open contact D-663 of the sheet eliminator cam microswitch D-635, even though the contacts of toggle switch D-623 may be open, with toggle switch D-623 in the "off" position, and the suction pump and motor D-654A for feeder A not operating.

Since each of the three feeders completes one mechanical cycle of operation for each revolution of its camshaft whenever the press is turning over, the actual feeding operation of each feeder may be turned "off" or "on" by turning the associated toggle switch "off" or "on", i.e., switch D-625 for feeder C, switch D-624 for feeder B, or switch D-623 for feeder A.

The various cams which turn in synchronization with each other are shown diagrammatically in FIG. 147, and the fact that they are synchronized with each other is indicated by the interconnecting dotted line D-695.

Cams D-646A, D-646B and D-646C and cams D-644A, D-644B and D-644C all make one revolution together in synchronization with each other and in synchronization with the three feeder cam shafts D-433, D-432 and D-431, and these cams make six revolutions for each revolution of cams D-569A, D-569B and D-569C and cam D-631. All of these cams are driven in sychronization with each other in the manner illustrated and described in detail in connection with FIGS. 141, 142 and 143.

FAULT SENSING AND REJECTING MECHANISM

The detection circuitry for each one of the three feeders is similar to that for each of the other two feeders and operates for each feeder which is turned "on". For each feeder a "fault" is defined as either the failure to feed a sheet when a sheet should have been fed, or the feeding of more than a single sheet when a single sheet should have been fed.

In the manner which will be described, the detection mechanism for each feeder which is turned "on" senses whether a fault has occurred on each stroke of that feeder. When a fault is detected, at any feeder the double sheet eliminator reject gate for that feeder, together with the double sheet eliminator reject gates for all other feeders which are turned "on", are opened simultaneously so that any sheet or sheets approaching one of these reject gates on that stroke of the feeders is rejected by being deflected into the reject tray associated with that particular reject gate.

RESETTING MECHANISM

There is a resetting mechanism, generally designated D-700, which causes the detector mechanisms of all feeders which are turned "on" to be reset to again detect faults. This resetting mechanism is manually set to reset all the detectors after one stroke of the feeders, after two strokes of the feeders, or after three strokes of the feeders. If it is set to reset the detecting mechanisms after one stroke of the feeders, then any fault detected by any one of the feeders which is turned "on" will cause the reject gates of that feeder and of any other feeders that are turned "on" to be opened to reject sheets approaching these reject gates on that one stroke of the feeders only, and the reject gates will then close and the detecting mechanisms will be reset to again detect a fault on the next stroke of the feeders.

If the reset mechanism is set to reset the detectors after two strokes of the feeders, then, when a fault is detected on any feeder that is turned "on", the reject gates of that feeder and of any other feeders that are turned "on" will be opened to reject any sheet approaching these reject gates on that stroke of the feeders, and will be opened to reject any sheets approaching these reject gates on the next stroke of the feeders, irrespective of whether or not a fault occurs on any of these feeders on the second stroke. Upon the completion of the second stroke, the reject gates of these feeders will be closed, and the detector mechanisms of each of these feeders will be reactivated so that they will be set to detect any fault that may occur on the next and subsequent strokes of the feeders.

Similarly, if the reset mechanism is set to reset the detectors after three strokes of the feeders, then, whenever a fault is detected on any feeder which is turned "on", the reject gates of that feeder and of any other feeders which are turned "on" will be opened and will reject any sheets approaching them on that stroke of the feeders, and they will also open and reject any sheets approaching them on the next two strokes of the feeders irrespective of whether or not any feeder feeds a fault on these next two strokes. Upon the completion of the third stroke, the reject gates of these feeders will be closed, and the detection mechanisms of these feeders will be reactivated and will be set to detect any fault which may occur on the next or any subsequent stroke of the feeders.

The detection mechanism for each feeder is activated only when that individual feeder is turned "on". As will be seen from the diagram in FIG. 147, this is accomplished on each feeder by having the "hot" line D-698A, D-698B or D-698C lead from the L-3 line D-652 of the power supply beyond the controlling toggle switch (CS-1) D-623, (BS-1) D-624 and (AS-1) D-625, respectively, in each case.

The resetting mechanism, generally designated D-700 comprises a reset stepping switch (RSS), such as a type 211 stepping switch manufactured by C. P. Clare and Co. of Chicago, Illinois, generally designated D-685, a reset selector switch (RSL), generally designated D-688, a reset relay (REK), generally designated D-702, and a reset push button (RS-1) D-629.

The reset stepping switch (RSS) D-685 in turn comprises a coil D-657, a common terminal D-683, a sweep contactor D-684, a series of contact points D-699, numbered 0 through 6, which are successively placed in contact with the common terminal as the sweep contactor D-684 moves from one to another, stepping switch auxiliary contacts (RSS-1) D-689, which are normally open, and close and open with each advance of the sweep contactor, and a second set of stepping switch auxiliary contacts (RSS-2) D-690, which are normally closed, and which open only when the sweep contactor is at the 0 position. The sweep contactor or rotor D-684 advances one step with each pulse to the coil D-657. When current is fed to line D-706 a pulse of current flows through coil D-657, and the sweep contactor D-684 advances one step and the auxiliary contacts (RSS-1) D-689 close and open. When current flows through the line D-705, the sweep contactor D-684 returns to the 0 position.

The reset selector switch (RSL) D-688 comprises a common terminal D-686, three selector terminals D-626, numbered 1, 2 and 3, and a manually set terminal contactor D-687, which may be preset to connect the common terminal to either selector terminal 1, 2, or 3. The selector terminals 1, 2 and 3 are each in turn connected to the similarly numbered step terminals of the reset stepping switch (RSS) D-685.

The common terminal D-683 of the reset stepping switch (RSS) D-685 is connected directly to the hot line D-652. The common terminal D-686 of the reset selector switch (RSL) D-688 leads through the coil D-656 of the reset relay (REK) D-702 to the neutral line D-653. Thus, when the sweep contactor D684 of the reset stepping switch contacts the numbered stepping switch contact D-699, corresponding to the selector switch contact D-626 which has been preset in contact with the common terminal D-686 of the reset selector switch, current flows through the reset relay coil D-656.

The reset relay (REK) D-702 comprises a coil D-656 and three normally closed contacts (REK-1) D-691, (REK-2) D-692 and (REK-3) D-693, which are in the detection circuits of the three feeders A,B and C, respectively, as will hereinafter be described. Thus, when current flows through the coil D-656 of the reset relay D-702, the three normally closed contacts D-691, D-692 and D-693 are opened. As will be seen from the diagram in FIG. 147, the same result can be achieved by pushing the reset push button (RS-1) D-629, which closes the normally opened contacts of that switch.

DETECTION MECHANISM

Since the detection circuits of each of the feeders are alike, and since they are interconnected in the manner shown in the wiring diagram of FIG. 147, only the detection circuit for feeder A will be described in detail.

There is a sheet eliminator cam switch (ES), generally designated D-635, and the common terminal D-661 of this switch is alternately in contact with the normally closed contact D-662 and the normally open contact D-663 of this switch, under the control of the sheet eliminator timing cam D-631, which as previously described is mounted on shaft D-595A, which makes one-sixth of a revolution for each revolution of the feeder camshafts, such as D-433, and the intermediate driving shafts, such as D-483. The sheet eliminator timing cam D-631 is timed so that as the leading edge of a sheet approaches one of the sheet eliminator reject gates, as for instance D-455A, the follower D-634 of the cam switch D-635 rides onto a lobe D-632 of timing cam D-631 and a connection is made between the normally open contact D-631 and the common terminal D-661. This contact is then maintained for a sufficient time to allow the trailing edge of the longest sheet which may be handled to pass the position of the sheet eliminator reject gate, and at this point the follower D-634 falls into a dwell D-633 of timing cam D-631 and the contact between common terminal D-661 and normally open contact D-663 is broken and contact is made between common terminal D-661 and normally closed contact D-662. Since the pull-out rollers of the three feeders are spaced apart by an equal distance, the single timing cam D-631 serves the detection circuits of each of the three feeders.

As has been illustrated and described in FIGS. 144A and 144B, the miss detector switch (AS-2) D-642A is normally closed and remains in that mode unless opened by the passage of a sheet being fed. The double sheet detector switch (AS-3) D-640A is normally open and remains in that mode unless more than a single sheet is fed. The feeding of more than a single sheet to the double sheet detector will cause detector switch D-640A to close. As will be seen from the wiring diagram, when feeder A is turned "on", current flows directly to one of the contacts of each of these switches, miss detector switch D-642A and double sheet detector switch D-640A.

If a "double" is fed, the double sheet detector closes switch D-640A and current flows through line D-708A to connection D-710A, and the coil (AFK) D-655A of the fault relay for feeder A is energized. The fault relay for feeder A comprises the coil (AFK) D-655A, a normally open contact (AFK-1) D-668A, a normally open contact (AFK-2) D-669A, and a normally closed contact (AFK-3) D-670A. When the coil D-655A is energized, the contacts D-668A and D-669A close and the contact D-670A opens. The closing of the contact D-668A allows current to flow directly through the coil D-655A, holding it energized. The closing of the contacts D-669A causes current to flow to the common terminal D-661 of the sheet eliminator cam switch D-635. Then, as the leading edge of the double sheets approach the sheet eliminator reject gate D-455A, the sheet eliminator timing cam D-631A causes contact to be made between the common terminal D-661 and the normally open contact D-663 of sheet eliminator cam switch D-635, which in turn causes current to flow through the coil of the sheet eliminator solenoid D-639A, opening the reject gate D-455A and causing the sheets to be ejected into the reject tray D-29A.

If either, or both, of the other feeders are turned "on", then current also flows through switch D-667B and/or D-667C, which in turn energizes sheet eliminator solenoids D-639B and/or D-639C, opening the corresponding sheet eliminator reject gates D-455B and/or D-455C, all dependent upon which of the other feeders is turned "on". After sufficient time has elapsed for the passage of the trailing edge of the longest sheet, corresponding to the length of a lobe D-632 on cam D-631, the contact with normally open terminal D-663 of the sheet eliminator cam switch D-635 is broken. The solenoid D-639A (and others that have been energized) are de-energized and the gate D-455A (and any other gates that were opened) are then closed. There are springs, not shown, which hold the sheet eliminator gates D-455A, D-455B and D-455C in the closed position, and the solenoids act to open the gates against the action of the spring in each case.

The next action in the cycle is that cam D-646A momentarily closes the normally open cam-operated switch (AS-4) D-647A, causing current to flow through line D-706, which pulses the coil D-657 of the reset stepping switch D-685 and causes the sweep contactor D-684 to move from the zero contact to the number 1 contact. If the reset selector switch (RSL) L-688 is set on 1, this completes the contact through the coil D-656 of the reset relay (REK) D-702, causing the normally closed contacts (REK-1) D-691 to open. This, in turn, deenergizes the coil (AFK) D-655A of the fault relay, which opens the contacts (AFK-1) D-668A and (AFK-2) D-669A, and closes the contact (AFK-3) D-670A. The closing of the contact (AFK-3) D-670A causes the stepping switch (RSS) D-685 to reset to zero. This is completed just prior to the mechanical closing of the suction valve D-3313A, so that the mechanism has been completely reset prior to feeding of the next sheet.

If the reset selector switch (RSL) D-688 is set at a position other than 1, as for instance position number 3, then the pulsing of the stepping switch coil D-657 will move the sweep contactor D-684 to contact number 1, but will not energize the reset relay coil D-656. Under these circumstances, the reset relay contact (REK-1) D-691 will remain closed, the coil (AFK) D-655A of the fault relay will remain energized, and contacts (AFK-1) D-668A and (AFK-2) D-669A of the fault relay will remain closed, and the contact (AFK-3) D-670A will remain open, so that, upon the leding edge of the next sheet fed approaching the sheet eliminator reject gate D-455A, the sheet eliminator solenoid (EL-A) D-639A will again be energized, the reject gate will open and the sheet will be ejected into the reject tray D-29A. And, in similar fashion, the sheet or sheets fed from either, or both, of the other feeders which are turned "on" will be similarly ejected by their reject gates.

This cycle will repeat itself until the sweep contactor D-684 on the reset stepping switch (RSS) D-685 reaches the terminal corresponding to the terminal to which the reset selector (RSL) D-688 is set, at which point the reset relay coil D-656 will be energized and the entire circuitry reset for the feeding of the next sheet, in the manner previously described.

OPERATION OF MISS DETECTOR

The operation of the miss detector is as follows: The miss detector microswitch (AS-2) D-642A is normally closed and remains closed except when opened by the presence of a sheet being fed. During the time in the cycle when the miss detector microswitch (AS-2) D-642A should be held open by the presence of a sheet, the cam D-644A closes the normally open microswitch (AS-5) D-645A. However, if the miss detector switch (AS-2) D-642A is held open by the presence of a sheet, no current flows through to point D-709A. However, if no sheet has been fed, the miss detector switch (AS-2) D-642A remains closed, and then, at the time in the cycle when a sheet should be present, cam D-644A closes normally open microswitch (AS-5) D-654A, and current then flows through to point D-709A and the action is identical to that described when current flows through the "double" detector switch (AS-3) D-640A to point D-710A. In other words, either "fault" results in current reaching either point D-709A or point D-710A, and in either case the response is identical, and as previously described.

It will be noted that current passing through miss detector switch (AS-2) D-642A passes through normally closed cam-operated switch (AS-6) D-638A as it flows to switch (AS-5) D-645A. Normally closed switch (AS-6) D-638A is controlled by the interaction of cam follower D-637A and the adjustable multiple cam D-569A which is mounted on shaft D-595A, all as illustrated and described in FIG. 142.

As was described in connection with FIG. 142, shaft D-595A makes one revolution for each six revolutions of the feeder camshaft D-433, and when it is desired to prevent the feeding of a sheet on certain revolutions of the feeder camshaft, the appropriate segments of adjustable multiple am D-569A are positioned in their outer operative position, as shown in dotted lines in FIG. 142. As previously described, when so positioned these cam segments mechanically break the suction line to the suction foot of feeder A, thereby preventing the feeding of a sheet on that cycle.

In similar fashion, these same segments of adjustable multiple cam D-569A, when in their outer operative position, not only mechanically break the suction to the suction foot, but also act on follower D-637A to open normally closed microswitch (AS-6) D-638A. This interrupts the flow of current to microswitch (AS-5) D-645A and to point D-709A, just as the opening of miss detector switch (AS-2) D-642A by the presence of a sheet being fed would have done.

Thus, the miss detector circuit does not react to signal a missed sheet when, in fact, none was intended to be fed, but only signals a miss on a stroke of the feeder when a sheet was intended to have been fed, but was not.

Once a fault has been detected on one of the feeders, and the sweep contactor D-684 has been set in motion as described, the sweep contactor D-684 will continue to move one step for each stroke of the feeders until it reaches the step which corresponds to the setting of the reset selector switch (RSL) D-688.

The detection of another fault on the same feeder, or on one of the other feeders, on an intervening stroke of the feeders will not change or interfere with this. An additional fault on the same feeder during this interval will have no effect. An additional fault on one of the other feeders which is turned "on" will energize the fault relay of the feeder involved and it will then remain energized until the sweep contactor D-684 reaches the step which corresponds to the setting of the reset selector switch (RSL) D-688.

When that occurs the reset relay (REK) D-702 will be energized and this will reset the detector mechanisms on all feeders and return the sweep contactor D-684 to 0, as previously described.

HOLDING CIRCUITS

In FIG. 147, the "hold" circuitry is generally designated D-701 and comprises a hold stepping switch (HSS), generally designated D-679, which is similar in operation and construction to the reset stepping switch (RSS) D-685 previously described with the exception that the hold stepping switch has twelve contact steps instead of six. It has a similar coil D-659, a common terminal D-677, a sweep contactor D-678, a series of contact points D-704 numbered from 0 to 12, similar stepping switch auxiliary contacts (HSS-1) D-676, which are normally open, and close and open with each advance of the sweep contactor D-678, a second set of stepping switch auxiliary contacts (SS-2) D-675, which are normally closed, and which open only when the sweep contactor D-678 is at the zero position.

There is also a similar selector switch (MFS), in this case known as a consecutive misfeed selector switch, generally designated D-628. This has a common terminal D-680, four selector terminals D-682, which are labeled 1, 4, 8 and 12, and which, in turn, are interconnected with the like numbered stop contacts D-704 of the hold stepping switch (HSS) D-679, and a manually set terminal contactor D-681, which may be preset to connect the common terminal to any one of the selector terminals 1, 4, 8 or 12.

There is a hold relay (HK), generally designated D-703, and which comprises a relay coil D-658 and normally open contacts (HK-1) D-671, (HK-2) D-672, (HK-3) D-673 and (HK-4) D-674. The normally open contacts (HK-2) D-672 of the hold relay (HF) D-703 are in the detection circuitry of feeder A, in series with the coil of a solenoid (SLV-A) D-636A, which, when energized, acts to override the mechanical control of the suction valve D-3313A and to hold it open, with the suction line to the suction foot D-655A broken. The normally open contacts (HK-3) D-673 of the hold replay (HK) D-703 perform a similar function in connection with feeder B and the normally open contacts (HK-4) D-674 perform a similr function with respect to feeder C.

The normally closed contact D-662 of the sheet eliminator cam switch (ES) D-635 is in series with the coil D-659 of the hold stepping switch (HSS) D-679. Thus, when current is flowing to the common terminal D-661 of the sheet eliminator cam switch (ES) D-635, as a result of a fault having been detected on any feeder which is in the "on" position and contacts (AFK-2) D-669A, (BFK-2) D-669B, and/or (CFK-2) D-669C having been closed, then, when the follower D-634 drops into a dwell D-633 of timing cam D-631, contact is made between the common terminal D-661 and the normally closed contact D-662 of sheet eliminator cam switch (ES) D-635, and the coil D-659 of the hold stepping switch (HSS) D-679 is pulsed and the sweep contactor D-678 advances one step. It continues to advance on step for each stroke of the feeders until the reset mechanism acts to reset the detector mechanisms as previously described.

Whenever the coil D-656 of the reset relay (REK) D-702 is energized, as previously described, and contacts (AFK-2) D-669A, (BFK-2) D-669B and (CKF-2) D-669C are opened and contacts (AFK-3) D-670A, (BFK-3) D-670B and (CFK-3) D-670C are closed, current flows from point D-705 through the auxiliary contacts (HSS-1) D-676 and (HSS-2) D-675 and resets the sweep contractor D-678 of the hold stepping switch (HSS) D-679 to zero. If successive faults occur and thereby prevent the reset mechanism from coming into play and resetting the detector mechanisms, then, on each stroke of the feeders on which such successive faults occur and until the reset mechanism acts to reset the detector mechanisms, the coil D-659 of the hold stepping switch (HSS) D-679 is pulsed and the sweep contactor D-678 advances one step.

The common terminal D-680 of the consecutive misfeed selector switch (MFS) D-628 is in series with the coil D-658 of the hold relay (HK) D-703, and the manually set terminal contactor D-681 is preset to connect the common terminal D-680 to either the first, fourth, eighth or twelfth position of the contacts D-704 on the hold stepping switch (HSS) D-679.

If the sweep contactor D-678 of the hold stepping (HSS) D-679 reaches the contact point corresponding to the position preset on the consecutive misfeed selector switch (MFS) D-628 without previously being returned to the 0 position as described above, then a cirucit is made through the relay coil D-658 of the feed hold relay (HK) D-703 and the coil is energized. This causes the normally open contacts (HK-1) D-671m(HK-2) D-672, (HK-3) D-673 and (HK-4) D-674 to close. The closing of the contact (HK-1) D-671 keeps the relay coil D-658 energized and holds it in this condition until the reset push button (RS-1) and (RS-2) D-629 is pushed, which opens the normally closed contacts (RS-2) of that switch D-629, thereby deenergizing the relay coil D-658.

The closing of the other contacts (HK-2) D-672 on feeder A, (HK-3) D-673 on feeder B, and (HK-4) D-674 on feeder C energizes the suction valve solenoids (SVL-A) D-636A, (SVL-B) D-636B and (SVL-C) D-636C on any of the feeders that are turned "on". The result is that on any of these feeders the suction valve is opened and held open until the reset push button (RS-1) and (RS-2) D-629 is pushed. This stops the feeding of additional sheets until the reset button D-629 is pushed. Also, the closing of contacts (HK-2) D-672, (HK-3) D-673 and (HK-4) D-674 energizes the coils (AFK) D-655A, (BFK) D-655B and (CFK) D-655C of the fault relays on each of the feeders that is turned on, thereby causing the sheet eliminator reject gates to be opened on these feeders and to continue to open on each stroke of the feeders until the reset button D-629 is pushed.

The energizing of the coil D-658 of the holding relay (HF) D-703, and the interruption of feeding and the opening of the sheet eliminator reject gates that flows therefrom, may also be initiated by pushing the manual hold button (HS-1) D-627.

The pile jogger "full" switch (HS-2) G-68 is a normally open microswitch located at the bottom of the descent of the pile for the pile jogger, as seen in FIG. 34, so that when the pile jogger is full and the platform reaches the "down" position, it closes switch (HS-2) G-68 and actuates the relay coil D-658 of the holding relay (HK) D-703, thereby similarly interrupting the feed from any of the feeders that are turned "on" and opening their sheet eliminator reject gates. In each of these cases, the operation may only be restarted by pushing the reset button D-629.

By setting the consecutive misfeed selector switch (MFS) D-628 at the desired point, the feeding will be stopped after the occurrence of four, eight or twelve strokes of the feeders during which consecutive faults are detected at any of the feeders which are turned "on". If the consecutive misfeed selector switch (MFS) D-628 is set at 1, the feeding of sheets from all feeders that are turned "on" will be stopped immediately upon the occurrence of a single fault by any such feeder.

The feeding from all feeders that are turned "on" will be stopped whenever the receding pile jogger becomes "full". Feeding from all of the feeders that are turned "on" may also be stopped at any time by the operator, by pushing the manual hold switch (HS-1) D-627.

When the operator pushes the manual hold switch (HS-1) D-627, contact is made through the switch only for so long as the switch is held closed, and the switch opens as soon as it is released. However, immediately upon making contact through the manual hold switch (HS-1) D-627, the hold relay coil D-658 is actuated and the contacts (HK-1) D-671 of the hold relay (HK) D-703 are closed, and the current flowing through these contacts keeps the hold relay coil D-658 energized until the operator presses the reset button D-629.

As has previously been pointed out, the circuits to each of the sheet eliminator solenoids (EL-A) D-639A, (EL-B) D-639B and (EL-C) 639C are connected into the circuit by the fourth pole on each of the on-off switches for the three feeders, (AS-1) D-667A, (BS-1) D-667B and (CS-1) D-667C, respectively, so that they will be energized whenever a fault occurs. Therefore, under normal circumstances the double sheet eliminator reject gate for each feeder will be activated only when that feeder is turned "on", and will then respond and be opened whenever a fault occurs on any of the feeders.

There are, however, certain circumstances in which it is desirable to have the double sheet eliminator reject gate D-455A of feeder A respond to the detection of a fault on feeder B or feeder C, even though feeder A may not be turned "on". To make this possible, a toggle switch (AS-7) D-630 is provided in the circuitry to the double sheet eliminator solenoid (EL-A) D-639A. The toggle switch (AS-7) D-630 is normally open, but when it is closed (even though feeder A may not be turned "on"), the double sheet eliminator solenoid (EL-A) D-639A and, therefore, the double sheet eliminator reject gate D-455A will respond to a fault on either feeder B or C, notwithstanding the fact that feeder A may be turned "off".

It should be noted that whenever the feeding of sheets is interrupted in all of the feeders which are turned "on", by the actuation of the "hold" mechanism by any of the means described above, the reject gates that are involved are also opened, so that the sheets being fed on that stroke of the feeders will be ejected into the reject trays.

FAULT DETECTING, REJECTING AND RESETTING OPERATION—3R PRESS

The following descriptions relate the above described fault detecting, rejecting, resetting and feeder interrupting devices and circuitry to the specific patterns of collating and printing which may be performed on the 3R model press, as set forth in the chart in FIG. 140.

The way in which the controls shown in FIG. 146 are set when each of these patterns of collating and printing is being performed is also explained. Except as otherwise described herein, the operator will determine in each case whether he wants the feeding to be interrupted after the occurrence of four, eight or twelve strokes of the feeders in which consecutive faults occur at any of the feeders being used, or any combination of the feeders being used, and will set the consecutive misfeed selector (MFS) D-628 at 4, 8 or 12, accordingly.

With respect to the pattern in section I of the chart in FIG. 140, sheets are fed from feeder C, with one sheet being fed for each revolution of the lower printing cylinder. If the identical image is to be printed on each successive sheet, the reset selector (RSL) D-688 is set on 1, sheets are loaded into feeder C, and only feeder C is turned "on". If feeder C faults, the reject gate D-455C will open on that stroke of the feeder only and then reset.

If different images are being printed on the three sheets that are fed to each revolution of the large printing cylinder, then the reset selector (RSL) D-688 is set on 3, and whenever a fault occurs the reject gate D-455C will be opened on that stroke of the feeder and on the two succeeding strokes of the feeder, and will then reset. Thus, only complete sets of three sheets will be rejected and the machine will continue to operate with the assurance that only complete sets, in proper order, are being delivered to the receiving hopper.

To produce the pattern shown at section II of the chart of FIG. 140, the mechanical adjustments are made as indicated on the chart. This includes moving the segmental cams D-602 and D-605 on feeder C out into the operative or dotted line position, as seen in FIG. 142. This mechanically holds the suction on Feeder C open on each second revolution of the lower printing cylinder, thus preventing a sheet from being fed on that revolution of the lower printing cylinder. Sheets are fed from feeder C only, and only feeder C is turned "on". The reset selector switch (RSL) D-688 is set on 3. This, when any fault is detected, the reject gate D-455C is opened for three revolutions of the lower printing cylinder and a complete set of the two sheets involved is ejected into the reject tray D-29C, and thereby only complete sets are allowed to pass through to the receiving hopper. On each second revolution of the lower printing cylinder when no sheet is to be fed, the switch (CS-6) D-638C is opened by one or the other of the segmental cams D-602 or D-605, thus causing the detection circuitry not to treat the absence of a sheet on this cycle of the feeder as a "fault".

To accomplish the printing and collating pattern illustrated in section III on the chart of FIG. 140, the feeding mechanism is set as indicated on the chart, with sheets of one type loaded into feeder C and sheets of another type loaded into feeder B. Feeder B and C are turned "on" and feeder A is turned "off". However, the "A-gate only" switch (AS-7) D-630 is turned "on" to cause the reject gate D-455A of feeder A to respond with the reject gates D-455B and D-455C of feeders B and C whenever a fault is detected. The reset selector switch (RSL) D-688 is set at 1. On the first revolution of the lower printing cylinder, sheets are fed from feeder B and from feeder C. On the second revolution of the lower printing cylinder, these two sheets advance on the conveyor board and another sheet is fed from feeder C. On the third revolution of the lower printing cylinder, these three sheets advance, with the sheet from feeder B passing through the bite of the large and lower printing cylinders, but no sheets are fed from either feeder.

As the large printing cylinder begins its next revolution, the process repeats itself with the sheets already on the conveyor board advancing and passing through the bite between the large and lower printing cylinders on successive revolutions of the lower printing cylinder. The consecutive misfeed selector switch (MFS) D-628 is set at 1. In this instance, the operator must observe that the first full set of three sheets is fed without fault and properly delivered into the receiving hopper. Thereafter, if a fault should occur on either feeder B or feeder C, all three reject gates will open and a complete set of three sheets will be ejected and the feeding of sheets will stop, through the action of the consecutive misfeed selector switch (MFS) D-628.

The operator must then place a single sheet in each of the three positions on the conveyor board and in the pattern of the ejected set and then press the reset push button (RS-1) and (RS-2) D-629, which will then recommence the cycle, with the fault eliminated. This will ensure that only complete sets and sets without fault are delivered into the receiving hopper.

It will be noted that in this instance feeder B feeds only on the first revolution of the lower printing cylinder, with the proper segmental cams on feeder B being set in operative position to prevent the feeding of sheets on the second and third revolutions of the lower printing cylinder. In the manner previously explained, the same segmental cams also open switch (BS-6) D-638B on these revolutions of the lower printing cylinder, so that the absence of a sheet being fed from feeder B on these revolutions of the lower printing cylinder is not treated as a "fault". Feeder C feeds on the first revolution of the lower printing cylinder and on the second revolution of the lower printing cylinder, but not on the third revolution of the lower printing cylinder. The proper segmental cams on feeder C are set to cause the suction valve D-3313C to be held open on the third revolution of the lower printing cylinder. The segmental cams which act to hold the suction valve D-3313C open on feeder C on the third revolution of the lower printing cylinder also act to open the switch (CS-6) D-638C, so that the absence of a sheet from feeder C on this third revolution of the lower printing cylinder is not treated as a "fault".

In feeding the pattern of sheets illustrated in section IV on the chart of FIG. 140, the mechanism is set, as indicated on the chart, with the feeder camshafts set to make one revolution for each revolution of the large printing cylinder and with feeder C timed to feed with the first revolution of the lower printing cylinder. The speed of the conveyor tapes is such that a sheet so fed will reach the stop fingers D-435 under feeder B on the first revolution of the lower printing cylinder, will move forward from the stop fingers D-435 under feeder B on the second revolution of the lower cylinder to the stop fingers D-437, move forward from the stop fingers D-437 under feeder A on the third revolution of the lower cylinder and into contact with the stop fingers 25 in the press, and move forward from the stop fingers 25 of the press and pass through the bite between the large and lower printing cylinders on the next first revolution of the lower printing cylinder.

Sheets are loaded into feeder C only, and only feeder C is turned "on". The reset selector switch (RSL) D-688 is set at 1. Any fault detected as a sheet is fed from feeder C will cause the sheet eliminator reject gate D-455C to open, ejecting any multiple sheets which may have been fed into the reject hopper D-29C, and the mechanism will then reset automatically prior to the feeding of the next sheet.

In each of these patterns of printing and collating, if the "fault" detected is the absence of a sheet when one should be present, there will, of course, be no sheet to be rejected by the double sheet eliminator reject gate into the reject tray. Also, when a "double" is detected and the sheets are deflected into the reject tray, no sheet passes on down the conveyor board to the press, and the result at the press is the same as if a failure to feed had occurred. The object which is achieved by the fault detection system illustrated and described in that, whenever the detection of a "fault" prevents one sheet of a set from passing through the press, the other sheets of the "set" are also rejected and prevented from passing through the press, so that only complete sets, without fault, pass through the press and are printed and delivered in proper sequence into the delivery hopper.

To produce the pattern of printing and collating illustrated at section V on the chart of FIG. 140, the mechanism is set as described on the chart only feeders B and C are turned "on", and sheets of different type are loaded into feeders B and C. The reset selector switch (RSL) D-688 is set at 2. If either feeder faults, that sheet and the next succeeding sheet will be rejected and the mechanism will then reset automatically. In each case, the segmental cams which prevent each feeder from feeding on alternate revolutions will also actuate the switches (CS-6) D-638C and (BS-6) D-638B, so that the detector mechanisms will not read the absence of a sheet, on a revolution when one is not intended to be fed, as a "fault".

To produce the pattern of feeding and collating illustrated at section VI on the chart of FIG. 140, the mechanism is set as indicated on the chart, sheets of different type are loaded into feeders A, B and C, and feeders A, B and C are turned "on". The reset selector switch (RSL) D-688 is set at 3. Whenever a fault occurs on any one of the feeders, the next two succeeding sheets from the other two feeders are also rejected, thereby rejecting a complete set, and the mechanism then resets automatically. Here again, the interaction of the segmental cams and the associated switches (AS-6) D-638A, (BS-6) D-638B and (CS-6) D-638C cause the respective detection mechanisms not to respond to the absence of a sheet, on those revolutions of the feeder camshafts when a sheet is not intended to be fed, as if a "fault" had occurred.

To produce the pattern of feeding, printing and collating illustrated at section VII on the chart of FIG. 140, the mechanism is set as called for in the chart, sheets of different type are loaded into feeders C and A only, and feeders C and A are turned "on". The reset selector switch (RSL) D-688 is set at 1. If a fault occurs on either feeder C or feeder A, both the reject gates D-455C and D-455A are opened and both sheets of the set are rejected, and the mechanism resets automatically for the next cycle of the feeders.

The pattern of feeding, collating and printing illustrated at section VIII on the chart of FIG. 140, is achieved in exactly the same way, with the mechanism set as called for on the chart, with sheets of different type loaded into feeders A and B only, with feeders A and B turned "on", and with the reset selector switch (RSL) D-688 set at 1. In this case, too, if either feeder B or feeder A faults, the reject gates D-455B and D-455A open, reject both sheets of the set, and the mechanism then resets automatically for the net cycle of the feeders.

To produce the cycle of feeding, printing and collating illustrated at section IX of the chart, the feeders are set as called for on the chart, sheets of different type are loaded into feeders A, B and C, and the three feeders A, B and C are turned "on". The reset selector switch (RSL) D-688 is set at 1. If a fault occurs on any one of the three feeders A, B or C, all three reject gates D-455A, D-455B and D-455C will open, and the entire set will be rejected. The mechanism will then reset automatically for the next cycle of the feeders.

It will be noted that in the case of the patterns illustrated in sections I, II, IV, V, VI, VII, VIII and IX, whenever a fault is detected, a complete set is rejected and the mechanism resets automatically and continues without interruption, while ensuring that only complete sets, without fault reach the receiving hopper. In the case of the pattern of feeding, printing and collating illustrated in section III, the fault is detected and a complete set is rejected. However, the feeding is thereupon interrupted, and it is necessary for the operator to restart the mechanism while making sure that the pattern in the receiving hopper remains in proper sequence, without fault.

The pattern shown in section III on the chart of FIG. 140 may also be produced by setting the feeders as called for under the pattern illustrated in section IX, except that, in this case, sheets of one type are placed in feeder A, and sheets of the other type are placed in both feeder B and feeder C. In this case, the pattern of sheets fed will be that shown under section III, but the setting will be as described for the pattern illustrated under section IX. In this case, faults will be detected and a complete set rejected and the mechanism automatically reset, and the operation will continue without interruption.

CYLINDER GRIPPERS AND CHAIN-CARRIED GRIPPERS

The press constructions shown in FIGS. 2*a*, 5*a* and 6, as illustrated diagrammatically in diagrams GG-3, GG-4 and GG-5, of FIG. 7*c*, and as illustrated in diagrams GG-7, GG-8 and GG-9 of FIG. 8*c*, employ a delivery mechanism which combines cylinder grippers of the type hereinbefore illustrated and described, with chain-carried delivery grippers, which are carried by chains that encircle the lower printing cylinder 20. The details of the manner in which the cylinder grippers and the chain-carried encircling grippers are constructed are best shown in FIGS. 148 through 152.

The two sets of grippers are constructed and controlled so that they may be used together cooperatively, or either set of grippers may be used separately, depending upon the particular press combination involved and the printing functions to be performed. The manner in which the cylinder grippers may be employed alone, either with stripper fingers or with a separate chain delivery mechanism, has been illustrated and described hereinbefore. In addition, the means by which the cylinder grippers and the grippers of a separate chain delivery mechanism would be controlled when a sheet is to be carried through the bite of the printing cylinders once, or more than once, has also been illustrated and described.

Delivery grippers carried by chains which encircle the lower printing cylinder 20 offer certain advantages when it is desired to deliver the sheets with their original bottom surface facing upwardly. The use of delivery grippers carried by encircling chains, in combination with cylinder grippers, makes it possible to employ the cylinder grippers to carry a sheet around the lower printing cylinder and through the bite between the printing cylinders more than once, while also making it possible to transfer the leading edge of the sheet from the bite of the cylinder grippers to the bite of the delivery grippers as the two pass simultaneously through an arc of travel of the lower printing cylinder, as opposed to making such transfer at the point of tangency between the lower printing cylinder and the sprockets of a separate chain delivery mechanism.

At high press speeds, a transfer from cylinder grippers to the grippers of a separate chain delivery mechanism at the point of tangency between the two must take place instantaneously as the cylinder grippers and the chain-carried grippers pass the point of tangency between the lower printing cylinder and the sprockets of the separate chain delivery mechanism. By comparison, at comparable press speeds, there is from ten to twenty times as much time available to accomplish the transfer of the leading edge of the sheet from cylinder grippers to delivery grippers carried by chains which encircle the lower printing cylinder, as the two sets of grippers move simultaneously through an arc about the lower printing cylinder.

As shown in FIGS. 148 and 148*a*, the construction of the cylinder grippers is generally similar to the cylinder grippers hereinbefore illustrated and described. A solid bar-like member G-72 is rigidly affixed to the leading edge of the lower printing cylinder 20, which carries an offset blanket 257 on its surface. Member G-72 is shaped to from the cylinder stops G-73, against which the sheets are registered, and the anvils G-74, against which the cylinder grippers G-76 bear, to hold the leading edge of a sheet. Bar member G-72 also includes the anvils G-78, against which the chain-carried delivery grippers bear, to seize the leading edge of a sheet. The cylinder gripper shaft G-71 is journalled in the member G-72, and also in the two sides of lower printing cylinder 20. Springs G-77 encircle the gripper shaft G-71 and bear against the member G-72 and against the individual gripper fingers G-76 to hold the gripper fingers against the anvils G-74, or against the leading edge of a sheet resting upon the anvils.

A stripper finger G-75 is provided to aid in ejecting the sheets when they are delivered, in the manner previously described.

The cylinder grippers open and close to receive a sheet, and open and close to release a sheet, in the manner previously illustrated and described. The rise in the cam 271 of FIG. 34 and 78, which causes the grippers to open and close to receive a sheet, is always positioned as previously illustrated, since sheets are always received from the feed roller and stop finger mechanism at the same position with respect to the lower printing cylinder 20. The rise in the cam 271, which controls the opening and closing of the cylinder grippers to release the sheet, is positioned in accordance with the point at which sheets are to be released. In the arrangement to be described, as shown in FIGS. 150, 150a and 152, in which cylinder grippers are used in combination with delivery grippers carried by chains which encircle lower printing cylinder 20, the cylinder grippers are caused to open to release a sheet at the bite between lower printing cylinder 20 and large printing cylinder 22.

The means for causing the cylinder grippers to release a sheet, after a single passage through the bite between the printing cylinders, or to carry the sheet around lower printing cylinder 20 and through the bite between the printing cylinders a second or third time, is the same as that hereinbefore illustrated and described.

As shown in FIGS. 149 and 149*a*, the delivery grippers are carried by chains which encircle lower printing cylinder 20. The encircling chain-carried delivery grippers are generally designated G-13. In the configuration illustrated, there are six such delivery grippers G-13 mounted on gripper shaft G-93, which is journalled in gripper bar G-92. Gripper bar G-92 is affixed at either end to an angular plate G-98, which in turn forms one link in each of the encircling chains G-14, and is supported by two pins G-101 and G-102 in each of these chains. Each of the chains G-14 engages a sprocket G-88 at either end of lower printing cylinder 20, and passes over another sprocket at equal pitch diameter, spaced from lower printing cylinder 20, as illustrated in FIGS. 2*a*, 5*a* and 6. The length of the encircling delivery chains, the number of delivery gripper bars carried thereby, and the spacing of the delivery gripper bars about the chains are as previously illustrated and described.

Each delivery gripper finger G-13 comprises a long finger G-85 mounted about the gripper shaft G-93. There is a pair of projecting stops G-87 at respectively opposite sides of the long gripper finger and projecting from the back thereof, which are in alignment with a ledge G-97 on the gripper bar G-92. There is a spring G-86 which wraps about the gripper shaft G-93 on either side of the gripper finger and bears at each end against the gripper bar G-92, and at the center across the top of the long gripper finger G-85. This spring acts to urge the long gripper finger G-85 in a clockwise direction, as shown in FIG. 149a. This causes the outer tip G-81 of the long gripper finger G-85 to bear against the anvil G-78, as the gripper passes about lower printing cylinder 20, and at other times rocks the gripper fingers slightly in a clockwise direction, until the projecting stop G-87 at the back of the finger contacts the ledge G-97 on the gripper bar G-92.

The forward nose portion G-81 of the long gripper G-85 is approximately three times as wide as the anvil G-78, on which it bears, and projects an equal distance on each side of the anvil. Just back from this nose portion G-81, there is a shaft G-94 journalled in the long gripper finger G-85, and projecting outwardly from each side thereof. On each of the projections of shaft G-94, a small gripper finger G-83 is journalled below the nose portion of the long gripper finger G-85. A spring G-82 encircles the shaft G-94 on each side of the long gripper finger G-85 and bears against it and against the bottom surface of each of the small gripper fingers G-83, thereby urging them into contact with the bottom surface of the nose portion G-81 of the long gripper finger G-85.

A flexible steel strap G-84 partially encircles the center of shaft G-94 and passes from the bottom of the shaft G-94 to the top of gripper shaft G-93. This flexible steel strap G-84 is secured at one end to gripper shaft G-93, which it partially encircles, and at the other end is secured to shaft G-94, which it also partially encircles. When gripper shaft G-93 is rocked in a counterclockwise direction, as shown in FIGS. 149*a* or 150*a*, flexible steel strap G-84 causes shaft G-94 together with small gripper fingers G-83, which are secured thereto, to be rocked in a clockwise direction against the action of spring G-82.

At each side of each gripper finger G-13, there are two pins G-91 secured in gripper shaft G-93. These pins G-91 are so located that, when gripper shaft G-93 is rocked in a counterclockwise direction, the gripper shaft G-93 first rocks within the long gripper finger G-85, but through the action of flexible strap G-84 causes the small gripper fingers G-83 to open downwardly away from the lower face of nose portion G-81. When the pins G-91 come in contact with the projecting stop portion G-87 at the back of the long gripper finger G-85, any further counterclockwise rotation of the gripper shaft G-93 lifts the long gripper finger G-85 out of contact with the anvil G-78.

The sprocket G-88 on the left-hand side, as shown in FIGS. 150a and 152, is cut out at G-103 to provide clearance for the gripper shaft G-93 to extend out beyond the sprocket to the left-hand side.

In FIGS. 150 and 150*a*, the cylinder grippers G-76 and the encircling chain-carried delivery gripper G-13 are illustrated in combination. FIG. 150 shows how the two sets of grippers interlace with each other and how they work together cooperatively with the cylinder stops G-73, the anvils G-74 for the cylinder grippers G-76, and the anvils G-78 for the delivery grippers G-13, all of which are part of the bar member G-72, which is rigidly affixed to lower printing cylinder 20.

In FIGS. 151 and 151*a*, the bar member G-72 which is rigidly affixed to the leading edge of lower printing cylinder 20 is shown in more detail. These two Figures illustrate the manner in which the cylinder gripper shaft G-71 is journalled in the bar member G-72, as well as in the side walls of lower printing cylinder 20. They also show the manner in which bar member G-72 is constructed to form the cylinder stops G-73, and the anvils G-74 for the cylinder grippers, and anvils G-78 for the delivery grippers. The ejector fingers G-75 are also shown, but, as previously pointed out, these are not used when the cylinder grippers are to be used in combination with delivery grippers, but only when the cylinder grippers are used alone, with stripper fingers to strip and deliver the sheets.

PROGRESSIVE OPERATION OF ENCIRCLING CHAIN-CARRIED GRIPPERS

FIG. 152 shows the essential elements of the delivery gripper fingers G-13 carried by the delivery gripper bar G-92 which is carried by the chains G-14 that encircle lower printing cylinder 20 on sprockets G-88. A cam G-104 is secured to the adjacent main frame 31 of the press by means of three studs, to which it is secured by means of three nuts G-105, G-106 and G-107. There is a cam-follower arm G-96 shown diagrammatically secured to the outer end of delivery gripper shaft G-93, and it in turn carries a cam-follower roller G-95 at its outer end. Cam-follower roller G-95 is in alignment with the face of cam G-104.

FIG. 152 illustrates the various positions assumed by the essential elements of the delivery grippers, the cylinder stops and the anvils; as the chain-carried grippers approach lower printing cylinder 20; as they are carried around the lower printing cylinder by the sprockets G-88; and as they move away from lower printing cylinder 20 with the chains G-14. The position of the delivery grippers G-13, the cam follower G-95, the cam-follower arm G-96, the delivery gripper shaft G-93, the long gripper finger G-85, the nose portion G-81 of the long gripper finger, the small gripper fingers G-83 and the shaft G-94 mounted in the long gripper finger G-85, about which the small grippers G-83 rock, are first shown at position 1 as they approach lower printing cylinder 20. The corresponding position of the bar G-72 affixed to the leading edge of lower printing cylinder 20 is also shown and labeled 1, together with cylinder stops G-73 and the anvils G-74 and G-78.

The corresponding position of the cylinder gripper shaft G-71 is also shown and labeled 1. Also shown and labeled 1 is the corresponding position of the cut-out G-103 in the near sprocket G-88, into which the delivery gripper shaft G-93 will move, and which allows the delivery gripper shaft G-93 to project outwardly through the near sprocket G-88 as it passes around lower printing cylinder 20. As lower printing cylinder 20 rotates in a counterclockwise direction, as shown in FIG. 152, the position of each of these elements is shown in fourteen successive positions, which are numbered consecutively from 1 through 14, and each of which represents an equal rotary progression of lower printing cylinder 20, as the delivery grippers G-13 approach the lower printing cylinder and then begin their passage around it.

If a sheet has been carried through the bite between the printing cylinders once, and is being carried around lower printing cylinder 20 by the cylinder grippers to complete another passage through the bite between the printing cylinders, the leading edge of such sheet will be in contact with cylinder stops G-73 and will be held securely in contact with the anvils G-74 by the cylinder grippers (not shown at 1 in FIG. 152), which interlace with the encircling chain delivery grippers, as described and illustrated in FIG. 150 and 150*a*.

If a previously printed sheet is held in the grip between the nose portion G-81 of the long delivery grippers G-85 and the small delivery grippers G-83 as the delivery grippers G-13 reach position 1 it will be released as the delivery grippers G-13 then move from position 1 to position 2. At position 1, the cam follower G-95 of the encircling delivery grippers G-13 first contacts the cam surface G-104. As delivery gripper shaft G-93 moves from position 1 to position 2, it is caused to turn in counterclockwise direction by the action of cam G-104 on cam follower G-95. Through the action of flexible strap G-84, this rotation is translated into clockwise rotation of shaft G-94, and the small delivery gripper fingers G-83 move with shaft G-94 in a clockwise direction. This causes the delivery grippers to open and release the sheet, which is then dropped onto the top of the delivery pile.

It will be noted that, as the delivery grippers G-13 move progressively from position 1 through positions 2-6 to position 7, the small gripper fingers G-83 continue to open and assume the successive attitudes shown at positions 1, 2, 3, 4, 5, 6, and 7. Similarly, the cylinder stops G-73 assume the positions shown at positions 1, 2, 3, 4, 5, 6 and 7.

It will be seen that if a sheet is being carried around lower printing cylinder 20 by the cylinder grippers, with its leading edge in contact with the cylinder stops G-73, between position 6 and position 7 the small gripper finger G-83 will move in ahead of the leading edge of such a sheet and assume a position behind it. The small gripper fingers G-83 will then remain in this relative position as the delivery grippers G-13 continue around lower printing cylinder 20. The nose portions G-81 of the long delivery grippers G-85 approach the anvils G-78 on which the leading edge of the sheet is being held, and, by position 11, the sheet is being held on the anvils G-78 by the nose portions G-81 of the long delivery grippers G-85, and against anvils G-74 by the cylinder grippers G-76, which are interlaced therewith, as shown in FIGS. 150 and 150*a*.

As lower printing cylinder 20 continues to rotate, it reaches a point forty-two degress before the bite between the lower printing cylinder 20 and the large printing cylinder 22, which is shown in FIG. 152 as −42°, and at this point the encircling delivery grippers have opened or lifted off the anvils G-78 as if to receive another sheet. However, in the case being described, there is a sheet being carried around lower printing cylinder 20 by the cylinder grippers G-76 and, therefore, they retain their grip on the leading edge of the sheet, controlled as previously illustrated and described in connection with FIGS. 79*a*, 80 and 81.

As lower printing cylinder 20 continues to rotate, the nose portion G-81 again comes to rest on the anvils G-78 at a point thirty degrees before the bite between the printing cylinders. This point is shown in FIG. 152 as −30°. Between this point and a point four degrees before the bite between the printing cylinders, which is indicated in FIG. 152 as −4°, the small grippers G-83 close and the leading edge of the sheet is seized between these small grippers G-83 and the nose portion G-81 of the long delivery grippers G-85. The encircling delivery grippers then maintain their hold on the leading edge of the sheet as they pass away from lower printing cylinder 20 and progress through positions 15, 16, 17, 18, and thereafter. Positions 15, 16, 17 and 18 show the manner in which the cylinder grippers G-76 open to release the leading edge of the sheet, together with the way in which the leading edge of the sheet clears the cylinder grippers G-76 and the cylinder stops G-73 at these positions.

On the next revolution of lower printing cylinder 20, the delivery grippers G-13 which are approaching lower printing cylinder 20 have been held open by securing the cam-follower arm G-96 in a position such that cam follower G-95 will be held out of contact with cam G-104 in the manner previously described. The encircling delivery grippers G-13 thus will pass around lower printing cylinder 20 and move away therefrom, with the small gripper fingers G-83 held in the wide open position, as seen at position 7, and thus will not interfere with the action of the cylinder grippers. The cylinder grippers will open and close to receive a sheet presented to them by the stop finger and upper and lower feed roll mechanism previously shown and described, advancing the sheet over paper support plate 66 at the proper time during the rotation of lower printing cylinder 20. The cylinder grippers them will remain closed as they carry the sheet through the bite between the printing cylinders, and they will retain their grip on the leading edge of the sheet and carry the sheet around lower printing cylinder 20. The delivery grippers G-13 which are held open as described will pass to the left with the chains G-14, without interfering with the cylinder grippers carrying the sheet around lower printing cylinder 20, since the small gripper fingers G-83 will be held in their wide open position.

As the leading edge of this sheet reaches position 1, an active set of cylinder grippers G-13 will be approaching lower printing cylinder 20, and the action described above will be repeated, with the sheet being carried away by the encircling delivery grippers when it is released by the cylinder grippers as the sheet passes through the bite between the cylinders for the second time.

Since, as previously described, the length of the delivery chains G-14 is a whole multiple of the circumference of the large printing cylinder, and since the number of delivery gripper bars is equal to the number of work areas on the large printing cylinder, or a whole multiple of the number of work areas on the large printing cylinder, any given set of delivery grippers G-13 in one of these gripper bars will always pass through the bite between the printing cylinders in coincidence with the same gap in the large printing cylinder, and preceding the same work area of the large printing cylinder. Therefore, each set of delivery grippers may either be left free to operate under control of cam G-104 when they are to carry a sheet away with them as they leave the bite between the printing cylinders, or may be locked open so tha they pass away from the bite between the printing cylinders without interfering with the cylinder grippers carrying the sheet around the lower printing cylinder 20 for another passage through the bite between the printing cylinders.

If all sheets are to be passed through the bite between the printing cylinders only once, then all of the delivery grippers G-13 in each of the encircling delivery gripper bars are left free to operate under control of cam G-104. Under these conditions, the sheets are fed by the stop finger and feed mechanism into the bite of both the cylinder grippers and the encircling delivery grippers at the point forty-two degress before the bite of the printing cylinders. The sheets are then released by the cylinder grippers and carried away by the encircling delivery grippers as the leading edge of the sheet passes through the bite between the printing cylinders, as hereinabove described.

In this case, the action of the grippers is the same, irrespective of whether a sheet is being fed to every revolution of lower printing cylinder 20, or to other than each revolution of the lower printing cylinder since, in either case, the sheets are to pass through the bite only once. The action of both the encircling delivery grippers and the cylinder grippers is the same on each revolution of lower printing cylinder 20, irrespective of whether a sheet has been fed to the cylinder stops.

On a press equipped with encircling chain delivery grippers only, sheets would be fed to the cylinder stops and seized by the encircling chain delivery grippers and carried away thereby, just as hereinabove described, but there would simply be no cylinder grippers, and thus, in this case, no ability to carry the sheet around lower printing cylinder 20 for an additional passage through the bite between the printing cylinders.

The case in which no encircling chain delivery grippers are provided, but only cylinder grippers, in combination, either with stripper fingers or with a separate chain delivery mechanism, has been illustrated and described elsewhere herein.

VERTICAL IMAGE ADJUSTMENTS ON THE 3R MODEL

FIGS. 153 and 154 illustrate the manner in which vertical image adjustments may be made on a 3R model press of the configuration seen in FIG. 119.

As seen in FIG. 119 there is a plate cylinder module mounted at module mounting position II and another plate cylinder module mounted at module mounting position IV. In FIGS. 153 and 154 only the plate cylinder mounted at module mounting position II is shown since the two plate cylinders and the means by which images are adjusted vertically on each are identical.

As seen most clearly in FIG. 154 large printing cylinder 3,022 which is mounted in rotational tangential relationship to lower printing cylinder 20 carries three removable segments mounted in its three work areas. A blanket segment F-3,042 is mounted in fixed position in work area VIII. This segment carries an offset blanket on its surface and is held in fixed position by mounting screws F-3,130. In each of work areas VII and IX a plate segment F-3,041 is mounted. Each of these segments carries an offset printing plate on its surface and each is held in position by mounting screws F-3,130. Each of these segments may be moved circumferentially to change the vertical position of an image carried thereon by loosening mounting screws F-3,130 at each side of the segment and then sliding the segment to the desired position throughout the length of slot F-3,131. When the desired position of vertical adjustment is achieved mounting screws F-3,130 are tightened.

The images carried on each of these two plates are transferred successively to an offset blanket carried in the single work area of lower printing cylinder 20 and thereafter printed onto the bottom of a sheet as it passes through the bite of the printing couple formed by large printing cylinder 3,022 and lower printing cylinder 20.

These two images may be brought into vertical registration with respect to each other moving one or both of these plate segments circumferentially about large printing cylinder 3,022 in the manner just described.

The plate cylinder A-11 shown in mounting position II, and the similar plate cylinder mounted at mounting position IV as shown in FIG. 119, each carry an offset printing plate and each print an image successively on the offset blanket carried on the segment mounted in work area VIII of large printing cylinder 3,022.

There are two large ring gears 3,040 and 3,041 secured to turn with large printing cylinder 3,022. Each of these gears 3,040 and 3,041 may be individually adjusted circumferentially with respect to large printing cylinder 3,022 and then secured thereto. Lower printing cylinder 20 is driven through an Oldham coupling 46 by a gear 45 which has a pitch diameter equal to the effective diameter of lower printing cylinder 20. Each of the large ring gears 3,040 and 3,041 has a pitch diameter equal to the effective diameter of large printing cylinder 3,022. Each of the plate cylinders A-11 is driven by a gear 62 which has a pitch diameter equal to the effective diameter of plate cylinder A-11. Each gear 62 is adjustably secured to a collar 57 which in turn drives a plate cylinder A-11 through an Oldham coupling 56.

Gear 45 which drives lower printing cylinder 20 is in alignment with and meshes with ring gear 3,041 on large printing cylinder 3,022. Each of the gears 62 for the plate cylinders A-11 is in alignment with and meshes with ring gear 3,040 on large printing cylinder 3,022.

The individual image on a plate carried by a plate cylinder such as the plate cylinder A-11 shown at mounting position II in FIG. 154 may be vertically adjusted by loosening the three bolts A-88 which secure gear 62 to collar 57. Plate cylinder A-11 may then by rotated to adjust the vertical position of an image on a plate carried thereby after which the bolts A-88 are tightened and the adjustment secured. The vertical image on any other plate cylinder mounted in any other one of the module mounting positions, as for instance the plate cylinder mounted in mounting position IV as seen in FIG. 119, may be similarly adjusted vertically to bring it into register with the image or images from the plate or plates on any other plate cylinder or cylinders.

The extent of the vertical image adjustment which may be accomplished in each case is limited by the length of the circumferential slots 79 in gear 62 through which bolts A-88 pass into threaded holes in collar 57.

Ring gear 3,041 rests against the face 3,379 of large printing cylinder 3,022 and is secured thereto by three shoulder bolts 3,367. Each of these shoulder bolts has a large shoulder portion 3,368 which bears against the outer face of gear 3,041 and it also has a smaller threaded portion 3,369 which passes through a circumferential slot 3,372 in the face of ring gear 3,041 and in turn is threaded into a threaded hole 3,373 in large printing cylinder 3,022.

If, after the images from the two plates on segments F-3,041 have been brought into register vertically with each other, in the manner previously described, it is then desired to vertically adjust the combined position of the two registered images as they appear on the bottom of sheets being printed, this may be accomplished, without disturbing the register of the two images to each other, by loosening the three shoulder bolts 3,367 and moving large printing cylinder 3,022 with respect to ring gear 3,041 to secure the desired positioning, after which shoulder bolts 3,367 are then tightened to secure the adjustment.

Ring gear 3,040 is secured in position by three bolts 3,374 each of which passes through a circumferential slot 3,376 in the ring gear 3,040 and then through a spacer collar 3,375 and then is threaded into a threaded hole 3,378 in large printing cylinder 3,022. There are also circumferential slots 3,371 in the face of ring gear 3,040 to accommodate the large shoulder portion 3,368 of the large shoulder bolts 3,367. In similar fashion there are also circumferential slots 3,377 in ring gear 3,041 to accommodate the spacer collars 3,375 through which the bolts 3,374 pass.

The spacer collars 3,375 are slightly longer than the thickness of ring gear 3,041 so that when bolts 3,374 are tightened the inner face of ring gear 3,040 is pressed against the outer face of the three spacer collars 3,375 and through them secured to the outer face 3,379 of large printing cylinder 3,022.

If, after the individual images from individual plates on the individual plate cylinders have been brought into register with each other, in the manner previously described, it is then desired to adjust the vertical position of these combined, registered images without disturbing their relationship to each other, this may be accomplished by loosening the three bolts 3,374 and rotating the ring gear 3,040, and with it the plate cylinders A-11, through the plate cylinder gears 62, until the desired vertical positioning has been obtained, after which the bolts 3,374 are tightened to secure the adjustment.

This will adjust the vertical position of all the images from the plate cylinders with respect to their combined, registered position on the top of the sheets and also with respect to the combined registered position of any images which are being printed on the bottom of the sheet, from plates mounted on plate segments on large printing cylinder 3,022 as previously described.

In this manner the combined, registered images printed on the top of the sheet may be brought into vertical adjustment with respect to the combined, registered images printed on the bottom of the sheet.

It should also be noted that if after this adjustment has been completed it is still desired to vertically adjust the combined vertical position of all the registered images on both sides of the sheet, without in any way disturbing their registration with respect to each other, this may be accomplished by loosening the three shoulder bolts 3,367, which then allows the two plate segments on large printing cylinder 3,022 and the plate cylinders A-11 in mounting positions II and IV to all be moved together to vertically ajust all of their previously registered images, upwardly or downwardly with respect to their combined registered position on the sheets being printed, without disturbing any of these interrelationships. The adjustment may then be secured by tightening the shoulder bolts 3,367.

It will thus be seen that, irrespective of how many plates are mounted on plate segments in work areas of large printing cylinder 3,022 and irrespective of how many plate cylinders are mounted in plate cylinder modules at the various module mounting positions, each image may be vertically adjusted individually to bring it into register with each other image. The combined, registered images being printed on either side of the sheet may then be registered as a unit, without interfering with their interrelationship, to position them with regard to their vertical position on the sheets being printed and/or with regard to the vertical position of the image or images being printed on the other side of the sheet. And finally all of the images being printed on both sides of the sheet, after being brough into register with each other, may have their vertical position on the sheets being printed adjusted without in any way distrubing their overall interrelationship.

As illustrated and described elsewhere herein there is a hole in the main frame through which a wrench may be inserted to tighten or loosen either the shoulder bolts 3,367 or the bolts 3,374 so that both ring gear 3,040 and ring gear 3,041 may be circumferentially adjusted independently of each other, and each without disturbing the adjustment of the other, from a position outside the frame of the press.

Similarly the bolts A-88 may be reached through a hole in the plate cylinder module frame so that this adjustment also may be made from a position outside the frames of the press.

While FIGS. 153 and 154 illustrate a model 3R press it will be apparent that the same method of making vertical image adjustments may be similarly applied to the model 2R press.

GENERAL SUMMARY

2R AND 3R PRESS MODELS

There has been disclosed a multi-purpose, sheet-fed press in which there is an especially constructed lower printing cylinder that may be assembled in an especially constructed frame in rotational, tangential relationship with an especially constructed large printing cylinder having two times the effective diameter of the lower printing cylinder, to form a printing couple with a printing bite therebetween, in what is referred to as the 2R model of the press. As has also been disclosed, the same specially constructed lower printing cylinder may be assembled into another especially constructed frame in rotational, tangential relationship to an especially constructed large printing cylinder having three times the effective diameter of the lower printing cylinder, to form a printing couple with a printing bite therebetween, in what is referred to as the 3R model of the press.

The periphery of the lower printing cylinder is divided into a single work area and a single gap and means are provided for mounting an offset blanket in the single work area of the lower printing cylinder.

The periphery of the large printing cylinder in the 2R model is divided into two work areas and two gaps and the periphery of the large printing cylinder in the 3R model is divided into three work areas and three gaps.

Specially constructed removable and interchangeable segments are provided for mounting in the work areas of the 2R model and specially constructed removable and interchangeable segments are provided for mounting in the work areas of the large printing cylinder in the 3R model. These, together with other means disclosed for mounting printing surfaces, provide means for mounting a wide variety of printing surfaces interchangeably in the work areas of the large printing cylinders on both the 2R model and 3R model. These printing surfaces include, but are not limited to, offset blankets, planographic lithographic printing plates, dry offset or letterset printing plates, embossing plates, letterpress printing plates of copper, zinc, or rubber, numbering machines, linotype slugs, etc.

In both the 2R and 3R models, means are provided for feeding sheets to and through the bite of the printing couple.

On the 2R model, means are provided for feeding a sheet to every revolution of the large printing cylinder and for carrying such a sheet through the bite once or twice. Means are also provided on the 2R model to feed two sheets to each revolution of the large printing cylinder and to carry each such sheet through the bite one time.

On the 3R model means are provided to feed one sheet to each revolution of the large printing and to carry such a sheet through the bite of the printing couple one time, two times, or three times. Means are also provided on the 3R model to feed two sheets to each revolution of the large printing cylinder and to carry one of them through the bite of the printing couple one time, or two times, and to carry the other sheet through the bite of the printing couple one time. Means are also provided on the 3R model for feeding three sheets to each revolution of the large printing cylinder and for carrying each of the three sheets through the bite one time.

The frames of the 2R model and of the 3R model are each especially constructed to receive and mount especially constructed printing modules at each of four module mounting positions.

Especially constructed printing modules are provided including:

A. Plate cylinder modules, each including a plate cylinder equal in effective diameter to the effective diameter of the specially constructed lower printing cylinder. The periphery of each such plate cylinder is divided into one work area and one gap, with the said work area being adapted to carry a printing plate. The plate cylinder module also includes means for applying ink to the surface of a plate carried on the plate cylinder and may also include dampening means for dampening the surface of such a plate. These specially constructed plate cylinder modules may be mounted at any of the module mounting positions of either the 2R press or the 3R press in assembling various configurations of either of the two models. When so mounted, each such plate cylinder is in rotational, tangetial relationship to the large printing cylinder and means are provided whereby each such plate cylinder may selectively be caused to roll in contact with each work area of the large printing cylinder or with selected ones of these work areas.

B. Specially constructed inking modules are provided, including ink form rollers and means of supplying ink to the ink form rollers. Each of these inking modules is so constructed that it may be mounted at selected ones of the module mounting stations on either the 2R model or 3R model press. When so mounted, the ink form rollers of the inking module are in rotational tangential relationship with the surfaces of the work areas of the large printing cylinder. Means are provided whereby the form rollers of an individual inking module may be selectively caused to roll in contact with each of the said work areas or with selected ones of said work areas. Means are provided for also supplying dampening solution to such surfaces as are inked by the ink form rollers, when desired.

C. An especially constructed dampening module is also provided which may be used to apply dampening solution only to the surface of selected work areas of the large printing cylinder.

These especially constructed components may then be assembled in a wide variety of combinations to produce various press models and in turn each of these press models may be operated in a manner to produce various different printing functions. A unique feature of each of these configurations lies in its efficiency, both with respect to the number and variety of different printing functions which may be accomplished and also, most importantly, in the efficiency of each configuration in terms of the number of images which may be applied to sheets passing through the bite of the printing couple on each revolution of the large printing cylinder.

While letterpress printing plates are by definition mirror image plates, offset or lithographic printing plates are most commonly right reading plates. One of the advantages of the offset lithographic printing process lies in the fact that right reading plates may be utilized. This not only makes such plates easy to check and proof read, but most importantly makes it possible to produce such right reading plates by a wide variety of plate making procedures, including writing, drawing and typewriting directly on the surface of such plates, as well as producing them from pre-existing originals in a wide variety of copying devices which are capable of producing such right reading offset printing plates, just as they produce right reading copies.

A few examples which illustrate the efficiencies of various configurations of the press are as follows:

THREE CYLINDER 2R PRESS

A three cylinder 2R press model may be produced by assembling a single plate cylinder module and an inking module onto a basic 2R frame structure, which includes a 2R large printing cylinder and a lower printing cylinder, which form a printing couple. An offset blanket is mounted in the single work area of the lower printing cylinder. A right reading offset plate is mounted in the single work area of the plate cylinder By mounting offset blankets in each of the work areas of the large printing cylinder and feeding two sheets through the bite on each revolution of the large printing cylinder, the image from the single right reading plate is printed onto one side of each of the sheets passing through the bite, with two images and two sheets being printed for each revolution of the large printing cylinder. In this case the rollers of the inking module are disengaged and are not used.

By replacing one of the offset blankets mounted in one of the work areas of the large printing cylinder with a second right reading offset late and adjusting the ink form rolls of the inking module to roll in contact with this plate only and then feeding one sheet once through the bite for each revolution of the large printing cylinder in the manner previously disclosed, two images will be printed simultaneously, on both sides of a single sheet which passes once through the bite on each revolution of the large printing cylinder.

By replacing the right reading offset plate mounted in one work area of the large printing cylinder with a letterpress plate and setting the ink form rolls of the inking module to roll in contact with the surface of this plate only and by setting the mechanism so that one sheet will be fed to each revolution of the large printing cylinder but carried through the bite of the printing couple two times in the manner previously disclosed, this sheet will then have two images printed on it, one by the offset process from the right reading offset plate on the plate cylinder and one image by the letterpress process directly from the mirror image letterpress plate mounted in one work area of the large printing cylinder, on a single revolution of the large printing cylinder.

The plate cylinder may then be disengaged from contact with the large printing cylinder and two, different, letterpress plates mounted in the two work areas of the large printing cylinder and the ink rollers of the ink module set to roll in contact with both these plates. By feeding a sheet once to each revolution of the large printing cylinder and allowing it to pass through the bite of the printing couple two times this sheet will have two letterpress images printed on one side as it passes through the bite of the printing couple two times, as the large printing cylinder makes a single revolution.

If it is desired that these two letterpress images be printed in different collors, an additional inking module may be added and the form rollers of the first inking module, carrying one color ink may be caused to roll only against the first letterpress plate while the form rollers of the second inking module, with another color ink, may be caused to roll in contact only with the second letterpress plate.

In either of the last two examples two sheets could be fed to each revolution of the large printing cylinder, instead of one, and each such sheet passed through the bite one time. In this case a set of two sheets, each bearing a different image, would be concurrently printed and collated for each revolution of the large printing cylinder.

In the last example these two sheets would each be printed by the letterpress process and in the preceeding example one would be printed by the letterpress process and the other by the offset process from a right reading plate.

THREE CYLINDER 3R PRESS

A similar three cylinder 3R model press, assembled by mounting a similar plate cy linder module on a 3R basic frame structure together with one or more inking modules, may similarly have an offset blanket carried in the single work area of the lower printing cylinder and a right reading offset printing plate carried in the single work area of the plate cylinder.

By disengaging the inking rollers of the ink modules from contact with the large printing cylinder and mounting three offset blankets in the three work areas of the large printing cylinder, three sheets may be fed to and through the bite of the printing couple on each revolution of the large printing cylinder with each such sheet having one image printed on one face thereof from the right reading offset plate, so that three sheets and three images are thus printed for each revolution of the large printing cylinder.

Two of the offset blankets carried in two of the work areas of the large printing cylinder may then be replaced by two separate right reading offset plates mounted in these two work areas of the large printing cylinder. These two plates may then be inked either by the ink rolls of a single inking module, which is set to roll in contact with each of them but not with the offset blanket in the third work area of the large printing cylinder, or each may be inked by the ink rollers of a separate inking module set to roll only in contact with the surface of that plate. Then by setting the feeding mechanism to feed one sheet to each revolution of the large printing cylinder and to carry that one sheet through the bite of the printing couple one time in the manner previously disclosed, that sheet will have one image from the right reading offset plate on the palte cylinder printed on one side and two images from the two right reading offset plates mounted in two work areas of the large printing cylinder simultaneously printed on the other side as it passes one time through the bite.

By removing the two right reading offset plates mounted in two work areas of the large printing cylinder and mounting a letterpress plate in one of these areas, a sheet may be fed to each revolution of the large printing cylinder and carried through the bite two times, thus having one image printed on one surface thereof by the offset process from the right reading offset plate on the plate cylinder and one image by the letterpress process directly from the mirror image letterpress plate mounted in a work area of the large printing cylinder.

By adding a second letterpress plate in the third work area of the large printing cylinder and disengaging the plate cylinder, a sheet fed to each revolution of the large printing cylinder and carried through the bite two times will have two letterpress images printed on one surface thereof for each revolution of the large printing cylinder.

In either of the last two examples two sheets may be fed to each revolution of the large printing cylinder and each carried through the bite one time. In this instance a set of two sheets will be concurrently printed and collated on each revolution of the large printing cylinder.

By re-engaging the plate cylinder, a sheet fed to each revolution of the large printing cylinder and carried through the bite three times, will have one image printed thereon from the right reading offset plate on the plate cylinder and two images printed thereon by the letterpress process directly from the two mirror image letterpress plates mounted in the two areas of the large printing cylinder.

Also, the plate cylinder may be disengaged and a third letterpress plate mounted in the third work area of the large printing cylinder so that there are letterpress plates mounted in each of the three work areas of the large printing cylinder. In this case, a sheet fed once to each revolutin of the large printing cylinder and carried through the bite three times will have three letterpress images printed thereon. As indicated previously, these three letterpress plates may all be inked from a single inking module and in this case will all be printed in the same color ink, or three ink modules may be employed with each set to roll in contact with only one of the three letterpress plates, in which case the three letterpress images will be in three different colors.

In either of the last two examples three sheets may be fed to each revolution of the large printing cylinder and each carried through the bite one time. In this instance a set of three sheets will be concurrently printed and collated on each revolution of the large printing cylinder.

FOUR CYLINDER 2R PRESS

A four cylinder 2R press may be assembled by adding an additional plate cylinder module to the configuration described above with respect to the three cylinder 2R press. In this configuration, offset blankets may ber mounted in both of the work areas of the large printing cylinder and right reading offset plates mounted on both of the plate cylinders.

By allowing both plate cylinders to roll in contact with both of the offset blankets on the large printing cylinder and by feeding two sheets to each revolution of the large printing cylinder, two images are thus printed on each of two sheets, or a total of four images, for each revolution of the large printing cylinder.

By setting one plate cylinder to roll in contact with only one work of the large printing cylinder and the other plate cylinder to roll in contact with only the other work area of the large printing cylinder and continuing to feed two sheets to each revolution of the large printing cylinder, two sheets with two different images will thus be concurrently printed and collated for each revolution of the large printing cylinder.

If one plate cylinder is allowed to roll in contact with only one work area of the large printing cylinder and the other plate cylinder allowed to roll in contact with only the other work area of the large printing cylinder, and if a single sheet is fed to each revolution of the large printing cylinder and carried through the bite of the printing couple two imes, this sheet will have two images from separate blankets printed on it for each revolution of the large printing cylinder.

If one of the blankets mounted in one of the work areas of the large printing cylinder is then replaced by a right reading offset printing plate and the ink rollers of an ink module are allowed to roll in contact only with the surface of that work area of the large printing cylinder, and the two right reading offset plates mounted on the two plate cylinders are allowed to roll in contact only with the other work area of the large printing cylinder, on which an offset blanket is mounted, a sheet fed once to each revolution of the large printing cylinder and passing through the bite only once, will be printed simultaneously with two images from the right reading offset plates on the plate cylinders on one side and with one image from the right reading offset plate in a work area of the large printing cylinder on the other side, for each revolution of the large printing cylinder.

By replacing the right reading offset plate in one work area of the large printing cylinder with a letterpress printing plate and causing a sheet fed once to each revolution of the large printing cylinder to be carried through the bite of the printing couple two times, this sheet may be printed with two images from the right reading offset plates on the plate cylinders via the blanket in one work area of the large printing cylinder and with the letterpress image from the mirror image letterpress plate mounted in the other work area of the large printing cylinder, as it passes through the bite of the printing couple two times on the single revolution of the large printing cylinder.

If, instead, two sheets are fed to each revolution of the large printing cylinder, with each sheet passing through the bite of the printing couple one time, these two sheets will be concurrently printed and collated, with one sheet being printed with the two images from the right reading offset plates on the plate cylinders and the other sheet being printed with the single letterpress image from the letterpress plate in one work area of the large printing cylinder.

If the plate cylinders are then disengaged and two letterpress plates are mounted in the two work areas of the large printing cylinder, a single sheet fed to one revolution of the large printing cylinder and carried through the bite two times will be printed on one side with two letterpress images from the two mirror image letterpress plates in the two work areas of the large printing cylinder as the large printing cylinder makes a single revolution.

If, instead, two sheets are fed to each revolution of the large printing cylinder with each sheet passing through the bite one time, these two sheets will be concurrently printed and collated with each bearing a different image from a different one of the two letterpress plates mounted in the two work areas of the large printing cylinder, on each revolution of the large printing cylinder.

FOUR CYLINDER 3R PRESS

By adding an additional plate cylinder module to the 3R configuration, as described above with respect to the three cylinder 3R press, a four cylinder 3R model press is thus assembled.

When this configuration is equipped with an offset blanket mounted in the single work area of the lower printing cylinder, three offset blankets mounted in the three work areas of the large printing cylinder and right reading offset printing plates mounted in the single work areas of the two plate cylinders, if each of the two plate cylinders is then set to roll in contact with each of the work areas of the large printing cylinder and three sheets are fed to each revolution of the large printing cylinder, with each sheet passing through the bite once, each of these three sheets has the two images from the two right reading offset plates on the plate cylinders printed onto one side thereof, so that a total of six images are thus printed for each revolution of the large printing cylinder.

If each of the plate cylinders is set to roll in contact only with a single different work area of the large printing cylinder and one sheet is fed to each revolution of the large printing cylinder and carried through the bite two times, this one sheet will have two images from right reading offset plates printed on it from separate blankets on each revolution of the large printing cylinder.

If two of the offset blankets mounted in two of the work areas of the large printing cylinder are then replaced with two right reading offset printing plates and each inked by the same, or by separate, inking modules, a sheet fed once to each revolution of the large printing cylinder and passed through the bite one time, will have the two images from the right reading offset plates on the two plate cylinders printed on one surface thereof from a single blanket, while simultaneously having the two images from the two right reading offset plates mounted in work areas of the large printing cylinder, printed on the other surface thereof from the single blanket on the lower printing cylinder.

By placing offset blankets in two of the work areas of the large printing cylinder and a letterpress plate in the third work area of the large printing cylinder, and setting one of the plate cylinders to roll in contact with only one of the work areas of the large printing cylinder which carries an offset blanket and setting the other plate cylinder to roll in contact with only the other work area of the large printing cylinder which carries an offset blanket, and setting the ink rollers of an ink module to roll in contact with only the surface of the letterpress plate in the third work area of the large cylinder, one sheet may then be fed to each revolution of the large printing cylinder and carried through the bite three times, and such sheet will then have two images printed on it, from separate blankets, from the right reading offset plates on the plate cylinders and a third image printed directly from the mirror image letterpress plate in the third work area of the large printing cylinder, on a single revolution of the large printing cylinder.

If the arrangement of plates and blankets is left as just described, and three sheets are fed to each revolution of the large printing cylinder with each sheet passing through the bite one time, then for each revolution of the large printing cylinder, three sheets will be printed and concurrently collated, with two of the sheets bearing images from the right reading offset plates on the plate cylinders and the third bearing image from the letterpress plate in one work area of the large printing cylinder.

If an offset blanket is mounted in one work area of the large printing cylinder and two letterpress plates are mounted in the other two work areas of the large printing cylinder, the two plate cylinders may be set to roll in contact with the single offset blanket in one work area of the large printing cylinder and the ink rollers of one or more ink modules may be set to roll in contact with the surfaces of the letterpress plates mounted in the other two work areas of the large printing cylinder. A sheet fed to each revolution of the large printing cylinder and carried through the bite three times will then have two images printed on it by the offset process from a single blanket, from the right reading offset plates on the plate cylinders, and two letterpress images from the two letterpress plates mounted in the other two work areas of the large printing cylinder.

If, on the other hand, three sheets are fed to each revolution of the large printing cylinder, with each sheet passing through the bite one time, one sheet will have two images printed on it by the offset process from the right reading offset plates on the plate cylinders, a second sheet will have one of the letterpress images printed on it and the third sheet will have the other letterpress image printed on it, thus producing a set of three concurrently printed and collated sheets on each revolution of the large printing cylinder.

And also this configuration may have three letterpress plates mounted in the three work areas of the large printing cylinder and in this case a single sheet fed to each revolution of the large printing cylinder, and carried through the bite three times, will have three letterpress images printed on it.

If three sheets are fed to each revolution of the large printing cylinder and each sheet passes through the bite one time, there will be a set of three sheets concurrently printed and collated, each bearing a separate image from a separate letterpress plate for each revolution of the large printing cylinder.

FIVE CYLINDER 2R PRESS

By adding a third plate cylinder module to the configuration of the 2R model press as described above in connection with the four cylinder 2R press, a five cylinder 2R model press is thus assembled.

With this configuration with two offset blankets mounted in the two work areas of the large printing cylinder and with three right reading offset plates mounted on the three plate cylinders, if the three plate cylinders are each set to roll in contact with each of the work areas of the large printing cylinder and if two sheets are fed to each revolution of the large printing cylinder, with each sheet passing through the bite one time, each of the two sheets will have three images printed on it from the three right reading offset plates, so that for each revolution of the large printing cylinder two such sheets are printed with three images each, or a total of six images are thus printed.

If two of the plate cylinders are set to roll in contact with only one of the work areas of the large printing cylinder and the other plate cylinder is set to roll in contact with only the other work area of the large printing cylinder, then if one sheet is fed for each revolution of the large printing cylinder and is carried through the bite two times, that sheet will have printed on it by the offset process, two images from one blanket from the first two right reading offset plates mounted on the first two plate cylinders, and a third image from the third right reading offset plate on the third plate cylinder which will be printed onto the sheet from a separate blanket, and these three images will be printed in a single revolution of the large printing cylinder. If, on the other hand, two sheets are fed for each revolution of the large printing cylinder, each passing through the bite one time, a set of two sheets will be printed and concurrently collated with one sheet bearing two images printed from right reading offset plates and the other sheet bearing a third image from a right reading offset plate, with the three images having been printed onto the two sheets which were concurrently printed and collated in a single revolution of the large printing cylinder.

If one of the offset blankets in one of the work areas of the large printing cylinder is replaced with a right reading offset plate, which is then inked by the ink rollers of an inking module which are set to roll in contact with only the surface of that plate and if the three plate cylinders are set to roll in contact with only the offset blanket mounted in the other work areas of the large printing cylinder and if a single sheet is fed to each revolution of the large printing cylinder and passes through the bite one time, this sheet will be simultaneously printed with three images from right reading offset plates on one side and one image from a right reading offset plate on the other side, on a single revolution of the large printing cylinder.

If the right reading offset plate mounted in one work area of the large printing cylinder is then replaced with a letterpress plate mounted in this same work area of the large printing cylinder and if a sheet is fed to each revolution of the large printing cylinder and carried through the bite two times, this single sheet will have three images printed on it by the offset process from three right reading offset plates via a single blanket and one image printed directly on it from a mirror image letterpress plate, on a single revolution of the large printing cylinder.

And also, if the plates and blankets are left as described above, but two sheets are fed for each revolution of the large printing cylinder and each sheet passes through the bite one time, a set of two sheets will be concurrently printed and collated for each revolution of the large printing cylinder, with one sheet bearing three images, printed from right reading offset plates by the offset process and the other sheet bearing a single image printed by the letterpress process.

FIVE CYLINDER 3R PRESS

If a third plate cylinder module is added to the 3R model press as described above in reference to the four cylinder 3R press, there will thus be assembled a five cylinder 3R model press.

If there are offset blankets mounted in each of the three work areas of the large printing cylinder and right reading offset plates mounted on each of the three plate cylinders, and each of the three plate cylinders is set to roll in contact with each of the work areas of the large printing cylinder, then if three sheets are fed for each revolution of the large printing cylinder and each sheet passes through the bite one time, each of these sheets will have three images printed on it by the offset process from right reading plates and a total of three sheets and nine images will have been printed for each revolution of the large printing cylinder.

If each of the three plate cylinders is set to roll in contact with only a different one of the three work areas of the large printing cylinder and if only one sheet is fed to each revolution of the large printing cylinder and that sheet is carried through the bite three times, that sheet will then have printed on it three separate images from three separate blankets, each by the offset process from right reading plates, on a single revolution of the large printing cylinder.

If two of the offset blankets, mounted in two of the work areas of the large printing cylinder, are then replaced with right reading offset plates and both are inked by the ink rollers of an inking module, whereas the three plate cylinders are set to roll in contact with only the other work areas of the large printing cylinder on which an offset blanket is mounted, and if one sheet is fed to each revolution of the large printing cylinder and passes through the bite one time, that sheet will have printed on it simultaneously, three images from right reading offset plates on one side and two images from right reading offset plates on the other side on a single revolution of the large printing cylinder.

If offset blankets are mounted in the three work areas of the large printing cylinder and each of the three plate cylinders is set to roll in contact only with a different one of the three work areas of the large printing cylinder, and if three sheets are fed to each revolution of the large printing cylinder, and each sheet passes through the bite one time three sheets will be concurrently printed and collated for each revolution of the large printing cylinder, with each sheet bearing a different image printed from a different right reading offset plate.

if one letterpress plate is mounted in one work area of the large printing cylinder, and offset blankets are mounted in the other two work areas of the large printing cylinder, and if two of the plate cylinders are set to roll in contact with only one of the work areas of the large printing cylinder which carries an offset blanket and the other plate cylinder is set to roll in contact with only the other work area of the large printing cylinder which carries an offset blanket and if one sheet is fed to each revolution of the large printing cylinder and that sheet passed through the bite three times, it will then have printed on it two images from a single blanket by the offset process, one image from a separate blanket by the offset process, all from right reading plates, and a fourth image directly from a mirror image letterpress plate, with these images being printed on each revolution of the large printing cylinder.

If instead, three sheets are fed to each revolution of the large printing cylinder and each sheet passes through the bite one time, the three sheets will be concurrently printed and collated, with one of the sheets bearing two images printed from right reading offset plates, with another sheet bearing one image printed from a right reading offset plate, and with the third sheet bearing an image printed from a mirror image letterpress plate.

If two letterpress plates are mounted in two of the work areas of the large printing cylinder and an offset blanket is mounted in the third work area of the large printing cylinder, and the three plate cylinders set to roll in contact with only the one work area of the large printing cylinder which carries an offset blanket, while the ink rollers of an inking module are set to roll in contact with the surfaces of the two letterpress plates, if one sheet is then fed to each revolution of the large printing cylinder and passed through the bite three times, it will have printed on it three images from right reading off-set plates from a single blanket and two images from a letterpress plate, all for each revolution of the large printing cylinder.

And also, if with this same set up three sheets are fed to each revolution of the large printing cylinder, and each sheet passes through the bite one time these three sheets will be concurrently printed and collated with one sheet bearing three images printed from right reading offset plates and the other two sheets bearing images printed from different letterpress plates, with the three sheets being printed and concurrently collated in a single revolution of the large printing cylinder.

While these examples are only representative of the many combinations which can be created from the specially constructed cylinders, frames, modules and components, they illustrate the efficiency which can be obtained, both in terms of the variety of functions that can be produced from any given combination and, most importantly, they illustrate the efficiency which can be obtained in terms of the numbers of images printed for each revolution of the large printing cylinder with each of these configurations.

From the foregoing, it will be seen that there has been provided a sheet-fed, high-production, multi-purpose printing press constructed from a group or groups, of especially constructed cylinders, frames, components and printing modules which may be assembled in a wide variety of combinations of such cylinders, frames, components and modules to produce various printing press configurations, either simple or complex, to perform a wide variety of printing functions with a high degree of efficiency, or combinations of printing functions including concurrent printing and collating, and also including feeder mechanism and delivery mechanism, together with highly efficient control mechanism, whereby maximum utilization of the various press configurations may be realized, producing a wide variety of structurally related printing presses having diverse printing capabilities selectively assembled from a wide variety of combinations of these especially constructed elements.

The embodiments in which an exclusive property or privilege is claimed are defined as follows:

1. In a printing press having a rotating shaft for supporting a print cylinder;

at least a first and a second cam, spaced longitudinally on said shaft and extending radially outward thereof for controlling functions of said printing press upon rotation of said shaft, said first cam including a first and a second slot means spaced radially outwardly of said shaft, said second cam including a first and a second slot means spaced radially outwardly of said shaft; and means for securing each cam to rotate with said shaft, yet permitting selective circumferential adjustment of the position of each cam on said shaft independent of each other cam on said shaft;

said securing means including a radial disk mounted to rotate with said shaft and positioned on one side of said first cam facing away from said second cam, first fastener means extending through said first slot means of both of said first and second cams for securing said first cam in a selected circumferential position to rotate with said disk, second fastener means extending through said second slot means of both said first and second cams for securing said second cam in a selected circumferential position to rotate with said disk, said second fastener means including a spacer extending through said second slot means of said first cam for maintaining said second cam in longitudinally spaced relation to said first cam on said shaft, and both said first and second fastener means including means for loosening or tightening the same accessible from one side of said second cam facing away from said first cam.

2. The printing press of claim 1 wherein;

said first fastener means includes a plurality of separate elongated first fasteners extending parallel to said shaft and positioned on radial planes spaced equilaterally around the shaft, said first slot means comprising a plurality of circumferentially spaced arcuately shaped first slots, one for receiving each of said elongated first fasteners, said second fastener means includes a plurality of separate elongated second fasteners extending parallel to said shaft and positioned on radial planes spaced equilaterally around the shaft, said second slot means comprising a plurality of circumferentially spaced arcuately shaped second slots, one for receiving each of said elongated second fasteners, said arcuate first and second slots having a length in a circumferential direction greater than the circumferential dimension of said respective first and second elongated fasteners for permitting limited selective adjustment of the rotative position of said bins and second cams independent of each other on said shaft when said first and second elongated fasteners are loosened to permit said selective position adjustment of their respective cams.

3. The printing press of claim 2 wherein;

said radial planes of said elongated first fasteners and second fasteners are in alternate order around said shaft.

4. The printing press of claim 3 wherein;

said elongated first and second fasteners are spaced radially outward of said shaft by a common radius.

5. The printing press of claim 2 wherein;

said first arcuate slots in said second cam are of a radial width greater than the adjacent radial dimension of said first elongated fasteners, and said second arcuate slots in said first cam are of a radial width greater than the adjacent radial dimension of said spacers on said second elongated rasteners, whereby one of said cams may be adjusted to a selected rotative position on said shaft when its respective elongated fasteners are loosened while the respective elongated fasteners of the other cam are in a tight condition.

6. The printing press of claim 1 wherein;

said second fastener means includes at least one elongated second fastener having a headed outer end portion and a threaded shank extending through a central bore of said spacer, said disk including at least one threaded aperture for threadedly receiving an inner end portion of said threaded shank, said spacer having opposite end surfaces adapted for engagement with adjacent faces of said disk and said second cam for maintaining spaced relationship longitudinally of said shaft between said first and second cam when said second fastener is tightened in threaded engagement with said disk, and said headed outer end portion including a face adapted to engage an outer face of said second cam to retain said second cam gear in selected rotative position on said shaft when said second fastener is tightened in threaded engagement with said disk.

7. The printing press of claim 6 wherein;

said shank of said second fastener is dimensioned to pass through said second slot means in said first and second cam, and said spacer is dimensioned to pass through said second slot means in said first cam.

8. The printing press of claim 1 wherein;

said first fastener means includes at least one elongated first fastener having a headed outer end portion and a threaded shank, and said disk including at least one threaded aperture for threadedly receiving an inner end portion of said threaded shank.

9. The printing press of claim 8 wherein;

said headed outer end portion of said first fastener is dimensioned to pass through said first slot means in said second cam, said shank is dimensioned to pass through said first slot means in said first cam, and said headed outer end portion includes a face adapted to engage an outer face of said first cam/gear to retain said first cam in selected rotative position when said first fastener is tightened in threaded engagement with said disk.

10. The printing press of claim 1 including;

a third cam spaced longitudinally on said shaft intermediate said first and second cams and extending radially outward of said shaft for controlling a function of said printing press upon rotation of said shaft;

said first, second and third cams including third slot means spaced radially outwardly of said shaft;

said third cam including said first and second slot means;

said means for securing each cam to rotate with said shaft additionally including, third fastener means extending through said third slot means of said first, second and third cams for securing said third cam in a selected circumferential position to rotate with said disk, said third fastener means including a spacer extending through said third slot of said first cam for maintaining said third cam in spaced relation between said first and second cams longitudinally on said shaft.

* * * * *